US007243513B2

(12) United States Patent
Kohlman et al.

(10) Patent No.: US 7,243,513 B2
(45) Date of Patent: Jul. 17, 2007

(54) PATTERNED TEXTILE PRODUCT

(75) Inventors: Randolph S. Kohlman, Boiling Springs, SC (US); William H. Stewart, Campobello, SC (US); Daniel T. McBride, Chesnee, SC (US); Peter K. Kang, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 87 days.

(21) Appl. No.: 10/755,561

(22) Filed: Jan. 12, 2004

(65) Prior Publication Data

US 2005/0106355 A1 May 19, 2005

Related U.S. Application Data

(60) Provisional application No. 60/454,565, filed on Mar. 14, 2003, provisional application No. 60/440,056, filed on Jan. 14, 2003.

(51) Int. Cl.
*D06B 3/10* (2006.01)

(52) U.S. Cl. ..... 68/205 R; 8/151

(58) Field of Classification Search ..... 68/205 R; 8/151

See application file for complete search history.

(56) References Cited

U.S. PATENT DOCUMENTS

| | | | | | |
|---|---|---|---|---|---|
| 2,690,118 | A | | 9/1954 | Schwartz | |
| 3,937,045 | A | * | 2/1976 | Klein et al. | 68/205 R |
| 4,033,154 | A | * | 7/1977 | Johnson | 68/205 R |
| 4,034,584 | A | * | 7/1977 | Klein et al. | 68/205 R |
| 4,084,615 | A | * | 4/1978 | Klein et al. | 137/624.11 |
| 4,170,883 | A | * | 10/1979 | Varner | 68/205 R |
| 4,578,965 | A | | 4/1986 | Brossman | 68/205 |
| 4,923,743 | A | * | 5/1990 | Stewart, Jr. | 427/288 |
| 5,161,395 | A | * | 11/1992 | Wethington | 68/205 R |
| 5,303,441 | A | * | 4/1994 | Dawson et al. | 8/151 |
| 5,318,065 | A | * | 6/1994 | Edwards et al. | 137/624.2 |
| 2002/0034607 | A1 | | 3/2002 | Stoyles | 428/95 |
| 2002/0136855 | A1 | | 9/2002 | Daniel et al. | 428/44 |

FOREIGN PATENT DOCUMENTS

| | | | |
|---|---|---|---|
| GB | 2 040 230 | * | 8/1980 |
| JP | 56-87/454 | * | 7/1981 |
| JP | 2-64567 | * | 3/1991 |

* cited by examiner

*Primary Examiner*—Frankie L. Stinson
(74) *Attorney, Agent, or Firm*—Terry T. Moyer; George M. Fisher

(57) ABSTRACT

A textile substrate is patterned by the selective application of various dyes to the substrate surface in a way that provides desirable, visually apparent enhancements in the area of pattern detail, definition, and color range, through the use of a novel patterning system, including the application of various chemical agents, that makes such enhancements possible. In one embodiment, the patterning system described herein is capable of producing pile-faced textile substrates, useful as floor coverings, that exhibit a unique combination of desirable pattern attributes that have been identified and measured using novel techniques specifically developed for these substrates and pattern attributes.

8 Claims, 254 Drawing Sheets

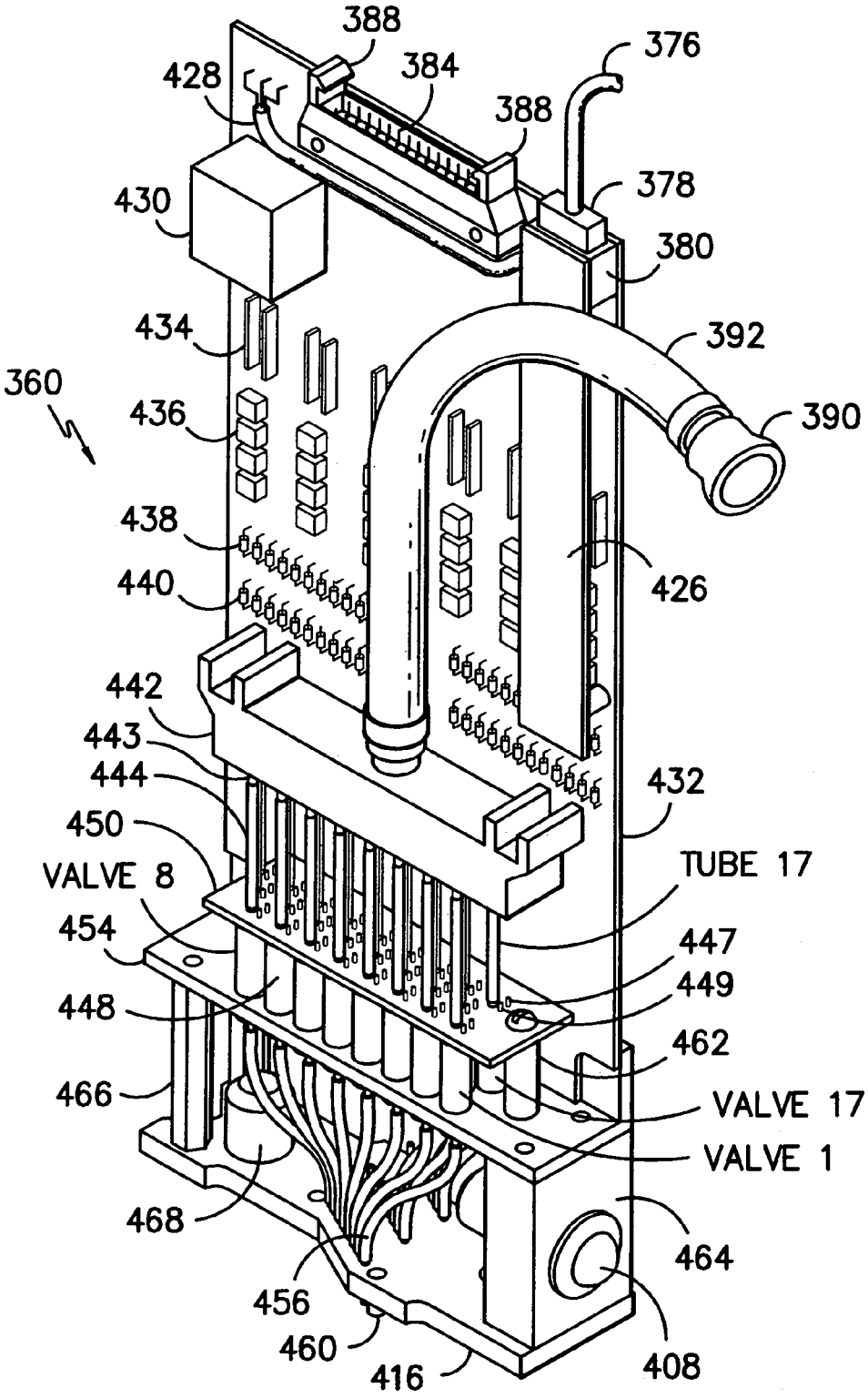
*FIG. —9—*

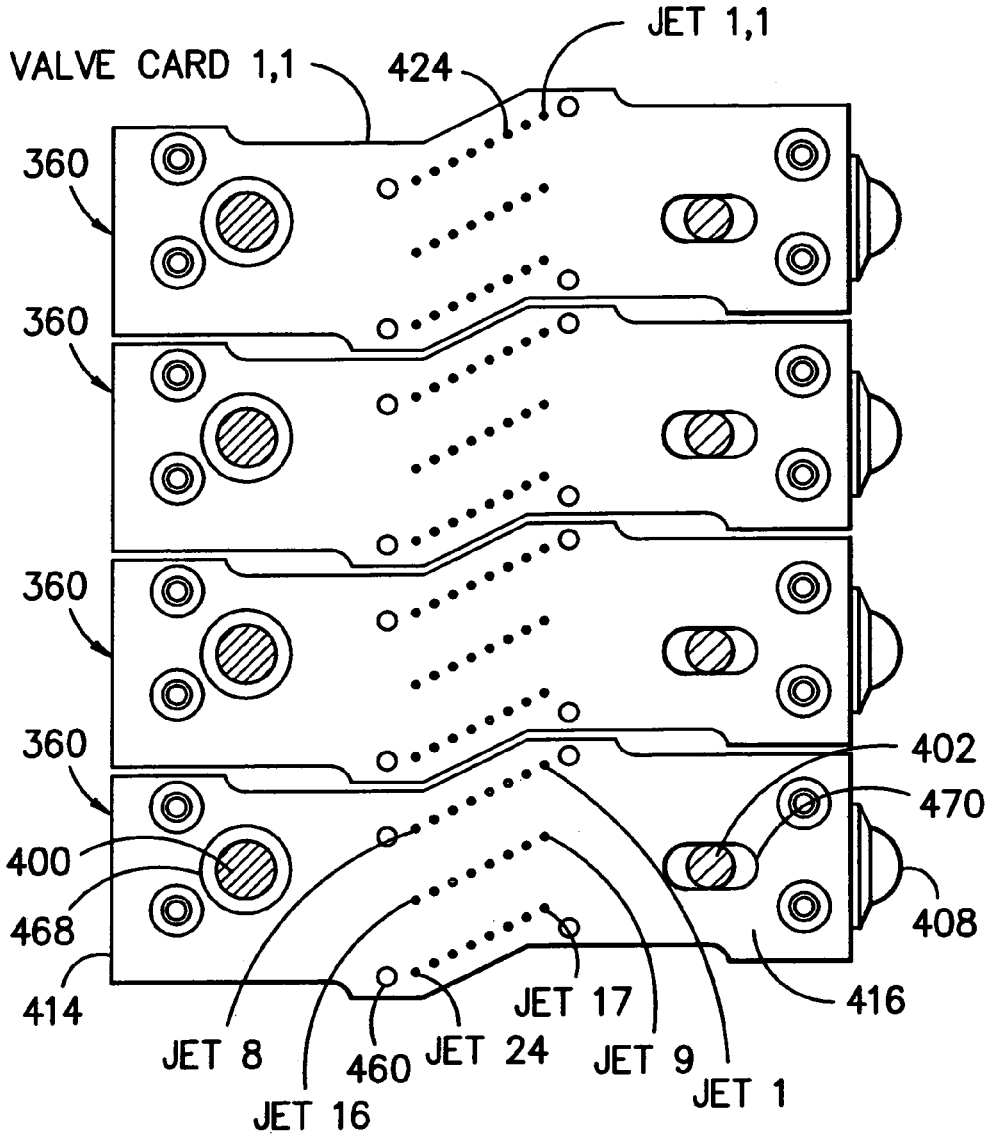
*FIG. —10—*

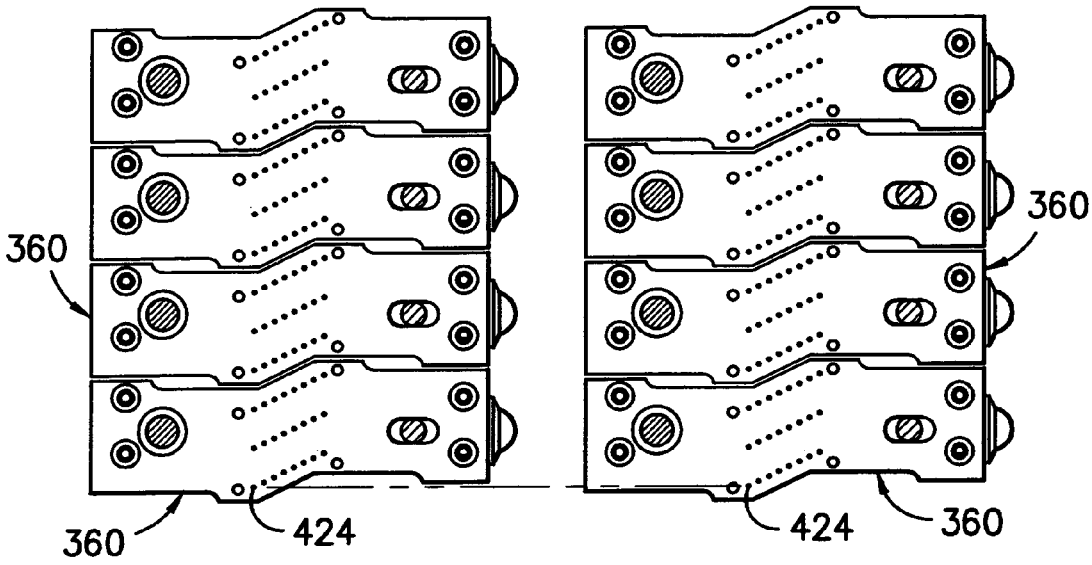
FIG. –11–
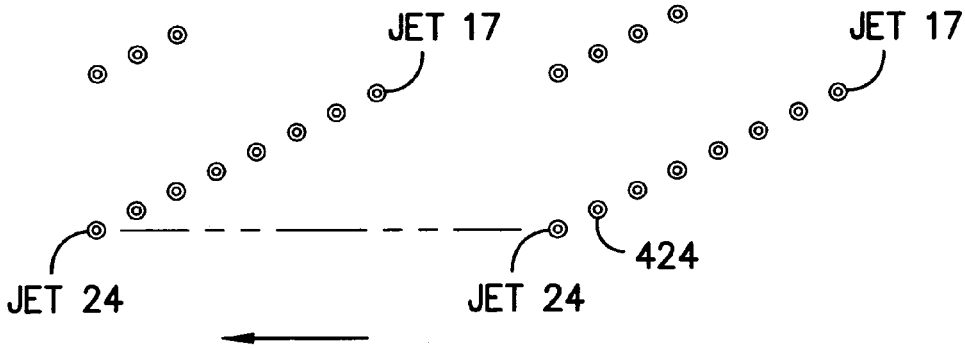
FIG. –11A–

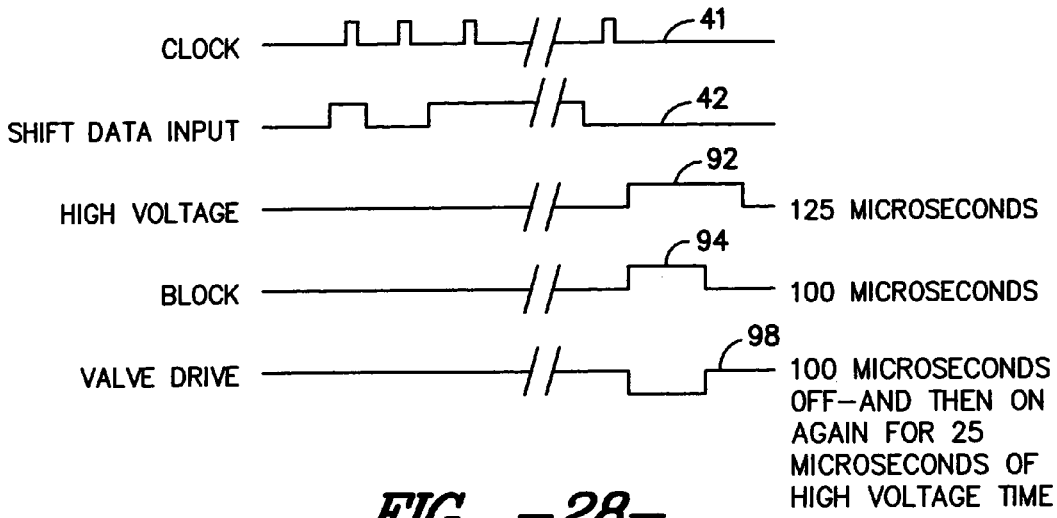
*FIG. –28–*
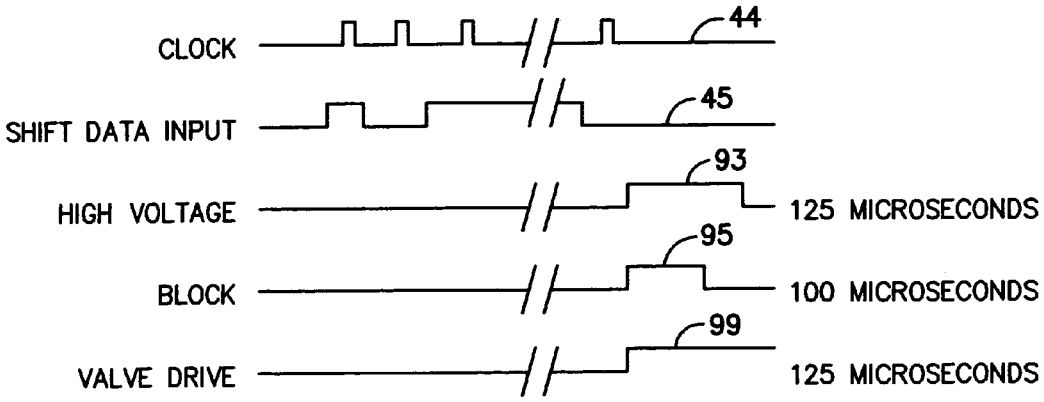
*FIG. –29–*

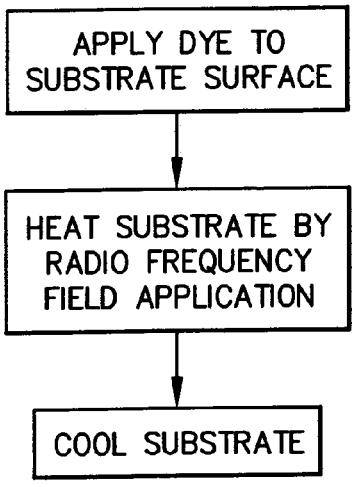
*FIG. –32–*
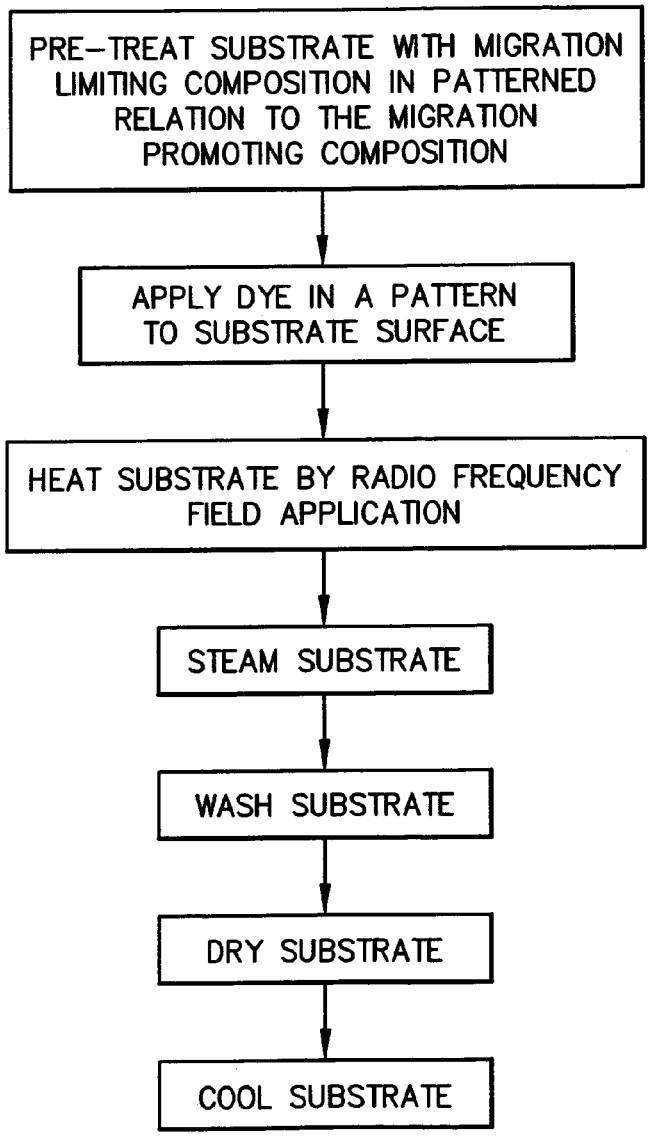
*FIG. –33–*

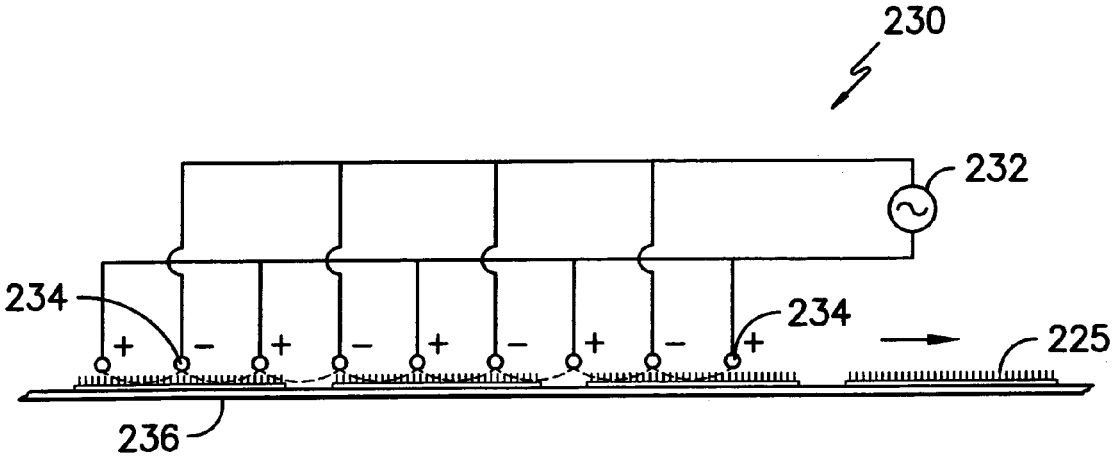
FIG. −34−
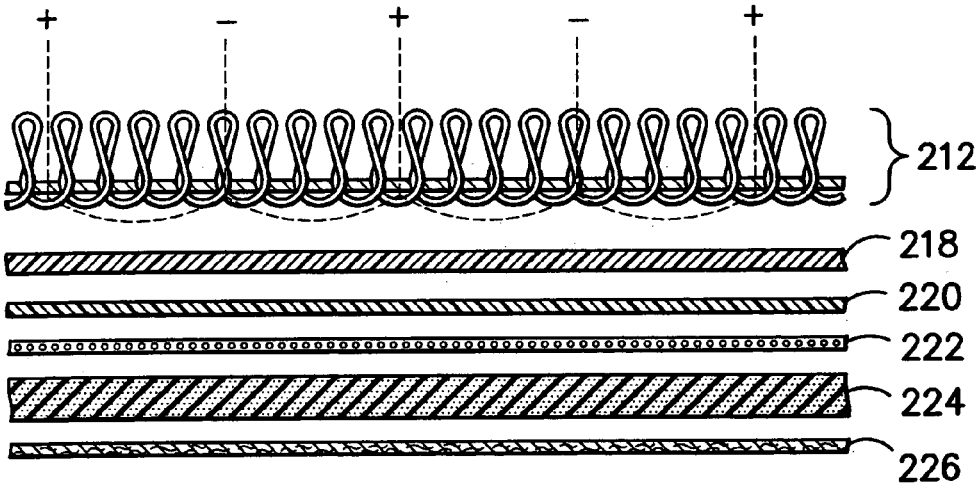
FIG. −35−

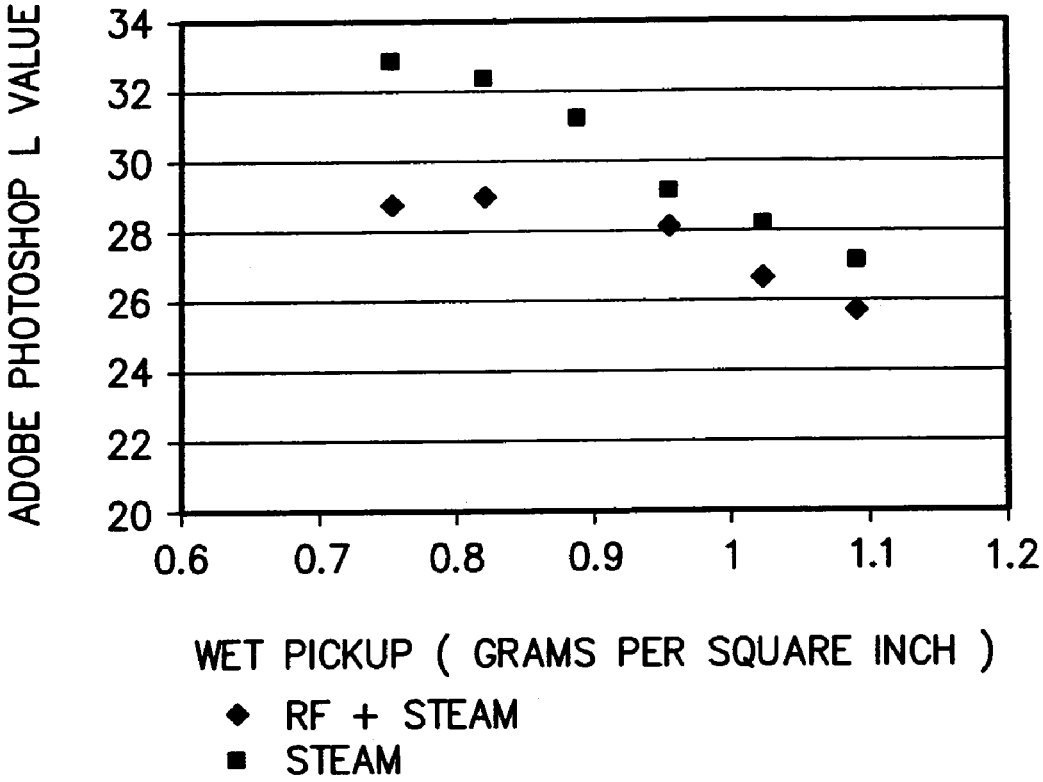
*FIG. —36—*

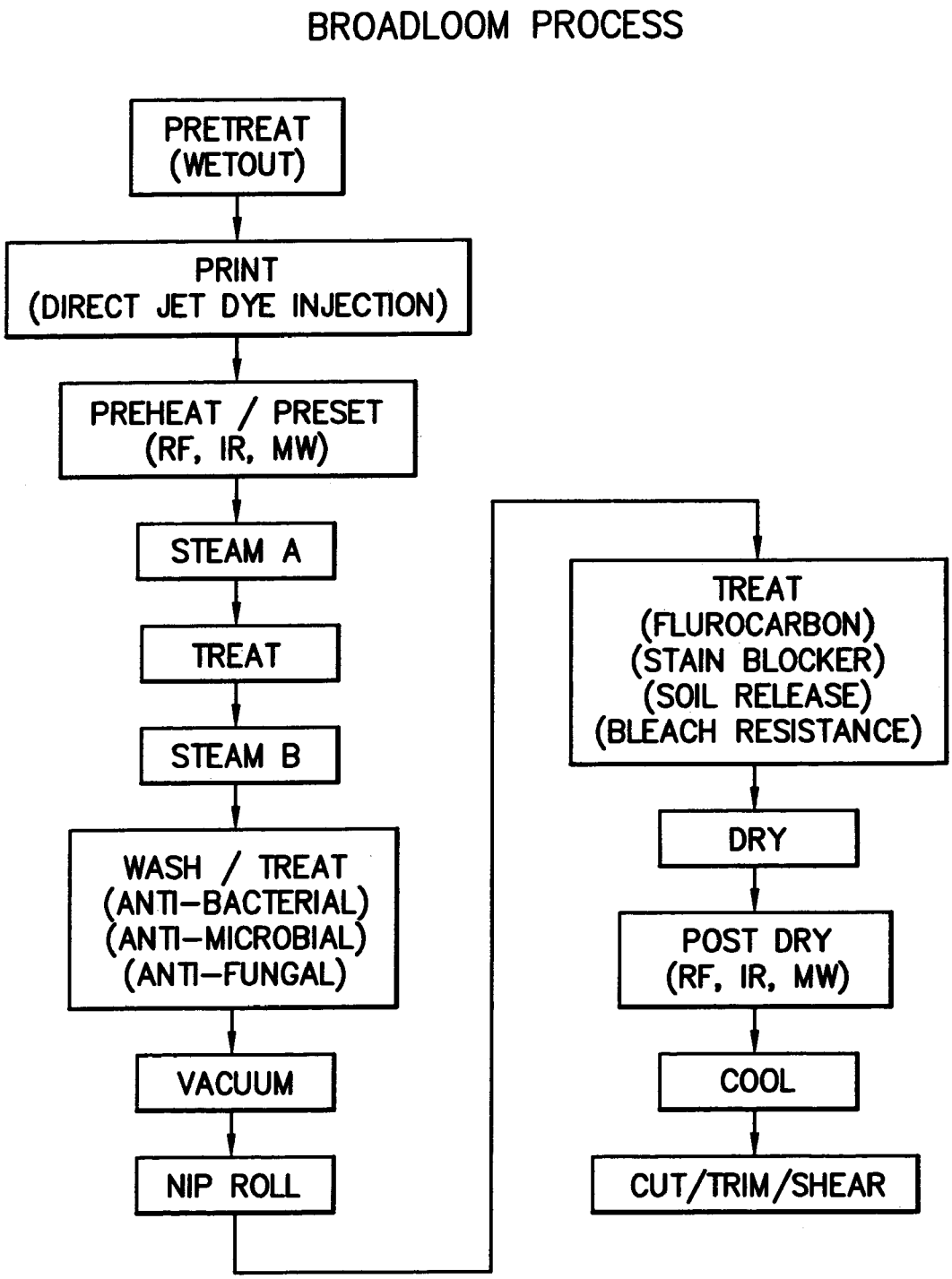
*FIG. —37—*

CARPET TILE PROCESS II
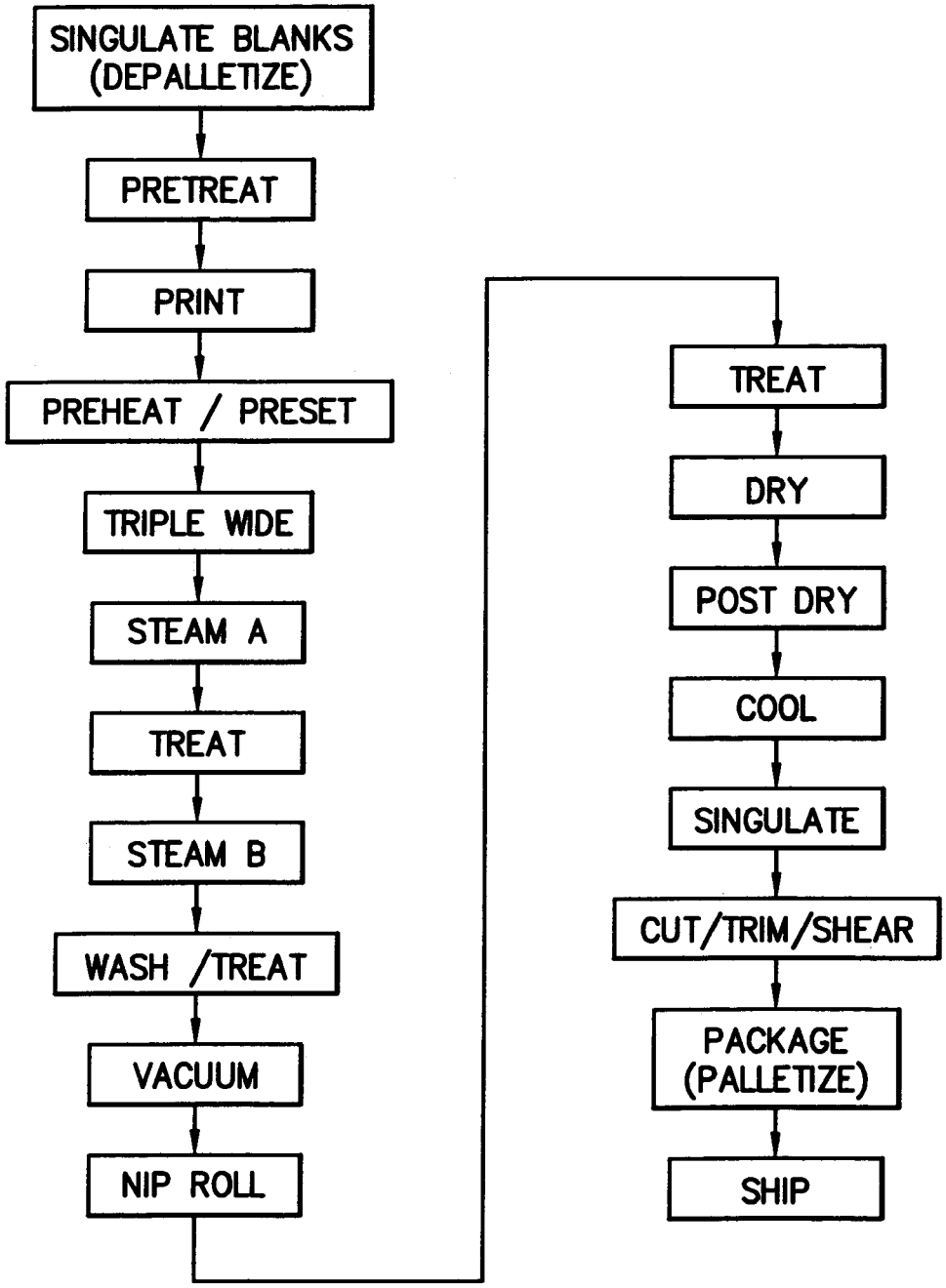
*FIG. —39—*

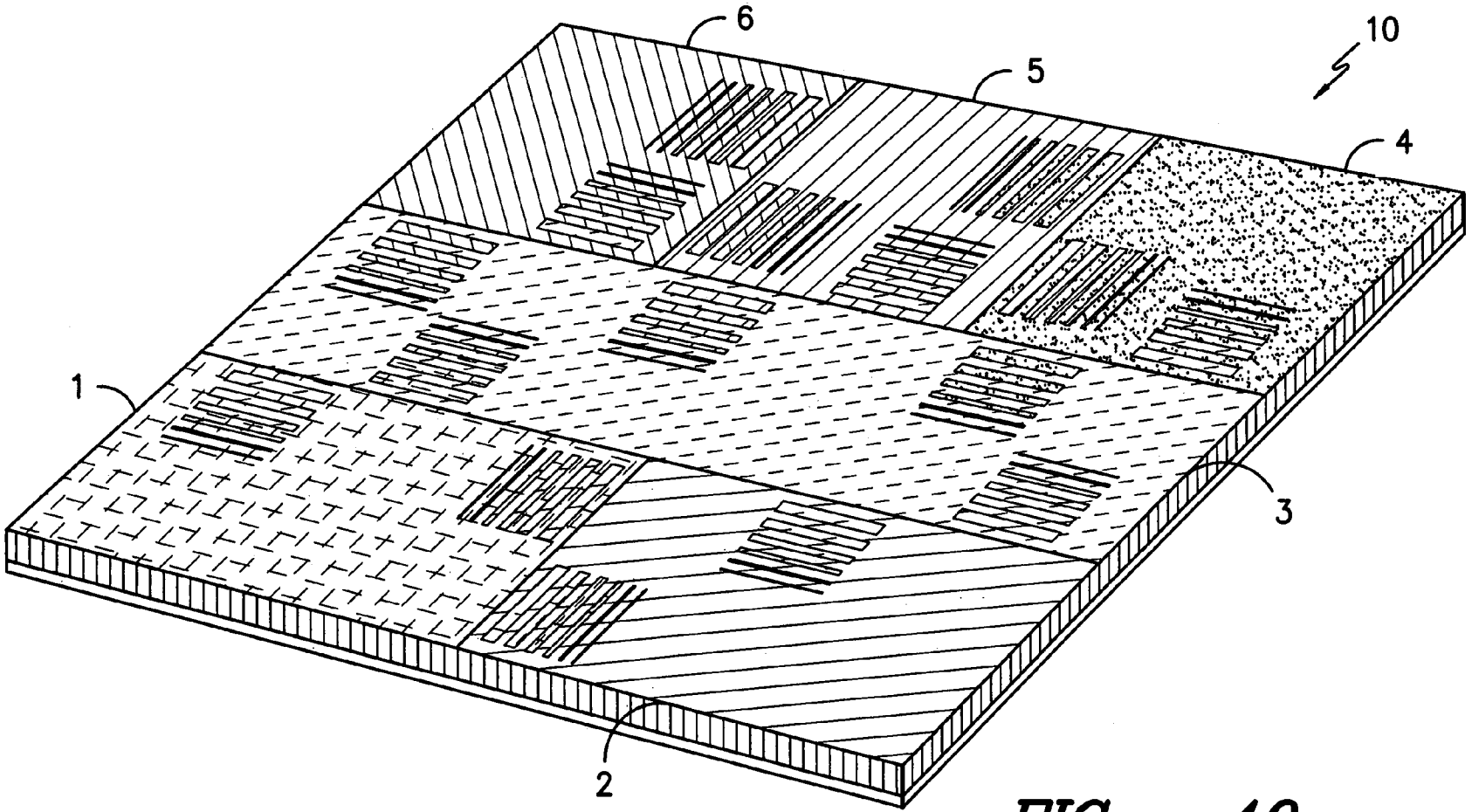
FIG. —40—

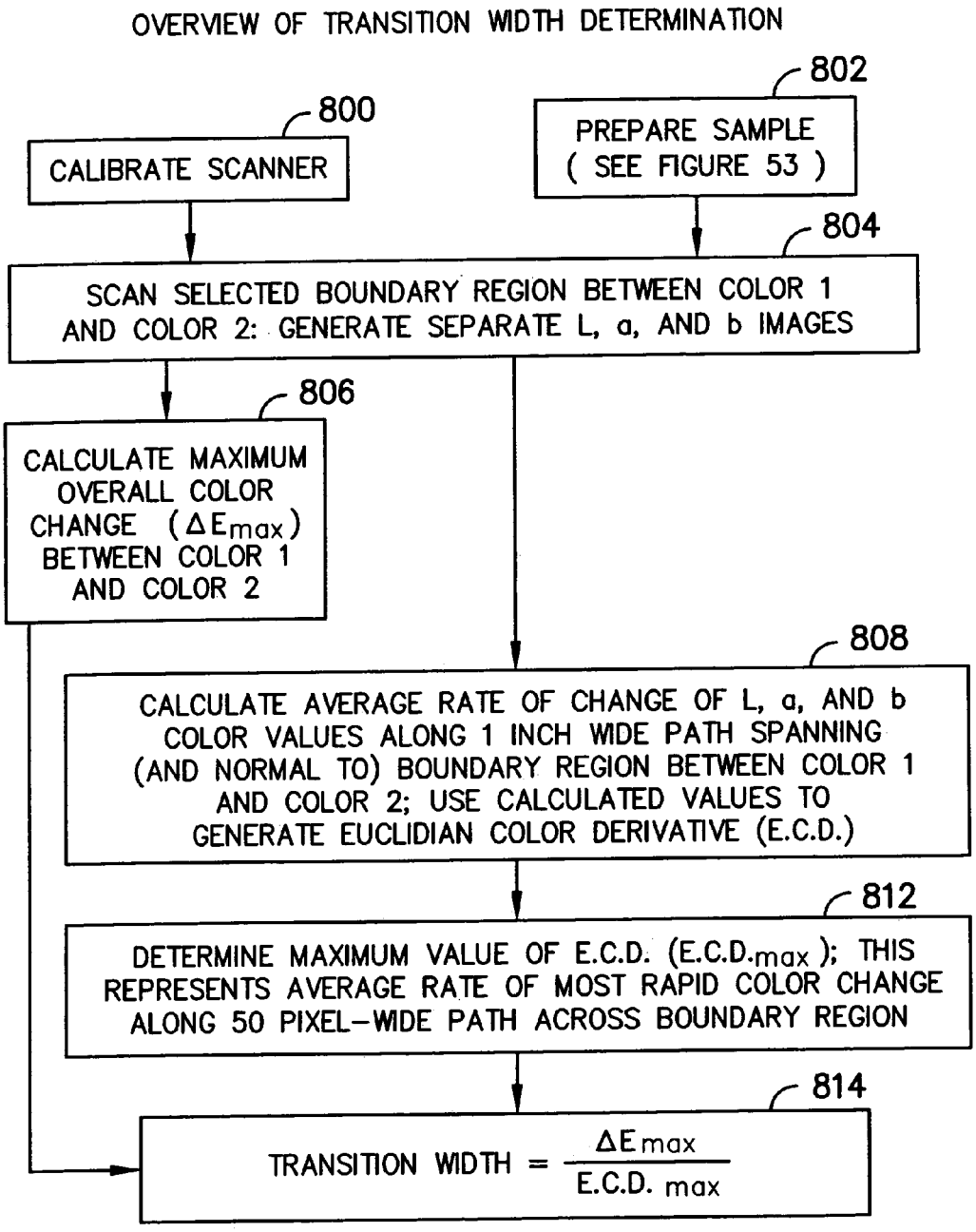
*FIG. —43—*

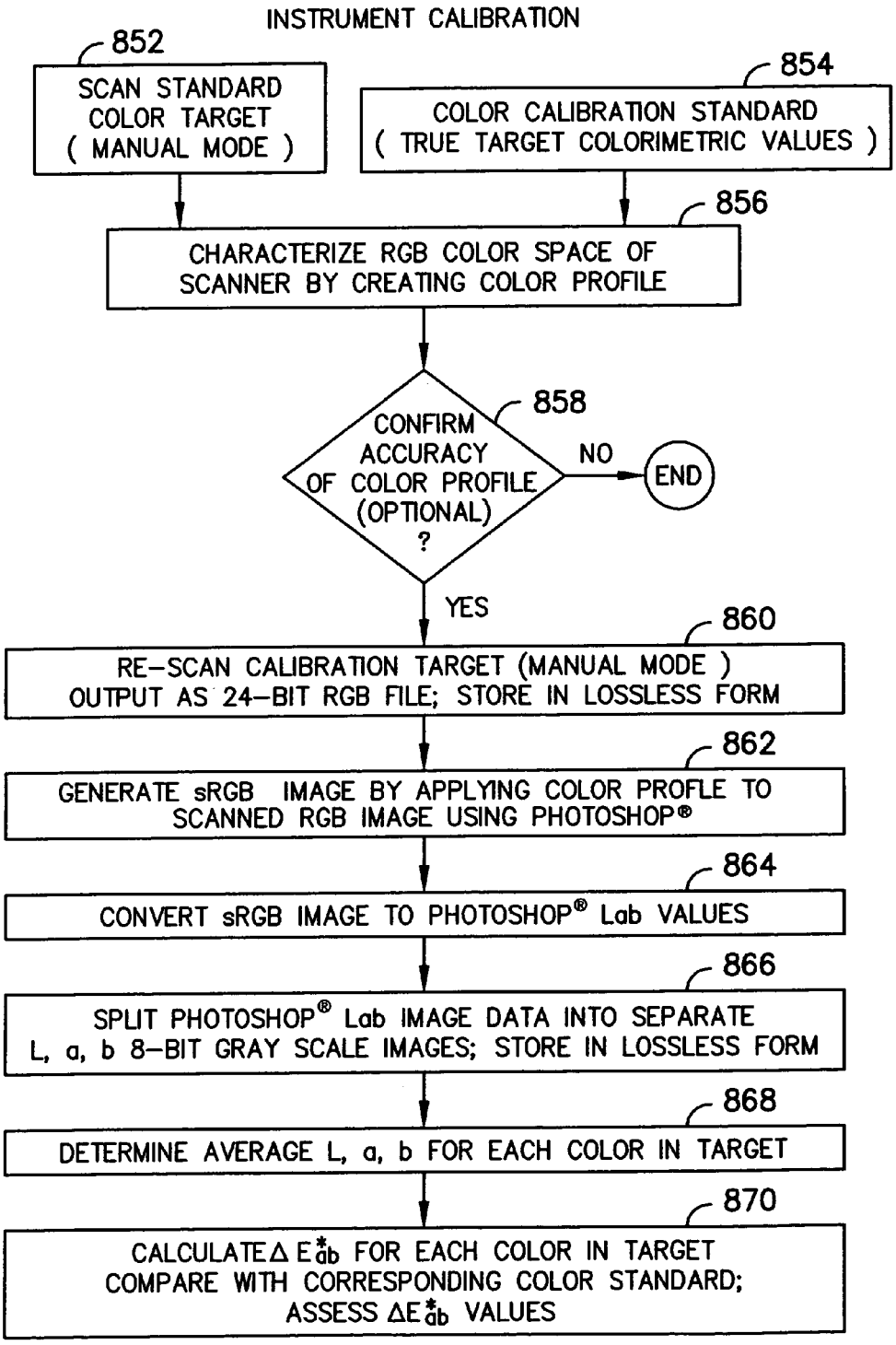
*FIG. —44—*

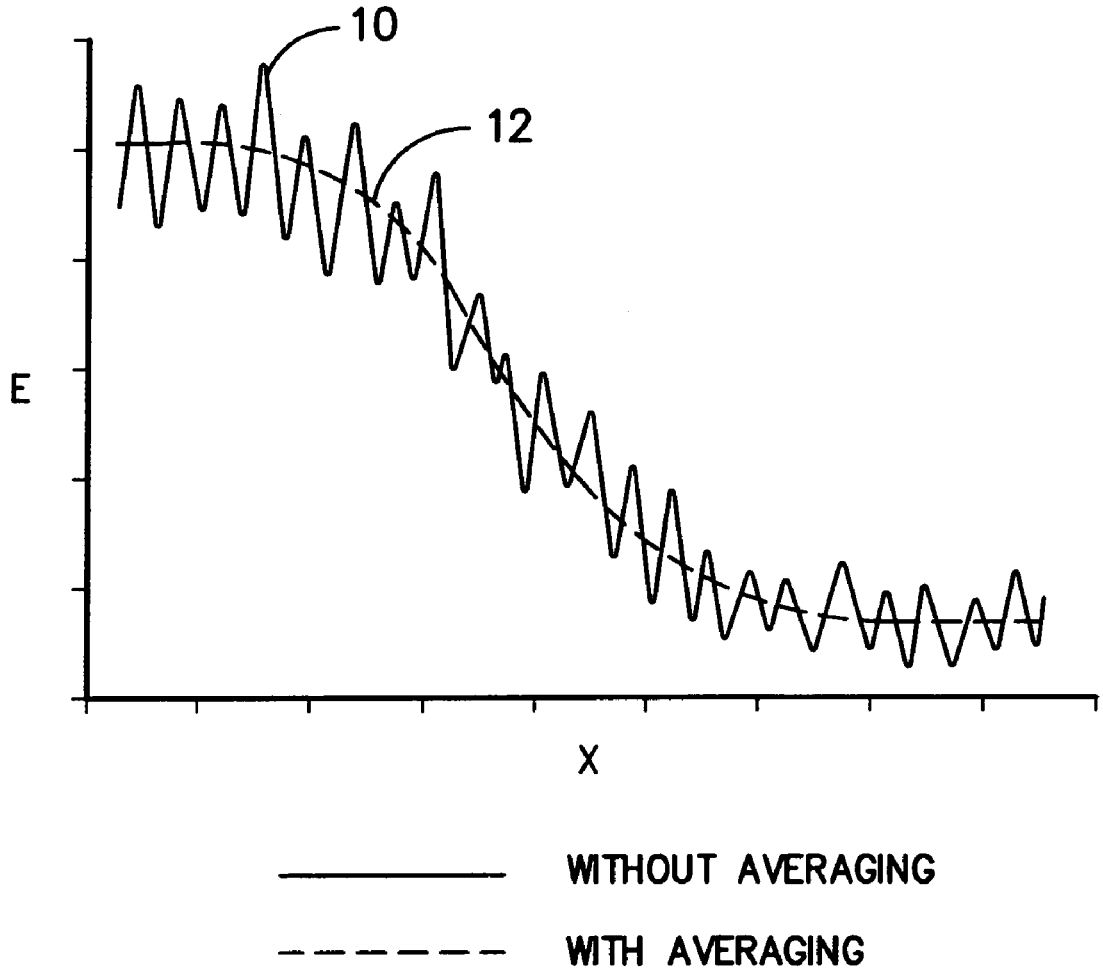
*FIG. —45—*

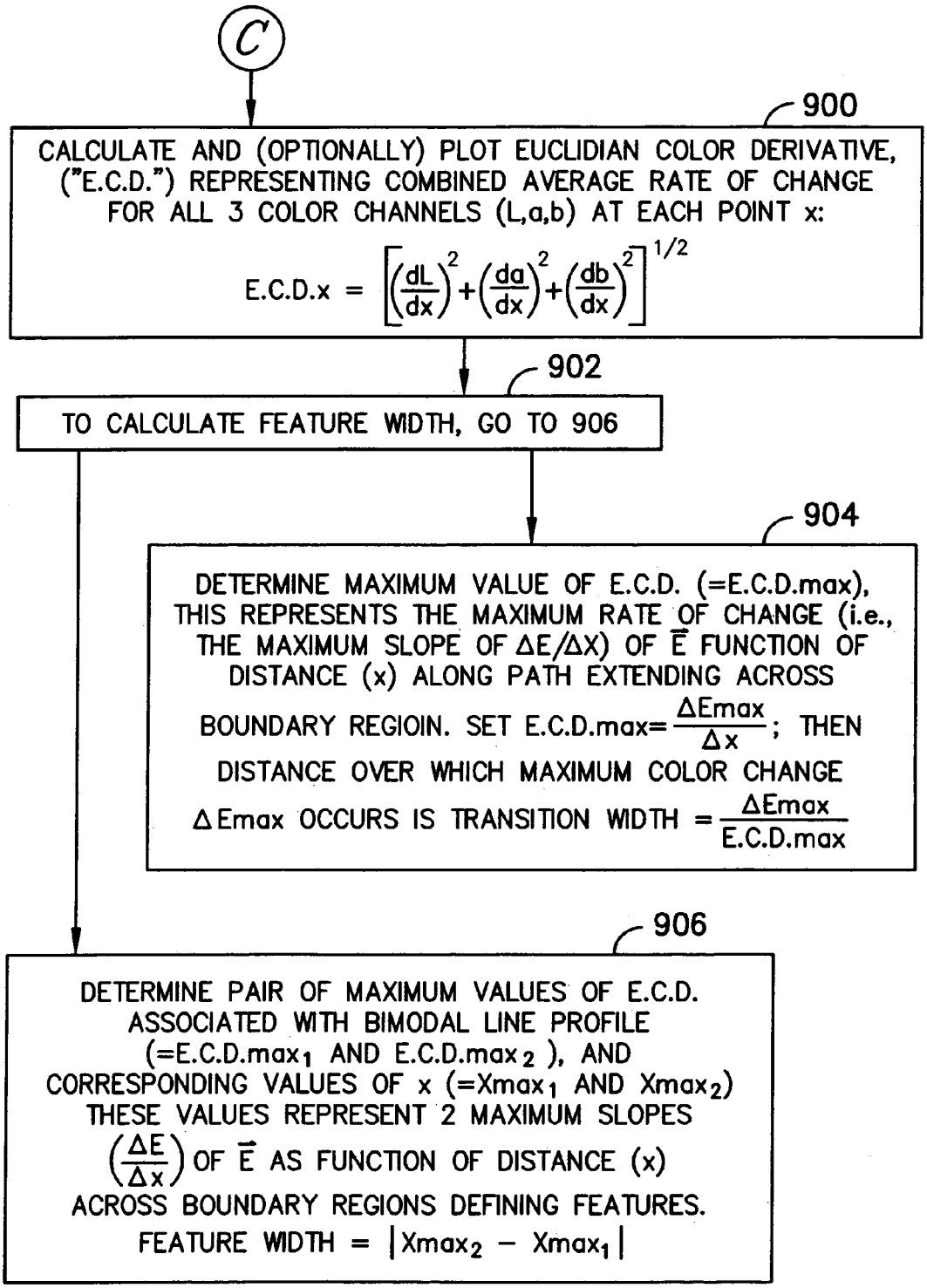
*FIG. —47C—*

PATTERNED TEXTILE PRODUCT

CROSS-REFERENCE TO RELATED APPLICATIONS

This application claims the benefit of U.S. Provisional Application No. 60/440,056, filed Jan. 14, 2003, and U.S. Provisional Application No. 60/454,565, filed Mar. 14, 2003.

STATEMENT OF INVENTION

This disclosure is directed to a textile substrate that has been patterned by the selective application of various dyes to the substrate surface in a way that provides desirable, visually apparent enhancements in the area of pattern detail, definition, and color range, and to the patterning system that makes such enhancements possible. In one embodiment, the patterning system described herein is capable of producing pile-faced textile substrates, useful as floor coverings, that exhibit a unique combination of desirable pattern attributes that have been identified and measured using novel techniques specifically developed for these substrates and pattern attributes.

BACKGROUND

This background discussion will be directed to the patterning of textile substrates having a pile surface, and, accordingly, for convenience, will use floor coverings as the source for specific examples. However, the techniques described herein are not limited to such surfaces, and are intended to apply, as appropriate, to other substrates comprised of textile fibers that are woven, non-woven, knitted, bonded, or otherwise entangled or attached to provide a cohesive, structurally integrated textile.

With respect to colored textiles useful for floor coverings, the coloring or patterning process can be thought of as belonging to one of two classes: processes that apply dye to the constituent yarns prior to substrate or pile surface formation ("yarn-dyed" processes), and processes that apply dye to the substrate after the substrate (and the pile surface) has been formed ("substrate-dyed" processes). For each class, it is possible to further distinguish the various dyed or patterned textile products available in the market, and particularly, floor covering products. While the following discussion will refer to carpet as representative of such products, it should be understood that rugs, carpet tiles, mats, and other floor covering products are intended to be included in the discussion as if specifically mentioned, unless a contrary intent is explicitly stated or is inherently appropriate.

Historically, dyed carpets were almost exclusively produced by various yarn-dyed processes, in which the yarns were dyed the desired color prior to a weaving or tufting operation in which the colored yarns were formed into a carpet. At the present time, two processes appear dominant in the manufacture of yarn-dyed woven carpets: Wilton and Axminster. In the former case, a variety of colors may be used, but because the yarn is used in uncut form, all colors found in the pattern must be transported across the back of the carpet, regardless of the location or extent to which they are employed in the pattern. Accordingly, while a relatively high level of pattern detail and definition can be achieved, the number of colors that can be used within the pattern is limited by the practical burdens associated with having to supply and accommodate each color yarn at all times, regardless of its use within the pattern. An Axminster-woven carpet, on the other hand, uses cut yarns that are placed within the weave. Using this technique, yarns of many colors may be used, but pattern detail and definition are generally less than that found in Wilton-weave carpets. Of course, in either case, the manufacturing process is time consuming and costly.

Where tufted, rather than woven, carpets are produced, it is necessary to hide yarns not required in the pattern at each location in order to maintain the desired color at that location on the carpet. Because having many colors available would require the hiding of a considerable number of yarns throughout the carpet, tufted carpets are capable of exhibiting significant pattern detail and definition, but tend to be limited in terms of the number of colors that can be displayed.

More recently, carpet manufacturers have attempted to develop various processes in which an undyed or uncolored substrate may be patterned through the application of dye to the substrate surface. Because such processes generally allow use of a stock substrate that can be patterned quickly in accordance with customer demand, and thus provide significant manufacturing economy and flexibility, carpet manufacturers have maintained a strong interest in developing and improving such patterning processes.

Generally, such "substrate-dyed" processes have evolved along three different approaches. In a first approach (the "drop-on-demand" approach), the dye or colorant is applied directly from valve applicators positioned over the textile substrate to be patterned. In an example of one such system, a valve is opened when the dye or colorant is to be dispensed onto the substrate, and is closed when the requisite quantity of dye has been delivered to the appropriate predetermined area of the substrate.

In one configuration of such a device (referred to hereinafter as the "DOD" device), a print head containing a plurality of individual dye nozzles or applicators is traversed across the path of a substrate to be patterned. A plurality of dye reservoirs are generally used, each reservoir supplying dye of a respectively assigned color to one or more nozzles to provide for multi-color patterning. A given nozzle therefore dispenses dye of a pre-determined color, and only dye of that color (until the machine is reconfigured, the applicators cleaned, etc.), at one of several pre-set quantity levels affecting all colors, in accordance with electronically-defined pattern data. Such data, in the form of "on-off" instructions, are directed to selected nozzles to dispense dye of the various desired colors onto the substrate as the print head is traversed across the width of the substrate and the substrate is sequentially indexed forward, thereby allowing the dye nozzles comprising the print head to trace a raster pattern across the face of the substrate and dispense dyes of the desired colors on any desired area of the substrate dictated by the selected pattern.

This traversing motion is believed to have two consequences affecting the machine's ability to create a precisely formed line in a direction parallel to conveyor motion. The first involves the possibility that the traversing motion across the width of the substrate to be patterned introduces a velocity component in the cross-conveyor direction that may result in an elongation of the dispensed drops in the direction of the traversal. The second involves the fact that creation of such a line involves the ability to actuate and de-actuate the dye dispenser at the exact time necessary to form a series of pixels that are in precise alignment as the dispenser is moving perpendicular to the line being formed. Perhaps because of one or both of these possible effects, the pattern features produced by this type of DOD device are known to be significantly anisotropic (i.e., direction-sensitive).

In a second approach (the "recirculating" or "RECIRC" approach), the individual dye applicators are also associated only with a given color, and the applicators also may be arranged in rows, perhaps in a series of parallel rows arranged in spaced relation along the path of the moving substrate. However, rather than dispensing dye only when required by the pattern, the applicators in this re-circulating approach are always "on" and continuously generate a stream of dye that is directed towards the surface of the moving substrate, but that stream is normally diverted into a catch basin associated with each row by individual streams of a control fluid (e.g., air). Actuation or de-actuation of such applicators involves, respectively, de-actuation or actuation of the corresponding control fluid. Accordingly, the dye stream can reach the substrate only when it is not diverted onto the catch basin by the intermittently-actuated (i.e., actuated in accordance with pattern data) transverse stream of air or other control fluid for a time interval sufficient to dispense the quantity of dye (which may vary considerably from color to color) specified by the electronically defined pattern data. Separate sets of applicators and corresponding catch basins are used so that dye that is directed into a specific catch basin can be collected and re-circulated to the row of dye applicators assigned to that color dye. Some details of such a device are discussed below, as well as in a number of U.S. Patents, including commonly-assigned U.S. Pat. Nos. 4,116,626, 5,136,520, 5,142,481, and 5,208,592, the teachings of which are hereby incorporated by reference.

In the RECIRC devices and techniques described in the above-referenced U.S. patents, the substrate pattern is defined in terms of pixels, and individual colorants or combinations of colorants are assigned to each pixel in order to impart the desired color to that corresponding pixel on the substrate. The application of such colorants to specific pixels is achieved through the use of many individual dye applicators, mounted along the length of the various color bars that are positioned in spaced, parallel relation across the path of the moving substrate to be patterned. Each applicator in a given color bar is supplied with colorant from the same colorant reservoir, with different color bars being supplied from different reservoirs, typically containing different colorants. By generating applicator actuation instructions that accommodate the fixed position of the applicator along the length of the color bar as well as the position of the color bar relative to the position of the target pixel on the moving substrate, any available colorant from any color bar may be applied to any pixel within the pattern area on the substrate, as may be required by the specific pattern being reproduced. As will be appreciated by those skilled in the art, compensation for substrate travel time between rows must be provided.

Although patterning systems employing this RECIRC design have been successful, those familiar with such systems are aware of several consequences of the fundamental design that have to be accommodated for best results. These consequences arise as a result of the dye stream being formed continuously rather than as demanded by the pattern. This design feature results in a dye stream that (1) must be deflected onto the substrate in accordance with pattern data, and (2) must, at other times, be recirculated in order to minimize the consumption of expensive dyes.

The first design consequence (i.e. the deflection of the dye stream) results in the dye stream being subject to both a slight velocity component as well as certain fluid mechanical effects as the dye stream is first allowed to strike the substrate and then, as dictated by pattern data, is re-deflected into the catch basin. These effects, which can have a subtle, but perceptible effect on pattern definition in the form of a slightly elongated drop footprint along the axis of deflection (which also corresponds to the axis of conveyor motion) that would not be present if the dye stream were simply dispensed from an overhead applicator in "on/off" fashion.

Additionally, because control of the dye stream is indirect in the sense that it depends upon the control imposed on and by the transverse stream of deflecting fluid, this design sets inherent limitations on the minimum quantity of dye that can be accurately and reliably delivered to a specific pixel.

Similar to the issue discussed in connection with the DOD device, above, there is also the fact that the formation of a line that is parallel to the direction of substrate movement involves the ability to deflect the dispensed dye stream(s) at the exact time necessary to form a series of pixels that are in precise alignment as the applicator dispenser is moving perpendicular to the line being formed. Perhaps because of one or both of these possible effects, the pattern features produced by the RECIRC device are also known to be significantly anisotropic (i.e., direction-sensitive).

The second design consequence (i.e., the recirculation of the dye when not patterning) results in a limitation as to the chemical agents that can be added to the dye—the inclusion of surfactants, shear-sensitive thickening agents, etc. to the dye, for example, can result in undesirable behavior of the dye as it recirculates. An additional consequence of the re-circulation system is the need to incline the system to promote gravity-assisted draining of the catch basin. That inclination tends to cause freshly deposited dye to flow down the inclined substrate and can result in the occurrence of non-circular dye drops. Perhaps most fundamentally, these two design consequences—particularly the second—do not accommodate the use of high viscosity dyes, which traditionally are the dyes of choice for high definition patterning of textile substrates because of their reduced tendency to spread uncontrollably when applied, as compared with lower viscosity dyes of the same kind.

In a third approach (the "screen print" approach), a series of screens (typically, one per color) comprised of individual relatively fine-gauge meshes are placed, sequentially and in registration with preceding screens, directly over the area of the substrate to be patterned. Within each screen are locations where the screen mesh is occluded or blocked, so that when dye is applied to one side of the screen, it passes through and colors the substrate everywhere except at those locations.

Screen printing, while capable of a high degree of detail and definition, nevertheless has a process "signature" which tends to characterize textile substrates that have been patterned using this process. The physical dimensions of the screens themselves usually define, and limit, the size of the pattern repeat. Typically, the screen is placed into direct contact with the surface of the substrate being patterned. This not only can deform the face fibers, but also limits the success with which substrates having contoured or otherwise uneven top surfaces (e.g., non-level loop carpets) can be patterned. Due to this physical interaction with, and occasional displacement of, the surface fibers, as well as the difficulties associated with achieving close registration tolerances when dealing with the precise positioning of a series of large screens on a deformable surface having a high degree of texture, screen printing procedures normally provide for significant overlap (and, therefore, significant overprinting) between adjacent screen placements, to assure that no substrate within the boundary regions between adjacent screen positions will be underdyed. The visual consequences of this overprinting are frequently apparent.

Perhaps the most characteristic quality of screen printed products is the physical depth of the resulting dyed pattern. In order to provide adequate control of the placement of the dye as it is pressed through the screen, the dyes used tend to be high viscosity. The use of high viscosity dye allows for high definition images—such dyes are not normally prone to migrate, and minimizing lateral dye migration on the substrate tends to sharpen the dye boundaries on the substrate. However, minimizing lateral dye migration also tends to impede vertical (i.e., along the fiber) dye migration into the pile, which means that, although screen dyed products may appear rather detailed, they generally will not exhibit a high degree of dye penetration—dyed yarns in pattern regions will be completely dyed over perhaps the first 30 or 40 percent of their length (depending upon the composition and total overall length of the fibers comprising the pile face), beyond which dye penetration is usually quite non-uniform and frequently non-existent.

In summary, the carpet patterning systems of the prior art collectively suffer from several important shortcomings, including an inability to provide a product with high pattern definition or resolution that can be easily patterned from an unlimited number of unpatterned stock substrates, and that exhibits a wide variety of visually uniform colors (including in situ blended colors) that extend deep within the substrate face.

SUMMARY OF THE INVENTION

To address these shortcomings, a fourth system, of the drop-on-demand type, has now been developed. This system, referred to as the PREF ("PREFerred") system, provides many of the collective advantages of various yarn-dyed systems, notably, sharply defined pattern edges, a high level of pattern detail, and an ability to incorporate a large number of colors within the pattern, with the collective advantages of various substrate-dyed systems, notably, speed and flexibility of patterning, an ability to use standard, un-dyed stock substrates as starting materials, and an ability to produce a variety of blended colors on the substrate from a limited number of process colorants. As described, this PREF system produces patterned products that possess a degree of definition and contrast that are unrivalled by the products produced by other known textile pattern dyeing systems.

This novel system provides a series of fixed arrays of individually actuated dye dispensers or applicators, each of which is positioned over and directed towards the moving substrate web to be patterned. In its most straightforward embodiment, all applicators associated with a given array are supplied with a common dye. When actuated, the applicators deliver to the substrate surface that quantity of dye specified by the pattern being reproduced, with an accuracy and a precision that has been previously unattainable by other drop-on-demand, recirculating, or screen printing systems, and with the capability of delivering dye quantities sufficiently large to achieve desirable dye penetration, as well as sufficiently small to achieve unprecedented in situ dye blending capability, and the ability to dye low face weight textiles without dye flooding.

As will be discussed in more detail below, the product produced by this unique PREF patterning system has been shown to be also unique in ways that are both visually apparent and scientifically measurable. Specific attributes of such products include a significant reduction in the distance necessary to transition from one color to a second color at a pattern area border, as well as a significant reduction in the minimum pattern element size that can be accurately and precisely rendered on the substrate, together with excellent dye penetration.

Several operational advantages can be obtained through the use of this PREF patterning system, particularly as compared with the re-circulation-type ("RECIRC") system discussed above. Because the PREF system does not depend upon the constant re-circulation of dye, limitations on dye viscosity and use of surfactants or anti-foaming agents are no longer necessary. Limitations with respect to machine configuration are also relaxed, in that there is no longer a need to accommodate a re-circulation system, complete with a separate catch basin for each dye used, which allows for more compact placement of the non-re-circulation-type color bars, thereby reducing the physical distance between adjacent color bars and removing the need to incline the patterning system to promote gravity-assisted draining of the catch basins. Furthermore, the geometry of dye stream formation and delivery found in the PREF system disclosed herein is sufficiently different that the "footprint" of the dye drop as it strikes the substrate is fundamentally changed—it is substantially circular in shape, rather than having a perceptible oblate appearance for the reasons discussed above.

In addition, because of the ability to use dyes that have a relatively high viscosity, there is an additional mechanism that is believed to contribute to the high definition patterning performance of this PREF system. As it strikes the substrate surface, the drop of high viscosity dye is given an opportunity to form a sphere-like shape prior to being absorbed by the substrate. As a result of this mechanism, the "footprint" of the dye drop (i.e., its lateral dimension in the plane of the substrate surface) tends to be minimized as it is first deposited on the substrate, before being fully absorbed. Consequently, the footprint within which the dye drop is ultimately absorbed may be reduced and, in turn, the perceived pattern resolution in that area may be increased (provided subsequent lateral dye migration can be controlled).

Perhaps most importantly in terms of combining high resolution patterning with the technologically opposing ability to create a wide range of available colors from a given set of process colors through in situ blending techniques, the nature of the valves and their configuration within the PREF patterning system allow for dramatically improved "turn-down" response. This ability provides for the application, with accuracy and precision, of much lower quantities of dye from individual dye applicators than was previously possible with state-of-the-art devices of the re-circulation type. This capability also provides an ability to pattern low face weight textile substrates without dye flooding.

This improved ability to dispense, with accuracy and precision, relatively small quantities of dye allows for the creation of highly localized dye blends on the substrate that require a relatively small proportion of a given dye. In the past, the creation of such blended colors may have required the construction of a relatively large multi-pixel structure (e.g., a superpixel) and an attendant increase in the possibility of increased heather (i.e., non-uniform color or half-tone artifacts), in order to achieve the proper ratio of the constituent dyes. With the turn-down response available with the novel patterning system disclosed herein, such blended colors may be constructed using fewer pixels, or perhaps only a single pixel, thereby enhancing the pattern definition possible when using such blended colors.

In summary, the PREF patterning system comprises an improved system for patterning textile substrates using a plurality of individually-controlled dye applicators that selectively apply, in accordance with color and applicator-specific actuation commands, a pattern-determined quantity of dye onto the substrate surface. Products produced using this novel system can be expected to have a high degree of pattern detail and definition, sharp borders surrounding each pattern element, an enhanced ability to blend various process colors on the substrate to form a large palette of available colors for use within the pattern, and excellent dye penetration within the substrate. These desirable capabilities previously have not been available in combination in a single substrate-dye system, and consequently the products of this system similarly have been previously unavailable.

To facilitate the discussions below, the following definitions shall be used, unless otherwise indicated or demanded by context. In each case, terms derived from the defined term shall have that meaning consistent with the given definition. Other definitions may be presented, as appropriate, throughout.

The term "substrate" shall mean any substantially flat, absorbent textile comprised of individual natural or man-made yarns or fibers (as used herein, yarns shall be used as a collective term to include both yarns and fibers, whether or not such fibers are components of yarns, unless otherwise specified or dictated by context). Substrates for which the processes described herein are particularly suited include pile fabrics and floor coverings, including carpets, rugs, carpet tiles, and floor mats. However, the teachings herein are fully applicable to the patterning of fabrics such as interior design fabrics (e.g., drapes, napery, upholstery fabrics, wall hanging fabrics, etc.), apparel fabrics, and other fabrics, and are intended to include textiles that are woven, knitted, entangled, bonded, tufted, or otherwise provided with the means to maintain structural integrity.

The term "absorbent" shall mean having the ability to accommodate and retain a liquid coloring agent by the constituent fibers or yarns, or by the interstices formed by adjacent fibers or yarns.

The term "patterning" shall mean the selective application of dye, in accordance with predetermined data, to specified areas of a substrate.

The term "pattern configuration," when used to indicate the placement of dyes or chemicals on a substrate, shall mean placement in accordance with a predetermined pattern that is to be reproduced. One example of placement in pattern configuration is placement in registry with the various colored areas comprising the pattern. However, placement in pattern configuration may also merely refer to placement in relation to certain pattern elements, where such placement may not necessarily be in registry with those pattern elements (as would occur if, for example, a chemical agent were applied in an irregularly-shaped area situated a pre-determined distance away from the edge of a pattern element) in order to achieve one or more special effects.

The term "pattern applied," as used to describe a dye or color on a substrate, shall mean that dye or color that is or was applied to the substrate in a pattern configuration.

The term "pixel" shall be used to describe the basis on which patterns are defined and, for at least some of the substrate patterning devices discussed herein, the basis for generating the dye applicator actuation commands required to reproduce those patterns. The derived term pixel-wise is used to describe the assignment or application of dye or other liquid to specific pixel-sized locations on the substrate, for example, as would occur in reproducing a pattern or pattern element defined in terms of pixels, but could also apply, in analogous fashion, to systems in which the pattern is not, strictly speaking, defined in terms of pixels.

The term "dye" shall mean, unless otherwise specified, a liquid containing various components that form a solution for dyeing a textile substrate, including one or more dyes or colorants (of any suitable kind) in a carrier and, optionally, other additives such as may be taught herein, that is applied to the substrate as part of the patterning process.

The term "dye migration" shall include the movement of any part of the dye solution in one pattern area on a substrate to a second, adjacent pattern area on the substrate in a manner that can change (e.g., by dyeing or diluting) the color of the second pattern area.

The term "process color" shall mean the color of a dye or colorant as it is applied to the substrate, prior to any mixing or blending with any other dye or colorant on the substrate.

The process colors are the set of colors dispensed by the patterning device from which all other colors to be generated on the substrate must be comprised.

The term "in situ blending" shall refer to the migration and mixing of dye after the dye has been applied to the substrate. In one example, dye of the same color is applied to adjacent pixels, and the migration of dye between adjacent pixels tends to promote a more uniform appearance within the dyed area of the substrate. In another example, dyes of two or more colors are applied to the same pixel, and the blending occurs primarily within the same pixel (and, to a lesser extent, in adjacent pixels due to the degree to which lateral migration of the dye takes place). In a third example, dyes of different colors are applied to adjacent pixels, with pixel-to-pixel migration taking place that effectively blends, to a greater or lesser extent, the various applied dyes to form a composite color. Of course, various combinations of the above (e.g., having multiple dyes applied to each of two or more adjacent pixels, with pixel-to-pixel migration taking place) are possible and may be advantageous under certain conditions.

The term "level" or "heather" shall be used to describe the degree to which a given area of the substrate exhibits visually uniform color. Dyed areas having poor level or high heather exhibit a mottled or splotchy appearance and, in cases where in situ color blending has been attempted, individual pixel-to-pixel color variations may be visually apparent. Such variations may or may not be welcome.

The terms "definition" or "high definition," as applied to a dye pattern as seen on a substrate, shall mean a pattern that exhibits excellent detail, with pattern elements that are rendered with exceptional clarity, visual contrast, and well-defined edges.

The term "boundary region" shall mean that area serving as the border between a first pattern area of a first color and a contiguous second pattern area of a second color. The boundary region includes all measurable gradations of color that appear in the transition from the "pure" first color to the "pure" second color (or vice versa) along a path representing the shortest distance between the two pattern areas at a specified location along their common border. One edge of the boundary region coincides with the location along the path at which the first color begins to be measurably influenced by the migration of dye from the second pattern area, and the other edge of the boundary region coincides with the location along the path at which the second color begins to be measurably influenced by the migration of dye from the first area. Boundary regions contain individual yarns, fibers, or pile elements that contain pattern-applied dyes from both bordering pattern areas.

The term "Transition Width" is a distance, useful in characterizing a given boundary region between two contiguous pattern areas, that is calculated using the techniques disclosed herein. Conceptually, the Transition Width may be thought of as a mathematically derived value that defines endpoints that may be used in place of (and that fall within) the actual leading and trailing edges defining the boundary region. These mathematically-derived endpoints are believed to be well suited for reliably characterizing the degree of abruptness of the color transition between the two contiguous pattern areas.

The term "Feature Width" shall mean the width of a pattern element, as measured across the shortest dimension of the pattern element in accordance with the procedures defined herein. Conceptually, minimum Feature Width may be thought of as inversely correlated with maximum print gauge, in that it is a measure of the smallest pattern feature that can be reliably positioned and reproduced on the substrate.

The term "semi-infinite," as used in connection with Transition Widths and Feature Widths, refers to the width of the pattern area bordering the boundary region of interest. A "semi-infinite" area is one having a sufficient width that dye migrating across its boundary regions from adjacent pattern areas can be assumed to have no influence on the color of the interior of the semi-infinite pattern area. That sufficient width is assumed to be three pixels. Accordingly, features widths three pixels or larger are considered "semi-infinite" in width, for purposes of analysis herein. Since this definition implies that the mid-point of a semi-infinite pattern area is sufficiently distant from a boundary region to avoid any physical influence (from dye migration) from any adjacent pattern areas, the choice of semi-infinite feature size may need to be adjusted as necessary.

The term "dominant boundary color" shall mean one of a pair of contiguous colors that, by virtue of its calorimetric nature, tends to dominate visually the second color within their common boundary region. For example, the boundary region associated with a darker color (i.e., one having a relatively low L* value, as defined by CIELAB) that is contiguous with a lighter color (i.e., one having a relatively higher L* value, as defined by CIELAB) is likely to be visually dominated by the edge of the darker color, rather than by the edge of the lighter color. Notable exceptions to this general rule are certain higher-intensity shades of yellow, which may behave as dominant colors in spite of a relatively high L* value.

The term "dye penetration," as applied to textile substrates having a pile or pile-like surface, shall mean the extent to which the dye applied to the surface of the substrate in a pattern configuration has migrated along the length of the yarns or textile fibers ("pile elements") comprising the pile in the general direction of the substrate back (usually, the point of attachment of the pile elements to the substrate back) and dyed such pile elements in a substantially uniform manner. By way of example only, for substrates having generally upstanding pile elements, dye penetration is the distance the pattern-applied dye has traveled along the length of the individual pile elements, and effectively uniformly dyed those pile elements without the appearance of streaks, bands, striations, significant changes of hue (e.g., due to reduced dye concentration or chromatographic effects), or other signs of incomplete, non-uniform dyeing along the length of the pile element. Substrates that show relatively shallow dye penetration may show complete dyeing near the surface of the undisturbed substrate, but show incompletely dyed pile elements (with respect to the pattern-applied dye) when the pile surface is brushed or parted.

The term "frostiness" is used to describe a deficiency of dye at the tips of pile yarns that otherwise show at least some dye penetration, giving the dyed surface of the substrate a light or hazy appearance.

The term "wet pickup" is used to describe the volume of dye applied to the surface of the substrate, expressed in convenient units (e.g., grams/cm$^2$).

The term "effective drop diameter" shall mean the diameter of a hypothetical spherical drop of dye that, if centrally placed in each pixel of a patterned area of a substrate, results in a given wet pickup.

The term "metered jet," as used to describe a substrate patterning process, shall mean any process for dyeing textiles in which multiple, discretely formed streams of flowable dye are applied to the substrate surface in accordance with pattern data by the selective actuation and de-actuation of individual dye applicators that dispense dye, usually in pixel-wise fashion, from conduits positioned opposite the substrate areas being patterned.

The term "effective print gauge" shall mean the actual resolution with which a pattern can be rendered on a substrate by a metered jet patterning device; it is equivalent to the maximum number of individual pixels per unit length to which a specific color can be effectively and reliably visually resolved.

The term "line profile" shall mean the variation of print color measurements (e.g., CIELAB values, or their spatial derivatives), averaged over a suitable number of paths that are perpendicular to, and cross, boundary regions between pattern areas of different colors.

The term "color signal" shall mean that signal in the output of a scanner digitizing a textile substrate that characterizes the color of the substrate surface.

The term "substrate noise" shall mean that signal in the output of a scanner digitizing a textile substrate, superimposed on a color signal, that is due to the topology of the substrate surface and its attendant highlights and shadows. Such effects are particularly apparent on a pile substrate surface, and more particularly on a pile substrate surface with relatively long pile elements or irregular pile lay.

BRIEF DESCRIPTION OF THE DRAWINGS

The following discussion is intended to be read in conjunction with the Figures, briefly described below.

FIG. 9 is a perspective view illustration of an exemplary all inclusive valve card;

FIG. 10 is a bottom view representation of a plurality of the valve cards of FIG. 9 arranged adjacent one another as they would be in a valve card set or valve card array in the PREF patterning device of FIGS. 5 and 6;

FIG. 11 is a bottom view representation of a portion of two adjacent sets or arrays of valve cards with the jets of each of the adjacent valve card sets being aligned with one another;

FIG. 11A is an enlarged view of a portion of the jets of two of the valve cards of FIG. 11 showing that the jets of a first valve card and a second or trailing valve card in the direction of travel of the substrate are aligned with one another;

FIG. 23A depicts a memory state at a time $T_1$; FIG. 23B depicts a memory state at time $T_2$, exactly one hundred pattern lines later;

FIG. 28 is a diagram of a clock voltage pulse, shift data in voltage pulse, high voltage pulse, block voltage pulse, and valve drive voltage pulse that represents when a valve that is turned on from the previous machine cycle;

FIG. 29 is a diagram of clock voltage pulse, shift data in voltage pulse, high voltage pulse, block voltage pulse, valve drive voltage pulse, corresponding to FIG. 28 that represents a valve that was not turned on in the previous machine cycle.

FIG. 32 is a simplified process flow diagram for dye application and fixation of dye within a carpet pile;

FIG. 33 is an expanded flow diagram illustrating a sequence of steps in the preparation of a carpet including the application and fixation of dye to the pile surface;

FIG. 34 illustrates a fringe-field radio frequency application unit including a plurality of electrodes extending across the travel path of a carpet tile for application of a drying electric field;

FIG. 35 is an exploded side view similar to FIG. 31 illustrating the RF field applied to a substantially controlled depth within the carpet structure;

FIG. 36 is a graph illustrating improved dyeing using RF preheat;

FIG. 37 is a flow chart illustrating an exemplary process for formation of a broadloom carpet which may incorporate patterned printing and/or RF preheating;

FIG. 39 is a flow chart illustrating another exemplary process for formation of a carpet tile product which may incorporate patterned printing and/or RF preheating;

FIG. 40 is a perspective view of a carpet tile with a pattern suitable for performing the analyses taught herein;

FIG. 43 is a flow chart describing an overview of the steps for determining transition width;

FIG. 44 is a flow chart depicting a series of steps for scanner instrument calibration;

FIG. 45 depicts a color signal that is superimposed with substrate noise;

FIGS. 47A through 47C comprises of a flow chart describing steps for performing image analysis of boundary regions;

APPARATUS DETAILED DESCRIPTION

For purposes of discussion, the apparatus of FIGS. 1-21 of the drawings will be described in conjunction with the metered jet patterning apparatus control system described below and to which the apparatus is particularly well suited. It should be understood, however, that the below described electronic control system of the present invention may be used, perhaps with obvious modifications, in other devices where similar quantities of digitized data must be rapidly distributed to a large number of individual elements.

Also for purposes of discussion, the apparatus described in FIGS. 1-21 of the drawings will be described in conjunction with the patterned textile products described below. The apparatus of FIGS. 1-21 of the drawings are particularly well suited to produce such products. It should be understood, however, that the apparatus of the present invention may be used, perhaps with obvious modification, to produce other products.

In accordance with at least one potentially preferred embodiment of the present invention and with reference to FIGS. 1-21 of the drawings, a drop-on-demand or direct jet textile patterning machine or device for pixel specific or pixel-wise dye application, chemical application, and/or the like is provided. The direct jet dyeing apparatus or textile patterning machine provides for not only the pixel specific dye application of individual colorants, but also combinations of colors, chemical agents, and the like to create not only conventional patterns, designs, colors, and effects, but also unique and previously unknown patterns, designs, effects, and the like.

Figure 1:
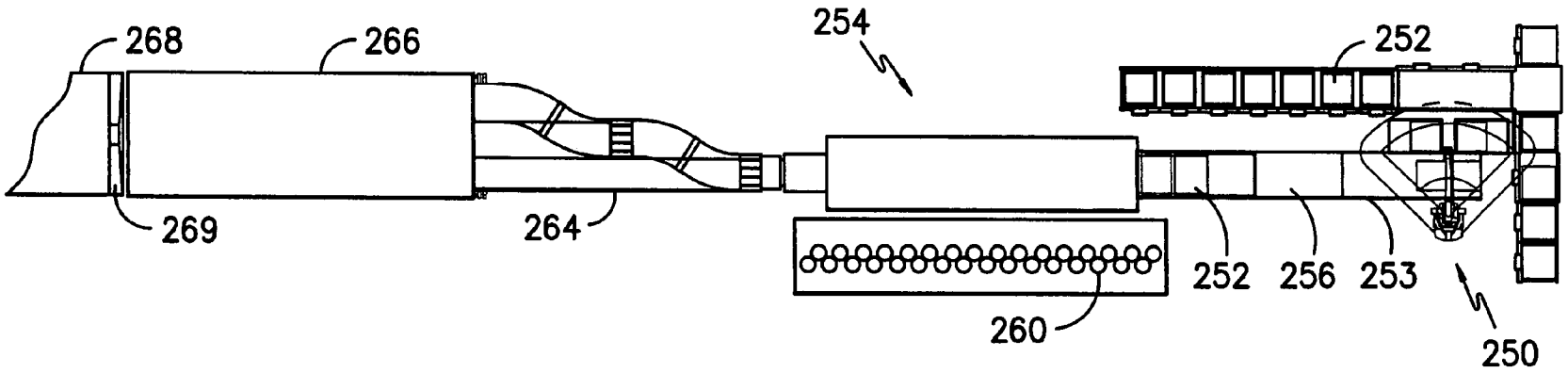
FIG. 1 is a schematic top view representation of the front end of an exemplary patterning range including an exemplary PREF patterning device for producing the products described herein.
Figure 2:
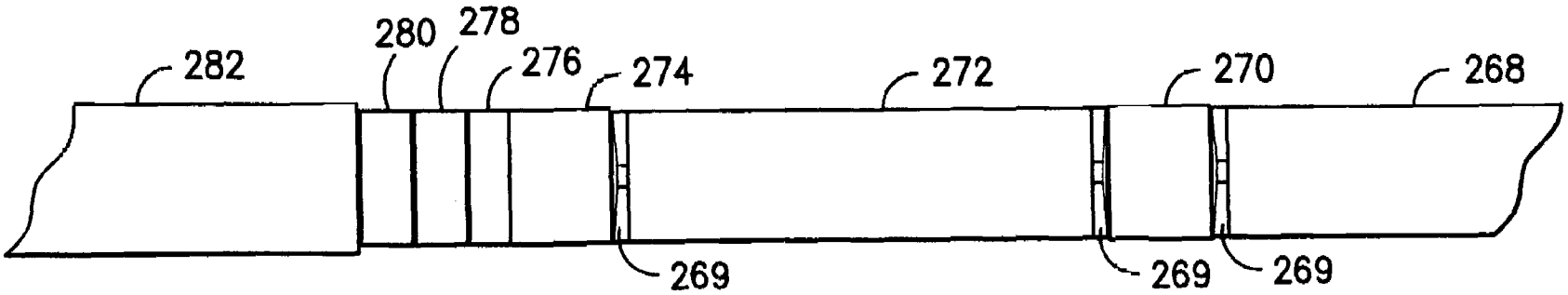
FIG. 2 is a schematic top view representation of the mid-section of the patterning range of FIG. 1.
Figure 3:
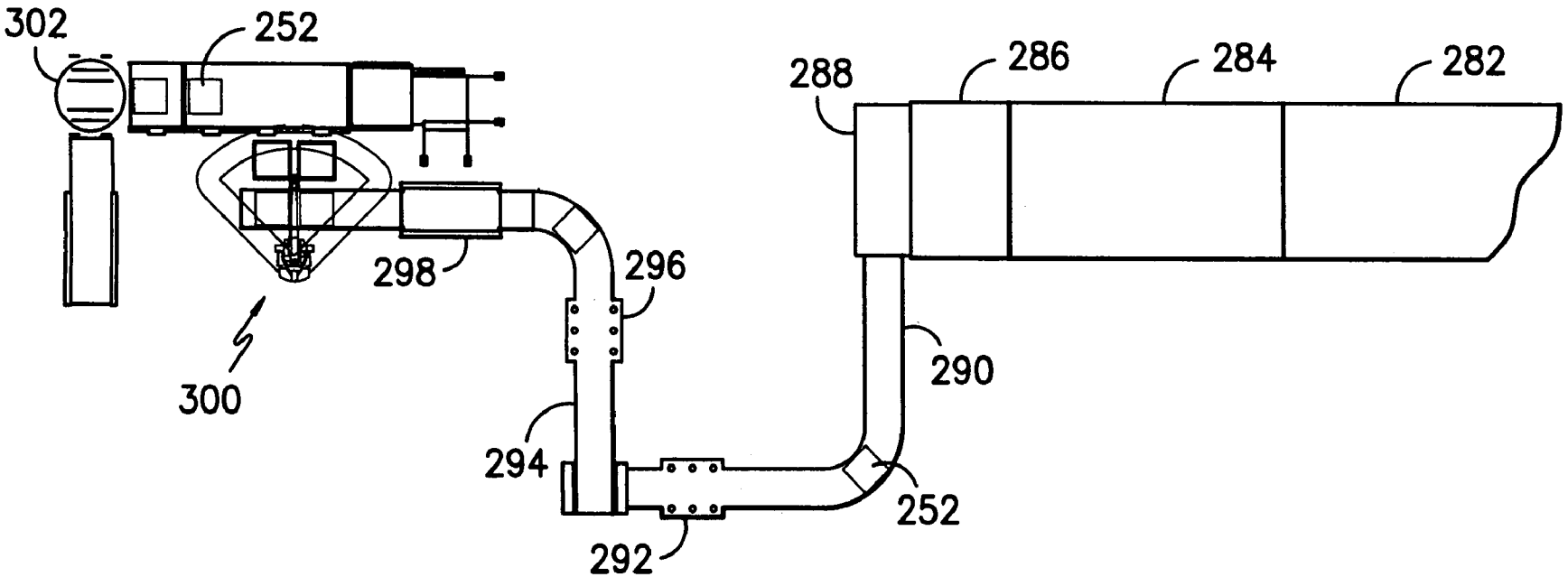
FIG. 3 is a schematic top view representation of the back end of the patterning device of FIGS. 1 and 1A.

Although the direct jet dyeing or patterning apparatus or machine of the present invention may be utilized to dye or pattern broadloom substrates, area rugs, floor mats, carpet tiles, runners or the like, FIGS. 1-3 are directed to a particular patterning range or dye range embodiment for dyeing or producing discrete carpet tiles. It is easy to envision that one could use a similar apparatus for patterning broadloom products. U.S. Pat. No. 3,894,413 discloses the dyeing of carpet tiles, while U.S. Pat. No. 6,120,560 discloses the dyeing of broadloom substrate, each hereby incorporated by reference.

With reference to the particular example of FIGS. 1-3 of the drawings, a dye range or production line for the dyeing or patterning, preferably in a pixel wise fashion, of a textile substrate includes at the front end a robotic depalletizing or singulating station 250 for receiving pallets of stacked carpet tiles or blanks 252, automatically removing single tiles from the stack on a pallet, and placing the singulated tiles on a conveyor 253 which conveys each tile or blank 252 through a pretreat station 256. In the pretreat station, the tiles may be subjected to steam, wet out, water, or the like. The pretreatment of a substrate prior to dyeing is described, for example, in U.S. Pat. Nos. 4,740,214 and 4,808,191 hereby incorporated by reference herein.

Following pretreatment (if any), each tile or blank 252 passes to an exemplary PREF patterning device or direct jet dyeing or patterning machine 254 including a conveyor mechanism 310 which has respective slats or dividers 320 which insure that each tile is in a specified location on the conveyor and is transported through the patterning device or machine 254 in an accurate fashion to provide for dyeing patterns, designs, colors and/or the like on each tile in a particular placement or location on each tile and to provide for accurate registration of designs, patterns, colors, or the like on adjacent tiles when the carpet tiles are installed at a location. The more accurate the placement of the tiles through the PREF patterning device 254, the more accurate the registration of the resultant designs on adjacent tiles.

The PREF patterning device or machine 254 in FIG. 1 is shown located adjacent thirty two dye or chemical tanks 260 which feed dye or chemicals to thirty two respective valve card sets or arrays as will be described in more detail below. Each of the dye or chemical tanks 260 preferably receives a selected dye solution or chemical agent from either a mixing tank, a surge tank, a storage tank, mixing equipment, or the like. Also, it is preferred that each of the dye or chemical tanks 260 delivers the dye or chemical agent to the valve card set under pressure, more preferably, at a substantially constant pressure, for example of about 10-35 psi, more preferably about 20-30 psi, most preferably about 30 psi.

With reference to FIG. 1, the dyed or printed carpet tiles exit the PREF patterning device or machine 254 and are transferred to a conveyor system or transfer table 264 which converts the tiles from a single file arrangement to a three-wide arrangement upstream of a preheat or preset station 266. For example, the preheat or preset station is an RF unit which heats at least the top surface of each tile to a temperature of about 190° F. in order to preheat or preset the dye on the yarn prior to entrance into a first steam section 268. This preheat or preset of the dye may not only provide for better resolution, less bleeding, better color, or the like, but may also reduce condensation on the top of the carpet tile when it enters into the steamer section 268.

Figure 1A:
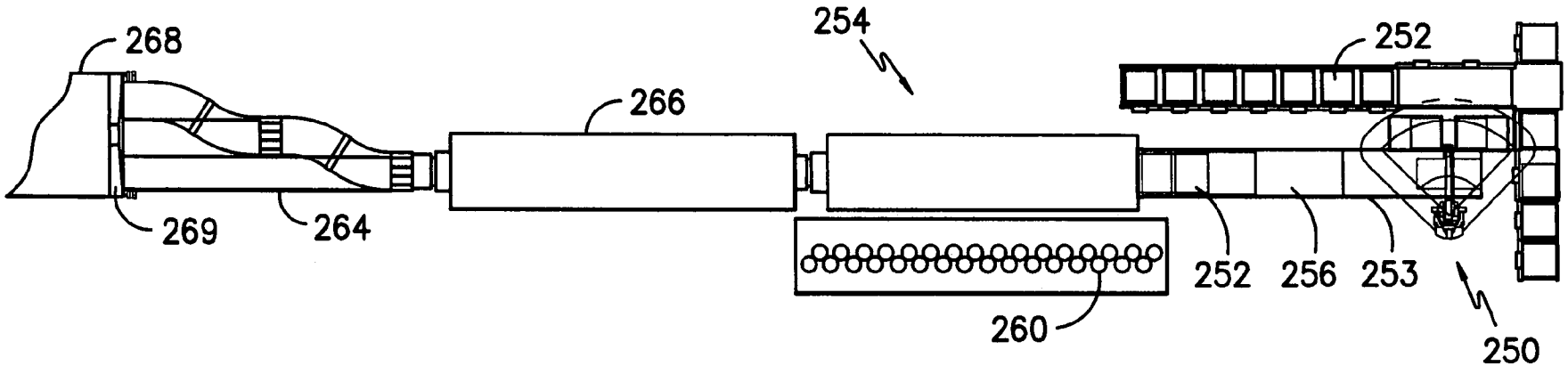
FIG. 1A is a schematic top view representation of an alternative front end of an exemplary patterning range like that of FIG. 1.

With reference to FIG. 1A and in accordance with an alternative embodiment, the dyed tiles or substrates 252 pass from the PREF patterning device 254 on to a single wide preheat station 266 before passing to the transfer conveyor or table 264 which converts the tiles from a single wide arrangement to a triple wide arrangement. Hence, the preheat station 266 of FIG. 2 is narrower than that of FIG. 1. Although FIGS. 1-3 show tiles being conveyed triple wide through a large portion of the range, it is contemplated that the range may be arrange to convey tiles single wide, double wide, triple wide, or the like.

With reference to FIG. 2, the tiles are conveyed triple wide through the first steamer section 268 to a first treatment station 270 and then into a second steamer section 272. Following the second steamer section 272, the tiles are conveyed triple wide into a wash and treat station 274, a vacuum station 276, a nip roll station 278, and through an additional treatment station 280 upstream of a dryer section 282. At the entrance and exit of each of the steamer sections 268, 272 is a steam hood 269.

With reference to FIG. 3, the dryer section 282, for example, a conventional forced air dryer or oven, is followed by a post dry section 284, such as an RF device. The tiles are further conveyed triple wide through a cooling section 286, for example, a cool air or refrigeration unit and then travel on to a singulating device 288 which converts the tiles back to a single tile line or arrangement.

Next, the carpet tiles 252 are conveyed along a first conveyor 290 to a first edge trim station 292 which simultaneously trims two opposite edges of each tile. Thereafter, the tiles enter a second conveyor 294 such as a roller conveyor, which conveys the tiles through a second edge trimming station 296 which trims the other two edges of each tile. After edge trimming, each tile passes through an in-line tile flipping station 298 which can flip every other tile so that tiles are stacked face to face or back to back at a robotic palletizing or stacking station 300. Although it is not shown, it is understood that the range or line of FIGS. 1-3 may include an in-line edge or tip shear station wherein, for example, the tips of a cut pile faced carpet tile are sheared prior to being palletized. In accordance with the example shown in FIG. 3, tiles may be removed from one of the conveyors 290 or 294, tip sheared, and then placed back onto the conveyor as desired. Alternatively, tiles may be stacked on to pallets by the robotic stacker 300, taken to an off-line tip shearing operation, tip sheared, repalletized, packaged and shipped.

The stacked tiles 252 pass to a pallet wrapping station 302 where, for example, a pallet of stacked tiles, for example 80 carpet tiles, is shrink wrapped (or sleeved and capped then wrapped) and then shipped to a customer, warehouse, or the like. The range of FIGS. 1-3 of the drawings includes a plurality of treatment stations which afford one the opportunity to treat tiles or blanks with steam, wet out, water, stain blocker, soil release agents, bleach resistant agents, fluorocarbons, anti-bacterial agents, and/or the like. Should one or more of these treatments require steaming, they can be accomplished in treatment station 270. Should one or more of these treatments require heat, they may be accomplished in one of the treatment stations 274 or 280 upstream of dryer 282. Although it is not shown in FIG. 3 of the drawings, it is contemplated that one may add a post treatment station following cooling station 286, singulating device 288 or the like.

Figure 4:
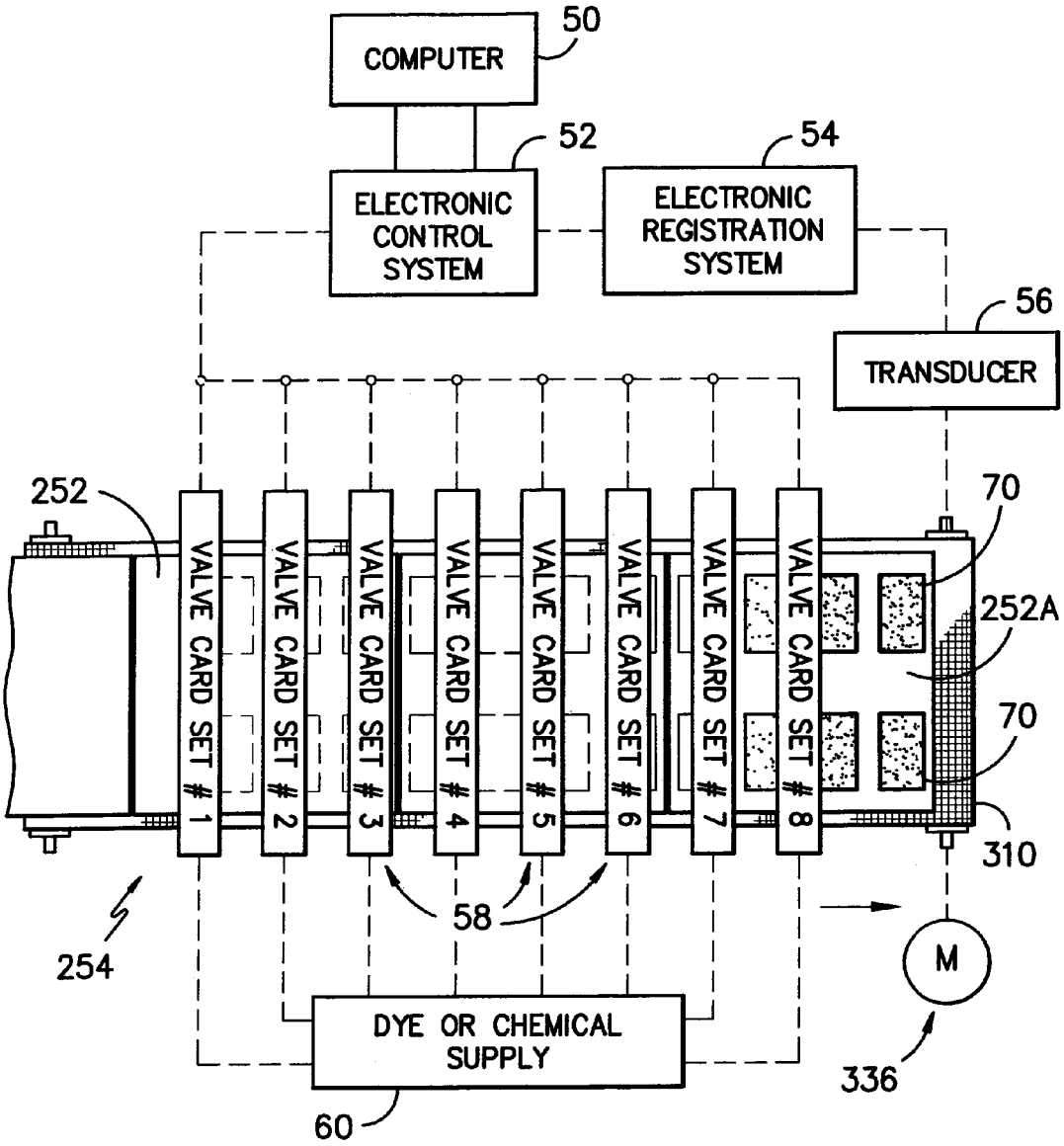
FIG. 4 is a schematic plan view representation of the PREF patterning device of FIGS. 1 and 1A.

With reference to FIG. 4 of the drawings, there is shown a schematic representation of a PREF patterning device 254. Also, included in this view are block representations of a computer system 50 associated with an electronic control system 52, an electronic registration system 54, and a rotary pulse generator or a similar transducer 56. The collective operation of these systems results in the generation of individual "on/off" actuation commands that control the flow of fluid from individual jets in valve cards arranged in valve card sets or arrays 58. The jets dispense fluid on substrate 252 in a controlled manner. A preferred particular control system for the PREF patterning device is described below with reference to FIGS. 22-29. By way of example only and not limitation, other control systems are described in U.S. Pat. Nos. 5,984,169, 5,128,876, 5,136,520, 5,140,686, 5,142,481, 5,195,143, 5,208,592, 4,033,154, 4,545,086, and 4,984,169, each of which is hereby incorporated by reference herein.

Valve card sets or arrays 1-8 of FIG. 4 receive dye and/or chemicals from dye or chemical supply 60. For example, valve card sets 1 and 2 may receive selective chemicals while valve card sets 3-8 may receive selected dyes such as red, green, yellow, blue, black, brown. Further, motor 336 is controlled by control system 52 in order to convey the substrates 252 under and past each valve card array 58 and produce a dyed substrate 252A having dye patterns, designs, or colors 70 thereon. It is preferred that substrates 252 be continuously conveyed past the valve card arrays at a set speed, for example, 20 feet per minute, 40 feet per minute, or 80 feet per minute or more. Although it is not preferred, the substrates may be indexed past valve card arrays 58. Still further, although FIG. 4 depicts a patterning machine with fixed dye heads (substrate is moved), it is to be understood that the substrate may be held still and the valve card sets or arrays moved across or over the substrate.

Although FIG. 4 only shows eight exemplary valve card sets or arrays 58, it is to be understood that the PREF patterning device 254 may include any number of such valve card sets with any number of valve cards in each set. In accordance with one particular example, the patterning apparatus 254 of the present invention has 24 valve card sets with 2 to 4 of the sets being chemical valve card sets and the remaining 20-22 valve card sets being provided with either a dye such as a colored dye, a clear dye or a diluent. In accordance with another example of the present invention, the patterning machine or device 254 includes 32 valve card sets with two of the valve card sets, the first and second valve card set being chemical valve card sets while the remaining valve card sets 3-32 are dye valve card sets or arrays for color dyes, clear dyes, diluents, dye blends, or the like.

Figure 5:
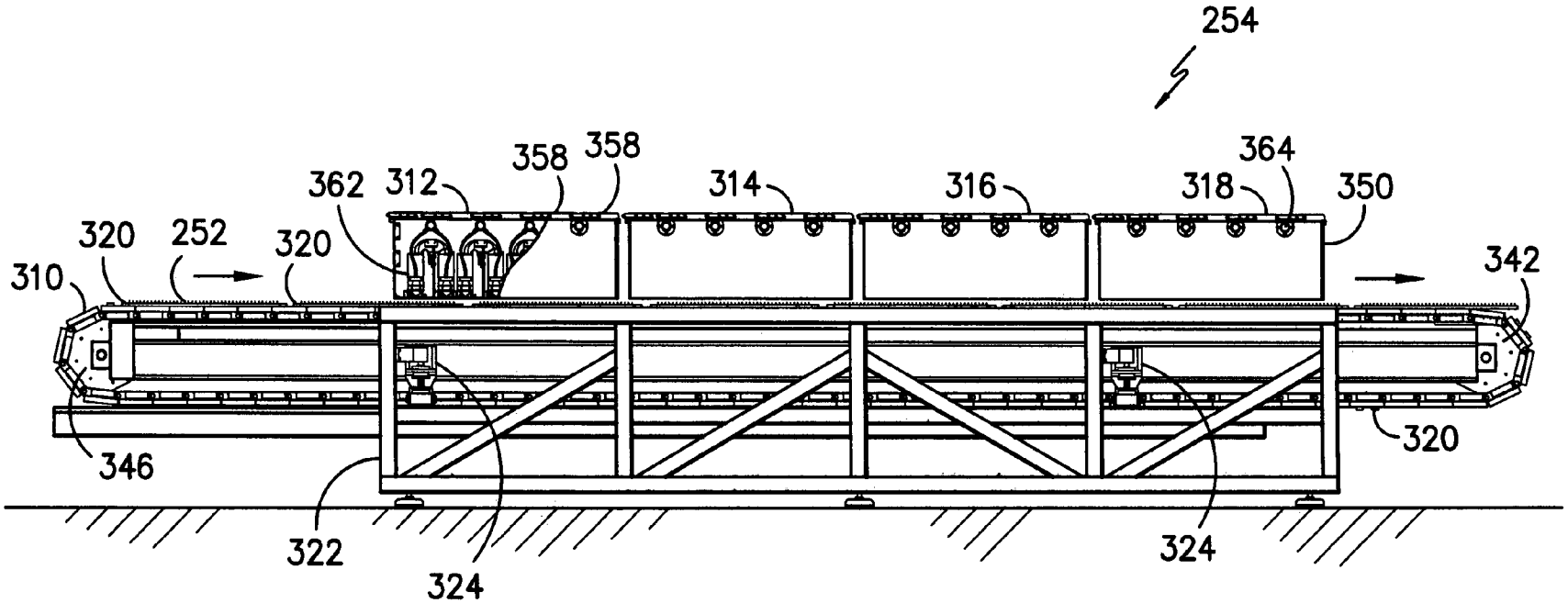
FIG. 5 is a side view illustration of the PREF drop-on-demand or direct jet patterning device or apparatus in accordance with an exemplary embodiment.
Figure 6:
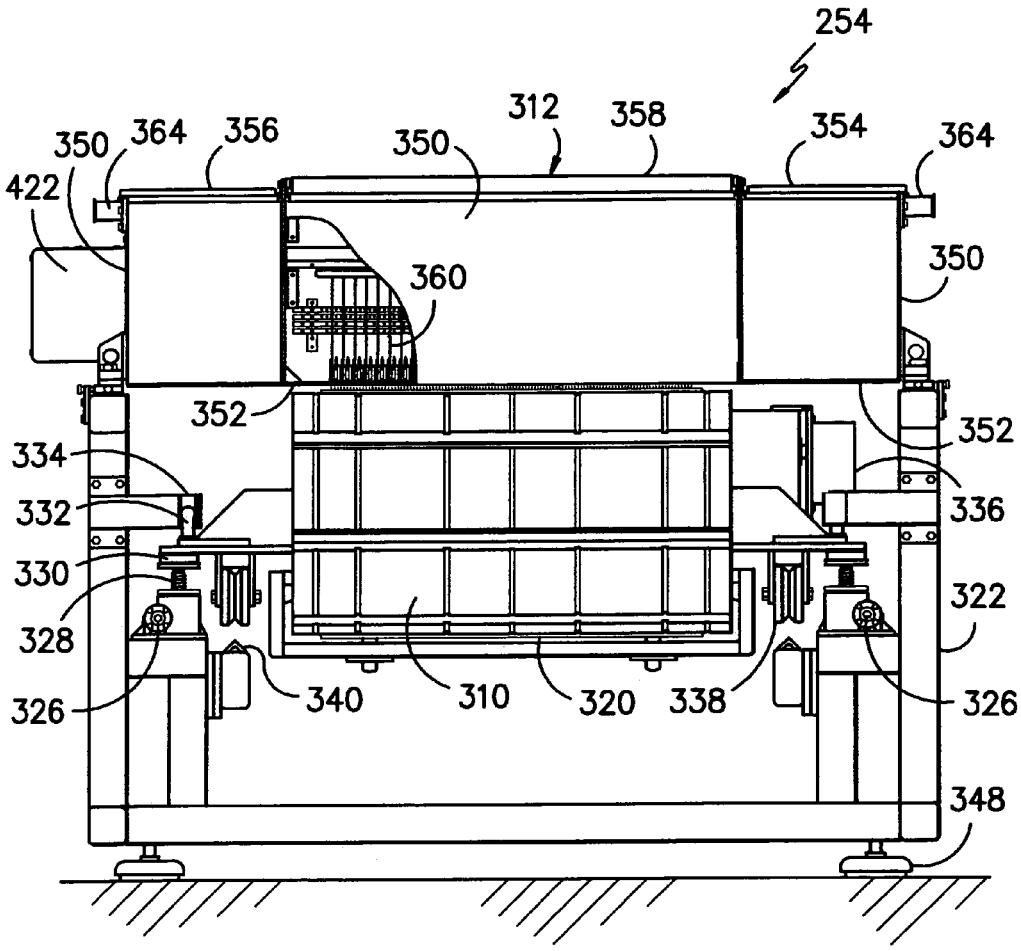
FIG. 6 is an end view illustration of the PREF patterning device of FIG. 5.

With reference to FIGS. 5 and 6 of the drawings and in accordance with a particular embodiment or example, a PREF patterning device, direct jet or drop-on-demand type jet dyeing machine or textile patterning machine 254 conveys a plurality of carpet tiles, substrates or blanks 252 atop a conveyor 310 located below and approximate to a plurality of valve card boxes or sections 312, 314, 316, and 318 each of which are shown to house eight valve card sets or arrays 362 (58) for a total of 32 valve card sets. The conveyor 310 includes a plurality of separator bars, slats or spacers 320 which insure that each of the carpet tiles 252 is located in the proper position on conveyor 310 as it is processed under each of the valve card sets 1-32. The valve card sections 312, 314, 316, and 318 are supported by a support structure 322. The conveyor 310 is supported by a plurality of powered height adjustment units 324 each including a servo motor 326 used to raise and lower a support screw 328 which supports a pad 330 which serves to raise or lower the conveyor 310 in response to electrical drive signals sent to servo motors 326. Each of the units 324 are supported by structure 322.

The gap between jets of each of the valve cards and the substrate to be patterned or dyed can be controlled from a remote location by electrical signals to each of servo motors 326. Proper positioning of the conveyor 310 relative to sections 312, 314, 316, and 318 is controlled by having rods or members 332 ride up and down in cylindrical members or openings 334 which provide for a large variation in gap between the valve card jets and the substrate, for example, a gap of up to about 2 inches, preferably one-eighth of an inch to 1 inch, more preferably one-eighth of an inch to one-quarter to an inch. Servo motors 326 provide for an automated adjustment of the gap between the jets and the substrate to account for the different pile heights of different substrates, textured substrates, and the like.

Conveyor 310 is driven by motor 336 in response to signals from control system 52. Motor 336 provides drive to one of end wheels or sprockets 342 and 346. Conveyor 310 is designed to be lowered down away from valve card sections 312, 314, 316, and 318 by lowering pads 330 which lowers a plurality of grooved wheels 338 down onto respective pointed tracks 340. Once the grooved wheels 338 are resting on tracks 340, the conveyor 310 can be moved out from under the valve card set sections for servicing, maintenance, replacement of conveyor sections, removal of jammed tiles, or the like.

Pins or elements 332 are short enough that when support pads 330 are lowered sufficiently to allow rollers 338 to contact tracks 340 that the pins 332 are free of channels 334 and conveyor 310 is free to be moved along tracks 340. Conveyor 310 is self-contained except for electrical connections or cables and as such can be moved along tracks 340.

Although the conveyor 310 is shown adapted for use with carpet tiles, it is to be understood that the conveyor may be modified or replaced with a conveyor which is adapted for use with broadloom, floor mats, area rugs, runners, or the like. For example, the registration slats or bars 320 may be removed to adapt the conveyor 310 for use with broadloom substrate.

Support structure 322 rests atop a plurality of adjustable resilient support feet 348 which tend to reduce noise and vibration. Also, support pads 330 may be somewhat resilient and may tend to reduce noise and vibration.

Each of valve card boxes or sections 312, 314, 316, and 318 include a plurality of side walls 350, a bottom plate 352, top plates 354 and 356, and a plurality of hinged lids or plates 358 which provide access to the interior of the sections for insertion, removal, or inspection of particular valve cards. It is preferred that the plates 354 and 356 and the lids 358 be of sufficient strength so that they support the weight of an operator walking around on top of the apparatus or machine 254.

Figure 17:
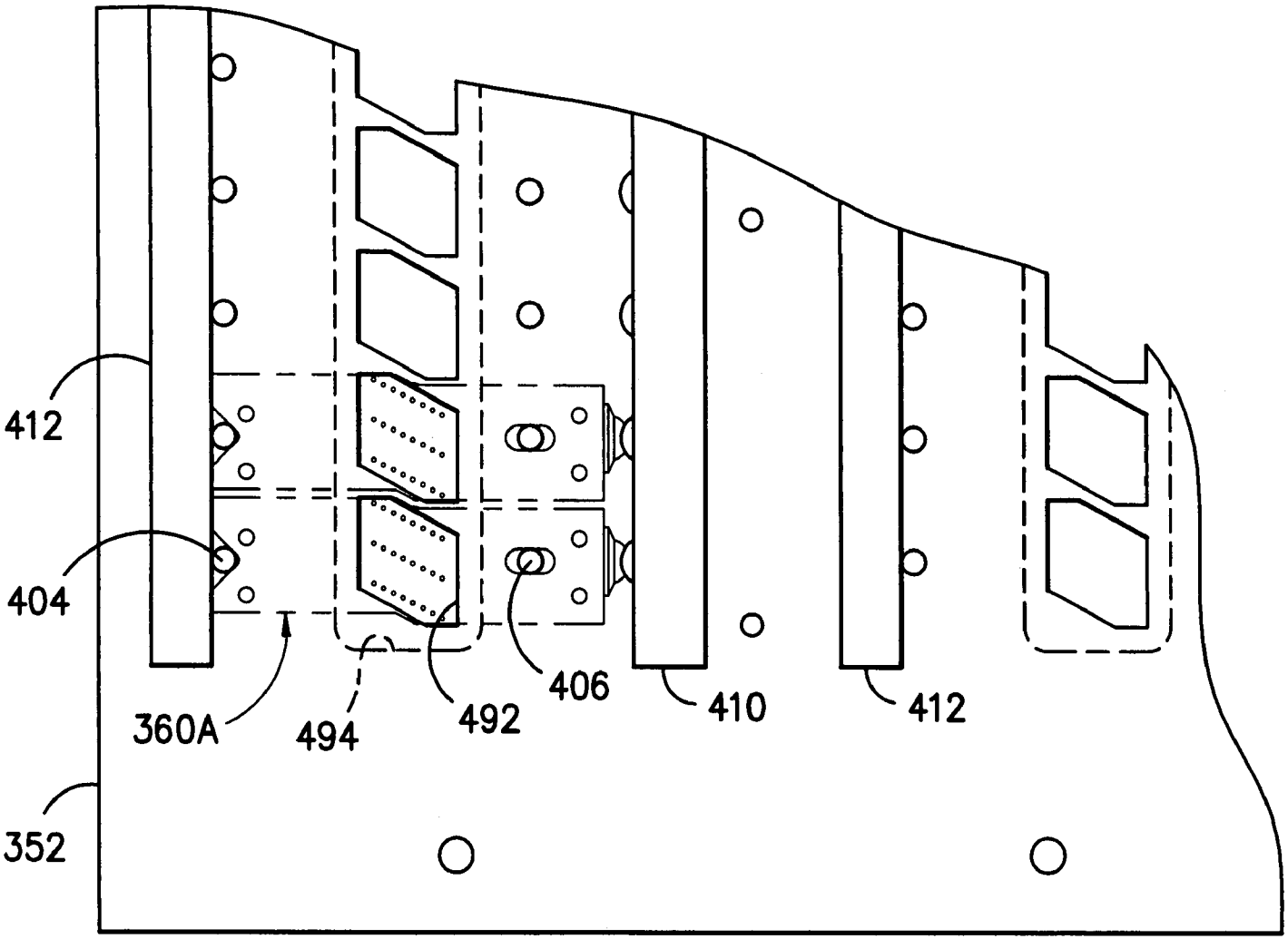
FIG. 17 is a top view representation of a portion of the base plate of the valve card section of FIG. 7.
Figure 18:
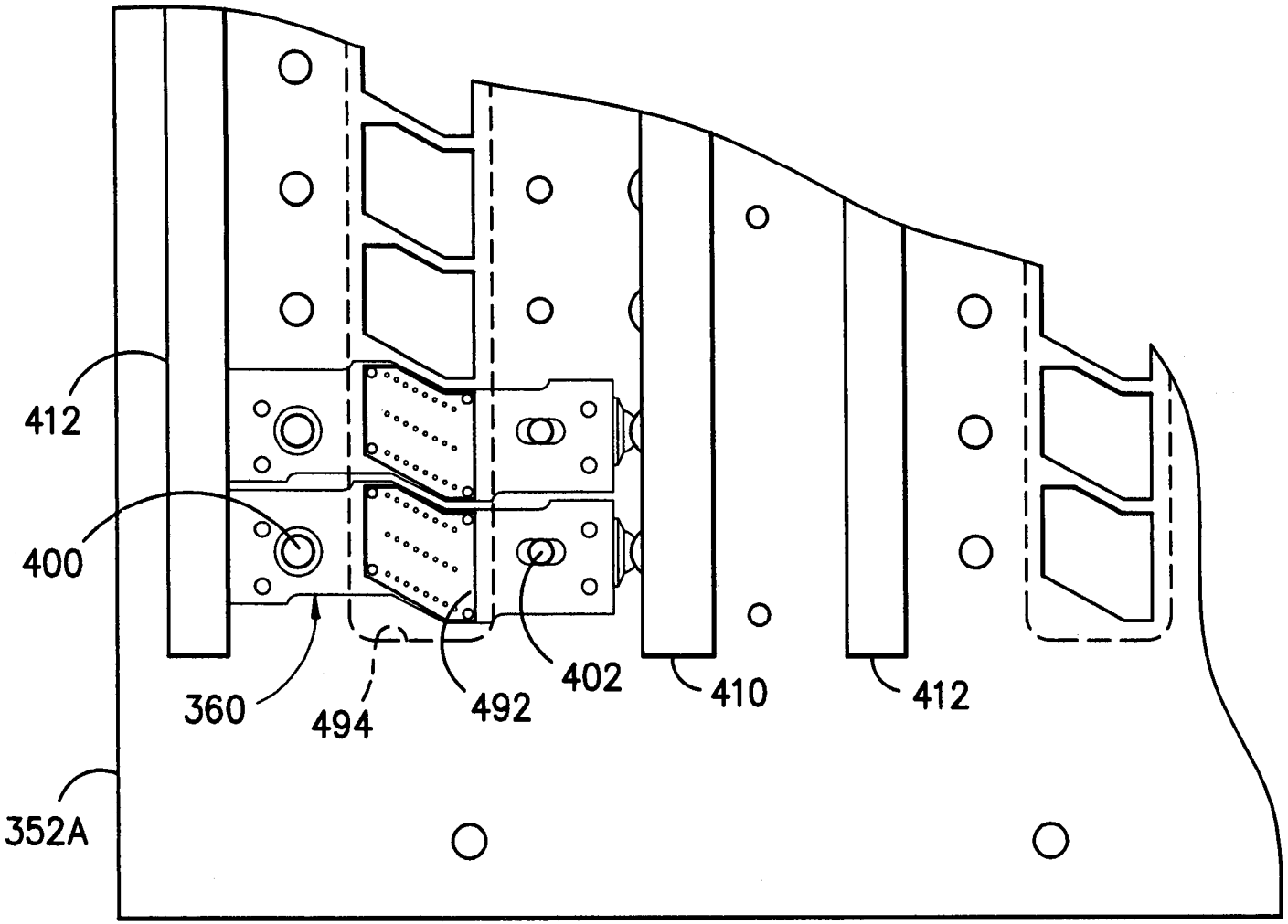
FIG. 18 is a top view representation of a portion of the base plate of the valve card section of FIG. 8.

Bottom plate 352 is preferably precisely machined and includes a plurality of openings which receive the protruding jets or jet arrays of each of the valve cards as well as any protective pins which extend alongside the jet array of each valve card as will be described below with respect to FIGS. 17 and 18.

With reference to FIG. 6, a partial cut-away of side or end plate 350 of valve card box or section 312 shows a plurality of valve cards adjacent one another in an operative position within the box or section 312 and forming a valve card set or array 58 or valve card set or array number 1 of patterning machine 254. For sake of discussion, when viewing the machine 254 from the front or from the end which receives substrates 252, the left-hand most valve card of the first valve card set or array is valve card 1,1 and the number 1 jet of valve card 1,1 is jet 1 of the patterning machine.

Figure 12:
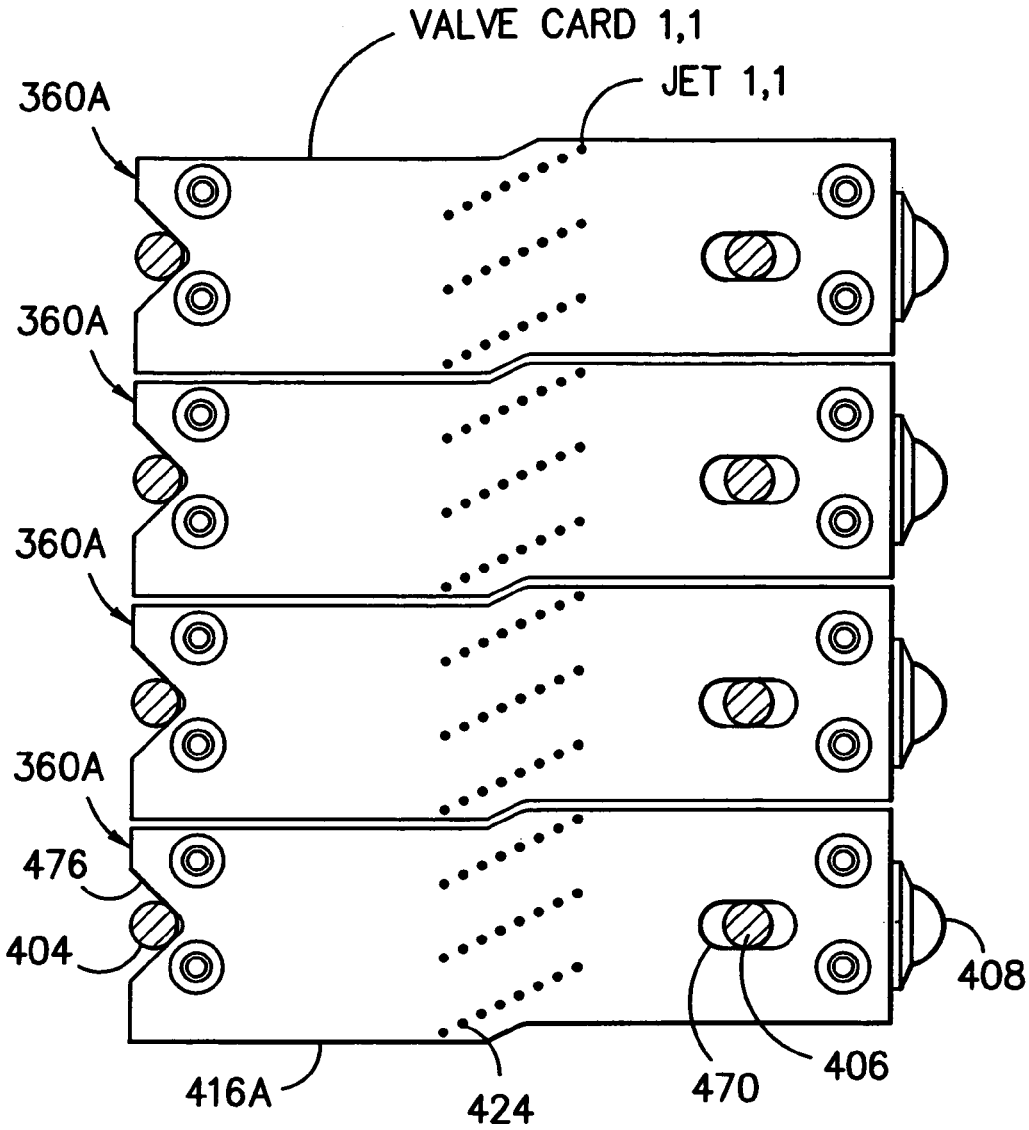
FIG. 12 is a bottom view representation of a plurality of valve cards in accordance with an alternative exemplary embodiment, aligned as they would be in a valve card set or array in a PREF apparatus like that shown in FIGS. 5 and 6.
Figure 13:
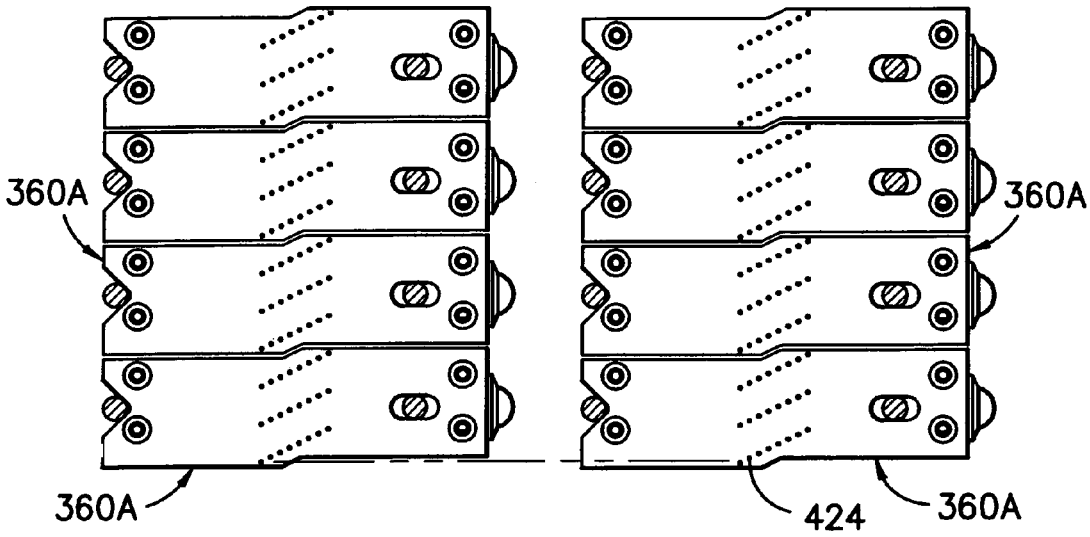
FIG. 13 is a bottom view illustration of a portion of two valve card sets or arrays of the valve cards of FIG. 12 arranged with the jets being off-set from one another.
Figure 13A:
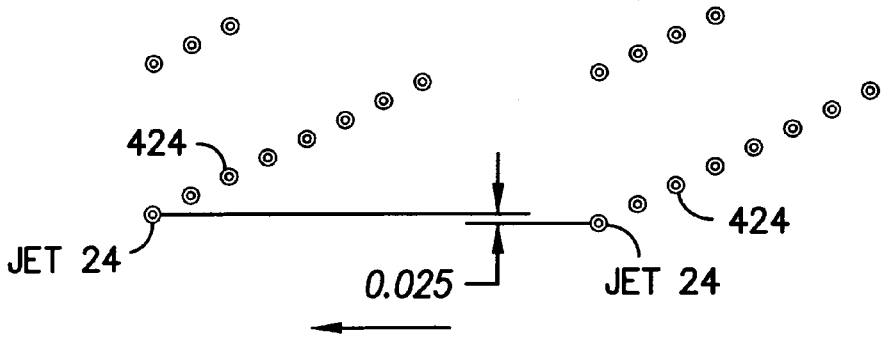
FIG. 13A is an enlarged representation of a portion of the jets of two of the valve cards of FIG. 13 showing that the valve cards are offset by half the distance between the jets so that the trailing valve card has jets offset from the leading valve card.

With reference to FIGS. 5-7, 12, 13, 13A, and 17 of the drawings, a particular arrangement is shown such as a 40 gauge (0.025 inch or 0.0635 cm) arrangement wherein a single fluid conduit or manifold 364 feeds each of the valve cards of two adjacent valve card sets or arrays so that each of these adjacent valve card sets carries the same dye and/or chemical agents. As shown in FIGS. 13-13A, the adjacent valve card sets can be offset from one another so that a first valve card jet array with the jets spaced, for example, at 20 gauge, that is 1/20 of an inch (0.05 inch or 0.127 cm), is offset from a second valve card jet array by one-half of the gauge of the jet array (0.025 inch or 0.0635 cm) to produce a resultant 40 gauge (0.025 inch or 0.0635 cm) arrangement. In other words, patterns, designs, colors, images, or the like can be created with 40 gauge or higher resolution using valve cards with jets set at 20 gauge by offsetting selected arrays of valve cards.

Figure 7:
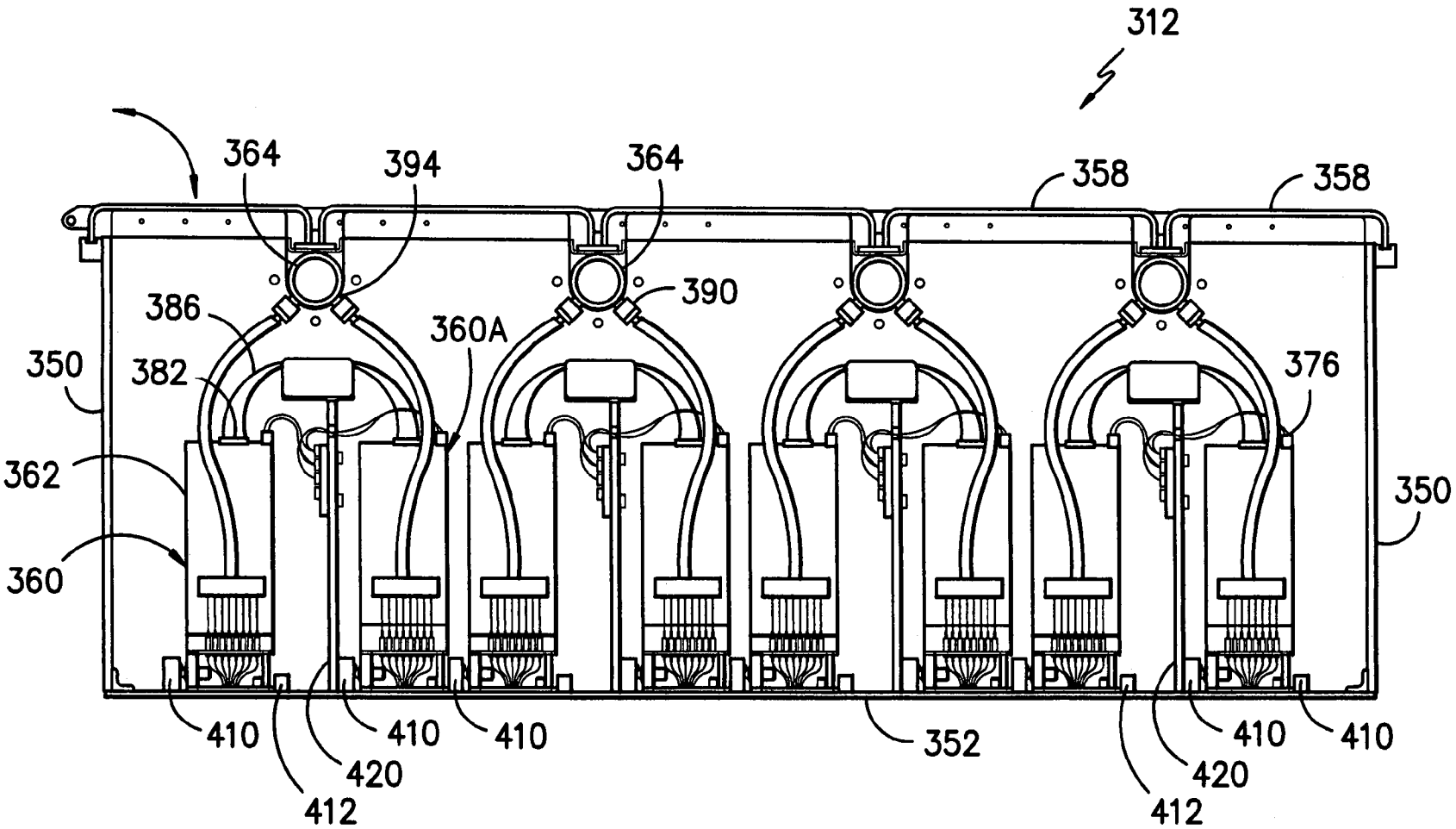
FIG. 7 is a cross-section representation of one section of the PREF patterning apparatus of FIGS. 5 and 6 in accordance with a first embodiment thereof.

Although FIGS. 5 and 7 show a 40 gauge arrangement or an arrangement where a single dye or chemical is fed to two adjacent valve card sets, it is to be understood that as shown in FIGS. 8, 10, 11, 11A and 18 that each valve card set can be fed from a separate fluid manifold or conduit 364 with each of the jet arrays of each of the valve cards of adjacent sets of valve cards being aligned to, for example, provide a 20 gauge (0.05 inch or 0.127 cm) arrangement in resolution for patterning or dyeing. This provides for an additional capacity for dyes or chemicals in that each valve card set or array may have its own independent color, chemical, or the like. It is to be understood that the PREF patterning device 254 of the present invention may produce patterns in any selected gauge by, for example, placing the jets at the desired spacing, using selected jets, offsetting valve card sets and the like. For example, one can produce 10 gauge (0.10 inch or 0.254 cm) patterns by spacing the jets for 10 gauge or by using every other jet in a 20 gauge jet arrangement.

With reference to FIG. 9, it is preferred that each of valve cards 360 be easily inserted, installed, removed, or replaced within each valve card box or section 312, 314, 316, 318. One installs a valve card 360 by simply lifting the lid 358, and inserting the valve card (in a vertical orientation) into its respective space or seat in base plate 352 (or 352A). Next, one attaches a power and identification (ID) cable 376 via a quick connect plug or head 378 adapted to be releasably received in a jack or receiver 380 (much like a telephone plug is adapted to be received in a telephone jack). Also, one attaches a valve control cable 386 via a connector 382 adapted to be received in a quick connect and disconnect receiver or socket 384. The valve control cable receiver 384 includes right and left pivoting end clips 388 which provide for quick connection and disconnection of the valve control cable 386. The remaining item to be connected to complete the hook up of the valve card 360 is a fluid quick connect with shut off coupling 390 on the end of a fluid tube or hose 392 which is adapted to be connected to a mating quick connect element 394 extending from manifold 364. The coupling 390 and hose 392 provide operative fluid connection between the valve card 360 and the manifold 364. Each valve card location within the patterning machine 254 has its own valve control cable 386 and power and ID cable 378. In this way, the machine control system can individually direct each jet (valve) of each valve card to fire as desired.

In accordance with the particular embodiment shown, one is able to insert and connect a new valve card into a selected valve card location within the valve card box or section within a matter of seconds. Likewise, one is able to remove a valve card should it be necessary for maintenance or replacement of a faulty or damaged valve card in a matter seconds by disconnecting coupling 390, connector 382, and plug 378 from their respective mating connectors or sockets and then pulling the valve card from its seat or location in base plate 352 or 352A.

In accordance with one example of the present invention, the speed of processing through the patterning device or machine 254 may be doubled or substantially increased by doubling up on the same color, that is, for example, using an arrangement like that of FIG. 7 wherein the same color is supplied to two adjacent valve card sets but having the jets of the adjacent valve card sets aligned as shown in FIG. 11A so that one can apply two drops of the same dye or chemical onto the same pixel or location on the substrate. Consequently, one can halve the minimum drop volume applied by each jet of the adjacent valve card arrays and thereby total 100% of the minimum drop volume for that particular substrate, dye, chemical, chemistry, or the like. This can also be done by having two manifolds 364 of FIG. 8 being filled with the same dye, chemical agent, chemistry, or the like. Also, it is to be understood that different colors may be applied over one another for shot-on-shot blending, different colors may be applied next to each other for shot-by-shot blending, and the like.

With reference to FIGS. 7-13, 17 and 18 of the drawings, each of the valve cards 360 is positioned very accurately within its valve card seat or location in base plate 352, 352A by a plurality of pins 400 and 402 or 404 and 406, a spring loaded locking ball 408 and a locking ball receiver bar 410, and a positioning bar or post 412 which rides against a flat edge 414 of base 416 or by having the flat edge 414 ride against the flat back of a locking ball receiver 410.

Preferably, each of the manifolds or fluid conduits 364 passes through the valve card set box or section 312, 314, 316, 318 and extends outwardly from at least one side wall 350, preferably both side walls 350, to provide for easy connection of dye or chemical supply thereto on one or both ends thereof or for connection of dye or chemical supply to one end thereof and provide the other end to be used for flushing or cleaning out of the manifold 364.

Each of the valve card boxes or sections 312, 314, 316, 318 also includes a plurality of power and control support plates or boards 420 which support connectors or distribution components for each of the valve control cables 386 and power and ID cables 376. With reference to FIG. 6 of the drawings, pattern machine 254 includes an extended enclosure 422 on at least one side thereof to provide a space for electrical components, cables, connections, and the like from, for example, electronic control system 52, electronic registration 54, and/or transducer 56 to each of the valve control cables 386 and power and ID cables 376. In accordance with one example, a one meter wide patterning apparatus includes 35 valve cards per valve card array or set, has 32 valve card sets for a total of 1,120 valve cards (each with 24 jets), 1,120 valve control cables, and 1,120 power and ID cables.

Each of the valve cards 360 is preferably a self-contained or all inclusive valve card assembly including electronics, power, fluidics, valves, jets, and the like which preferably provide for precise and accurate deposition of selected quantities of fluid onto a substrate passing under the jets 424 of each of the valve cards 360. Also, the valve cards have the jets 424 arranged in staggered angled rows or columns of jets which provides for a compact arrangement of valve cards as well as for a high resolution or high gauge (large number of jets), for example, 20 gauge (0.05 inch or 0.127 cm) or 40 gauge (0.025 inch or 0.0635 cm) arrangement of jets. For example, the jets on each valve card of FIGS. 10 and 12 may be spaced to produce a 20 gauge or 0.05 inch (0.127 cm) resolution pattern. By placing the jets in the angled array shown, one is also able to limit the length of the valve card in the direction of travel of the substrate.

With reference again to FIG. 9, the preferably all-inclusive valve card or valve card module 360 further includes a identification (ID) board 426 that provides an electronic serial number unique to each valve card. The patterning machine control system queries the ID board 426 (via line 376) and receives a card number so that the system can track the location of the particular valve card, the history of the card, maintenance of the card, and the like. Consequently, cable or line 376 includes both electrical power and ID query lines.

Power is transferred by power line 428 over to a noise filter 430 on a main board 432 of valve card 360. Main board 432 also includes electronic components for control of each valve, including resistor packs 434, integrated circuits (ICs) 436, zener diodes 438, diodes 440, and the like which provide electronic control signals for selectively operating or actuating (opening) each solenoid valve to allow fluid or liquid such as dye or chemicals to be dispensed from the selected jet corresponding to that particular valve. In accordance with the particular example shown in FIGS. 9, 10 and 12, there are 24 valves and 24 corresponding jets per valve card. In this way, each valve card provides a fixed array of individually controlled dye dispensers or applicators. Also, a plurality of aligned valve cards, a valve card set or array, preferably spans the width of the entire substrate and serves as an applicator bar or color bar.

Although the valve cards shown in FIGS. 9-13 each have 24 jets (and 24 valves), it is contemplated that one could have any number of jets per valve card, for example, 8, 16, 20, 24, or the like depending on the resolution desired, the drop volume desired, the substrate being dyed, whether or not the jets of each array are angled, whether the valve cards are aligned with one another, and the like. The shown valve cards with jets spaced for 20 gauge (0.05 inch or 0.127 cm) patterning of the present invention are novel, unique in the industry, and provide for a substantially true 20×20 gauge resolution on pile carpet.

With reference to FIGS. 9 and 14-16, valve card or valve card module 360 further includes a dye or fluid manifold 442 which receives fluid from hose 392 and distributes it to twenty-four manifold outlets 443 which are each respectively connected to a manifold to valve tube 444 which is received over an upper valve tube or inlet 446 of valve 448. Each of the upper valve tubes 446 passes through a daughter board or valve connection interface printed circuit board (PCB) 450 which provides for not only support and location of the upper tube 446 of each valve, but also provides for the electrical connection between the valve control circuitry on board 432 and positive and negative electrical terminals or leads 447 and 449 on each valve. This arrangement facilitates the manufacture of the valve card as well as repair or replacement of faulty valves. Each of the valves 448 has a lower tube or outlet 452 which extends below a valve support plate 454 and receives a valve to jet tube 456 which operatively connects outlet 452 to a respective jet tube 458 of jet 424. Jet tubes 458 pass through base plate 416 and in the embodiment shown in FIGS. 9 and 10 are protected by protection pins 460.

Daughter board 450 is supported by one or more board spacers 462 and valve support plate 454 is in turn supported by a valve bracket 464 and spacers 466. Bracket 464 also supports locking ball mechanism 408. As is typical with locking ball units, locking ball 408 includes a spring which biases the ball outwardly to provide a snap fit of the valve card within its seat.

Valve card base 416 further supports a cylindrical pin receiver 468 which is adapted to receive pin 400. Base plate 416 also includes an opening or slot 470 adapted to receive pin 402. With reference to FIG. 9, each of the valves 448 is arranged in one of three off-set rows of eight valves each so that the valves are nested and provide a compact arrangement thereof.

Figure 14:
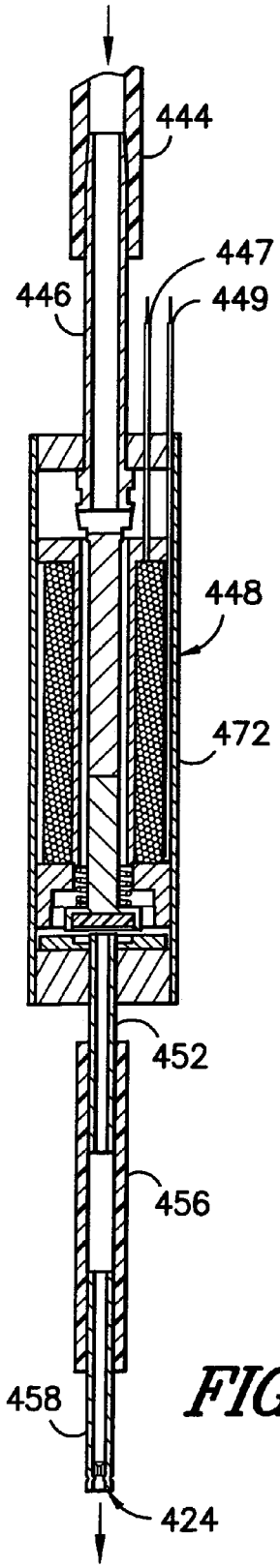
FIG. 14 is a somewhat schematic cross-section illustration of a valve, jet, and tubing arrangement (individually controlled dye applicator or dispenser) in accordance with an exemplary embodiment of the present invention.
Figure 15:
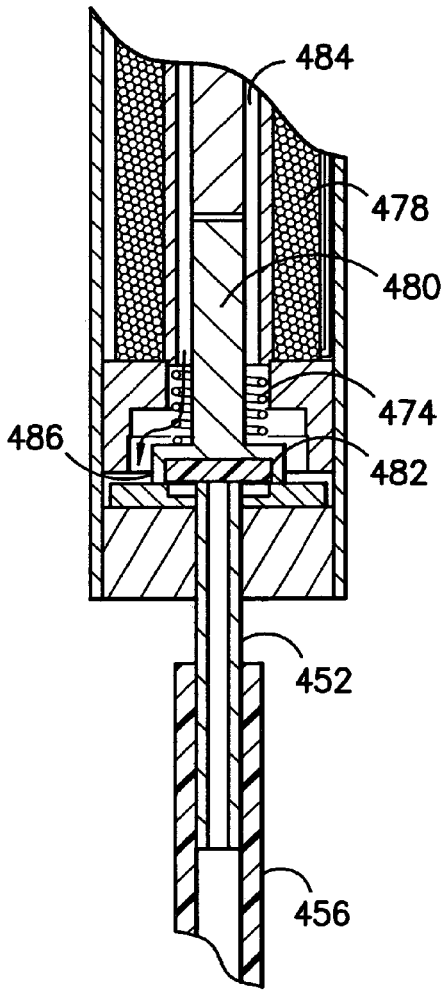
FIG. 15 is an enlarged cross-section illustration of a portion of the valve of FIG. 14.
Figure 16:
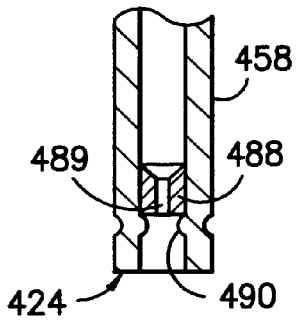
FIG. 16 is an enlarged cross-section illustration of a portion of the jet of FIG. 14.

In accordance with one particular example of the present invention, each of the valves 448 has a cylindrical valve body 472 having outer dimensions of approximately 0.83 inch in length and 0.22 inch in diameter. In accordance with the present invention, it is preferred that each of the valves be an in-line solenoid valve which is electrically actuated open and which is biased closed by a spring 474 as shown in FIGS. 14 and 15. It is preferred that the valves are in-line or flow-through valves in order to keep the valve card 360 relatively small, with, for example, outer dimensions of approximately 11-½" inches tall, 1-⅜ inches wide, and 4-¼ inches long (not including the portion of hose 392 that extends beyond the main board 432). Also, a relatively small valve size while still being adequate to provide the needed minimum drop volume for a particular substrate, also reduces energy requirements, reduces heat generation, and allows for a greater number of valves or jets, and thereby provides for increased gauge of the patterning machine 254.

Although the valve card embodiment shown in FIGS. 9 and 10 of the drawings may be a potentially preferred embodiment, an alternative embodiment of a valve card 360A is shown in FIGS. 12 and 13 of the drawings wherein a base plate 416A is adapted to receive a pin 404 in a V-slot 476 and a pin 406 in slot 470. Valve cards 360A are like valve cards 360 in that they include twenty-four jets 424 arranged in an angled array of three angled rows or columns of jets. As mentioned above, FIGS. 13 and 13A show that one can double the gauge of the machine by offsetting adjacent valve card sets relative one to another.

With reference again to FIGS. 14-16 of the drawings, it is preferred that each of the valves 448 be an electrically actuated solenoid valve having coils or windings 478 which when activated via leads 447, 449 move a valve shaft or member 480 from the closed position shown in FIG. 15 to the open position shown in FIG. 14 against the bias of spring 474. This moves a resilient valve seat 482 away from tube 452 to allow fluid to flow under pressure through valve 448 and into tube 452. In particular, liquid such as dye or chemical agents flow through tube 446, through an annular passage 484, through and around spring 474, around member 480, between seat 482 and tube 452, and into tube 452. Member 480 includes a socket or receiver 486 which receives resilient seat 482. In accordance with one embodiment, shaft 480 is formed of 430F stainless steel and resilient seat 482 is formed of EPDM rubber.

In the valve closed position of FIG. 15, fluid such as dye, chemical agents, air, or the like is not allowed to pass through valve 448 and as such no fluid or liquid is dispensed or ejected from jet 424. Any liquid in tube 452, tube 456, and tube 458 above jewel orifice 488 is held in place by capillary action. When the valve is open as shown in FIG. 14, fluid passes through tube 452, through tube 456, through jet tube 458, through orifice 489 of jewel orifice 488, and out of jet tube 458 of jet 424. As valve 448 may be actuated very quickly, a small drop or amount of liquid may be ejected from jet 424. Also, it is to be understood that the valve 448 may be held open for quite some time to allow a stream of fluid to be dispensed from jet 424.

Jet tube 458 includes a plurality of nubs 490 or an annular nub which retains jeweled orifice 488 within jet tube 458. The inner diameter of the jet tube 458 is not critical as the orifice 489 of the jeweled orifice 488 determines the liquid dispensed out of the jet 424 along with the firing time, viscosity, chemistry, and the like.

In accordance with the present invention, it is preferred that the jet 424 include a precision crafted jeweled orifice 488 so as to provide a substantially splatter-free valve jet in that fluid is dispensed or ejected from the jet by being forced through the orifice 489 rather than out the end of jet tube 458. Although it is preferred that the jet 424 include jeweled orifice 488, it is contemplated that one may remove the jeweled orifice 488 or replace it with an orifice plate or other restriction.

In accordance with one particular example of the present invention, the jeweled orifice has an exit opening or orifice 489 with a diameter of about 0.02 inch or less. In accordance with a particular example of the present invention, tube 444 has a 0.05 inch inner diameter and a 0.09 inch outer diameter, tube 456 has a 0.032 inch inner diameter and a 0.09 inch outer diameter, tube 444 has a tube length of 1.23 inches, and each of tubes 456 has a sufficient length to provide connection between respective pairs of the tubes 452 and jet tubes 458.

With reference to FIG. 9 of the drawings, not all the valve-to-jet tubes 456 are shown in their entirety for the sake of clarity and to show a portion of the back of the base plate 416. Nevertheless, it is to be understood that each of the valve outlet tubes 452 is connected to a jet tube 458 by a respective tube 456.

In accordance with one example of the present invention, it is preferred that the fluid supplied to hose 392 and dye manifold 442 of valve card 360 or valve card 360A be supplied at a pressure of between about 15 and 35 psi, more preferably about 25-30 psi, and most preferably at a constant pressure of about 30 psi. By supplying the fluid at a constant pressure, one can provide for more accurate drop volumes or wet pickup of fluid on the substrate.

In accordance with a particular example of the present invention, each of the valves 448 meets the following valve specification:

Exemplary Valve Specification

This example defines the design, performance, and test specifications for the preferred valve. Specifications are defined where appropriate for the individual valve, as well as for the valve card modules.

1.0 Design and Performance Specification

This section defines the parameters that affect the valve design as well as expected performance of the valve and valve card module.

1.1 Flow Media

The valve is designed to operate with the following flow media:

Media: Aqueous Solutions, Dispersions, and Emulsions
Viscosity: 1-1300 centipoise (Brookfield LVT #3 @ 60 rpm)
pH: 3.0-12.0
Specific Gravity: 0.95-1.05
Filtration: 5 micron nominal
Temperature: 5-45° C.
Operating Pressure: ≧40 psig 1.2 Electrical The solenoid actuation system is designed to operate under the following conditions:

HSD Pulse Voltage: 45.6-50.4 VDC
HSD Pulse Duration: 237.5-262.5 microseconds
Holding Voltage: 2.7-3.3 VDC
Power Dissipation: 600 milliwatts (42 ohm coil)
where: HSD=High Speed Drive.

1.3 Exit Jewel Orifice

The jewel orifice and the jewel orifice tube are constructed to meet the following design and performance criteria:

Jewel Orifice Diameter: 0.0159-0.0161 inches
Orifice/Tube Directivity: Within 0.100 inch diameter circle at 4 inch standoff, with tube mounted in valve card module.

1.4 Machining Tolerance

The machining tolerance for valve card module base plate is ±0.001 inches unless otherwise stated.

1.5 Performance

Within the design constraints listed above, the required valve performance is specified as follows:

Design Life: $\geqq 2\times10^9$ Cycles $T_{OPEN}$: $\leqq$500 microseconds (Time for valve to fully open.)

$\Delta T_{CLOSE}$: $\leqq$1,000 microseconds (Time for valve to fully close.)

Duty Cycle: 0-100%

Leakage: None at $\geqq$40 psig (<1 drop/hour)

The individual valves are assembled onto valve card modules which contain 24 valves. Flow uniformity from valve to valve within a given valve card, as well as absolute flow is preferred for proper system performance. The following specifications define the performance of individual valves as well as the flow characteristics of the valve card module taken as a whole. For this specification a representative media is specified.

Flow Media: Kelzan S® xanthan gum

Viscosity: 700-750 centipoise (Brookfield LVT #3 @ 60 rpm)

pH: 4.5-5.0

Filtration: 5 micron nominal

Pressure: 29.7-30.3 psig

Temperature: 20-35° C.

Flow Condition: 5000 Cycles: 5.00 milliseconds ON, 1.00 milliseconds OFF

Output: $\mu_{VC}$: 17.00-22.00 grams $f_i$: $(0.95*\mu_{VC})\leqq f_i\leqq(1.05*\mu_{VC})$ where: $f_i$=output for an individual valve on a valve card module $$\mu_{VC} = \text{mean output of a valve card module}$$

$$= \Sigma f_i / 24,$$

$$i = 1, 2, \ldots, 24.$$

The above specification requires that the maximum deviation from the mean output of a valve card module by any individual valve is less than or equal to 5%. Further, the mean output of the valve card module is preferably between 17.00 and 22.00 grams for this condition.

With reference to FIGS. 7, 12-13 and 17 of the drawings, base plate 352 has a plurality of openings 492 therethrough adapted to receive each of the respective arrays of jets 424 on the base of each of the valve cards 360A. Also, base plate 352 supports respective pins 404 and 406 which serve to position the base plate 416A of each valve card 360A. Further base plate 352 supports members 410 and 412 which serve to further accurately position the valve card 360A and to provide for a quick connect and disconnect of the seating of the valve card relative to the base plate 352. Locking ball or ball plunger 408 is releasably received in a concave socket in support or receiver 410 so that the valve card 360A snaps into place in its selected seat or location in base plate 352. Base plate 352 further includes a recess on the bottom surface thereof in the area of openings 492 to provide easy access to the jets, visibility of the jets, and the like.

With reference to FIGS. 8, 9-11 and 18 of the drawings, base plate 352A includes a plurality of openings 492 to provide for the angled array of jets 424 of each of the valve cards 360. Further, base plate 352A supports pins 400 and 402 which provide for positioning of base plate 416 of each of the valve cards 360. Still further, base plate 352A supports members 410 and 412 which further provide for positioning of each of the valve cards and for a quick connect and disconnect or seating of the valve card. Like base plate 352, base plate 352A includes a recess 494 on the lower surface thereof to further accommodate the jets 424.

Each of base plates 352 and 352A are preferably precision machined items to provide for very accurate placement of valve cards in the machine and thereby provide accurate placement of the dye and/or the chemicals on the substrate to produce high resolution designs, excellent registration of one design to the next, repeatability of product, top quality, and the like.

Figure 19:
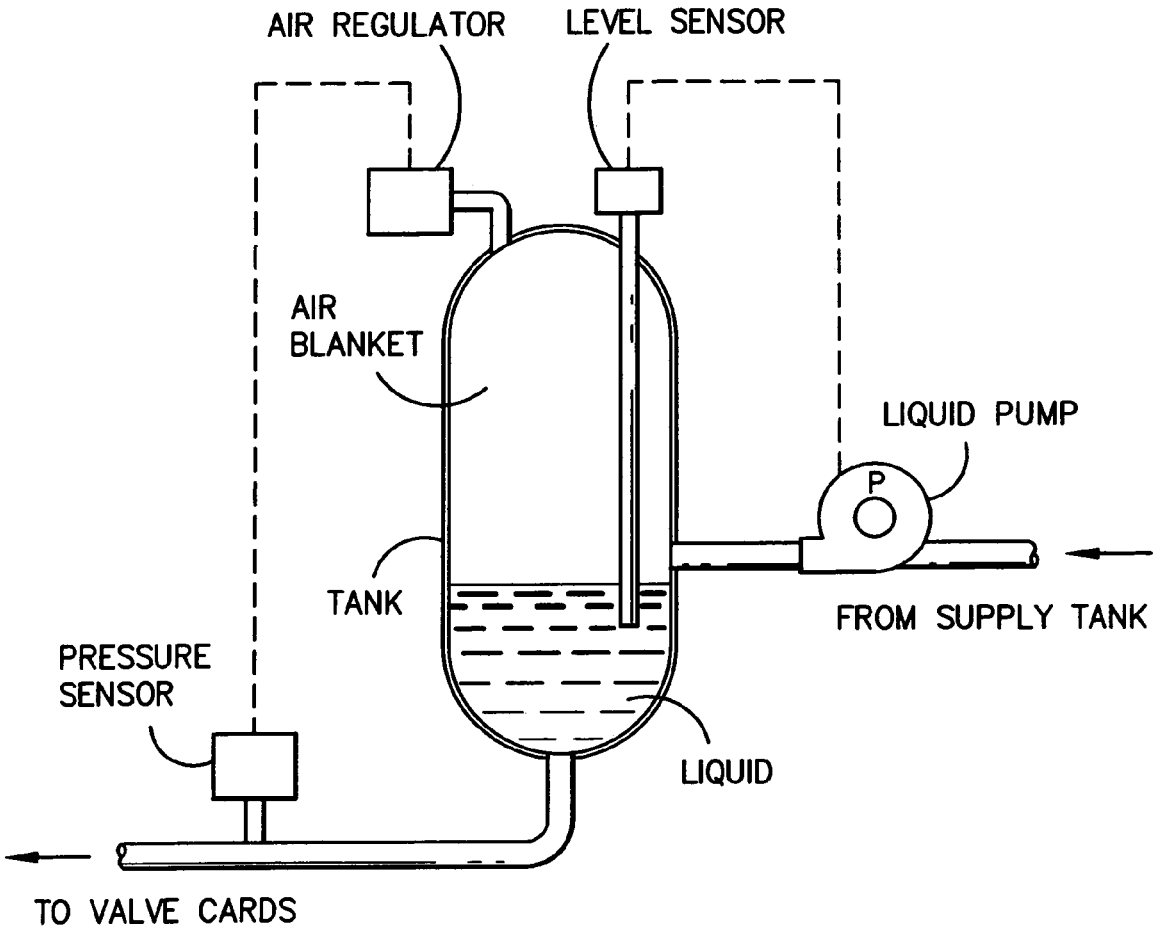
FIG. 19 is a schematic representation of an exemplary embodiment of a pressurized fluid tank for feeding dye and/or chemicals to a fluid conduit which feeds a plurality of valve cards in one or more valve card sets or arrays.

With reference to FIG. 19 of the drawings, each of the valve card sets or arrays (fixed arrays of individually controlled dye dispensers or applicators) is fed a fluid or liquid such as a dye, chemical agent, or the like from a fluid tank which preferably is kept at a constant pressure. Also, it may be advantageous to continuously agitate the fluid or liquid in the tank in order to keep it well mixed, keep the dye dispersed, and the like.

Figure 20:
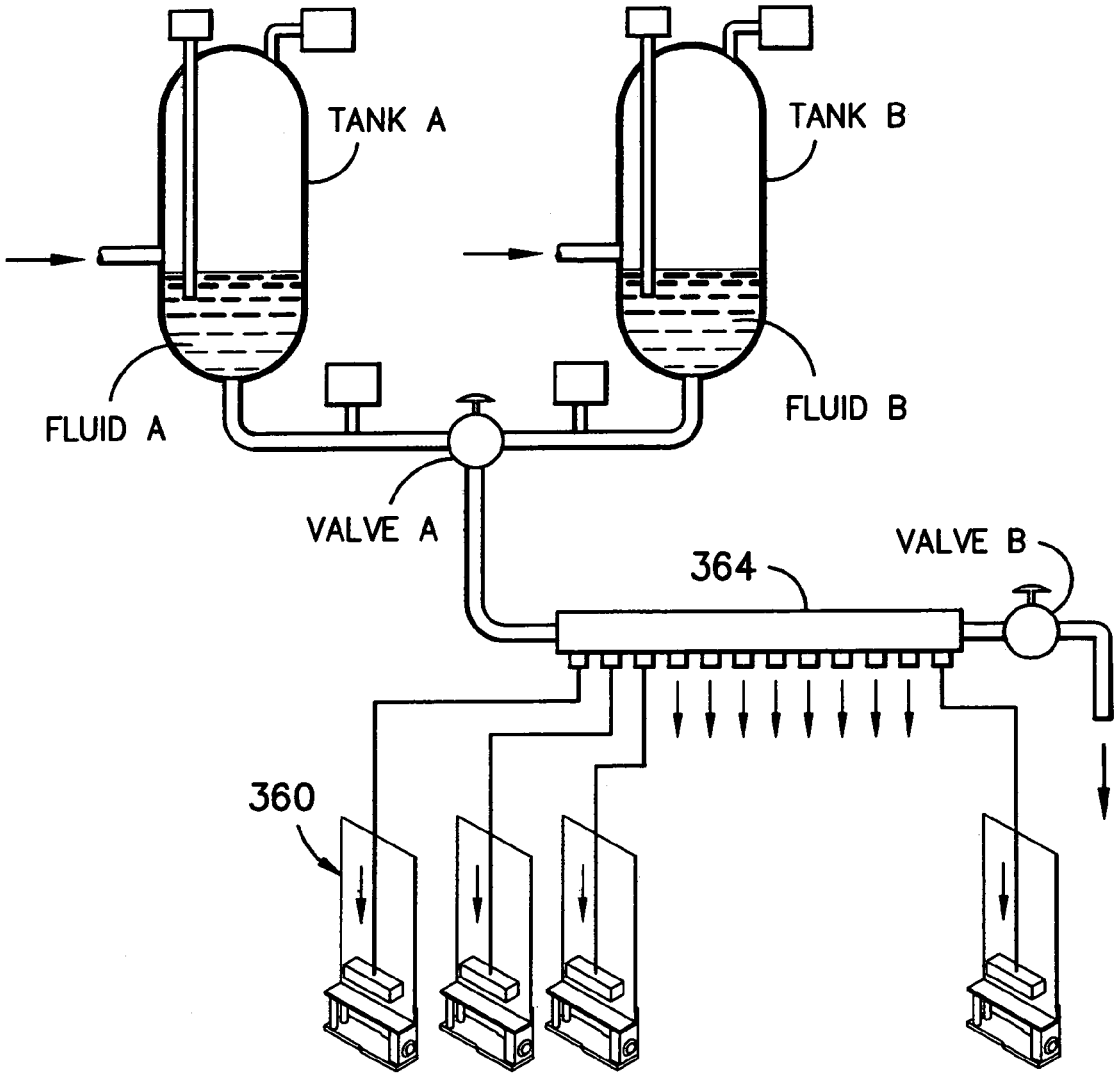
FIG. 20 is a schematic representation of a selectable multiple dye or chemical supply which feeds a particular fluid conduit for a plurality of valve cards in a particular valve card set or array.

With reference to FIG. 20 of the drawings, one may supply a particular valve card set or array from a Fluid A or Fluid B from each of a Tank A or Tank B selectively by operating a Valve A which is, for example, a 3-way valve which provides Fluid A from Tank A to fluid conduit or manifold 364, Fluid B from Tank B to fluid conduit 364, or is closed to provide neither Fluid A or Fluid B to conduit 364. When supplying Fluid A or Fluid B to conduit 364 and to valve cards 360 of one or more valve card sets, Valve B is usually closed. When flushing out fluid conduit 364 with, for example, Fluid A or Fluid B, Valve B can be opened to drain the contaminated fluid so that conduit 364 contains only the fluid of choice. Once the manifold 364 is flushed, Valve B is closed, and then the valve cards are flushed. In this fashion, one can quickly change from one color to the next or from one chemistry to the next in a particular valve card set or combination of valve card sets.

Figure 21:
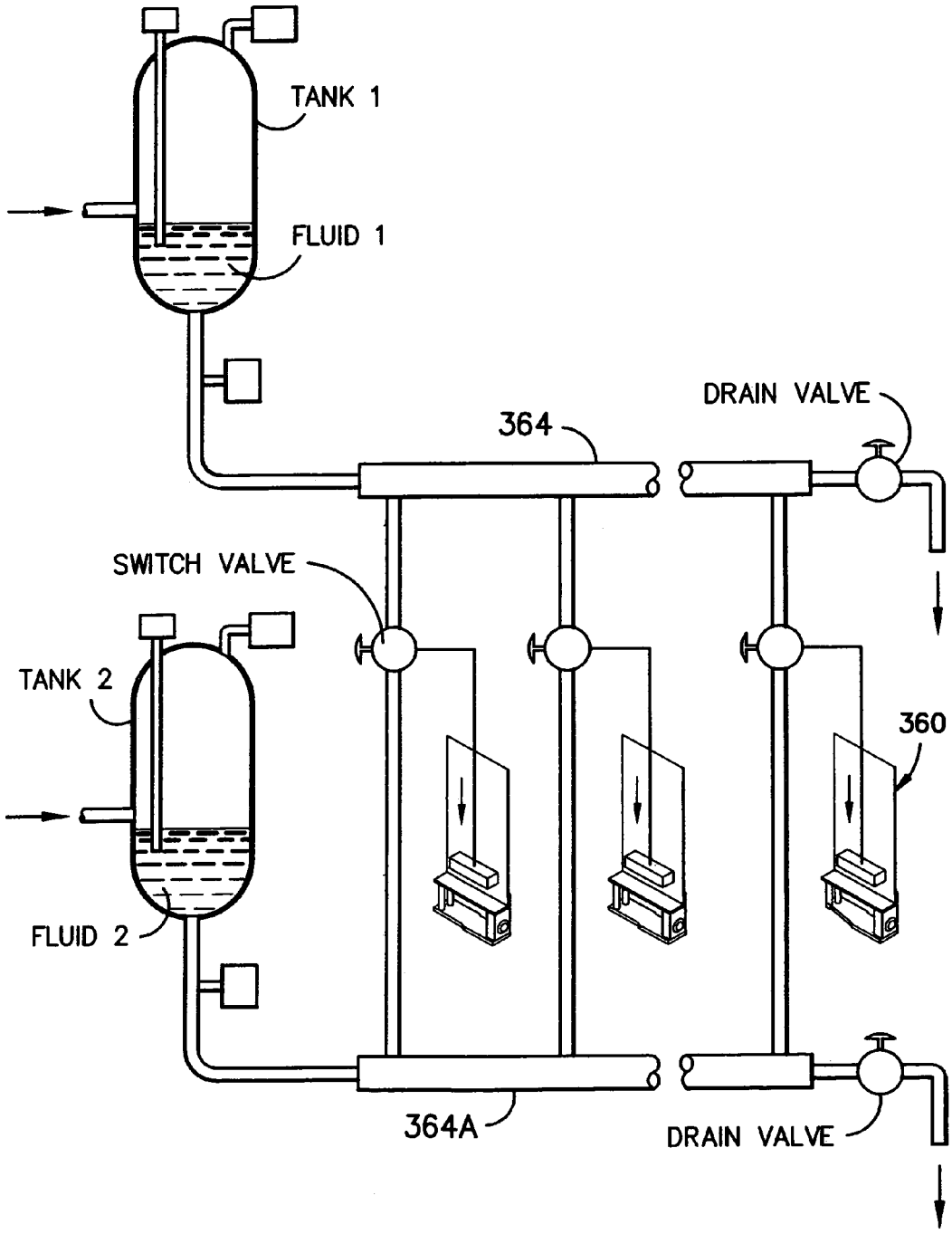
FIG. 21 is a schematic representation of a selectable multiple dye or chemical supply to a plurality of valve cards in accordance with still yet another exemplary embodiment.
Figure 22:
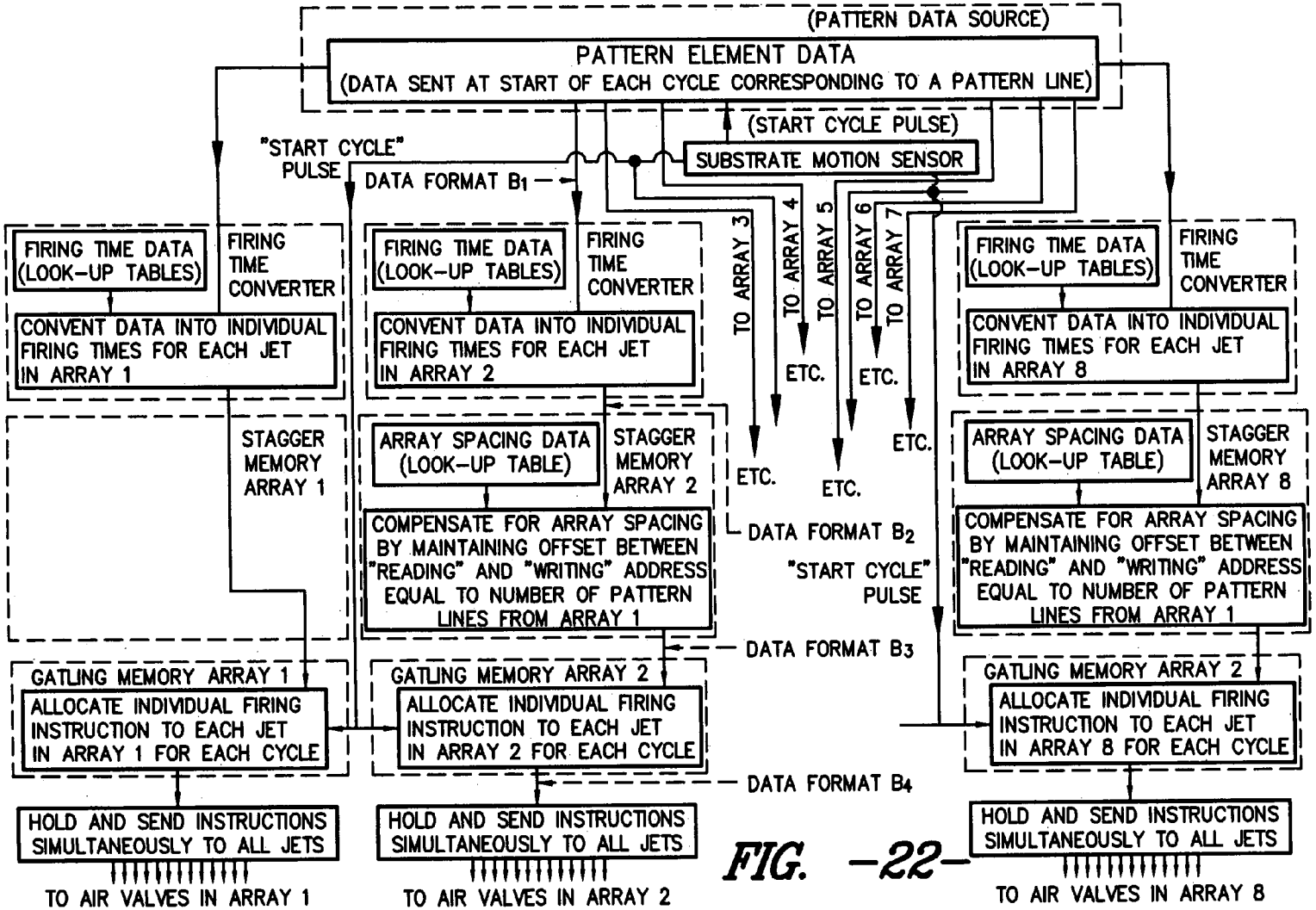
FIG. 22 is a block diagram disclosing, in overview, an electronic control system suitable for use in operating the PREF patterning device of FIGS. 1-21.
Figure 23A:
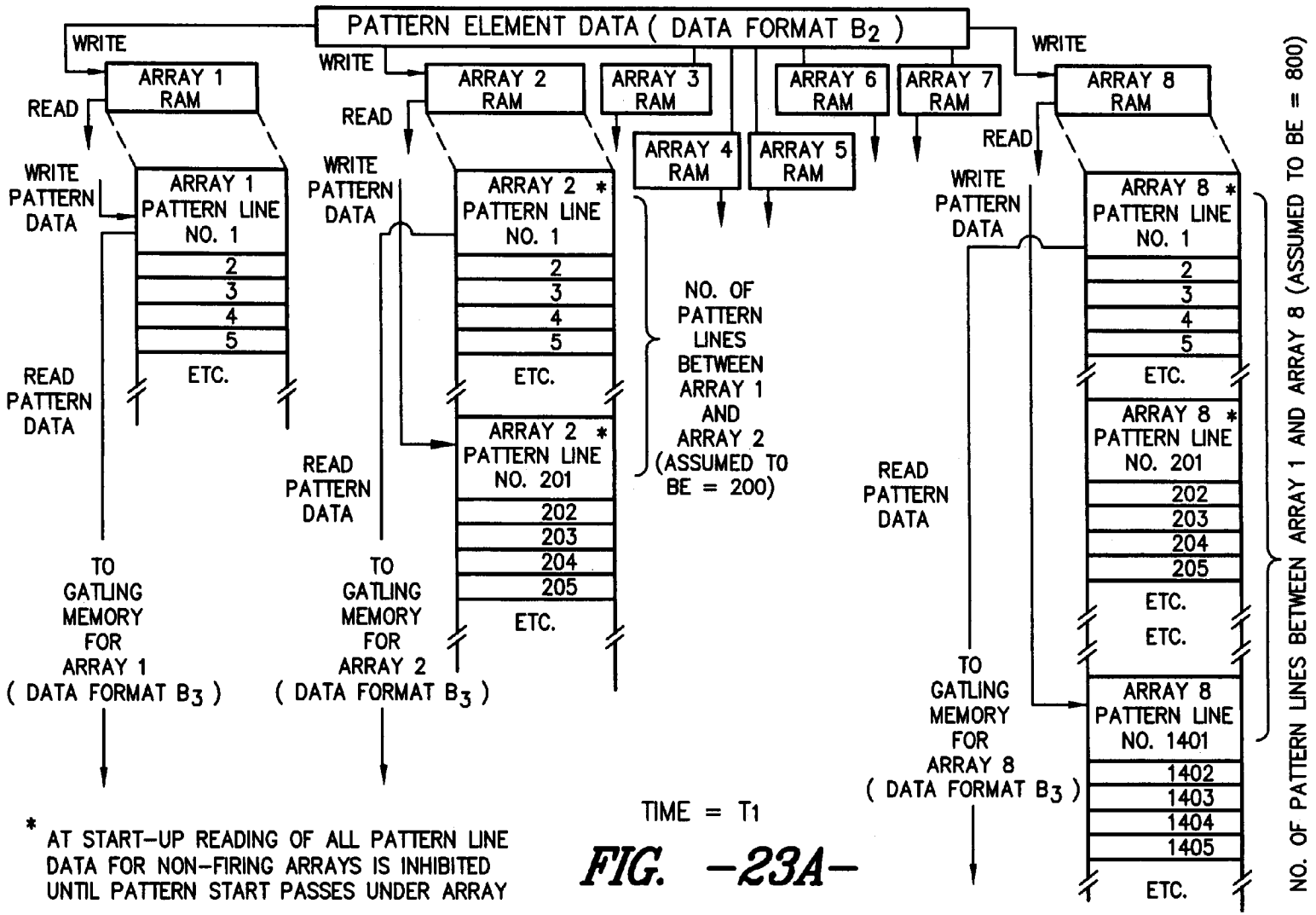
FIGS. 23A and 23B are diagrammatic representations of the "stagger" memory disclosed in FIG. 22.
Figure 23B:
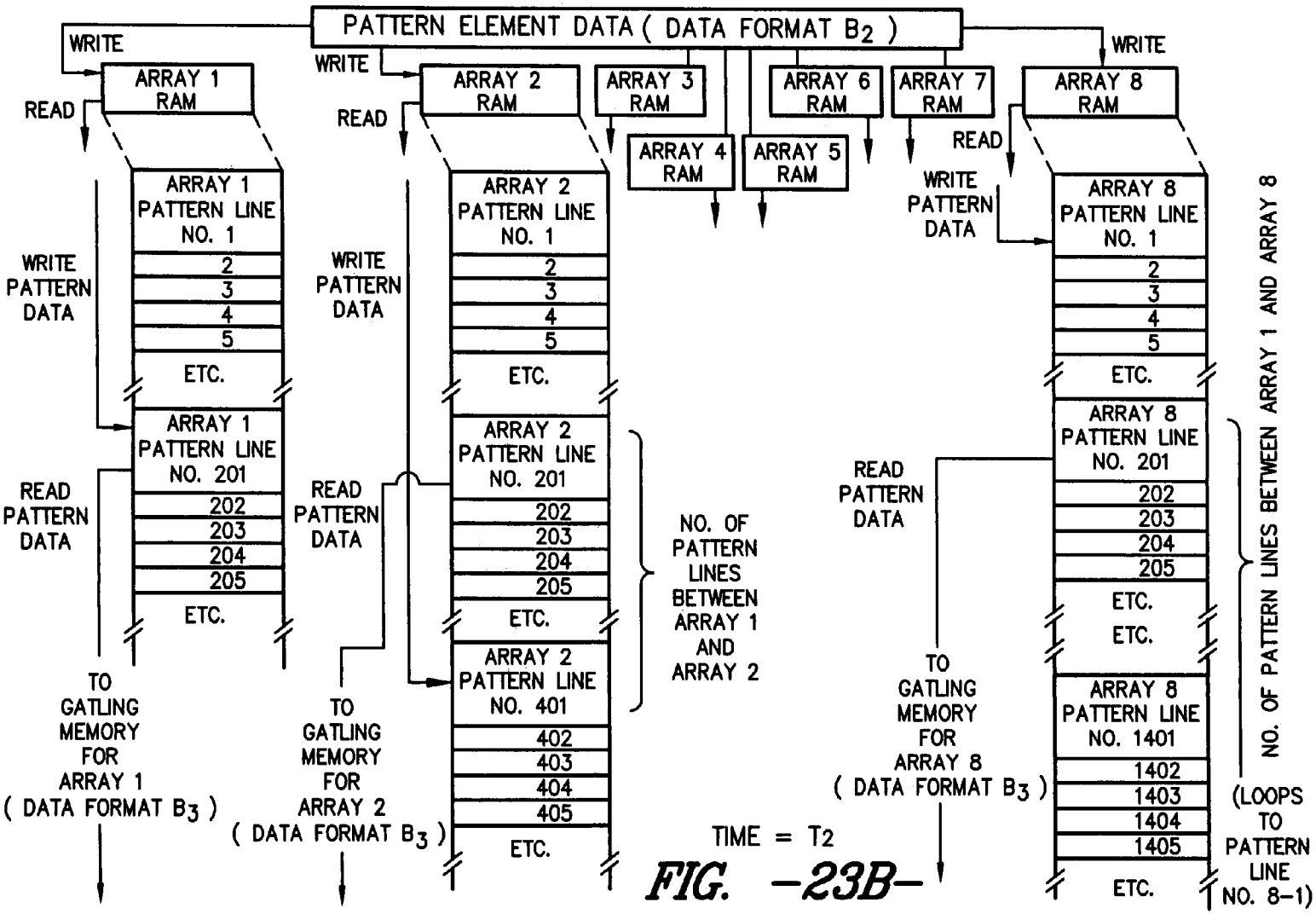
Figure 24:
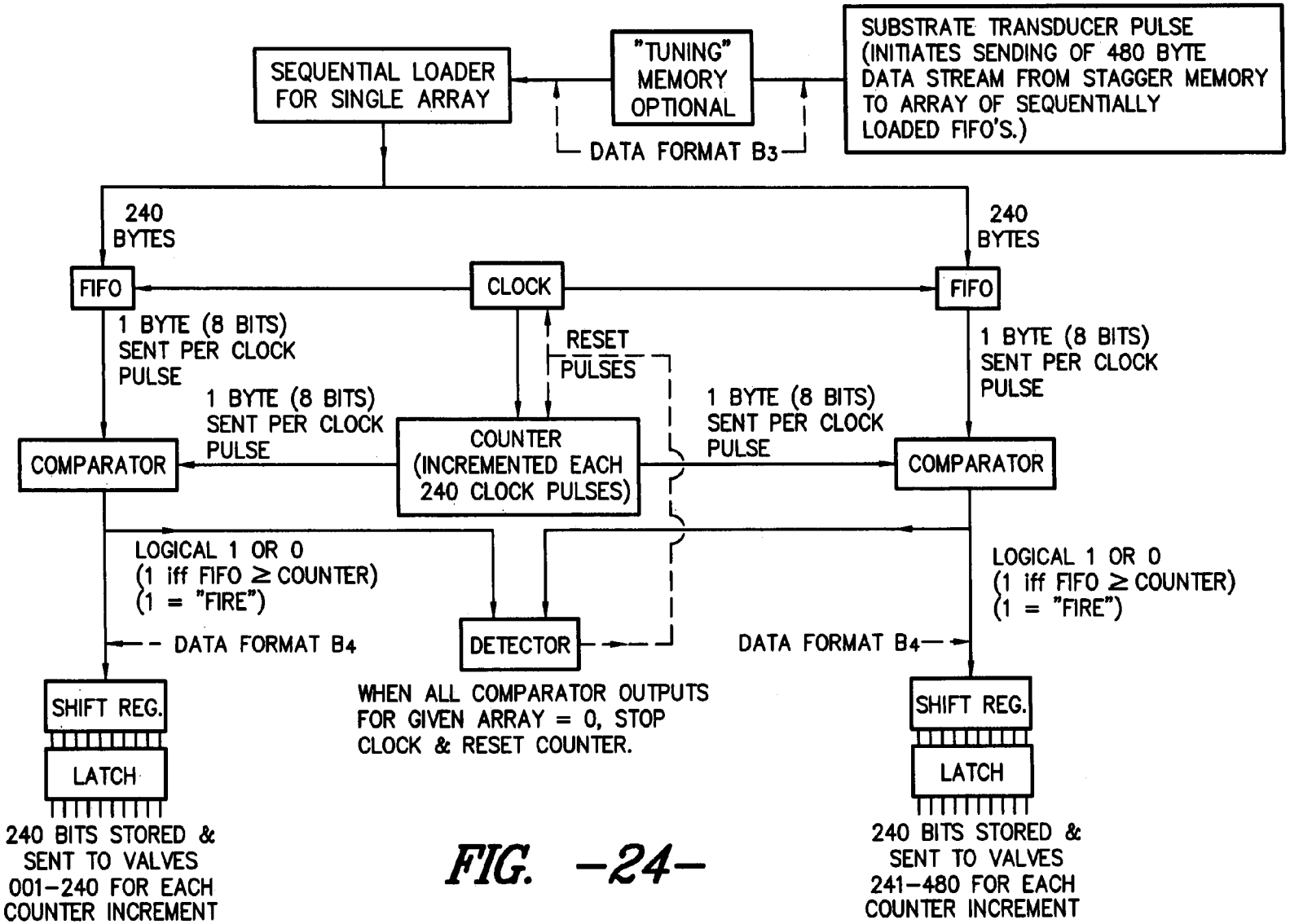
FIG. 24 is a block diagram describing the "gatling" memory described in FIG. 22.
Figure 25:
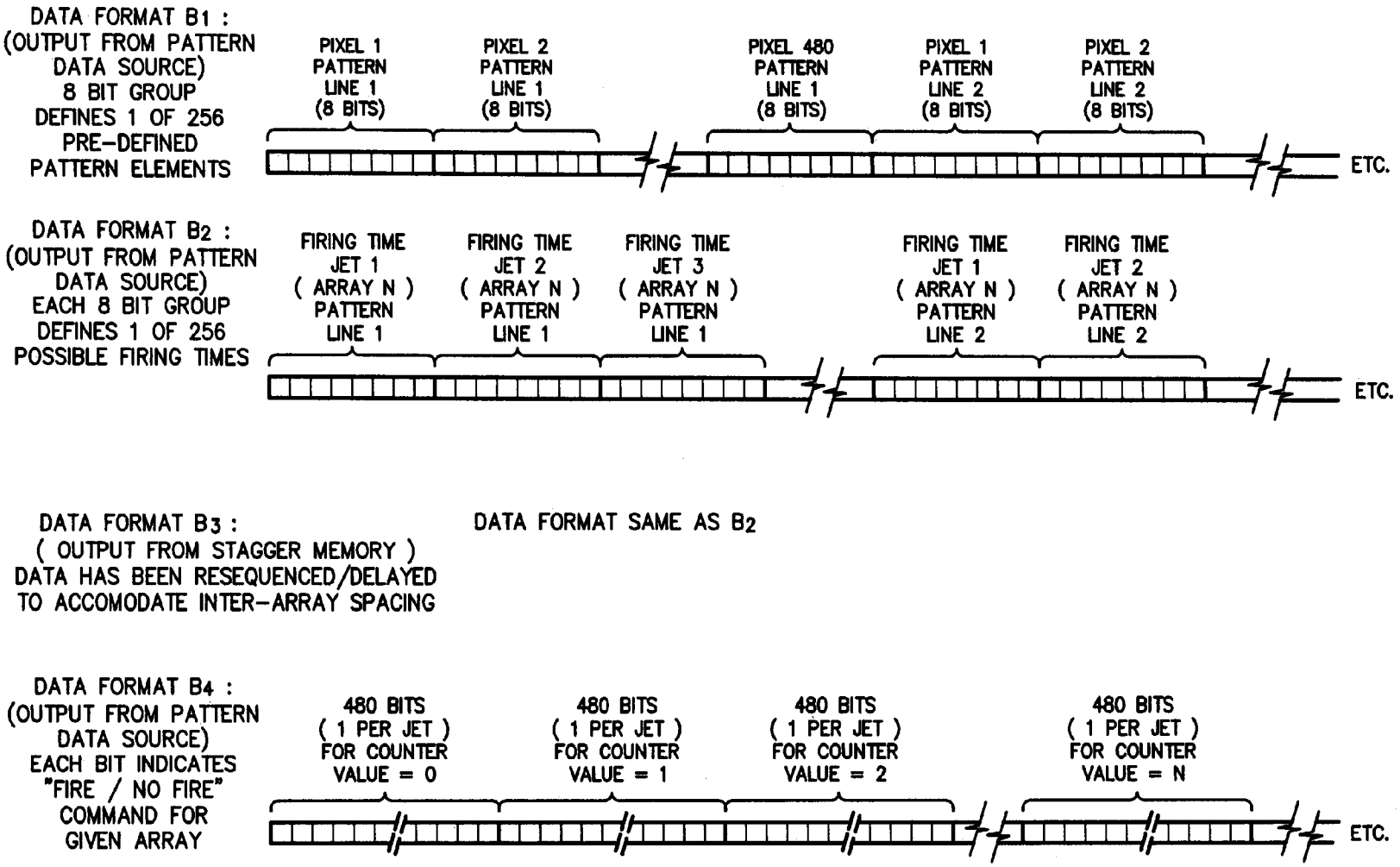
FIG. 25 schematically depicts the format of the pattern data at various data processing stages of the present invention as indicated in FIGS. 22 through 24.
Figure 26:
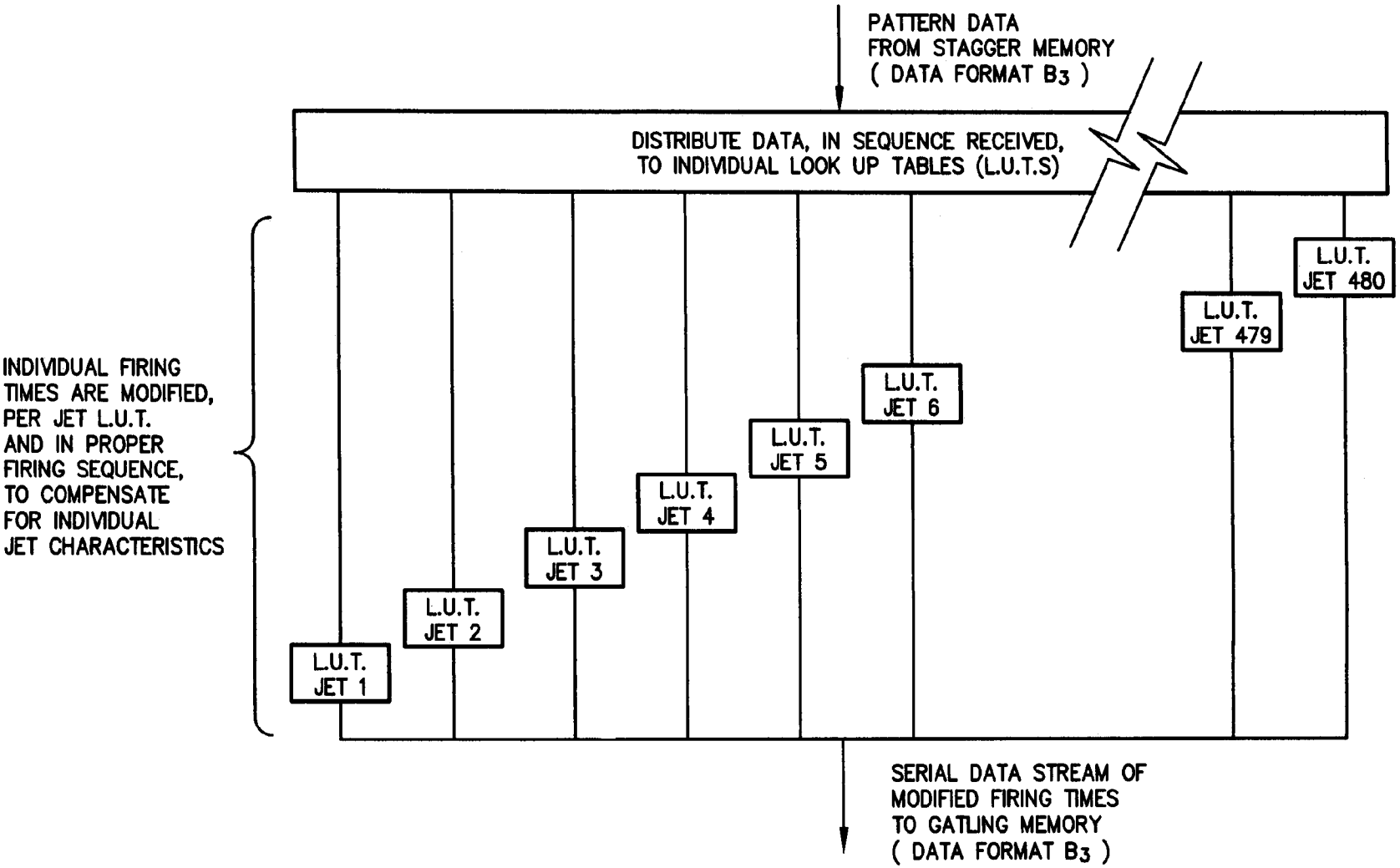
FIG. 26 is a diagram showing an optional "jet tuning" function which may be associated with each array, as described herein.

With reference to FIG. 21 of the drawings, one may supply a Fluid 1 or Fluid 2 to each of valve cards 360 utilizing individual switch valves for each valve card which selectively allows either Fluid 1 or Fluid 2 to pass to the valve card. To flush the valve card and start with a new color or different fluid, one simply switches to the new color or fluid and allows that to flow through the valve card a sufficient time to flush the old fluid from the valve card. This may reduce waste of dye or chemicals as contrasted to other systems which require the flushing of an entire fluid conduit from a supply tank, manifold, or the like.

With reference to each of FIGS. 19, 20, and 21, one can place a new dye or chemical, color, or the like in a dye tank or chemical tank by draining the tank of the old fluid and either flushing the tank with either the new fluid or with a flushing fluid or liquid, such as water, sufficiently to remove the old fluid, drain the flushing fluid, and add the new fluid. Hence, process colors can be changed rather readily by changing out the particular dye mix of each dye tank.

In accordance with one example of the present invention and with reference to FIG. 20 of the drawings, a quick change method to rapidly switch color in a textile printing machine utilizes one manifold and multiple dye supply. Dye change-over is accomplished by switching dye supplies with a 3-way valve and then momentarily opening the drain valve to dump old dye color from the manifold. Old dye that remains in the line between the manifold and the print head or jets can be dumped out through the print head. The drain valve should be held open a little longer than it takes to dump all the old dye, this will assure that any dye clinging to the manifold walls will be stripped off by wall shear. More than two colors can be accommodated by using multiple dye supplies and multiple-way valving.

In accordance with another example of the present invention and with reference to FIG. 21 of the drawings, multiple manifolds and multiple dye supplies are used to provide a quick color change. Dye change-over is accomplished by switching dye supplies with a multi-way valve, one for each print head or valve card. Old dye in the line between the multiple-way valve and the print head can be dumped out through the print head. Old dye in the manifold can be cleaned out through the open drain valve. Meanwhile, new dye supply and manifold is used for printing. Once cleaned out, another color can be loaded into the old dye supply manifold, readying another dye for printing. Alternatively, different colors can be maintained in each dye supply system with a multi-way valve used to switch among colors. In this fashion, only dye in the line between the multi-way valve and the print head need be drained or wasted. This method provides a number of colors quickly available for printing.

In accordance with a particular example of the present invention and with reference with FIG. 19, a pressure control system includes a pressurized tank, pump, pressure and level sensors, an air regulator, and two controllers that allow the use of a liquid at a rapidly varying rate while maintaining constant pressure and while the liquid is replenished.

The objective is to maintain constant pressure at the pressure sensor (the usage point) while liquid is being used from the tank at a rapidly changing flow rate. A signal from the pressure sensor is fed to the controller than in turn controls the regulator. Another controller maintains a liquid level using a continuous level sensor as input and a speed control pump as output.

An air blanket in the pressure tank reduces variations in pressure. Without the air blanket, any mismatch in pump speed and liquid usage rate would, because of the incompressibility of liquid, result in changes in pressure. The air blanket absorbs any mismatch in liquid flow rates by either compressing or expanding. Additionally, as the air compresses or expands, the regulator will exhaust or supply air, further decreasing the variation in pressure.

Controlling liquid levels in the pressure tank reduces errors in regulation. No real regulator can perfectly maintain pressure. By reducing changes in liquid levels, the necessary flow of air through the regulator will be decreased, providing more precise pressure control.

Larger air blankets in the pressure tank reduces variation in pressure. As the air blanket volume is increased, and for a given change in liquid volume, there will be less variation in pressure. This can be shown with the ideal gas law. For example, consider 2 tanks, A and B. Tank A has 10 gallons of air blanket and Tank B has 100 gallons of air blanket. The liquid volume change is 1 gallon and the initial pressure of 30 psig. Tank B would see less variation in pressure due to changes in liquid level.

It is contemplated that textile materials may be patterned using a wide variety of natural or synthetic dyes, including acid dyes, basic dyes, reactive dyes, direct dyes, disperse dyes, mordant dyes, or pigments, depending upon the application and the fiber content of the substrate to be dyed. The teachings herein are applicable to the use of a broad range of such dyes, as well as a broad range of textile materials. Textile materials which can be pattern dyed by means of the present invention include tufted, bonded, knitted, woven, flocked, needle punched, and non-woven textile materials, such as flat woven, pile woven, circular knit, flat knit, warp knit, cut pile, loop pile, cut and loop pile, textured pile, and the like. Typically, but not necessarily, such textile materials will include a pile or nap surface. Such textile materials may include floor coverings (e.g., carpets, rugs, carpet tiles, area rugs, runners, floor mats, etc.), drapery fabrics, upholstery fabrics (including automotive upholstery fabrics), panel fabrics, and the like. Such textile materials can be formed of natural or synthetic fibers, such as polyester, nylon, wool, cotton and acrylic, as well as textile materials containing mixtures of such natural or synthetic fibers, blends, or combinations thereof.

With reference to FIGS. 1-21 of the drawings, there is presented exemplary embodiments of direct jet dyeing apparatus for the pixel wise application of dyes, chemical agents, or the like to a textile material or substrate, such as a pile substrate, such as carpet or the like.

Although the apparatus and methods of the present invention are not limited to a particular substrate, examples of several exemplary substrates for use with the apparatus are described below.

Base Construction Examples:

Fiber Type
- Type 6 nylon BCF
- Type 6 nylon Staple
- Type 6,6 nylon BCF
- Type 6,6 nylon Staple
- 100% wool
- wool/nylon blends (to include wool blends from 99% to 50 wool)
- wool/nylon blends (to include wool/nylon blends with additional low melt fiber of polyester, polyolefin, nylon, or like; up to 15%)
- other fibers such as polyester, PTT, cotton, dyeable polypropylene, and the like Yarn Size
- BCF denier range: 500 d to 2500 d
- Staple yarn size (cotton count): 1.0 cc-6.0 cc Yarn Ply
- 1-4 ply Yarn Color
- Natural, white, light colored, or the like.
- The yarn may be yarn dyed, solution dyed, space dyed, or natural. A light colored or white yarn can be over dyed. A white or light beige color is preferred.

Construction Type
- Tufted
- bonded (latex, PVC, hot melt)
- needle punch, hydroentangled, flocked, and the like Construction Method
- cut pile
- loop pile
- woven (Axminster, Wilton, face-to-face, and the like)
- non woven Tufted Construction Specifications
- GAUGE 5/32 g; 1/8 g; 1/10 g; 5/64 g; 1/16 g; and the like
- WEIGHT 8 oz/sq.yd.—up to—80 oz/sq.yd.
- STITCH 6 stitches per inch—up to—18 stitches per inch
- PILE HEIGHT 0.05 inches—up to—0.75 inches

EXAMPLES

1. Wool/Nylon blend
   80/20 wool/nylon; 2.3 cc size; 2 ply; ~6 tpi twist;

chemically set or Superba heatset
⅛ g tufted cut pile; ~40 oz/sq yd.; ~9 stitches per inch; ~0.35" pile height 2. 32 oz. Bonded white base
100% type 6,6 staple nylon; 3.15 cc size; 2 ply; 4.5 tpi twist; Superba heatset
~⅛ g latex bonded cut pile; 32 oz/sq yd.; ~9 folds per inch; ~0.25" pile height
3. 20 oz. Tufted white base
100% type 6,6 BCF nylon; 1120 d+1315 d size; 2 ply; 4.5 twist; Superba heatset
1/10 g tufted loop; 20 oz/sq yd.; ~12 stitches per inch; ~0.15" pile height
4. 12 oz. Tufted white base
100% type 6,6 BCF nylon; 1360 d size; 1 ply; 0 twist; no heatset
1/10 g tufted loop; 12 oz/sq yd.; ~12 stitches per inch; ~0.13" pile height
5. 18 oz. BCF filament cut pile
100% type 6 BCF nylon; 1095 d size; 2 ply; 4.5 twist per inch; Superba heatset
1/10 g tufted cut pile; 18 oz/sq yd.; ~13 stitches per inch; ~0.25" pile height
6. 17.5 oz. Tufted Face Cushion Back Carpet Tile (36 inch square having a tufted face, latex precoat, hot melt adhesive, glass stabilizer, foam cushion, and felt backing).
Face Weight: 17.5 oz/sq yd.
stitches per inch: 12.0
tufting gauge: 5/64
tuft density: 153.6 per sq inch
pile height: 11/64" and 8/64" (dual pile ht. product)
fiber: 900 d type 6.6 BCF nylon
yarn: 2 ply headset with 5 turns per inch
dye method: jet dye finishes:
1. stain blocker
2. bleach resist chemistry
3. antimicrobial, such as AlphaSan® antimicrobial agent Precoat: 16 oz./sq. yd. SBR latex
Hot Melt: 44 oz./sq. yd. bitumen hot melt
Stabilizer: 2 oz./sq. yd. nonwoven glass mat with binder
Polyurethane Cushion: density 15 lbs. per cubic foot (possible range: 15-25 lbs. per cubic foot)
Felt: 3-4 oz./sq. yd. nonwoven PET/PP 7. 17.5 oz. Tufted Face Broadloom Carpet (6 foot wide roll goods with tufted face, latex precoat, foam cushion, and felt backing).
Face Weight: 17.5 oz./sq. yd.
Stitches per inch: 12.0
Tufting gauge: 5/64
Tuft density: 153.6 per sq. inch
Pile height: 11/64" and 8/64" (dual pile ht. product)
Fiber: 900 d type 6.6 BCF nylon
Yarn: 2 ply heatset with 5 turns per inch
Dye method: jet dye Finishes:
1. stain blocker
2. bleach resist chemistry
3. antimicrobial, such as AlphaSane® antimicrobial agent Precoat: 12 oz./sq. yd. of SBR latex
Polyurethane Cushion: density 15 lbs. per cubic foot (possible range: 15-25 lbs. per cubic foot)
Felt: 3-4 oz. per sq. yd. nonwoven PET/PP In accordance with at least one embodiment of the present invention, wherein higher resolution patterns, designs, or the like are applied to a substrate such as pile carpet, it may be preferred to use smaller dpf or finer yarns which dye darker and/or to use semi-dull yarns which provide less frostiness as contrasted to conventional carpet yarns or faces.

Control System Detailed Discussion

The following is a description of an electronic control system suitable for operation of the above-described preferred patterning device, as set forth in FIGS. 1 through 21. Figures applicable to this description are FIGS. 22 through 29. It should be noted that, in the interest of simplifying the description, the number of arrays or color bars has been assumed to be eight, and the print gauge (i.e., dots per inch) of the patterning device has been assumed to be 20. The terms "jet" and "applicator" are interchangeable; both refer to an individually addressable dye applicator. Also, the term "array" and "color bar," when referring to the arrangement of dye applicators associated with the PREF patterning machine, are similarly interchangeable. Extrapolating the teachings herein to a larger number of color bars or to a different print gauge, as may be required in connection with the above-described patterning device, will be apparent to those skilled in the art.

Pattern data is accepted in the form of a series of eight bit units which uniquely identify a pattern design element to be associated with that pattern element or pixel. The number of different pattern design elements is equal to the number of distinct areas of the pattern which may be assigned a separate color. It should be noted that the teachings herein can be easily adapted by those skilled in the art to accommodate 12 or 16 bit data, or more, if necessary.

The process of sequencing the individual pattern line data to accommodate substrate travel time between adjacent arrays is performed through the use of array-specific Random Access Memories (RAMs), which are preferably of the static type. Prior to any data being loaded, all RAMs should be initialized to zero. All pattern data for a specific array is then loaded into a RAM individually associated with that array. The pattern data is in the form of a series of bytes, each byte specifying a desired firing time for a single applicator or jet comprising the array. The loading process is a coordinated one, with all jet firing time data being loaded into the respective RAMs at the same time and in the same relative order, i.e., all firing times corresponding to the first line of the pattern for all jets in each array is loaded in the appropriate RAM first, followed by all data corresponding to the second pattern line, etc. Each RAM is read using reading address offsets which effectively delay the reading of the data a sufficient amount of time to allow a specific area of the substrate to "catch up" to the corresponding pattern data for that specific area which will be sent to the next array along the substrate path. As will be explained, the spacing or offsetting of the individual jets arranged along diagonals on valve cards within an array or color bar can be accommodated by adjustments made to the reading address.

At this time, the pattern data, in the form of a series of individual firing times expressed in byte form, is preferably transformed into a sequence of individual binary digit ("bit") groups. Each group in the sequence represents the value of its corresponding respective firing time by the relative number of binary digits of a predetermined logic value (e.g., logical "one"="fire") which are sequentially "stacked" within each group. This transformation allows the firing times, expressed in byte form, to be expressed as a continuing sequence of individual firing commands (i.e., single bits) which may be recognized by the applicators The data from each RAM, having been sequenced to accommodate the substrate travel time between the arrays, is loaded into a collection of First-In First-Out Memories (FIFOs). For configurations where the individual jet (i.e., applicators) associated with a given color bar are not in a straight line across the substrate path, as is the case for the staggered jets of the patterning device of FIGS. 10 through 11A, the RAM offset address must be adjusted to compensate for the jet to jet spacing in the direction of substrate movement. Each array is associated with an individual set of FIFOs. Each FIFO repeatedly sends its contents, one byte at a time and strictly in the order in which the bytes were originally loaded, to a comparator. The value of the byte, representing a desired elapsed firing time of a single jet along the array, is compared with a clock value that has been initialized to provide a value representing the smallest increment of time for which control of any jet is desired. As a result of the comparison, a firing command in the form of a logical "one" or logical "zero", which signifies that the jet is to "fire" or "not fire", respectively, is generated and, in a preferred embodiment, is forwarded to a shift register associated with the array, as well as to a detector. After all bytes (representing all jet locations along that array) have been sent and compared, the contents of the shift register are forwarded, in parallel, to the air valve assemblies along the array by way of a latch associated with the shift register. Thereafter, the counter value is incremented, the same contents of the FIFO are compared with the new counter value, and the contents of the shift register are again forwarded, in a parallel format and via a latch, to the air valve assemblies in the array.

At some counter value, all elapsed firing times read from the FIFOs will be less than or equal to that value of the counter. When this condition exists at every array, fresh data, representing a new pattern line, is forwarded from the RAM in response to a transducer pulse indicating the substrate has moved an amount equivalent to one pattern line. This fresh data is loaded into the FIFOs and a new series of iterative comparisons is initiated, using a re-initialized counter. This process is repeated until all pattern lines have been processed. If the pattern is to be repeated, the RAM re-initiates the above procedure by sending the first pattern line to the appropriate FIFO's.

For purposes of discussion, the electronic control system of the instant invention will be described in conjunction with the PREF patterning apparatus discussed above, to which this control system is particularly well suited. It should be understood, however, that the electronic control system of the instant invention may be used, perhaps with obvious modifications, in other devices where similar quantities of digitized data must be rapidly distributed to a large number of individual elements.

In a typical dyeing operation utilizing such apparatus, so long as no pattern information is supplied by control device 20 to the air valves V associated with the array of dye outlets 52, the valves remain "open" to permit passage of pressurized air from air manifold 74 through air supply conduits 64, which continuously deflects all of the continuously flowing dye streams from the array outlets 52 into the primary collection chamber 80 for recirculation. When the substrate 12 initially passes beneath the dye outlets 52 of the individual arrays 26, pattern control system 20 is actuated in a suitable manner, such as manually by an operator Thereafter, signals from transducer 18 prompt pattern information to be processed and sent from pattern control system 20. As dictated by the pattern information, pattern control system 20 generates control signals to selectively "close" appropriate air valves so that, in accordance with the desired pattern, deflecting air streams at specified individual dye outlets 52 along the arrays 26 are interrupted and the corresponding dye streams are not deflected, but instead are allowed to continue along their normal discharge paths to strike the substrate 12. Thus, by operating the air valves of each array in the desired pattern sequence, a pattern of dye may be placed on the substrate during its passage under the respective array.

For the sake of discussion, the following assumptions, conventions, and definitions are used herein. The term "dye jet" or "jet" refers to the applicator apparatus individually associated with the formation of each dye stream in the various arrays. It will be assumed that the substrate will be printed with a pattern having a resolution or print gauge of one-tenth inch as measured along the path under the arrays, i.e., the arrays will direct (or interrupt the flow of) dye onto the substrate in accordance with instructions given each time the substrate moves one-twentieth of an inch (1.27 mm) along its path. This implies that a pattern line, as defined earlier (i.e., a continuous line of single pattern elements extending across the substrate), has a width or thickness of one-twentieth of an inch (1.27 mm). Substrate speed along the conveyor will be assumed to be one linear inch per second, or five linear feet per minute. This implies that, during each time period in which the substrate moves one-twentieth of an inch (i.e., each one-twentieth of a second), which hereinafter may be referred to as a pattern cycle, each and every valve controlling the individual dye jets in the various arrays will receive an electronically encoded instruction which specifies (a) whether the valve should interrupt the flow of diverting air intersecting its respective dye jet and, if so, (b) the duration of such interruption. This time, during which the stream of dye is undeflected and contacts the substrate, may be referred to as "firing time" or the time during which a dye jet "fires" or is actuated. Firing time and dye contact time are synonymous. Array sequence numbering, i.e., first, second, etc., refers to the order in which the substrate passes under or opposite the respective arrays. Similarly, "downstream" and "upstream" refer to the conveyor direction and opposite that direction, respectively. A total of eight arrays are assumed, each having four hundred eighty individual dye jets, although the invention is by no means limited to such numbers and may easily be adapted to support thousands of individual dye jets per array, and/or a greater number of individual arrays. Array-to-array spacing along the direction of substrate travel is assumed to be uniformly ten inches (25.4 cm), i.e., two hundred pattern line widths. Note that two hundred pattern lines implies the processing of pattern data for two hundred pattern cycles.

For purposes of comparison, a control system of the prior art is disclosed in FIG. 6 and will be described in detail below. For purposes of explanation, the format of the patterning data or patterning instructions for this prior art control system, as indicated in FIG. 6, is schematically depicted in FIG. 7. As shown, the pattern element data (in Data Format A1) is first converted to "on/off" firing instructions (referring to the deactuation or actuation, respectively, of the diverting air associated with the individual dye streams) by electronically associating the "raw" pattern data with pre-generated firing instruction data from a computer generated look-up table. This firing instruction data merely specifies, using a single logical bit for each jet, which jets in a given array shall fire during a given pattern cycle, and is represented by Data Format A2 of FIG. 7.

Following this operation, the sequence of "on/off" firing instructions is then rearranged to accommodate the physical spacing between the arrays. This is necessary to assure that the proper firing instruction data corresponding to a given area of the substrate to be patterned arrives at the initial array and at each downstream array at the exact time at which that given substrate area passes under the proper array. This is accomplished by interleaving the array data and inserting synthetic "off" data for downstream arrays at pattern start and for upstream arrays at pattern end, to effectively sequence and delay the arrival of pattern data to the downstream arrays until the substrate has had the opportunity to move into position under the downstream arrays. The data exiting this interleaving operation is in the form of a serial bit stream comprising, for a given pattern cycle, one bit per jet (indicating whether the jet should fire during this cycle) for each respective jet in each array, as indicated in Data Format A3 of FIG. 7.

This serial bit stream is then fed to a data distributor which, for each "start pattern cycle" pulse received from the registration control system (indicating a new pattern line is to begin), simply counts the proper number of bits corresponding to the number of jets in a given array, in the sequence such bits are received from the interleaving operation. When the proper number of bits necessary to comprise firing instructions for that entire array has been counted, that set of bits is sent, in serial form, to the proper array for further processing, as described below, and the counting procedure is begun again for the next array involved in the patterning operation. Each array, in a rotating sequence, is sent data in similar fashion for a given pattern line, and the process is repeated at each "start patterning/cycle" pulse until the patterning of the substrate is completed.

Associated with each array is an electronically encoded value for the actual firing time to be used by that array for all patterning cycles associated with a given pattern. It is important to note that, while this "duration" value may vary from array to array, for a given array it is constrained to be uniform, and cannot vary from jet to jet or from patterning cycle to patterning cycle. Therefore, if any jets in a given array must fire during a given patterning cycle, all such firing jets must fire for the same period of time. This "duration" value is superimposed upon the "fire/don't fire" single-bit data received from the pattern data distribution operation and is temporarily stored in one or more shift registers individually associated with each array. After a predetermined delay to allow time for the shift registers to fill, the data is sent simultaneously to the respective valves associated with the diverting streams of air at each dye jet position along the array.

Figure 8:
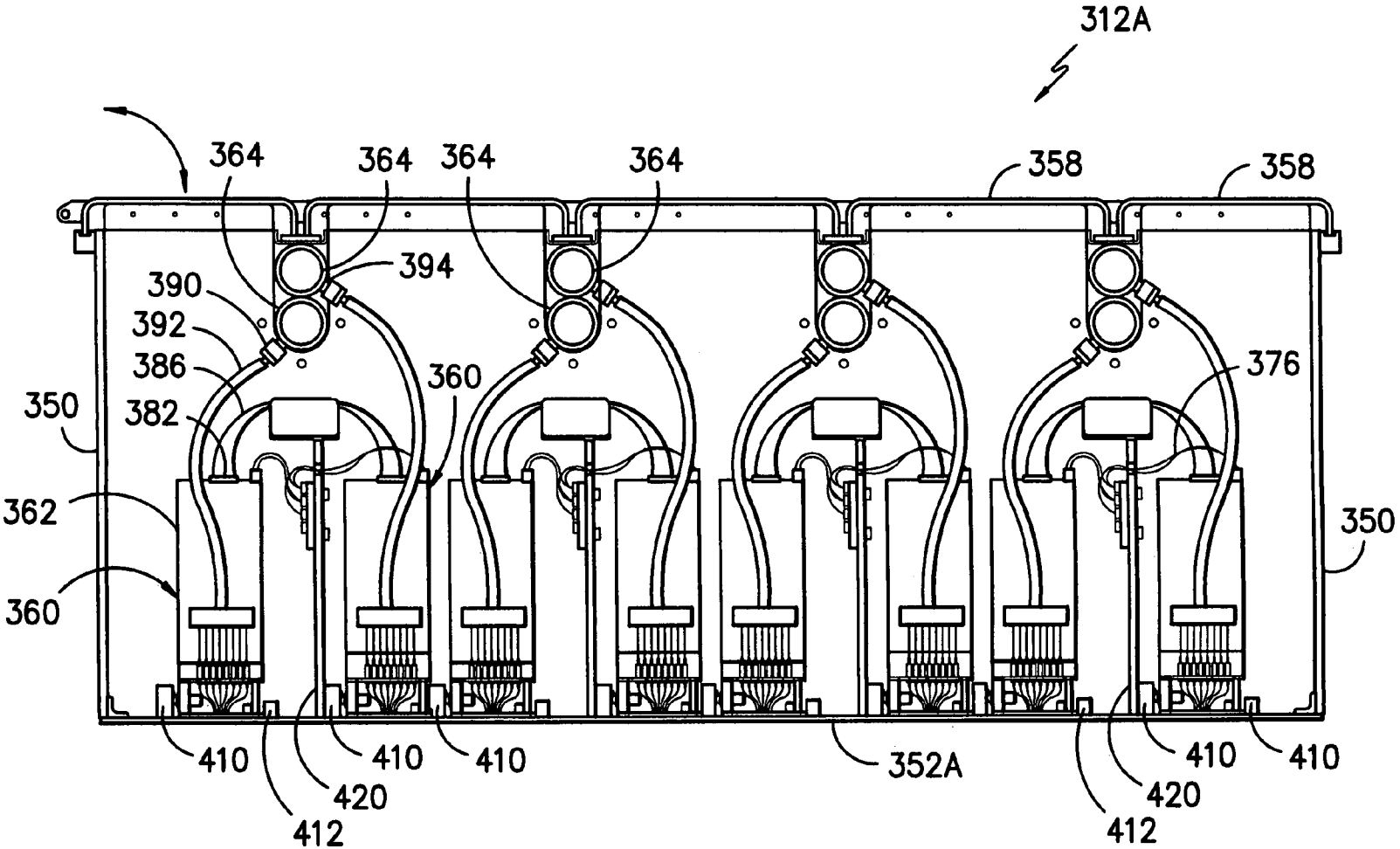
FIG. 8 is a cross-section illustration of one section of the PREF patterning device of FIGS. 5 and 6 in accordance with a second embodiment thereof.

The control system of the present invention, as depicted in FIGS. 8 through 11, may be most easily described by considering the system as essentially comprising three separate data storage and allocation systems (a firing time converter, which incorporates a memory, a "stagger" memory, and a "gatling" memory) operating in a serial sequence. These systems are schematically depicted in FIG. 8, which represents an overview of the control system of the present invention as applied to a patterning device disclosed above. FIG. 11 schematically depicts representative data formats at the process stages indicated in FIG. 8. Each array is associated with a respective firing time converter and "stagger" memory, followed by a separate "gatling" memory, arranged in tandem. Each of these major elements will be discussed in turn.

As shown in FIG. 8, the raw pattern data is sent as prompted by the "start pattern cycle" pulse received from the substrate motion sensor. This sensor merely generates a pulse each time a substrate conveyor moves the substrate a predetermined linear distance (e.g., one-twentieth of an inch) along the path under the patterning arrays. (Note that, in the system of the prior art, the "start pattern cycle" pulse was received from the registration control system; in the novel system described herein, a separate registration control system is not needed.) The same "start pattern cycle" pulse is simultaneously sent to each array, for reasons which will be explained below.

The raw patterning data is in the form of a sequence of pixel codes, with one such code specifying, for each pattern line, the dye jet response for a given dye jet position on each and every array, i.e., each pixel code controls the response of eight separate dye jets (one per array) with respect to a single pattern line. As discussed above, the pixel codes merely define those distinct areas of the pattern which may be assigned a different color. The data is preferably arranged in strict sequence, with data for applicators 1-480 for the first pattern line being first in the series, followed by data for applicators 1-480 for the second pattern line, etc., as depicted by Data Format B1 of FIG. 11. The complete serial stream of such pixel codes is sent, in identical form and without any array-specific allocation, to a firing time converter/memory associated with each respective array for conversion of the pixel codes into firing times This stream of pixel codes preferably comprises a sufficient number of codes to provide an individual code for each dye jet position across the substrate for each pattern line in the overall pattern. Assuming eight arrays of 480 applicators each, a pattern line of 0.05 inch (1.27 mm) in width (measured along the substrate path), and an overall pattern which is 60 inches (152.4 cm) in length (i.e., measured along the substrate path), this would require a raw pattern data stream comprised of 576,000 separate codes.

Comprising each firing time converter is a look-up table having a sufficient number of addresses so that each possible address code forming the serial stream of pattern data may be assigned a unique address in the look-up table At each address within the look-up table is a byte representing a relative firing time or dye contact time, which, assuming an eight bit address code is used to form the raw pattern data, can be zero or one of 255 different discrete time values corresponding to the relative amount of time the dye jet in question is to remain "on."

Accordingly, for each eight bit byte of pixel data, one of 256 different firing times (including a firing time of zero) is defined for each specific jet location one each and every array. Jet identity is determined by the relative position of the address code within the serial stream of pattern data and by the information pre-loaded into the look-up table, which information specifies in which arrays a given jet position fires, and for what length of time. (If desirable, data individually comprised of two or more bytes, specifying, e.g., one of 65,536 different firing times or other patterning parameter levels may be used in accordance with the teachings herein, with appropriate modifications to the hardware.) The result is sent, in Data Format B2 (see FIG. 11), to the "stagger" memory associated with the given array. At this point, no attempt has been made to compensate for the physical spacing between arrays and jets, or to group and hold the data for sending to the actual air valves associated with each dye jet.

Compensation for the physical spacing between arrays may be best explained with reference to FIGS. 9A and 9B, which functionally describe the individual stagger memories for various arrays in greater detail.

The "stagger" memory operates on the firing time data produced by the look-up tables and performs two principal functions: (1) the serial data stream from the look-up table, representing firing times, is grouped and allocated to the appropriate arrays on the patterning machine and (2) "non-operative" data is added to the respective pattern data for each array to inhibit, at start-up and for a pre-determined interval which is specific to that particular array, the reading of the pattern data in order to compensate for the elapsed time during which the specific portion of the substrate to be patterned with that pattern data is moving from array to array.

The "stagger" memory operates as follows. The firing time data is sent to an individual random access memory (RAM) associated with each of the eight arrays. Although either static or dynamic RAM's may be used, static RAM's have been found to be preferred because of increased speed. At each array, the data is written to the RAM in the order in which it was sent from the look-up table, thereby preserving the jet and array identity of the individual firing times. Each RAM preferably has sufficient capacity to hold firing time information for the total number of pattern lines extending from the first to the eighth array (assumed to be fourteen hundred for purposes of discussion) for each jet in its respective array. In the discussion which follows, it may be helpful to consider the fourteen hundred pattern lines as being arranged in seven groups of two hundred pattern lines each (to correspond with the assumed inter-array spacing).

The RAM's are both written to and read from in a unidirectional repeating cycle, with all "read" pointers being collectively initialized and "lock-stepped" so that corresponding address locations in all RAM's for all arrays are read simultaneously. Associated with each RAM is a pre-determined offset value which represents the number of sequential memory address values separating the "write" pointer used to insert the data into the memory addresses and the "read" pointer used to read the data from the RAM addresses, thereby "staggering" in time the respective read and write operations for a given memory address.

In configurations where the jets associated with an array or color bar are not in a straight line across the substrate path, as is the case for the staggered jets of the patterning device of FIGS. 10 through 11A, once the "read" pointer is calculated, it must be adjusted, on a jet-by-jet basis as data is being read from the array, to compensate for the jet-to-jet spacing (i.e., the offset) in the direction of substrate motion. Thus, for example, if the jets are offset in the substrate direction by:

| Jet | Pattern line offset |
|---|---|
| 1 | 0 lines |
| 2 | 2 lines |
| 3 | 4 lines |
| 4 | 6 lines |
| 5 | 8 lines |
| 6 | 10 lines |
| 7 | 12 lines |
| 8 | 14 lines |
| 9 | 0 lines |
| 10 | 2 lines |
| 11, etc. | 4 lines, etc. |

Then the "read" pointer would be adjusted by:

| Jet | Data line offset |
|---|---|
| 1 | 0 |
| 2 | −2 |

-continued

| Jet | Data line offset |
|---|---|
| 3 | −4 |
| 4 | −6 |
| 5 | −8 |
| 6 | −10 |
| 7 | −12 |
| 8 | −14 |
| 9 | 0 |
| 10 | −2 |
| 11, etc. | −4, etc. |

The negative sign indicates the offset must be moved to previous lines in the stagger memory array. Therefore, after jet 1 prints and the substrate moves two lines, jet 2 prints adjacent to the pixel printed by jet 1. Referencing FIG. 23A, if the data for jet 1 is to be read from line 205, then the data for jet 2 will be read from line 203.

In this example, the write address and read address increment. Alternatively, and perhaps advantageously, the address counters can be decremented. By so doing, the adjustments can be made as positive numbers (i.e., add, rather than subtract, the adjustment to the read address. This alternative simplifies the hardware implementation.

As depicted on the left hand side of FIG. 9A, the RAM offset value for the first array is zero, i.e., the "read pattern data" operation is initiated at the same memory address as the "write pattern data" operation, with no offset. The offset for the second array, however, is shown as being two hundred, which number is equal to the number of pattern lines or pattern cycles (as well as the corresponding number of read or write cycles) needed to span the distance physically separating the first array from the second array, as measured along the path of the substrate in units of pattern lines. As depicted, the "read pattern" pointer, initialized at the first memory address location, is found two hundred address locations "above" or "earlier" than the "write" pointer. Accordingly, beginning the "read" operation at a memory address location which lags the "write" operation by two hundred consecutive locations effectively delays the reading of the written data by two hundred pattern cycles to correspond to—and compensate for—the physical spacing between the first and second array. To avoid using "dummy" data for the "read" operation until the "read" pointer catches up with the first address written to by the "write" pointer, a "read inhibit" procedure may be used. Such procedure would only be necessary at the beginning and end of a pattern. Alternatively, data representing zero firing time can be loaded in the RAM's in the appropriate address locations so that the "read" operation, although enabled, reads data which disables the jets during such times.

The right hand side of FIG. 9A depicts the stagger memory for the eighth array. As with all other arrays, the "read" pointer has been initialized to the first memory address in the RAM.

The "write" pointer, shown at its initialized memory address location, leads the "read" pointer by an address difference equivalent to fourteen hundred pattern lines (assuming seven intervening arrays and a uniform inter-array spacing of two hundred pattern lines).

FIG. 9B depicts the stagger memories of FIG. 9A exactly two hundred pattern cycles later, i.e., after the data for two hundred pattern lines have been read. The "read" and "write" pointers associated with Array 1 are still together, but have moved "down" two hundred memory address locations and are now reading and writing the firing time data associated with the first line of the second group of two hundred pattern lines in the RAM.

The "read" and "write" pointers associated with Array 2 are still separated by an offset corresponding to the physical spacing between Array 1 and Array 2, as measured in units of pattern lines. Looking at the pointers associated with Array 8, the "read" pointer is positioned to read the first line of firing time data from the second group of two hundred pattern lines, while the "write" pointer is positioned to write new firing time data into RAM addresses which will be read only after the existing fourteen hundred pattern lines in the RAM are read. It is therefore apparent the "read" pointer is specifying firing time data which was written fourteen hundred pattern cycles previously.

The storage registers associated with each array's stagger memory store the firing time data for the pattern line to be dyed by that respective array in that pattern cycle until prompted by a pulse from the substrate transducer indicating the substrate has traveled a distance equal to the width of one pattern line. At that time, the firing time data, in Data Format B3 (see FIG. 11), is sent to the "gatling" memory for processing as indicated below, and firing time data for the next pattern line is forwarded to the stagger memory for processing as described above.

FIG. 10 depicts a "gatling" memory module for one array. For the patterning device depicted in FIG. 1, eight configurations of the type shown in FIG. 10 would be necessary, one for each array. In a preferred embodiment, all would be driven by a common clock and counter. The gatling memory performs two principal functions: (1) the serial stream of encoded firing times is converted to individual strings of logical (i.e., "on" or "off") firing commands, the length of each respective "on" string reflecting the value of the corresponding encoded firing time, and (2) these commands are quickly and efficiently allocated to the appropriate applicators.

As depicted in FIG. 10, associated with each array is a set of dedicated first in-first out memory modules (each of which will be hereinafter referred to as a "FIFO"). An essential characteristic of the FIFO is that data is read out of the FIFO in precisely the same order or sequence in which the data was written into the FIFO. In the exemplary embodiment described herein, the set of FIFO modules must have a collective capacity sufficient to store one byte (i.e., eight bits, equal to the size of the address codes comprising the original pattern data) of data for each of the four hundred eighty diverting air valves in the array. For purposes of explanation., it will be assumed that each of the two FIFO's shown can accommodate two hundred forty bytes of data.

Each FIFO has its input connected to the sequential loader and its output connected to an individual comparator. A counter is configured to send an eight bit incrementing count to each of the comparators in response to a pulse from a "gatling" clock. The "gatling" clock is also connected to each FIFO, and can thus synchronize the initiation of operations involving both the FIFO's and the respective comparators associated with each FIFO. If the smallest increment of time on which "firing time" is based is to be different from array to array, independent clocks and counters may be associated with each such array. Preferably, the output from each comparator may be operably connected to a respective shift register/latch combination, which serves to store temporarily the comparator output data before it is sent to the respective array, as described in more detail below. Each comparator output is also directed to a common detector, the function of which shall be discussed below. As indicated in FIG. 10, a reset pulse from the detector is sent to both the "gatling" clock and the counter at the conclusion of each pattern cycle, as will be explained below.

In response to the transducer pulse, the respective stagger memories for each array are read in sequence and the data is fed to an array-specific sequential loader, as depicted in FIG. 10. The sequential loader sends the first group of two hundred forty bytes of data received to a first FIFO and the second group of two hundred forty bytes of data to a second FIFO. Similar operations are performed simultaneously at other sequential loaders associated with other arrays. Each byte represents a relative firing time or dye contact time (or, more accurately, an elapsed diverting air stream interruption time) for an individual jet in the array. After each of the FIFO's for each array are loaded, they are simultaneously sent a series of pulses from the "gatling" clock, each pulse prompting each FIFO to send a byte of data (comprised of eight bits), in the same sequence in which the bytes were sent to the FIFO by the sequential loader, to its respective individual comparator. This FIFO "firing time" data byte is one of two separate inputs received by the comparator, the second input being a byte sent from a single counter common to all FIFOs associated with every array. This common counter byte is sent in response to the same gatling clock pulse which prompted the FIFO data, and serves as a clock for measuring elapsed time from the onset of the dye stream striking the substrate for this pattern cycle. At each pulse from the gatling clock, a new byte of data is released from each FIFO and sent to its respective comparator.

At each comparator, the eight bit "elapsed time" counter value is compared with the value of the eight bit "firing time" byte sent by the FIFO. The result of this comparison is a single "fire/no fire command" bit sent to the shift register as well as the detector. If the FIFO value is greater than the counter value, indicating the desired firing time as specified by the pattern data is greater than the elapsed firing time as specified by the counter, the comparator output bit is a logical "one" (interpreted by the array applicators as a "fire" command) Otherwise, the comparator output bit is a logical "zero" (interpreted by the array applicators as a "no fire" or "cease fire" command) At the next gatling clock pulse, the next byte of firing time data in each FIFO (corresponding to the next individual jet along the array) is sent to the respective comparator, where it is compared with the same counter value. Each comparator compares the value of the firing time data forwarded by its respective FIFO to the value of the counter and generates a "fire/no fire" command in the form of a logical one or logical zero, as appropriate, for transmission to the shift register and the detector.

This process is repeated until all two hundred forty "firing time" bytes have been read from the FIFO's and have been compared with the "elapsed firing time" value indicated by the counter. At this time the shift register, which now contains a serial string of two hundred forty logical ones and zeros corresponding to individual firing commands, forwards these firing commands in parallel format to a latch. The latch serves to transfer, in parallel, the firing commands from the shift register to the individual air valves associated with the array dye applicators at the same time the shift register accepts a fresh set of two hundred forty firing commands for subsequent forwarding to the latch. Each time the shift register forwards its contents to the latch (in response to a clock pulse), the counter value is incremented. Following this transfer, the counter value is incremented by one time unit and the process is repeated, with all two hundred forty bytes of "firing time" data in each FIFO being reexamined and transformed into two hundred forty single bit "fire/no fire" commands, in sequence, by the comparator using the newly incremented value of "elapsed time" supplied by the counter. While, in a preferred embodiment, the serial firing commands may be converted to, and stored in, a parallel format by the shift register/latch combination disclosed herein, it is foreseen that various alternative techniques for directing the serial stream of firing commands to the appropriate applicators may be employed, perhaps without converting said commands to a true parallel format.

The above process, involving the sequential comparison of each FIFO's entire capacity of firing time data with each incremented "elapsed time" value generated by the counter, is repeated until the detector determines that all comparator outputs for that array are a logical "zero." This indicates that, for all jets in the array, no desired firing time (represented by the FIFO values) for any jet in the array exceeds the elapsed time then indicated by the counter. When this condition is sensed by the comparator, it indicates that, for that pattern line and that array, all required patterning has occurred. Accordingly, the detector sends "reset" pulses to both the counter and to the gatling clock. The gatling module then waits for the next substrate transducer pulse to prompt the transmission and loading of firing time data for the next pattern line by the sequential loader into the FIFO's, and the reiterative reading/comparing process is repeated as described above.

In a preferred embodiment, the gatling memory for each array may actually consist of two separate and identical FIFO's which may alternately be connected to the array valves. In this way, while data are being read out and compared in one gatling memory, the data for the next pattern line may be loaded into the FIFO's associated with the alternate gatling memory, thereby eliminating any data loading delays which might otherwise be present if only one gatling memory per array were used. It should be apparent that the number of individual FIFO's may be appropriately modified to accommodate a greater or lesser number of dye jets in an array.

FIG. 12 depicts an optional memory, to be associated with each array, which may be used when maximum pattern definition is desired This memory, which may take the form of a static RAM, functions in a "tuning" or "trimming" capacity to compensate, in precise fashion, for small variations in the response time or dye flow characteristics of the individual applicators. This is achieved by means of a look-up table embodied in the RAM which associates, for each applicator in a given array, and, if desired, for each possible firing time associated with each such applicator, an individual factor which increases or decreases the firing time dictated by the pattern data by an amount necessary to cause all applicators in a given array to deliver substantially the same quantity of dye onto the substrate in response to the same pattern data firing instructions.

As explained above, the time required to activate a valve is known as firing time. Firing time typically comprises of a portion of a machine cycle. Machine cycle is defined as the amount of time which is required for an electrical device such as a valve to perform its intended function. Typically, there is usually a small amount of dead time between firing times to allow the valves to turn off. In a contiguous valve system, there is no dead time between firing time cycles with the firing time equivalent to the machine cycle. With systems of this type, valves must be turned on and off in accordance with pattern data.

In the case where one or more valves are already activated, excess energy may be dissipated in those valves. In order to save energy, and avoid unnecessary stress on the valves, one can input the pattern data for each of a series of valves, then compare that digital valve activation data in a one to one correspondence to the digital valve activation data that was inputted to that same series of valves in the previous machine cycle. If a particular valve was turned on in the previous machine cycle, then this valve will not be applied with voltage for a percentage of the valve's machine cycle time. The specific technique used to implement this process is described below.

Figure 27:
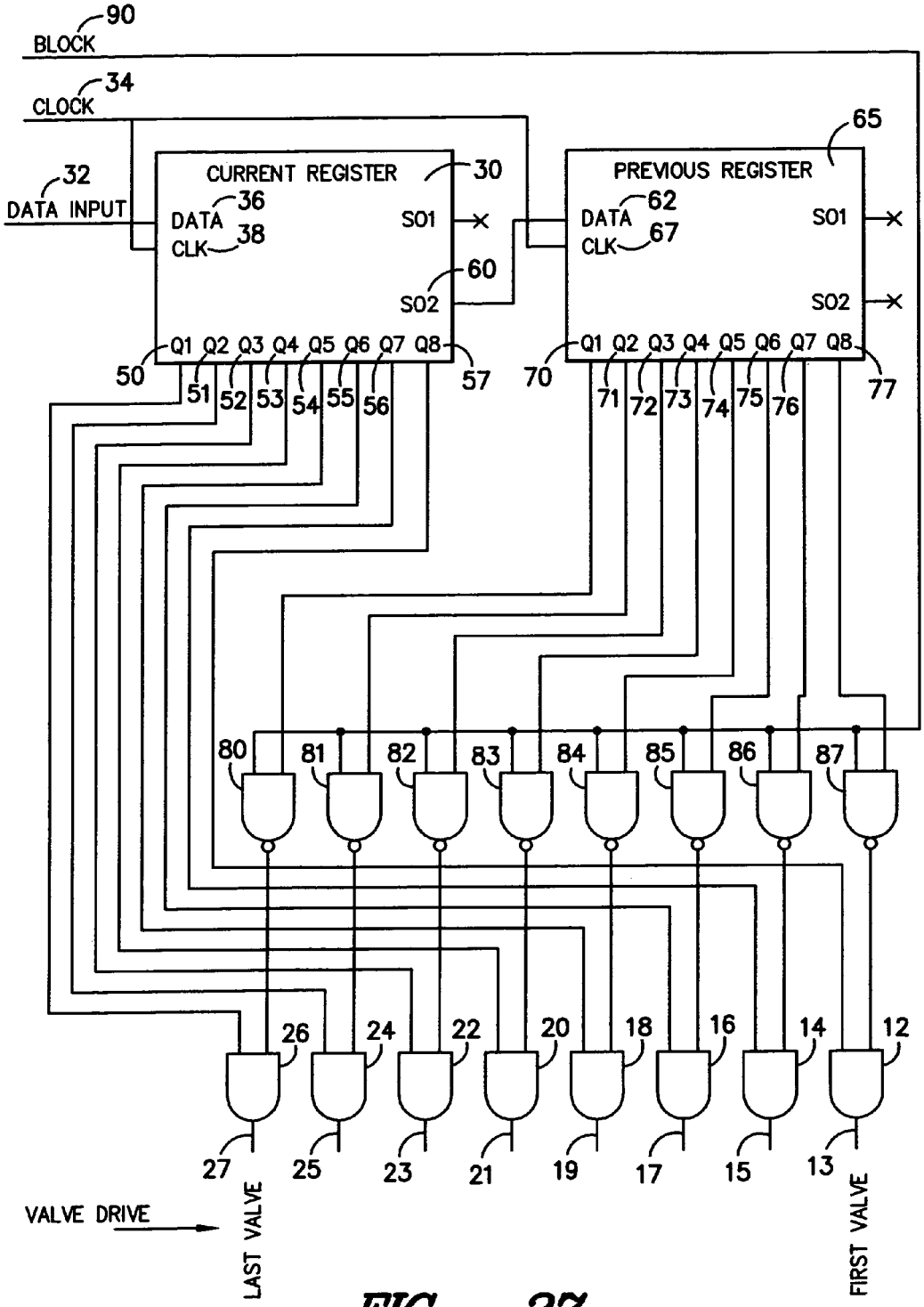
FIG. 27 is a block diagram disclosing, an overview, the novel contiguous valve control system disclosed herein.

FIG. 27 shows a contiguous valve control in which each valve is controlled by a single control line. The firing time of each valve is initiated by activating a control line associated with a particular valve for a pre-determined period of time. In a contiguous valve system, the firing time and machine cycle are synonymous. Solenoid valves that are already activated dissipate excess energy in the form of heat which can result in damage to the solenoid valves. In the beginning of each machine cycle, valves may be turned on and off in accordance with computer pattern data.

An excellent example of this type of technology is the pattern application of dye on a substrate wherein streams of dye are selectively directed onto the substrate in accordance with pattern information. Each individual dye stream is controlled by a solenoid valve. Therefore, for intricate patterns, the number of solenoids utilized can be extensive. The solenoid valves that are typically used in the above application normally operate at fifteen (15) volts. By increasing the voltage to 100 volts for a short period of time, just as the solenoid valve is activated, the time required to activate the valve is reduced substantially. This technique works well, however, this vast increase in voltage also results in significant power loss in the electrical conductor extending between the power source and the plurality of solenoid valves. The voltage loss in the electrical conductor is directly proportional to the number of valves activated. Therefore, when just a few solenoid valves are activated, the response time is significantly shorter then when a large number of valves are activated. The solution to the problem of voltage drop due to load variance is solved by anticipating the load and supplying additional energy by lengthening the time energy is applied. The electrical components presented in this Application are solenoid valves, however, relays, coils, resistors, and any other type of electrical component that operates as a voltage load may be utilized with this technology. In addition, any type of solenoid valve may be utilized with the fifteen volt solenoid valve illustrated as a non-limiting example.

An example of means of automatically and electronically changing from one set of pattern data to another is disclosed in U.S. Pat. No. 4,170,883, issued Oct. 16, 1979, which is hereby incorporated by reference. Other commonly assigned patents which relate to patterning substrate by utilizing the activation of valves include U.S. Pat. No. 5,208,592 issued May 4, 1993, which is hereby incorporated by reference; U.S. Pat. No. 5,140,686 issued Aug. 18, 1992, which is hereby incorporated by reference; U.S. Pat. No. 5,136,520 issued Aug. 4, 1992, which is hereby incorporated by reference; U.S. Pat. No. 4,984,169 issued Jan. 8, 1991, which is hereby incorporated by reference; U.S. Pat. No. 5,142,481 issued Aug. 25, 1992, which is hereby incorporated by reference; and U.S. Pat. No. 5,128,876 issued Jul. 7, 1992, which is hereby incorporated by reference.

As shown in FIG. 27, serial data is inputted into a current shift register 30 by means of a data input 32. A non-limiting example of current shift registers of this type would include 74HC4094. This data is actually sequentially clocked into this register by means of clock line 34. Data input line 32 is electrically connected to data input terminal 36 of current shift register 30. Clock line 34 is electrically connected to clock input terminal 38 of current shift register 30. A representative clock pulse that can be found on clock line 34 is pictorially represented by numeral 41 in FIG. 28 and numeral 44 in FIG. 29. A data input voltage pulse that can be found on data input 32 is pictorially represented by numerals 42 in FIG. 2 and numeral 45 in FIG. 3. Although, there can be any number of output terminals associated with current register 30, in a preferred embodiment there are eight output terminals represented as Q1, Q2, Q3, Q4, Q5, Q6, Q7 and Q8 designated by numerals 50, 51, 52, 53, 54, 55, 56, and 57, respectively. Output terminals 50, 51, 52, 53, 54, 55, 56, and 57 of current register 30 are electrically connected to one of two inputs of a series of AND gates numerically designated as 26, 24, 22, 20, 18, 16, 14 and 12, respectively. A non-limiting example of AND gates of this type would include 74H08. The valve activation data leaves current register 30 by means of serial output S02 designated by numeral 60 which is electrically connected to data input terminal 62 of a previous shift register as generally indicated by numeral 65. A nonlimiting example of a shift register of this type is 74HC4094. This serial data is clocked into previous register 65 by means of electrical connection between clock line 34 and clock input terminal 67. Once again, the clock voltage pulse representations are indicated by numerals 41 and 44 on FIGS. 28 and 29, respectively, and the data shift in voltage pulses are indicated by numerals 42 and 45 on FIGS. 28 and 29, respectively. The preferred embodiment of previous shift register 65 also has eight output terminals. Output terminal Q1 is designated by numeral 70, output terminal Q2 is designated by numeral 71, output terminal Q3 is designated by numeral 72, output numeral Q4 is designated by numeral 73, output terminal Q5 is designated by numeral 74, output terminal Q6 is designated by numeral 75, output terminal Q7 is designated by numeral 76, and output terminal Q8 is designated by numeral 77. These output lines 70, 71, 72, 73, 74, 75, 76 and 77 are electrically connected to one of two inputs to a series of preferably eight NAND gates numerically designated as 80, 81, 82, 83, 84, 85, 86 and 87, respectively. A non-limiting example of NAND gates 80, 81, 82, 83, 84, 85, 86, and 87 at this type would include 74HC00. The remaining second input connections to NAND gates 80, 81, 82, 83, 84, 85, 86, and 87 are connected to block line 90. Block line 90 is a voltage pulse which is on for a percentage of time of the total time in which the high voltage pulse is applied to the valve. As shown in FIG. 28 the high voltage pulse is designated by numeral 92. In FIG. 29 the high voltage pulse is designated by numeral 93. A block voltage pulse is preferably a significant period of time in relation to the total period of time in which the high voltage pulse is applied to the valve. In the preferred embodiment the high voltage pulse is in a high state for 125 microseconds while the block voltage pulse is activated in a high state for 100 microseconds. Block voltage pulse is shown in FIG. 28 as numeral 94 and is shown in FIG. 29 as numeral 95.

Therefore, the output of NAND gates 80, 81, 82, 83, 84, 85, 86 and 87 will always be in a digital "one" state unless there is a positive block voltage pulse 94, 95 at the same time the output terminal of either 70, 71, 72, 73, 74, 75, 76 or 77 of previous register 75 is in a digital "one" state or high state. Otherwise, in all remaining conditions of the output of NAND gates 80 through 87 will be in a digital "one" state. The outputs from NAND gates 80 through 87 are inputted to respective AND gates 26, 24, 22, 20, 18, 16, 14 and 12 in conjunction with the digital output terminals 50, 51, 52, 53, 54, 55, 56 and 57. The output from AND gates 26, 24, 22, 20, 18, 16, 14 and 12 are outputted to control lines 27, 25, 23, 21, 19, 17, 15 and 13, respectively. These control lines actuate the valves.

Therefore, according to FIG. 28 the valve drive will be continually activated except when there is a block voltage pulse 94 in conjunction with a digital "one" state on one of the output terminals 70 through 77. This will result in voltage pulse 98 in which the respective valve drive will be off for the initial 100 microseconds and then on for the last 25 seconds of a total of 125 microsecond activation time. This is shown by high voltage 92, block voltage 94 and valve drive voltage 98, respectively, in FIG. 28.

FIG. 29 represents the condition when there are no digital "one" states present on any one of outputs 70 through 77 of previous shift register 65. The valve drive voltage 99 will then be on continually and there will not be a period of time in which the valve drive voltage 99 will be turned off. It is because high voltage pulse 93 is turning on the valve for the first time and this valve was not on during the previous machine cycle.

It should be noted that, alternatively, the foregoing logic can be implemented by using programmable logic devices in place of the discrete devices discussed above.

Process Detailed Discussion

According to one contemplated practice, the present process and apparatus may be used in dyeing a dye accepting substrate in either a pattern or solid shade by dispensing a dye using a plurality of dye jets in combination with the selective application of various chemical agents that may enhance the definition of patterned designs across the substrate. More particularly, the controlled application of such chemical agents in relation to the application of dye may be used to curtail color migration of dye between selected zones across the substrate thereby sharpening boundaries between patterned zones. The use of such containment may be useful in both solid colored as well as patterned substrates. In the case of solid shades, deeper shading is achieved across the entire surface. In the case of patterned substrates such practices offer the ability to deliberately and selectively emphasize certain pattern areas or elements, creating desirable visual effects.

It is common to define a textile pattern in terms of pixels, and individual dyes, or combinations of dyes, are assigned to each pixel in order to impart the desired color to that corresponding pixel or pixel-sized area on the substrate. The application of such dyes to specific pixels is achieved through the use of many individual dye jets, mounted along the length of the various color bars (also referred to as application bars) that are positioned in spaced, parallel relation across the path of the moving substrate to be patterned. Each jet in a given color bar is supplied with dye from the same dye reservoir, with different color bars being supplied from different reservoirs, typically containing different dyes. By generating jet actuation instructions that accommodate the position of the jet along the length of the color bar and the position of the color bar relative to the position of the target pixel on the moving substrate, any available dye from any color bar may be applied to any pixel within the pattern area on the substrate, as may be required by the specific pattern being reproduced.

In the past, various chemical agents sometimes have been applied to the substrate using techniques such as baths, pads, sprayers, or other appropriate devices. Using such devices, surfactants or other dye migration modifying agents have been applied substantially uniformly to the surface of the substrate prior to the patterning step of selectively applying dyes in accordance with pattern information, as is set forth in, for example, commonly-assigned U.S. Pat. Nos. 4,740,214 and 4,808,191 both of which are incorporated by reference as if fully set forth herein.

It is contemplated that the application of dye-migration-limiting agents may be utilized in combination with controlled dye application across a substrate to effect enhanced color depth and pattern definition. The applied dye may be rapidly fixed across the substrate to prevent blurring or fading of the developed pattern or depth of shade. The selective application of dye-migration-controlling agents may be carried out in registration with, or otherwise in relation to, dye application such that the migration or diffusion characteristics of the dispensed dye on the substrate may be curtailed in specific, predetermined areas of the pattern to provide patterned products having a variety of visual effects thereby providing a wide variety of aesthetic advantages. If desired, a dye pattern (or solid shade) may be positionally fixed across a textile substrate by the dual complementary mechanisms of chemical migration controlling agents in combination with RF (radio frequency) heating to arrest dye migration through fixation of applied dye and dye blends. The use of such RF heating thus further enhances pattern definition.

Figure 30:
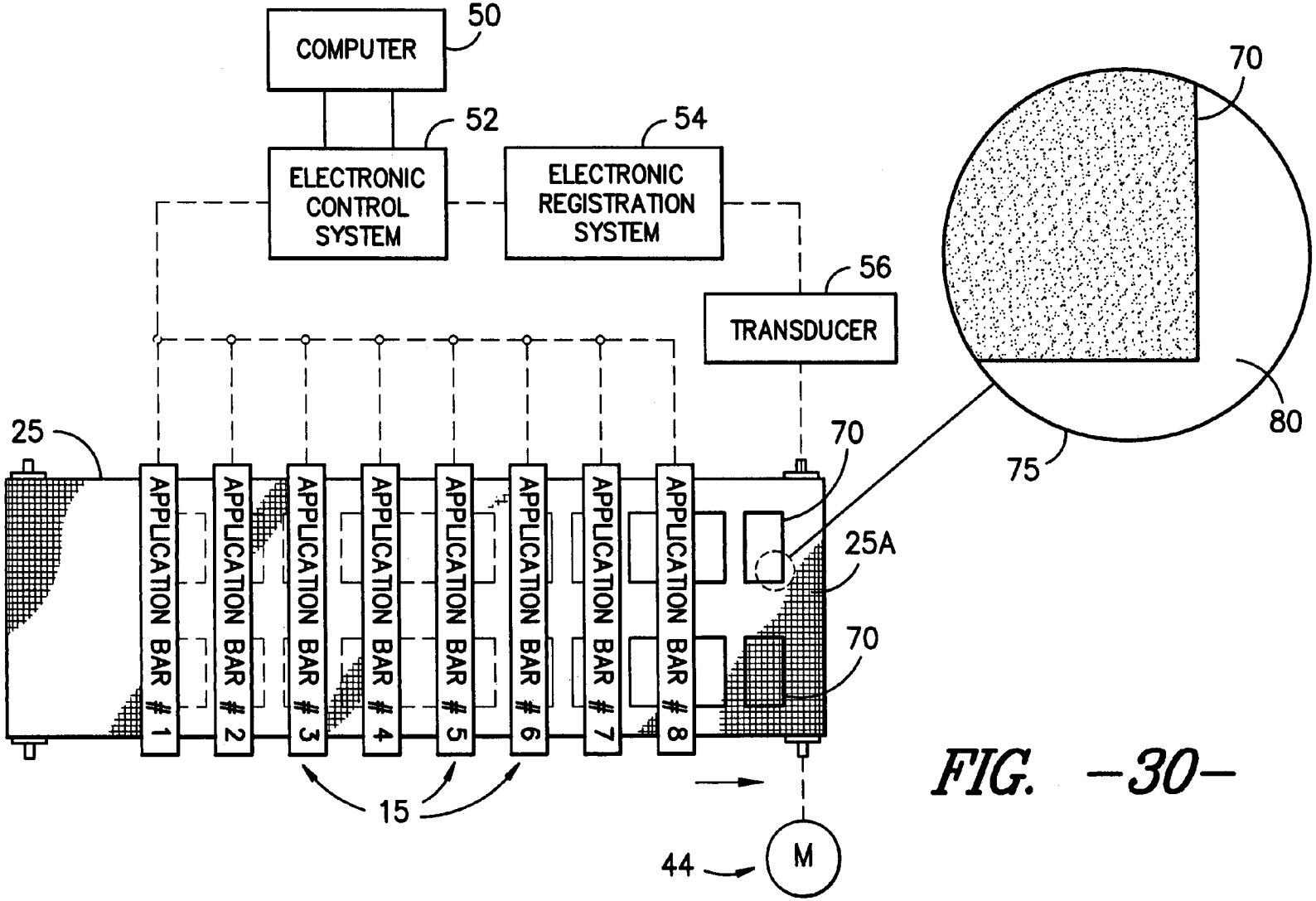
FIG. 30 schematically depicts plan view of a patterning device showing block colored areas of the substrate.

As illustrated schematically in FIG. 30 a substrate 25 is passed beneath an arrangement of application bars 15 for pixel-wise placement of dye and/or migration-controlling agents. After being transported under application bars 15 in a manner that provides for the accurate pixel-wise placement of dye-migration-controlling agents and dye in precisely-defined areas of the substrate, the patterned substrate 25A may be passed through other, conventional dyeing-related steps such as drying, fixing, etc. For example, the pattern-dyed, textile material may be passed through an RF heater as will be described further hereinafter, to fix patches of discrete or blended dyes thereon. Included in FIG. 30 are block representations of computer system 50 associated with electronic control system 52, electronic registration system 54, and rotary pulse generator or similar transducer 56. The collective operation of these systems results in the generation of individual "on/off" actuation commands that control the flow of fluid from the application bars to the substrate in a controlled manner.

It is contemplated that textile materials may be patterned or dyed in solid shades using a wide variety of natural or synthetic dyes, including acid dyes, basic dyes, reactive dyes, direct dyes, disperse dyes, mordant dyes, or pigments, depending upon the application and the fiber content of the substrate to be dyed. The teachings herein are applicable to the use of a broad range of such dyes, as well as a broad range of textile materials. Textile materials which can be dyed by means of the present invention include knitted, woven, and non-woven textile materials, tufted materials, bonded materials and the like. Typically, but not necessarily, such textile materials will include a pile surface. Such textile materials may include floor coverings (e.g., carpets, rugs, carpet tiles, floor mats, etc.), drapery fabrics, upholstery fabrics (including automotive upholstery fabrics), and the like. Such textile materials can be formed of natural or synthetic fibers, such as polyester, nylon, wool, cotton and acrylic, as well as textile materials containing mixtures of such natural or synthetic fibers, or combinations thereof.

According to a first contemplated practice, at one of the first or second application bars, a "leveler" such as a surfactant of anionic character as described in U.S. Pat. No. 4,110,367 to Papalos (incorporated by reference) is applied either uniformly or in a desired pattern across the substrate 25. The character of the leveler is preferably neutral or of the same ionic character as the dye. Most preferably, the leveler is of the same ionic character to the dye solution and is of counter-ionic character to the substrate. Thus, if the substrate is nylon which is generally neutral or cationic in character, the leveler will most preferably be anionic in character. By way of example only, and not limitation, various contemplated surfactants of anionic character include mixed fatty alcohol sodium sulfates, alkyl sulfonates, alkyldiaryl sulfonates, sulfonated sulphones dialkyl sulfosuccinates, alkane or alkene-amido-benzene-sulphonics, monosulfonated alkylphenoxy glycerol, alkyl-substituted diphenyl ether sulfonates, and sulfonated alkylphenoxy acetones. It is also contemplated that corresponding sulfate or phosphate compounds may be used in place of any of the aforementioned sulfonated compounds. Nonionic aliphatics may also be utilized if desired. One anionic surfactant which is believed to be particularly useful is believed to be a sulfonate dispersion available under the trade designation TANAPURE® AC from Bayer Corporation Industrial Chemicals Division having a place of business in Pittsburgh, Pa., USA. Of course, the leveler may also be applied to the substrate by other techniques such as padding, spraying, dip coating, or the like thereby avoiding the need to use an application bar.

At one of the application bars, a migration limiting composition may be applied. According to the preferred practice of the invention, the migration limiting composition is counter-ionic to the dye. In the event that the leveler is ionic in character, the migration limiting composition is preferably counter-ionic to the leveler. The application of the migration limiting composition may be either uniform across a zone where migration is to be limited or may be applied as a trace outline to define a boundary for migration prevention. Coverage by the migration limiting composition across a zone to be dyed facilitates the development of high relief coloration at that zone. It is also contemplated that the migration limiting composition may be applied either selectively or uniformly across the substrate with or without a leveler.

As will be appreciated, the application of a migration limiting composition of counter-acting character to a previously applied leveler composition tends to at least partially override the effects of the leveler at the location where the migration limiting composition is applied. Thus, even if a substrate is treated uniformly with a leveler at a preliminary step, localized zones of reduced migration may be established across the substrate by the patterned application of effective amounts of a counter-acting migration limiting composition.

According to one contemplated practice, the migration limiting composition includes a component which is counter-ionic to a component in the dye so as to react with the dye. Thus, according to the preferred practice, one of the dye or the migration limiting composition includes a cationic component while the other contains an anionic component. If desired, the dye may also include a constituent to enhance the reaction between the counter-ionic components of the dye and the migration limiting composition. Preferably the reactive ionic component in at least one of the migration limiting composition or the dye solution includes an ionic polymeric material, e.g., a material having a molecular weight of at least about 5,000, preferably at least about 10,000. More preferably, both the dye and the migration limiting composition include reactive polymeric materials having a molecular weight of at least about 5000 (more preferably at least about 10,000). According to the most preferred contemplated practice, both the dye and the migration limiting composition include anionic reactive polymeric materials having a molecular weight of at least about 5000 (more preferably at least about 10,000). Anionic polymeric constituents which are contemplated include biopolysaccharides such as xanthan gum, acrylic acid containing polymers, sodium alginate and the like. Cationic polymeric constituents include polyacrylamide copolymers having cationic groups, e.g., polyacrylamide copolymers containing primary, secondary and tertiary amines, both quaternized and non-quaternized. Non-polymeric anionic constituents include anionic surfactants such as sodium dodecyl benzene sulfonate and the like. Non-polymeric cationic constituents include cationic surfactants such as didecyl dimethyl ammonium chloride and the like.

In a process wherein the dye and the migration limiting composition include reactive counter-ionic components, the cationic component (from one of the dye solution or migration limiting composition) and the anionic component (from the other of the dye solution or migration limiting agent) desirably come into contact with each other when the dye solution is applied to the textile material. An ionic interaction then occurs effectively controlling undesired migration of the dye.

The desired interaction of the cationic component with the anionic component at zones where migration is to be limited may conveniently be accomplished by applying one of the ionic components to the textile material in the form of the migration limiting composition carried within an aqueous solution (which is disposed in patterned relation across the substrate relative to the migration promoting agent) prior to application of the dye solution in the desired pattern and then applying the corresponding counter-ionic material as a component of the dye solution in registry with the migration limiting agent. Thus if the cationic component is first applied to the textile material as a component of the migration limiting agent, the anionic component may be applied as a component of the dye solution. Similarly, if the anionic component is first applied to the textile material as a component of the aqueous solution, the cationic component may be applied as a component of the dye solution. If desired, jet applicators may be used to apply dye and migration limiting composition substantially in registry in a pattern across the substrate.

As mentioned above, a migration limiting composition containing one of the reactive ionic components is preferably applied to the textile material at zones where dye is to be contained prior to application of the dye solution. This ionic component, i.e., either the anionic component or cationic component, may typically be provided in the solution in an amount of from about 0.1 percent to about 10 percent, preferably from about 0.2 to about 5 percent, by weight based upon the weight of the aqueous solution. A wide range of additional textile dyeing pretreatment chemicals may also optionally be provided in the aqueous solution so long as those chemicals do not interfere with any skin forming interaction. Examples include, for instance, wetting agents, buffers, etc. Ideally the pH of the aqueous solution may be from about 3 to about 9, although the pH is not critical.

The amount of solution carrying the migration limiting composition applied to the textile material may vary widely from an amount sufficient to thoroughly saturate the textile material to an amount that will only barely moisten the textile material. The amount of cationic or anionic component provided may vary widely depending upon the molecular weight, number of ionic groups, etc. In general the amount of migration limiting composition applied may be from about 1 percent to about 300 percent, preferably about 5 percent to about 200 percent and most preferably about 50 percent to about 150 percent by weight based upon the weight of the textile material. After application of the migration limiting composition in a desired pattern, the textile material may be dried prior to application of the dye solution or alternatively the dye solution may be applied directly without prior drying of the textile material.

Of course, it is to be understood that alternative migration limiting compositions may be applied in patterned relation across the substrate. By way of example only, and not limitation, it is contemplated that a process as described in U.S. Pat. No. 4,808,191 (incorporated by reference) may be used wherein an aqueous solution of a metal salt having a charge of +2 or more is applied to the substrate after which an aqueous dye solution containing dye and thickening agent which will form a complex with the previously applied metal salt is applied in a pattern across the substrate. The complex coordinating with the dye thereby inhibits migration of the dye substantially beyond the boundaries of the pattern. It is believed that in such a process that as a result of the pretreatment of the textile material to be dyed the metal salt binds to the fibers of the textile material, such that when the aqueous dye-thickener solution is subsequently applied, according to a desired pattern, the thickener forms a complex with the "fixed" metal and the complex coordinates with the dye. As a result, the dye molecules are stably bound, by virtue of the textile substrate-metal-thickener-dye complex, and dye migration by either of the diffusion or capillary action routes is inhibited. Potentially preferred metal salts include those of aluminum, zirconium, hafnium, boron, magnesium, calcium, zinc, strontium, barium, gallium and beryllium.

According to the potentially preferred practice, in the event that such migration limiting compositions are used, it is contemplated that they are selectively applied in a patterned arrangement across the substrate at zones where migration limitation yielding high relief is desired rather than being dispensed across the entire substrate as taught in the prior art. In addition, a migration promoting agent is preferably dispensed across at least a portion of the remainder of the substrate such that a combination of migration limitation and promotion is established simultaneously across the substrate, but possibly in different pattern areas.

It is also contemplated that other migration limiting compositions in the form of dye fixing/receiving compositions may be selectively applied at zones where high relief is desired. According to one contemplated practice, such a dye fixing/receiving composition includes a dye fixing agent and an ink receiving agent. In one embodiment, the dye fixing/receiving compound can include a compatible resin binder. Additional additives can be used with the dye fixing/receiving composition, such as whitening agents, antimicrobial agents, light stabilizers/UV absorbers, and lubricants.

In one embodiment, the dye fixing agent has a molecular weight of at least about 1000. In one embodiment, the dye fixing agent includes reactive amino compounds of highly cationic nature. One potentially preferred reactive amino compound is a compound having a high positive charge density (i.e., at least one (1) milliequivalent per gram). Reactive amino compounds that can be used in the present invention include compounds containing at least one primary, secondary, tertiary, or quaternary amino moiety. Additionally, the reactive amino compounds can contain a reactive group that is capable of reacting with the textile substrate or resin binder to form a bond thereto. Examples of a reactive group include epoxide, isocyanate, vinyl sulphone, and halo-triazine. In particular, epichlorohydrin polyamine condensation polymer may be particularly useful.

Ink receiving agents in the dye fixing/receiving compositions which may be useful include inorganic particles that receive the ink through adsorbency or absorbency. In one embodiment, the particle size of the ink receiving agent is equal to, or less than, about 10 microns. In another embodiment, the particle size of the ink receiving agent is equal to, or less than, about 3 microns. In yet another embodiment, the particle size of the ink receiving agent is equal to, or less than, about 1 micron. Examples of contemplated ink receiving agents include silica, silicate, calcium carbonate, aluminum oxide, aluminum hydroxide, and titanium dioxide. Bohemite alumina and silica gel may work particularly well as the ink receiving agents in dye fixing/receiving compositions, especially silica gel particles that have been treated to carry a cationic charge. In the case of silica gel particles, alumina surface coating and cationic silane surface modification may be desired. It is believed that the microporous nature of the bohemite alumina and silica gel allow further physical entrapment of a dye/pigment, such as an anionic dye/pigment, to afford improved wash fastness. In one embodiment, the inorganic particles have a porosity with a pore diameter from about 10 nm to about 200 nm.

In most formulations, the cationic charge from cationic reactive amino compounds is much greater than the cationic charge present on the inorganic particles. Therefore the mere presence of relative minor cationic charge on the inorganic particle would not significantly improve the dye/substrate interaction through cationic-anionic charge interaction. It is the combination of highly charged reactive amino compounds and the microporous inorganic particles that further improves the migration limiting character of the treated substrate.

In one embodiment, the dye fixing agent typically will comprise from about 0.2% to about 20% by weight of the treated textile substrate. The ink receiving agent typically will comprise from about 0.2% to about 20% by weight of the treated textile substrate. In one embodiment, the dye fixing/adsorbing composition comprises from about 1% to about 20%, by weight, of the treated textile substrate. In another embodiment, the dye fixing/adsorbing composition comprises from about 1% to about 5%, by weight, of the treated textile substrate. In another further embodiment, the dye fixing/adsorbing composition comprises from about 5% to about 10%, by weight, of the treated textile substrate. Prior to placement on the textile substrate, the dye fixing/receiving composition is preferably in the form of a stable aqueous solution or dispersion.

As indicated, the dye fixing/adsorbing composition may be used in combination with a resin binder to limit dye migration. It is contemplated that the resin binder will be of a character to have a good bond with the fiber of the textile substrate. The resin binder can be a thermoplastic or thermosetting polymeric binder. Such a binder preferably has a glass transition temperature of below about 40° C. It is also preferred that the binder be durable when subjected to washing. Examples of resin binders include non-anionic or cationic lattices, such as ethylenevinylacetate, acrylic, urethane polymer, polyamide, polyester, and polyvinyl chloride. In one embodiment, the resin binder comprises up to about 10% of the weight of the treated substrate.

It is believed that the dye fixing agent interacts with the ionic dyes in a charge type attraction, and that the dye fixing agent of the present invention typically will react with the fiber of the textile substrate to form a chemical bond with the textile substrate. In an embodiment where a resin binder is used, it is believed that the dye fixing agent will chemically bond with the resin binder, which bonds with the textile substrate. It is also believed that the ink receiving agent provides surface area for the ink from the patterning device to interact with the dye fixing agent, thereby facilitating the effects of the dye fixing agent.

Patterned application of a dye fixing/adsorbing composition as described above in registry with applied dyes may provide a printed textile with excellent color brightness and print resolution. These benefits may be particularly pronounced for aqueous pigment ink placed on the treated textile substrate on a pixel by pixel basis. More particularly, an aqueous pigment ink, with a pigment to ink ratio of about 10 to 1 or greater, by weight, of binder can be printed on a treated textile substrate to produce a water fast and weatherable printed image on the treated textile. Furthermore, pigment ink with about 10%, by weight, or less of binder can be printed onto the textile substrate with a treatment of a quaternary amino compound, with or without the inorganic particles, and provide a durable print. The quaternary amino compound can be secured to the textile substrate by a chemical bond, or any other appropriate method. It is believed that the treatment swells when it receives the aqueous ink. It is also believed that this swelling will increase the chances of the interaction between the pigment particles of the ink and highly cationic and porous features of the treatment.

Concentration of dyestuff in the dye is totally dependent on the desired color but, in general, may be in a range that is conventional for textile dyeing operations, e.g. about 0.01 to about 2 percent, preferably about 0.01 to about 1.5 percent, by weight, based upon the weight of the dye solution, exclusive of the thickener. The amount of thickener added to the aqueous dye solution is selected to provide the desired viscosity appropriate to the particular pattern dyeing method.

In general, dyes are combined with a number of other constituents such as thickening agents, defoamers, wetting agents, biocides, and other additives to arrive at the dye solution that is dispensed by the patterning device. In general, amounts of thickener range from less than 0.1 to about 3 weight percent, based on the weight of the dye solution. For drop on demand devices viscosities are preferably within the range of from about 800 to about 5000 centipoise, depending upon the operating conditions (e.g., dye pressure and applicator orifice size). Note that all viscosity values listed herein are intended to be measured by a Brookfield LVT viscometer with No. 3 spindle, running at 30 rpm and 25° C.

It has been found that by selectively patterning the substrate 25 with migration enhancing compositions that a substantially enhanced degree of freedom is established in the development of complex patterns. In particular, the selective application of treatment chemistries in combination with patterned dye application affords substantial freedom in the creation of sharp transitions between colored regions.

By way of example only, and not limitation, in the break-out section 75 of FIG. 30, a colored block 70 as may be developed by the application of one or more dyes from one or more application bars is illustrated within a background zone 80. By way of example only, in the color block 70, a substantially level deeply shaded solid coloration of high relief may be achieved by patterned application of one or more dye solutions from one or more application bars across a substrate on which a pattern of migration limiting composition corresponding to the boundaries of the color block 70 has been applied.

According to the potentially preferred practice of the present invention, prior to application of a dye solution, the substrate 25 is treated with a migration limiting composition of cationic character such as an aqueous solution containing a cationic polyacrylamide copolymer, quaternized ammonium salt or other suitable composition as previously described which is counter-ionic to an agent in the dye solution such that the migration limiting composition is dispensed across the substrate 25 in a pattern which substantially encompasses the color block 70. According to a potentially preferred practice, the disposition of the migration limiting agent will preferably be coextensive with the boundaries of the color block 70. By way of example only, the controlled disposition of the migration limiting composition may be effected by jet impingement patterning using one of the application bars 15. In this regard it is to be understood that the migration limiting composition may be applied either directly across the surface of the substrate 25 or in overlying relation to a previously applied surfactant or other leveler composition. After the migration limiting composition is applied, at least one dye solution containing a dye with or without a thickening agent is applied in a desired pattern. The dye and/or any thickening agent is of ionic character to react with the migration limiting composition in covering relation to the color block 70. Due to the reaction between the migration limiting composition and the counter-ionic component(s) in the dye solution, diffusion of the dye past the boundary of the color block is substantially precluded.

As will be appreciated, regardless of the migration character within a given zone, once a dye has been applied, it is desirable to rapidly and efficiently fix the dye at the substrate so as to preclude further undesired blending and/or migration. In the past, such fixation has been effected by a wide range of techniques including super heated steam, natural and forced air heating as well as heating using radiant and/or convective heat transfer mechanisms.

In accordance with a potentially preferred practice of the present invention, once a dye has been applied, RF (radio frequency) electric fields may be applied to an effective controlled depth within the substrate as to effectively and rapidly heat the dyed portion of the substrate so as to prepare the dye for fixation. The parameters of the RF application are controlled so as to provide rapid directional heating to a controlled depth into the substrate while at the same time avoiding burning or other damage of structural components of the substrate material. It is contemplated that such RF heating treatment may be particularly beneficial in the treatment of a pile fabric such as a carpet or the like although it may also be used in treatment of other substrates. Thus, while the process will hereinafter be described through reference to treatment of a pile carpet fabric, such description is to be understood to be exemplary and explanatory only.

According to one aspect of the present invention, heating energy may be delivered to the substrate in the form of electric fields generated using a so-called "fringe-field" electrode system operated at frequencies within the RF range with alternating positive and negative electrodes disposed in opposing relation over the pile surface of the carpet. The operating frequency, and arrangement of electrodes is established so as to provide and maintain the desired heating energy level.

Figure 31:
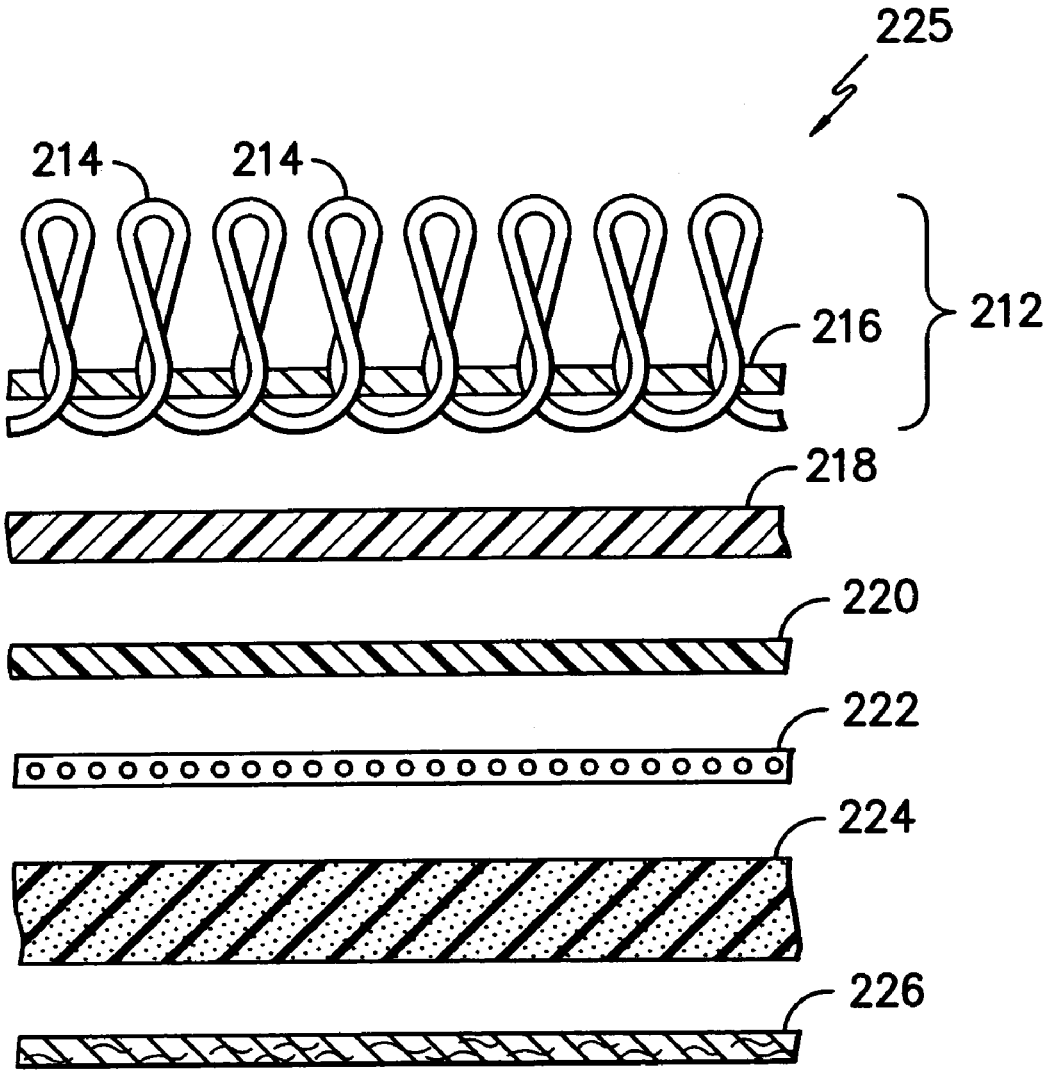
FIG. 31 is an exploded schematic view of an exemplary multi-layered carpet construction.

Referring to FIG. 31, an exemplary substrate structure 225 in the form of a cushion backed carpet or carpet tile as may be treated by RF heating is illustrated. In this exemplary construction, the substrate structure 225 is made up of a primary carpet fabric 212 formed from a plurality of pile yarns 214 tufted through a primary backing layer 216 such as a scrim or nonwoven fibrous textile of polyester or polypropylene as will be well known to those of skill in the art. A precoat backing layer 218 of a resilient adhesive such as SBR latex is disposed across the underside of the primary carpet fabric 212 so as to hold the pile yarns 214 in place within the primary backing 216. An adhesive layer 220 such as a hot melt adhesive extends away from the precoat backing layer 218. A layer of stabilizing material 222 such as woven or nonwoven glass is disposed at a position between the adhesive layer 220 and a cushioning layer 224 such as virgin or rebonded polyurethane foam or the like. A secondary backing layer 226 such as a nonwoven blend of polyester and polypropylene fibers is disposed across the underside of the cushioning layer 224.

As will be appreciated, the actual construction of the substrate structure 225 may be subject to a wide range of variations. Accordingly, the multi-layered construction illustrated in FIG. 31 is to be understood as constituting merely an exemplary construction representative of a carpet and that the present invention is equally applicable to any other construction of carpeting and or other textiles as may be desired. By way of example only, various carpet tile constructions are described in U.S. Pat. Nos. 6,203,881 and 6,468,623, the contents of which are hereby incorporated by reference as if fully set forth herein.

In the event that the substrate structure is a carpet, the pile yarns 214 may be either spun or filament yarns formed of natural fibers such as wool, cotton, or the like. The pile yarns 214 may also be formed of synthetic materials such as polyamide polymers including nylon 6 or nylon 6,6, polyesters such as PET and PBT; polyolefins such as polyethylene and polypropylene; rayon; and polyvinyl polymers such as polyacrylonitrile. Blends of natural and synthetic fibers such as blends of cotton, wool and nylon may also be used within the pile yarns 214. In FIG. 31, the pile yarns 214 are illustrated in a loop pile construction. Of course it is to be understood that other pile constructions as will be known to those of skill in the art including cut pile constructions and the like may likewise be used.

As described above, a pattern configuration of migration controlling chemicals and dyes may be applied across the substrate 225 so as to develop desired patterning across the surface of the substrate 225. The patterning which is developed may be the result of discrete process colors in patterned relation across the substrate 225 and/or the controlled in situ blending of two or more process colors. Moreover, the patterning may be further controlled by substantially controlling the degree of permitted dye migration. Regardless of the patterning techniques which are utilized, it is desirable to have the ability to substantially arrest further dye migration and/or blending in a rapid controlled manner by fixing the dyes in place.

In accordance with a potentially preferred practice, it has been found that using an RF (radio frequency) heater permits the achievement of rapid and efficient temperature elevation to a controlled depth within the substrate so as to facilitate dye fixation at the dyed portions of the substrate. In operation, RF heaters introduce an alternating electric field within the item to be heated thereby causing water molecules within such material to rotate rapidly in an attempt to align with the changing electric field. Such rotation generates heat within the product.

Applicants have recognized that the proper application of RF heating may be utilized to enhance dye fixation across a carpet or other textile substrate material following the patterned application of dye solution to the pile yarns. In particular, it has been found that the application of RF electric fields may provide rapid heating so as to arrest dye diffusion in a rapid and controlled manner. Moreover, due to the fact that heating is carried out to a controlled depth, the energy transfer to the substrate is more efficient and the potential for damage to various construction layers underlying the dyed surface of the substrate is substantially minimized.

In application, the present invention preferably makes use of a so-called "fringe field" RF heating unit such as that which is shown schematically in FIG. 34. The RF application unit 230 includes a generator 232 connected to an arrangement of alternatingly charged elongate electrodes 234. In the potentially preferred construction, the electrodes 234 are in the form of rods extending above and transverse to a conveyor 236 which carries the substrate 225, such as a carpet through the heating zone. It has been found that by proper selection of the operational frequency and electrode configuration relative to the substrate, that proper surface heating and fixation may be achieved without the potentially detrimental occurrence of arcing between the electrodes and/or undue heating of structural elements below the surface. As illustrated in phantom lines, an application field is developed in a patterned arrangement between the alternating electrodes. The fields so generated extend an operative distance into the substrate 225 so as to provide the energy to effect molecular rotation within the field boundaries.

The substantially controlled operative depth of the field generated between the electrodes in relation to the various layers of a substrate composite structure is illustrated in FIG. 35. As shown, the operating frequency and electrode spacing are such that the effective electric field extends to a position just below the pile yarns so as to avoid any substantial heating of any underlying layers which may contain moisture.

The use of RF heating to enhance dye fixation is believed to promote the rapid fixation of the dye chromaphore at the pile yarns 214 such that even at relatively low concentrations of dye, a deeper shading is achieved at the visible surface of the pile yarns 214. This improvement in shade retention is illustrated in FIG. 36, wherein light reflection is measured at the yarn tips of carpet samples dyed with the same concentration of the same dye but where one sample undergoes dye fixation using RF preheating followed by steaming while the other sample undergoes dye fixation using steam fixation alone. The measure of reflectance along the Y axis is reported in terms of ADOBE PHOTOSHOP® L values wherein a lower number represents a darker shade corresponding to enhanced light absorption and correspondingly reduced reflectance. As shown, at lower concentrations of dye application, the carpet treated with RF preheating exhibited darker shading. The difference in shading became less pronounced as increased concentrations of dye are applied. However, even at the higher dye application levels, the enhanced shading at the yarn tips within the carpet treated using RF preheating was measurable.

While the phenomena resulting in the enhanced coloration at the yarn tip is not fully understood, it is believed that the use of RF heating rapidly heats the dyed portions of the substrate to a level sufficient to arrest the tendency of the dye solution to wick away from the application zones. Convective and/or conductive heating does not appear to provide the very early arrest of the dye migration which appears to be provided by RF heating. Thus, the use of RF heating has been found to substantially improve the definition of patterns across the substrate by preventing pixel to pixel diffusion from progressing beyond the point desired while also avoiding the occurrence of so called frostiness at the tips of the dyed yarns.

It is believed that in actual practice, the use of fringe field RF dye heating may be utilized to substantially improve both the efficiency of the dye fixation process as well as the aesthetic appearance of the product formed thereby. A wide array of actual product formation practices incorporating RF heating to aid in dye fixation are contemplated. By way of example only, and not limitation, various procedures applicable to the treatment of carpet are illustrated in FIGS. 32 and 33.

According to a first contemplated practice illustrated in FIG. 32, a substrate such as a carpet fabric of tufted or bonded construction including a plurality of outwardly projecting pile yarns is subjected to a dye application step during which dye is applied in a pattern across the surface. This application may be by any known technique, although the controlled streaming of dye solutions wherein the dye is applied on a pixel by pixel basis may be preferred. Following application of the dye to the carpet pile, the pile is thereafter heated by RF heating using a fringe field RF heating unit so as to apply an activating electric field to a predefined depth within the carpet pile. The dye may be fixed at this step if desired. Following the RF heating step, the carpet is thereafter cooled. If desired, this cooling may be facilitated by use of a forced cooling unit.

In FIG. 33, the principal steps in a potentially preferred substrate dyeing and treatment process are shown. In this process, a substrate such as a carpet of tufted or bonded construction including a multiplicity of outwardly projecting pile yarns is pretreated by a migration limiting composition as described above. Following the application of the migration limiting composition, the dye is applied in a pattern across the carpet pile by jet streaming. Following the dye application, the pile is preheated by a fringe field RF heating unit which applies an activating electric field to an effective depth within the carpet pile. Following the RF heating step, dye fixation is completed by application of steam heat. The carpet may thereafter be washed, dried and cooled prior to use.

As previously indicated, the processes as outlined above may be particularly useful in the manufacture of floor covering textiles including broad loom carpet and carpet tile. One potentially preferred process of forming a broadloom carpet using a substrate such as 6' wide, 12' wide, 14' wide, broadloom substrate is provided at FIG. 37. As will be appreciated, the broad loom substrate may be a tufted carpet, bonded carpet, or the like. According to the exemplary process illustrated, one may pretreat the substrate with, for example, steam, a wetting agent, or the like, print or dye the substrate using a textile patterning machine, heat the substrate to fix the dye, wash the substrate to remove excess dye or other materials from the dye chemistry such as gums or the like, treat the dyed substrate with for example strain blocker chemistries, bleach resist chemistries, or anti-microbial and antifungal chemistries, and thereafter either wash it again or move the substrate directly to a drying procedure involving for example vacuuming, nip rolling, and drying, thereafter cooling the substrate, and then cutting the substrate into rolls of broadloom, slitting it from 12' wide to 6' wide, and/or the like.

In accordance with a particular embodiment of a process or procedure for printing or dyeing a broadloom substrate and with reference to FIG. 37 of the drawings, there is an added pre-heat or pre-set of the substrate following printing utilizing a heating means such as radio frequency (RF), infrared (1R), microwave (MW), or the like upstream of a first steam section followed by a treatment step, if any, followed by a second steaming procedure, then to a treatment process followed by vacuuming or nip rolling and then an additional treatment process if desired, for example adding fluorocarbon, stain blocker, bleach resistance, or the like, followed by drying, and then a post drying using an RF, IR, or MW energy source to drive off moisture, followed by cooling and cutting. In the process shown in FIG. 37, energy is conserved by using a RF, IR, or MW pre-heat followed by conventional steaming so that the RF, IR, or MW energy is not required to do the entire fixing of the dye. Likewise, post drying is done by RF, IR, or MW following a conventional circulating hot air dryer so that the RF, IR, or MW is used to dry only the last remaining moisture from the substrate. In this fashion, energy is conserved and costs are reduced.

Also, by providing for a treatment step between two steaming operations, one can add agents which are fixed by the second steaming procedure.

Although FIG. 37 may relate to a potentially preferred embodiment of a broadloom treatment process, the present invention is in no way limited thereto.

Figure 38:
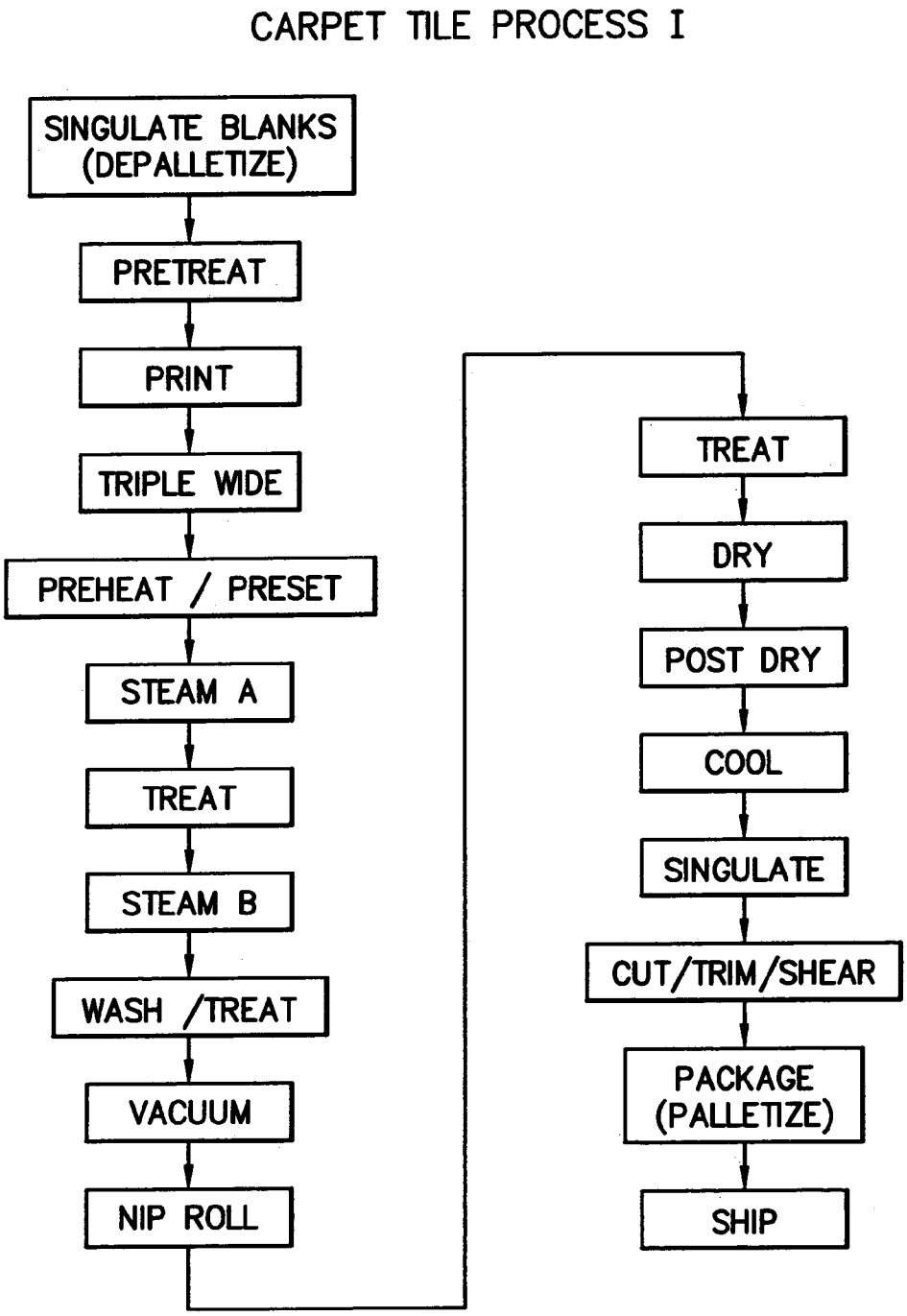
FIG. 38 is a flow chart illustrating an exemplary process for formation of a carpet tile product which may incorporate patterned printing and/or RF preheating.

Like the process of FIG. 37, FIGS. 38 and 39 relate to a rather detailed processes of printing or dyeing carpet tiles in accordance with exemplary fist and second embodiments of the present invention. With reference to FIG. 38 of the drawings, undyed carpet tile blanks are delivered and depalletized or singulated, pretreated by steam, wet out, or the like, printed or dyed in a preferably single file fashion, then conveyed into a triple wide arrangement of tiles which go through a preheat, preset step, for example, utilizing RF, IR, or MW, the first steaming step, a treatment step, a second steaming step, a wash and treatment step, vacuuming, nip rolling, and an additional treatment step if desired, drying, post drying using, for example IR, RF, or MW, cooling, singulating back to single tile formation, then going through an edge trimming and face shearing operating as needed, then packaged, palletized, and shipped.

In accordance with the second exemplary process of FIG. 39 of the drawings, the tiles go through the pre heat or preset step in a single file fashion prior to being conveyed into a triple wide arrangement. This provides for a preheat or preset apparatus which must only treat a single line of tiles and provide for not only energy efficiency, but also insures that each tile is treated in the same fashion so to avoid any inconsistencies that might occur across three tiles being conveyed through a preheat or preset device. Treating single wide tiles insures that each tile is treated in the same fashion so as to avoid any inconsistencies that might occur across three tiles being conveyed through a preheat or preset device, such as an RF, IR, or MW device. It is preferred that each and every tile be treated in the same fashion so that the resultant products are identical to insure that quality is maintained.

A basic jet dyeing, patterning, or printing process includes the basic steps of presenting a dyeable substrate in a controlled fashion under one or more dye applicators, controlling the dye applicators to selectively dye predetermined pixels or locations on the substrate, controlling the transport of the substrate, past or under the dye applicators so as to dye in registration, and thereafter fixing the dye, washing the substrate, drying the substrate, cutting or trimming the substrate, packaging the substrate, and the like.

In accordance with a more complex and possibly preferred process of dyeing broadloom form substrate, such as 6' wide, 12' wide, 14' wide, broadloom substrate such as tufted carpet, bonded carpet, or the like, one may pretreat the substrate with, for example, steam, a wetting agent, or the like, print or dye the substrate using a textile patterning machine, heat the substrate to fix the dye, wash the substrate to remove excess dye or other materials from the dye chemistry such as gums or the like, treat the dyed substrate with for example strain blocker chemistries, bleach resist chemistries, or anti-microbial and antifungal chemistries, and thereafter either wash it again or move the substrate directly to a drying procedure involving for example vacuuming, nip rolling, and drying, thereafter cooling the substrate, and then cutting the substrate into tiles, area rugs, rolls of broadloom, slitting it from 12' wide to 6' wide, and/or the like.

In accordance with a particular embodiment of a process or procedure for printing or dyeing a broadloom substrate and with reference to FIG. 37 of the drawings, there is an added pre-heat or pre-set of the substrate following printing utilizing a heating means such as radio frequency (RF), infrared (IR), microwave (MW), or the like upstream of a first steam section followed by a treatment step, if any, followed by a second steaming procedure, then to a treatment process followed by vacuuming or nip rolling and then an additional treatment process if desired, for example adding fluorocarbon, stain blocker, bleach resistance, or the like, followed by drying, and then a post drying using an RF, IR, or MW energy source to drive off moisture, followed by cooling and cutting. In the process shown in FIG. 32, energy is conserved by using a RF, IR, or MW pre-heat followed by conventional steaming so that the RF, IR, or MW energy is not required to do the entire fixing of the dye. Likewise, post drying is done by RF, IR, or MW following a conventional circulating hot air dryer so that the RF, IR, or MW is used to dry only the last remaining moisture from the substrate. In this fashion, energy is conserved and costs are reduced.

Also, by providing for a treatment step between two steaming operations, one can add agents which are fixed by the second steaming procedure.

Although FIG. 32 may relate to a potentially preferred embodiment of a broadloom treatment process, the present invention is in no way limited thereto.

Like the process of FIG. 32, FIGS. 33 and 34 relate to a rather detailed processes of printing or dyeing carpet tiles in accordance with exemplary fist and second embodiments of the present invention. With reference to FIG. 33 of the drawings, undyed carpet tile blanks are delivered and depalletized or singulated, pretreated by steam, wet out, or the like, printed or dyed in a preferably single file fashion, then conveyed into a triple wide arrangement of tiles which go through a preheat, preset step, for example, utilizing RF, IR, or MW, the first steaming step, a treatment step, a second steaming step, a wash and treatment step, vacuuming, nip rolling, and an additional treatment step if desired, drying, post drying using, for example IR, RF, or MW, cooling, singulating back to single tile formation, then going through an edge trimming and face shearing operating as needed, then packaged, palletized, and shipped.

In accordance with the second exemplary process of FIG. 34 of the drawings, the tiles go through the pre heat or preset step in a single file fashion prior to being conveyed into a triple wide arrangement. This provides for a preheat or preset apparatus which must only treat a single line of tiles and provide for not only energy efficiency, but also insures that each tile is treated in the same fashion so to avoid any inconsistencies that might occur across three tiles being conveyed through a preheat or preset device. Treating single wide tiles insures that each tile is treated in the same fashion so as to avoid any inconsistencies that might occur across three tiles being conveyed through a preheat or preset device, such as an RF, IR, or MW device. It is preferred that each and every tile be treated in the same fashion so that the resultant products are identical to insure that quality is maintained.

Product Detailed Discussion

Figure 219:
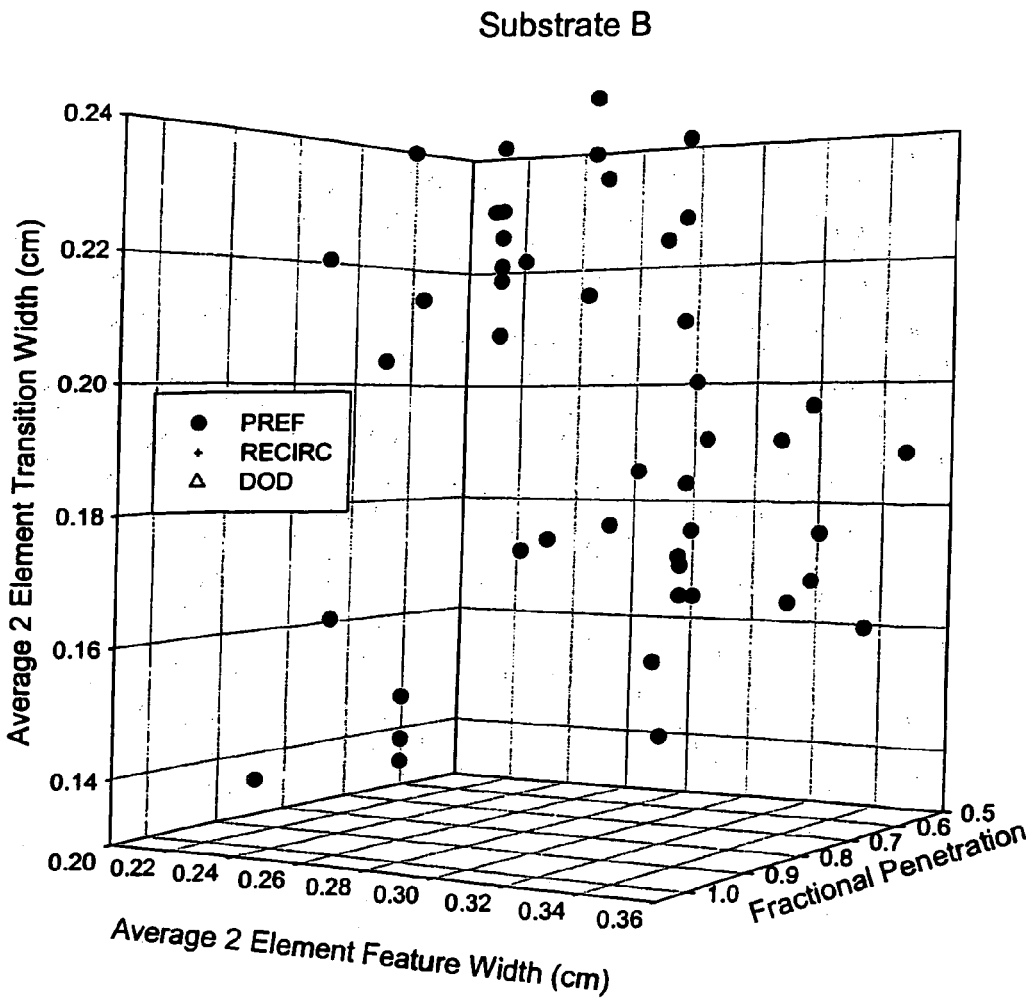
Figure 220:
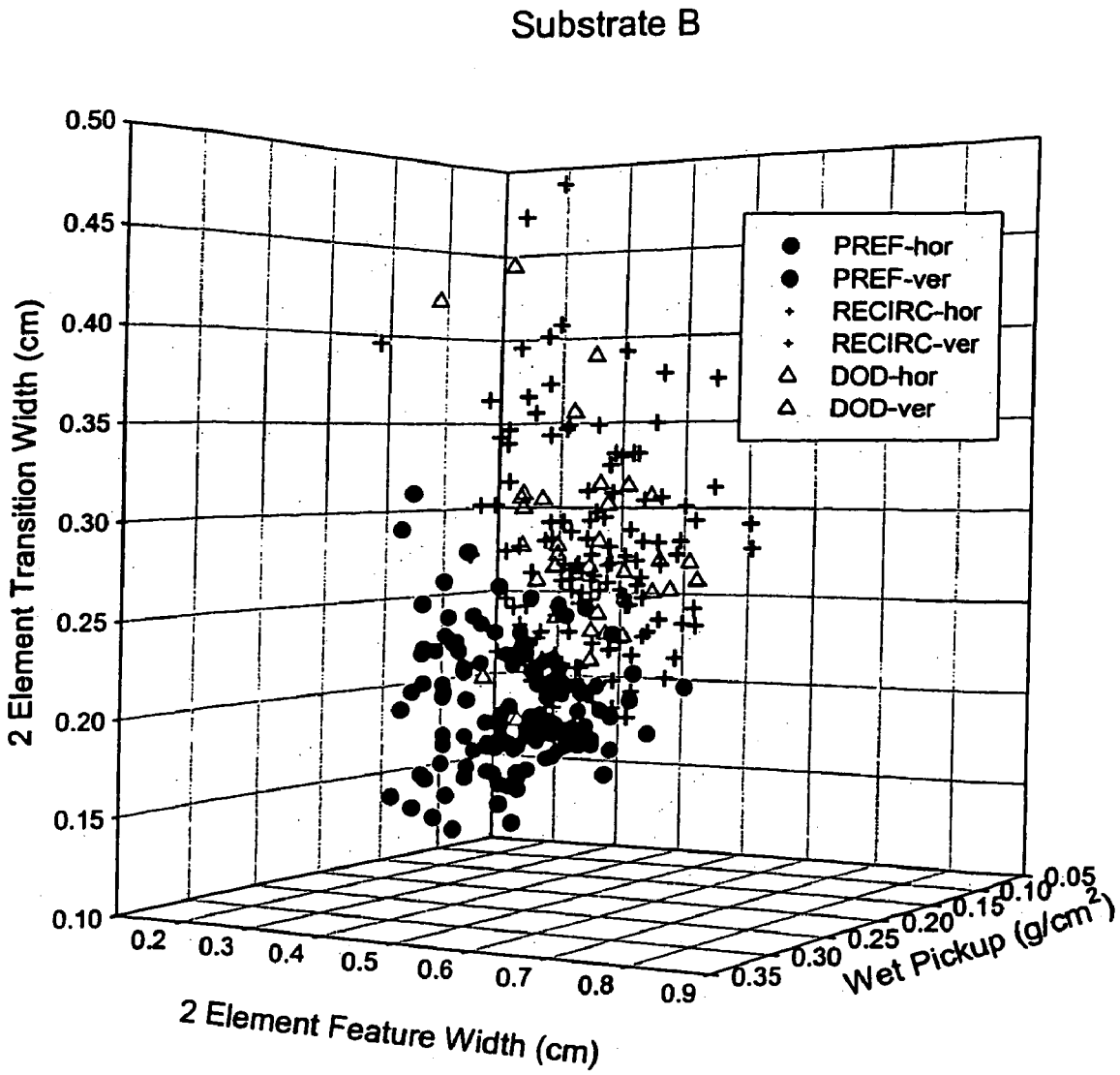

As discussed above, the patterning system described herein has been shown to have the ability to produce patterned floor covering textiles that are unique in ways that are both visually apparent and scientifically measurable. The basis for this statement will be explained in conjunction with FIGS. 40 through 219. These Figures show an exemplary floor covering substrate—here, a carpet tile—that has been patterned in a way that will illustrate the discussion that follows, and additionally show and explain various measurements and the results of these measurements made on representative substrates carrying a similar pattern. For comparison purposes, the patterning system used will include not only the preferred stationary color bar, drop-on-demand patterning system described in detail above, but also the alternative drop-on-demand and recirculation-type patterning systems discussed above.

FIG. 40 depicts a patterned pile carpet tile 10 with dyed pattern areas 1 through 6, each area being dyed a different, visually uniform color that forms a boundary with at least two adjacent pattern areas. Additionally, each pattern area contains at least two sets of design elements in the form of a series of progressively dimensioned rectangles or "test bars" of uniform length but decreasing thickness that are positioned to be closely parallel to an immediately adjacent pattern area, from which the test bar derives its color. For example, the 5 sets of test bars in Pattern Area 3 contains the respective colors of Pattern Areas 1, 2, 4, 5, and 6. The thickness of each test bar in a set, but not their relative spacing, follows a decreasing progression in terms of integral pixel widths (0.05 inches or 1.27 mm), with the thickest test bar for the PREF and RECIRC patterning systems being 0.30 inches (7.62 mm) thick and spaced 0.5 inches (1.27 cm) from the respective pattern area, the next-thickest test bar being 0.25 inches (6.35 mm) thick, and so on, through the following progression: 0.20 inches (5.08 mm), 0.15 inches (3.81 mm), 0.10 inches (2.54 mm), and 0.05 inches (1.27 mm). A corresponding test pattern was generated for the DOD patterning device, with units appropriate for the pixel width (0.0625 inch or 0.159 mm) of that device.

Accordingly, the thinnest test bar (with dimensions dictated by the pixel size or gauge of the patterning device) has a thickness of one pixel (0.05 in./1.27 mm or 0.0625 in./0.159 mm) and is positioned 0.5 inches (1.27 cm) from the immediately preceding test bar. These test bars provide, for purposes of discussion, certain features that were used to establish differences in pattern definition and appearance that are believed to distinguish the products of the preferred patterning process from that of any other process intended for the automated patterning of textile substrates on a commercial scale. These distinctive characteristics are discussed below.

One distinctive characteristic of the pattern produced by the preferred stationary color bar, drop-on-demand patterning system described in detail above, is the dramatic abruptness with which a first color that characterizes a first pattern area can transition into a second color that characterizes an immediately adjacent second pattern area. This abruptness, which provides for sharply-defined pattern elements, has been quantified as a Transition Width between the two adjacent pattern areas, and shall be used as a measure of the improvement in pattern definition that is achievable using the teachings herein. The concept of relative contrast between adjacent pattern areas, which contributes to perceived visual contrast, depth of color, and pattern definition (collectively referred to as pattern "pop") is related to Transition Width in that a small Transition Width tends to emphasize differences between boundary colors, and therefore contributes to the perception of increased contrast.

Closely related to the concept of Transition Width is that of Feature Width, a second distinctive characteristic of the preferred pattering system described herein. Feature Width may be thought of as the shortest distance over which an observable pattern feature or element can be accurately and reliably displayed on the substrate or, alternatively, as effective gauge, i.e., the level of detail or degree of resolution that can be achieved on a specified substrate with a specified patterning system. Measures of Feature Width will be used to confirm that the preferred patterning system is capable of providing an effective printing gauge that is much closer to the theoretical maximum gauge of the pattering system than the other systems tested. The subjects of Feature Width and effective gauge will be discussed in greater detail below.

The effect of good Transition Width performance is enhanced where Feature Width performance (i.e., pattern detail) is also good. If both performances are good, the pattern has considerable apparent relative contrast, and appears both highly defined and visually rich. If fine detail is present, but Transition Width performance is mediocre or poor, the overall relative contrast is appreciably reduced, and the resulting pattern appears lacking in "pop," and the fine detail appears indistinct or washed out.

It will be readily understood by those skilled in the art that both of the above characteristics—Transition Width between adjacent colors and Feature Width of small-scale details—are functions of several parameters, the most important of which are believed to include (1) the physical nature and uniformity of the substrate and its wicking characteristics, (2) the nature of the dye (particularly its viscosity and its interaction with any topical chemical treatments that modify the surface energy of the substrate and thereby modify the migration characteristics of the dye following its application), and (3) the quantity of dye that is applied to the substrate. Each of these will be discussed in turn.

It can be readily appreciated even by those not skilled in the art that attempting to form, using liquid colorants, a pattern having high definition on a substrate that is both inherently absorbent and inherently non-uniform (as are most textiles) is a daunting task. Not only does the inherent non-uniformities of substrate construction (e.g., small temporary differences in the direction of pile lay or in yarn height or twist) make difficult the application of dye to the substrate along a stable, well-defined line, but the migration characteristics of the dye following application frequently result in uncontrolled and undesirable lateral wicking of the dye into adjacent pattern areas, thereby degrading edge definition.

Figure 41A:
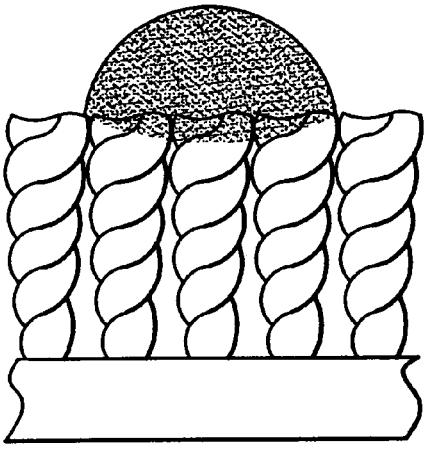
FIGS. 41A and 41B systematically depict performance of a dye drop on a cut pile surface.
Figure 41B:
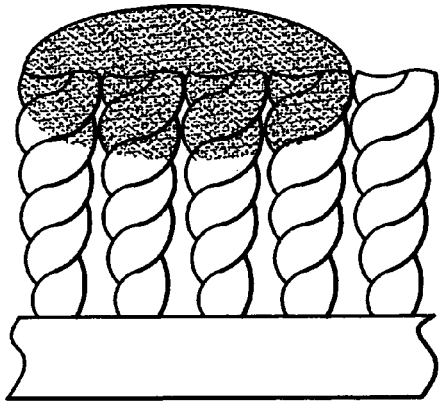
Figure 42A:
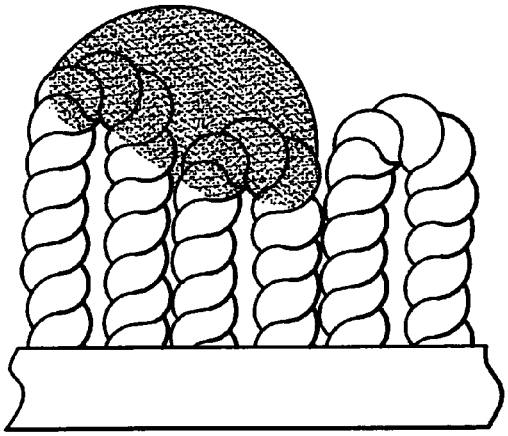
FIGS. 42A and 42B systematically depict performance of a dye drop on a loop pile surface.
Figure 42B:
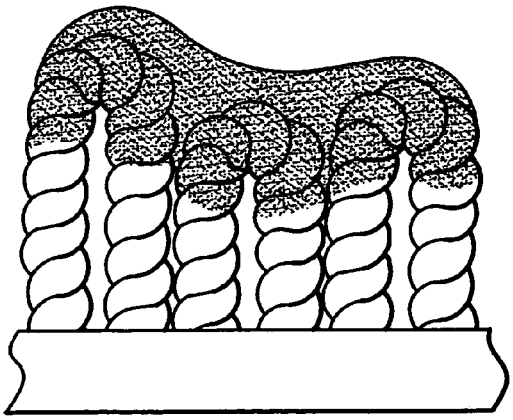

Generally speaking, low viscosity dyes tend to migrate within a substrate more readily than high viscosity dyes. Accordingly, use of low viscosity dyes has both favorable and unfavorable consequences: greater migration yields less lateral control of ultimate dye placement, and therefore tends to reduce the definition with which a pattern can be reproduced, but also tends to promote vertical migration (i.e., migration along the length of the yarn or fiber), and therefore tends to increase the dye penetration within the substrate. Contrariwise, high viscosity dyes provide relatively greater lateral control of ultimate dye placement, but frequently such lateral control comes at the expense of limiting vertical migration within individual yarns or groups of yarns. This is graphically depicted in FIGS. 41A and 41B. In FIG. 41A, a dye drop is shown on a cut pile textile surface that is well controlled laterally, but also is not providing appreciable penetration. Conversely, the dye drop of FIG. 41B appears to be providing substantially more penetration, but at the expense of significant lateral migration. FIGS. 42A and 42B show similar effects on a loop pile textile surface. Attempts to simultaneously retain the advantages of low viscosity and high viscosity dye systems, without the attendant disadvantages, have usually involved the addition or application of various chemical migration modifying agents to the dye or to the substrate, as discussed in detail above.

Those skilled in the art will also recognize that the quantity of dye applied to a given area on the substrate is of considerable significance, in that relatively sharp transitions and relatively high definition in patterns frequently are achievable if wet pickup (a measure of the quantity of dye applied to and incorporated into the substrate) is reduced to a level at which only the top-most portion of the constituent yarns or fibers comprising the substrate surface are consistently and thoroughly dyed. By so doing, the migration between adjacent yarns or fibers is minimized and the observed definition of the rendered pattern is improved. This improvement, however, can result in decreased dye penetration within the substrate, yielding yarns or textile fibers that carry the desired color only along a relatively small proportion of their length and that tend to show incompletely dyed yarns or textile fibers beyond the yarn tips when the pile surface is brushed or parted. Accordingly, for a given substrate and a given dye and topical chemistry system, it is believed that the PREF patterning system described herein yields a patterned product that is unique in that the pattern simultaneously can exhibit both high definition and high dye penetration within the substrate.

In order to understand the following discussions relating to color measurement, it is necessary to understand that the measurement of color commonly involves separate measurements of various components of color. A widely-recognized system, known as the CIELAB system is a rectangular, three-dimensional coordinate system in which the respective perpendicular axes are lightness ("L*), redness/greenness ("a*") and yellowness/blueness ("b*"). Accordingly, differences in color between a first color (e.g., that color characteristic of Pattern Area 1) and a second color (e.g., that color characteristic of Pattern Area 2) can be represented by the respective differences in L* values, a* values, and b*values, or, mathematically, $$\Delta L^* = L^*_{Color\ 1} - L^*_{Color\ 2}$$

$$\Delta a^* = a^*_{Color\ 1} - a^*_{Color\ 2}$$

$$\Delta b^* = b^*_{Color\ 1} - b^*_{Color\ 2}$$

with the total color difference represented by:

$$\Delta E^*_{ab} = [(\Delta L^*)^2 + (\Delta a^*)^2 + (\Delta b^*)^2]^{1/2}$$

While the above formulae specifically address the CIELAB color identification system, it is known that the Lab system used in Adobe Photoshop® (distributed by Adobe Systems of San Jose, Calif.) (hereinafter, "Photoshop®") is substantially the same, and was used as indicated for the analyses herein. Accordingly, the mathematical relationships expressed above, with slightly different nomenclature, are equally valid for the Photoshop® Lab system.

To understand the discussions herein concerning the migration and blending behavior of various color pairs along common boundaries, it is necessary to introduce the concept of a dominant boundary color. In many cases, where two colors in a pattern are contiguous, the boundary region separating the respectively colored areas, if magnified, would appear to comprise an essentially monotonic increase in the visual concentration of one color, overlaid by a roughly corresponding essentially monotonic decrease in the visual concentration of the other color. In some cases, one sees in the boundary region a third color that is the subtractive combination of the two colors that appears in the central portion of the boundary region. Therefore, in a magnified view, the boundary region resembles a graduated transition from one color to the other (perhaps with the introduction of a third color in the middle of the transition), although, due to ever-present variations in color imposed by substrate surface and wicking irregularities and other factors, discussed below, the transition is not necessarily a smooth one.

Where the boundary is formed by one of a class of colors termed "dominant boundary colors," this "graduated transition" model might need to be modified. Such colors are sufficiently dark or chromatically dominant that they may establish a relatively well-defined boundary, with little apparent blending or co-mingling of color, wherever they stop migrating, regardless of the migration of the color in the opposing pattern area. One can intuitively appreciate that, where, for example, black dye is applied to Pattern Area 1 and beige dye is applied to Pattern Area 2, the resulting boundary region is likely to be defined much more in terms of the extent to which the black dye has migrated into areas occupied by some beige dye, rather than in terms of the extent to which beige dye has migrated into areas occupied by some black dye. This is due to the fact that any mixtures of black and beige dye—regardless of any preponderance of beige dye in the mixture—are more likely to be perceived as black rather than beige. Other colors that exhibit this behavior, and thus can be considered dominant boundary colors, include red, dark blue, and green. Generally, for two dyes at the same concentration (i.e., dye molecules per unit volume), the much darker color is the dominant color. For the same dye at different concentrations, the color with the much higher concentration will dominate.

Through use of Kubelka-Munk Theory, this relationship, in somewhat simplified form, can be expressed mathematically by the following generalized inequality that expressed the case where a first dye dominates a second dye:

$$C_1 \cdot [k_1/s_0] \geqq\geqq C_2 \cdot [k_2/s_0]$$

where $C_1$ and $C_2$ are the concentrations of the first and second dyes, respectively, $k_1$ and $k_2$ are their respective coefficients of light absorption, and $s_0$ is the coefficient of light scattering of the substrate. Those skilled in the art will recognize that the various coefficients are wavelength-specific, and the above comparison must be modified for colors with chroma to include the effects of perceptual discrimination at different wavelengths; e.g., the use of CIELAB $\Delta E^*_{ab}$.

Notwithstanding the above, it should be understood that, generally, boundary regions appear to have characteristics that are a composite of behavior often associated with dominant colors (e.g., relatively well-defined contours where the dominant color defines the boundary) and behavior often associated with non-dominant color interactions (e.g., relatively graduated transitions from one pattern color to the other). Visual assessments of patterns are usually most influenced by the dominant colors.

Regardless of whether dominant or non-dominant colors are involved, the boundary region tends to be non-uniform in nature, thereby requiring some means by which they are minimized so that useable data relating to color change within the boundary region can be measured. It will be recalled that several distinctive characteristics of the patterns generated by the preferred patterning system described above—Transition Width, Feature Width, and effective gauge—were identified. With the above as background, measuring these characteristics will now be discussed in greater detail.

According to the teachings herein, the concept of Transition Width is perhaps the most fundamental in discussions concerning the description and analysis of high definition patterning of textiles. It involves the quantification of the changes in color between adjacent colored areas within a pattern, as measured across a common boundary, and is simply an attempt to characterize the degree of abruptness with which a transition from one colored area on the substrate to an adjacent colored area can be achieved. Good Transition Width performance has been found to be of fundamental importance in establishing a pattern that exhibits high definition.

Intuitively, it might appear that the most direct way to measure a transition between two adjacent colored areas would be to make calorimetric measurements, starting well within Pattern Area 1 and extending along a direct path to a point well within Pattern Area 2. Theoretically, the edges of the boundary region—that region in which the respective colors of Pattern Areas 1 and 2 measurably influence each other—should be apparent provided a sufficiently sensitive instrument is used. Due primarily to the surface topology of the substrate surface and its attendant non-uniform reflective properties, repeated measurements along different paths crossing the same boundary region can produce results that vary wildly due to an apparent "substrate noise" component, superimposed on the color signal, that can significantly obscure the onset of the boundary region. Usually, this situation is only made worse by increasing the sensitivity or the resolution of the measurement system. Accordingly, the concept of a defined, mathematically-derived Transition Width that includes significant data averaging is used as a refined measure of the abruptness that characterized the boundaries between colors in contiguous pattern areas. The derivation and practical calculation of this term is set forth below, and begins with the calibration of the scanning equipment.

FIG. 43 sets forth in summary form the major steps involved in determining the Transition Width of a selected portion of a boundary region. It should be noted that each of the steps indicated in FIG. 43 is explained in further detail in connection with FIGS. 46 and 47A-47C that collectively describe the image data acquisition and analysis procedures associated with generating Transition Width and Feature Width data from the test patterns.

Step 800 of FIG. 43 involves the calibration of the scanner to be used in scanning the sample for which a Transition Width and/or Feature Width is to be calculated. This calibration procedure is set forth in more detail in FIG. 44, discussed below. Not mentioned in FIG. 44 are those good practices known to those skilled in the art, such as allowing adequate scanner warm-up time, cleaning the glass surface of the scanner, etc.

As seen in FIG. 44, steps 852 through 870 are collectively directed to the calibration of a color scanner or similar device that can, when properly calibrated, scan a pattern appearing on a textile substrate and generate a signal (perhaps with the assistance of additional signal processing software) that accurately represents color as a function of position on the substrate. Step 852 represents the scanning (in manual mode, with all automatic adjustments disabled) of a standardized color test target (e.g., Kodak Q-60 Photographic Target Standard, available from Eastman Kodak Company of Rochester, N.Y.). Such test targets are accompanied by a data disk containing CIELAB or other numerical characterizations of the colors displayed on the target (i.e., the "true" target colors) (step 854). By comparing the scanned colors with the "true" colors (step 856) with the aid of appropriate software such as GretagMacBeth's Profile Maker 3.1 (distributed by GretagMacBeth LLC of New Windsor, N.Y.), a scanner-specific color profile can be generated. This profile allows for automatic numeric representation of color in a color space (e.g., Photoshop® Lab) that closely corresponds to CIELAB, as a function of position.

An optional, but recommended, step is to assess the accuracy of the color profile, a straightforward process outlined in FIG. 44 that uses Photoshop® to convert scan values into Photoshop® Lab values. This procedure (which duplicates the image data acquisition steps 872-878 of FIG. 47A) results in the generation of a $\Delta E_{ab}^*$ value for each color in the target, generated by comparing the scanned and subsequently profiled color values of each target value with the L*a*b* values of the same target color from the calibration disk that accompanied the target, and provides an assessment of the overall colorimetric accuracy of the scanning procedure. It should be noted that step 868 of FIG. 44 preferably may be done with the aid of software that locates and isolates the respective color areas on the target. Averaging the $\Delta E^*_{ab}$ values for each color on the Kodak Q-60 target was found to result in a value of about 3.5 (with a standard deviation of the averaged $\Delta E^*_{ab}$ of about 0.2 over time). Such values were considered acceptable.

Returning to FIG. 43, step 802 refers to preparation of the sample, which involves brushing the sample to remove loose fibers and to standardize the pile lay. The sample is then oriented on the clean scanner bed and is aligned appropriately (i.e., with the boundary region or test bar of interest aligned with the side of the scanner bed), with care taken not to disturb the pile. The next step indicated in FIG. 43 involves the selection, sizing, and scanning of the boundary region formed between two pattern areas (respectively, "PATTERN AREA 1" and "PATTERN AREA 2") to be analyzed.

Selection of the location and size of the sample area to be scanned involves several considerations. Theoretically, the edges of the boundary region—where the respective colors of Pattern Areas 1 and 2 begin to mix—should be apparent provided an instrument of high sensitivity and resolution is used. However, as discussed above, such instruments tend to produce outputs that contain significant substrate noise. The degree to which such noise obscures the relevant data is determined by a number of factors, including the resolution of the scanner. Analyses using a relatively high resolution scan (e.g., 100 to 300 d.p.i.) typically resulted in a large substrate noise component, while analyses using a relatively low resolution scan more in keeping with the actual effective gauge of the pattern on the substrate (e.g., 10 to 20 d.p.i.) yielded results that were deemed too approximate or "quantized" to provide the resolving power necessary for an appropriately revealing analysis. Accordingly, a scanning resolution of 50 d.p.i. (i.e., 20 dots per centimeter) was selected as an appropriate compromise. To avoid confusion in the course of these discussion, it will be necessary to distinguish, as the context requires, this scanning resolution (sometimes expressed in terms of pixels) from the resolution, or pixel size, associated with the patterning process (i.e., patterning machine print gauge).

In a further effort to reduce the noise component due to these signal variations, it was decided that the width of the path across the boundary region should be increased from a single pixel path to a swath of 50 pixels, or one inch (2.54 cm), wide (extending parallel to the boundary region). In this way, a line profile that is an average of 50 paths was generated for each pixel along a perpendicular path across the boundary region. By so doing, substrate surface variations along the 50 pixel width associated with each scan tend to self-cancel, and the subsequent image processing steps (e.g., generating Transition Widths and Feature Widths, discussed below) are less influenced by aberrant data points. The result is a much more clearly defined curve, as depicted at 12 in FIG. 45.

It is also recommended that the selected boundary region be substantially straight (i.e., not curved) over the region tested in order to facilitate analysis in accordance with the teachings herein. An additional consideration in sizing the region to be scanned (apart from providing for an appropriate number of scan paths, discussed above) is the need to establish the correct desired endpoints of the color transition represented by the boundary region (i.e., the actual colors of the pattern areas uninfluenced by dye migration from the boundary region). Accordingly, the area of the sample that is scanned should include areas sufficiently far from the boundary region of interest that the respective colors of the two pattern areas contiguous to the boundary region can be individually characterized without the influence of the other color. If such characterization is not possible because, for instance, one (or both) of the pattern areas forming the boundary region is a fine detail, it may be necessary, in addition to the scan including the boundary region of interest, to make a separate scan of one or more similarly colored pattern area(s) in another part of the substrate surface that allows characterization of the semi-infinite color of the two pattern areas forming the boundary region.

Following these procedures, the sample is appropriately scanned (e.g., in the same manual mode used to scan the color target), with the boundary region appropriately (and consistently) oriented so that subsequent line profiling (or averaging) is parallel to the boundary region. The output of the scanner (following appropriate color profiling) is then used to generate separate Photoshop® L, a, and b color channel images (step 804). As indicated at step 806, the L, a, and b images of the semi-infinite areas selected to represent the colors of the two pattern areas forming the boundary region of interest are used to determine the overall color change ($\Delta E_{max}$) found between Pattern Areas 1 and 2. Since the color values may be encoded in a particular way to facilitate ease of image pixel storage, it may be necessary to convert the encoded values of the Photoshop® Lab values into their colorimetric equivalent. This overall color change ($\Delta E_{max}$) is used later (step 814) to calculate Transition Width (i.e., the color difference $\Delta E_{max}$ takes place over a distance $\Delta X$, the Transition Width).

In step 808, images that represent color derivatives (i.e., rate of change of color with position across the boundary region) are calculated (using two convolution kernels, discussed in connection with FIGS. 46 and 46A) for each of the three color channel images. Then the Photoshop Lab derivative images are used to calculate a derivative line profile across the boundary region for each color channel. This process may be better understood with reference to the overview diagrams of FIGS. 46 and 46A.

Figure 46:
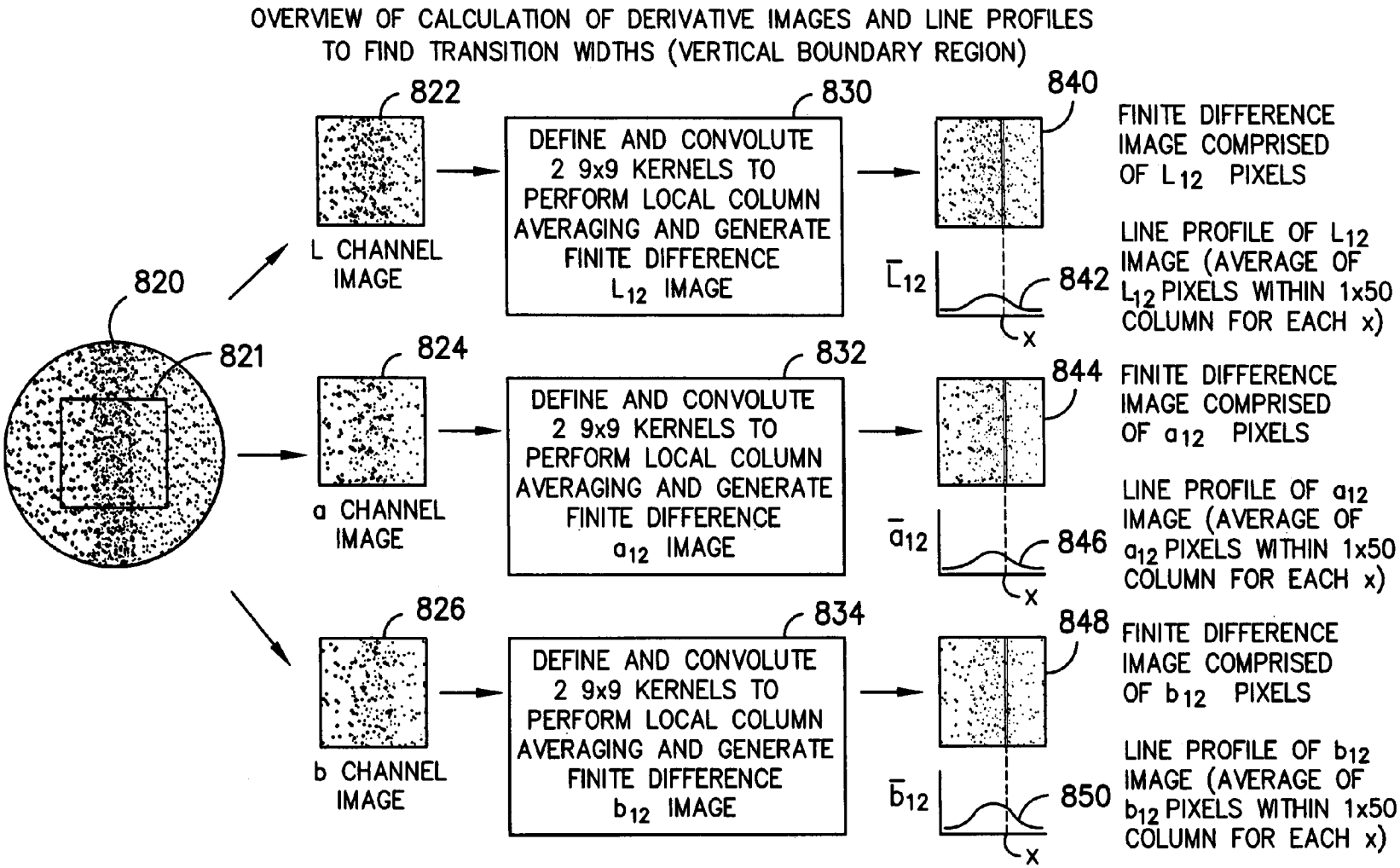
FIG. 46 is an overview of a calculation used in finding Transition Widths.

As depicted in FIG. 46, the boundary region of interest has been selected (820), a scan area representative of that boundary region and the adjoining pattern areas have been defined (821), and the individual Photoshop® L, a, and b color channel images have been generated (822, 824, and 826). The next step (830, 832, 834) involves the application of a convolution kernel that performs an averaging operation parallel to the boundary region, in this case, a 9×9 kernel, in the manner known to those skilled in the art. As a result of this operation, each pixel comprising each color channel image is assigned an average value that is calculated by adding the value of that pixel with the values of the four pixels above and below that pixel (i.e., parallel to the boundary region) and dividing by nine, thereby providing respective L, a, and b images that have been spatially averaged parallel to the boundary region.

Also as indicated in these steps (and described in more detail in FIG. 47A, at steps 886 and 888), a second convolution kernel is used, identical to the first except for having its non-zero values uniformly offset by 1 pixel in a direction perpendicular to the boundary region. This kernel has the effect of averaging the pixel values within a 1×9 column (4 pixels above and below the central pixel) parallel to the boundary region and assigning the average value to the central pixel, as above, as well as shifting the image by one pixel perpendicular to the direction of the boundary region. After all pixel locations within the scanned area have been averaged using these two convolution kernels, the results are stored. The respective color channel images are then subtracted from each other to form images representing a finite difference approximation of the derivative at the boundary for each L, a, and b color channel (see FIG. 46 at 840, 844, and 848), indicated as $L_{12}$, $a_{12}$, and $b_{12}$, respectively. A line profile across the boundary region based on each of these finite difference images is then generated, as indicated (842, 846, 850). Such signal compositing or averaging, as well as derivative calculations, may be performed using software such as Image Pro Plus®, Adobe Photoshop®, IPL®, MATLAB®, or other software having similar functionality.

The individual L, a, and b line profiles are then combined to form an overall Euclidian Color Derivative ("E.C.D."), i.e., $$E.C.D._x = \sqrt{\left(\frac{dL}{dx}\right)^2 + \left(\frac{da}{dx}\right)^2 + \left(\frac{db}{dx}\right)^2}$$

actually based on finite difference calculations, which provides a measure of the rate at which color is changing as a function of distance (x) across the boundary region. This E.C.D. optionally may be plotted to provide some visual feedback as to the nature of the color change within the boundary region. As indicated at 812 of FIG. 43, the ultimate value of the E.C.D. is in determining the maximum rate of color change within the boundary region (designated "$E.C.D._{max}$"), and determining that point ($X_{max}$) along a perpendicular path across the boundary region at which that maximum rate occurs. The Transition Width calculation is then straightforward, as indicated at 814, in accordance with the following formula:

$$\text{Transition Width}=[\Delta E_{max}/E.C.D._{max}]$$

One skilled in the art will recognize that if multiple boundary regions are present, care must be taken that the measurements of $E.C.D._{max}$ and $\Delta E_{max}$ represent the boundary region of interest.

Figure 48:
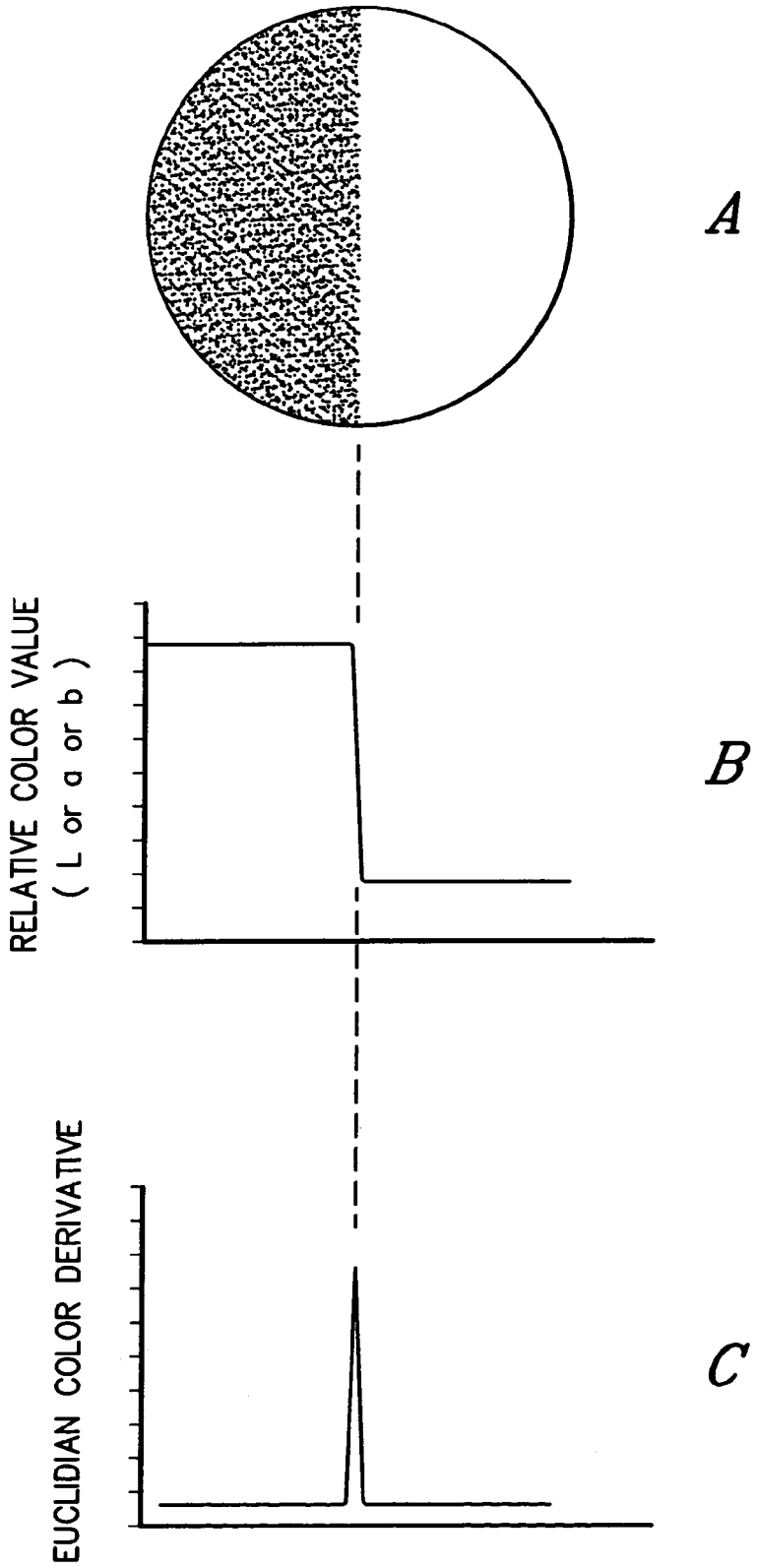
FIG. 48 depicts an idealized boundary region between two pattern areas and its associated mathematical models.
Figure 49:
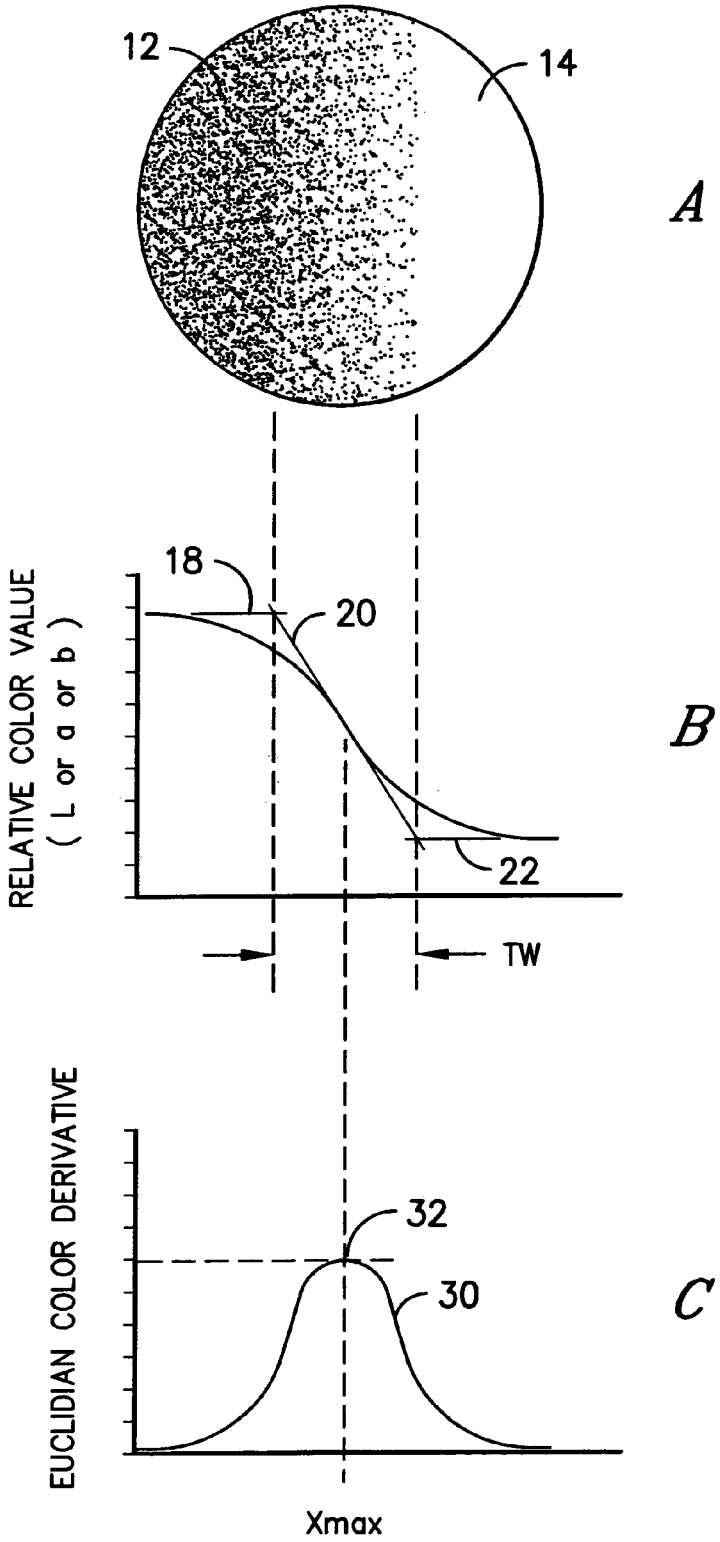
FIG. 49 is a diagram similar to that of FIG. 48, but depicting a diffused boundary region between two pattern areas.
Figure 50:
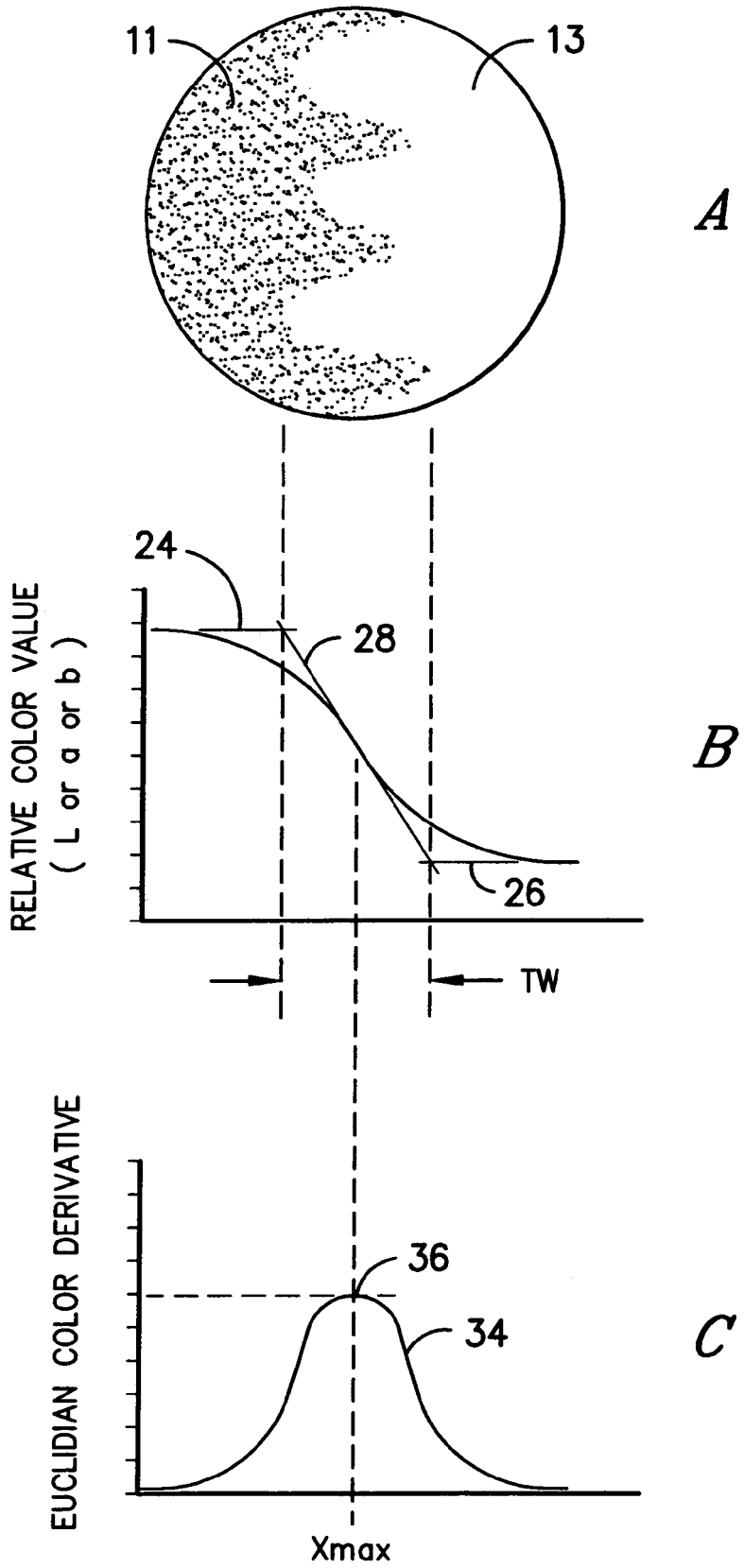
FIG. 50 is a diagram similar to that of FIG. 49, but depicts a sharp, meandering boundary region.
Figure 51:
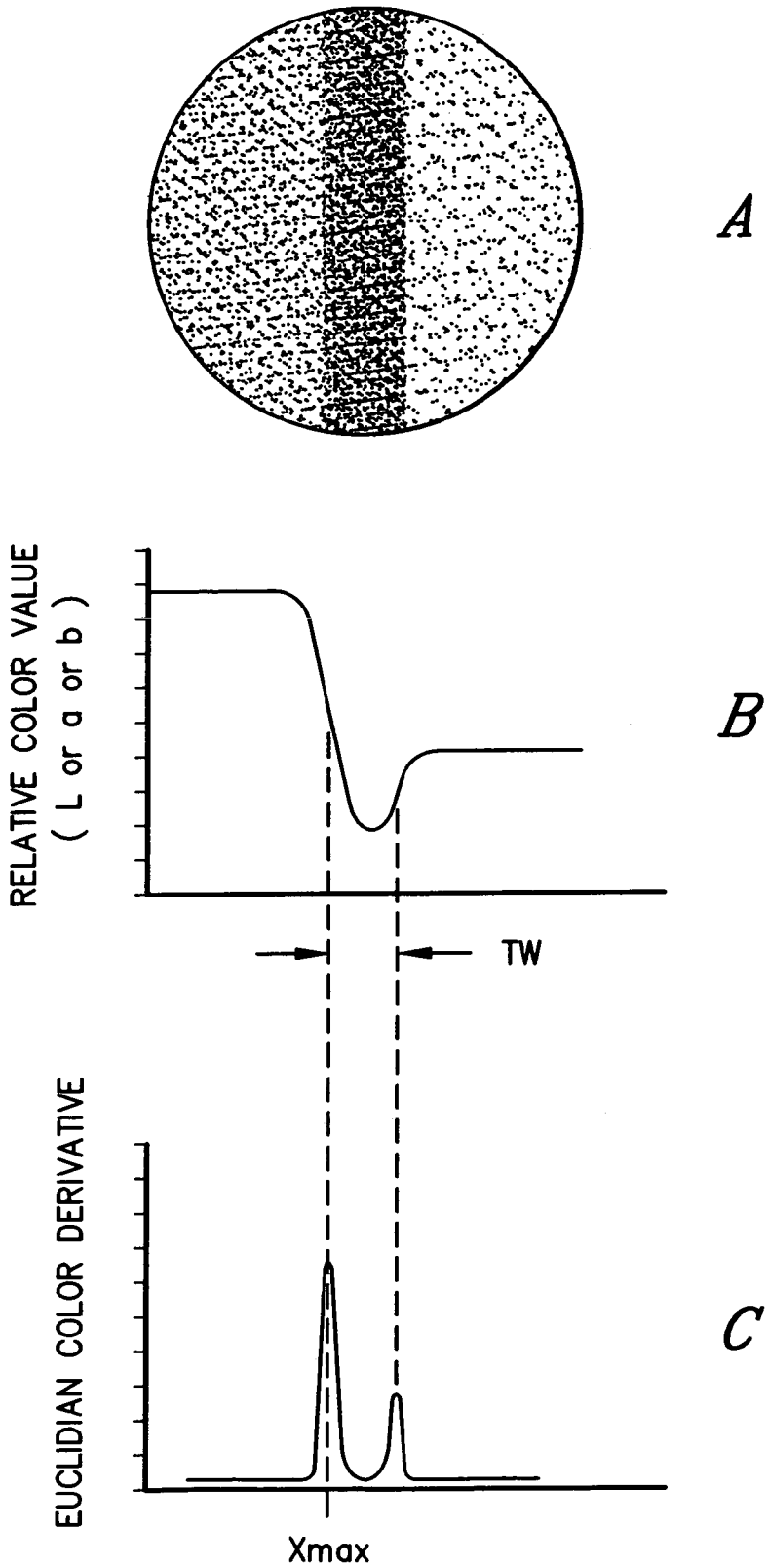
FIG. 51 is similar to FIGS. 49 and 50, but depicts a boundary region in which color blending has resulted in the formation of a third color in the boundary region.

FIGS. 48 through 51 present, by means of a graphical analogy, an alternative approach to describing this general process. FIG. 48 depicts, in highly schematic and abbreviated form, a transition from one pattern area to a second pattern area having an idealized boundary region in which no blending from one area to the other occurs. FIGS. 49 through 51 depict, in highly schematic and exaggerated form, three types of boundary regions that are commonly encountered. In most cases, the observed boundary regions more closely resemble a combination of two or more of the depicted boundary regions. FIG. 49A is an example of the first type of boundary, in which the color from a first area 12 gradually transitions into the (different) color of a second area 14. The resulting boundary region is depicted as an overlap of gradually diminishing concentrations of the respective colors comprising the opposing pattern areas. In such cases, the inevitable substrate noise that accompanies such measurements tends to obscure the leading and trailing edges of the boundary region, which is a principle reason for the adoption of the "linearized color difference curve" approach described above—such approach needs only the maximum slope of the color difference curve (an easier data element to measure or estimate), and not its measured end points, in order to calculate the edges (and the magnitude) of the Transition Width.

Color value is plotted schematically along the vertical axis of FIG. 49B as a function of relative position across the boundary region, which is plotted along the horizontal axis. For illustrative purposes, FIG. 49B has been vertically aligned with the visual representation of the boundary region in FIG. 49A. The first derivatives dL/dx, da/dx, db/dx, are calculated using any appropriate software, such as Image Pro Plus® 4.5 (available from Media Cybernetics, Inc. of Silver Spring, Md.), Adobe Photoshop®, etc. They are combined to produce the E.C.D. plotted in FIG. 49C, and also has been aligned with the visual representation of FIGS. 49A and 49B.

This derivative curve 30 represents, in graphical form, the rate of color change as a function of location across the boundary region, and generally can be expected to have a single global maximum, in this case at $X_{max}$. Depending upon the sophistication desired, this derivative is preferably calculated using all three Photoshop® Lab color channels. In recognition of the possible use of multi-dimensional color space (including the use of other color coordinate systems, such as Lightness, Chroma, and Hue), the vertical axis or magnitude of the derivative is generically labeled Euclidian Color Derivative. The horizontal axis identifies that location within the boundary region at which the rate of change of color (i.e., the rate of change of $\Delta E$) is a maximum.

Using the indicated maximum value of the E.C.D., a linearized color difference curve 20 has been constructed (49B) by drawing a straight line on the curve at $X_{max}$ with the slope equal to the maximum value of the E.C.D. When extrapolated to intersect the color values defining the $\Delta E_{max}$ (i.e., the color values 18, 22 associated with the respective opposed pattern areas at 12 and 14), the projection of these intersection points onto the X-axis defines the Transition Width ("TW") within this boundary region.

FIG. 50 depicts, in highly schematic and exaggerated form, an example of the second type of boundary that, in less "pure" form, is commonly encountered in boundary regions. In this case, the color from a first area 11 forms a much more distinct, but much more irregular, line between the two pattern areas, 11 and 13. Rather than a diffuse, subtle blending of the two colors forming the boundary, the dominant color tends to form a relatively well-defined, but wandering, edge that only generally follows the axis of the boundary and subjectively yields a pattern that, while sharply defined on a micro scale, does not contribute to the high definition appearance discussed herein. The essential character of the meandering edge, along with the inevitable textural-related noise that accompanies these color measurements, makes the determination of the leading and trailing edges of the boundary region a meaningless matter unless some sort of averaging or weighting process is used. Again, the adoption of the "linearized color difference curve" approach described above can be used in such cases, as such approach needs only the maximum slope of the color difference curve (an easier data element to measure or estimate), and not its measured end points, in order to calculate the edges (and the magnitude) of the Transition Width.

Color value is plotted along the vertical axis of FIG. 50B as a function of relative position across the boundary region, which is plotted along the horizontal axis. For illustrative purposes, FIG. 50B has been vertically aligned with the visual representation of the boundary region in FIG. 50A. The first derivatives (again calculated using any appropriate software, such as Image Pro Plus® 4.5) is plotted in FIG. 50C, and for illustrative purposes, also has been aligned with the visual representation of FIG. 50A. Using the indicated maximum value 36 of the first derivative 34, a linearized color difference curve 28 has been constructed. When extrapolated to intersect the color values characterizing the respective opposed pattern areas (at 24 and 26, respectively), the projection of these intersecting points onto the X-axis defines the Transition Width within this boundary region.

It has been observed that, in some cases, the boundary region between the color of one region and the color of a second, contiguous region does not involve a transition involving only the two respective colors, but rather involves the formation of an entirely different, intermediate color within the boundary region, such as when red and green blend into each other to form brown. That situation is graphically illustrated, in similar fashion, in FIG. 51. In such cases, calculation of the derivative yields two peaks, and the less dominant peak is ignored. The calculation of Transition Width and Feature Width is based only on the larger derivative peak.

Figure 47A:
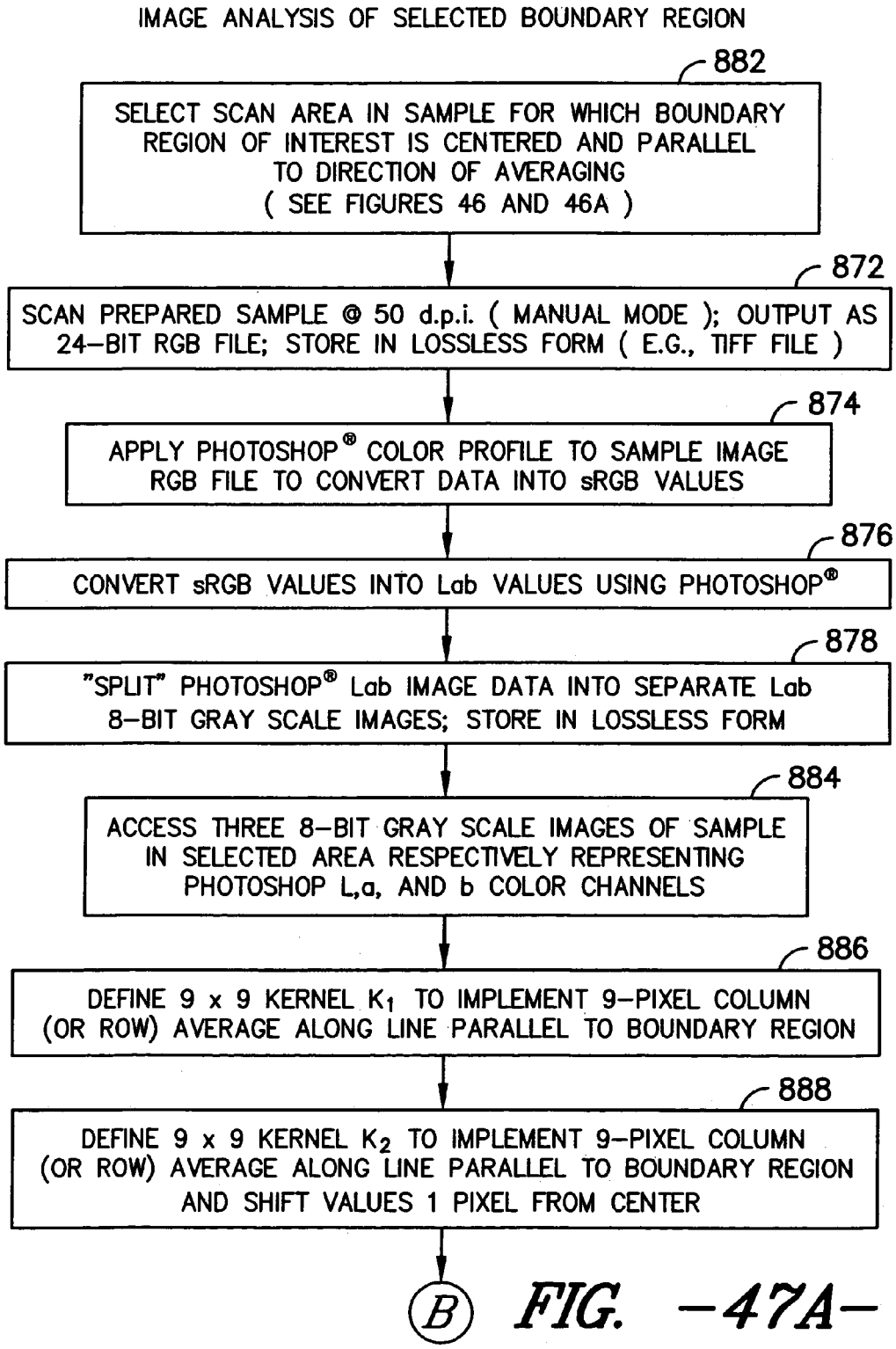
Figure 47B:
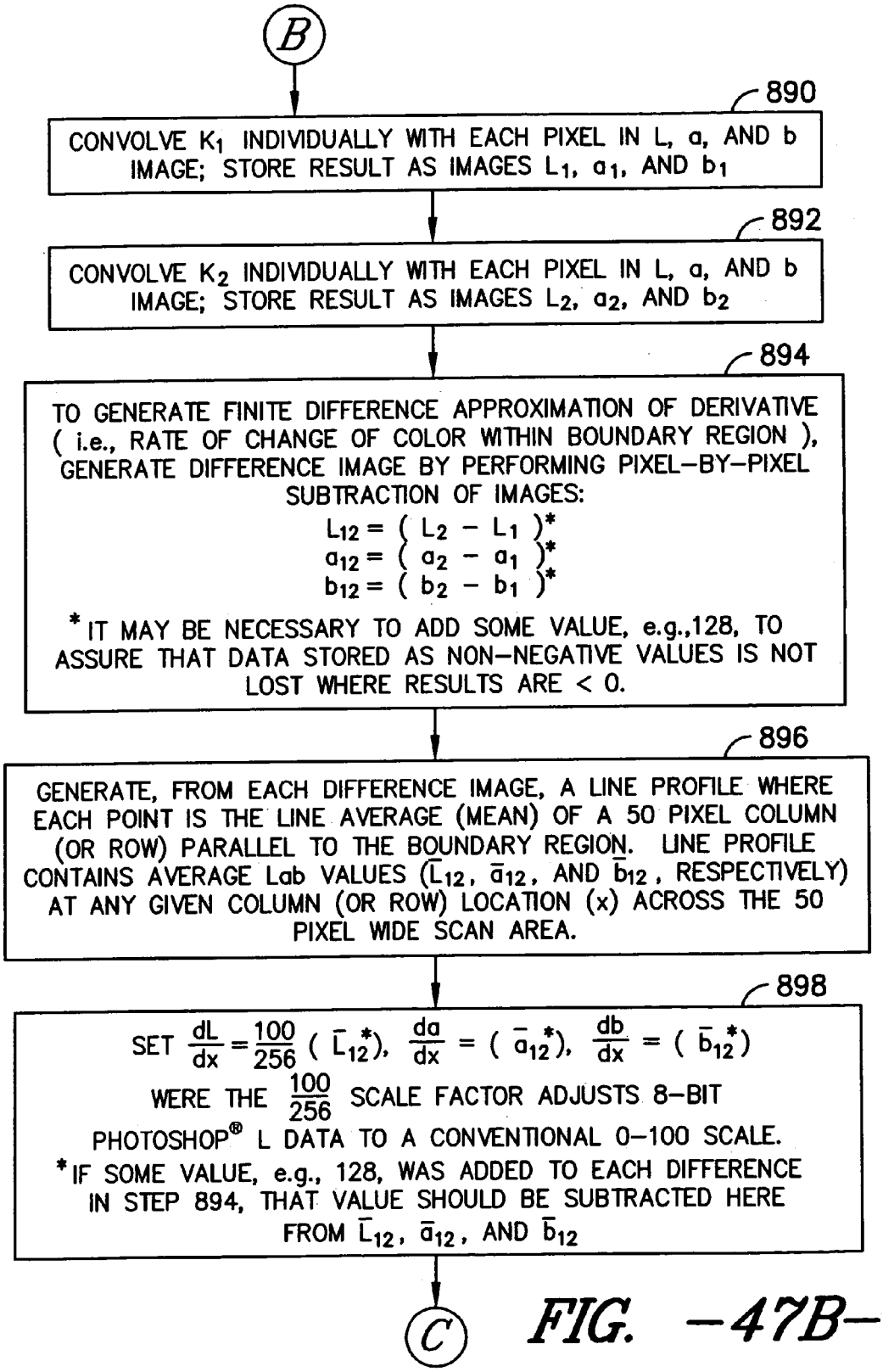

Details of the above-described Transition Width determination are set forth in FIGS. 47A through 47C. Step 882 depicts the selection of the scan area for the boundary region of interest. As noted, it is recommended that the boundary region associated with the selected pattern areas is substantially centered (to provide for a determination of the "pure" color of each of the respective pattern areas away from the influence of the boundary region) and parallel to the direction in which the boundary region will be spatially averaged. Otherwise, the averaging procedure will tend to obscure the inherent sharpness of the boundary.

A scan of the properly prepared sample, with the calibrated scanner set to manual mode (i.e., no auto adjustment of contrast, hue, lightness, etc.—the same settings used for scanning the color target), is then performed (872) using an appropriate scanner such as a Umax Powerlook 2100 XL, available from UMAX Technologies, Inc. of Dallas, Tex., and appropriate software, such as Magic Scan acquisition software, also available from UMAX Technologies, Inc. of Dallas, Tex. As discussed above, it has been found that relatively high scanning resolutions tend to contribute excessive substrate noise when scanning non-uniform substrates as here. Accordingly, scanning resolutions on the order of 50 d.p.i. (e.g., 20 dots per centimeter) are suggested as appropriate for this analysis, although other resolutions may be effective, depending upon the uniformity of the sample. Additionally, 8-bit data acquisition per color channel is recommended. The 24-bit RGB results of the scan should be stored in a preferred lossless format (e.g., a TIFF file).

The previously generated color profile is then applied within Photoshop® to the scanned image to convert the sample image RGB file to Photoshop® sRGB values (874). The sRGB values are then converted to Photoshop® Lab values (876) and the image is separated into 8-bit L, a, and b color channel images, and are stored in a lossless manner (878).

At this point, imaging processing software such as Image Pro Plus, distributed by Media Cybernetics, Inc. of Silver Spring, Md., is used to form a kernel that will generate spatially averaged images for each color channel to smooth the data to allow for more meaningful additional processing. The first 9×9 kernel used herein contained all zeros, except for the central column, which contained all 1's. As indicated at 886 and 888, two such kernels ($K_1$ and $K_2$) are generated, the second kernel ($K_2$) being identical to the first except for a consistent 1-pixel lateral shift perpendicular to the image boundary region. When each of the three color channel images is convolved, in turn, with $K_1$ and $K_2$, the resulting pairs of L, a, and b channel images ($L_1$, $a_1$, and $b_1$, and $L_2$, $a_2$, and $b_2$, respectively) are subtracted, in pixel-by-pixel fashion, from each other (i.e., $L_{12}=L_2-L_1$, $a_{12}=a_2-a_1$, $b_{12}=b_2-b_1$) to form a corresponding set of finite difference images in which each pixel comprising the respective image has the indicated $L_{12}$, $a_{12}$, or $b_{12}$ values (890, 892, 894). As noted in the Figure at 894, in cases where data must be stored as non-negative values (e.g., 8-bit, 0-255 data), it may be necessary to add some constant to the data to assure that negative values are not lost in the storage process. That constant is merely subtracted when the data are retrieved for the purpose of reconstructing absolute color differences.

At step 896, suitable image processing software, such as Image Pro Plus® is used to generate line profiles based on each of the three finite difference images, again for the purpose of allowing for more meaningful additional analysis of highly non-uniform substrates. Each of the three profiles (one per color channel) is generated by averaging the respective $L_{12}$, $a_{12}$, or $b_{12}$ values along a 1×50 pixel strip that is oriented parallel to the boundary region and that is incremented, pixel by pixel, along a line perpendicular to the boundary region. The result is the generation of average $L_{12}$, $a_{12}$, and $b_{12}$ values as a function of perpendicular distance ("x") across the boundary region. If derived from a single boundary region, such line profiles usually resemble single-mode (or multi-mode, if the colors blend within the boundary region to form a third color), generally bell-shaped curves, as shown at 842, 846, and 850 of FIG. 46.

Step 898 establishes an equivalence between the averaged finite difference values for each color channel generated in the preceding step and the corresponding derivative, from which the individual color channel data may be combined to form a comprehensive "Euclidian Color Derivative" ("E.C.D.") that tracks the average rate of change of color (incorporating data from all three color channels) as a function of perpendicular distance into the boundary region. Also, as indicated, an L-value scaling factor may be necessary, and any constants added in step 894 should be subtracted at this time.

As indicated at 902, the calculations to this point apply to the determination of both Transition Width and Feature Width. The subject of Feature Width will be taken up following the conclusion of this discussion of Transition Width. Accordingly, the next step discussed is 904, is directed to calculation of the Transition Width. In step 904, the maximum value of the Euclidian Color Derivative ("$E.C.D._{max}$"), and its corresponding x value ("$X_{max}$") is calculated using suitable image processing software. $E.C.D._{max}$ represents the maximum average rate of change of E as a function of distance (x) along a swath 50 pixels wide extending perpendicularly into the boundary region or, correspondingly, the slope $\Delta E/\Delta X$ at its maximum value ($=\Delta E_{max}/\Delta X$). Recognizing the equivalence of these two slope leads to setting $E.C.D._{max}=\Delta E_{max}/\Delta X$, from which it follows that $$\Delta X=\text{Transition Width}=[\Delta E_{max}/E.C.D._{max}]$$

Figure 52:
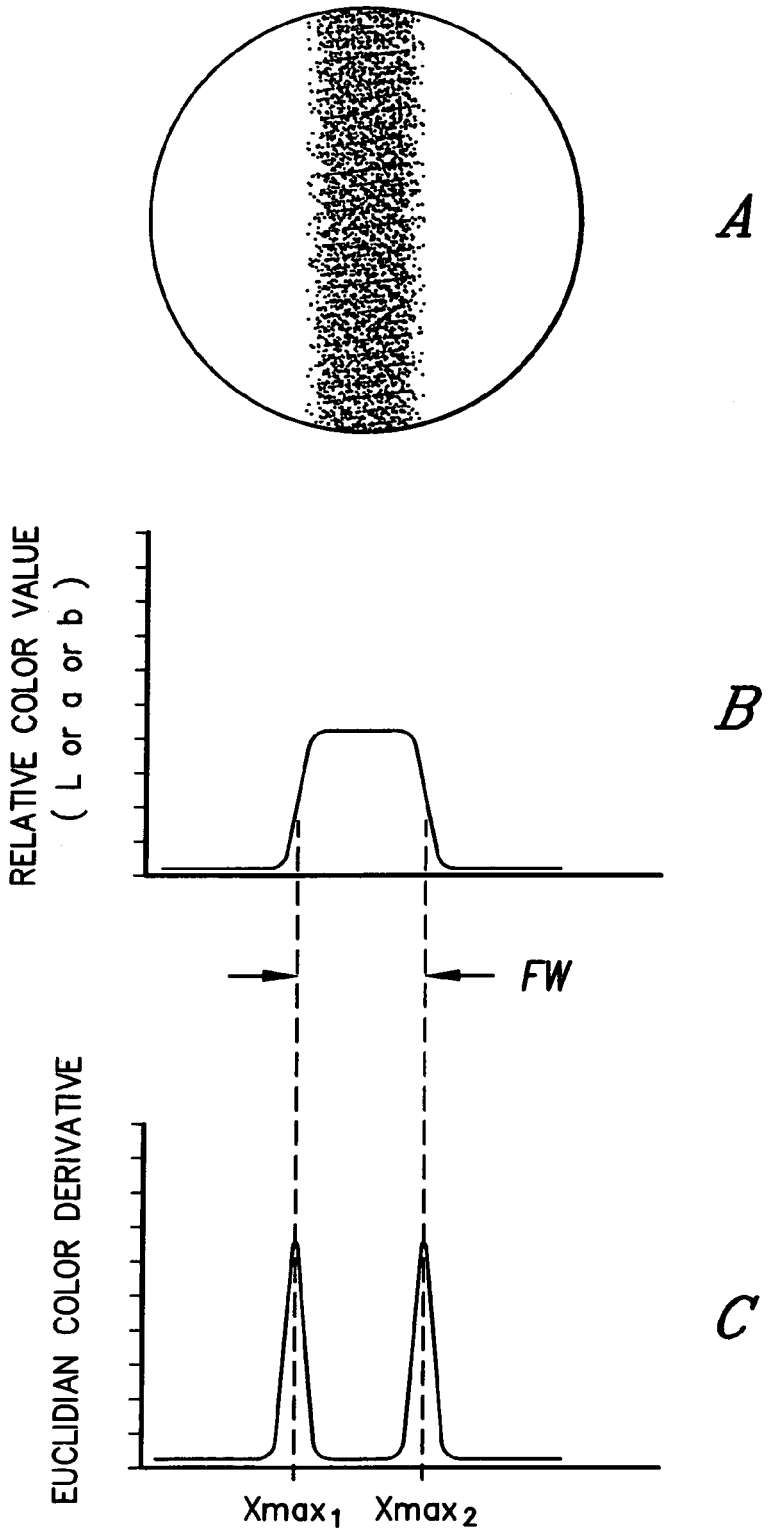
FIG. 52 schematically depicts process steps involved in determining the Feature Width for a feature having relatively straight but diffused boundary regions.
Figure 53:
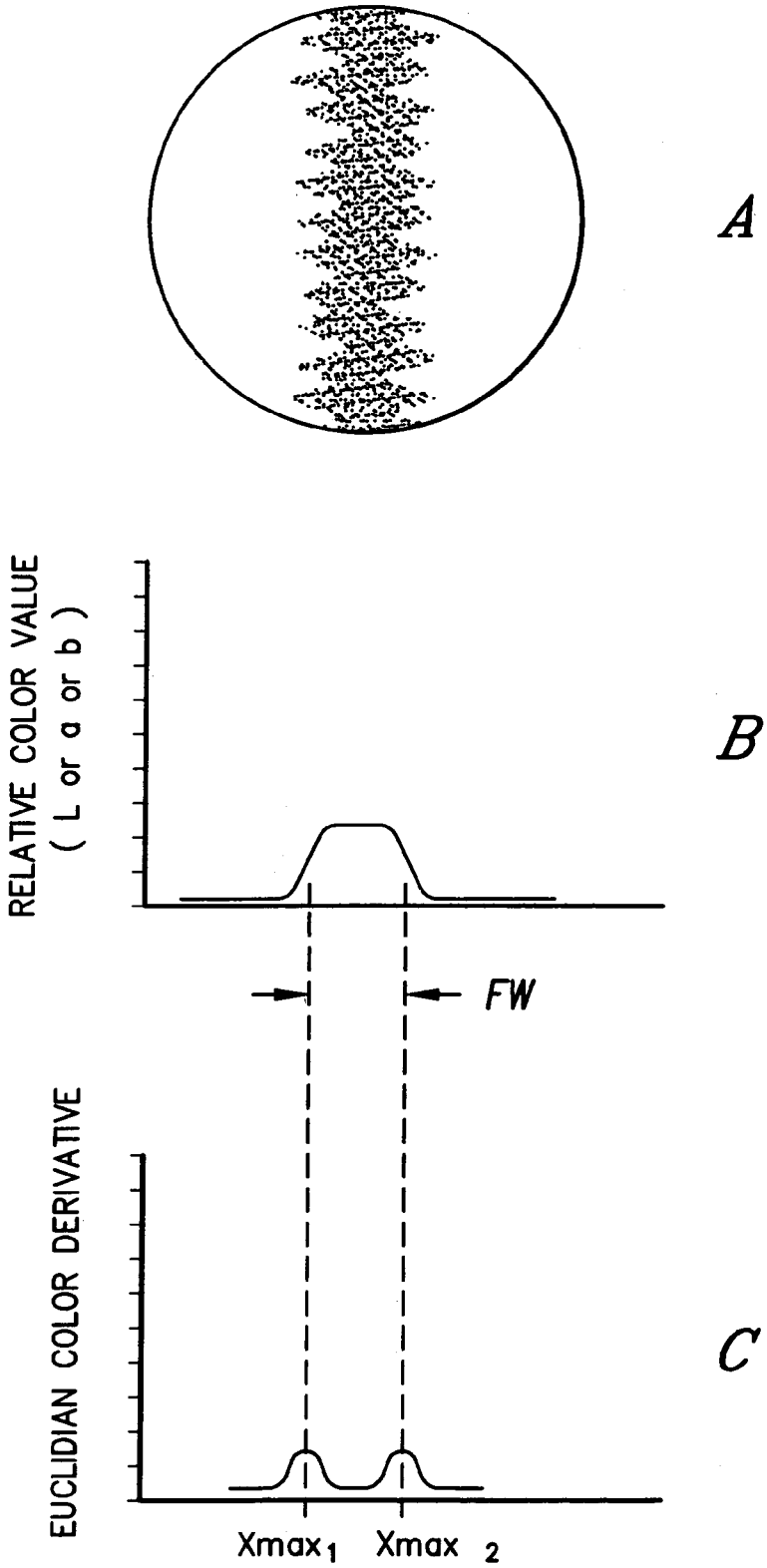
FIG. 53 is a diagram similar to that of FIG. 52, but depicts a feature having meandering but relatively sharp boundary regions.

Step 906 of FIG. 47C is directed to calculation of Feature Width. Simply stated, Feature Width is merely the minimum direct distance across a feature or pattern element, as measured from those points within the opposing boundary regions where the color is most quickly transitioning between the pattern areas adjacent to the respective boundary regions (using the $X_{max}$ values associated with Transition Width calculations). Graphically, the concept of Feature Width is depicted in schematic and abbreviated form in FIGS. 52 and 53, in which the former depicts a Feature Width determination in a feature having Transition Widths loosely corresponding to that of FIG. 49 and the latter depicts a Feature Width determination in a feature having Transition Widths loosely corresponding to that of FIG. 50.

Figure 46A:
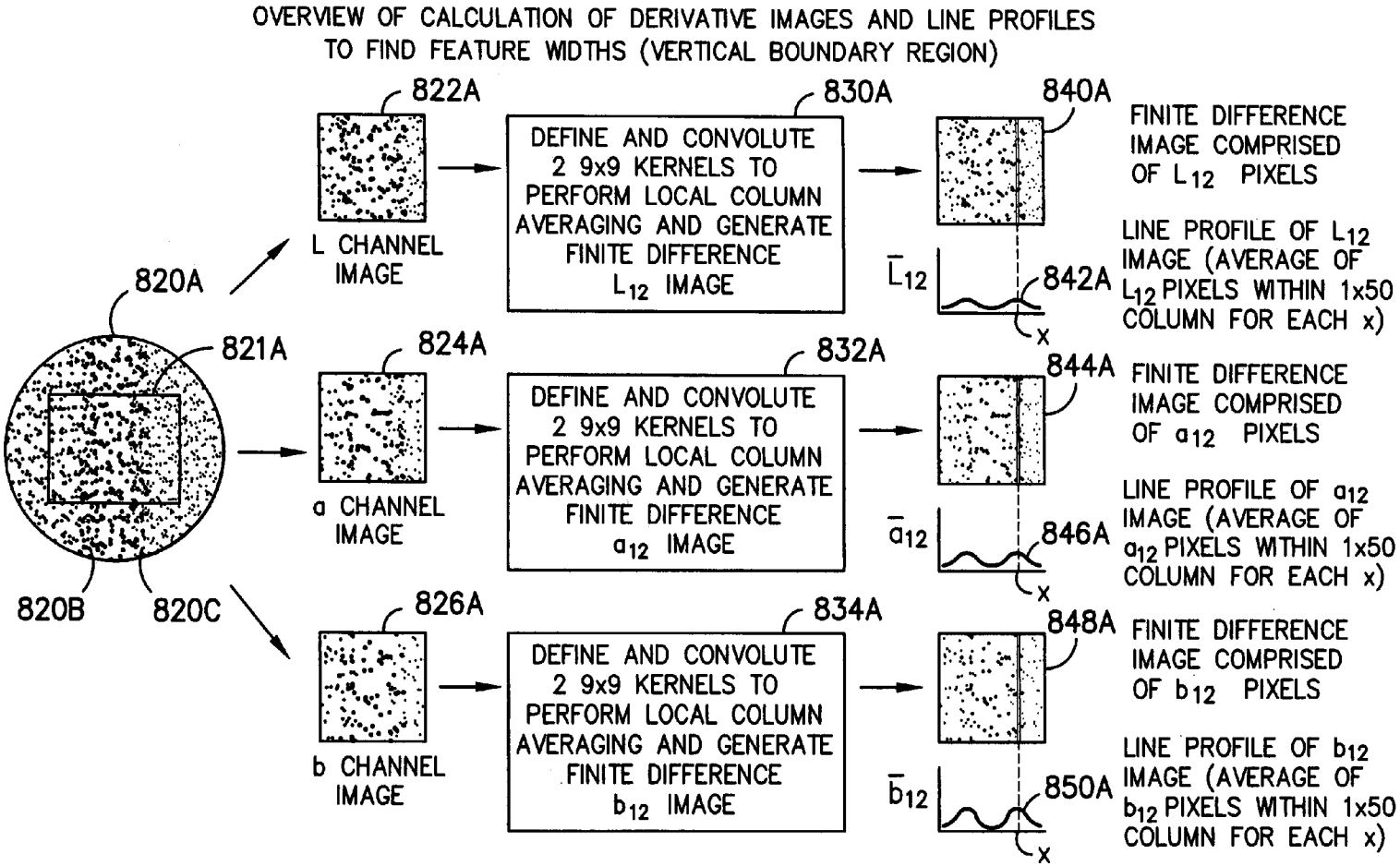
FIG. 46A is a diagram similar to FIG. 46 but directed to determining Feature Widths.

The process is described in more detail in FIG. 46A, which begins with a narrow pattern element, shown at 820A, defined by boundary regions 820B and 820C in scan area 821A. All the subsequent image processing steps are substantially the same as were discussed above in connection with FIG. 46, except that one skilled in the art will recognize that the two boundary regions that define the feature need to be dealt with. The resulting images are different, notably resulting in diagrams 840A through 850A, in which the finite difference image shows the presence of two distinct boundary regions confining the narrow pattern element, with the corresponding derivative line profiles, in most cases, exhibiting a bimodal appearance where it is assumed that each mode represents a single boundary region. If, for example, a third color is formed within a boundary region, there may be more than one mode within that single boundary region. Note that in the image processing indicated in FIGS. 47A-47C, all of the operations performed on the single boundary region to determine the Transition Width are also performed on each of the twin boundary regions, including the calculation of a Euclidian Color Derivative (step 900). Following this step, however, two separate values for $X_{max}$ (i.e., $X_{max1}$ and $X_{max2}$) are calculated (see FIG. 47C, step 906). The Feature Width is simply the scalar difference between $X_{max1}$ and $X_{max2}$, taken as an absolute value.

Preparation and Patterning of Textiles

Using the above techniques, measurements were made on a variety of substrates, using the patterning systems described above: the preferred patterning system ("PREF"), a representative example of the alternative drop-on-demand patterning system ("DOD"), and a representative example of the recirculating patterning system ("RECIRC"). A total of five substrates were used, representing a reasonable sampling of current floor covering substrates, with construction and process-related characteristics as set forth in Table 1.

Patterning Machine: Three different machines were used for most substrates: (1) the preferred drop-on-demand, fixed-head machine (identified as "PREF") described in detail herein, (2) a commercial, readily available drop-on-demand machine (identified as "DOD") having a traversing head, as described above (not used with patterning Substrate E), and (3) a commercial, recirculating fixed head machine

TABLE 1

| | SUBSTRATE A | SUBSTRATE B | SUBSTRATE C | SUBSTRATE D | SUBSTRATE E |
|---|---|---|---|---|---|
| Product Type | Bonded Cut Pile | Tufted Loop | Tufted Cut Pile | Tufted Cut Pile | Tufted Cut Pile |
| Finished Face Weight (g/m$^2$) | 796 | 640.3 | 1355 | 1305.9 | 1364.4 |
| Finished Pile Height (cm) | 0.442 | (50% of tufts) 0.437 cm (50% of tufts) 0.556 cm | 0.754 | 1.39 | 0.709 |
| Tufting Gauge (Tufting Needless Per Meter) | 528.3 | 393.7 | 393.7 | 315 | 315 |
| Stitches Per Meter | 393.7 | 422 | 439 | 425.2 | 433 |
| Chemical Fiber Type | Nylon 6,6 yarns | Nylon 6,6 yarns | Nylon 6,6 yarns | Nylon 6,6 yarns | Wool, Nylon 6,6 yarns |
| Plied Yarn Type | Solutia staple type 198X cutter blend, 7.5 inch (19.1 cm) staple, 19 dpf | Two Filament yarns make up tufts: 1120 Denier Solutia type KET and 1315 Denier Solutia type CBT | Solutia staple type 198X cutter blend, 7.5 inch (19.1 cm) staple, 19 dpf | DuPont 100% Filament, antistat, Type 846, Semi-dull, trilobal, 17 dpf | Lyles 80/20 Wood Nylon |
| Plied Yarn Turns Per Centimeter | 1.77 | 1.77 | 1.77 | 1.97 | 2.26 |
| Carpet Yarn Mass Per Length (Grams Per Meter) | 0.203 | 0.15 | 0.203 | 0.154 | 0.259 |
| Manufacturing Printing Wet Pickup Range (grams/cm$^2$) | 0.16–0.24 | 0.16–0.24 | 0.29–0.46 | 0.46–0.56 | 0.24–0.46 |

It is noted that the pile height information given above generally does not correspond to the height of the tuft above the backing (the exposed pile height), but rather to the length of yarn used in the manufacturing process. The measurements of exposed pile height, as measured from the point of attachment to the backing surface (i.e., the proximal end of the pile element) for each of the five substrates of this study were: approximately 0.35 cm for Substrate A, approximately 0.37 cm for Substrate B, approximately 0.73 cm for Substrate C, approximately 1.07 cm for Substrate D, and approximately 0.71 cm for Substrate E. As used herein, pile height shall refer to exposed pile height, corresponding to the length of the pile elements as measured from their proximal to their distal ends (i.e., the pile element tip). It should also be understood by those skilled in the art that the substrates used herein were selected to represent a broad range of carpet substrates of broadly similar face weight, pile height, fiber type. It is believed that the results obtained herein are generally applicable to similar substrates having the same general fiber types, particularly those for which face weights and pile heights are roughly similar, e.g., those for which face weights and pile heights are within about 30% of those substrates listed in Table 1.

It should be noted that, for purposes of gauging the potential performance of a high definition patterning system such as is disclosed herein, Substrate A, above, was considered most likely to produce good test results due to its relative uniformity as a printing surface. For each of the above-listed substrates, other experimental variables or parameters were present each time a sample pattern was made. Each of these parameters are listed and commented upon below.

(identified as "RECIRC"), also as described above. As a practical matter, the consequences of this choice affected both the dispensing technique (type valve, applicator motion relative to the substrate, etc.) as well as the viscosity and composition of the dye used (the recirculating system uses low viscosity dyes and is somewhat surfactant-intolerant). Print gauge (d.p.i.) is also determined by machine choice: both the PREF and RECIRC machines are 20 gauge, while the DOD machine is 16 gauge (gauge measurements are nominal, with no accommodation for the effects of substrate topology and dye migration). This means a 1 pixel-wide line would be slightly larger in physical width for the DOD device as compared with the others, assuming no on-substrate dye migration effects.

Direction: Because of the various velocity components introduced by the patterning device that could influence (for better or worse) the precise targeting of dye on the substrate, the test bars shown in FIG. 40 were actually printed on the substrate in a first orientation with respect to the print head, as well as in a second orientation, with the test pattern turned 90°, with one orientation being parallel to the tuft line of the substrates analyzed herein. In this way, any advantage or disadvantage due to feature orientation relative to dye stream movement as the dye is dispensed onto the substrate could be noted. Accordingly, the Figures will list a "Dir" parameter, with values of "hor" indicating that the long axis of the rectangles comprising the test bars were parallel to the direction of conveyor travel, or "ver" indicating that the long axis of the rectangles comprising the test bars were perpendicular to the direction of conveyor travel. The term "directionally averaged" as applied to Transition Width or Feature Width data means that the data were collected with the pattern feature or element, or the associated boundary regions, in two orthogonal orientations, and the data were averaged over the two directions (e.g., parallel and perpendicular to the edge of the substrate). Similar orthogonal measurements and subsequent averaging may also apply to the measurement of drop dimensions, where appropriate. It shall be understood for the following discussion that the directional designations of horizontal and vertical, as used to describe the orientation of printed pattern elements, have a particular meaning. A horizontal orientation (for the whole printed bar pattern) shall indicate that the bars (or lines) are printed in a direction parallel to the substrate transport direction through the printer. A vertical orientation (for the whole printed bar pattern) shall indicate that the bars (or lines) are printed in a direction perpendicular to the substrate transport direction through the printer.

In order to numerically characterize the performance of the various patterning systems with respect to direction, the term Isotropy Index may be used. This term is simply the larger of the two quotients obtained by dividing the value of one parameter (e.g., Feature Width or Transition Width) in one direction by the same parameter in the orthogonal direction and, accordingly, will always be a number greater than 1. This quotient can be calculated for either Transition Width or Feature Width.

Color: In the discussion concerning dominant boundary colors above, it was noted that the presence of a dominant boundary color means that the color that is much darker, or that has a much higher concentration, has a much greater influence on the appearance of the boundary region than is observed when only non-dominant colors are involved. In reality, color dominance is a relative phenomenon: a color may be distinctly dominant if paired with a first color and significantly less so if, instead, it is paired with a second color. Because of the difficulty in generalizing this dominant color interaction, a variety of different color combinations involving a dominant color were used in the measurements. In each combination, the first named color denotes the color of the pattern element or feature and the second named color indicates the color of the "background" or surrounding area within which the feature is isolated. Dominant color combinations used are as follows (the color considered dominant in the pairing is named first).:

Red-Green
Black-Red
Yellow-Beige
Brown-Beige
Green-Beige
Black-Beige
Red-Beige

While brown is considered dominant within a brown-beige pairing, it tends to migrate less readily than other colors, e.g., colors such as red, black, yellow, and greens that are relatively slow-fixing dyes, for the experiments and measurements reported herein. Accordingly, these latter colors were found to be more likely to be involved in classic dominant color boundary behavior because of their greater mobility (they tend to migrate across borders), or their tendency to dominate an interface by resisting dilution by other colors, or both. Contrariwise, the brown—beige pairing was found to provide a reasonable surrogate for interactions involving substantially such less-dominant colors, which form a great many of the boundary color interactions—perhaps a majority—found in commercial textile patterns, particularly in carpets, rugs, mats, and other floor coverings. In such pairings, both dyes involved tend to fix quickly and are less water soluble, and therefore tend to migrate from their assigned destination pixel to a lesser degree. When such dyes do migrate and mix, neither dye visually dominates, i.e., their blend is visually intermediate with respect to the two dyes.

In connection with the investigation of Transition Width and Feature Width, the above color combinations used in the reverse sense (i.e., the color considered non-dominant in the combination representing the pattern element or feature and the color considered dominant in the combination representing the background, for example, Green-Red, Red-Black, etc.) were also tested. This was done to account for the fact that, where narrow features are involved, the influence of the background can be profound—a dominant color as a background color can effectively "squeeze" a narrow feature dyed in a non-dominant color, perhaps to extinction.

Figure 122:
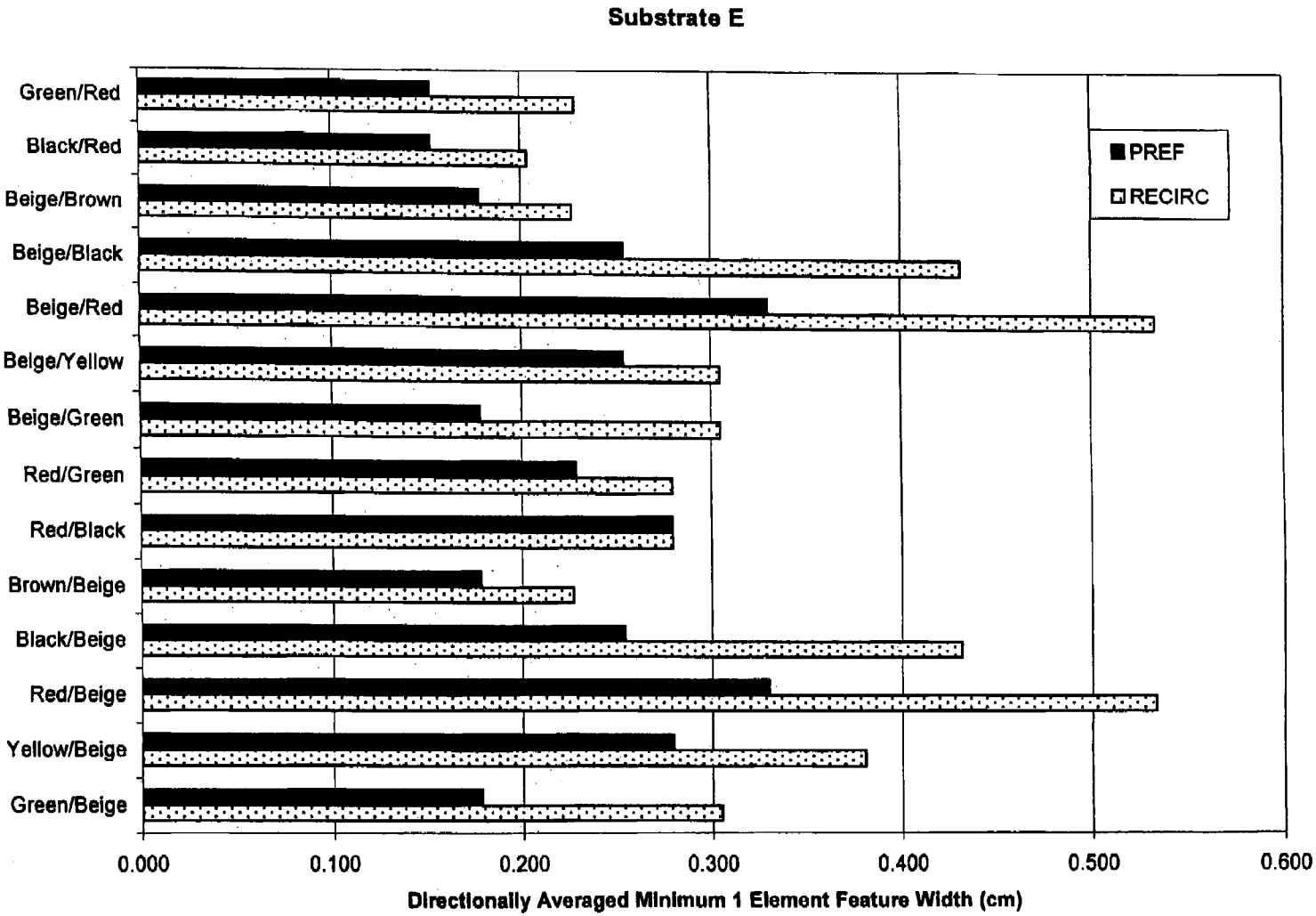

Wet Pickup: Wet pickup is merely a measure of the quantity of dye that is applied per unit area on the substrate. Because of the known general relationship between increased wet pickup and decreased ability to reproduce fine detail due to the attendant wicking, it was necessary to measure typical values of this variable for each patterning machine and make the selected values applicable to all of the patterning machines. Accordingly, for purposes of the studies reported herein, reasonable operational wet pickup ranges were determined for each patterning machine (and therefore each dye system) and each substrate. These ranges were then compared, and a common range of substrate-specific wet pickups (as listed in Table 1) was established that could be used on a specific substrate with any of the patterning machines. Unless otherwise specified, these ranges, specified in Table 1, were used to generate the data reported in FIGS. 55 through 122. Given the capabilities of current textile metered-jet print technologies, it can be noted that the PREF patterning system is capable of patterning a textile substrate having a face weight substantially below that of Substrate A, listed in Table 1, with high definition and no dye flooding. This stems from an ability to dispense low dye drop volumes (e.g. volumes within the range of about 0.08 g/cm$^2$ to about 0.04 g/cm$^2$ or less) reliably and accurately, as compared with the RECIRC and DOD systems, or any other known comparable metered-jet system specifically designed to pattern textiles.

Face Fiber Type: Arguably, the two most popular fibers for use in patterned floor coverings are wool and nylon 6,6. The former has an unparalleled reputation for luxury and richness of color, while the latter, even more popular than wool, excels in its ability to wear and dye well. For purposes of the measurements made herein, four different substrates (Substrates A through D), each containing nylon 6,6 fibers, were used, as well as one sample (Substrate E), containing an 80% wool, 20% nylon 6,6 blend. Substrates A through D were selected to be representative of a broad cross-section of commercially available floor coverings having a pile construction predominantly comprising nylon 6,6 fibers, and the term "nylon 6,6" will refer to such substrates. Substrate E was carefully selected to have a construction capable of providing a reasonable basis for comparison with the various nylon 6,6 samples and for the conclusions relating to such comparison, discussed below. Substrate E is intended to be representative of a broad class of commercially available floor coverings having a pile construction predominantly comprised of wool, with pile heights and face weights roughly comparable to those of Substrate C, and the term "wool" will refer to such substrates. Generally, wool fibers tend to resist, to a greater degree, absorption of the dyes used herein for patterning. This characteristic, likely due to the natural presence of lanolin in wool fibers (even following rigorous and largely effective lanolin-removing steps), can result in a tendency for the applied dyes to form puddles on or near the surface and for those dyes to bleed or migrate laterally, thereby degrading pattern definition. This condition was consistently observed in the patterns formed on Substrate E, which will be discussed in greater detail below.

Edge Treatment: As a feature in each of the patterning machines tested, it is possible to reduce to some degree the quantity of dye applied to the edge of a feature. This ability is desirable because it can discourage uncontrolled wicking or diffusion beyond the feature edge and thereby encourage the formation of an abrupt transition within the boundary region to the color of the adjacent pattern area (the edge of which might have had a similar treatment). Although the flexibility available varies among the machines, in each case efforts were made to optimize, to the extent allowed by the equipment, the delivery of dye to the edges of the test bar so as to minimize the width of the boundary region, maximize the abruptness of the color transition within that boundary region, and thereby maximize the definition of the rendered pattern. Accordingly, since edge treatment (to the extent available) was implemented in all cases, no distinctions on the graphs are made regarding this parameter.

Figure 54A:
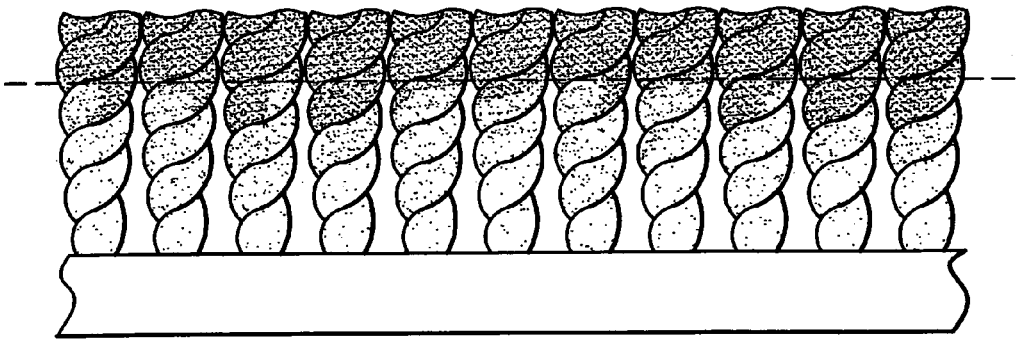
FIG. 54A depicts irregular and relatively shallow dye penetration in a cut pile substrate.
Figure 54B:
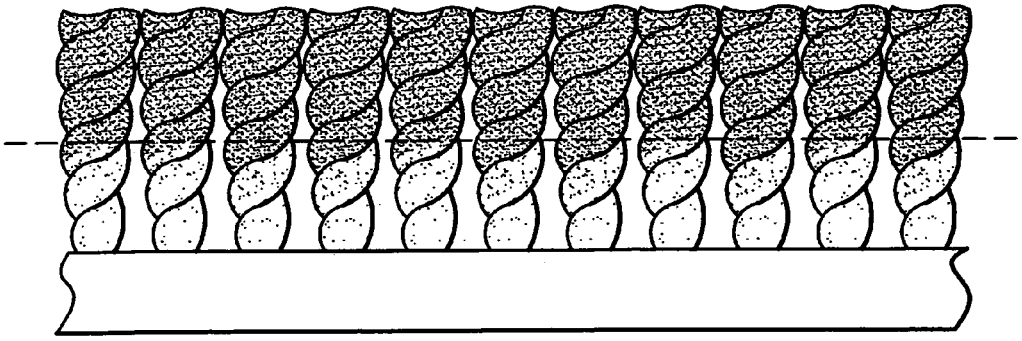
FIG. 54B depicts substantially deeper and more uniform dye penetration in a cut pile substrate.

Dye Penetration: As defined above, dye penetration (and the related term fractional penetration) refers to the extent to which the dye applied to the surface of the substrate in a pattern configuration has migrated along the length of the yarns or textile fibers ("pile elements") comprising the pile in the general direction of the proximal portion of the pile element (i.e., the point of attachment of the pile element to the substrate back) and dyed such pile elements in a substantially uniform manner. Specifically, as measured in connection with the data reported below, dye penetration was taken as a measure of the distance the pattern-applied dye has traveled along the length of the individual pile elements and effectively uniformly dyed those pile elements without the appearance along the length of the pile element of streaks, bands, striations, significant changes of hue (e.g., due to reduced dye concentration or chromatographic effects), or other signs of incomplete, non-uniform dyeing. Substrates that show relatively shallow dye penetration may show complete dyeing near the surface of the undisturbed substrate, but show incompletely dyed pile elements (with respect to the pattern-applied dye) when the pile surface is brushed or parted. This is depicted diagrammatically in FIGS. 54A and 54B. In the former, the depth of dye penetration is taken to be at the level of the dotted line. In the latter, which is much more uniform and more representative of PREF-patterned products, the level of dye penetration is not only greater, but is more uniform, resulting in a dye penetration level again indicated at the dotted line. For purposes herein, commercially acceptable dye penetration, expressed as a fraction of exposed fiber or yarn length (i.e., fractional penetration) was assumed to be 50% or greater for pile constructions comprised predominantly of nylon 6,6, and 40% or greater for pile constructions comprised predominantly of wool.

Dye Formulations: Dye formulations were as indicated in the Examples.

Order of Application of Dyes: In each case, the dyes were applied in the following order: Beige, Brown, Black, Red, Green, Yellow.

The data discussed below was generated using the samples prepared in accordance with the following examples.

EXAMPLE 1

Sample Preparation and Printing using the PREF Printing Technology:

The specific dyestuffs that made up the colors that were printed for this evaluation are shown in the table below. The name of the color, as referred to in the specification, is given for reference.

| Color | Constituent Dyes (Dye, g/L) |
|---|---|
| Beige | Erionyl Yellow MR (0.026 g/L) |
| | Isolan Bordeaux R (0.054 g/L) |
| | Erionyl Black MR (0.019 g/L) |
| Brown | Erionyl Yellow MR (0.791 g/L) |
| | Isolan Bordeaux R (0.077 g/L) |
| | Erionyl Black MR (0.105 g/L) |
| Black | Erionyl Yellow MR (0.902 g/L) |
| | Isolan Bordeaux R (0.279 g/L) |
| | Erionyl Black MR (3.906 g/L) |
| Red | Isolan Red SRL (3.786 g/L) |
| | Nylosan Yellow N7GL (1.817 g/L) |
| Green | Nylosan Yellow N7GL (1.185 g/L) |
| | Lanaset Blue 5G (0.699 g/L) |
| Yellow | Supranol Yellow (3.0 g/L) |

Erionyl Yellow MR, Erionyl Black MR, and Nylosan Yellow N7GL are all available from Ciba Specialty Chemicals Corp. of Highpoint, N.C. Isolan Bordeaux R, Isolan Red SRL, Lanaset Blue 5G, and Supranol Yellow are available from DyStar LP of Charlotte, N.C.

To form each of the process dyes listed in the tables, the specified dyestuffs were added to a stock solution that was prepared by adding the following components to deionized water:

1. 1 g/L of a surfactant SynFac 9214, manufactured by Milliken & Company
2. 2 g/L of a defoamer FT-16, manufactured by Milliken & Company
3. 0.5 g/L of a bactericide, such as Kathon®, manufactured by Rohm and Haas of Philadelphia, Pa.
4. 1 g/L of Sodium Sulfate salt ($Na_2SO_4$), distributed by Fisher Scientific of Atlanta, Ga., or Sigma-Aldrich, of St. Louis, Mo.
5. Enough xanthan gum thickener, Keltrol T®, manufactured by CP Kelco of Wilmington, Del., to provide a viscosity of approximately 1200 centipoise for the resulting paste, as measured using an LVT Brookfield viscometer using spindle 3 at 30 rpm.

Unpatterned carpet tiles (36"×36") of Substrates A through E were obtained. These carpet tiles were brushed lightly with a medium bristle brush to align the tufts and remove loose fibers. The carpet tiles were then placed into an atmospheric steamer operating at a saturated steam temperature of 100 degrees Celsius. The tiles were processed in the steamer for a period of 15 seconds to loft the yarn tufts and give a more uniform print surface. The carpet tiles were then treated with a chemical wet out comprising surfactant and polycationic agents that have the effect of reducing the lateral spreading of the dyes on the surface of the carpet tile as well as holding the colorants near the surface of the carpet so that the surface fibers are more uniformly dyed, resulting in a less frosty appearance of the surface print. The specific formulation of the chemical wetout, prepared in deionized water, was as follows:

1. 1.5 g/L of a polycationic agent, such as Polycat M-30®, as available from Peach State Labs, Inc. of Rome, Ga.

2. 3.0 g/L Syn-O-Wet 324, manufactured by Milliken & Company.

The amount of chemical applied to the surface was approximately 20% of the face weight of the substrate. For Substrates A and B, a wet pickup of 16 mg/cm$^2$ was applied. For Substrates C, D, and E, a wet pickup of 27 mg/cm$^2$ was applied.

The tiles were then placed on the printing platform of the printing machine and the patterning was applied. The print pattern information for the bar-element patterns was designed and encoded with an internal Milliken software package for pixel-based pattern design that took advantage of the 20 gauge (i.e., nominal 20 dpi) patterning capability of the PREF system. The pattern was optimized through visual assessment to provide sharp edge definition and optimize the gauge performance of the bar element pattern. The bar pattern was printed in two orthogonal directions to test for differences in the print quality in the machine and cross-machine direction (i.e., print quality anisotropy).

After the patterning was applied, the surface temperature of the tiles was raised to 200° F. by passage through an RF oven, Model 70301, manufactured by Radio Frequency Corporation, with an array height of 50 mm, for a period of 6.5 minutes to preheat the dyes; this resulted in more saturated colors and sharper pattern edges. The tiles were then placed into the same steamer as above for a period of 5 minutes (8 minutes for Substrate E) to complete the fixation of the dyestuffs to the substrate yarns. The tiles were subsequently placed on a wash platform and saturated with a spray of water to help remove excess dyes (i.e., dyes that did not fix to the carpet yarns), stock solution, etc. The wet tiles were then run through a nip to remove excess water and placed in a dryer, with a dwell temperature of approximately 340 degrees Fahrenheit for a period of about 10 minutes. Substrates C, D and E were then sheared on their surface to remove loose fibers and make the top surface more uniform.

EXAMPLE 2

Sample Preparation and Printing using the RECIRC Printing Technology:

The specific dyestuffs that made up the colors that were printed for the RECIRC evaluation are the same as were used for the PREF evaluation. To form each of the print colors for the RECIRC system, which requires a lower viscosity stock solution, the specified dyestuffs were added to a slightly modified stock solution that formed the remainder of the stock solution. The remainder of the stock solution was prepared by adding the following components to deionized water:

1. 1 g/L of a defoamer FT-24, manufactured by Milliken & Company
2. 0.5 g/L of a bacteriocide, such as Kathon®, manufactured by Rohm and Haas of Philadelphia, Pa.
3. Enough xanthan gum thickener, Keizan S®, manufactured by CP Kelco of Wilmington, Del., to provide a viscosity for the resulting paste of approximately 600 centipoise, as measured using an LVT Brookfield viscometer, using spindle 3 at 30 rpm. For Substrate E, the xanthan gum thickener used for printing was Keltrol T®, manufactured by CP Kelco of Wilmington, Del. All other ingredients were the same.

The pastes and dyestuffs were thoroughly mixed to make the final process colorants.

Substrates A through E, in the form of 36"×36" carpet tiles, were used. These carpet tiles were brushed lightly with a medium bristle brush to align the tufts and remove loose fibers. The carpet tiles were then treated with a chemical wetout comprising surfactant and polycationic agents that have the effect of reducing the lateral spreading of the dyes on the surface of the carpet tile as well as holding the colorants near the surface of the carpet so that the surface fibers are more uniformly dyed, resulting in a less frosty appearance of the surface print. The specific formulation of the chemical wetout, prepared in deionized water, is as given in Example 1.

1. 1.5 g/L of a polycationic agent, such as Polycat M-30® as available from Peach State Labs, Inc. of Rome, Ga.
2. 3.0 g/L Syn-O-Wet 324, manufactured by Milliken & Company.

The amount of chemical applied to the surface is approximately 20% of the face weight of the substrate. For Substrates A and B, a wet pickup of about 16 mg/cm$^2$ of the chemistry was applied. For Substrates C, D, and E, a wet pickup of about 27 mg/cm$^2$ was applied.

The tiles were then placed on the printing platform of the RECIRC machine and the patterning was applied. The print pattern information for the bar-element patterns was designed and encoded with an internal Milliken software package for pixel-based pattern design that took advantage of the 20 gauge (i.e., nominal 20 dpi) printing capability of the RECIRC system. The pattern was optimized through visual assessment to provide sharp edge definition and optimize the gauge performance of the bar element pattern. The bar pattern was printed in two orthogonal directions to test for anisotropies in the print quality in the machine and cross-machine direction.

The carpet tiles were then placed into an atmospheric steamer operating at a saturated steam temperature of 100 degrees Celsius for a period of 5 minutes to complete the fixation of the dyestuffs to the substrate yarns, with the exception of Substrate E, which was retained in the steamer for a period of 8 minutes. The tiles were subsequently placed on a wash platform and saturated with a spray of water to help remove excess dyes (i.e., dyes that did not fix to the carpet yarns) and the remaining print paste. The wet tiles were then run through a nip to remove excess water and placed in a dryer, with a dwell temperature of approximately 340 degrees Fahrenheit for a period of about 10 minutes. Substrates C, D and E were then sheared on their surface to remove loose fibers and make the top surface more uniform.

EXAMPLE 3

Sample Preparation and Printing using the DOD Printing Technology:

The specific dyestuffs that made up the colors that were printed for the evaluation of DOD print technology are the same as in Example 1. To form each of the print colors, the specified dyestuffs (as in Example 1) were added to a stock solution different from the previous two examples. The stock solution was prepared by adding the following components to deionized water:

1. 1 g/L of citric acid, available from Fisher Scientific, of Atlanta Ga., or Sigma-Aldrich, of St. Louis Mo.
2. 1 g/L of a defoamer, NoFome® available from Bayer of Pittsburgh, Pa.
3. 0.5 g/L of a surfactant, Tanasperse CJ®, available from Bayer of Pittsburgh, Pa.
4. Enough acrylic thickener, Tanaprint ST 160C®, manufactured by Bayer of Pittsburgh, Pa., to provide a viscosity of approximately 1200 centipoise for the stock solution, as measured using an LVT Brookfield viscometer using spindle 3 at 30 rpm. The concentration of Tanaprint varied with the amount of dyestuff in the following way: Beige (7.8 g/L), Brown (8.1 g/L), Black (11.7 g/L), Red (12.5 g/L), Green (10 g/L), and Yellow (8.7 g/L).

The stock solution and dyestuffs were thoroughly mixed to make the final process colorants.

Substrates A through E, in the form of 18"×36" carpet tiles, were used. These carpet tiles were brushed lightly with a medium bristle brush to align the tufts and remove loose fibers. The carpet tiles were then placed into an atmospheric steamer operating at a saturated steam temperature of 100 degrees Celsius. The tiles were processed in the steamer for a period of 15 seconds, to loft the yarn tufts and give a more uniform print surface.

The tiles were then placed on the printing platform of the printing machine and the patterning was applied. The print pattern information for the bar-element patterns was designed and encoded with an internal Milliken software package for pixilated-pattern design. This file was converted to the DOD specific design code. It was necessary to convert from the 20 gauge designs used for PREF and RECIRC to a 16-gauge design for use with the DOD system. The technology allowed for reducing the dye at the edges by 50% to try to optimize the edge sharpness. Also, the color-dispensing valves could be equipped with orifice plates with two or three orifices that define the streams of dye (dye jets). Representative bar patterns were printed with each of these set-ups. The bar pattern was printed in two orthogonal directions to test for anisotropies in the print quality in the machine and cross-machine direction.

The carpet tiles were then placed into an atmospheric steamer operating at a saturated steam temperature of 100 degrees Celsius for a period of 5 minutes to complete the fixation of the dyestuffs to the substrate yarns. The tiles were subsequently placed on a wash platform and saturated with a spray of water to help remove excess dyes (i.e., dyes that did not fix to the carpet yarns) and the remaining print paste. The wet tiles were subsequently run through a nip to remove excess water and placed in a dryer, with a dwell temperature of approximately 340 degrees Fahrenheit for a period of about 10 minutes. Substrates C, D and E were then sheared on their surface to remove loose fibers and make the top surface more uniform.

It should be noted that the level of patterning performance obtained with the DOD and RECIRC machines was confirmed to be generally consistent with that demonstrated by samples available in the marketplace.

Discussion of Data

Figure 55:
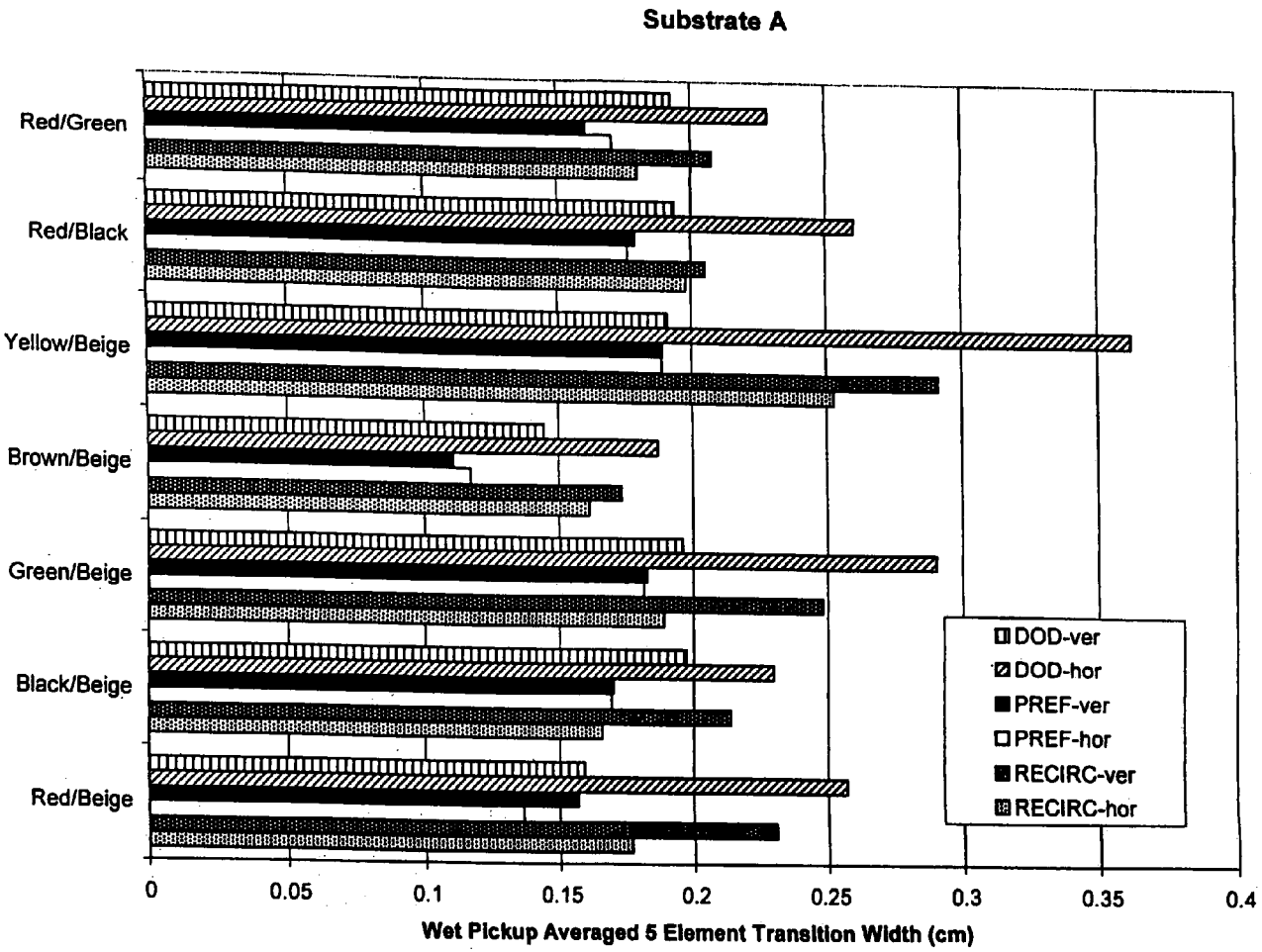
FIGS. 55 through 255 depict, in various formats, experimental data collected in the course of conducting the analyses described herein.
Figure 56:
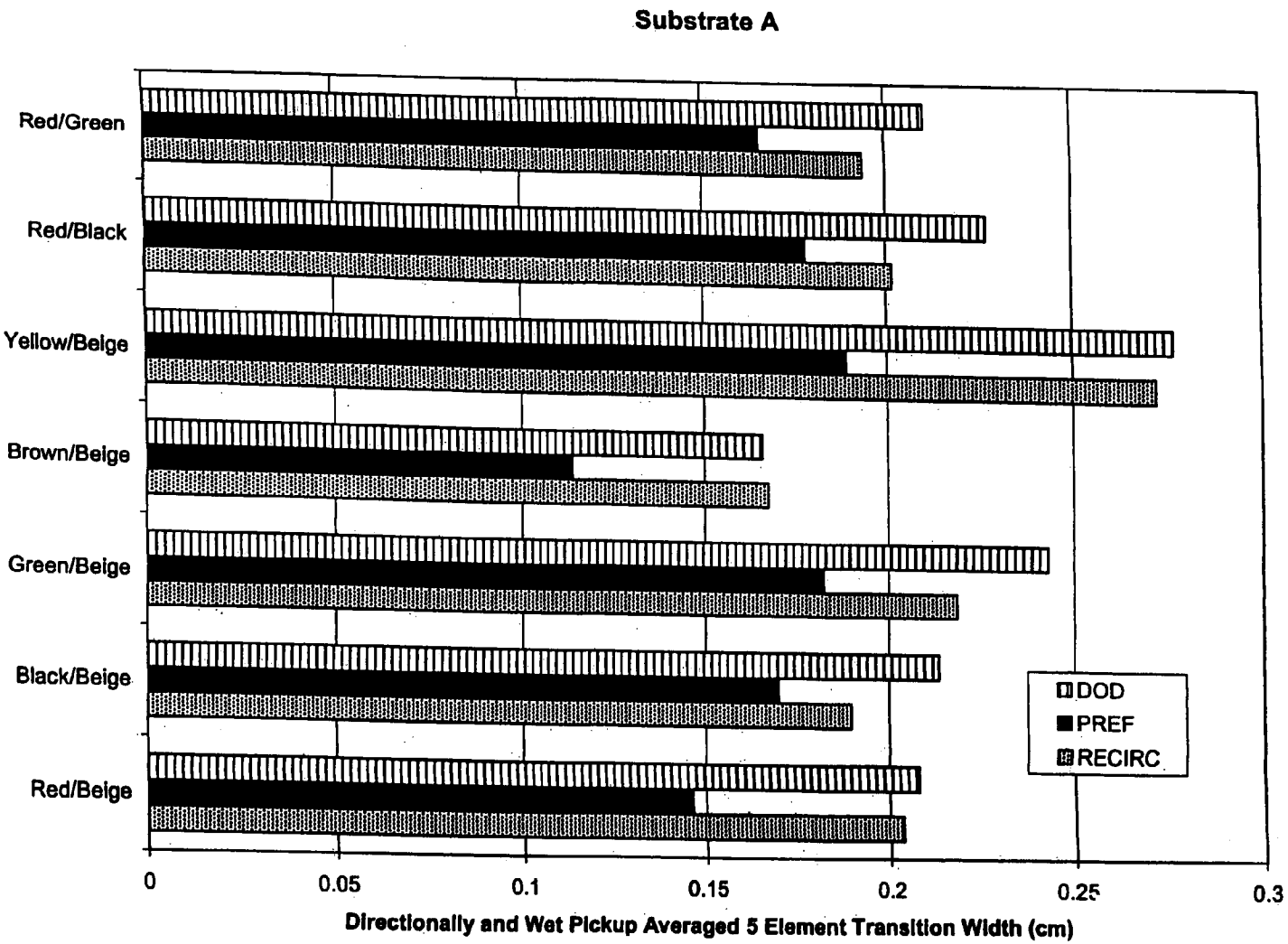
Figure 57:
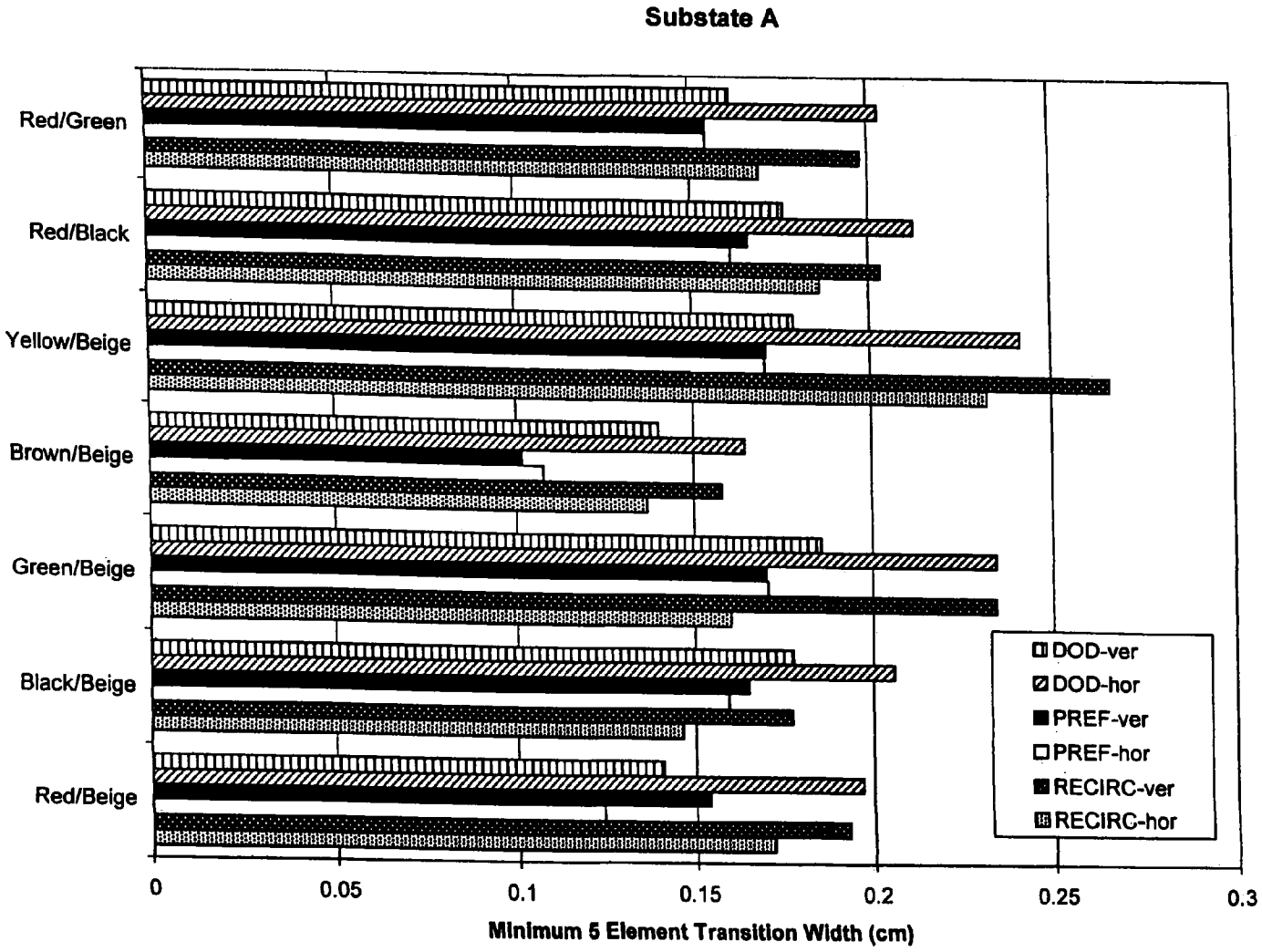
Figure 58:
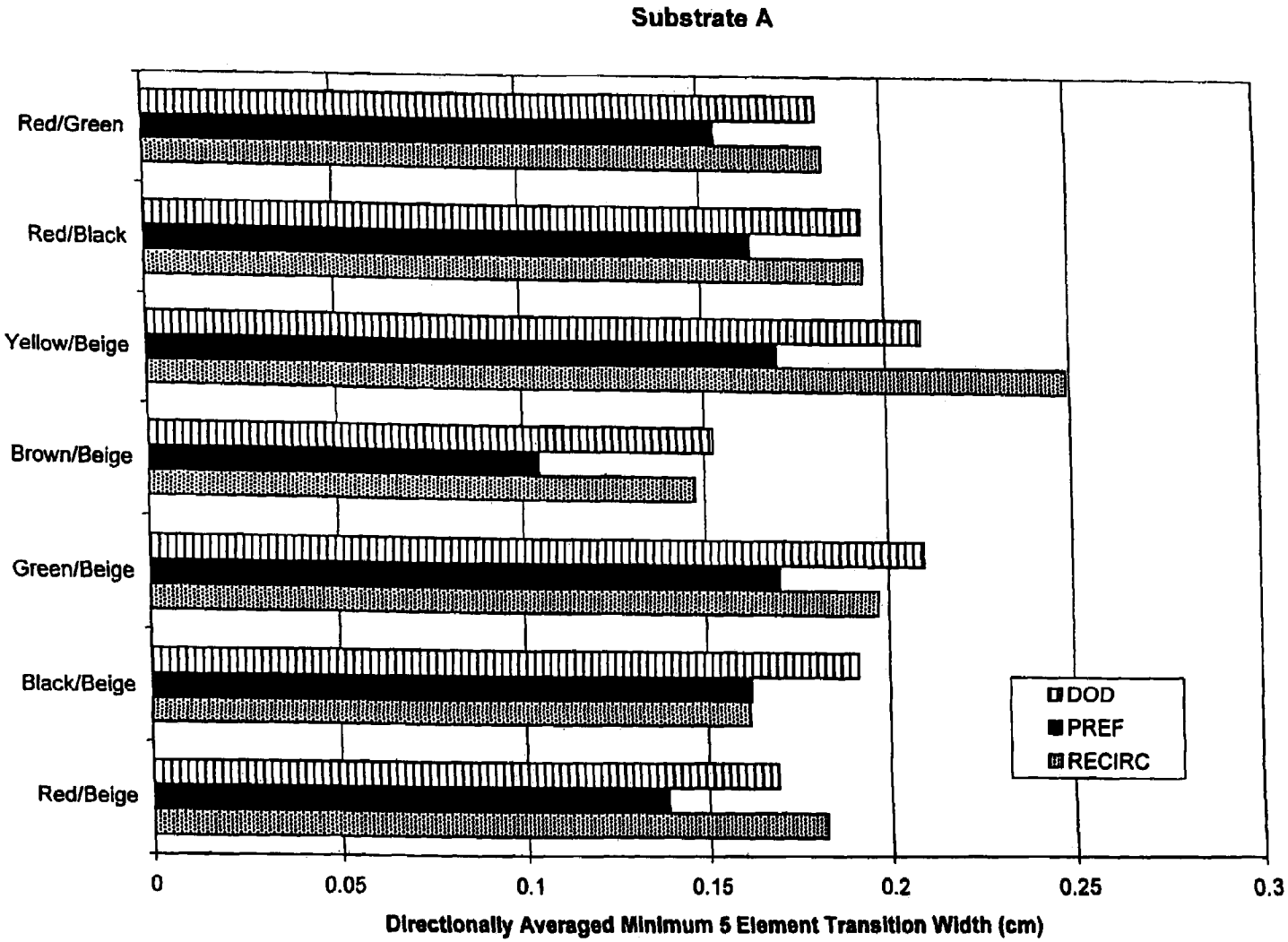
Figure 59:
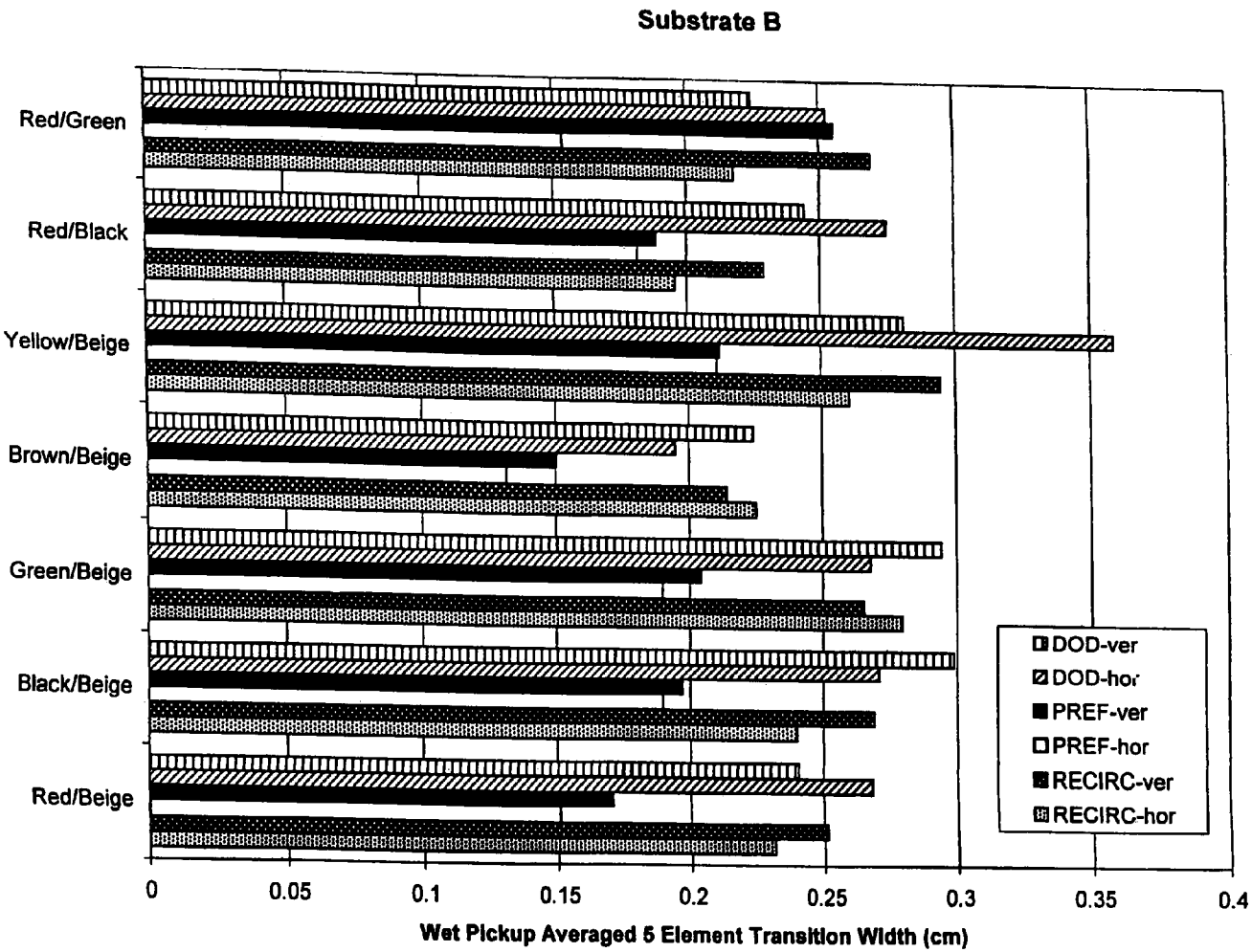
Figure 60:
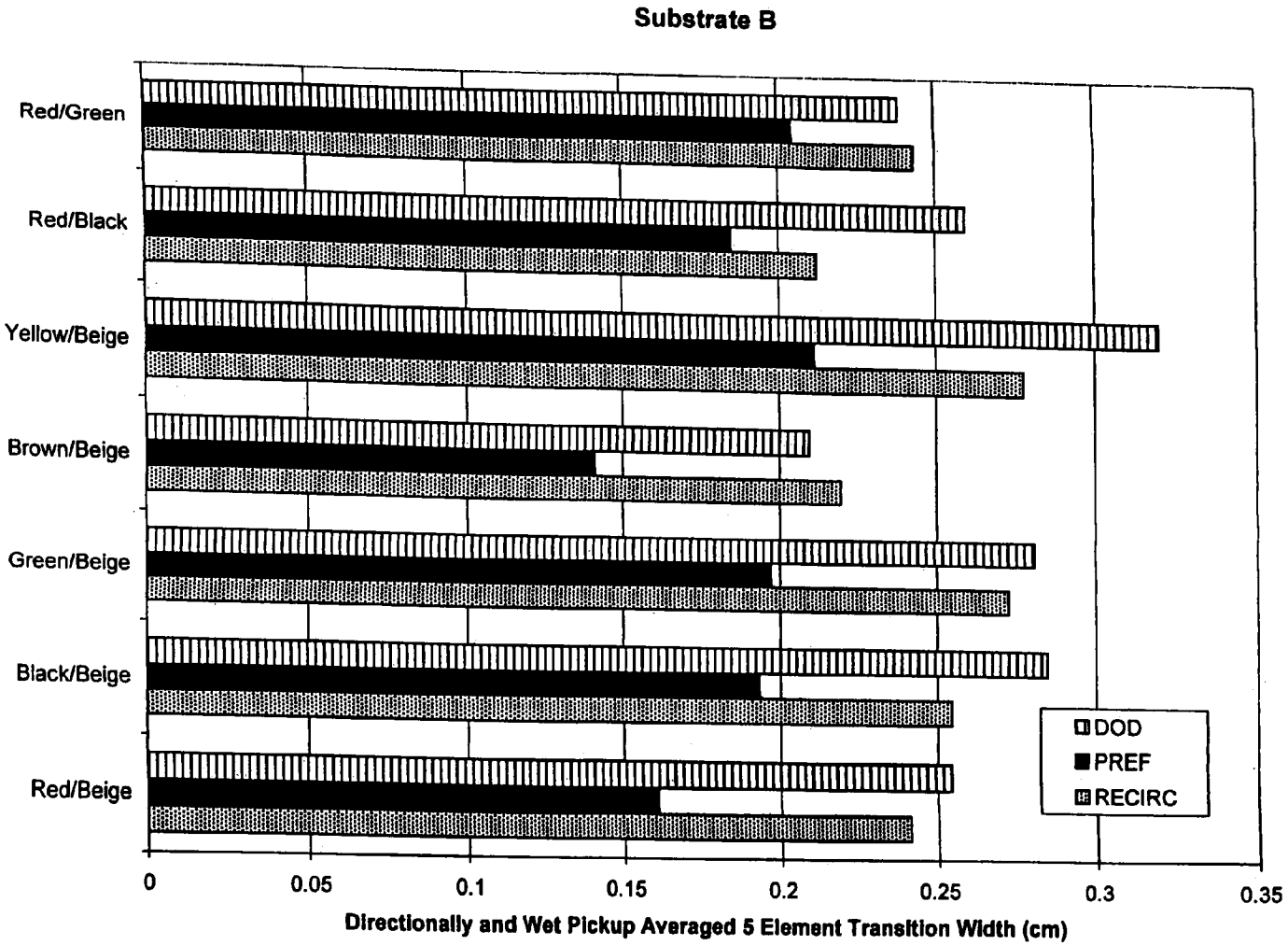
Figure 61:
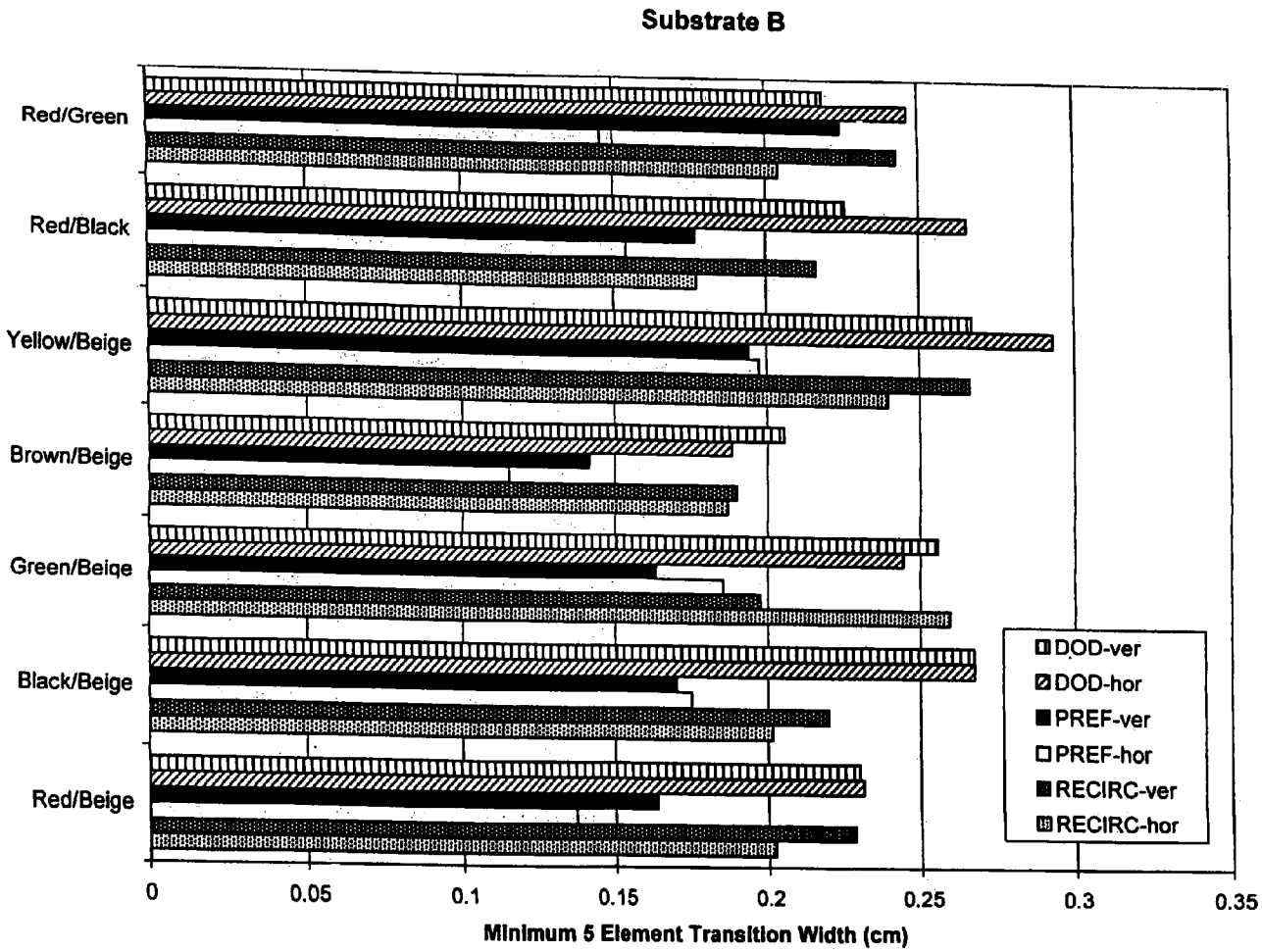
Figure 62:
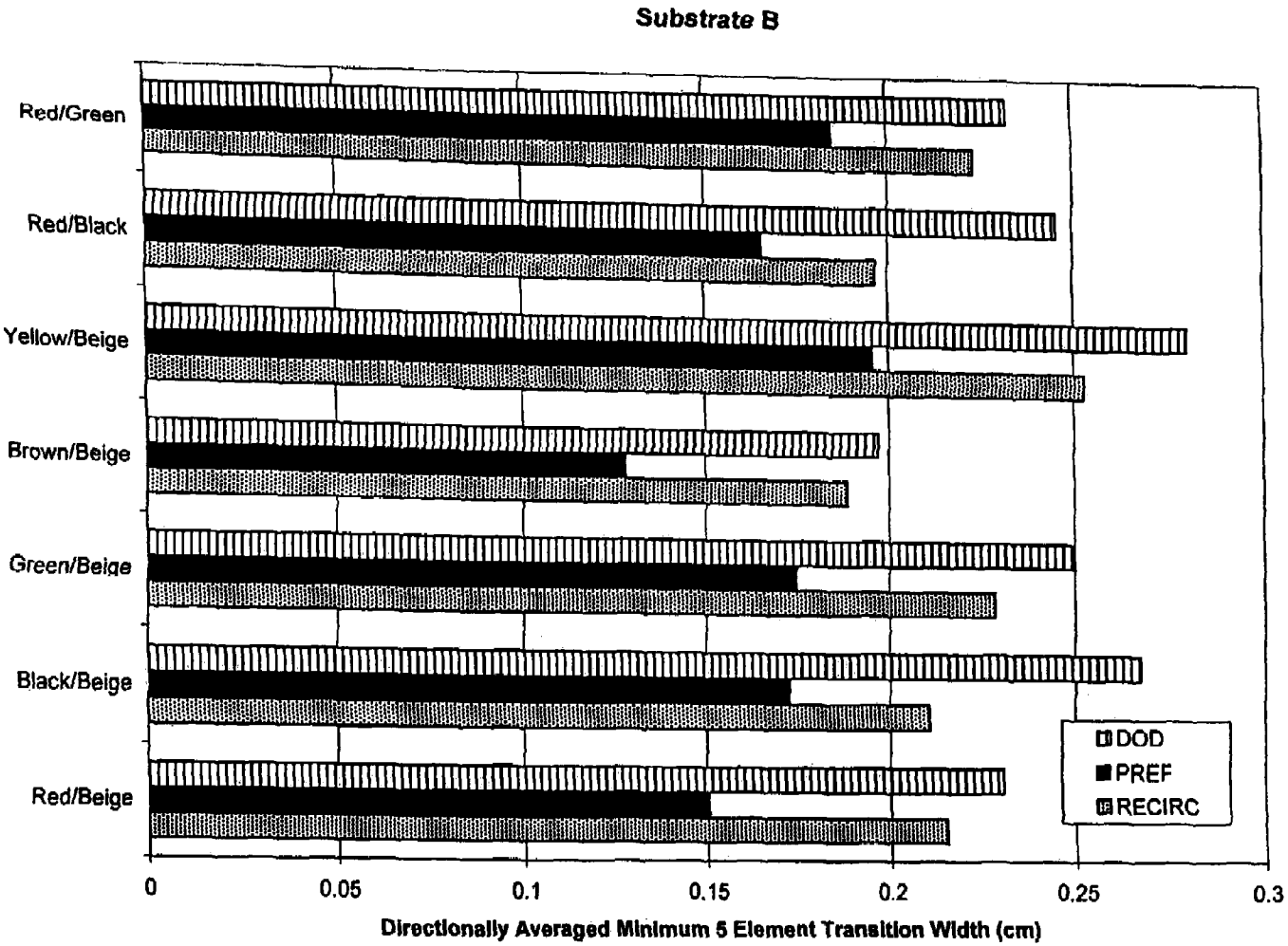
Figure 63:
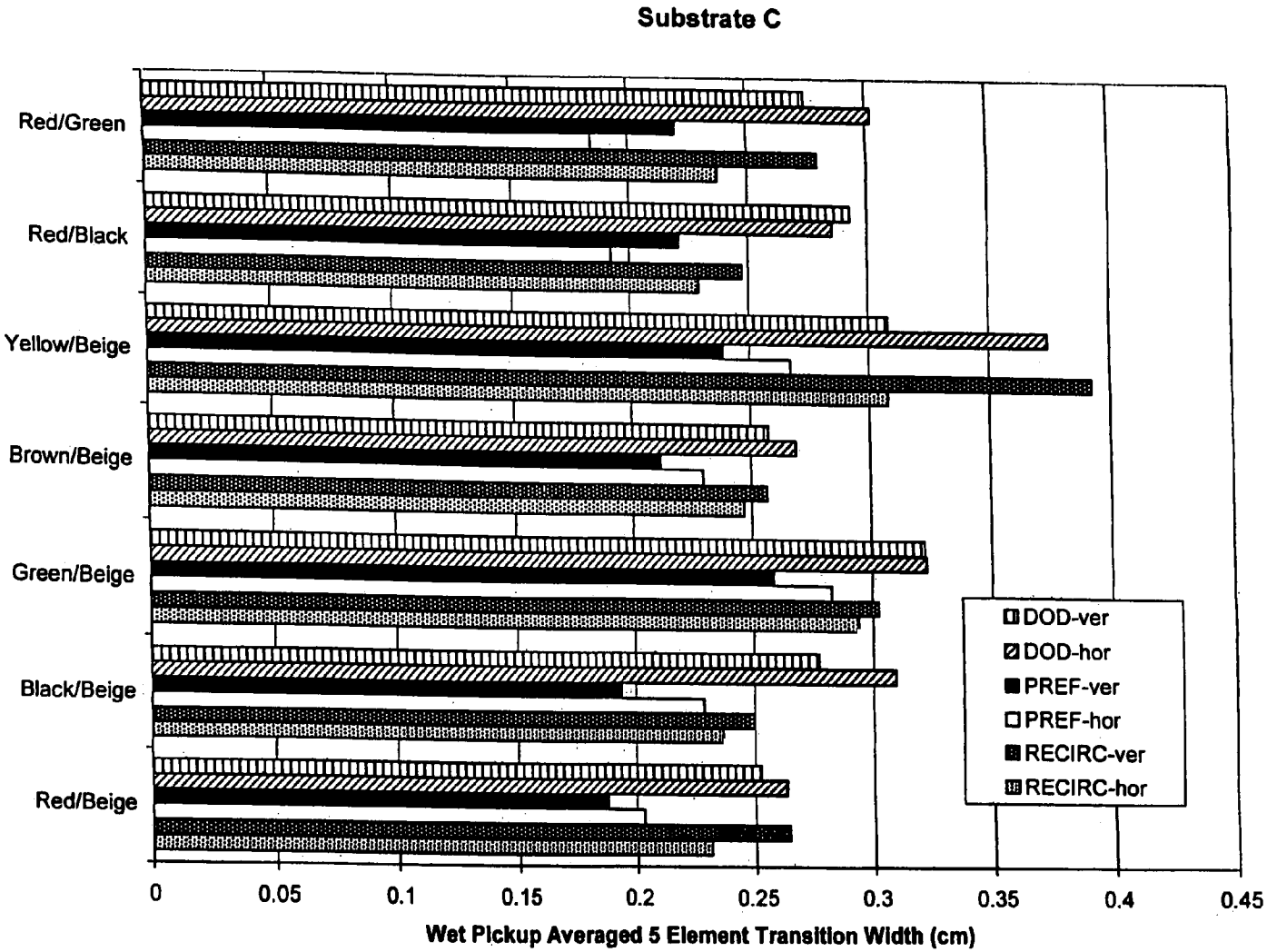
Figure 64:
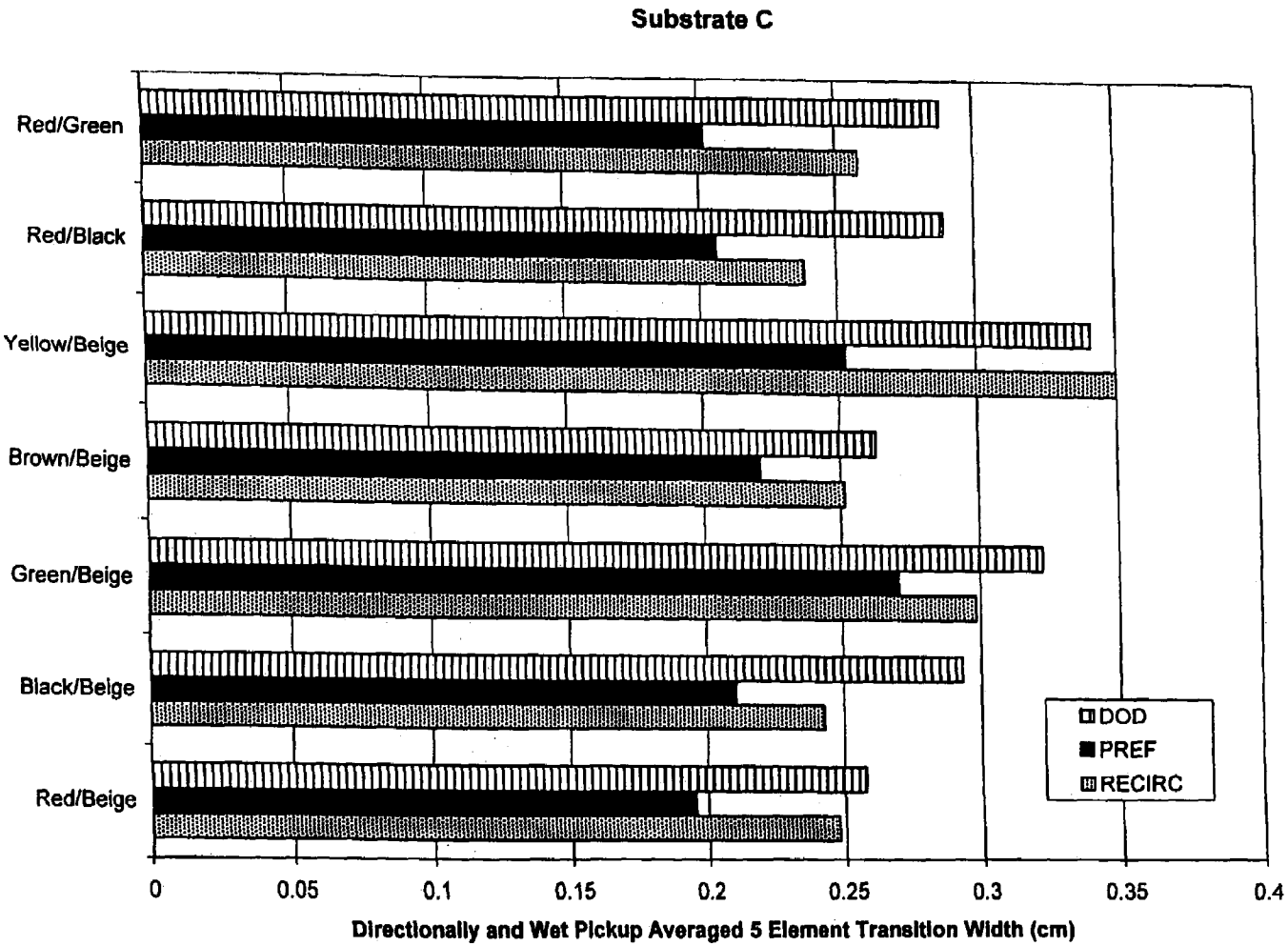
Figure 65:
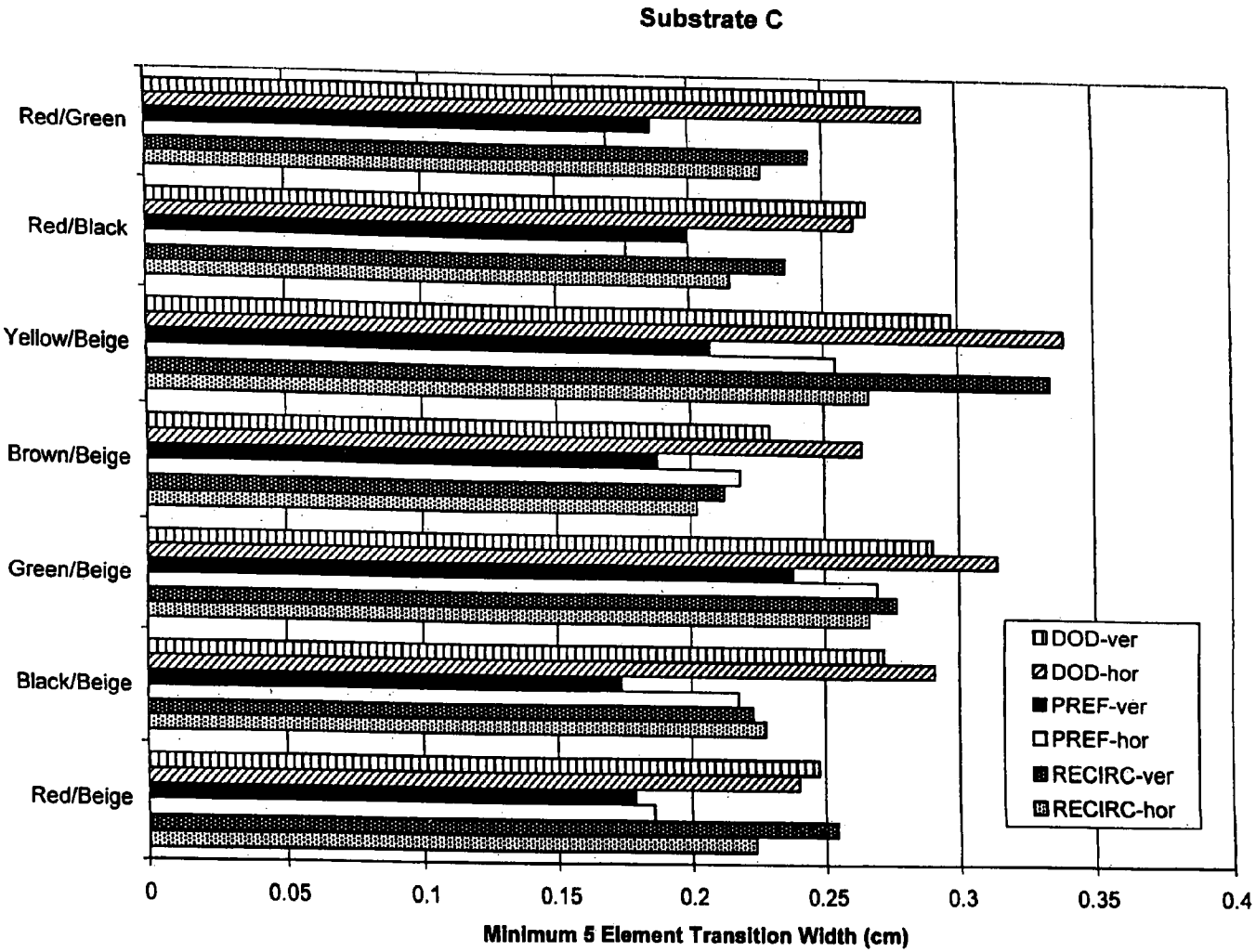
Figure 66:
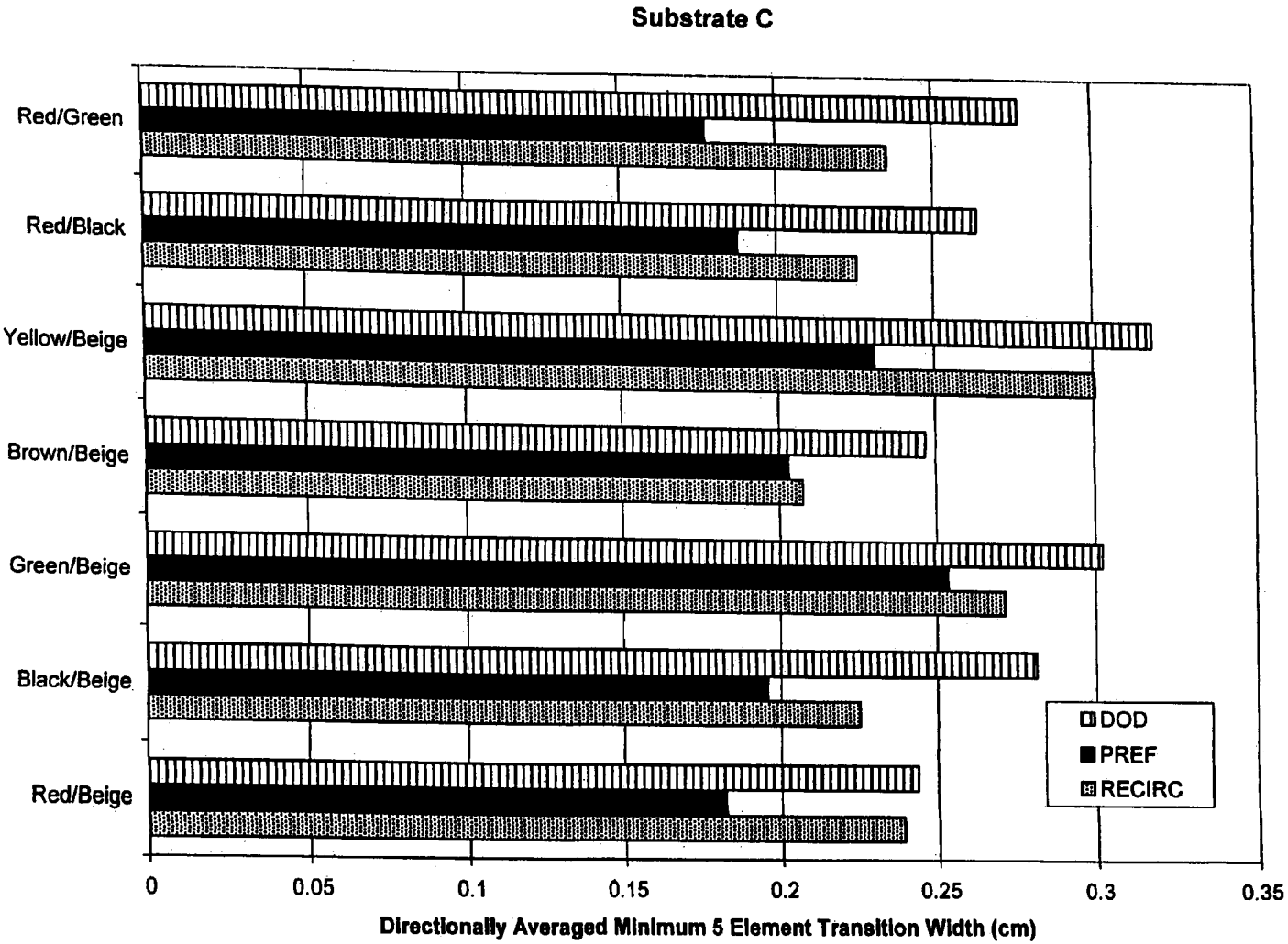
Figure 67:
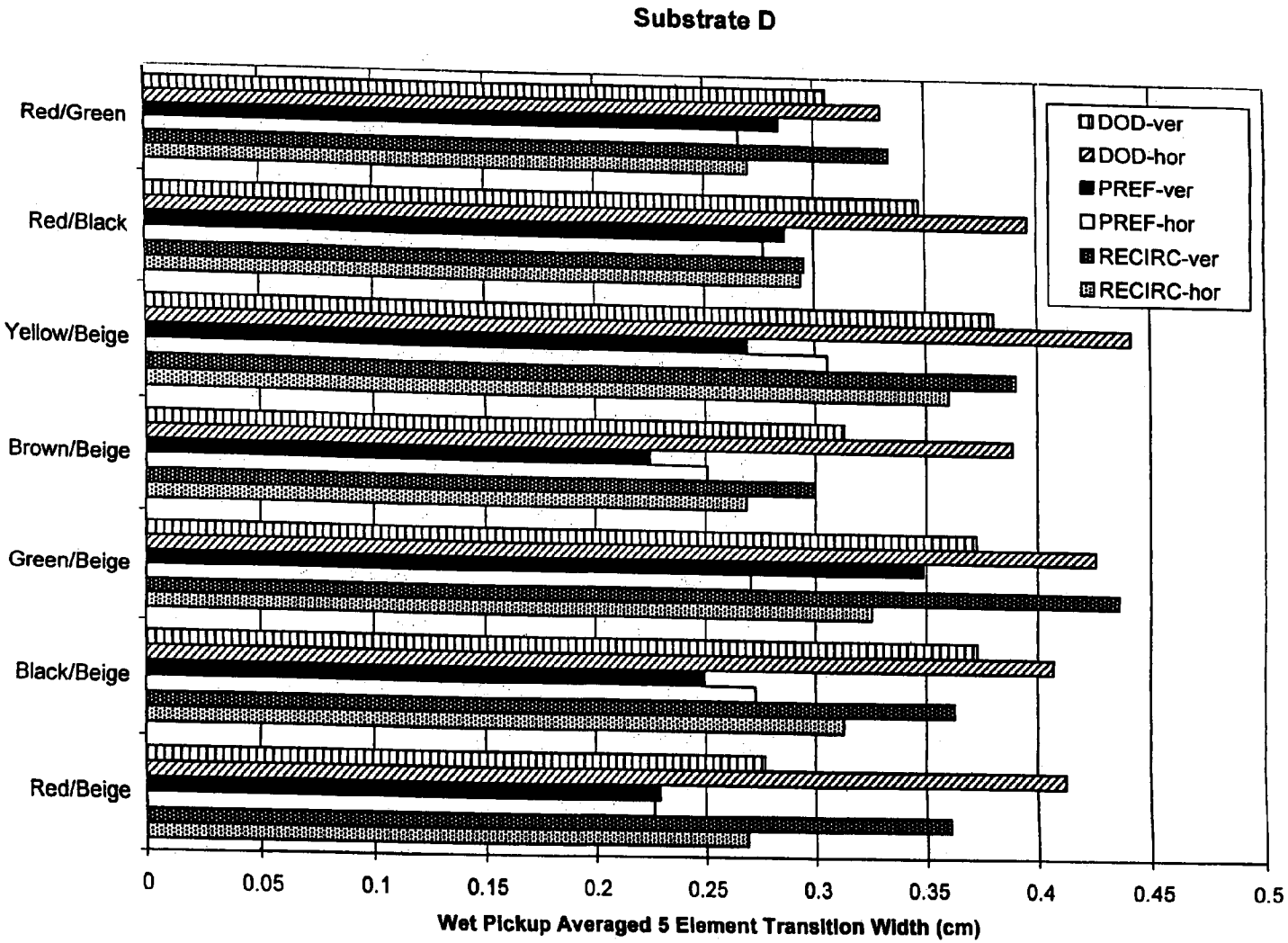
Figure 68:
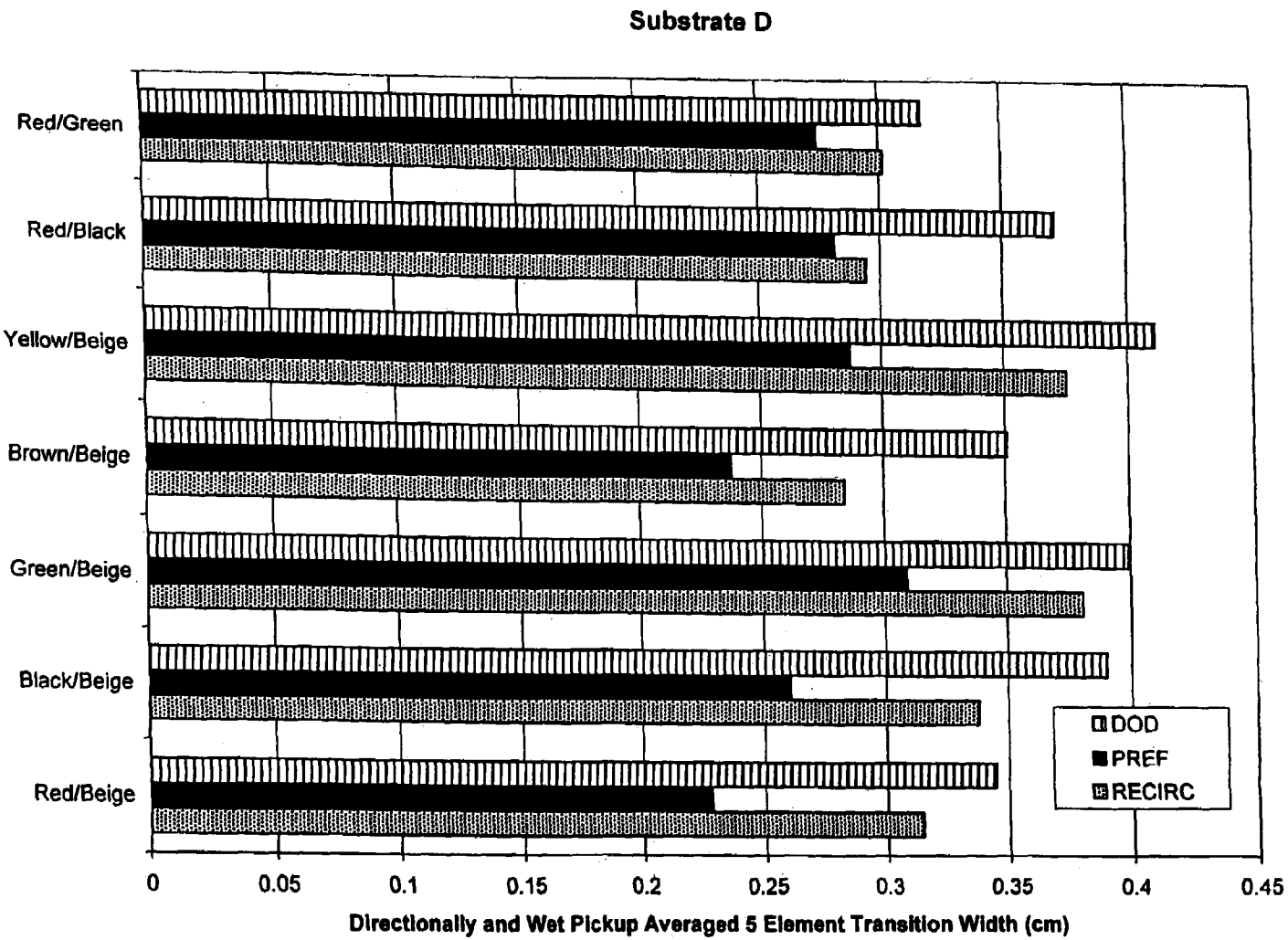
Figure 69:
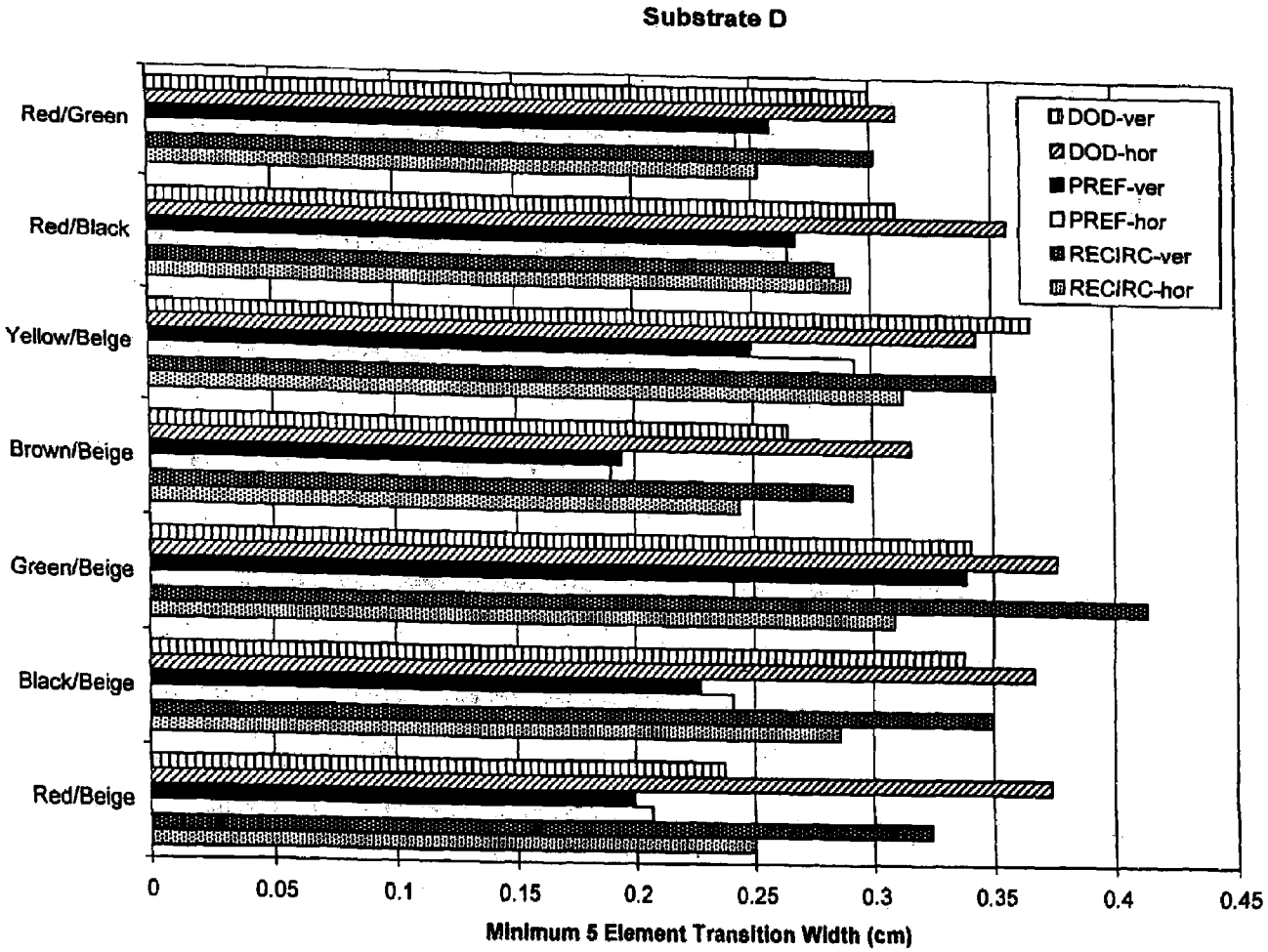
Figure 70:
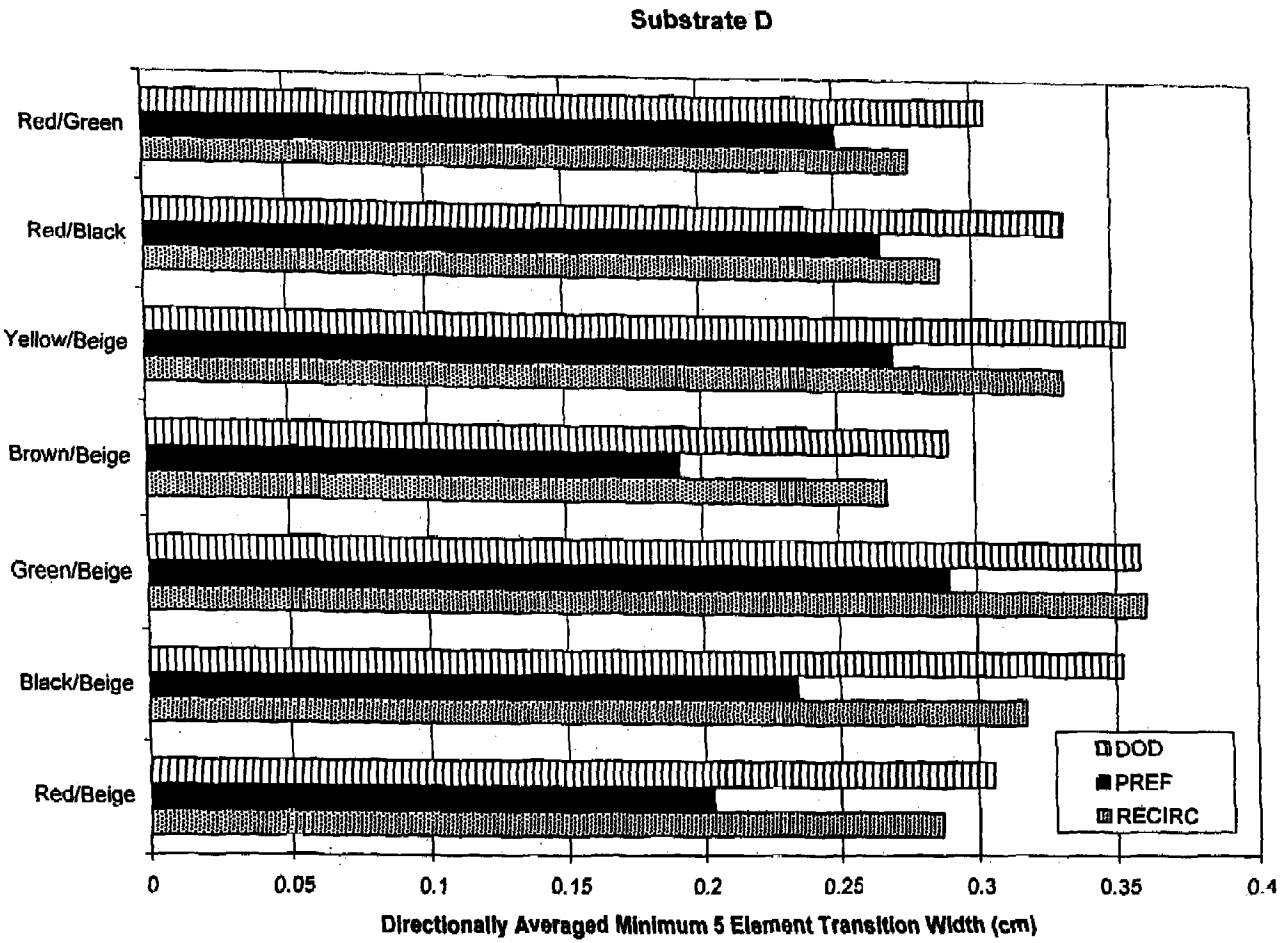
Figure 71:
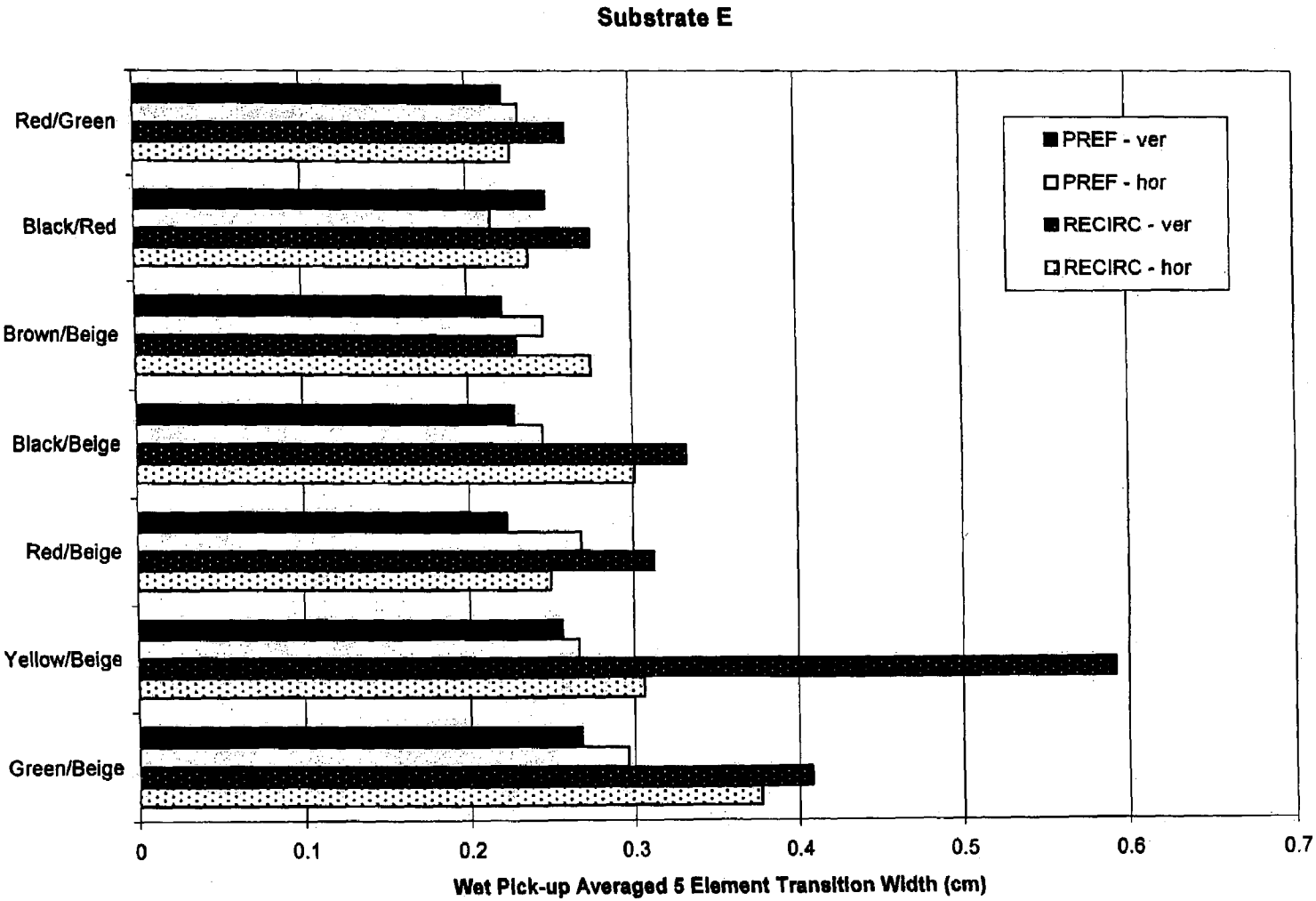
Figure 72:
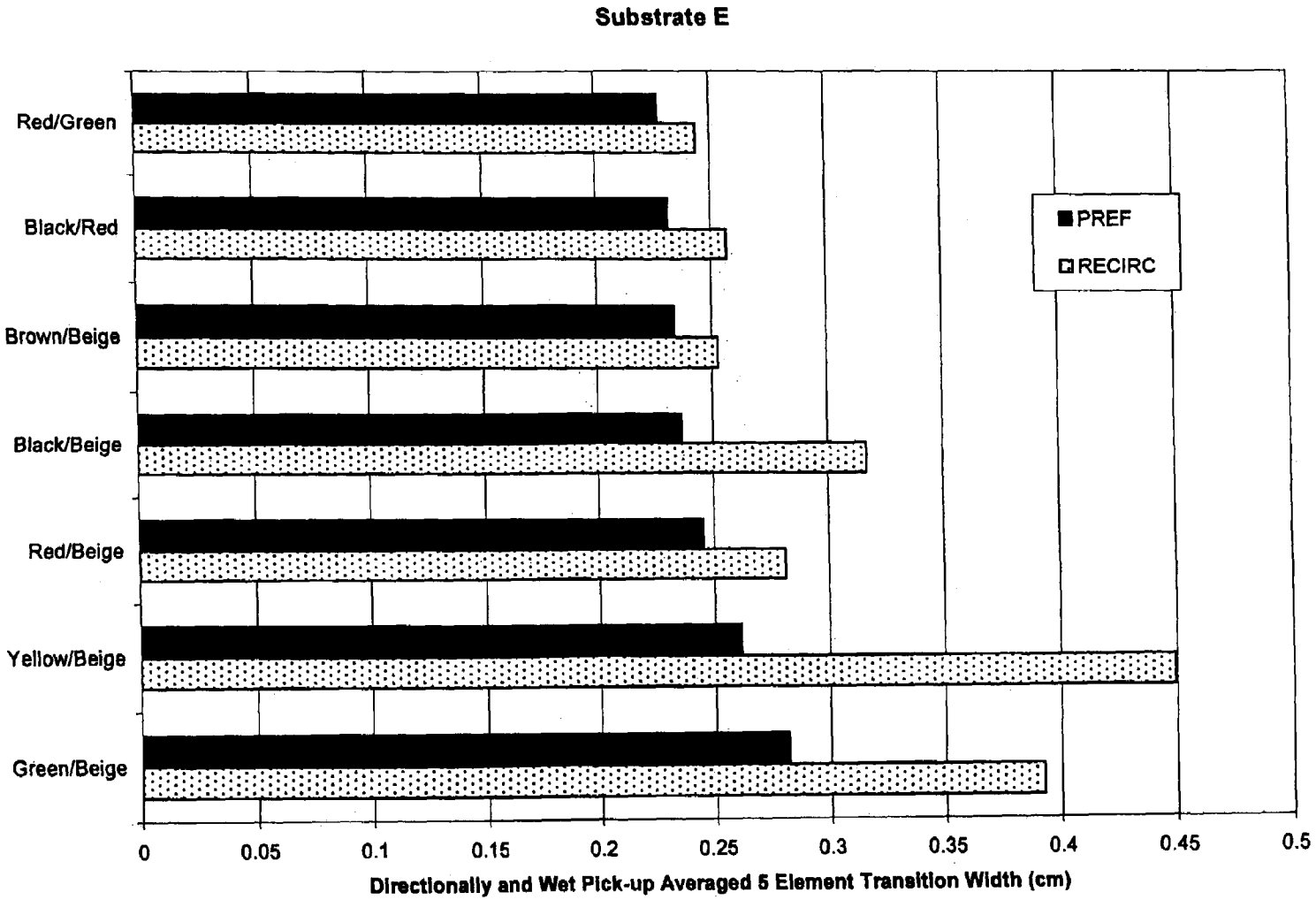
Figure 73:
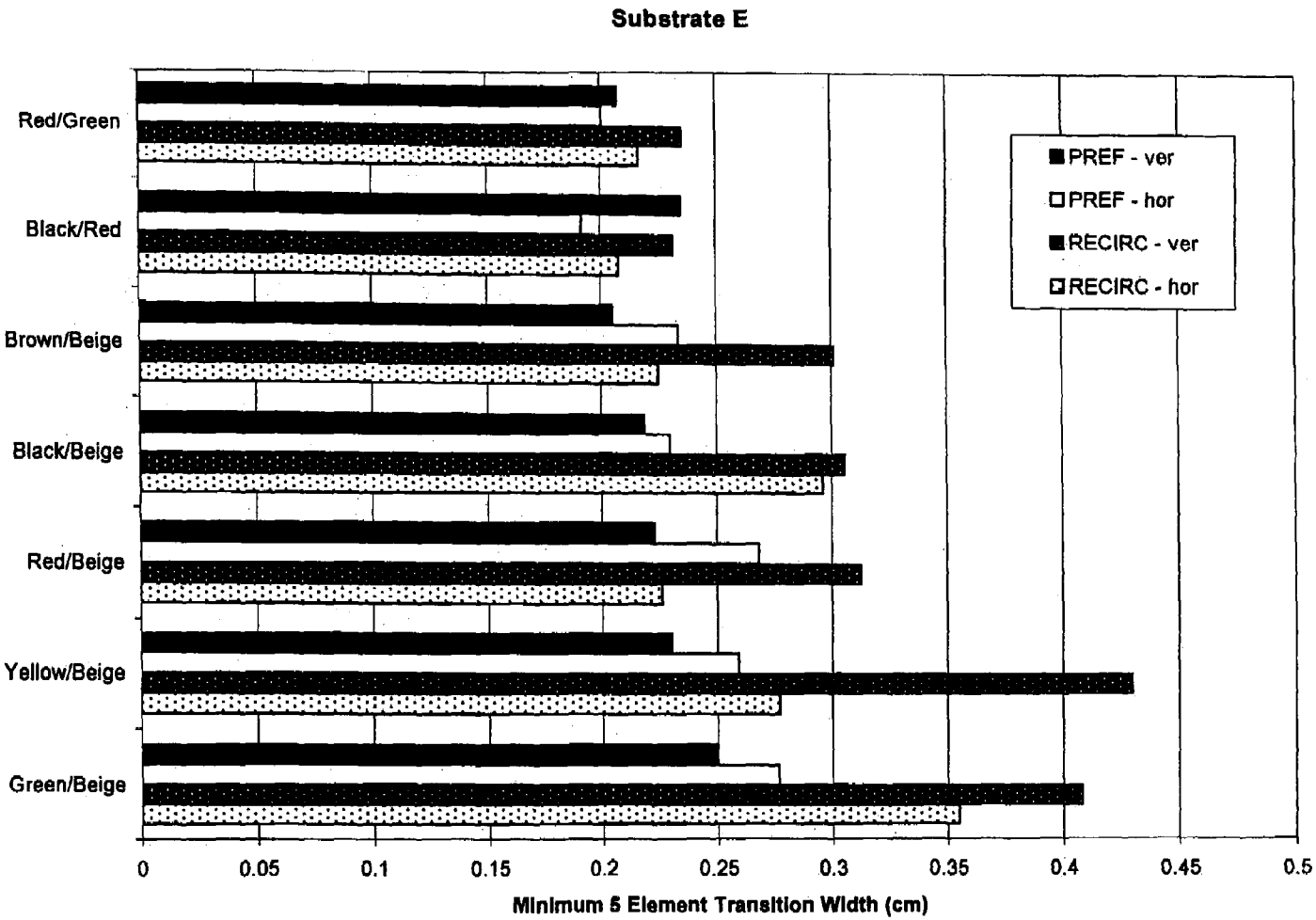
Figure 74:
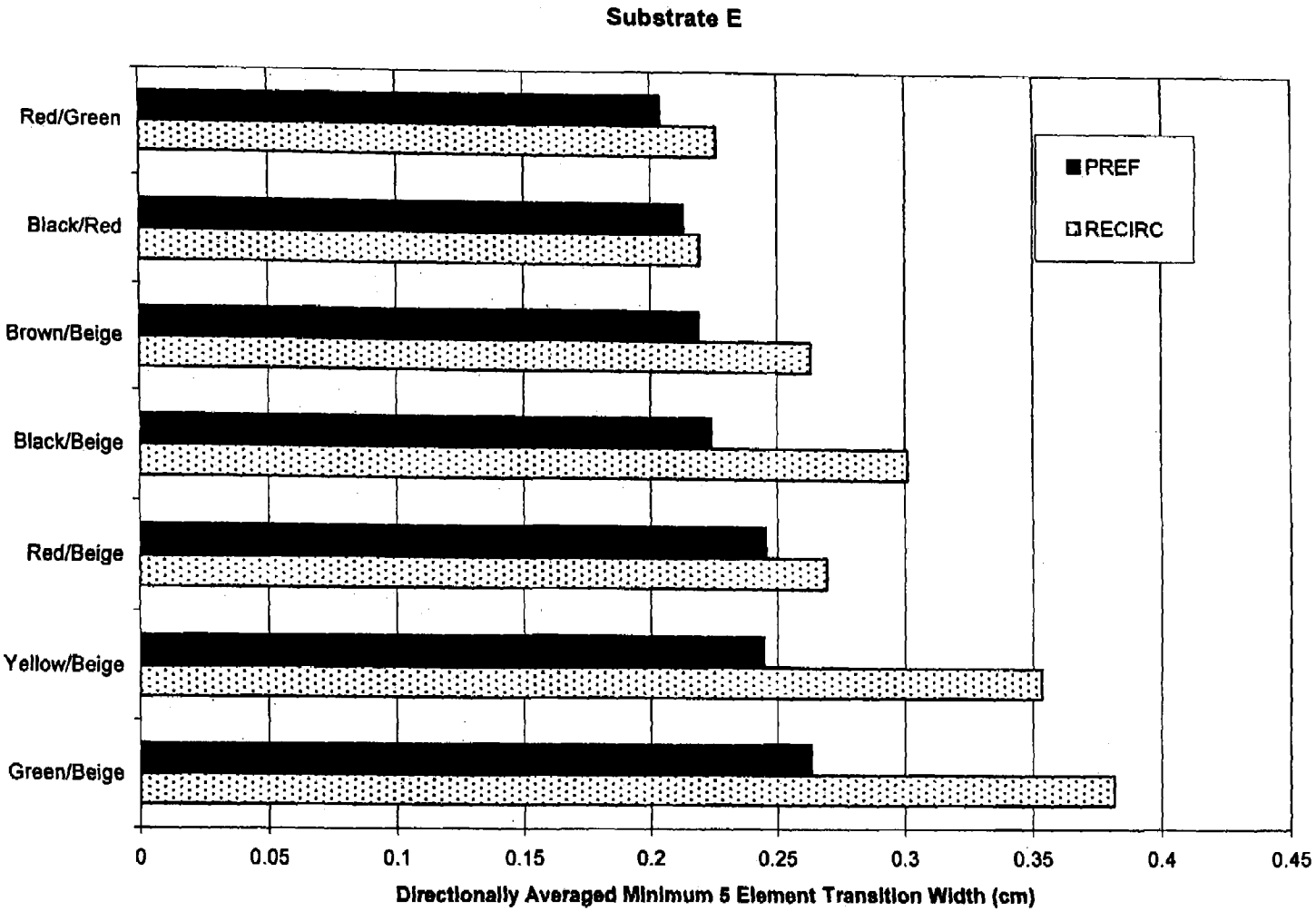
Figure 75:
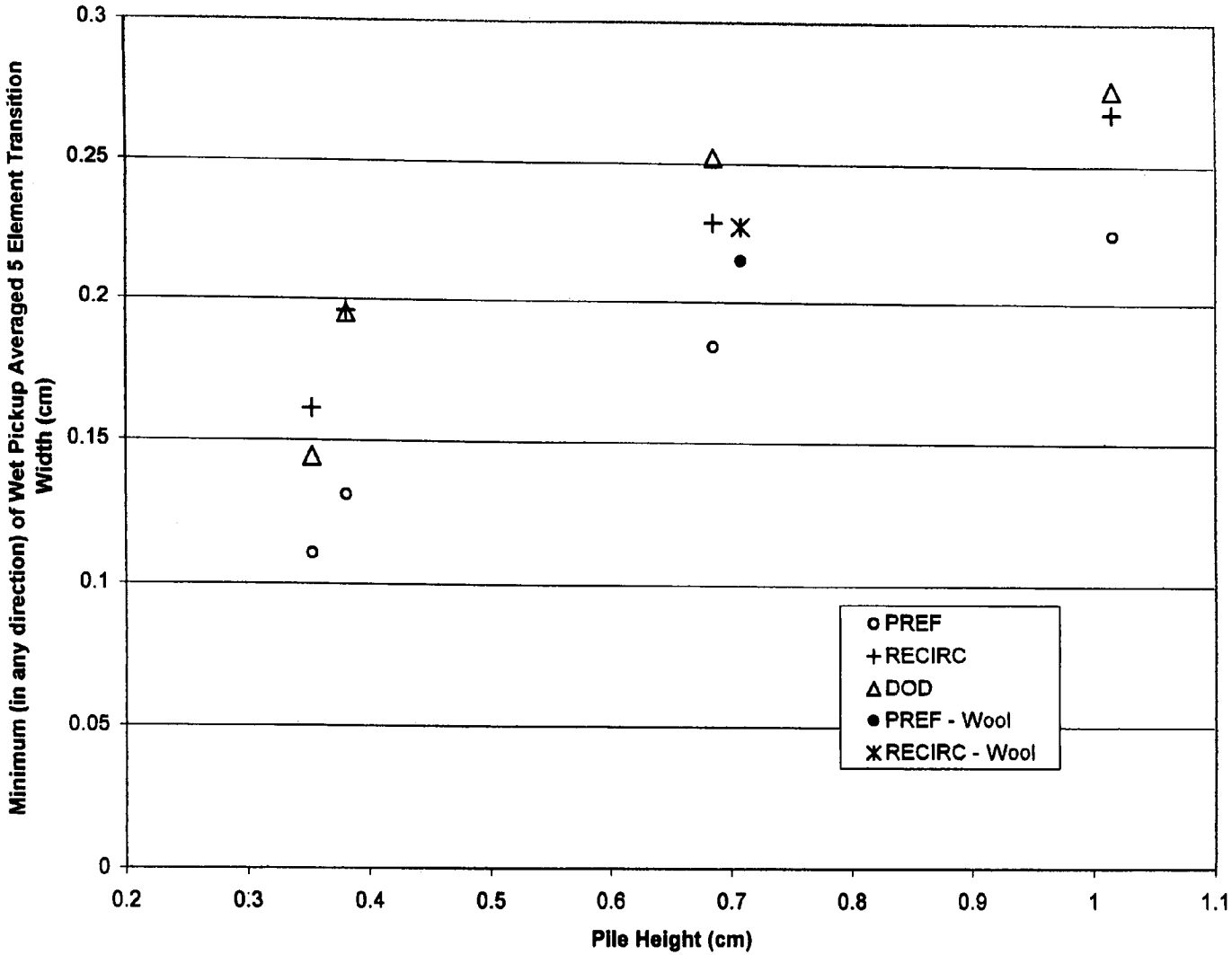
Figure 76:
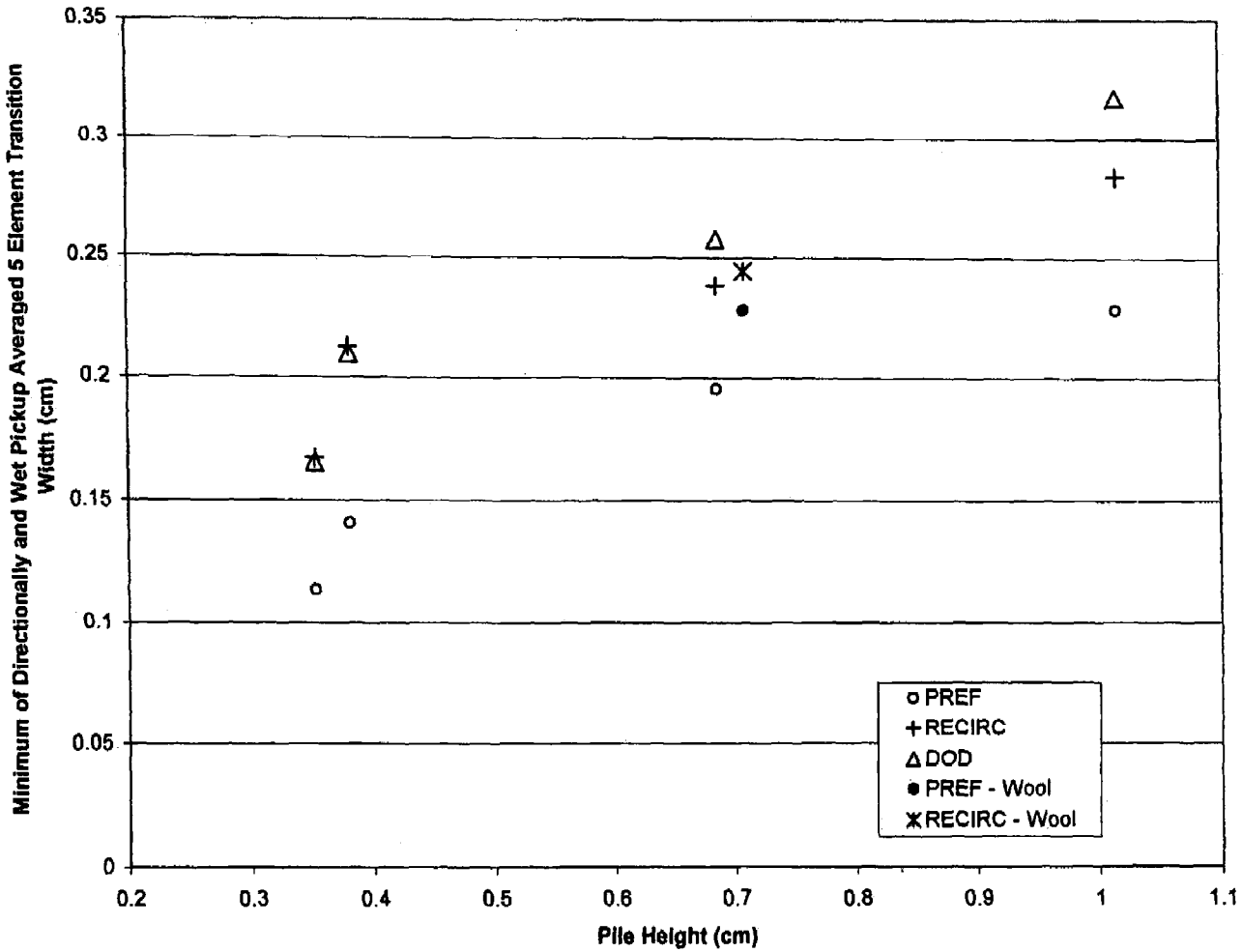
Figure 255:
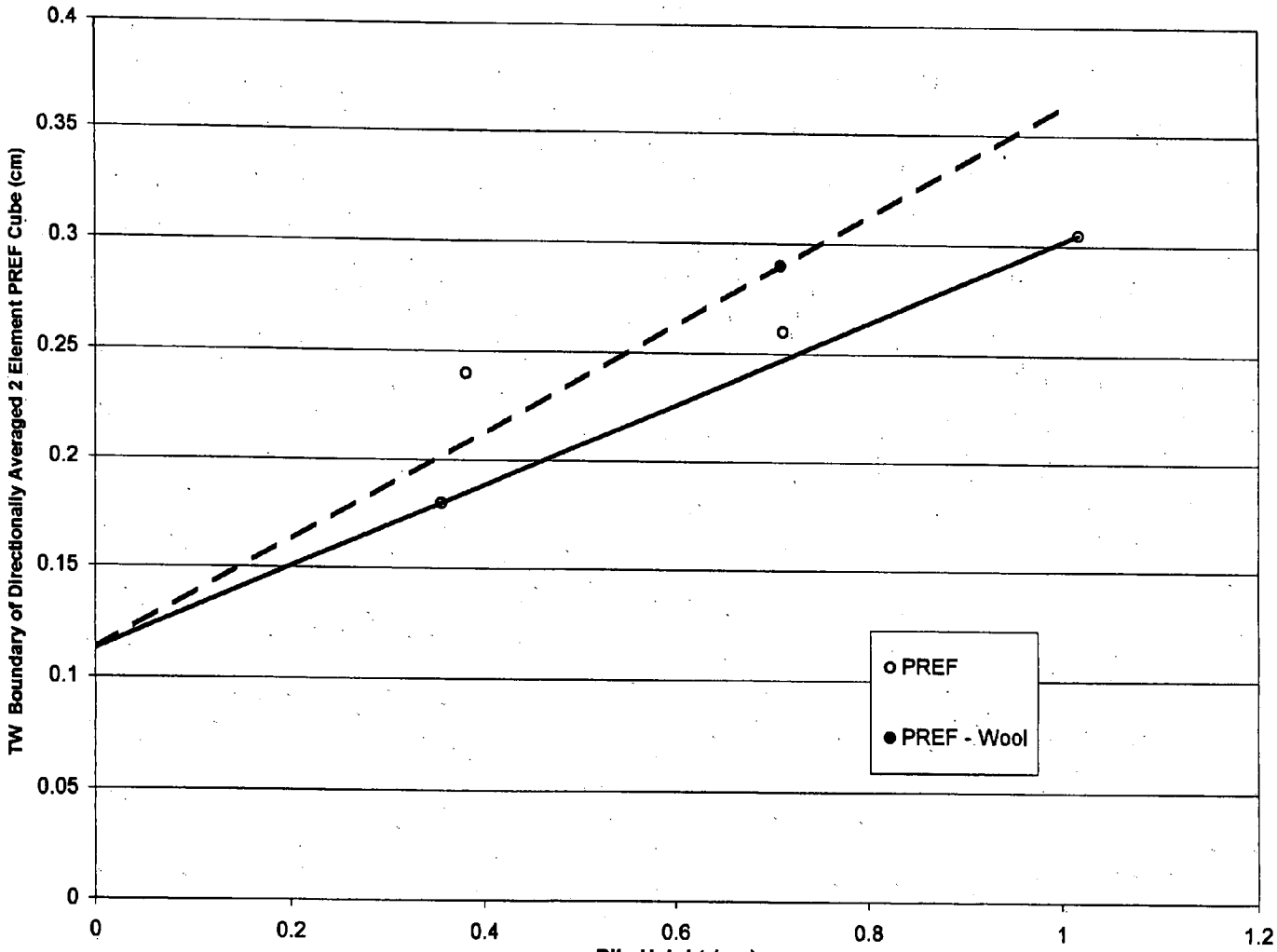

FIGS. 55 through 255 display data, variously presented, gathered in the course of making measurements of pattern characteristics on the above-described substrates using the above-described metered jet patterning devices. Due to the quantity of data, an attempt has been made to organize the presentation of these data in a way that facilitates an appreciation for the significance and inter-relationship of the data, as well as the formation and discussion of conclusions supported by the data.

Data from each of the five substrates are presented in respective sets of four bar charts, showing:

1. Wet Pickup Averaged data
2. Directionally and Wet Pickup Averaged data
3. Minimum data
4. Directionally averaged Minimum data As can be concluded from a review of these bar charts, the three different patterning technologies (PREF, RECIRC, and DOD) may provide somewhat equivalent Transition Width ("TW") and Feature Width ("FW") performance at very low wet pickups, for which the penetration of dye into the pile is very low. As the wet pickup is increased to provide the requisite pile penetration (expressed as a fraction or percentage and referred to as "fractional penetration"), drastic differences in quality of the three print technologies appear. The PREF technology provides somewhat slowly decreasing (i.e., improving) Transition Width ("TW") and Feature Width ("FW") performance with higher wet pickup. In contrast, the print performance for RECIRC and DOD patterning systems becomes relatively worse at high wet pickups. To demonstrate this point, FIGS. 55-133 include TW and FW data from multiple wet pickup print trials that were averaged to provide the data on the chart, and are therefore referred to as "wet pickup-averaged" Transition Widths and Feature Widths. The range of wet pickup values applicable to each substrate for which the data is averaged is indicated in Table 1 as the manufacturing wet pickup ranges, and represent those wet pickups that are necessary to provide reliable dye penetration (as defined herein) along at least 50% of the length of the pile elements (for Substrate E, a criterion of at least 40% was used, in recognition of its inherent resistance to dyeing using the dyes described herein), as is generally required to prevent the showing of undyed fibers or yarns to a commercially unacceptable degree. The measured Wet Pickup Averaged Transition Widths and Feature Widths are shown in the charts for two orthogonal directions, which allows for a characterization of whether the print quality depends on print direction. By comparing the data in this way, differences in print quality for different color (dye) pairings becomes apparent.

A variant of the preceding charts is the Directionally and Wet Pickup Averaged data charts. These charts result from taking the Wet Pickup Averaged data in the two orthogonal directions and finding the average value for each color in the two orthogonal directions. For the RECIRC and DOD printing technologies, there tends to be a consistent "good" and "bad" (in a relative sense) direction for printing. In contrast, the print quality of the PREF printing technology tends to be isotropic (to the extent allowed by the substrate) and thus print quality in either of two orthogonal print directions tend to be equally "good". The directional average is useful because it gives an overall sense of whether a printed pattern will appear sharp and be able to support fine details regardless of the orientation of the pattern elements on the printed substrate surface.

In a separate chart, the minimum Transition Widths and Feature Widths that were measured over the wet pickup ranges indicated in Table 1 are shown. The minimum values tend to be measured on substrates printed with the relatively low wet pickups within the range of wet pickups that produce acceptable fractional penetration. These data are also presented in two orthogonal directions. These charts represent the best (i.e., smallest) values for Transition Width and Feature Width that were obtained within the wet pickup ranges of Table 1. These values are also shown in directionally averaged form, for the reasons indicated above.

In the Examples, it was indicated that bar or line elements of sequentially increasing width were printed with the various color combinations to demonstrate the inherent differences of the three print technologies in rendering small scale details as well as large scale pattern elements in a printed pattern. In the presentation of bar chart data as well as other subsequent data, the terms "1 element feature" and "5 element feature" are used. The 1 element feature is a feature that is intended to be 1 printed pixel wide, i.e., the pattern calls for the assignment of a given color to a feature having a minimum dimension equal to the nominal gauge of the patterning device. The 5 element feature is, by extension, one that is intended to be 5 printed pixels in its smallest dimension. The physical size of a single pixel depends upon the nominal gauge of the printing technology used. In the PREF system, dye applicators are spaced along a line with a density of 20 applicators per inch, corresponding to a nominal gauge of 0.05 inch. Applicator spacings for the other technologies are 0.05 inch (nominal 20 gauge) for the RECIRC system and 0.0625 inch (nominal 16 gauge) for the DOD system. Measurements of the Transition Width and Feature Width for the 1 element feature are direct measurements of the capability of the printing systems to render a fine detailed element that is 1 pixel in its smallest dimension.

A 2 element feature is defined in a similar way, except that the desired pattern feature is intended to have a minimum dimension equal to two pixels (e.g., 0.1 inch for the PREF and RECIRC systems, and 0.125 inch for the DOD system). The 2 element feature was intended to simulate situations in which relatively fine detail was required, but with a measure of confidence that the detail would be observable, regardless of the influence of dominant colors, uncooperative pile constructions, or other factors that might serve to disguise or obliterate the desired feature.

When attempting to render a 1 or 2 element feature, the entire feature may be affected by migration of dyes from the boundary area, thus affecting the Transition Width and Feature Width for that pattern element. When a pattern element is large enough that dye within the two boundary regions that define opposite edges of the feature cannot interact with each other, there begins to be little difference in the Transition Widths measured for the boundary region, and the pattern element dimension is essentially "semi-infinite." Therefore, for purposes herein, the measurement of 5 element Transition Widths directly measure the ability of each of the print technologies to render semi-infinite boundaries, and thus it is assumed that the 5 element Transition Widths apply with reasonable accuracy to all pattern elements that are 3 or more printed pixel elements wide. When pattern areas of this size are rendered, there appears to be little visible difference between the Feature Widths associated with the various print technologies. However, the PREF system delivers, on average, substantially superior Transition Width measurements for all substrates measured.

In the Examples, it was specified that six representative colors were used to print the bar patterns that characterize the three print technologies. Seven specific color pairings were used: Red/Beige, Black/Beige, Green/Beige, Brown/Beige, Yellow/Beige, Red/Black, and Red/Green. The following is an example, using Red and Beige, of what was done using all of the above color pairings. The bar patterns for the Red/Beige color pairing were printed first with the 1 and 5 pixel wide features being red on a beige background, and then with those same-sized features being beige on a red background. Because the 5 element features represent a semi-infinite pattern area (i.e., is the equivalent of a "background" area), the resulting 5 element Transition Width for a beige feature on a red background was deemed to be basically equivalent to the 5 element Transition Width for a red feature on a beige background (both merely simulating two adjacent large-scale areas). Therefore, only seven color combinations are shown on the 5 element Transition Width charts.

Again using red and beige, it will be noted from the 1 element (and 2 element) Transition Width and Feature Width charts that the results obtained for a red 1 or 2 element feature on a beige background are very different from the results obtained for a beige 1 or 2 element feature on a red background. Therefore, the results for all 14 color pairings are shown for the 1 and 2 element Transition Width and Feature Width charts (seven color combinations with each of the two colors taking turns being respectively the feature or the background). This is noteworthy because when a dominant dye is used, a 1 element feature of the dominant dye in a non-dominant background may be visually discernable, but the 1 element feature of a non-dominant dye in a dominant dye background may have such substantially increased Transition Widths (and therefore substantially reduced relative contrast with its neighbor) due to dye migration of the dominant dye across the boundary as to be quite faint, or even entirely obliterated. The convention used in the charts is to list the color of the pair that represents the feature first, and the color that represents the background second.

It should be noted that the ability to render fine sharp details that are substantially anisotropic (i.e., don't vary substantially with direction), depends upon the printing substrate. As such, it is noted that Substrate A is a dense, uniform print base with a low, relatively stable pile surface that does not distort to a significant degree the inherent patterning characteristics of the three printing systems, and, generally speaking, is the substrate best suited to demonstrate the capabilities of a given printing system.

The Wet Pickup Averaged 5 Element Transition Width charts for the Substrate A, FIG. 55, demonstrates the inherent anisotropies, or directional dependences, of the Transition Width for the RECIRC and DOD print systems. The RECIRC print system shows a consistent anisotropy for all of the color pairings shown. Note that the RECIRC system consistently renders a narrower Transition Width for features printed in the designated horizontal (hor) direction. For a 1 element straight line printed with the RECIRC print system in the designated horizontal direction, a single jet on the array prints the entire line and the drop footprint is elongated (due to relative movement of the dye stream during actuation, and other factors) in the same direction as the line. By comparison, the Transition Widths are consistently larger on substrate A for the features printed in the vertical (ver) direction. For a straight line printed with the RECIRC print system in the designated vertical direction, an array of neighboring jets is required to print the line and the drop footprint is elongated across the boundary of the line. This result is in keeping with the expectation of those skilled in the art of using a RECIRC-type printing system.

The Wet Pickup Averaged 5 Element Transition Width data for the DOD printing System on Substrate A (FIG. 55) also shows a consistent anisotropy for all of the color groupings shown, but in a different direction. The DOD system consistently renders a narrower Transition Width for features printed in the vertical (ver) direction. For a straight line printed with the DOD print system in the designated vertical direction, the traversing color-metering head prints the line on a single sweep of the print head across the substrate. By comparison, the 1 element Transition Widths are consistently larger on substrate A for the features printed in the horizontal (hor) direction. For a straight line printed with the DOD print system in the designated horizontal direction, the traversing color-metering head prints the line as it indexes forward and attempts to print at the same point in its raster sweep (multiple raster sweeps of the head produce the line). The timing of dye flow actuation as the head rasters across the pattern needs to be extremely well calibrated to get a good edge in this print direction. This result is in keeping with the expectation of those skilled in the art of using this DOD printing system.

In contrast to the preceding discussion, the PREF print system provides a relatively direction-independent result. With few exceptions, the Transition Width values measured for all of the color groupings shown is nearly the same for the horizontal and vertical directions.

It is noted that this anisotropy also can be seen in the charts for minimum 5 element Transition Widths, shown in FIGS. 55-74. These anisotropy trends tend to apply to all five substrates, though not uniformly. It is noted that substrates with loops tend to have wicking channels parallel to the print surface of the substrate, which are believed to draw dye along the surface of the substrate and promote directional differences. Also, a multi-leveled substrate topology may serve to channel dyes away from their intended pixel location on the substrate. For substrates that have long pile elements, it is relatively easy for the upper portions of the pile elements to move away from their initial locations at the time of printing and therefore distort the inherent print properties imparted to the substrate by the various print technologies. Therefore, it is not surprising that substrate-specific effects may mask the directional print-properties inherent in each of the print systems. As mentioned above, Substrate A appears generally to be the most revealing of these various printing characteristics, because it provides few of the above masking structures.

Almost without exception, it can be seen from the Wet Pickup Averaged and Minimum 5 Element Transition Width charts that the PREF printing system is capable of rendering a boundary between large pattern areas with a smaller Transition Width (and therefore a finer edge) than the DOD and RECIRC systems for any given color combination. There are instances where one direction can be printed with the DOD or RECIRC systems such that the 5 element Transition Width is comparable to the PREF results, but usually the orthogonal direction for that competing technology is worse than that for PREF. This result becomes very clear when looking at the directionally averaged charts. These directionally averaged (both Wet Pickup averaged and Minimum) 5 element Transition Width charts, contained in FIGS. 55-74, demonstrate that the PREF data is almost universally superior to the RECIRC and DOD print systems for each color combination at a boundary.

While the numeric values that represent the 5 element Transition Widths for the different color combinations vary over a range, the PREF 5 element Transition Widths tend to be more uniformly clustered. Furthermore, the PREF patterning system can be distinguished because it is able to generate, for any specified substrate, the smallest 5 element Transition Widths for some color combinations. In fact, the lowest 5 element Transition Widths tend to be for the brown/beige color pairing. This is significant because both brown and beige are fairly low concentration dyes that do not readily migrate out of their designated pixel locations. The interaction of these colors in this color pairing is considered by those skilled in art as being closely representative of the vast majority of color interactions normally found in patterned textiles. Therefore, the ability to render low 5 element Transition Widths with this color pairing is significant for printing substrates with the PREF patterning system in general. It is further noted that most of the colors represented in these data are colors that tend to bleed out of their pixel area—for instance, reds, blacks, greens, and yellows all tend to migrate out of their assigned pixel location fairly readily, and are therefore considered difficult to print (at lest if fine detail is desired). Therefore, it is believed that, taken together, the results using relatively easy and well as relatively difficult color combinations, generates data that effectively brackets the capability of these systems.

To attempt to quantify the ability of PREF to render narrower 5 element Transition Widths, FIGS. 75-79 show the minimum 5 element Transition Width data (either Wet Pickup Averaged or Minimum, in either orthogonal direction or directionally averaged, and for all colors) obtained for each substrate, plotted against the pile height (measured from tip to exposed base) for the corresponding substrate.

There are several reasons why one skilled in the art would expect that the Transition Width should increase with the pile height. A longer pile element requires more dye to pattern it with acceptably deep dye penetration. When the larger amount of dye is dispensed onto the carpet surface, there is a greater probability that it will form a bead or puddle that is substantially larger than the pixel area that is designated for it. Therefore, there may be substantially more dye overlap between neighboring pixels. Furthermore, the larger amount of dye on the surface makes it more probable that there will be some dye wicking in a lateral direction along the surface of the substrate. In addition, a longer pile element is more likely to be "floppy" and move from its "as-dyed" position, thus distorting the surface print and increasing the Transition Width, on the average.

Figure 77:
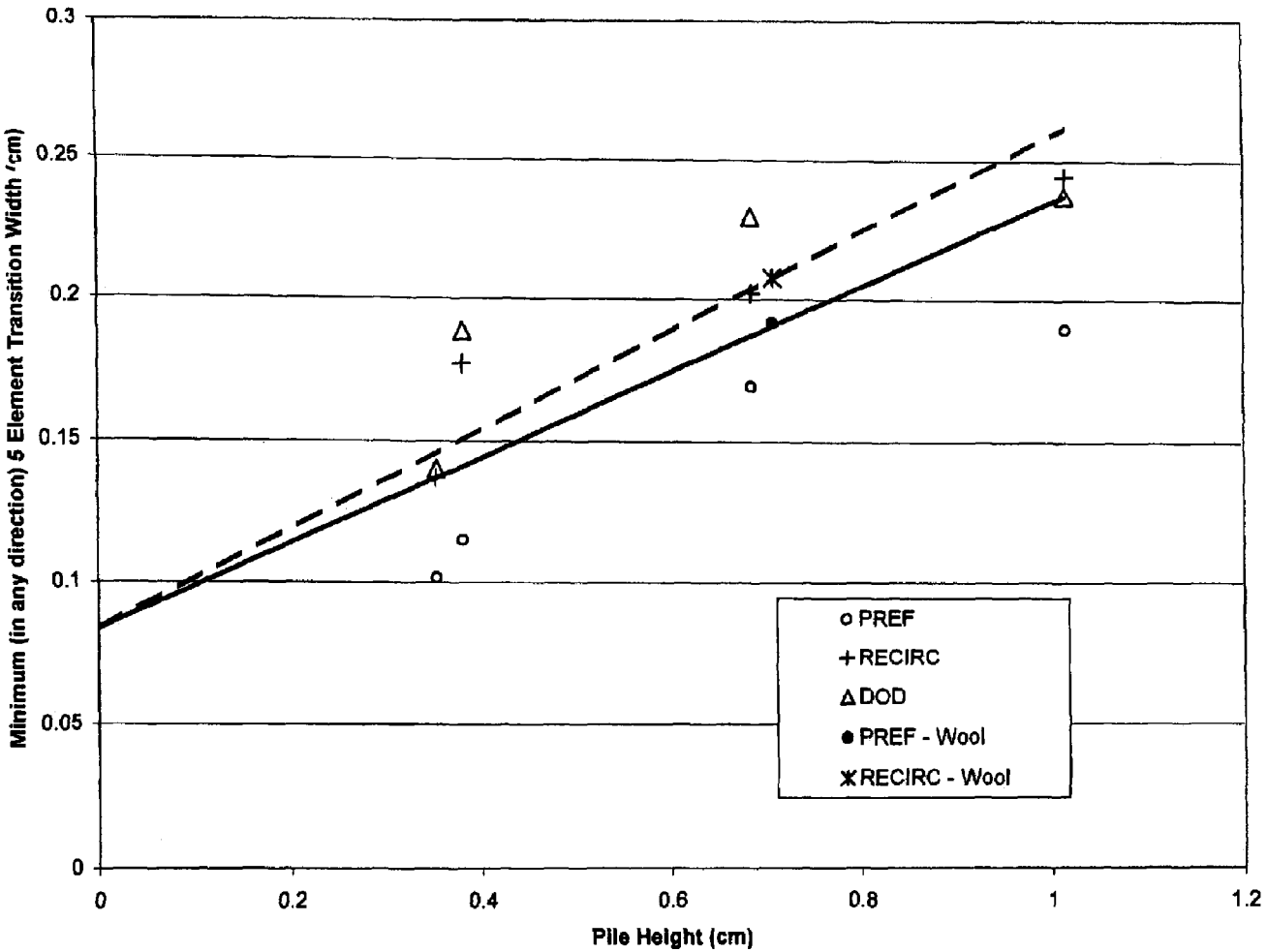

Looking at FIGS. 55-78, it is apparent that the best (i.e., minimum) 5 element Transition Width for each of the 5 substrates is obtained with the PREF patterning system. In each case, it is possible on the charts to draw a line that separates the lowest value of 5 element Transition Width for the DOD and RECIRC technologies from the corresponding PREF values. Looking first at the data generated from the Substrates A through D (i.e., the nylon 6,6 pile) as shown in FIG. 77, the equation for a separating line for the Minimum 5 Element Transition Width (in any direction and for any of the listed color combinations) as a function of pile height is as follows:

(nylon 6,6):

$$TW_{min,\ any\ direction}(\text{cm})=0.15\cdot[\text{Measured Pile Height (cm)}]+0.08$$

Figure 78:
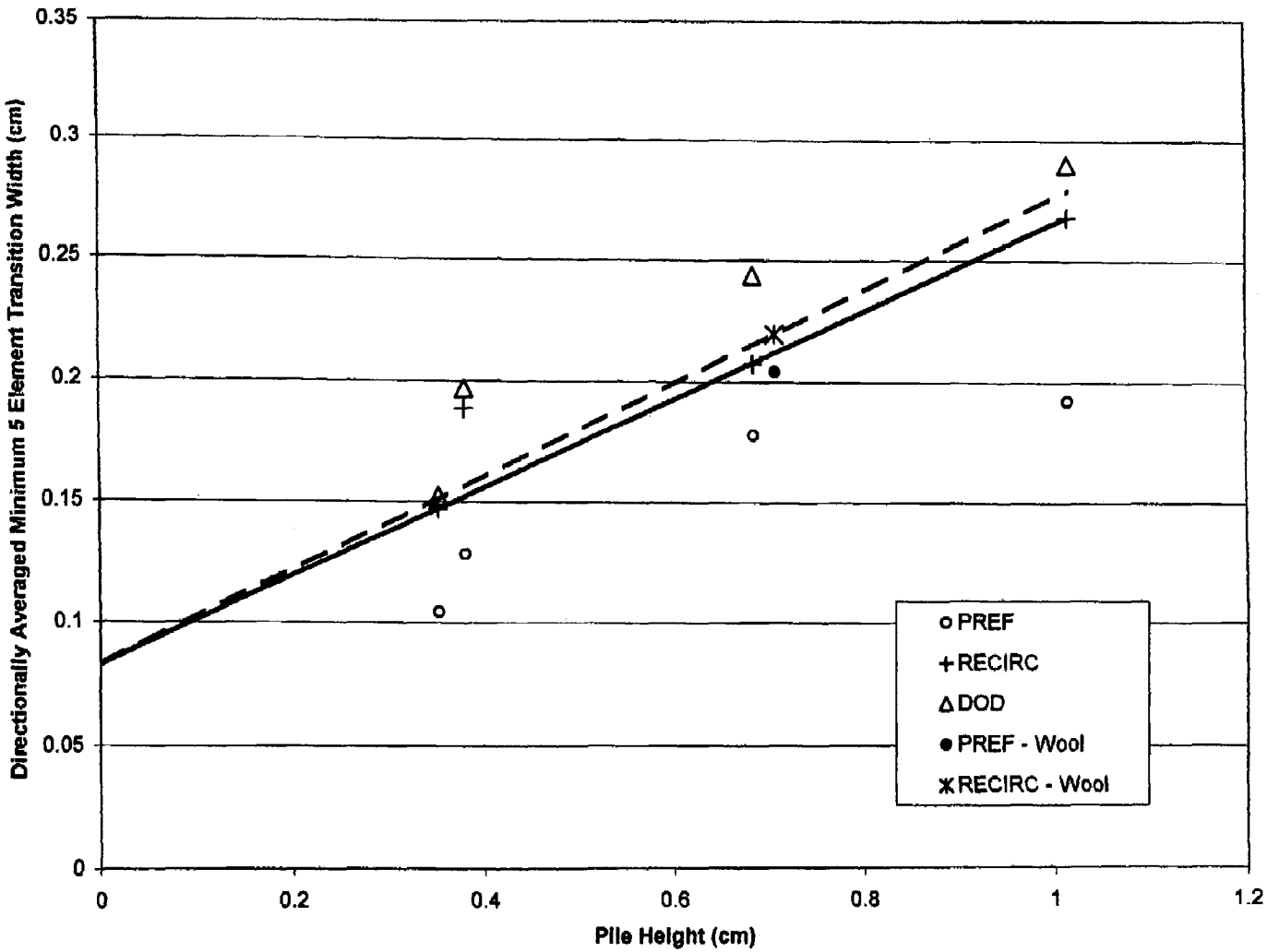
Figure 79:
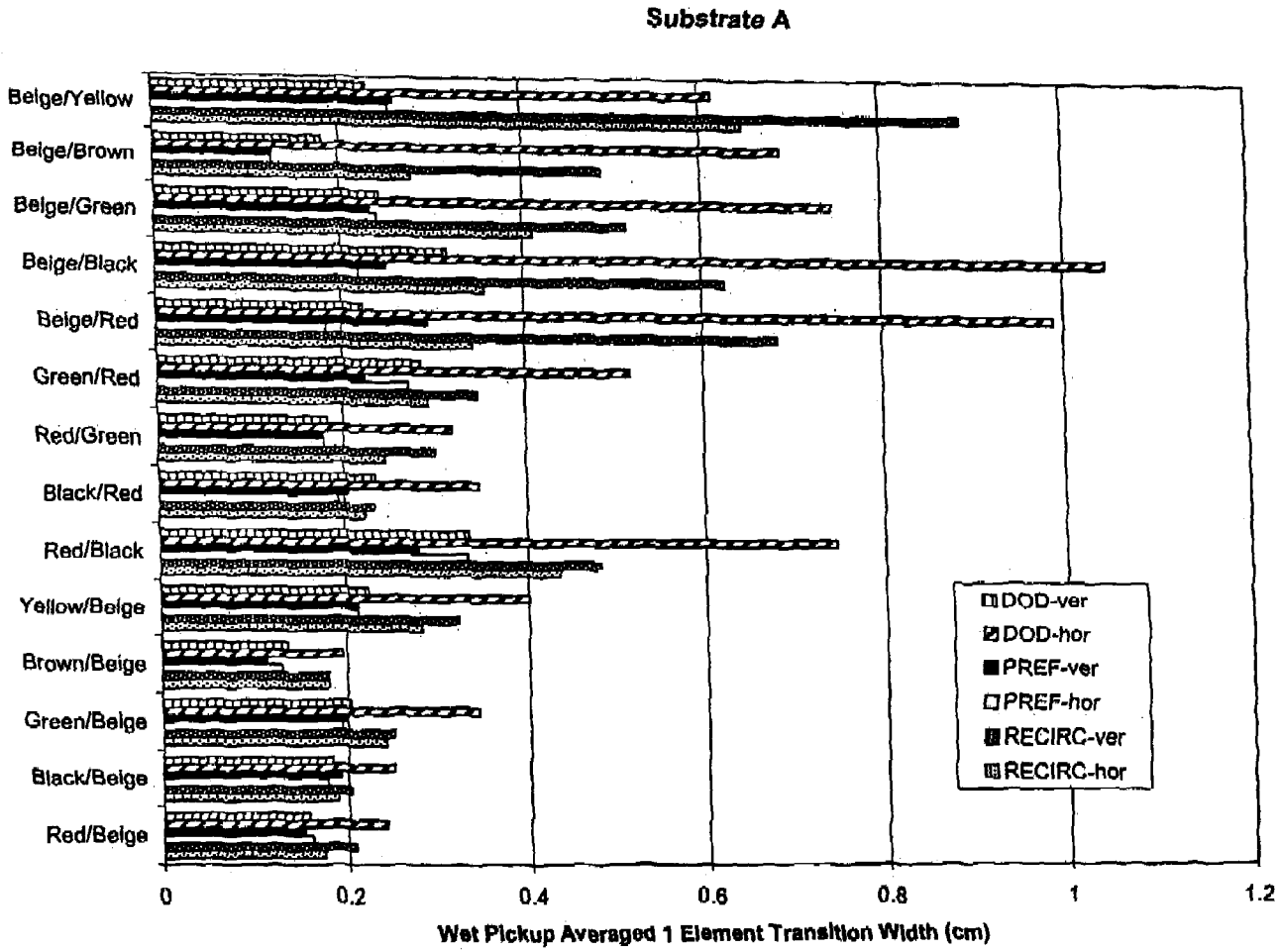
Figure 80:
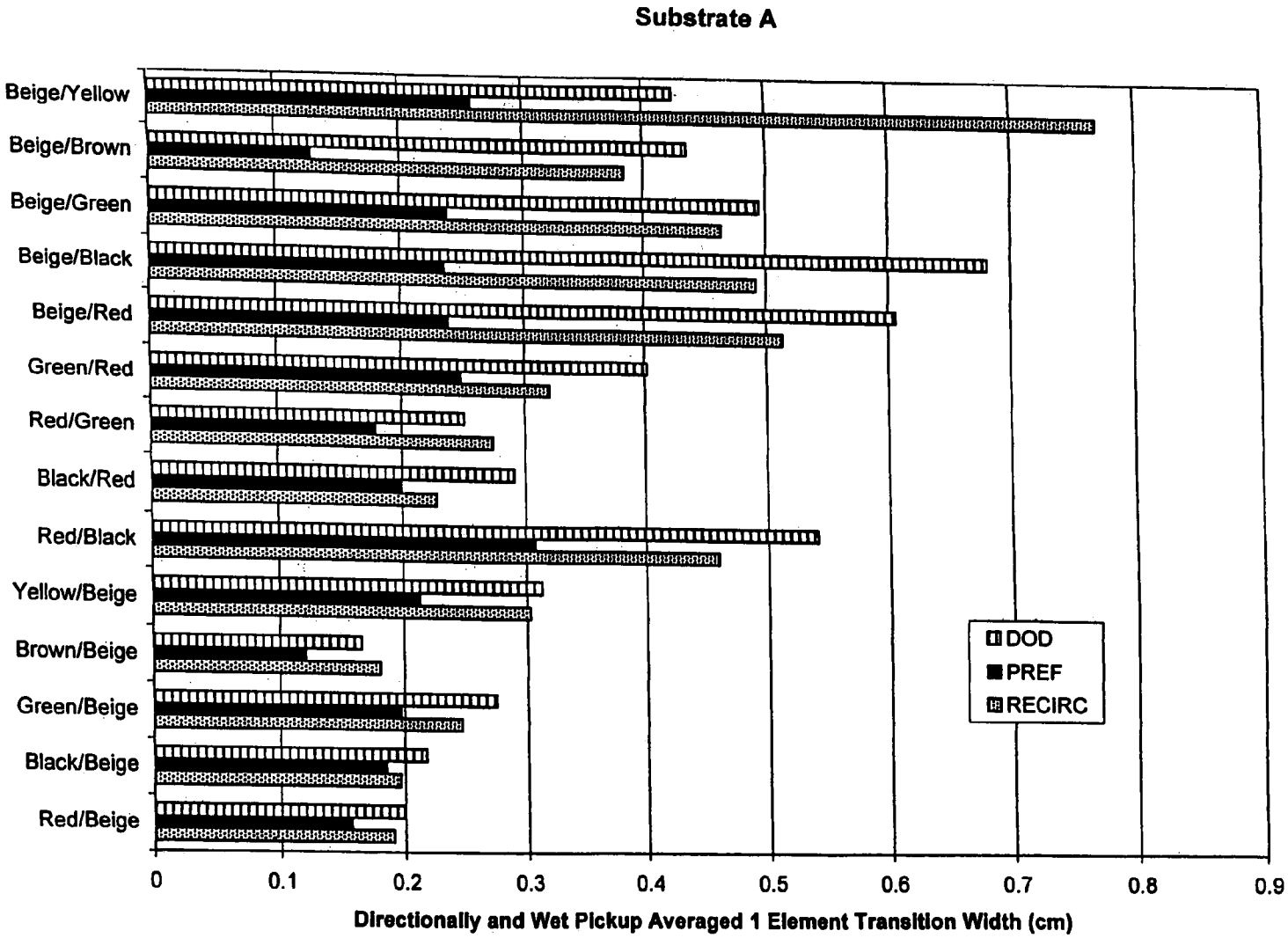
Figure 81:
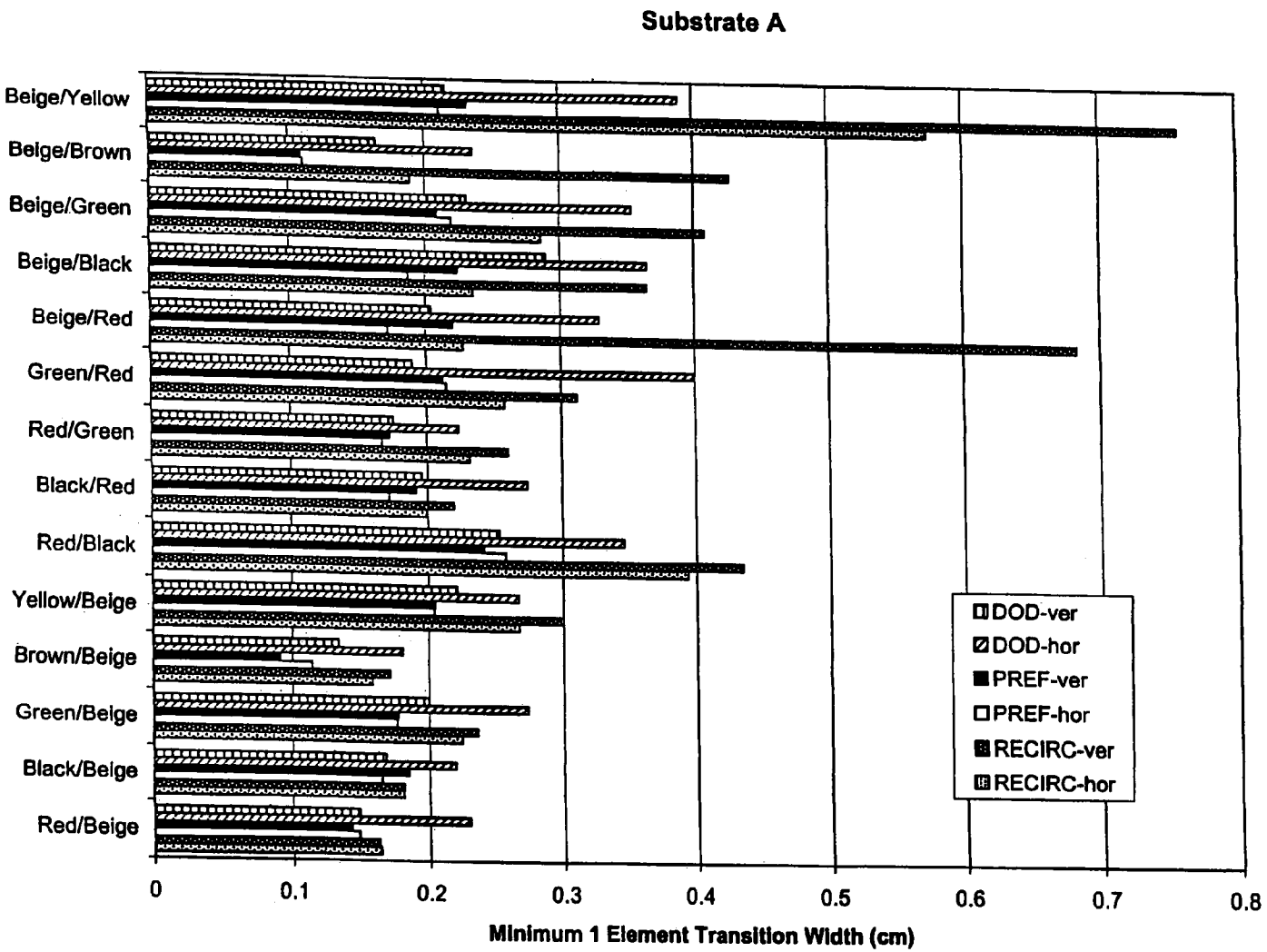
Figure 82:
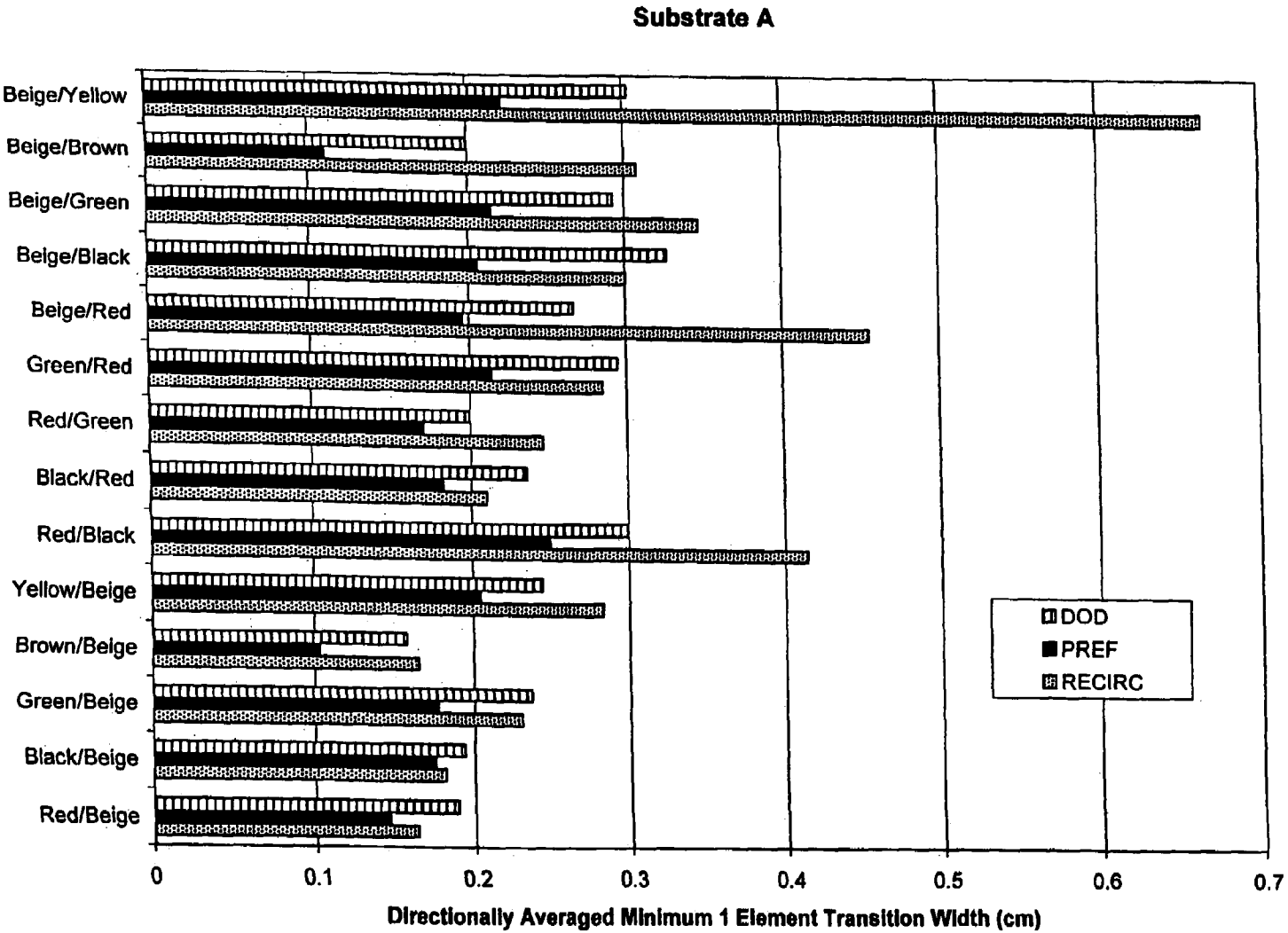
Figure 83:
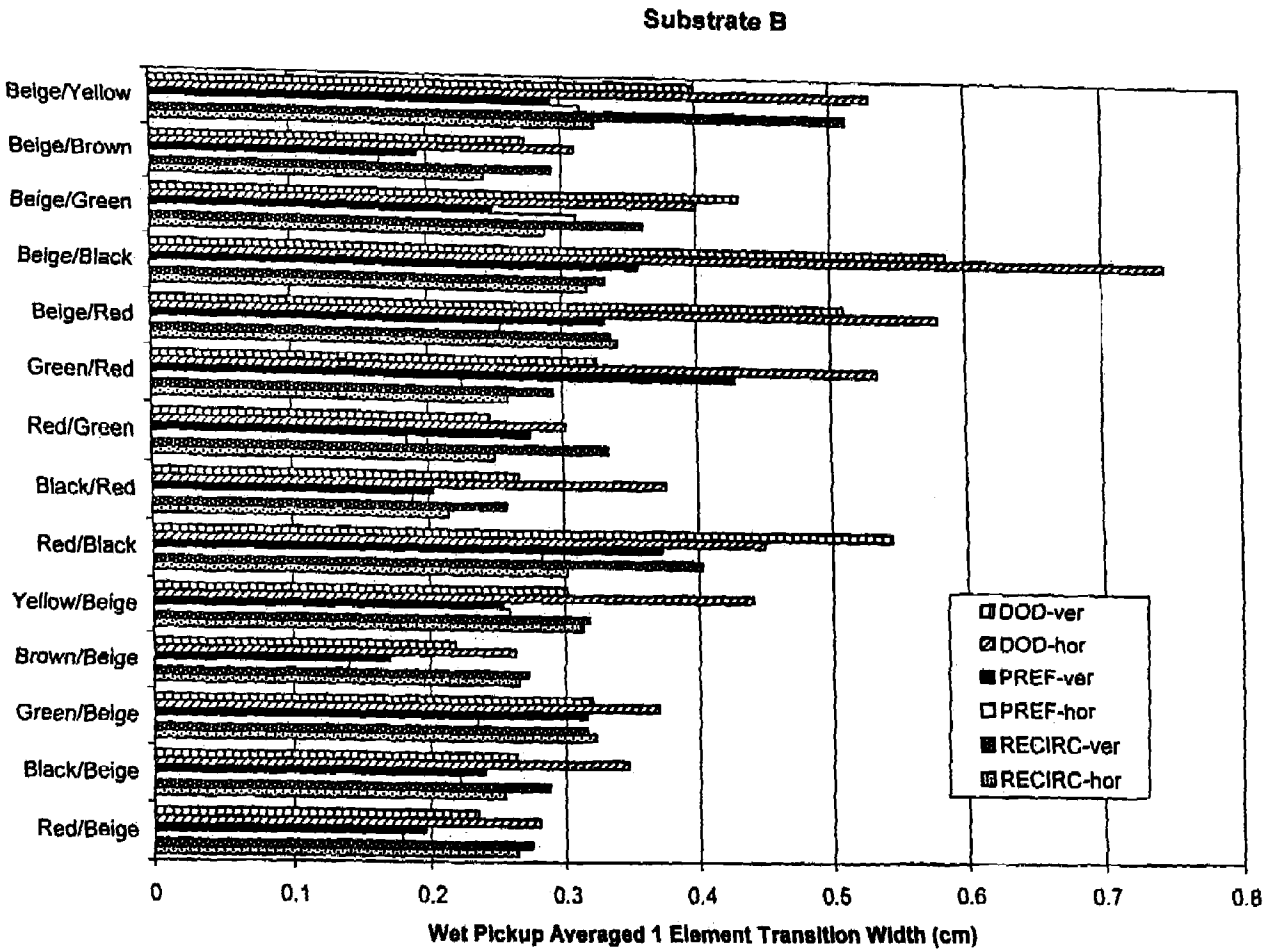
Figure 84:
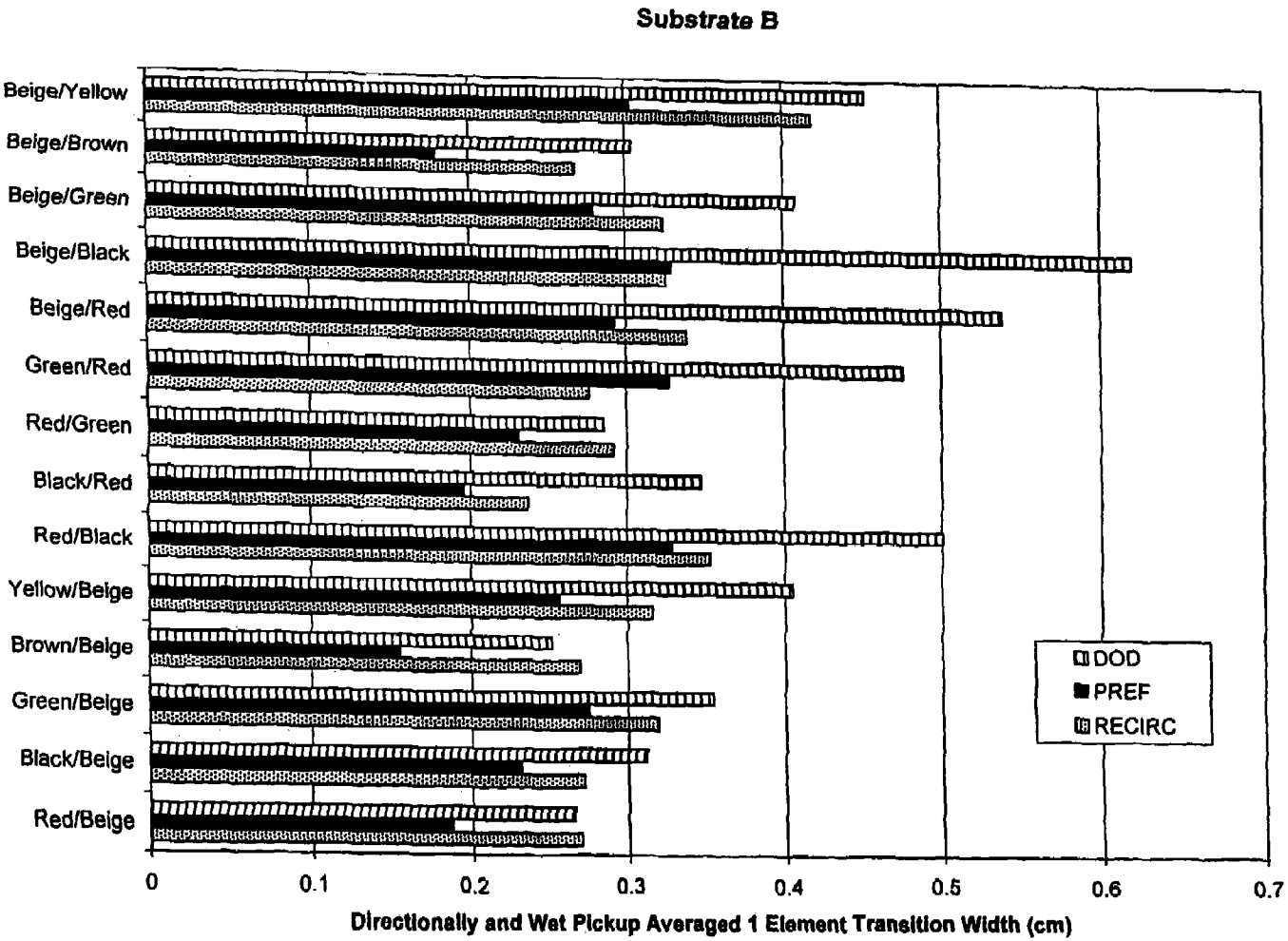
Figure 85:
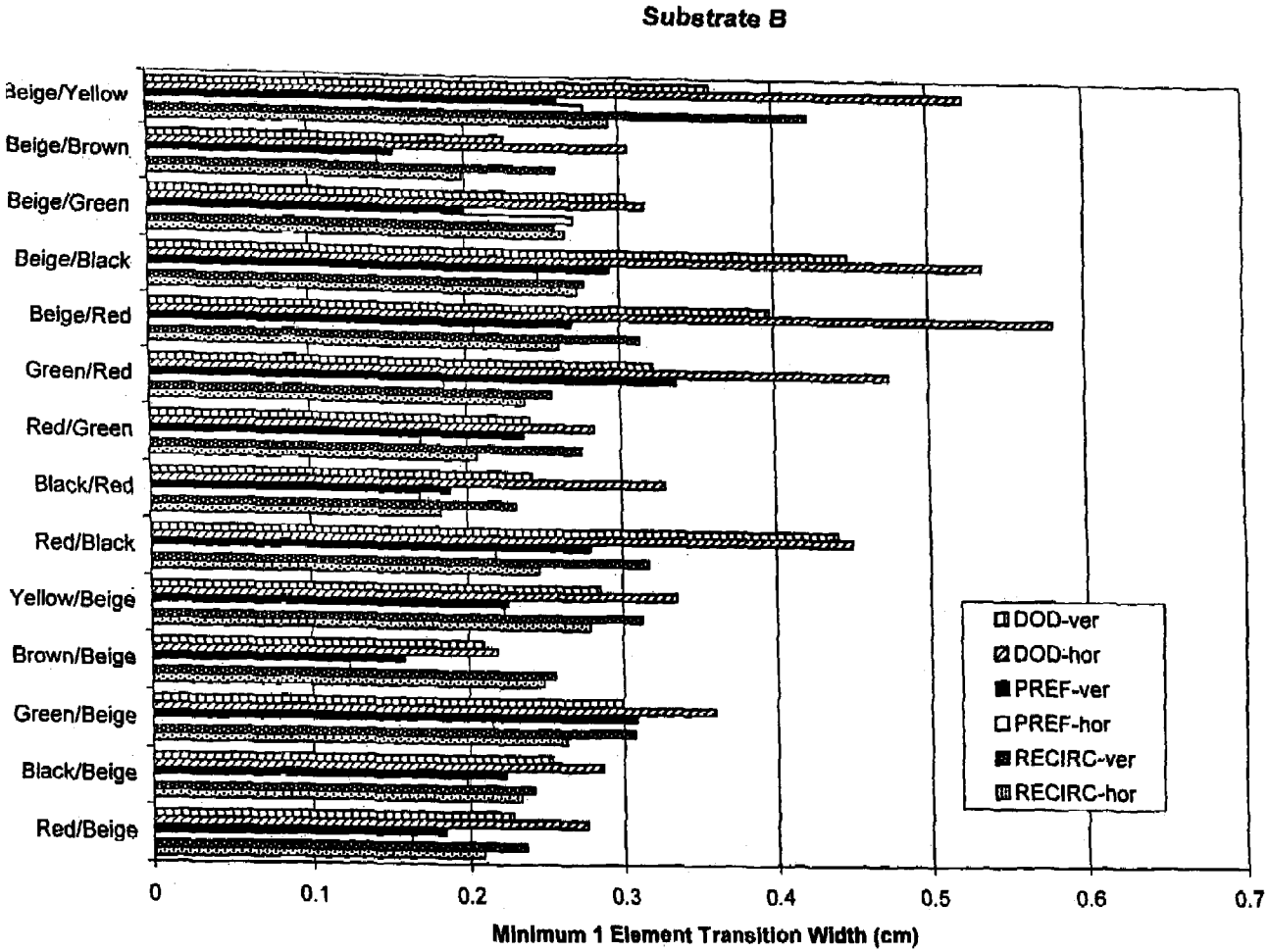
Figure 86:
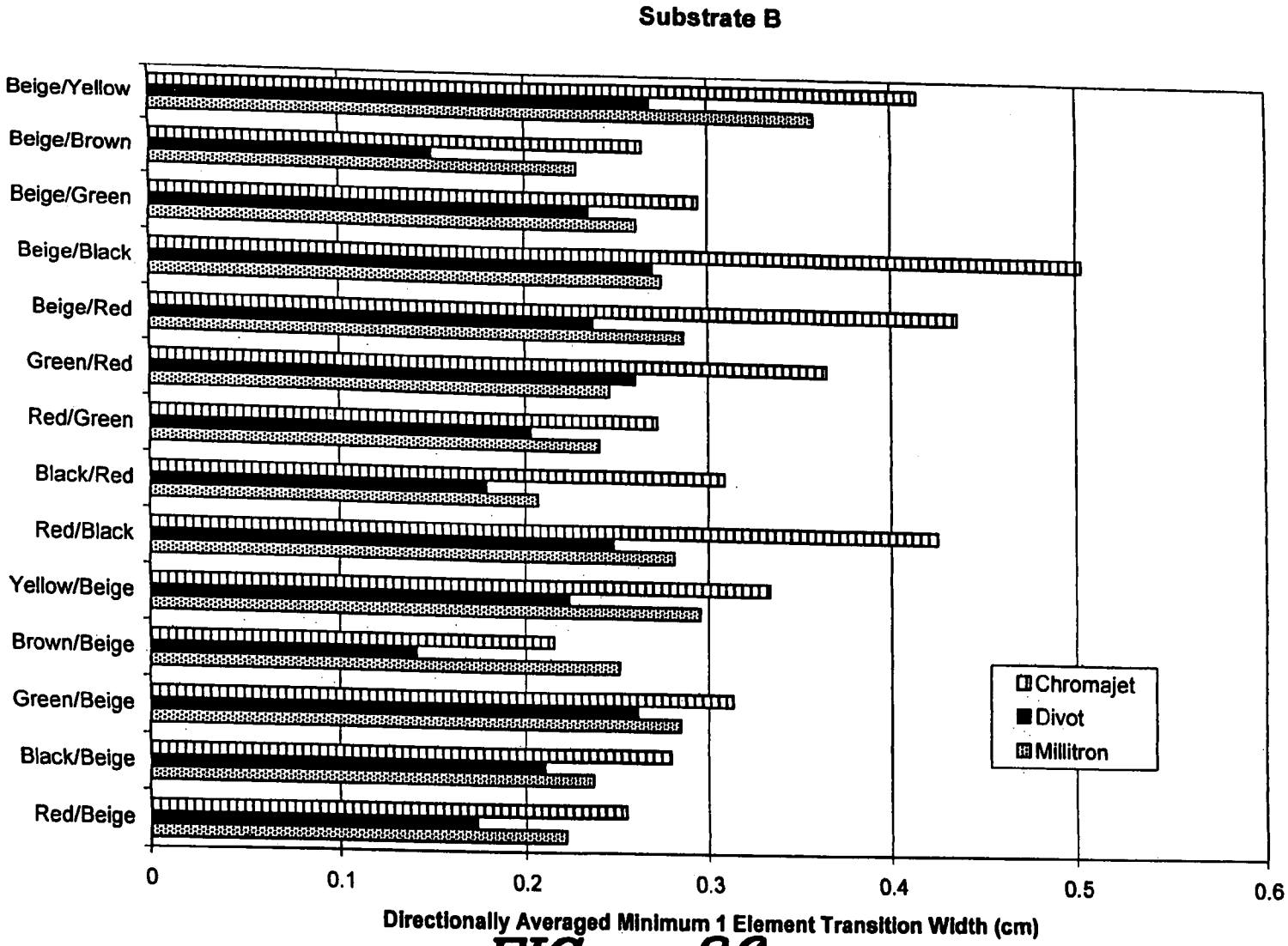
Figure 87:
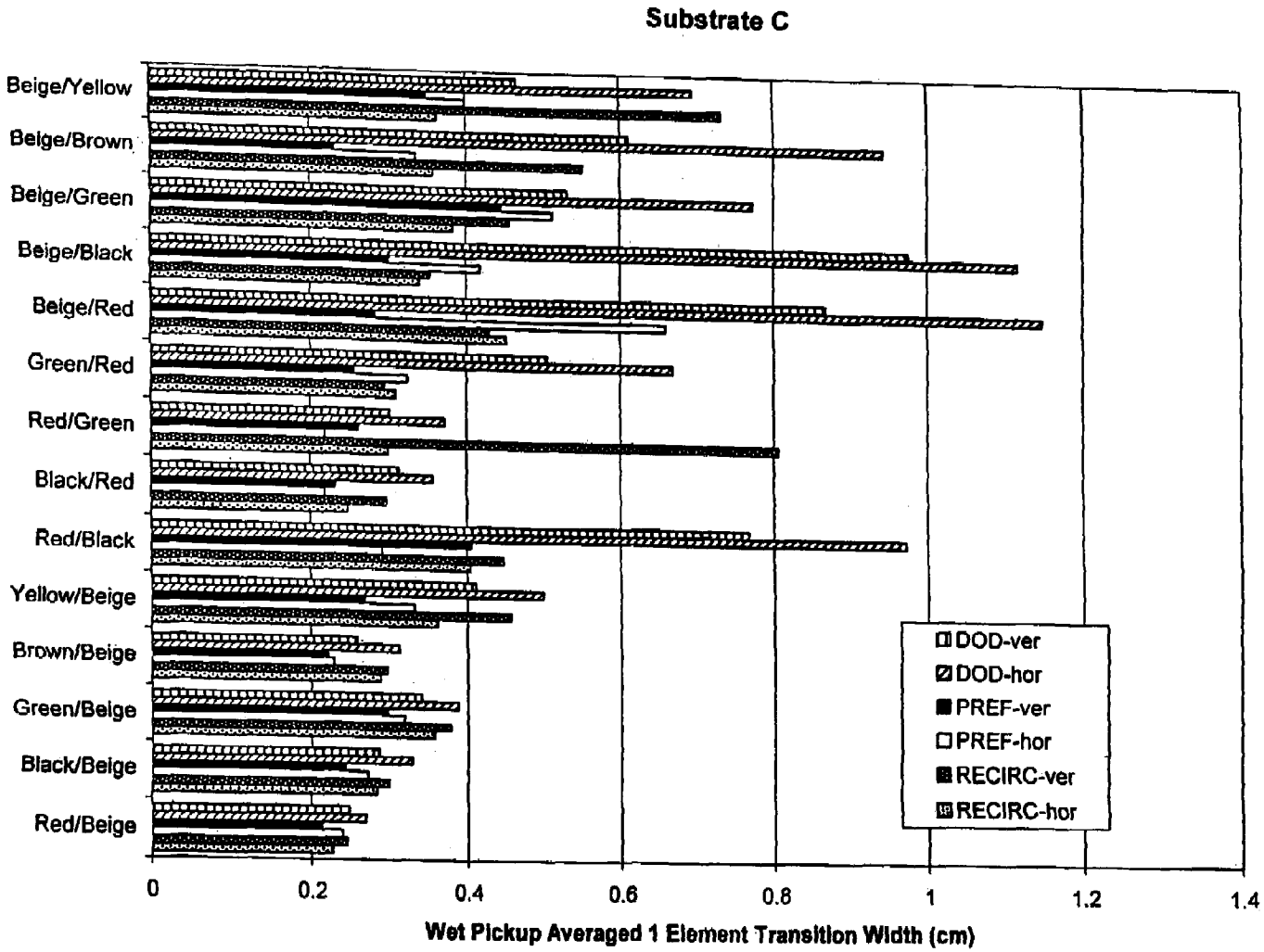
Figure 88:
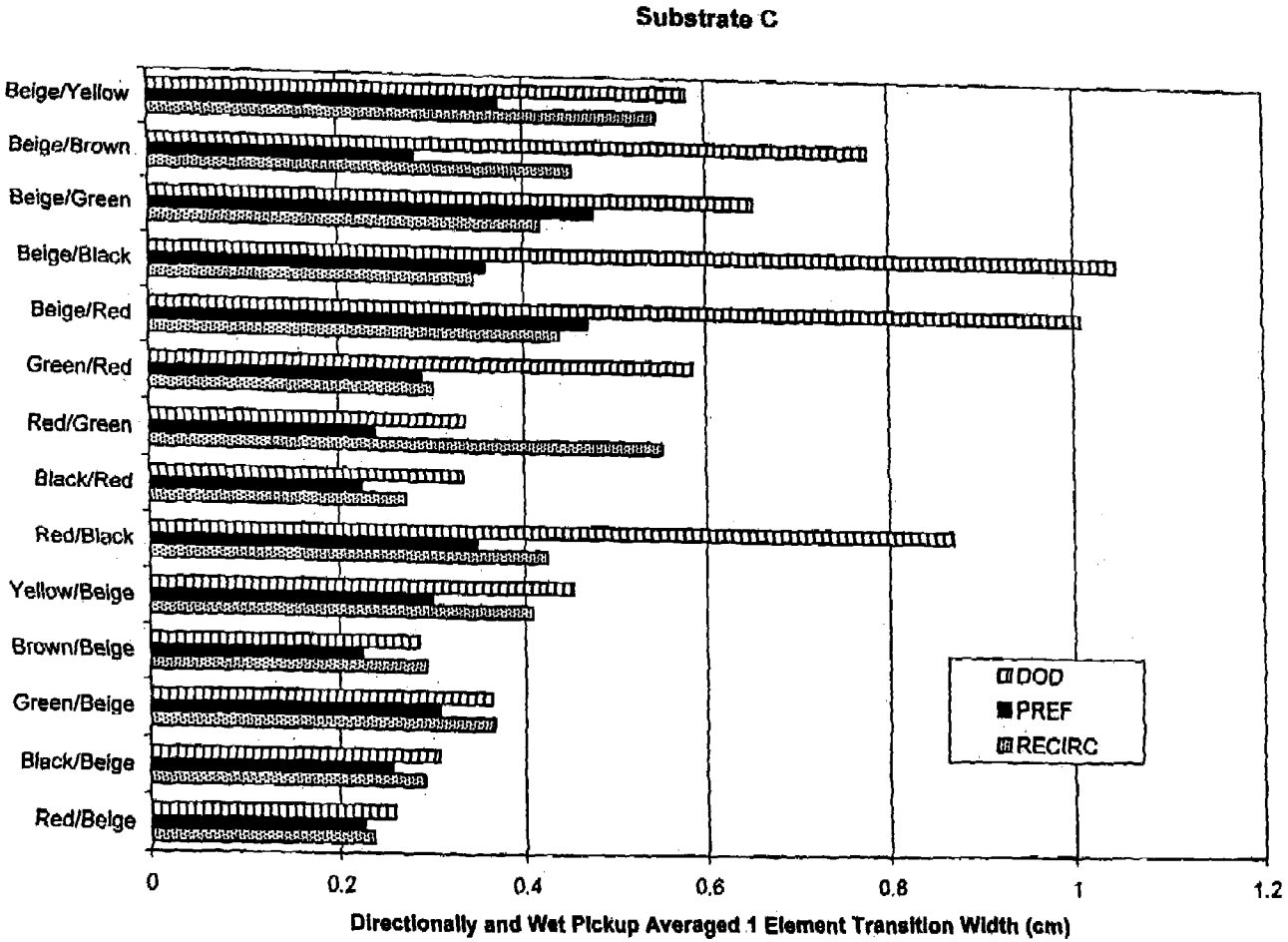
Figure 89:
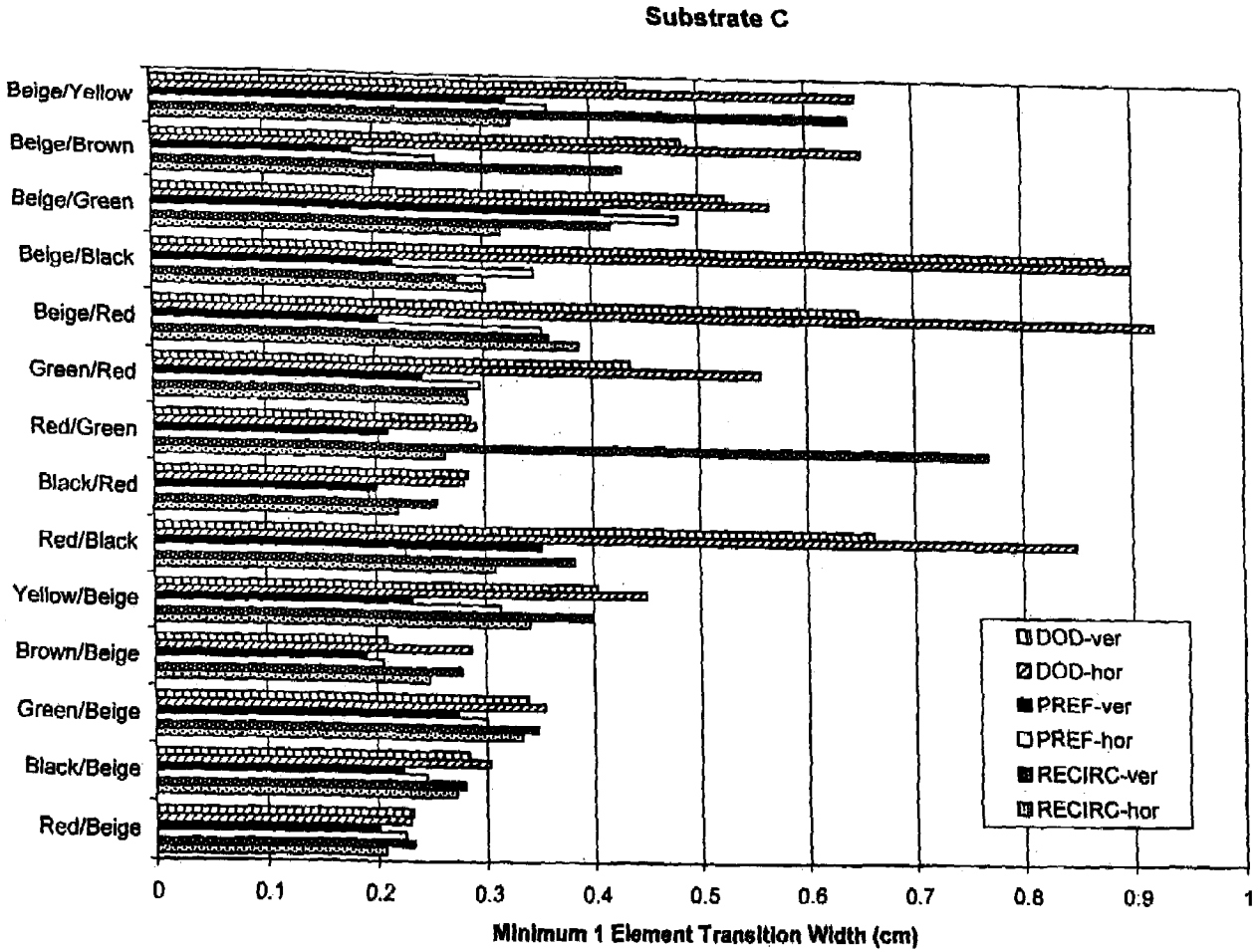
Figure 90:
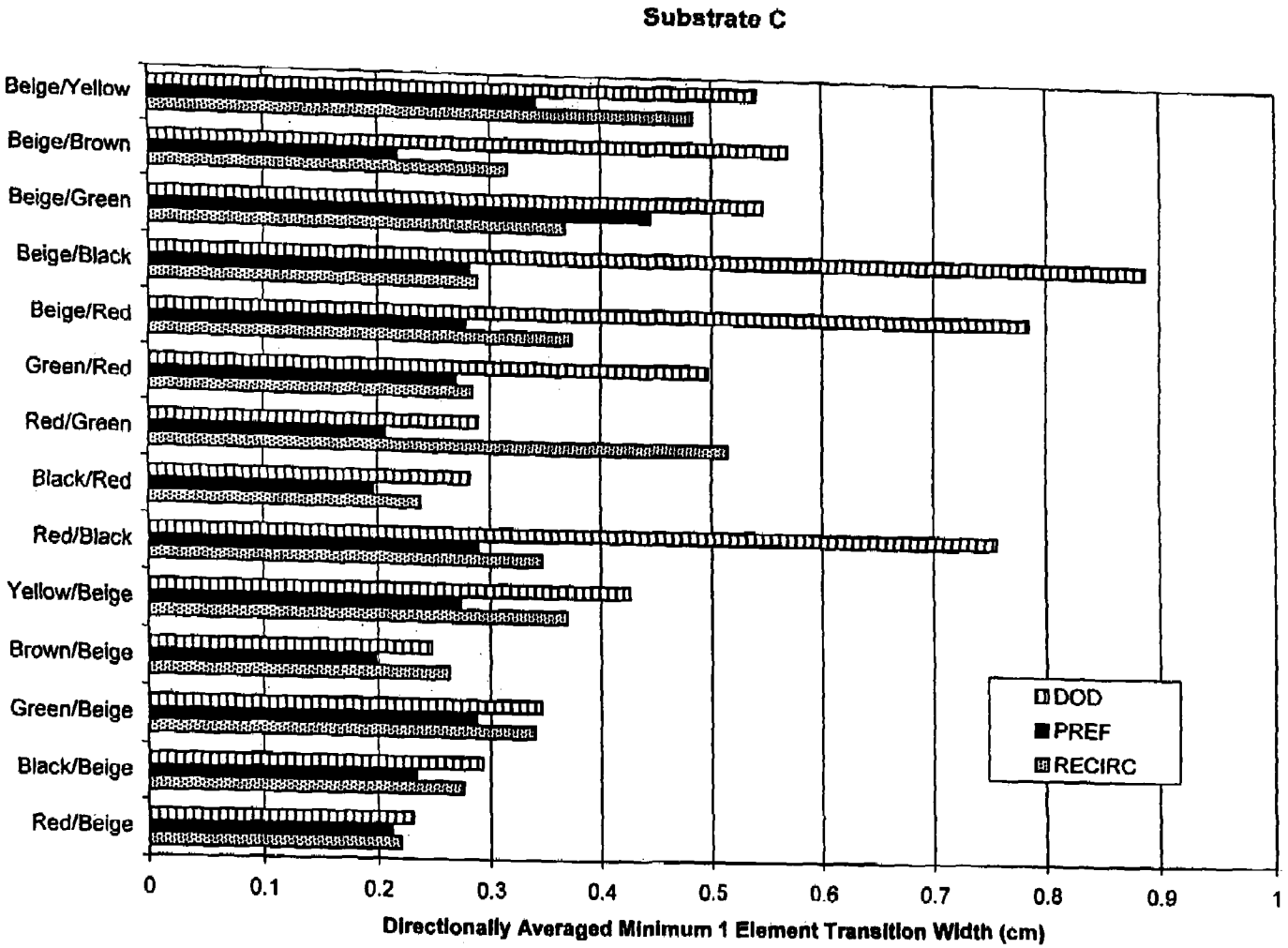
Figure 91:
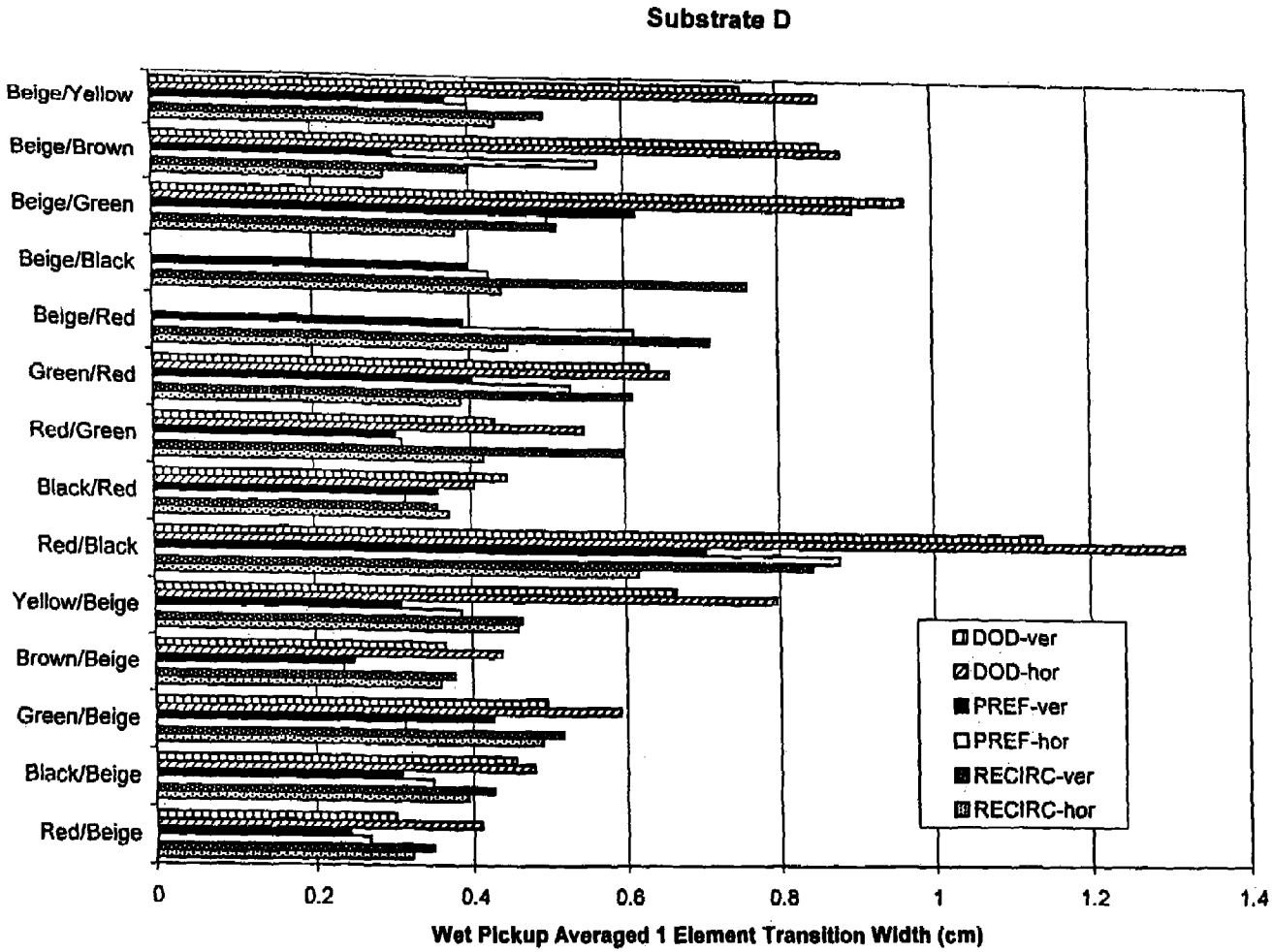
Figure 92:
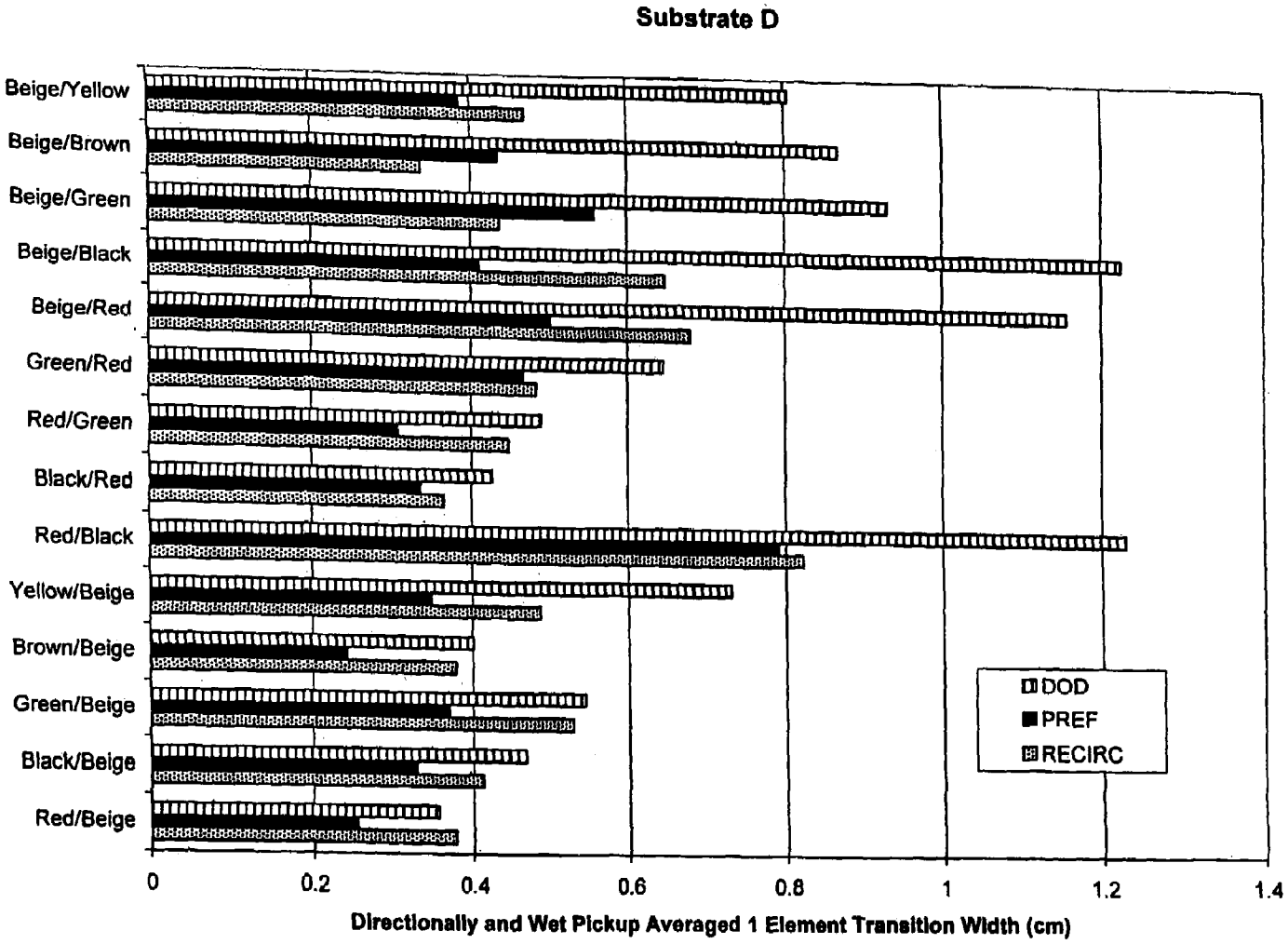
Figure 93:
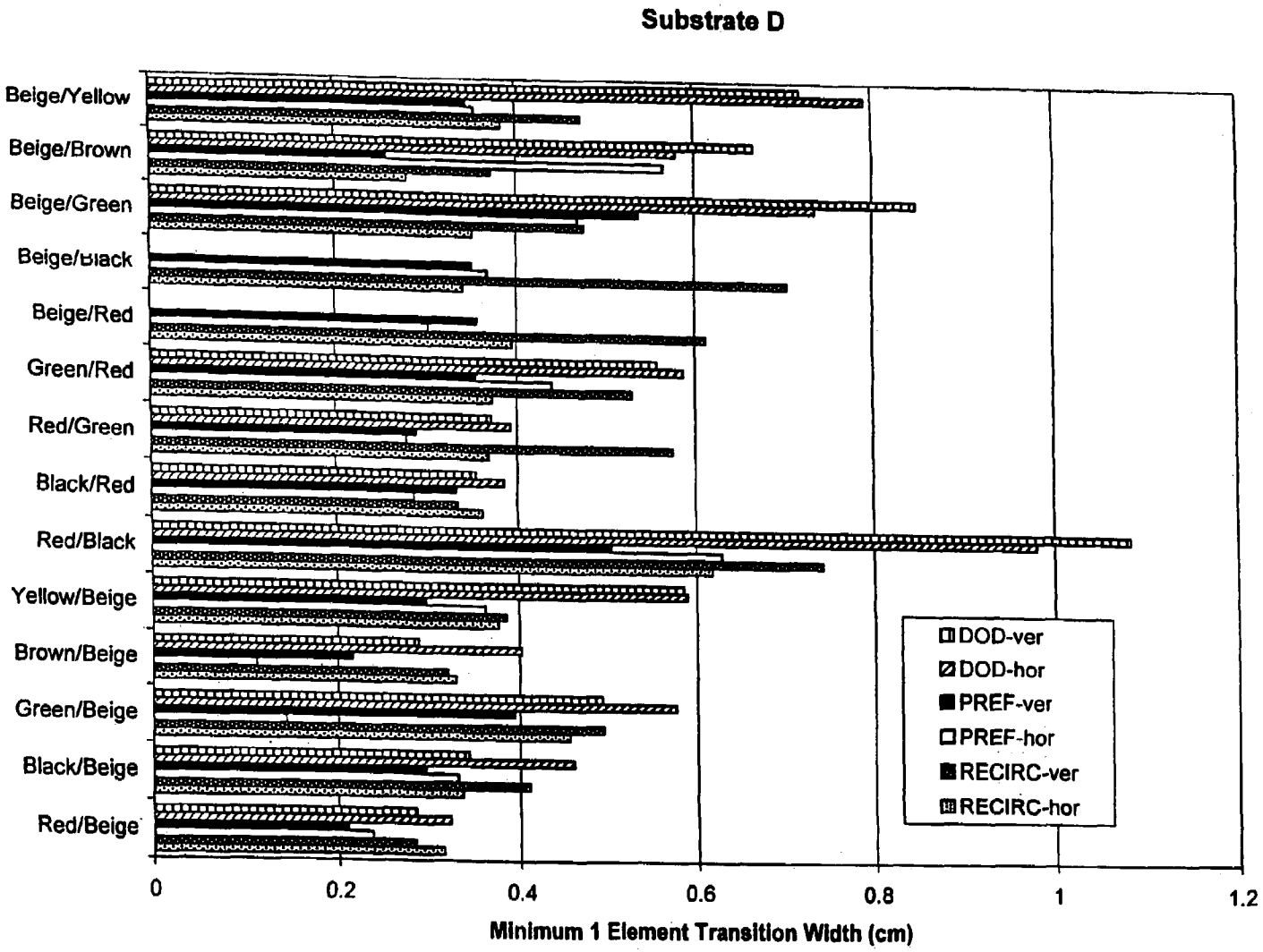
Figure 94:
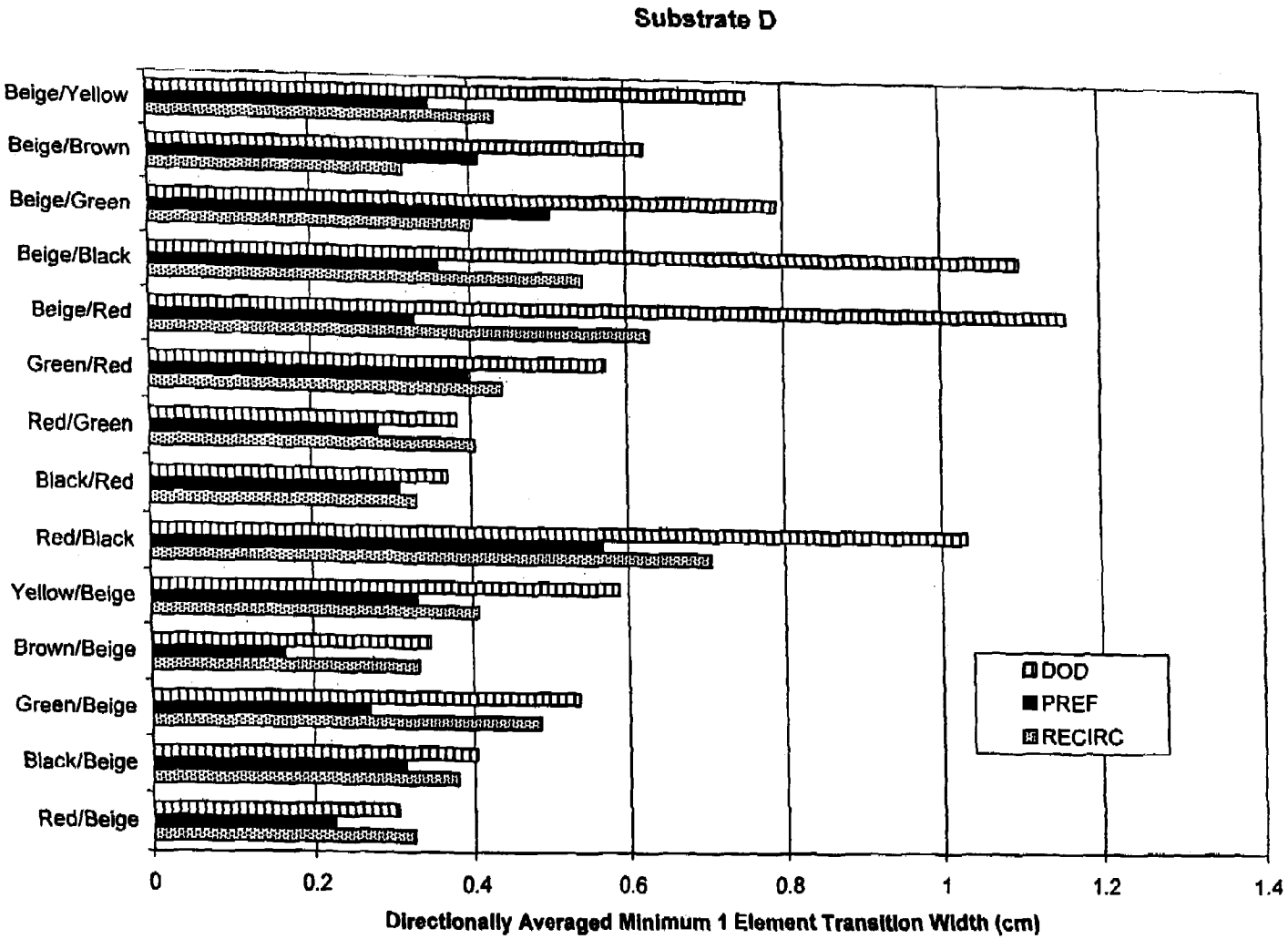
Figure 95:
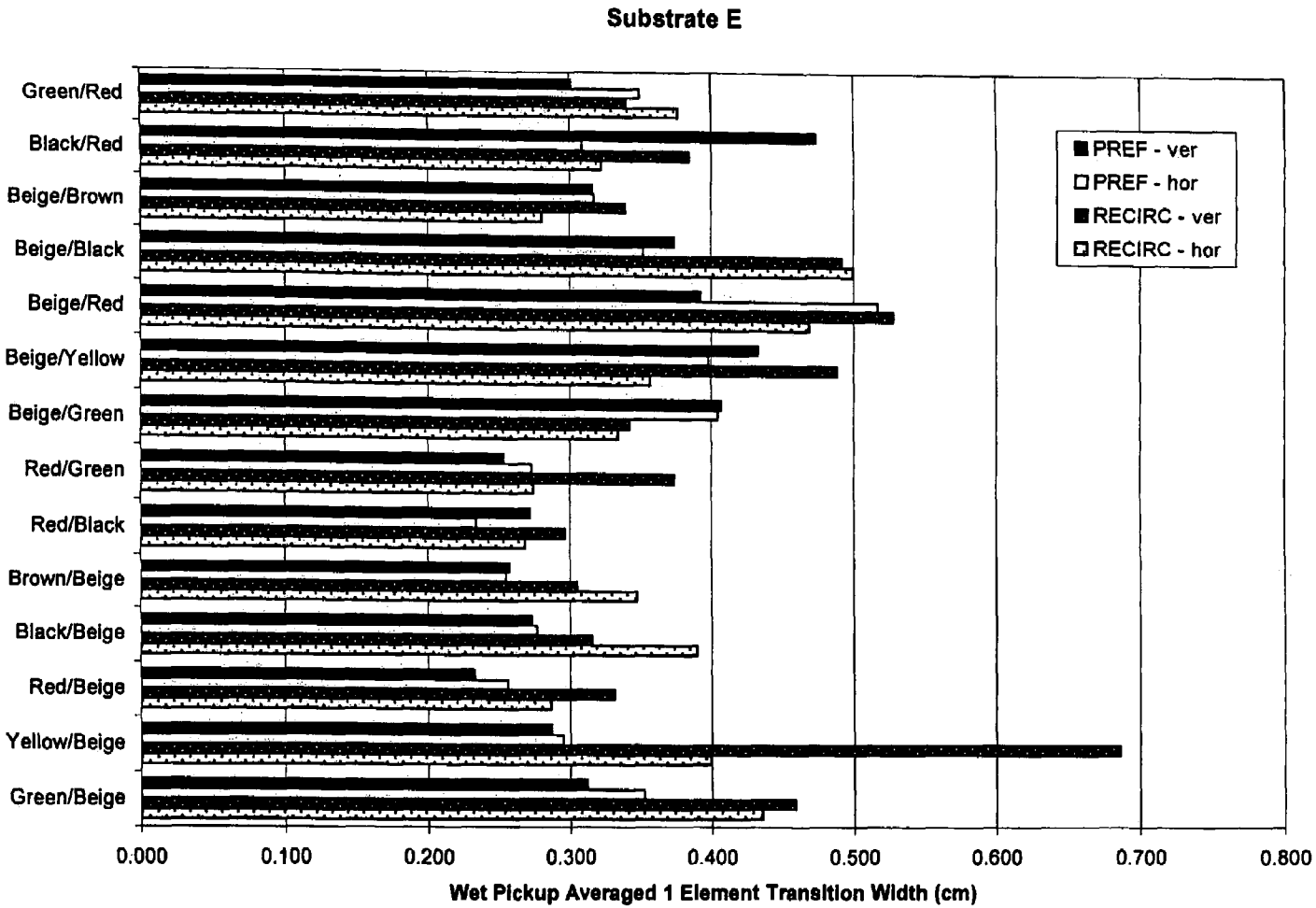
Figure 96:
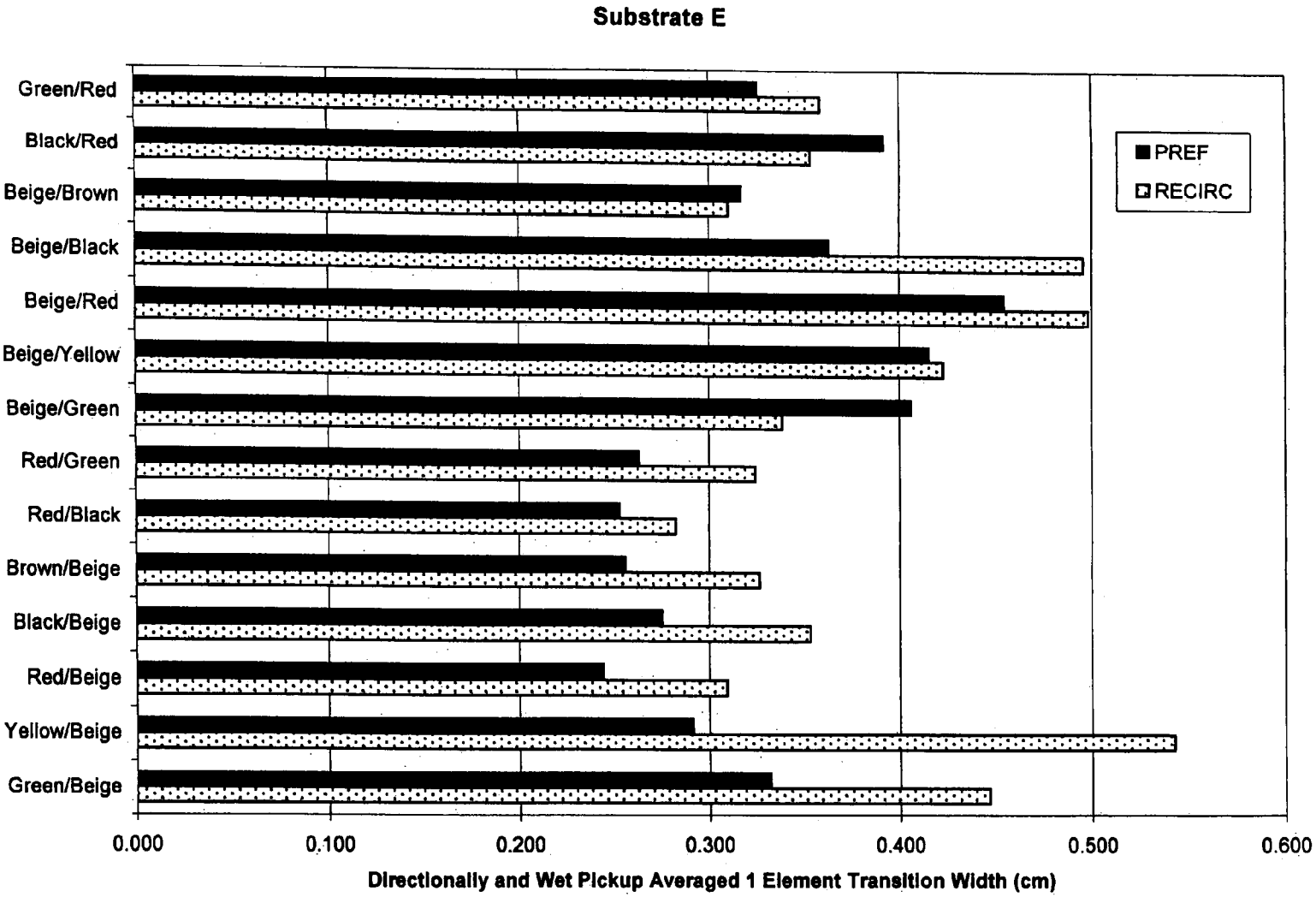
Figure 97:
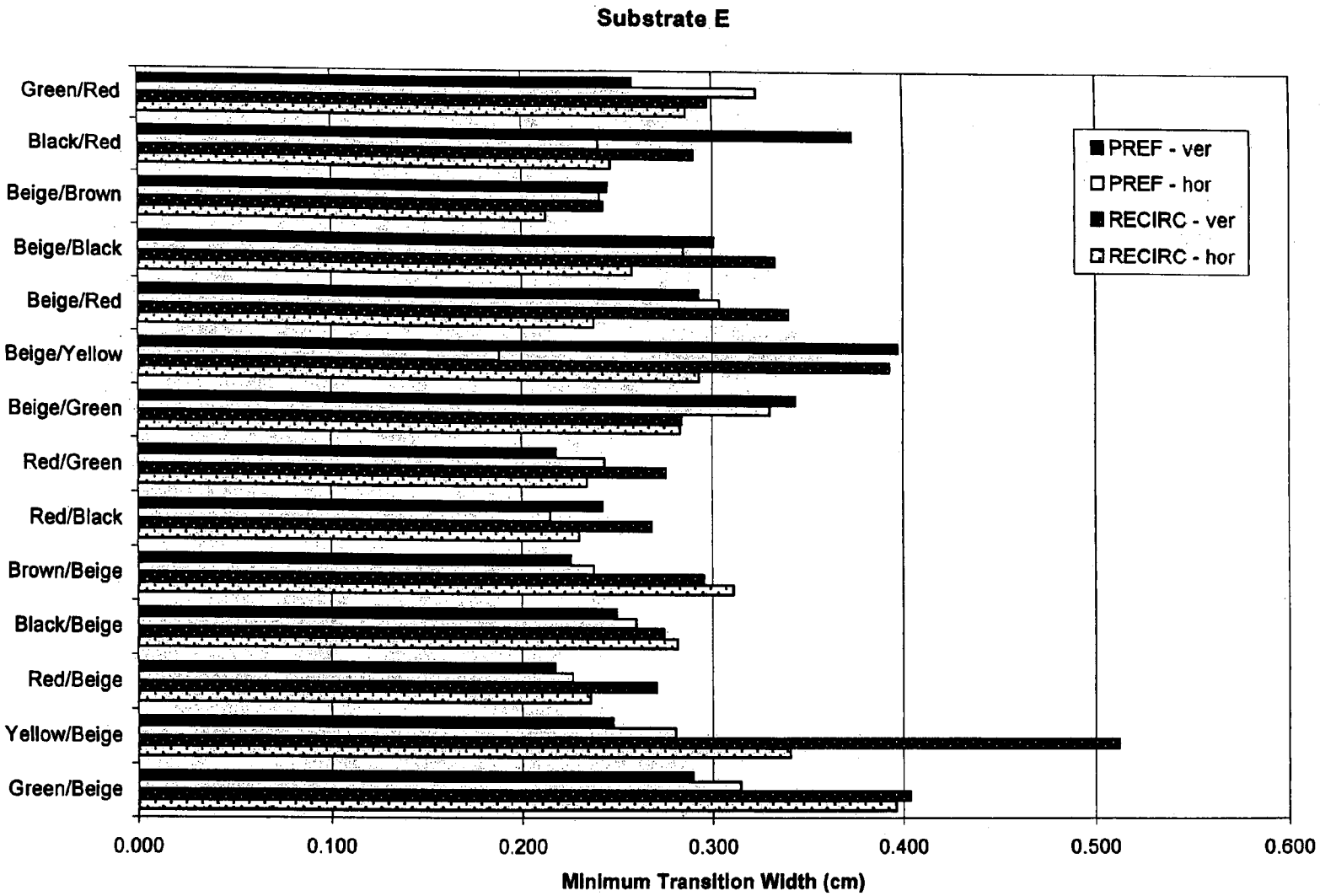
Figure 98:
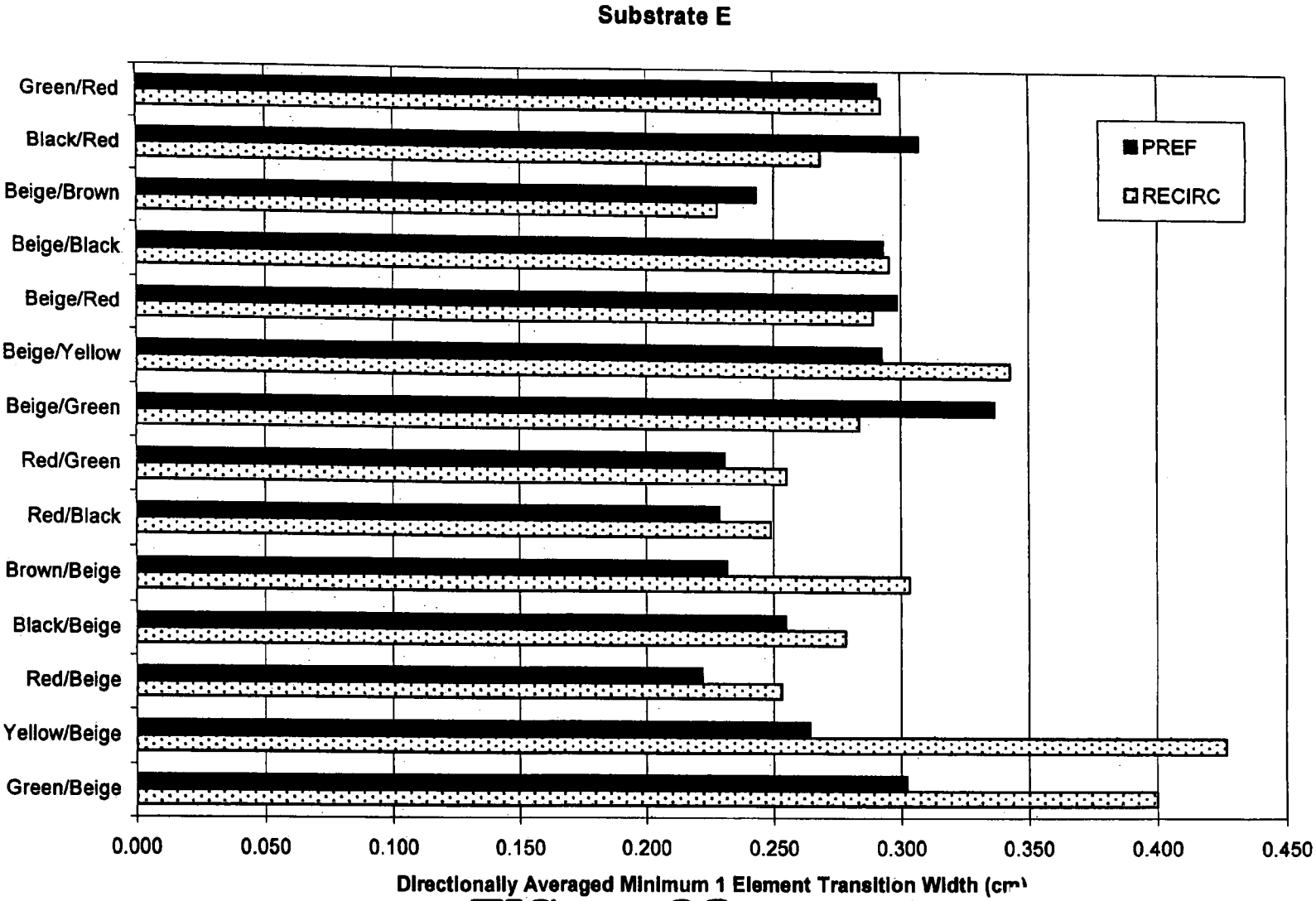
Figure 99:
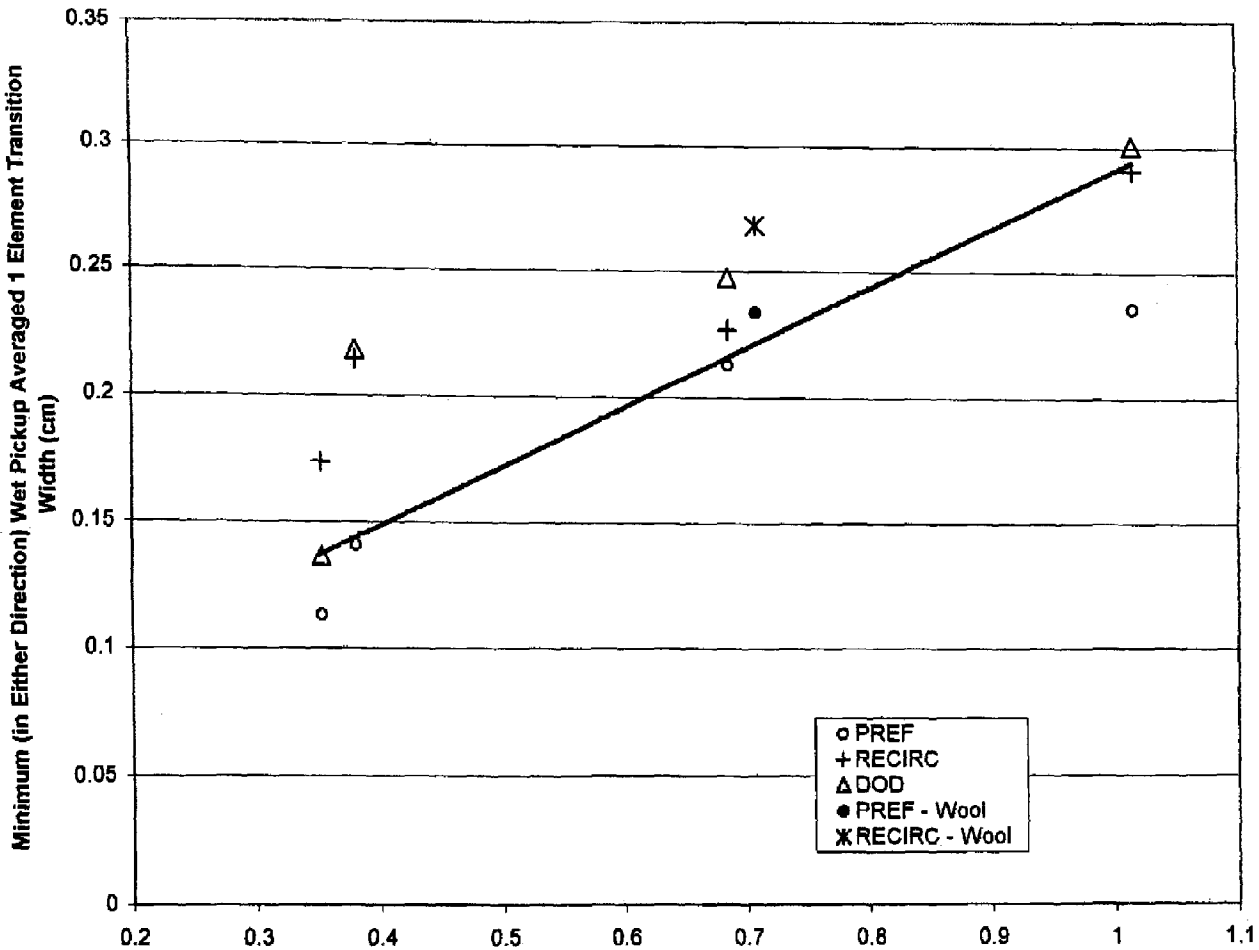
Figure 100:
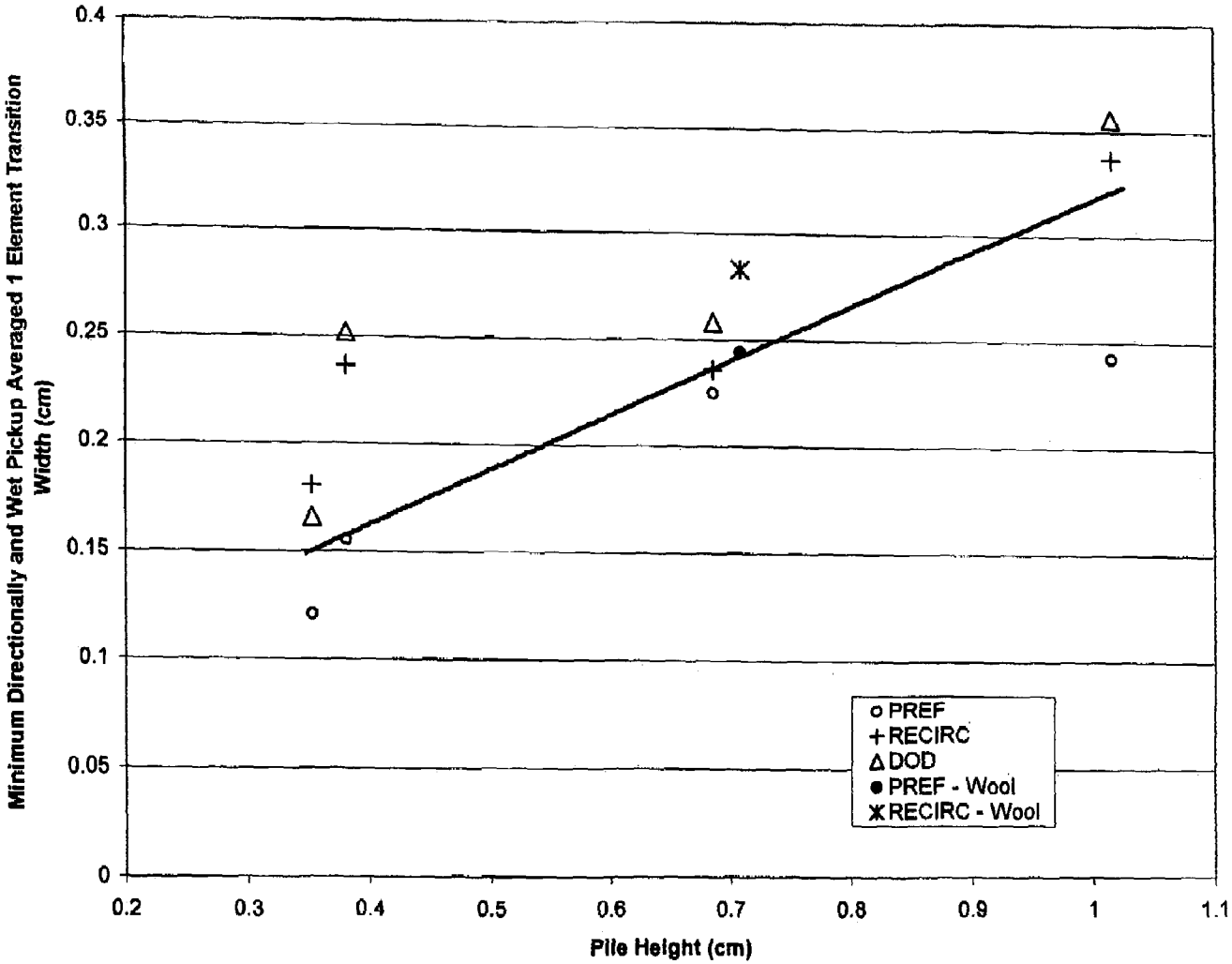

The corresponding line for the Directionally Averaged 5 Element Transition Width, FIG. 78, is given by:

(nylon 6,6)

$$TW_{directionally\ averaged\ min}(\text{cm})=0.18\cdot[\text{Measured Pile Height (cm)}]+0.083$$

Looking at the data generated from Substrate E (i.e., the 80% wool/20% nylon 6,6 pile), the degree of dye penetration was typically less than the corresponding dye penetration observed in Substrates A through D (100% nylon 6,6 pile). As explained earlier, because of this resistance to penetration observed with pile comprised of wool, there is a tendency for the dye to remain at or near the surface of the pile, thereby enhancing the opportunity for the dye to migrate or bleed laterally and causing an increase in the Transition Width associated with that pattern feature, as compared with a similarly-constructed substrate with pile elements comprised primarily or exclusively of nylon 6,6.

As one skilled in the art would expect, this effect decreases with decreasing pile height (pile penetration becomes equally easy regardless of pile composition). Accordingly, as pile height approaches negligible values, the observed Transition Width behavior for Substrate E rivals that observed for Substrates A through D, and the corresponding equation for a separating line for the Minimum 5 Element Transition Width in any direction versus pile height for Substrate E (FIG. 77) may be given by.

(wool):

$$TW_{min,\ any\ direction}(\text{cm})=0.181\cdot[\text{Measured Pile Height (cm)}]+0.08$$

The corresponding line for the Directionally Averaged 5 Element Transition Width, FIG. 78, is given by (wool):

$$TW_{directionally\ averaged\ min}(\text{cm})=0.193\cdot[\text{Measured Pile Height (cm)}]+0.083$$

Concerning the capability of the various printing systems to render fine details in a pattern, the 1 element Feature Width data allows many distinctions to be made. Generally, the statements and clarifications that were made previously for the five element transition Width charts apply to the 1 Element Transition Width data, with the following clarifications. It is often the case that the 1 Element Transition Width data for certain reciprocal color combinations (e.g., red feature/beige background and beige feature/red background) is drastically different. More specifically, for the case where the non-dominant color is the feature, the non-dominant feature is often overwhelmed by the dominant background dye that has migrated from the pixel location to which it was assigned. Therefore, the 1 Element Transition Widths for the non-dominant color feature with a dominant color background may be substantially larger than the 1 element Transition Width for a dominant color feature on a non-dominant color background.

To see this fundamental difference in the charts, it is noted that the dominant color features are those with the following designations: red/beige, black/beige, green/beige, brown/beige, yellow/beige, black/red, and red/green, using the same convention as earlier to name the feature color first. Therefore, the non-dominant color features are: beige/red, beige/black, beige/green, beige/brown, beige/yellow, red/black, and green/red. Because a non-dominant color feature may be totally overwhelmed by the dominant color forming the background, the algorithms used herein to calculate Transition Widths and Feature Widths occasionally were unable to identify a feature where one was assigned by the pattern. In these cases, no data appears on the bar chart for that feature. In other words, when no data appears on the bar chart (see, for example, the absence of DOD data from the "Beige/Black" group of histograms in FIGS. 91, 93, 115, and 117), it is a result of that non-dominant color feature being totally overwhelmed by dye migration from a neighboring (background) dominant dye color, making the feature very difficult to see in the resulting printed pattern.

Looking at the Wet Pickup Averaged 1 Element Transition Width and Minimum 1 Element Transition Width data for Substrate A, FIGS. 79-82, there again is a general trend of print-direction anisotropy. The anisotropies are the same as were described for the 5 Element Transition Width data, as would be expected. For the same reasons, this anisotropy can be hidden due to substrate effects, as described above. As for the 5 Element Transition Width data, the PREF 1 Element Transition Width of a given color combination is almost universally smaller (yielding sharper fine detail edges) on Substrates B through E, especially for the dominant color combinations (see FIGS. 79-102), than can be obtained for the RECIRC and DOD printing systems. Because, for a 1 element feature, the whole feature can be dominated (and essentially obliterated) by the migration or incursion of dyes from the neighboring pixels, the 1 Element Transition Widths may be somewhat larger than the 5 element Transition Widths. The superiority of the PREF printing system can be clearly seen in the Directionally Averaged Wet Pickup Averaged and Minimum 1 Element Transition Width charts, contained in FIGS. 79-102, for each color combination, where again the PREF printing system tends to have the tightest grouping of 1 element Transition Width values for all color combinations. This tight grouping is significant because, for all colors, generally sharper edges can be printed, resulting in overall superior print sharpness for a multicolored print pattern.

Figure 101:
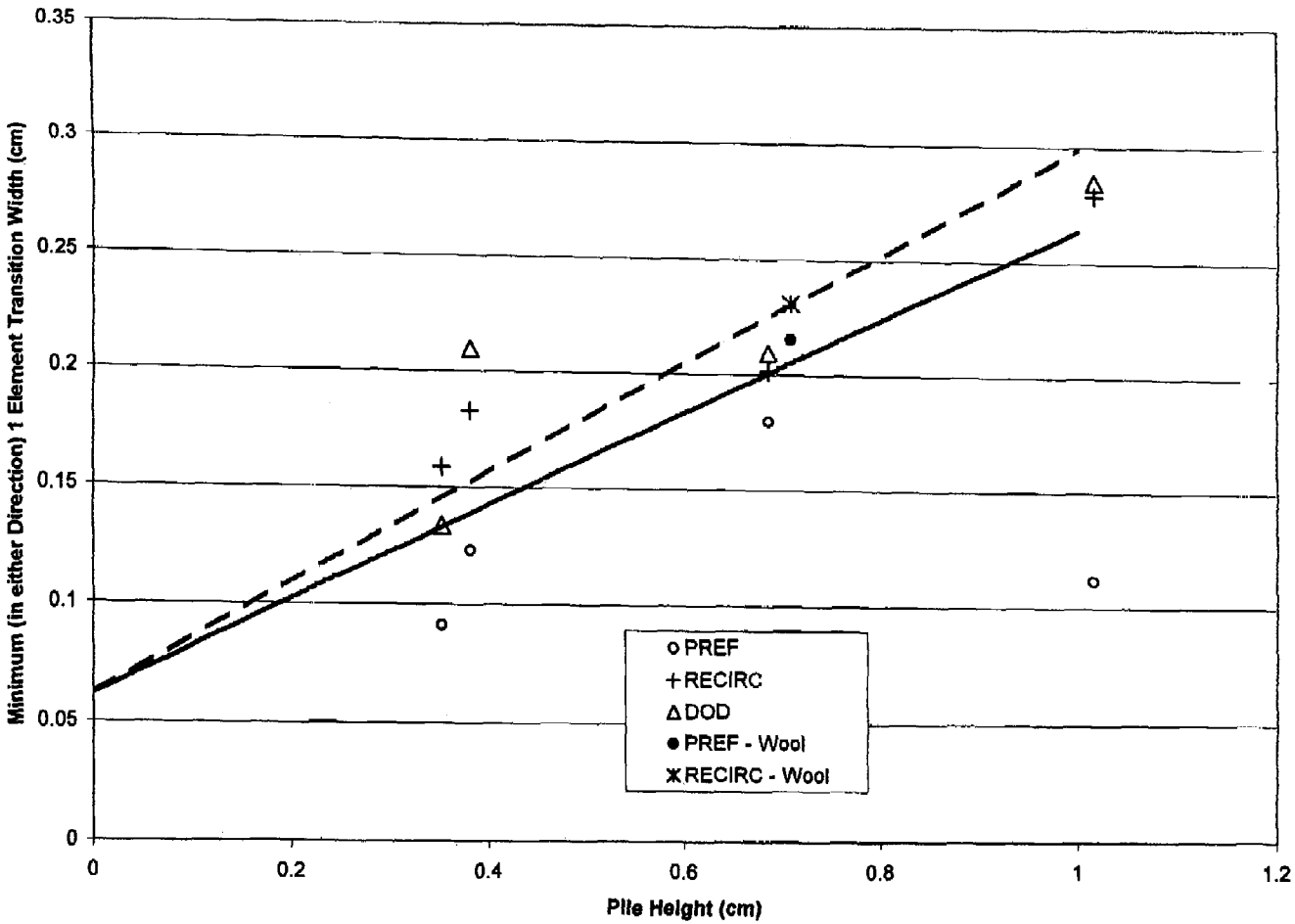

In the same manner as for the 5 Element Transition Width charts, the PREF system distinguishes itself by having the lowest 1 element Transition Widths for any color combination. Therefore, more sharply defined 1 element features can be rendered with the PREF printing system. To numerically quantify this fact, FIGS. 99-102 show the Minimum 1 Element Transition Widths (these show both minimum values for the Wet Pickup Averaged and Minimum 1 Element Transition Widths in each direction for any color combination, as well as the Minimum Directionally Averaged Wet Pickup and Minimum 1 Element Transition Widths obtained for all color combinations) obtained for each substrate, plotted against the measured pile height for the corresponding substrate. These plots enable a line to be drawn that separates the smallest 1 Element Transition Widths that the DOD and RECIRC technologies can print from the corresponding 1 Element Transition Widths that the PREF printing system can generate. Considering first the data for Substrates A through D, the equation for the separating line for the Minimum 1 Element Transition Width in any direction versus pile height, FIG. 101, is given below:

(nylon 6,6)

$$TW_{1\ element,\ min,\ any\ direction}(\text{cm})=0.202\cdot[\text{Measured Pile Height (cm)}]+0.062$$

Figure 102:
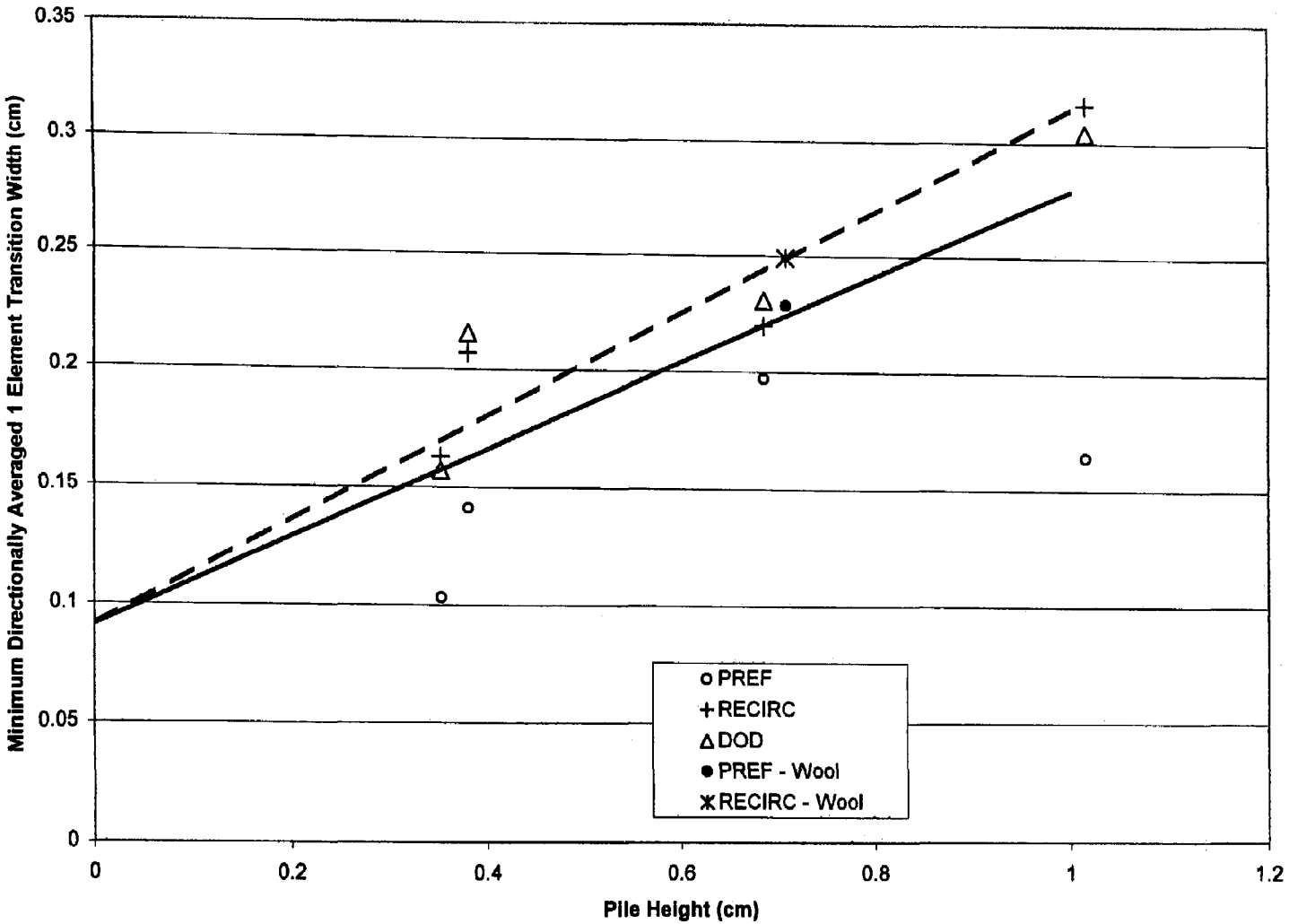

The corresponding line for the Directionally Averaged Minimum 1 Element Transition Width, FIG. 102, is given by (nylon 6,6)

$$TW_{1\ element,\ directionally\ averaged\ min}(\text{cm})=0.188\cdot[\text{Measured Pile Height (cm)}]+0.091$$

Looking at the data generated from Substrate E (i.e., the 0.80% wool/20% nylon 6,6 pile), the degree of dye penetration was typically less than the corresponding dye penetration observed in Substrates A through D (100% nylon 6,6 pile). Because of this resistance to penetration observed with pile comprised of wool, there is a tendency for the dye to remain on or near the surface of the pile, thereby enhancing the opportunity for the dye to migrate or bleed laterally and causing an increase in the Transition Width associated with that pattern feature (regardless of Feature Width), as compared with a similarly-constructed substrate with pile elements comprised primarily or exclusively of nylon 6,6. Accordingly, the corresponding equations for wool (see FIGS. 101 and 102, respectively) are:

(wool)

$$TW_{1\ element,\ min,\ any\ direction}(\text{cm})=0.238[\text{Measured Pile Height (cm)}]+0.062$$

The corresponding line for the Directionally Averaged Minimum 1 Element Transition Width, FIG. 102, is given by (wool)

$$TW_{1\ element,\ directionally\ averaged\ min}\ (\text{cm}) = 0.223 \cdot [\text{Measured Pile Height (cm)}] + 0.091$$

Another aspect that defines the ability to generate fine details in a printed pattern is Feature Width, or its equivalent, effective gauge. Minimum Feature Width (or, equivalently, maximum effective print gauge) is a measure of the smallest area of the substrate to which a specific color can be practically and reliably assigned. It is a function of a variety of factors (substrate construction, nature of dye, print direction, etc.), but is assumed to be substantially constrained by the nominal gauge of the patterning device (which is merely a measure of the smallest area of the substrate to which a specific color can be theoretically assigned, given the physical layout of the patterning device). It will be remembered that the nominal gauge of the PREF and RECIRC patterning systems is 20 gauge (20 drops or pixels/inch), while the DOD system is nominally a 16 gauge print system (16 drops or pixels/inch).

This minimum width for a 1 pixel printed element (i.e., the effective gauge) is measured as described earlier by a 1 Element Feature Width. Before discussing the data in the 1 Element Feature Width charts, some clarifications are necessary. It is generally the case that a pattern element width can be reduced by the encroachment of dye from neighboring pixels that tends to hide the presence of that pattern element. The charts show that some of the finest details that are rendered on the substrate are the non-dominant color features. Such ability to generate a fine detail using a color that is overwhelmed by dye from neighboring pixels (that themselves were not rendered with a fine detail since they readily migrated out of their pixel area) is not a reliable indication of the capabilities of the printer or patterning system. Therefore, the following discussion relates only to the dominant dye features on the non-dominant (or at least less dominant) background. By being able to control more effectively the dyes that tend to migrate readily out of their respective pixel areas, the more capable the printer is of generally rendering for all colors a fine detail.

Figure 103:
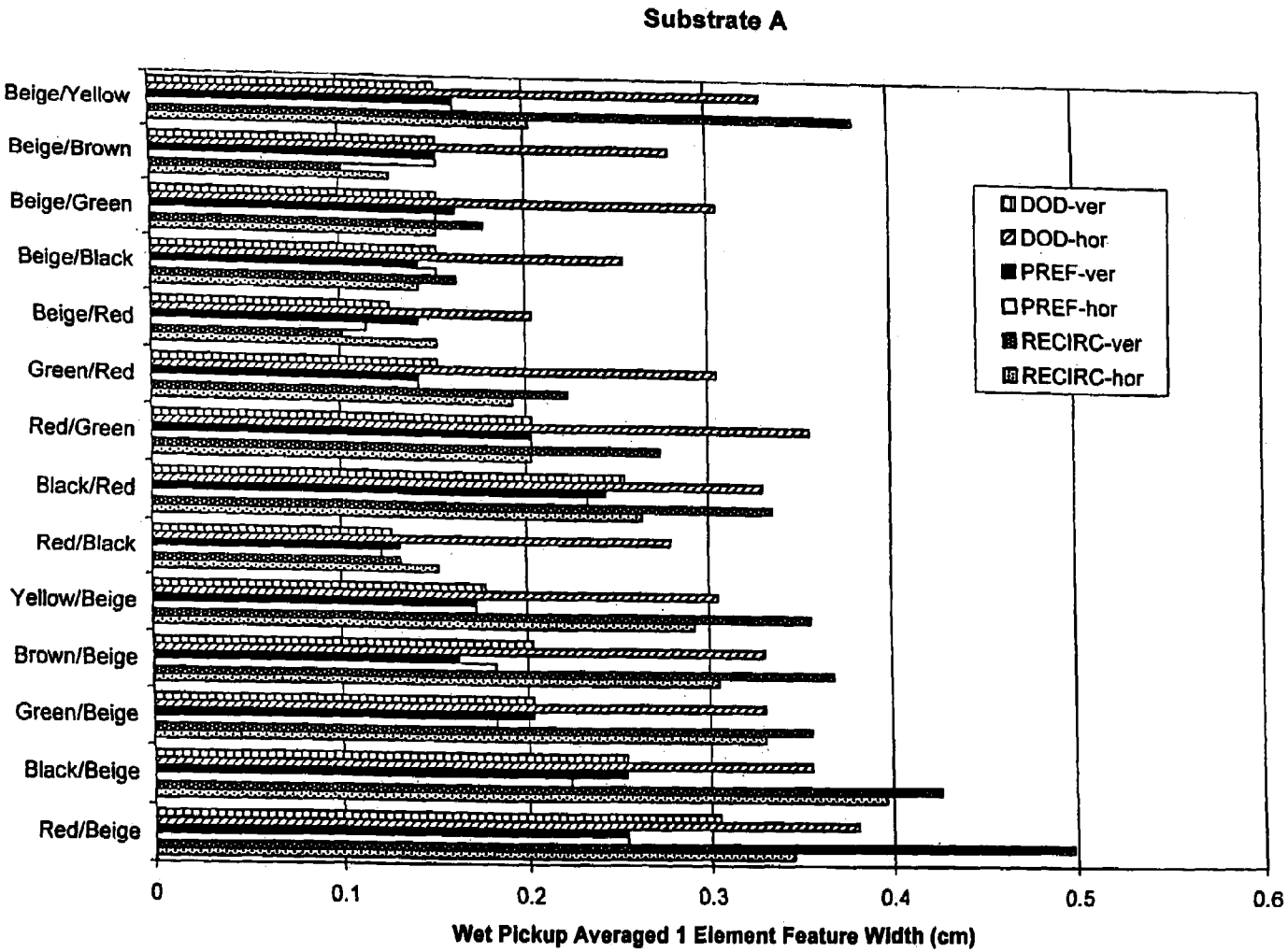
Figure 104:
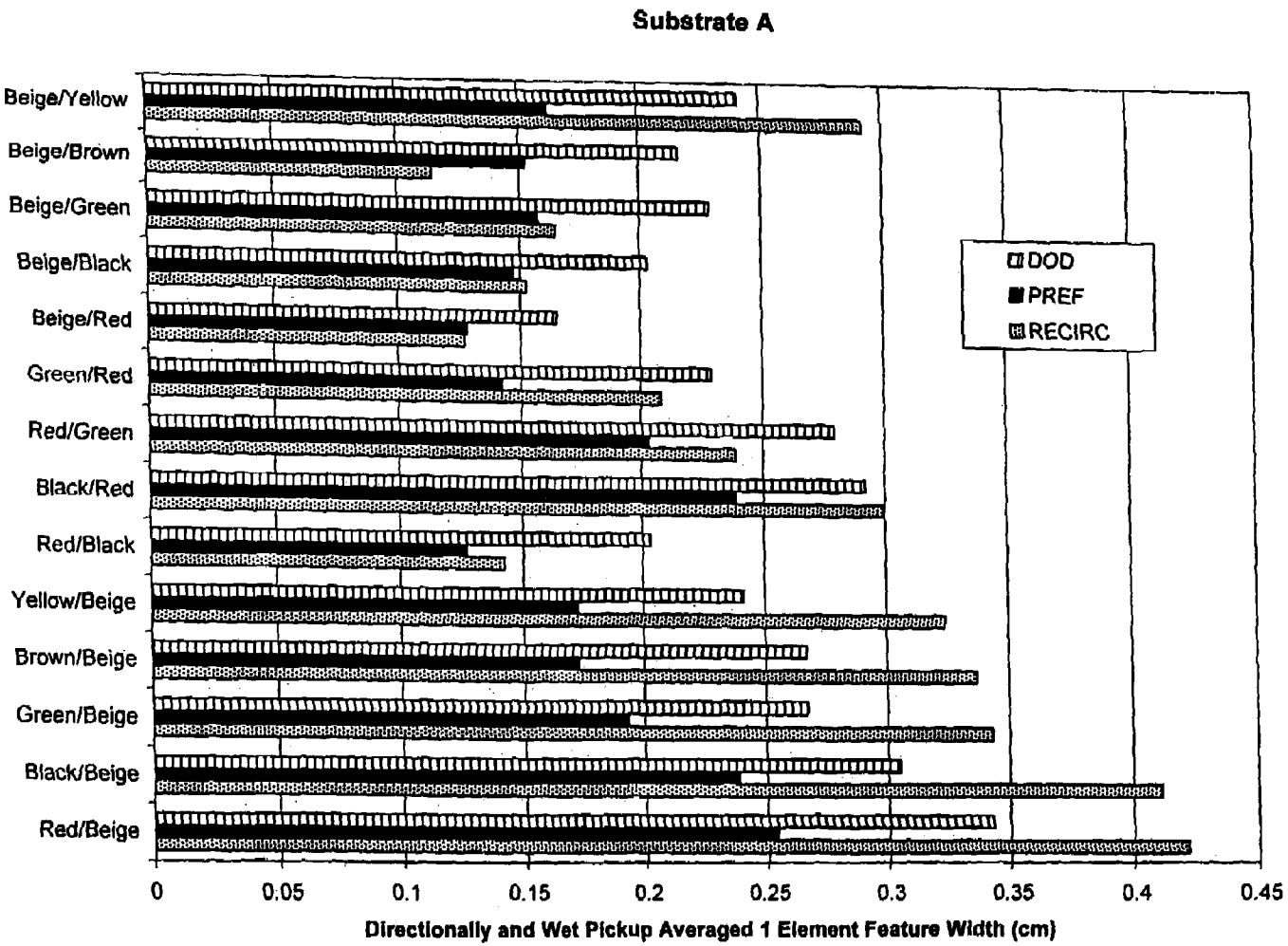
Figure 105:
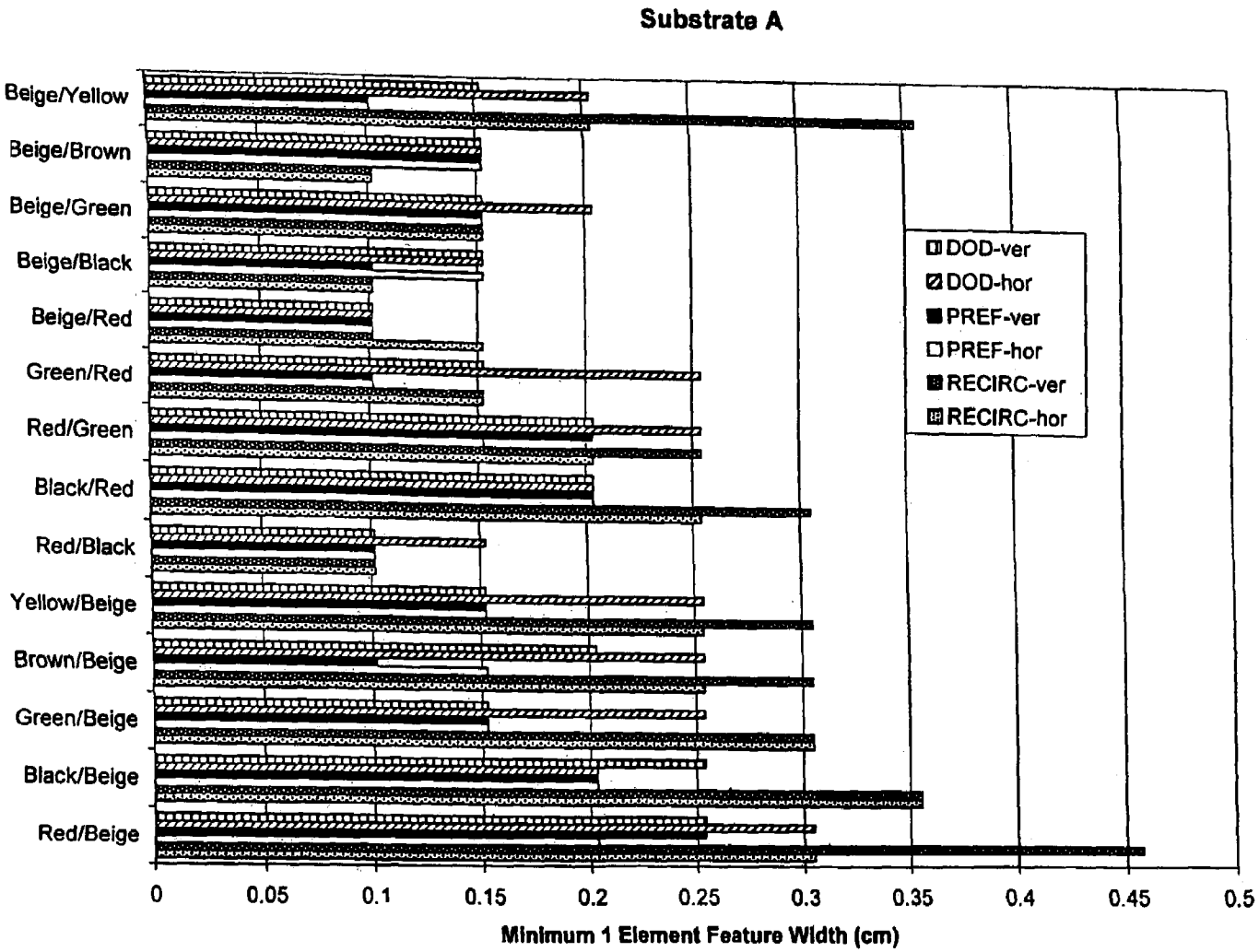
Figure 106:
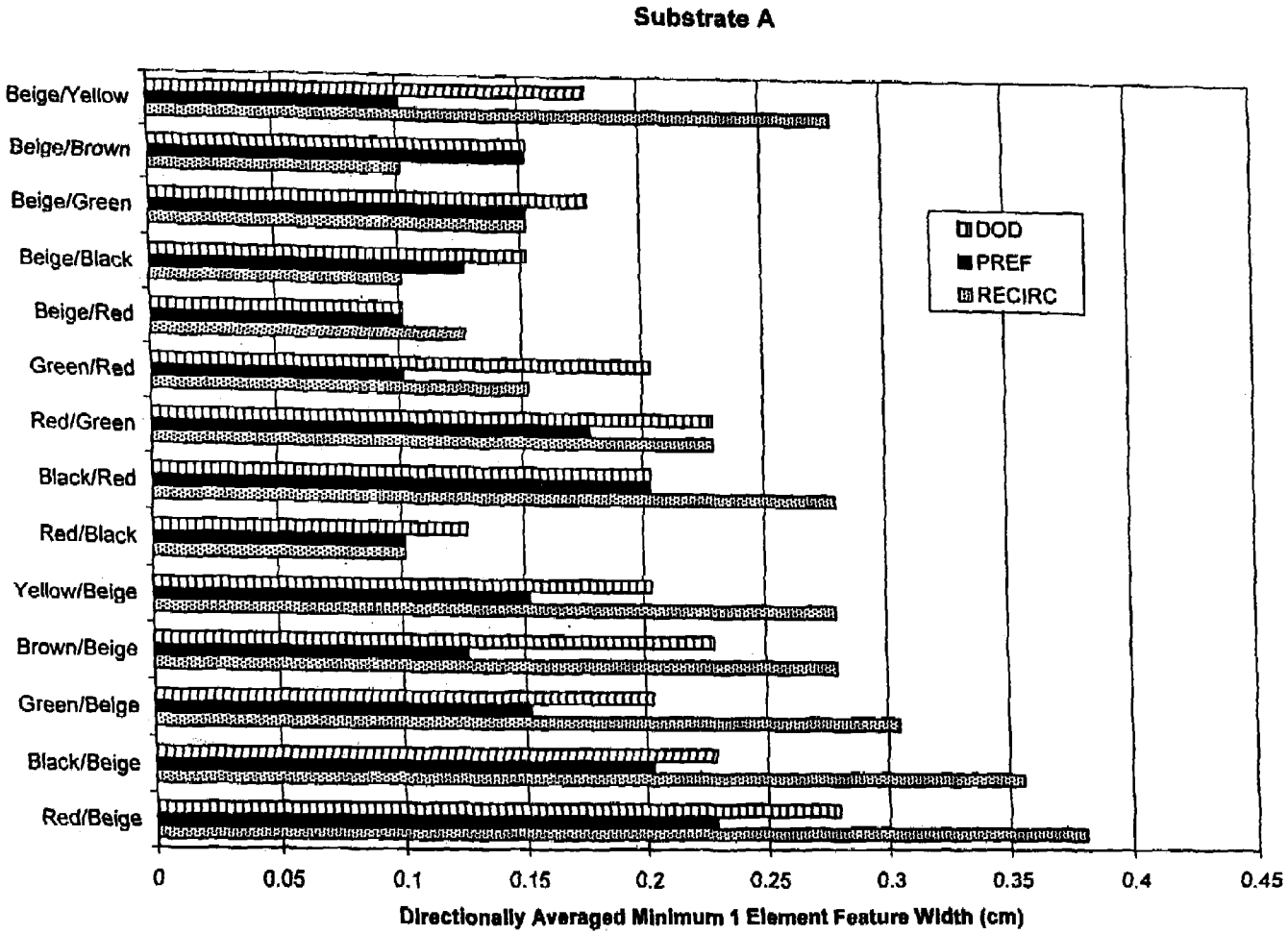
Figure 107:
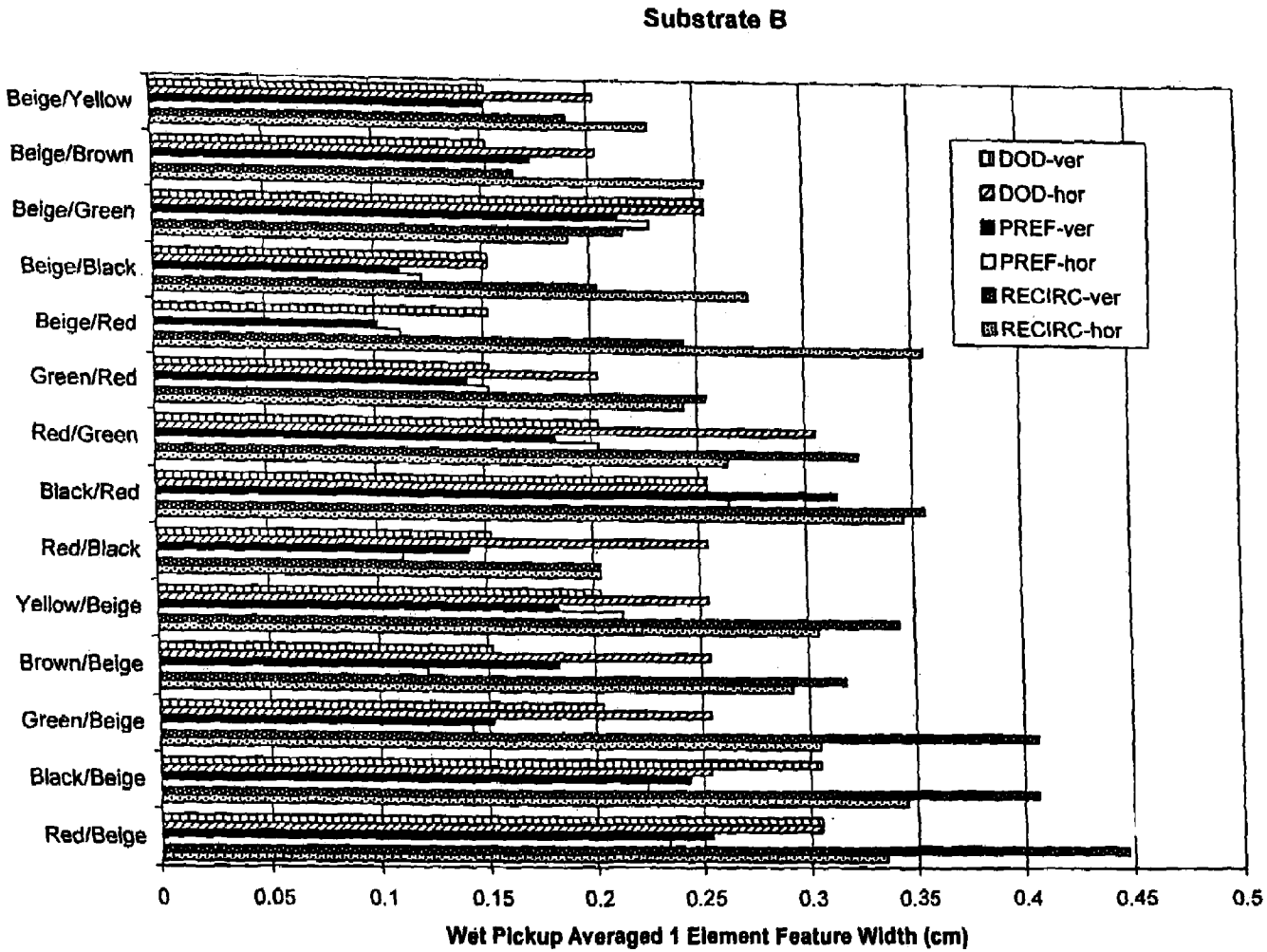
Figure 108:
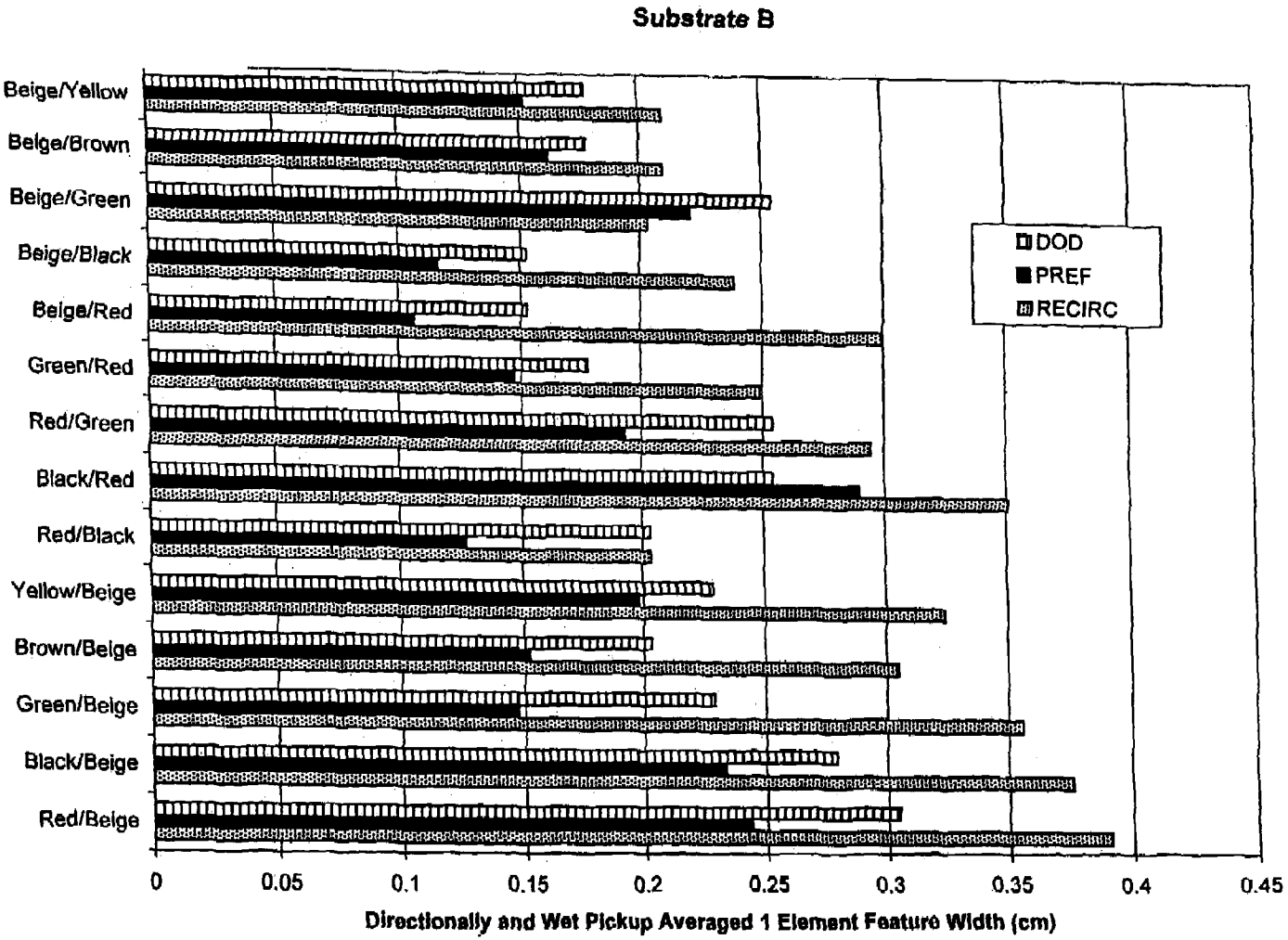
Figure 109:
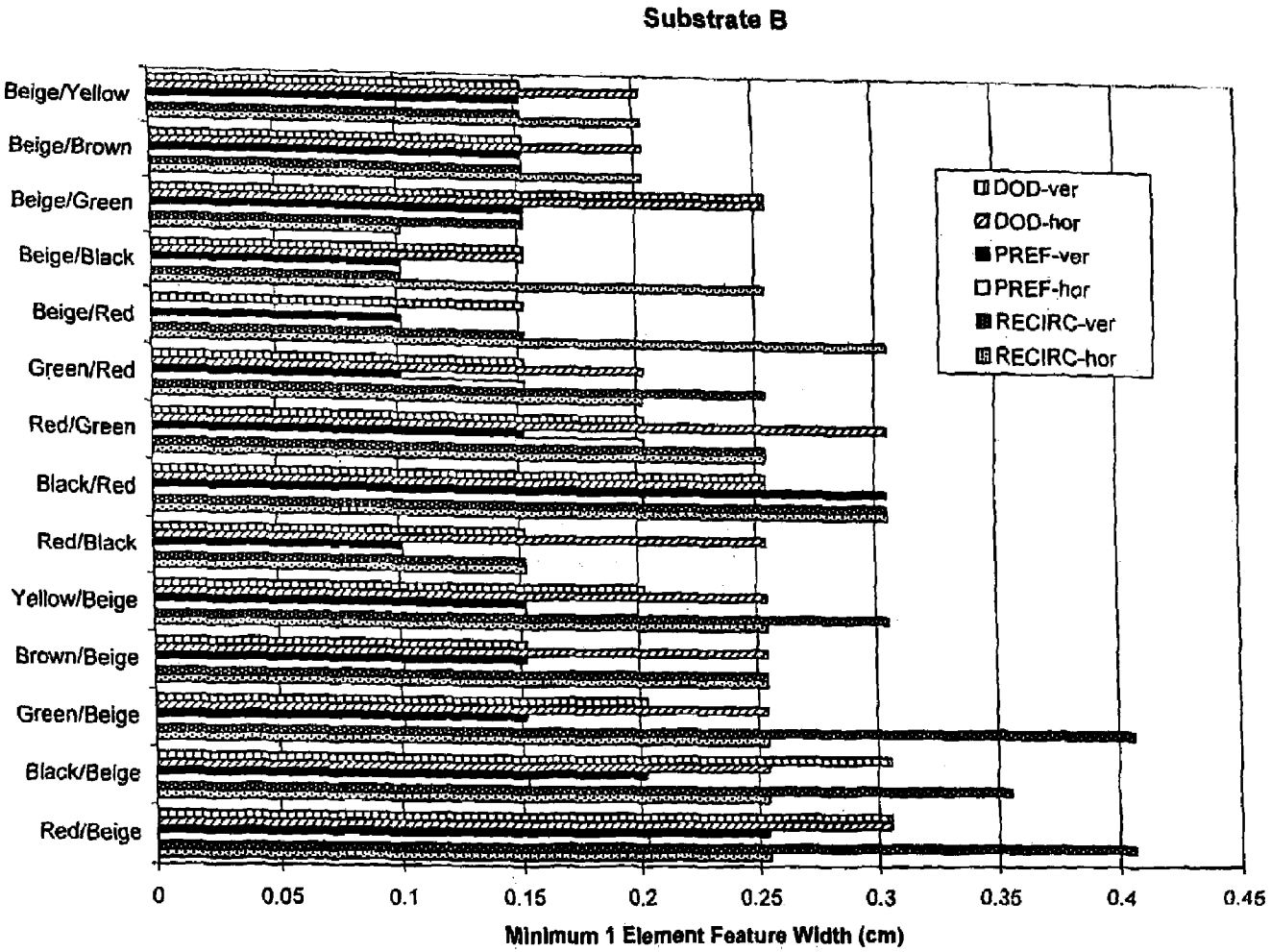
Figure 110:
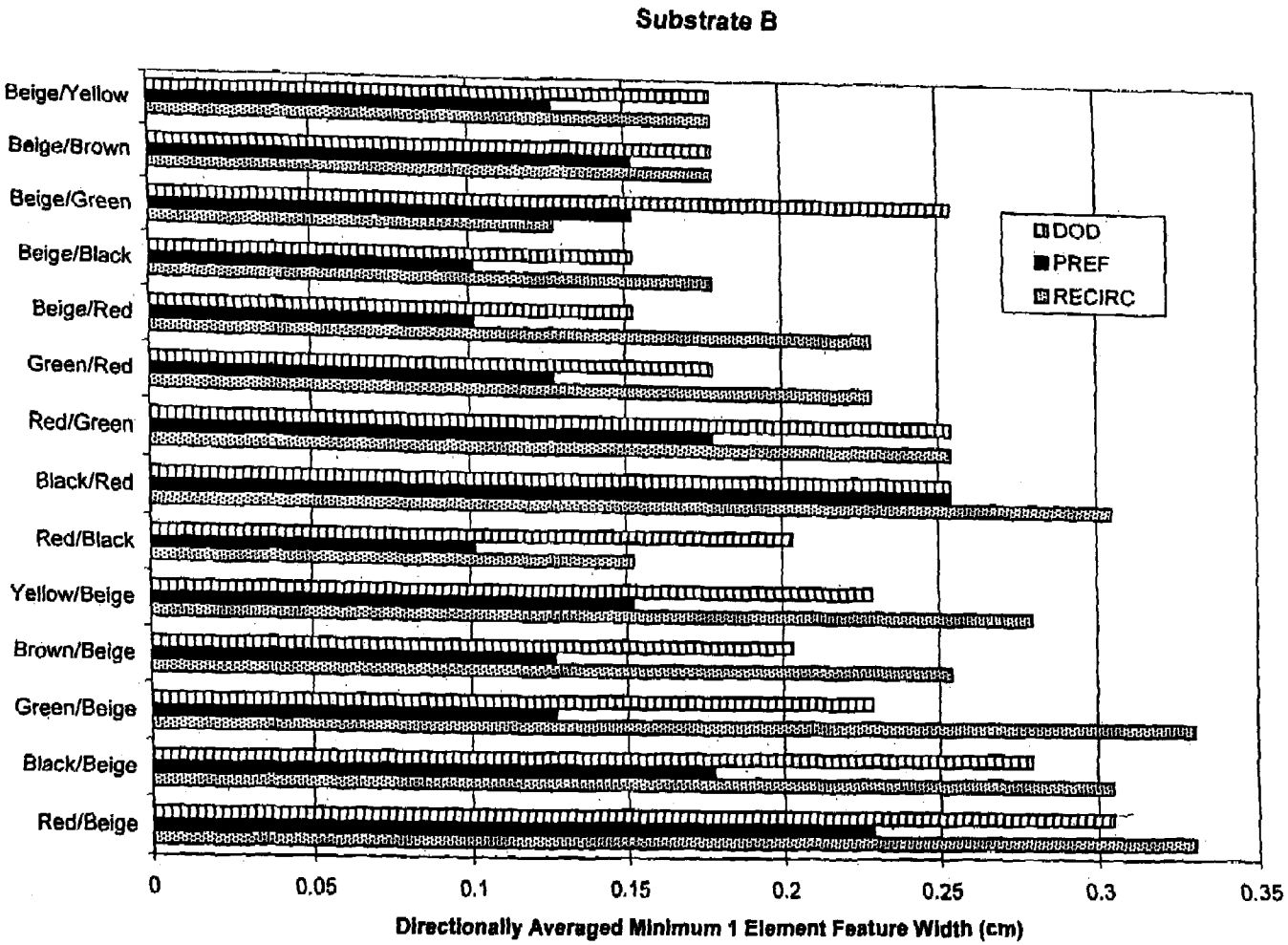
Figure 111:
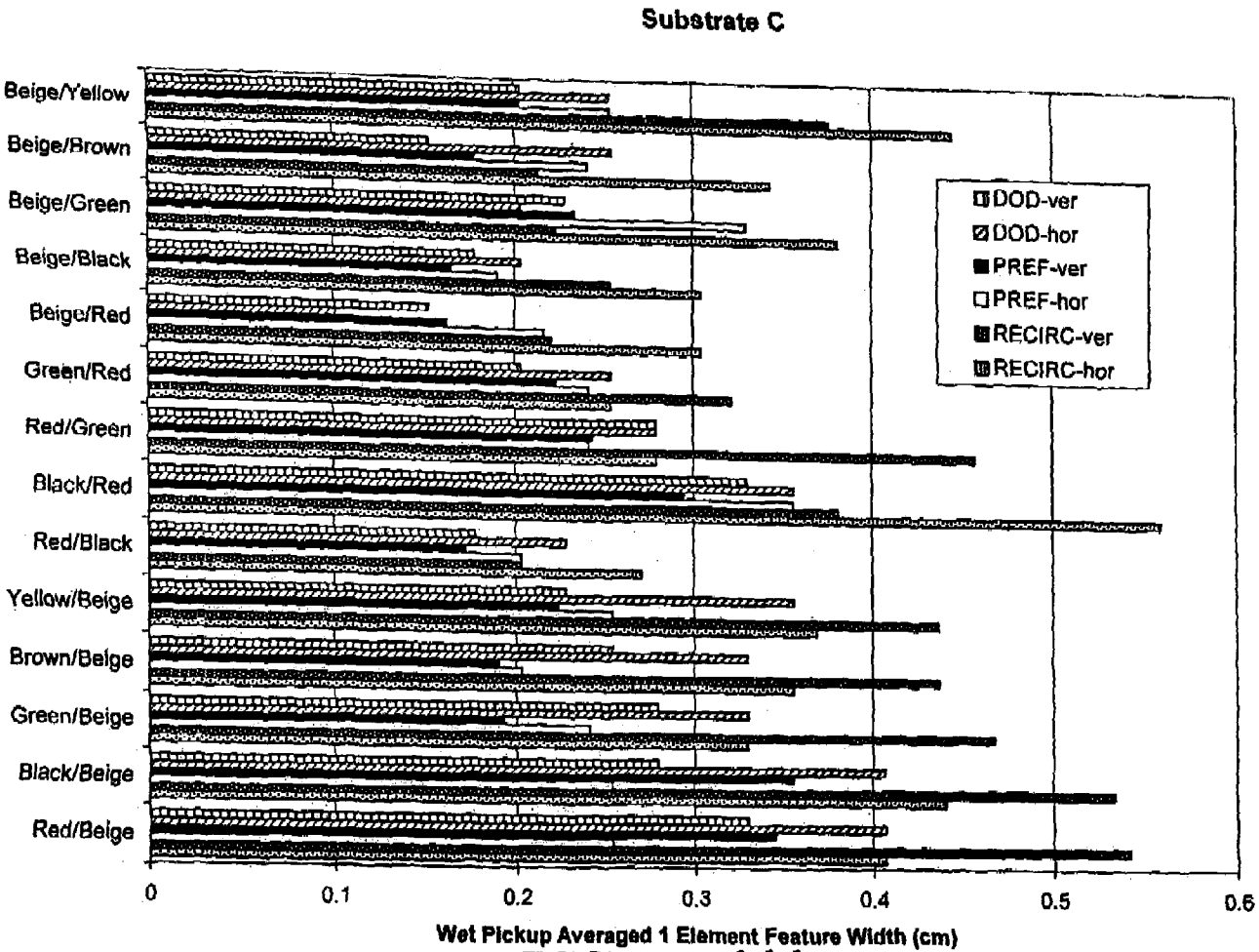
Figure 112:
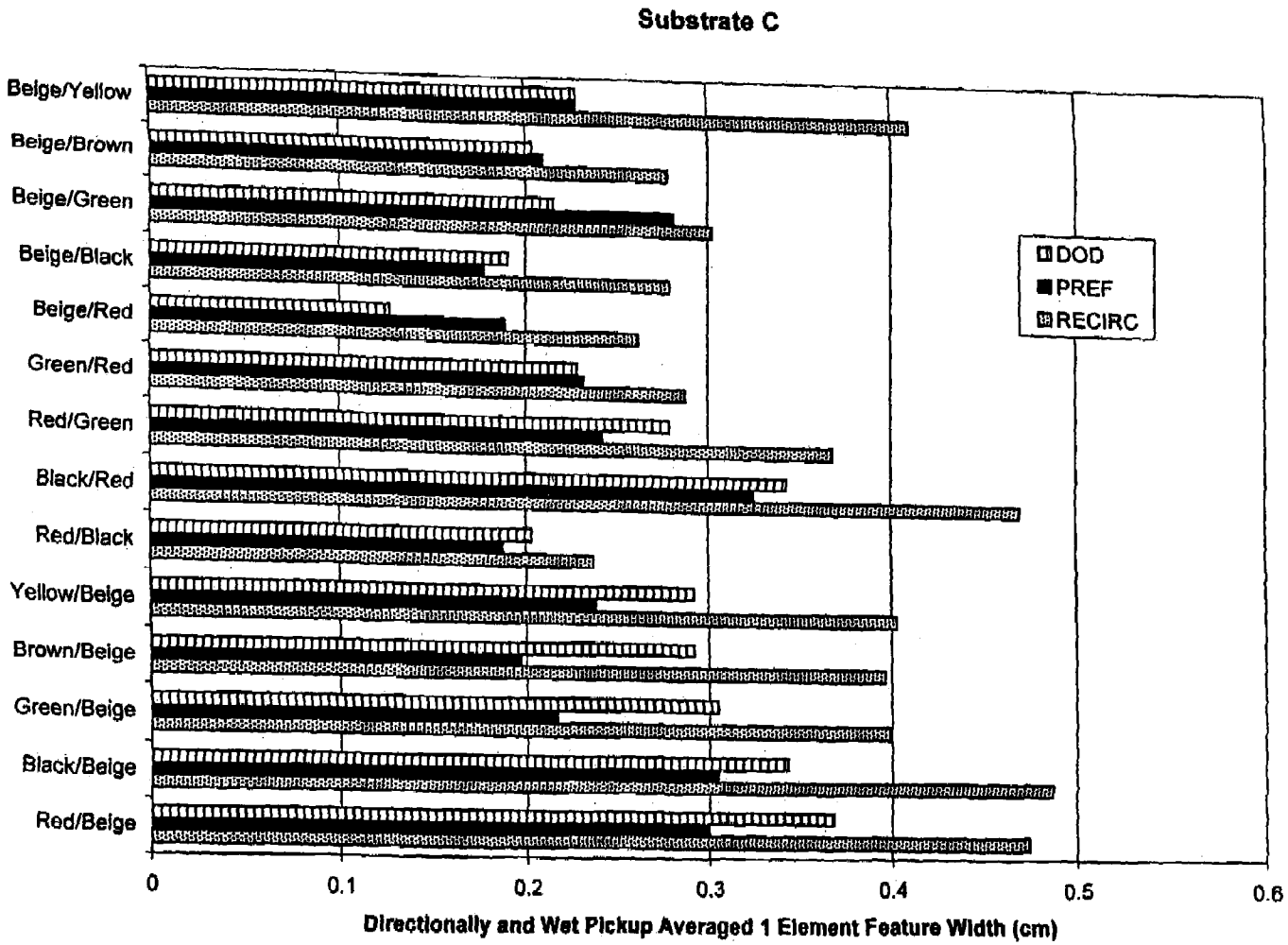
Figure 113:
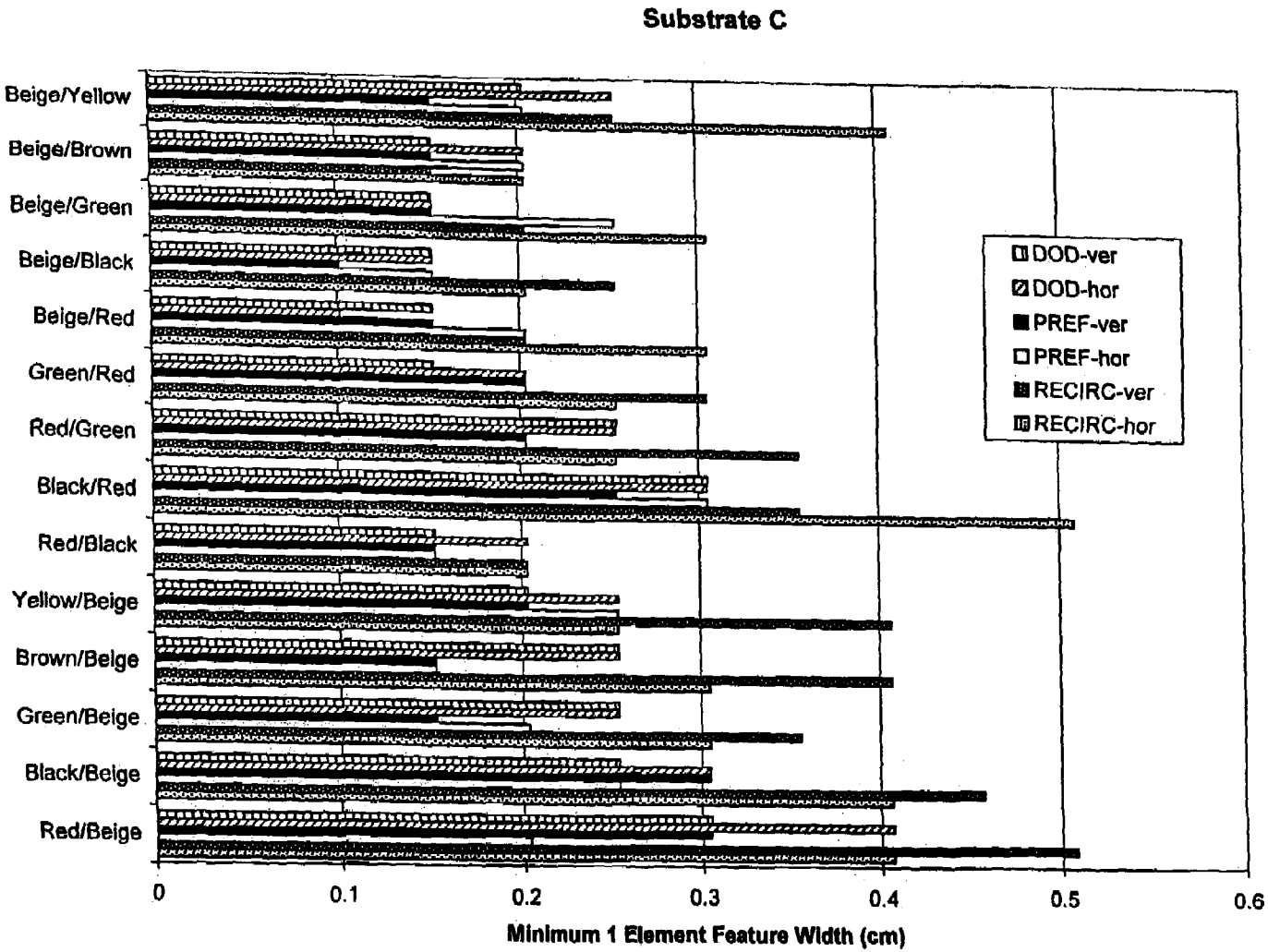
Figure 114:
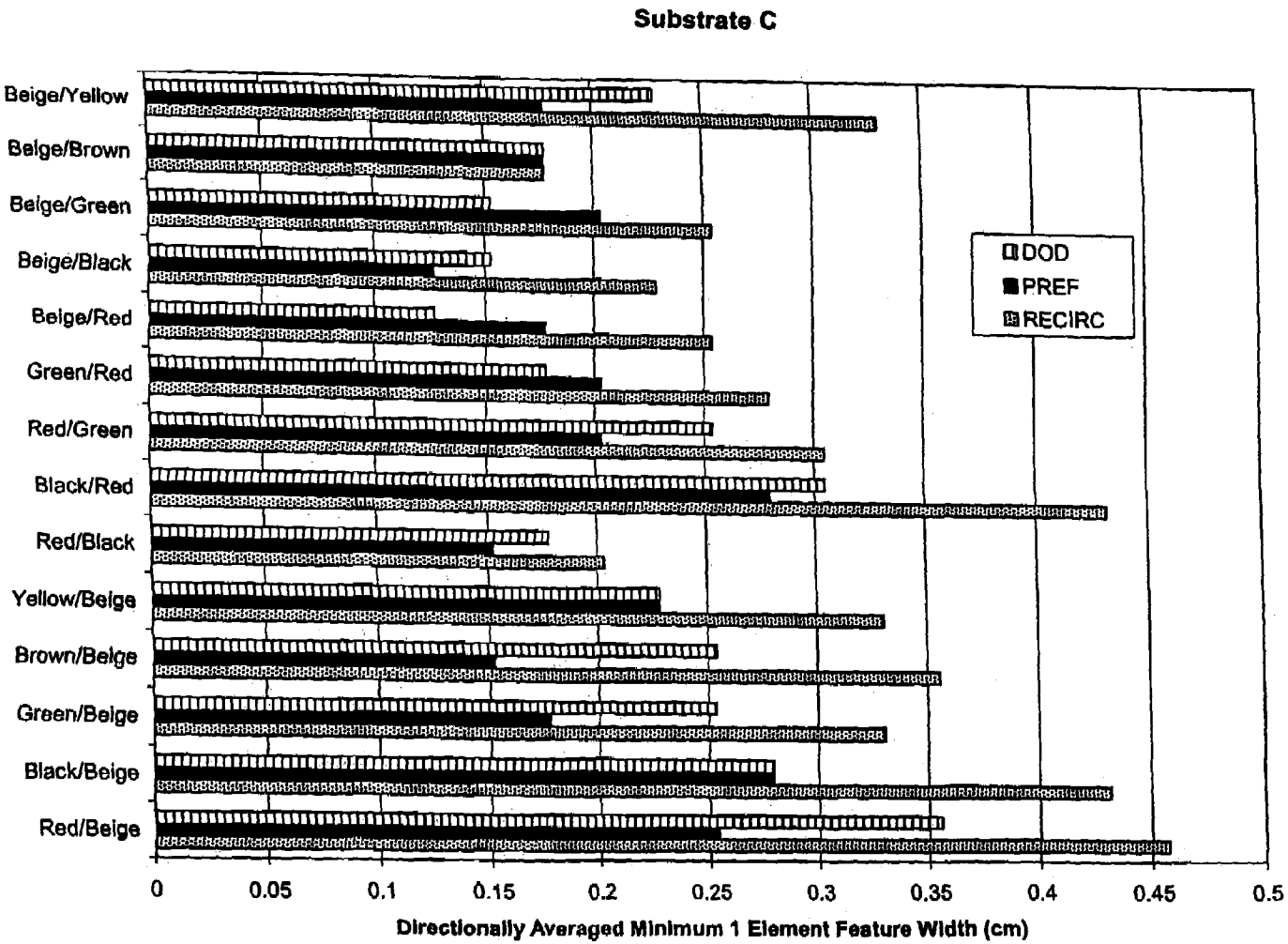
Figure 115:
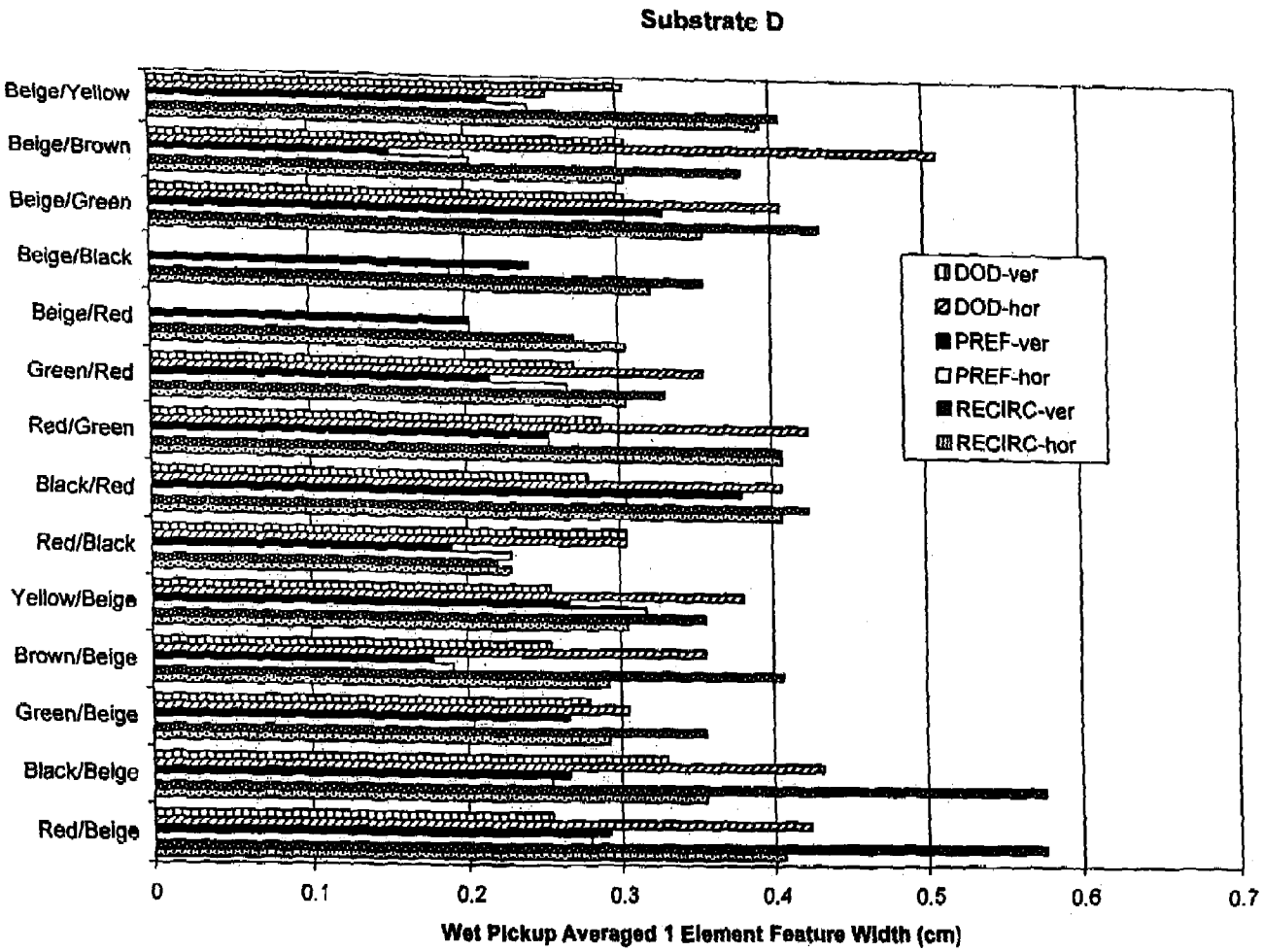
Figure 116:
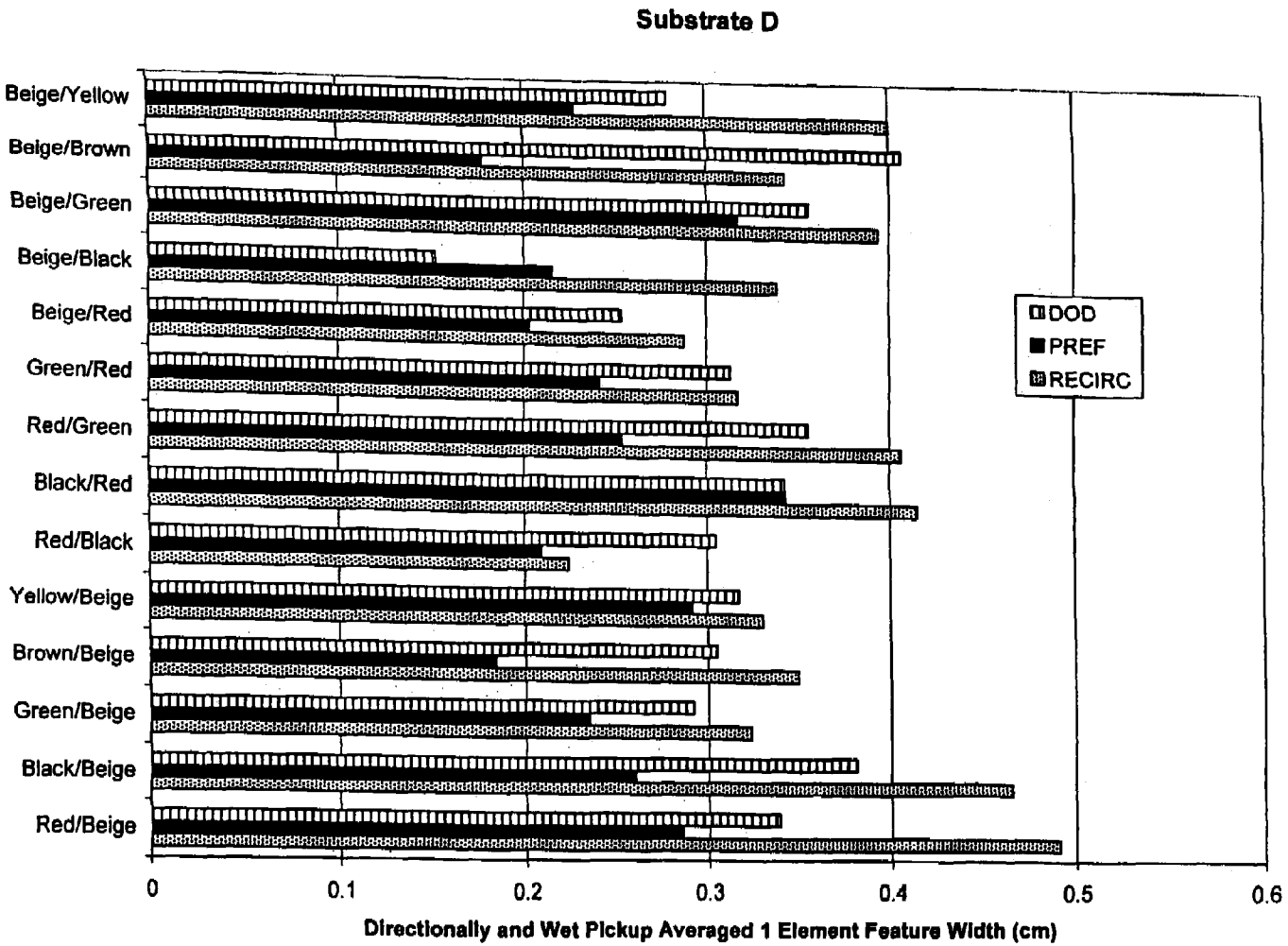
Figure 117:
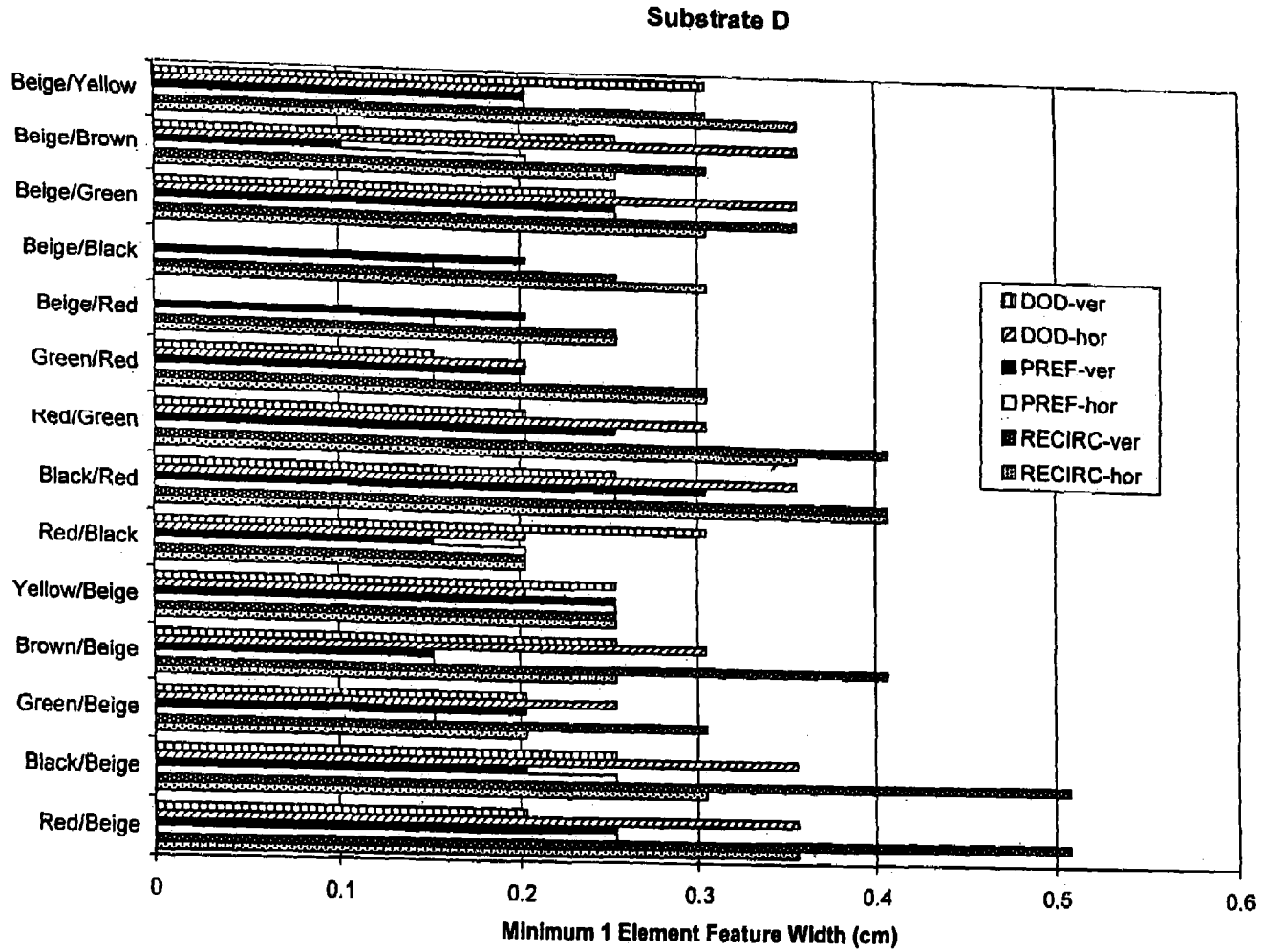
Figure 118:
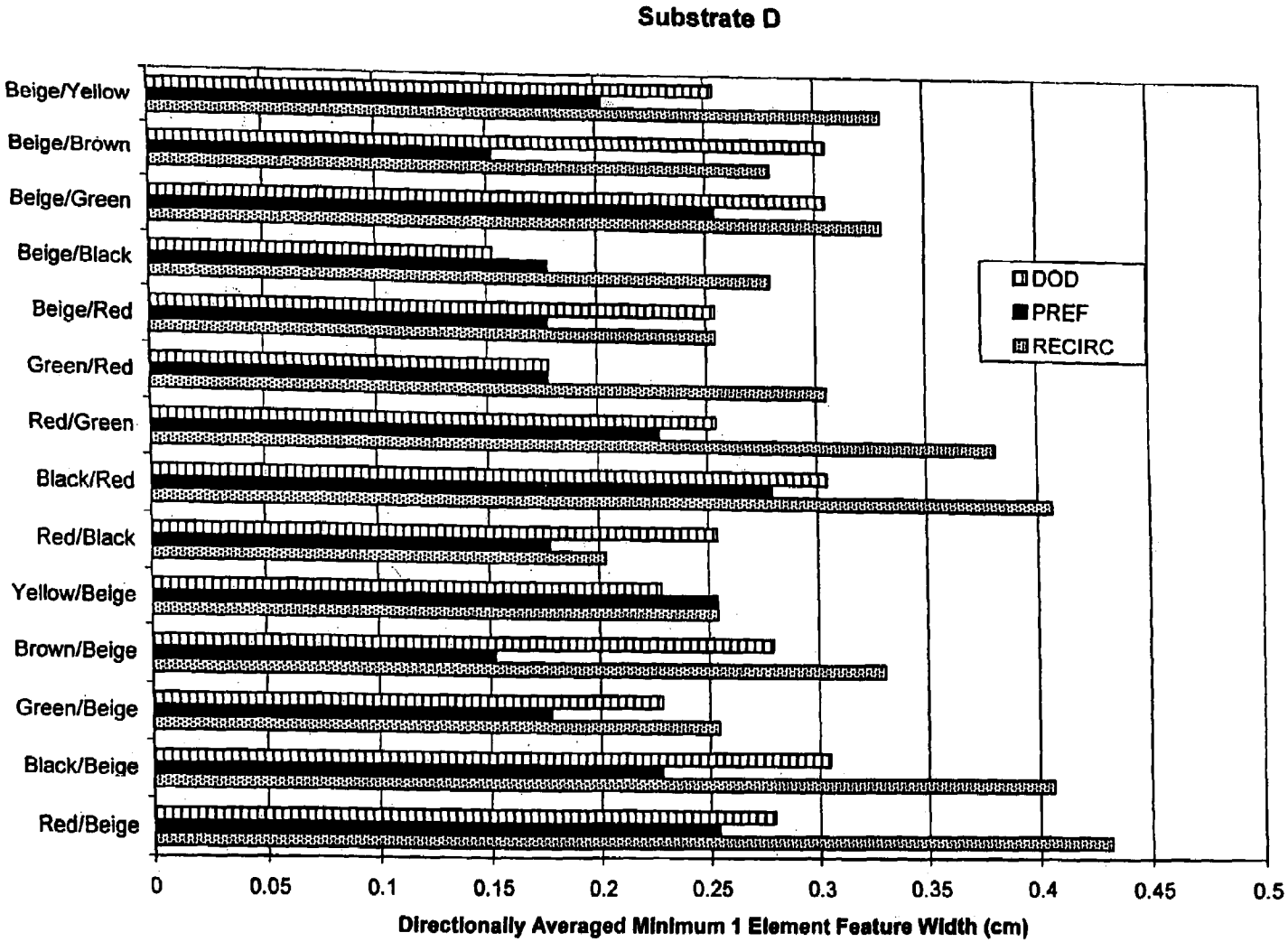
Figure 119:
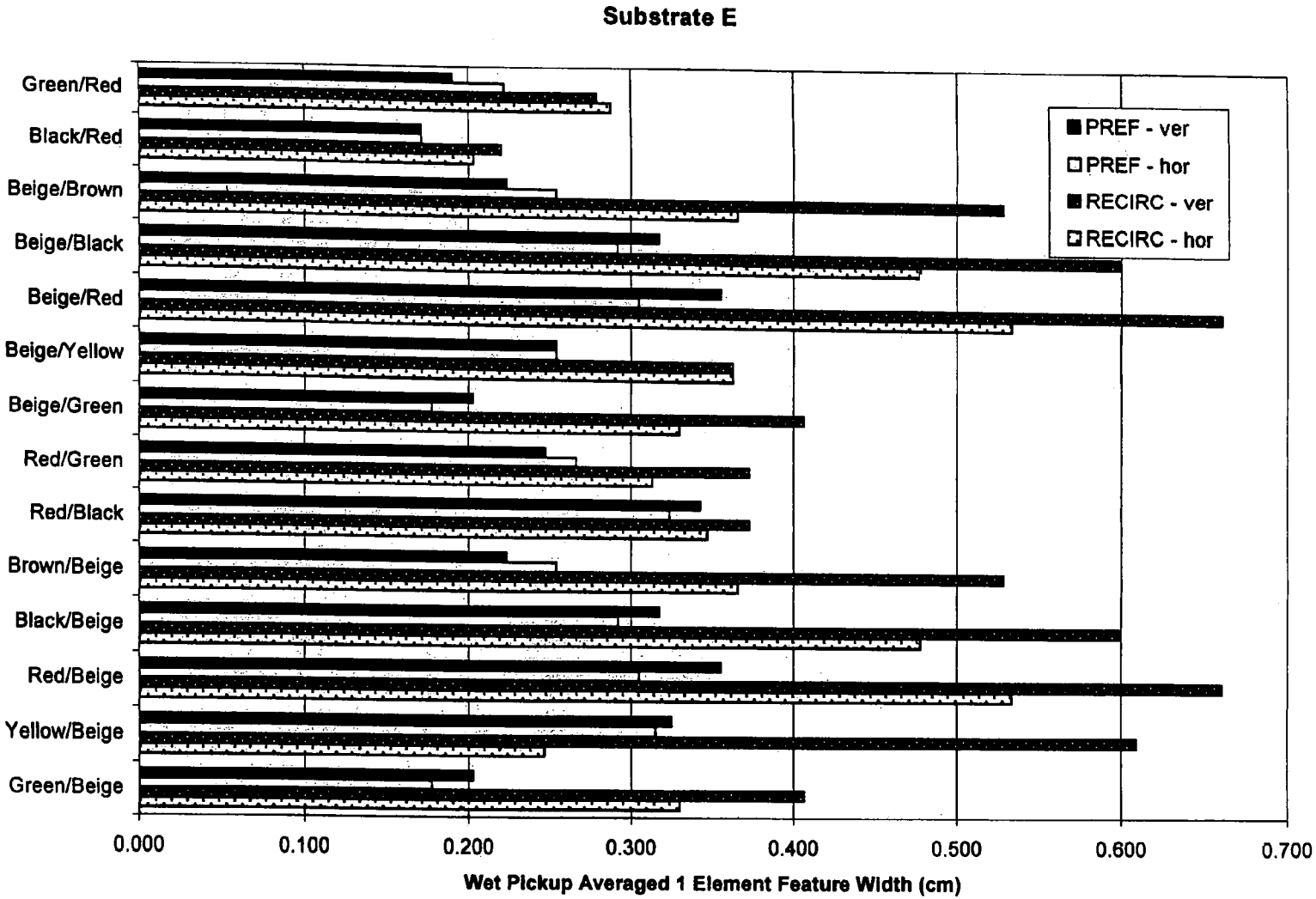
Figure 120:
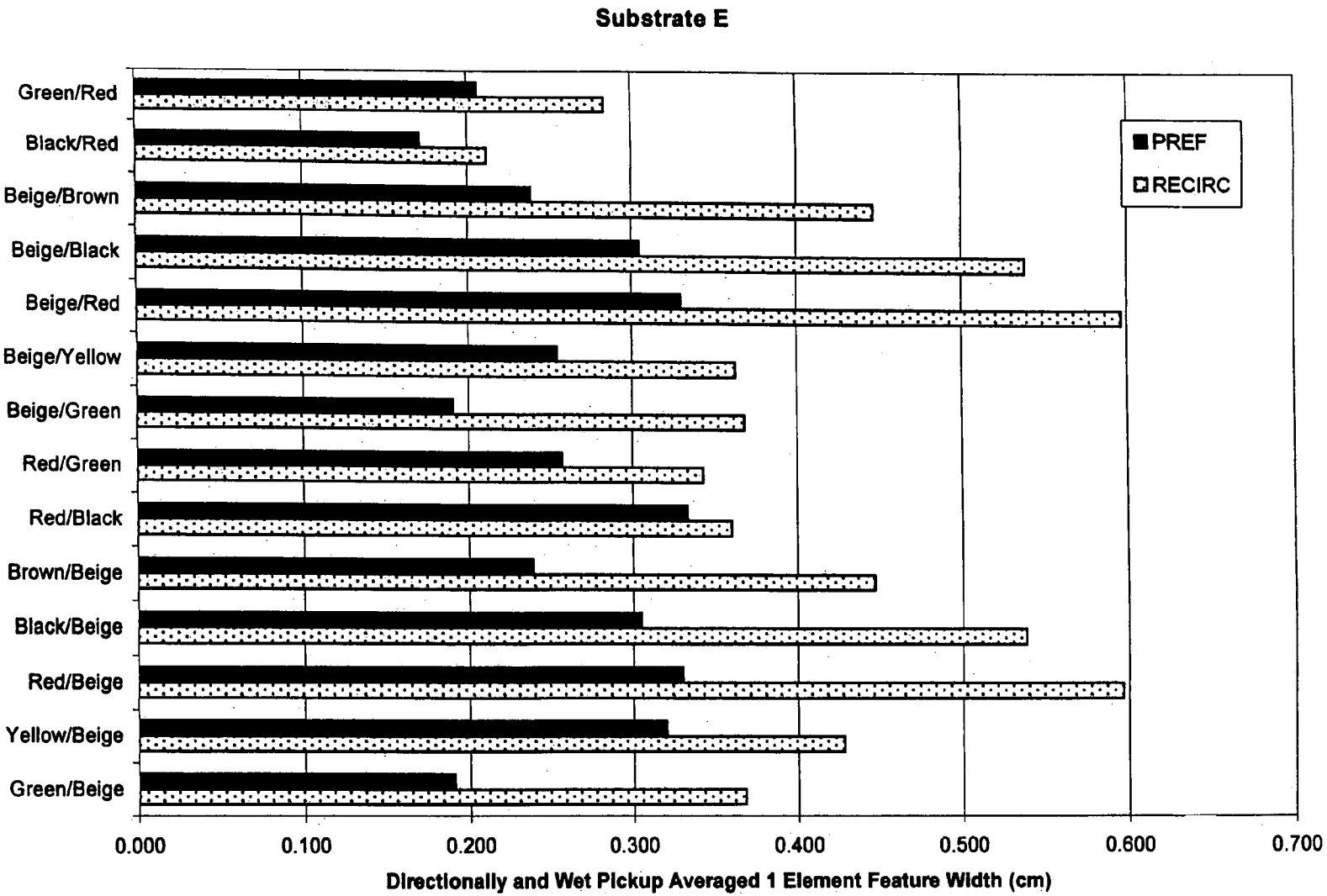
Figure 121:
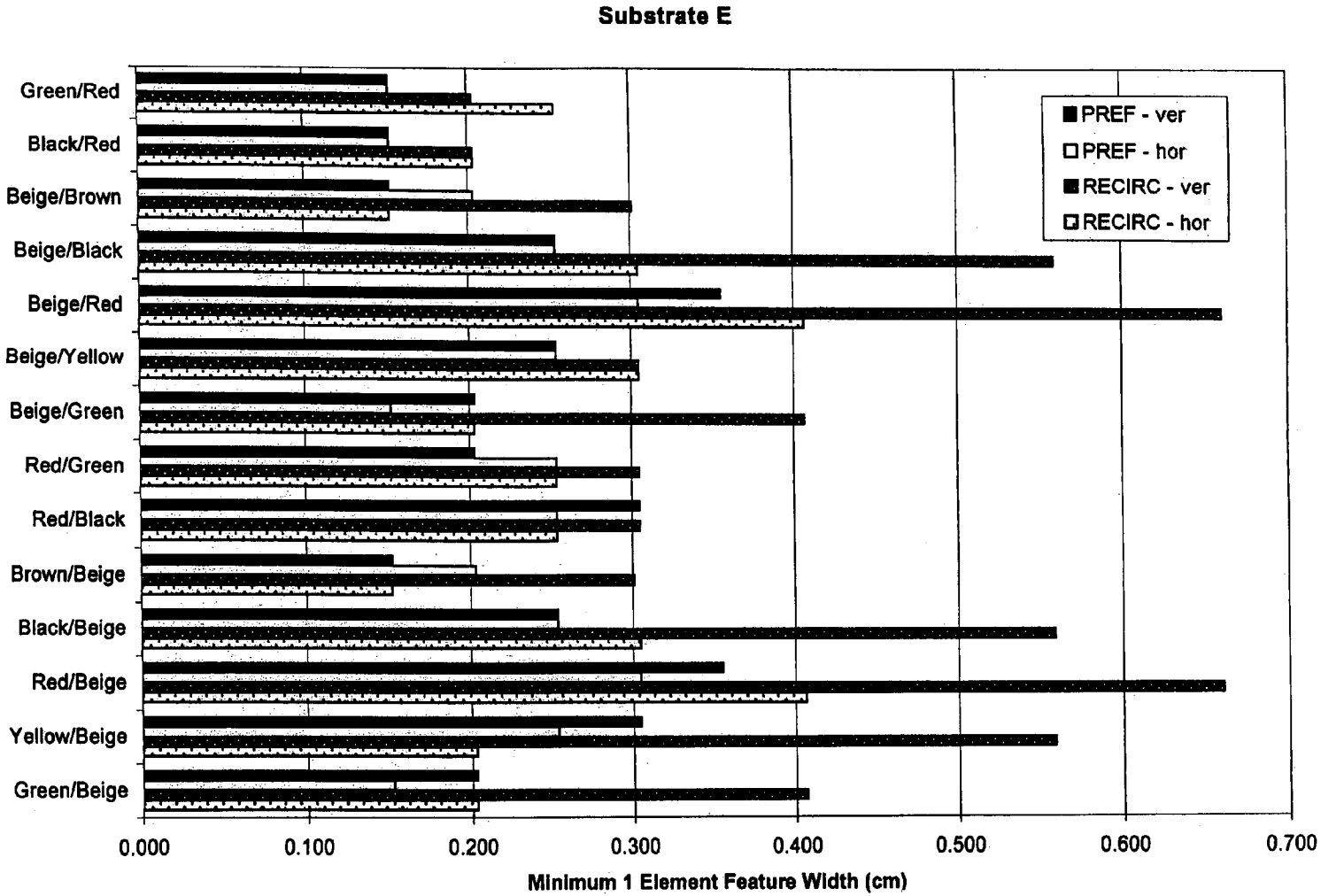

The Wet Pickup Averaged 1 Element Feature Width data for Substrate A, FIG. 103, show many of the same characteristics that were mentioned in the discussion of the Transition Width data for this substrate.

For example, as a consequence of the basic design of the RECIRC and DOD patterning devices, there is a readily discernable directional effect or anisotropy in rendering small features, due to the inherent design of the patterning devices. For the dominant color features, the PREF printing system tends to print feature elements that have little, if any, directional dependence, while both the RECIRC and DOD patterning systems show a much more consistent trend of directional dependence for all of the dominant color features shown. Specifically, the RECIRC system consistently renders a narrower Feature Width for features printed in the horizontal (hor) direction, while the DOD system consistently renders a narrower Feature Width for features printed in the vertical (ver) direction, for the same reasons noted in the discussion on the anisotropy of the Transition Width data. Such results are consistent with the expectations of those skilled in the art of using these respective patterning systems. As noted for the Transition Width data, this Feature Width printing anisotropy is modified to a greater or lesser degree by substrate effects.

In most cases, the 1 Element Wet Pickup Averaged Dominant Color Feature Width for PREF-system printing, shown in FIGS. 103-122, is smaller than that obtained in either orthogonal direction for RECIRC or DOD for any given color combination. There are instances where a good direction for the DOD and RECIRC data may be comparable to the PREF data, but, for most dominant colors on all substrates, the PREF printing process produces a narrower 1 Element Dominant Color Feature Width. This overall ability to produce narrower 1 element features can be seen in the directionally averaged (Wet Pickup Averaged, as well as Minimum) 1 element Feature Width charts, where, almost universally, the PREF patterning system produced directionally averaged dominant color features that were narrower than the corresponding directionally averaged DOD or RECIRC feature. Again, the numeric value for the 1 element dominant color Feature Width varies depending on which dominant color is being rendered. However, as noted for the Transition Width data, the 1 element Feature Width data generated by the PREF patterning system (1) appears to be more tightly clustered, resulting in a more general ability to render fine details of any color, and (2) reflects and ability to generate smaller dominant color details than either the RECIRC or DOD printing system for some colors.

Figure 123:
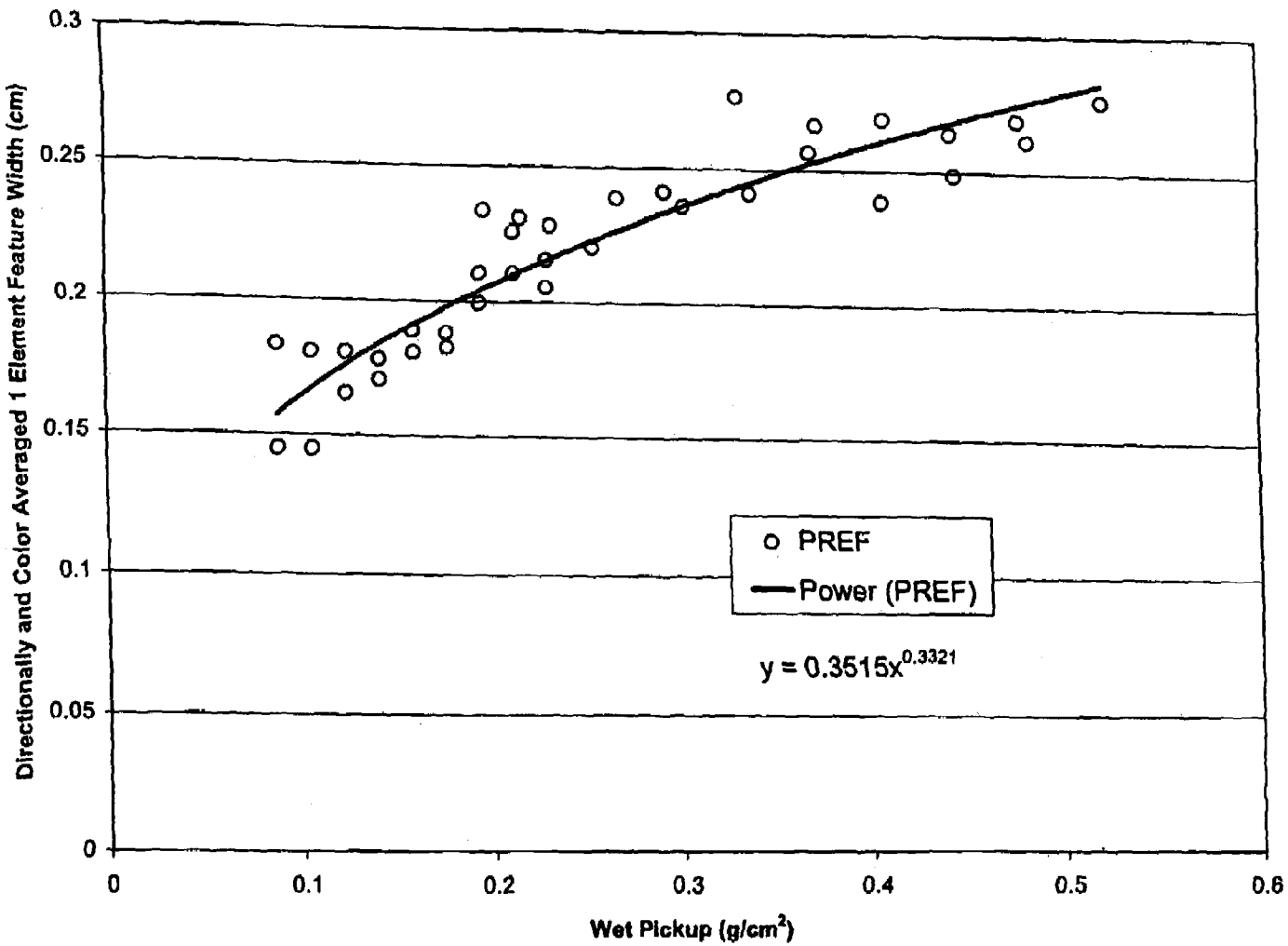

FIG. 123 shows the Color Averaged (and Directionally Averaged) 1 Element Feature Width data as a function of wet pickup for Substrates A through D, printed by the PREF patterning system. The wet pickup range for these data is larger than the range specified in the manufacturing wet pickup ranges listed in Table 1 for each of the four nylon 6,6 substrates. There are, therefore, data for higher and lower wet pickups than are typically specified for the respective substrates. Additionally, the 1 Element Feature Width data is color-averaged over all dominant colors printed on the same substrate with a similar wet pickup. The raw data for each color fall in the center of the data ranges seen for all colors, so these data may be thought of as an average expectation for the 1 Element Feature Width. Some important observations to be made from FIG. 123 are discussed below.

Since the color and direction averaged 1 Element Feature Width data for each nylon 6,6 substrate is included on the chart and the data appear to fall on a continuous curve, it is reasonable to infer that the Feature Width is, in general, a function of the wet pickup required to dye the nylon 6,6 substrate to obtain an adequate fractional penetration. This implies that when substantial wet pickup is required to get high penetration of colors on the substrate, as, for example, a carpeting product with long tufts, the Feature Width will be larger than for a product for which substantial penetration can be achieved with a lower wet pickup.

FIG. 123 shows a least square regression fit of a power law equation to the color and direction averaged 1 element Feature Width data, plotted against wet pickup. The power law exponent of the fit is approximately ⅓. This is significant because it corroborates a model that is very useful in characterizing the PREF print system. If it is assumed that, subsequent to being dispensed onto a substrate surface, the dye is able to bead up and form a sphere on the surface that is then absorbed intact (i.e., wholly within a circular "footprint" having a diameter equal to that of the sphere, without spreading outwardly), then the Feature Width that one would expect for patterning with such a sphere in each pixel area would be equivalent to the diameter of the corresponding circular footprint. Such a model is reasonable as the high viscosity of the dye used in the PREF patterning system, coupled with the chemistry that is applied to the substrate surfaces, would tend to slow the drop's wicking into the substrate and allow it to form a bead on the surface before being absorbed into the substrate. Using such a model, the Feature Width would be described by the diameter of a sphere with a volume determined by the wet pickup applied to the substrate and the dye density, which is approximately 1 g/cm$^3$ for the PREF patterning system. Assuming a 20 gauge patterning system, 400 drops would be dispensed into a square inch of substrate and the wet pickup in that square inch would be divided equally into the 400 drops. The resulting equation that relates 1 Element Feature Width to wet pickup, given that the geometric volume of a sphere is $(4/3)\pi r^3$, where r is the radius of the sphere (=diameter of sphere/2), is:

$$FW_{1\ element}(\text{cm})=2\cdot((3/248\cdot\pi)\cdot W\ t\ \text{Pickup}(\text{g/cm}^2))^{1/3}$$

The power law exponent of ⅓ from the fit to the PREF Color-and-Direction Averaged 1 Element Feature Width data indicates that the spherical drop model for Feature Width may be a good way to characterize the PREF patterning system's ability to print fine features on a substrate, and particularly nylon 6,6.

Figure 124:
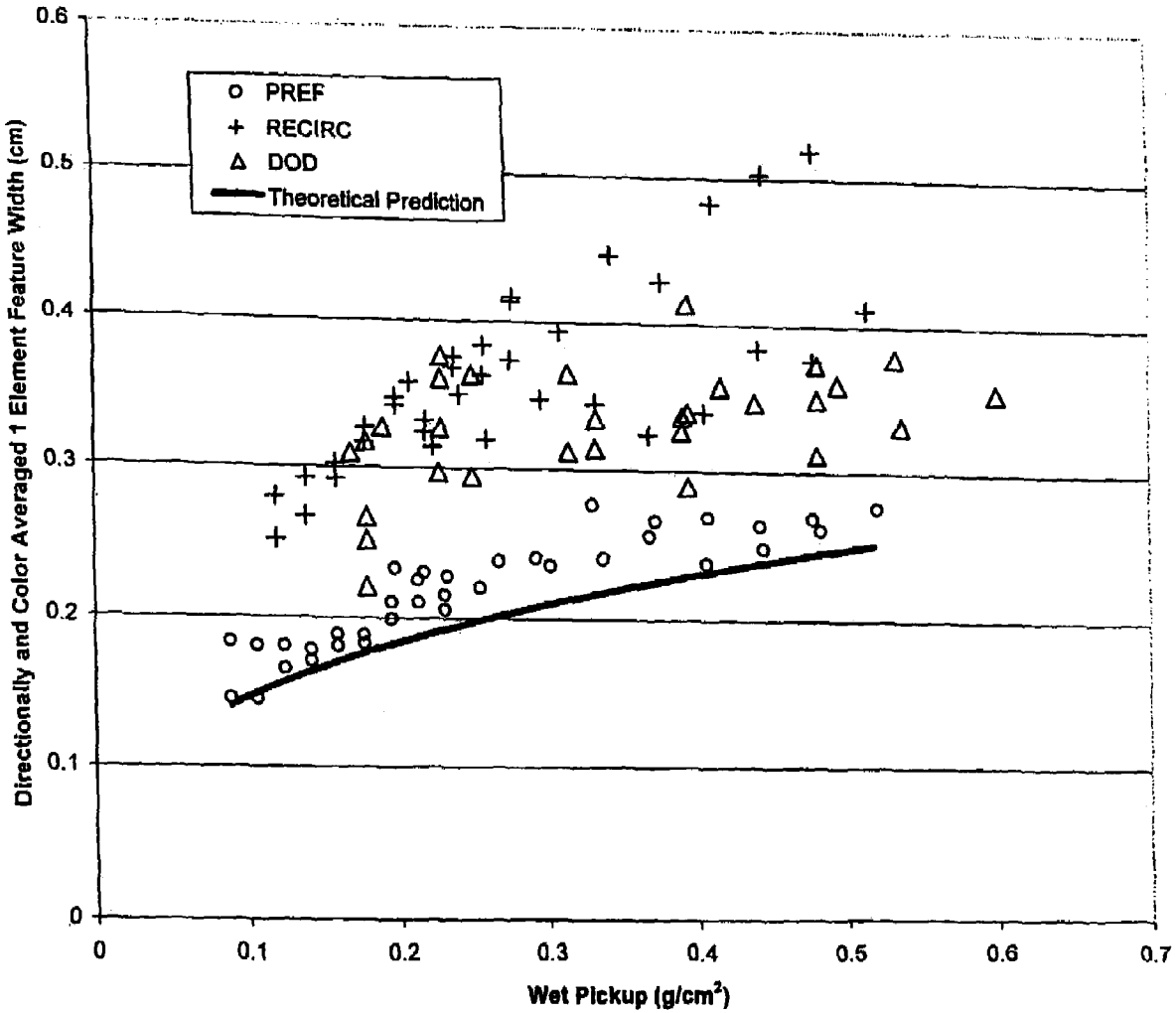
Figure 125:
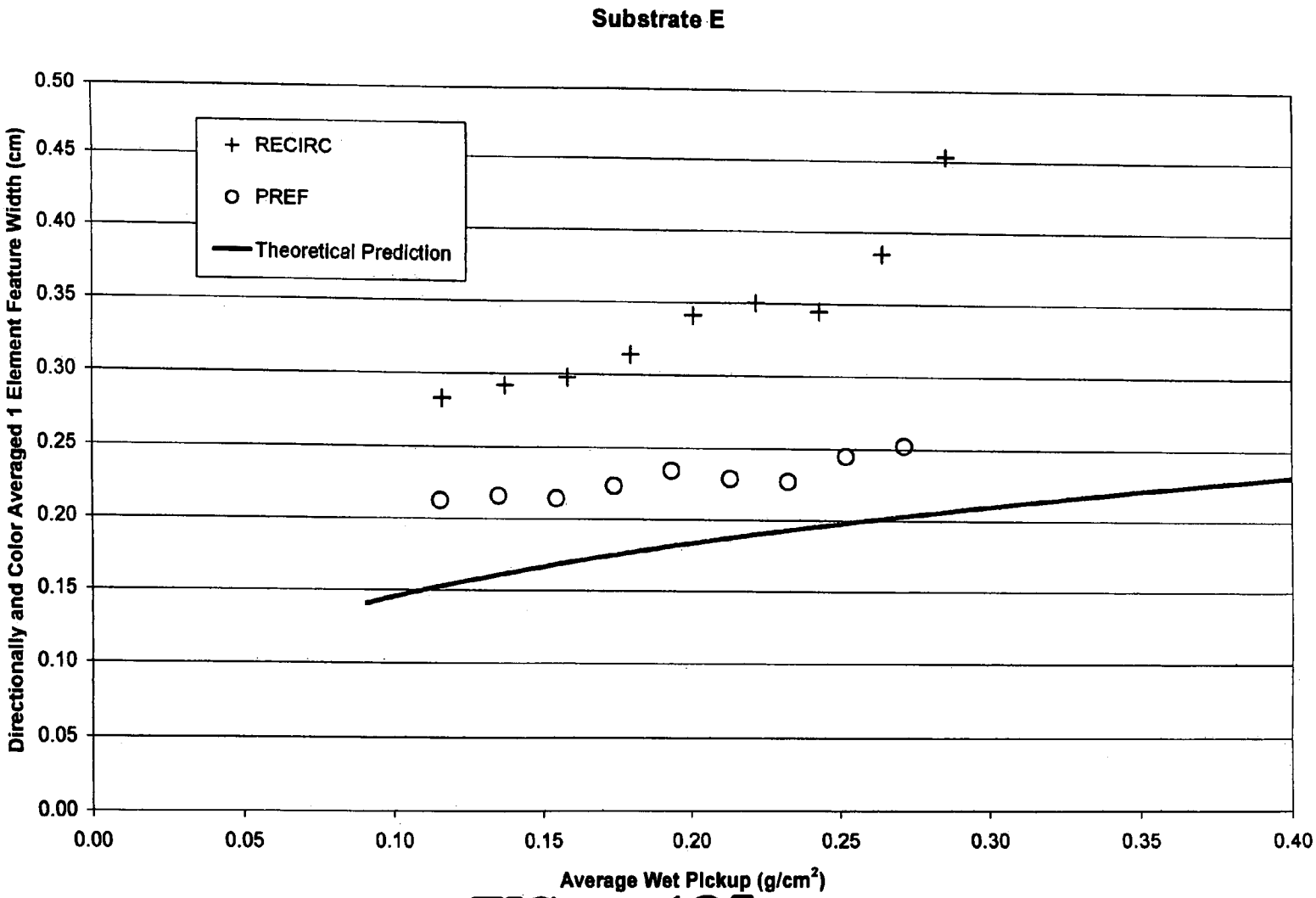

FIG. 124 shows a comparison of the Color and Direction Averaged 1 Element Feature Width data for the nylon 6,6 substrates for PREF, RECIRC, and the DOD printing systems. In addition, the chart shows the un-scaled prediction for 1 Element Feature Width from the spherical drop model calculated for the corresponding wet pickup. It is significant to note that (1) the PREF 1 Element Color and Direction Averaged Feature Width is nearly equal to the prediction of the spherical drop model, indicating that the PREF system more closely approximates that model, and (2) the RECIRC and DOD data both deviate more from the predictions of this simple model. This same general trend for the PREF 1 Element Feature Width is seen, but to a somewhat lesser extent, for Substrate E (see FIG. 125). The lessening of this effect is believed to be due to an increase in the tendency for dye to remain on the surface of Substrate E, thereby enhancing the opportunity for the dye to migrate laterally rather than vertically.

Figure 126:
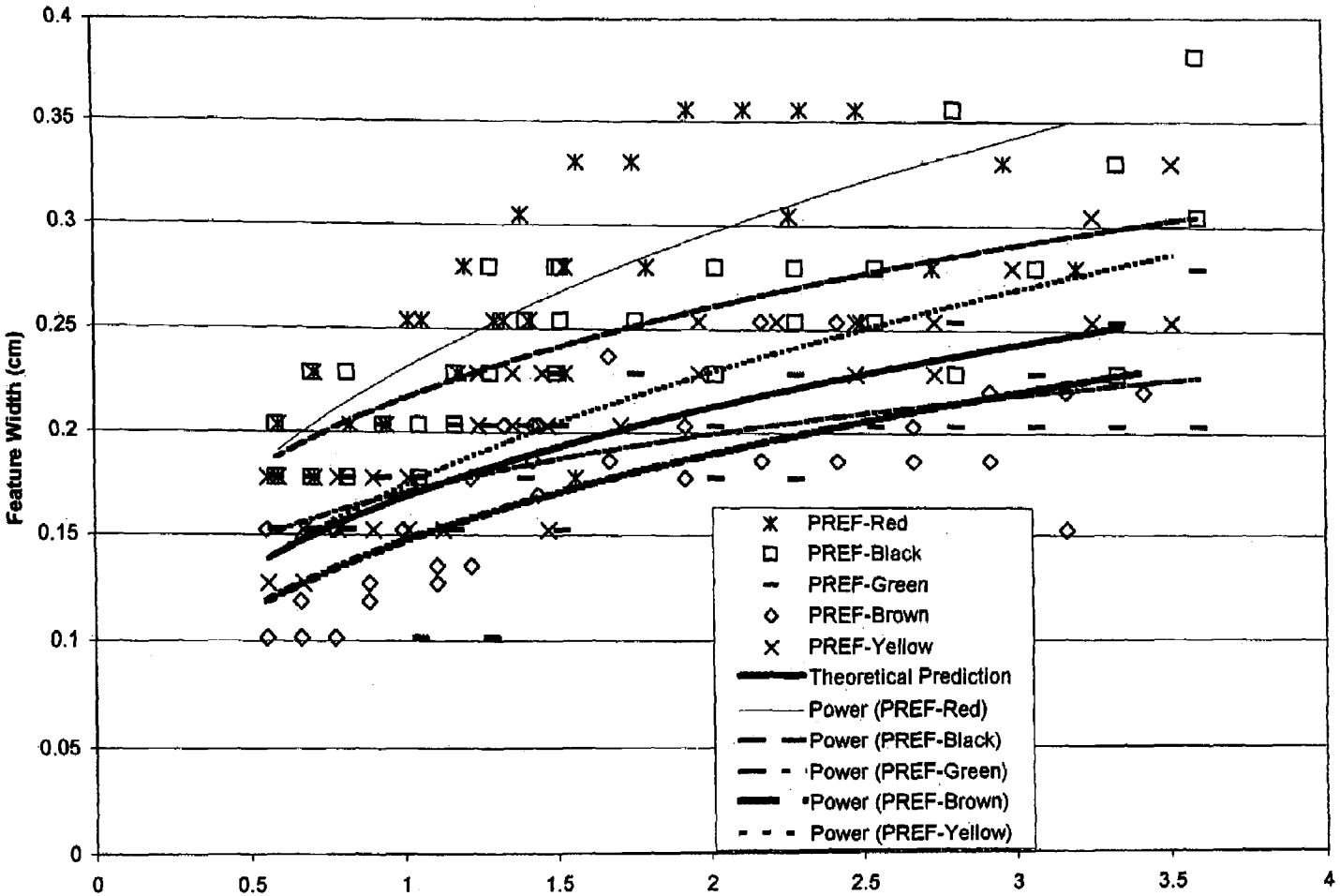

The details of the dye are also believed to affect the Feature Width. FIG. 126 shows the Direction Averaged 1 Element Feature Width data for the five dominant color features, as printed on Substrates A-D against a beige background. Power curve fits to the data support the following conclusions. In general, 1 element Feature Width tends to increase monotonically with the concentration of individual dyestuffs in the printed dye. Therefore, for the specific dyes that were printed with PREF in the Examples, the order of decreasing Feature Width is: red, black, yellow, green, and brown.

Figure 127:
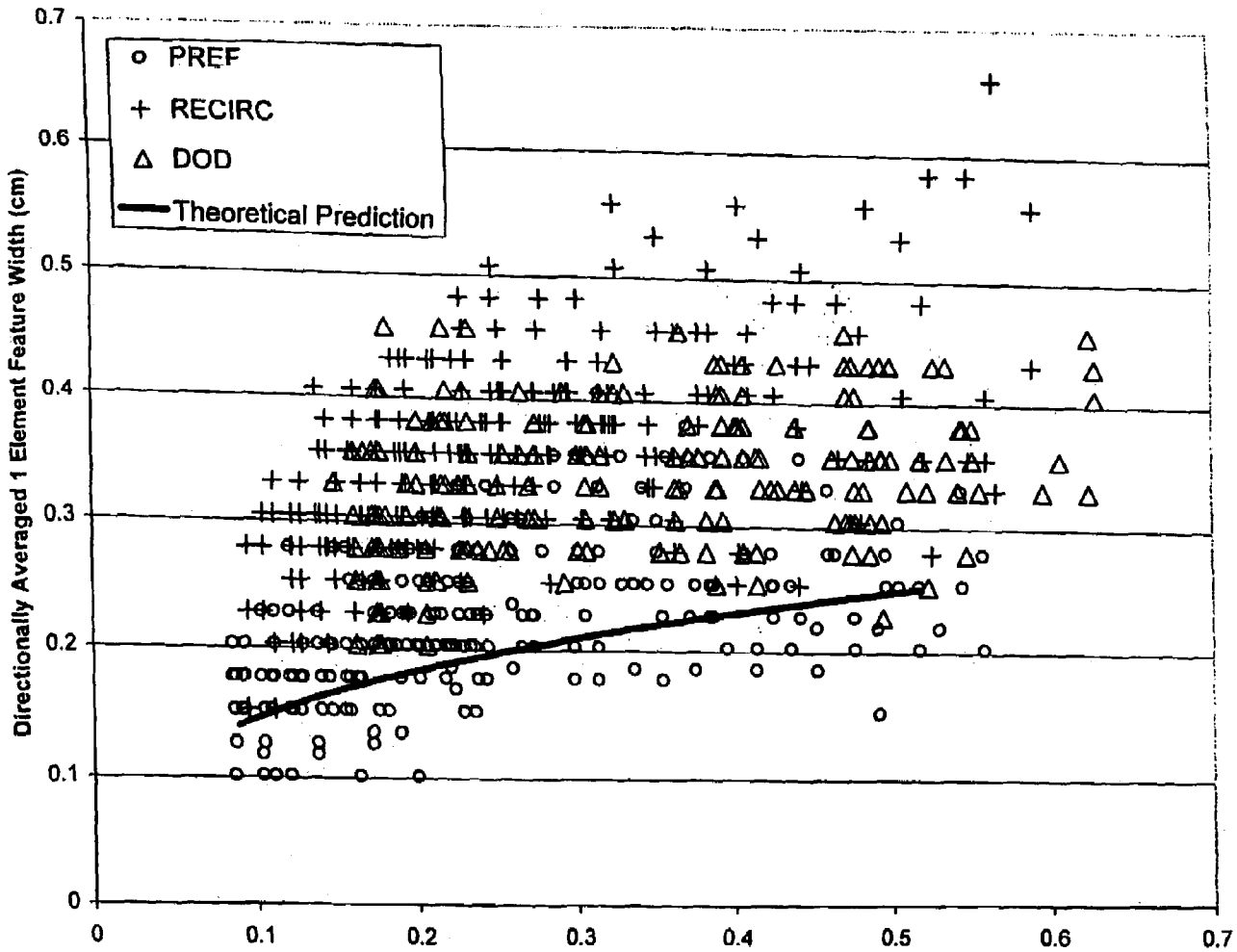
Figure 128:
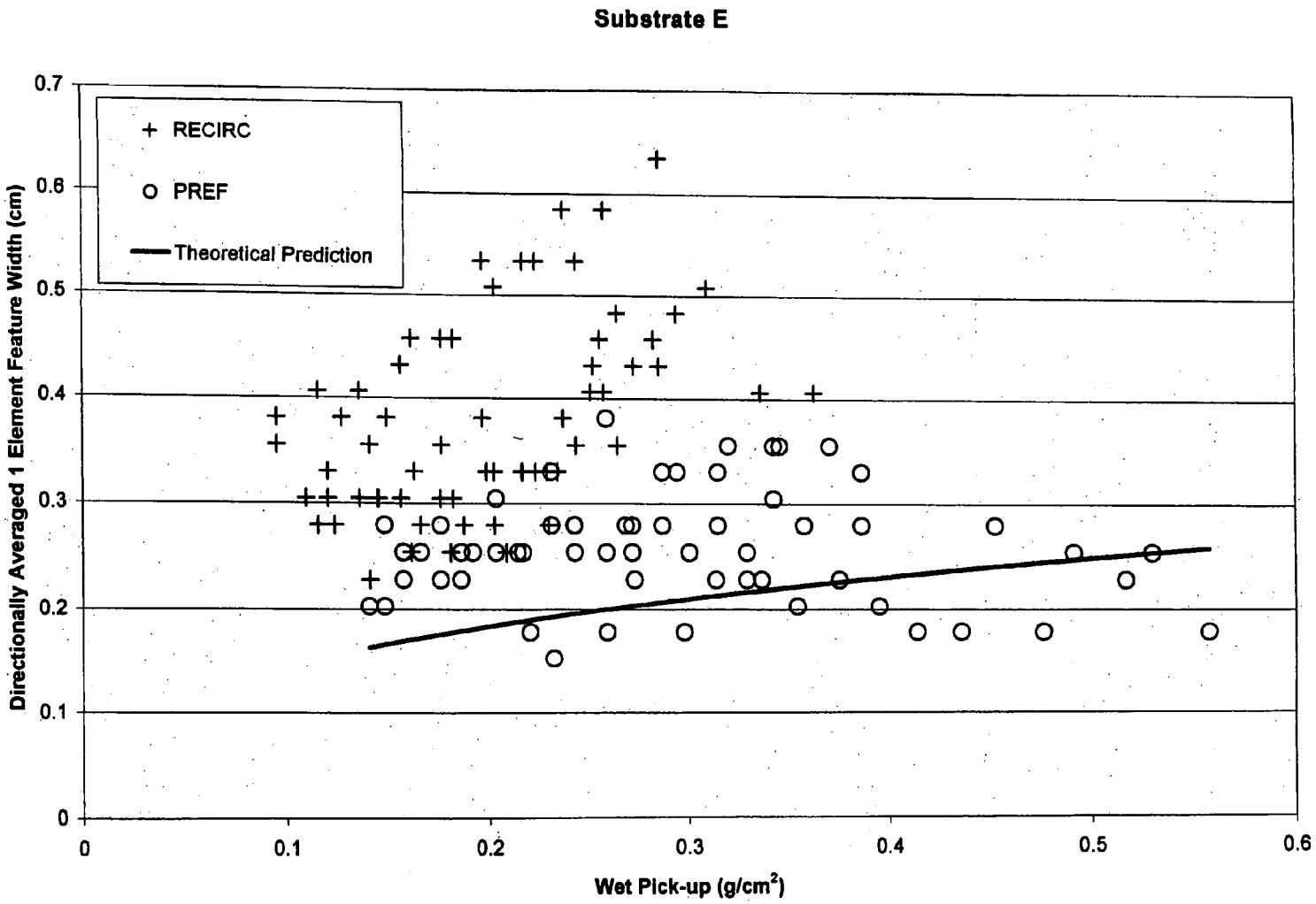

FIG. 127 shows the Directionally Averaged 1 element Feature Width plotted against Wet Pickup for all the dominant color features for the three print technologies for the nylon 6,6 substrates (Substrates A through D). In addition, the spherical drop model prediction for the 1 Element Feature Width is plotted as a solid line on the chart. When all of the color data is plotted, it is noted that some of the PREF Directionally Averaged 1 Element Feature Widths are smaller than the spherical drop model prediction—an effect believed to be due to certain channeling effects induced by neighboring dye drops or small scale substrate construction features. It is interesting to note that, aside from one exception (found at a relatively high wet pickup value), the Directionally Averaged 1 Element Feature Width data falling below the solid line (i.e., with values smaller than those predicted by the spherical drop model) are all PREF data. Actually, a great deal of the Directionally Averaged 1 Element Feature Width data beneath the line representing the spherical drop model prediction are for the brown color feature. This is significant because, as mentioned earlier, the brown/beige pairing is believed by those skilled in the art to represent the majority of color pairings actually used to print textile substrates.

The single non-PREF data point that falls below the line was checked and found to have a relatively large 1 Element Transition Width. If the additional requirement is made that the data under the curve also need to have a 1 element Transition Width less than, say, 4.5 mm, then the spherical drop model provides a cut off that represents the effective gauge or Feature Width that reliably distinguishes the PREF's system patterned products. This requirement that a printed fine element feature have both a small Feature Width and a small Transition Width will later be shown to demonstrate, in decisive fashion, the advantage of the PREF patterning system over the RECIRC and DOD print systems.

Figure 129:
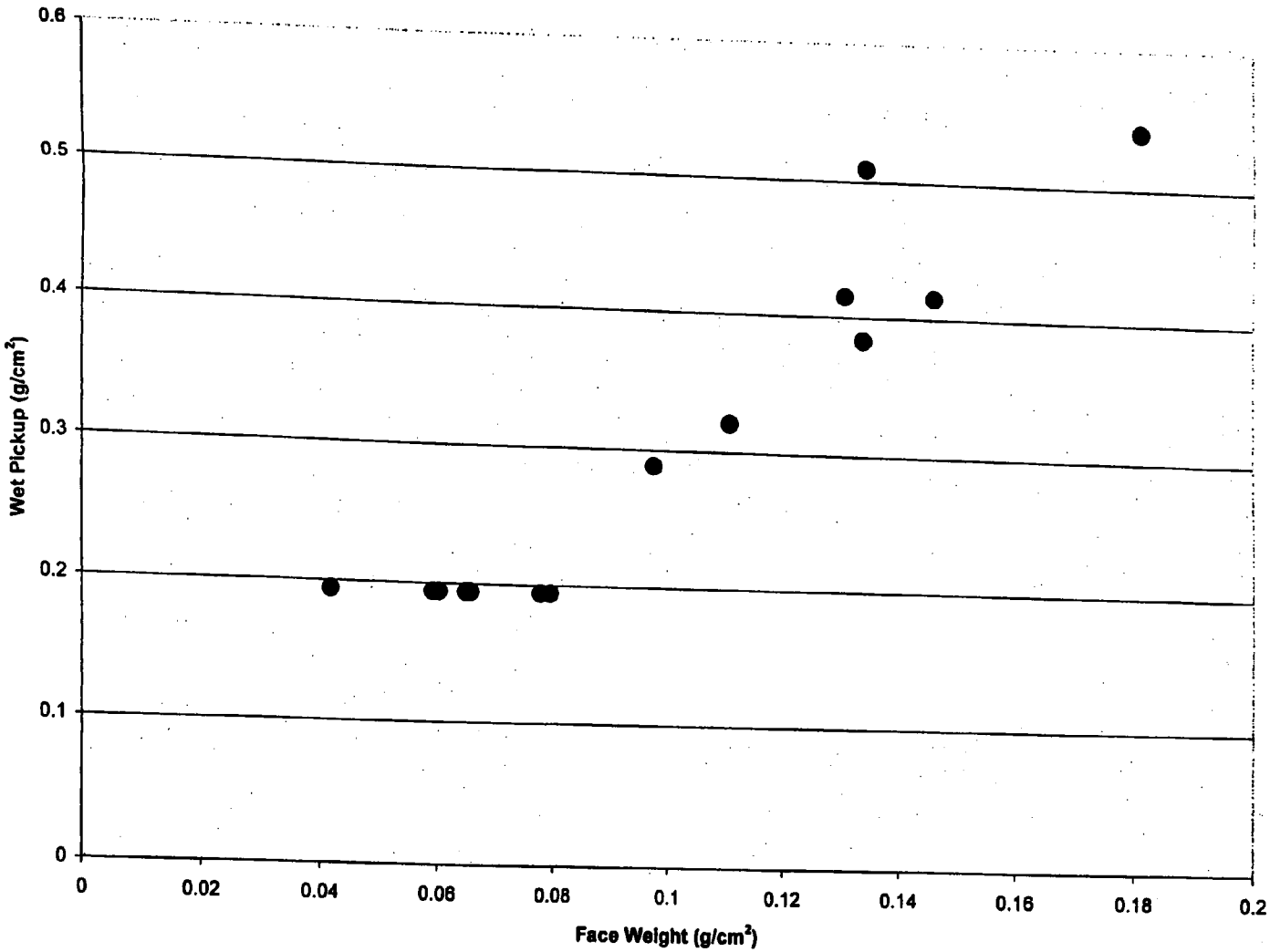

For an arbitrary substrate, one can calculate the Feature Width that would separate PREF printing from its competitors by knowing the wet pickup that is required to achieve adequate penetration along the length of the tuft extending above the backing (e.g., at least 50% for nylon 6,6 substrates and at least 40% for wool substrates) on that specific base, and translating that wet pickup, using the spherical drop model equation for the 1 Element Feature Width as a function of wet pickup, to a Feature Width that can uniquely characterize a PREF-patterned product. To facilitate this process, FIG. 129 shows, for a number of substrates that are printed for commercially available floor coverings, the printed-pile face weight and the required wet pickup of dye that would be necessary to achieve adequate penetration, as defined above. From this table and the spherical drop model, one can calculate the 1 Element Feature Width that separates the PREF patterning system from RECIRC and DOD for any given nylon 6,6 substrate and corresponding wet pickup. One skilled in the art will recognize that, since the Directionally Averaged 1 Element Feature Width increases with wet pickup, it can also be expected to increase with pile height. This is because increased pile height requires additional wet pickup so that the pile can be dyed with adequate penetration.

Figure 130:
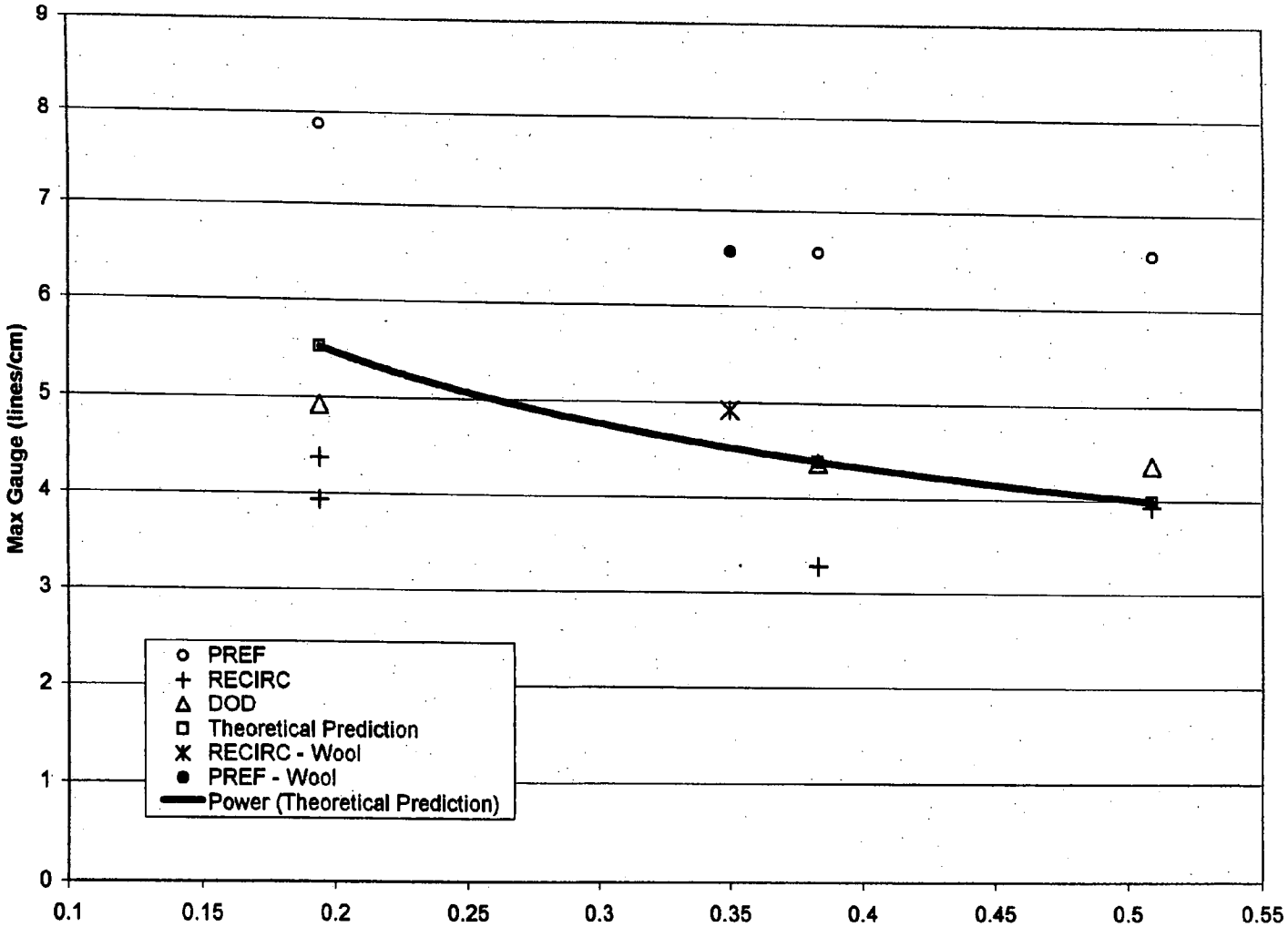
Figure 131:
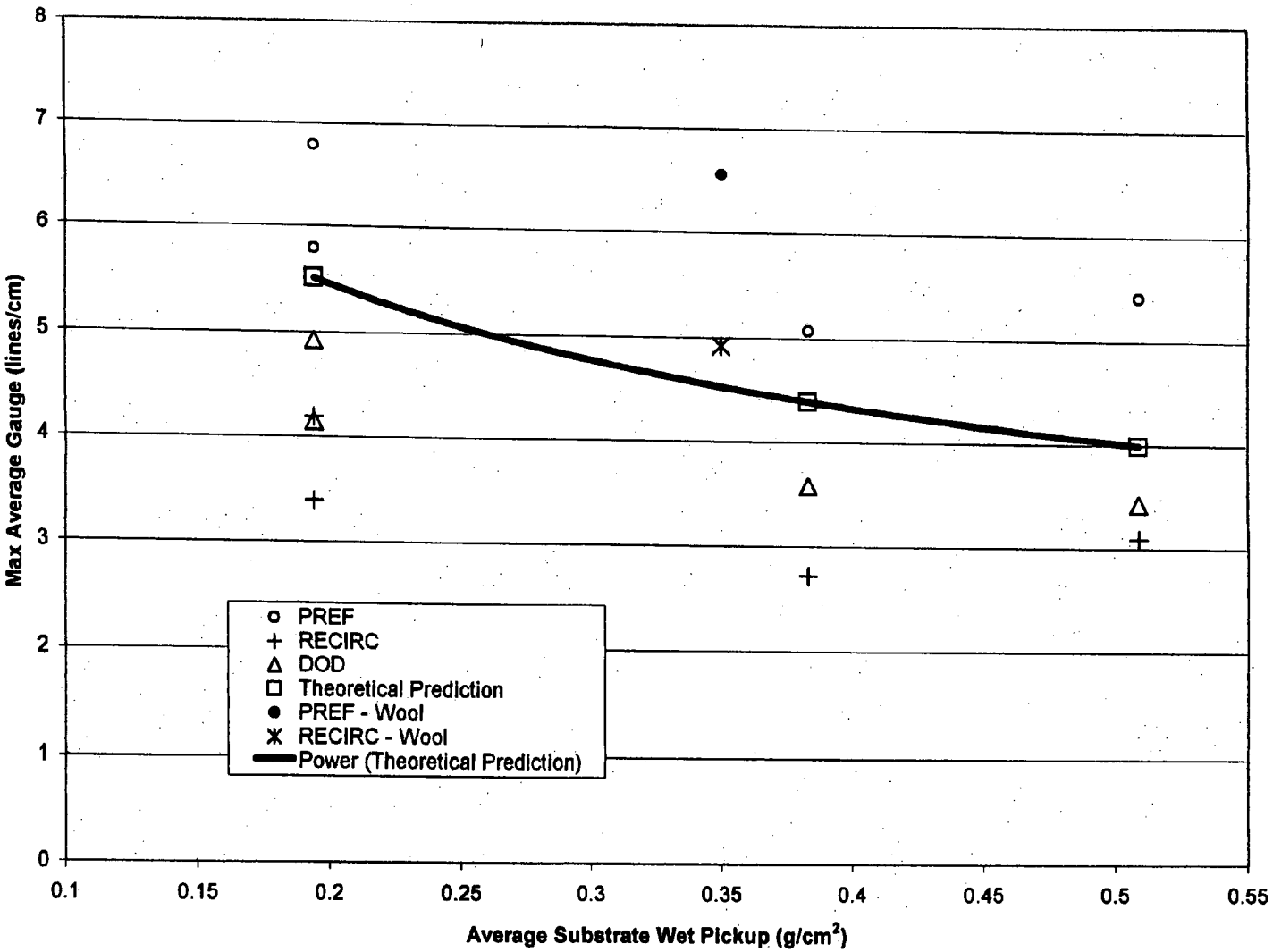
Figure 132:
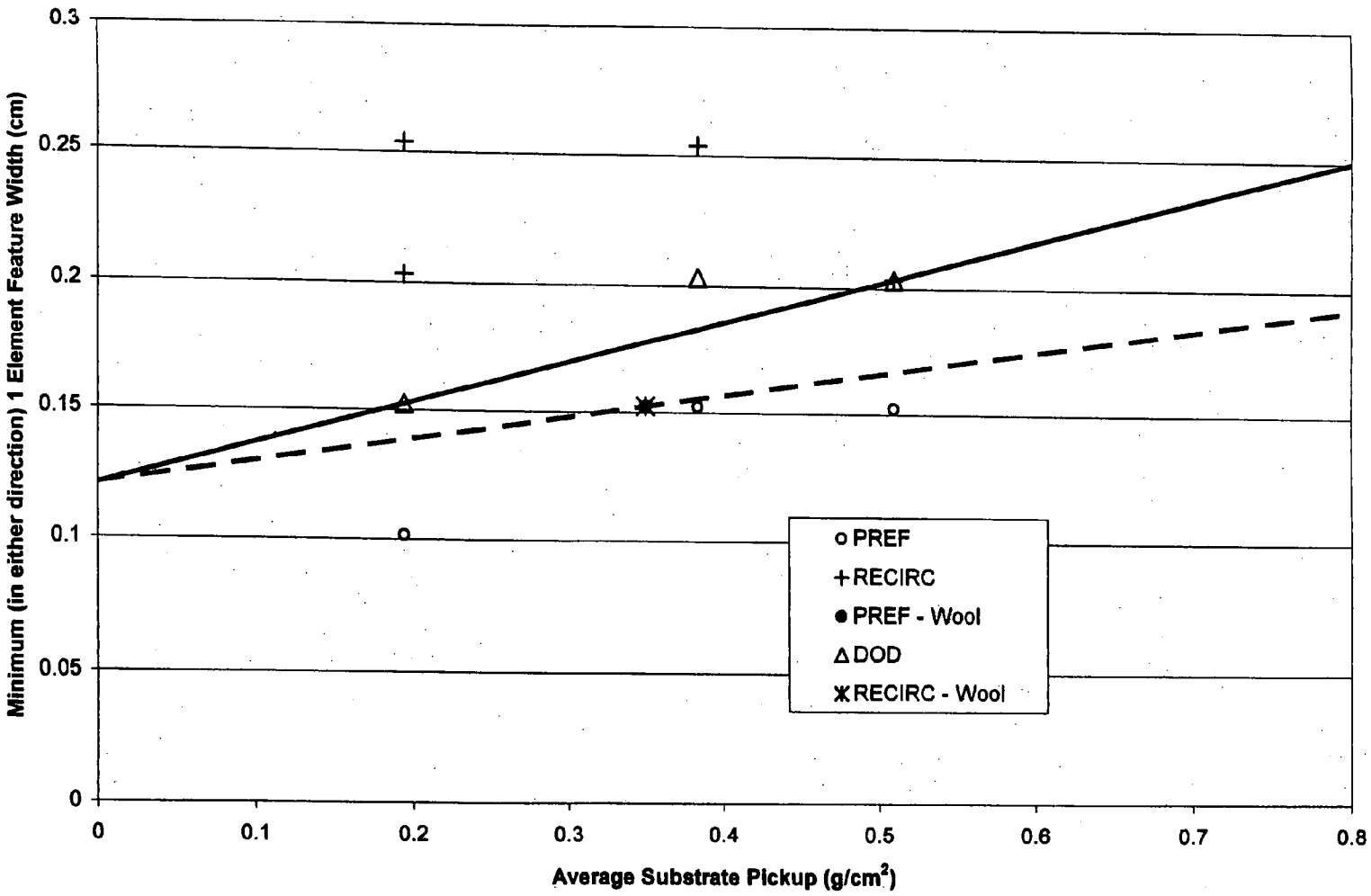
Figure 133:
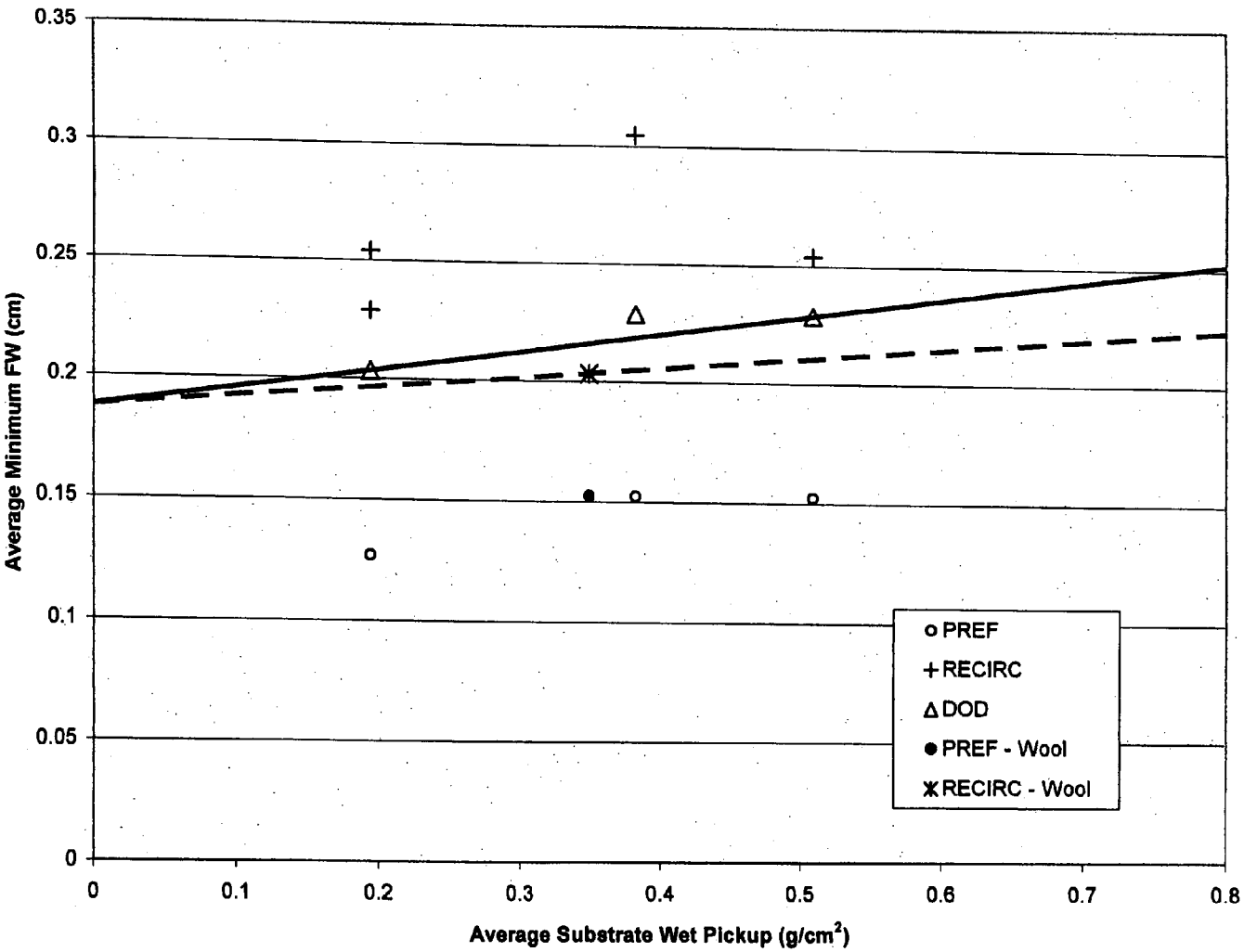
Figure 134:
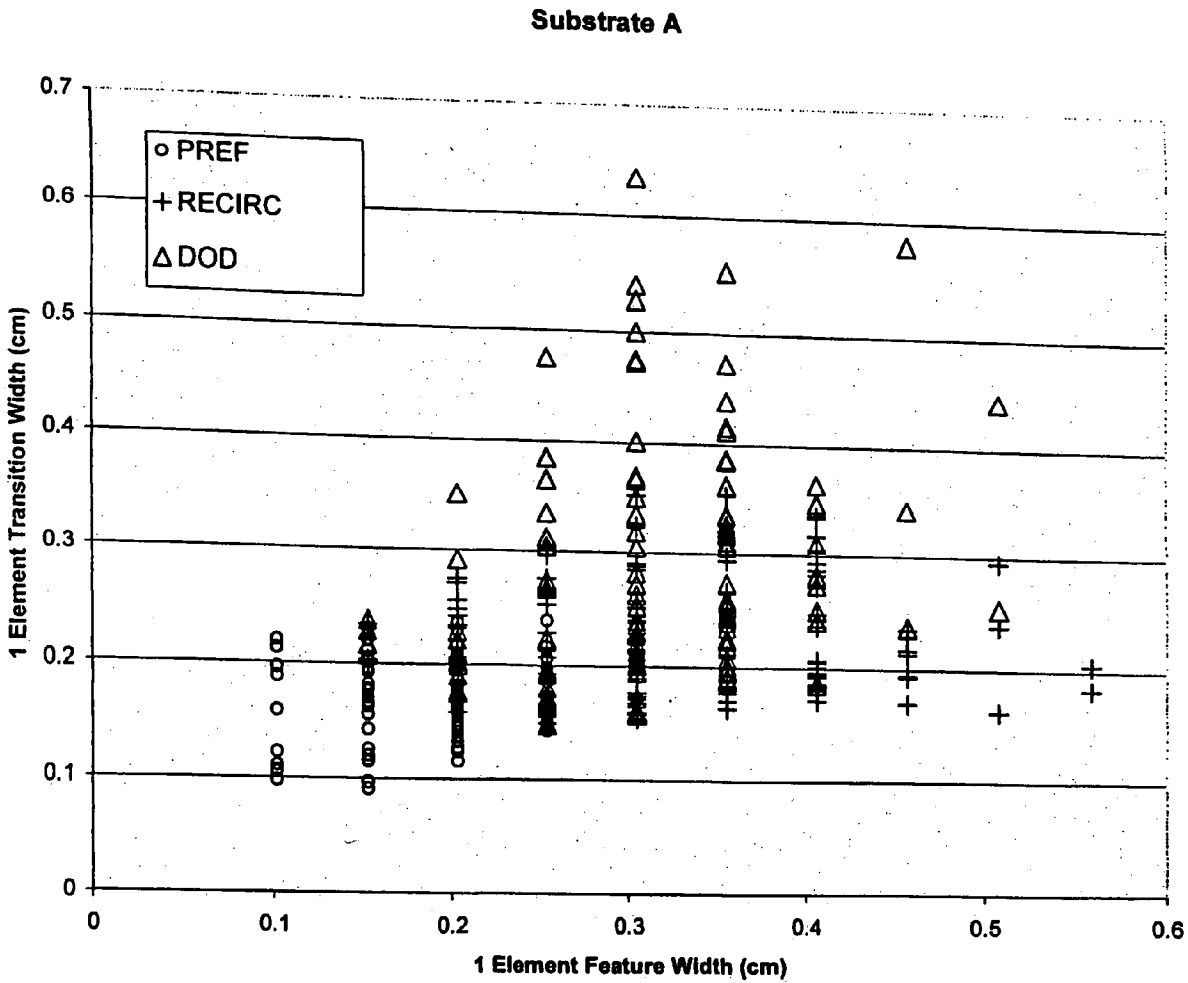
Figure 135:
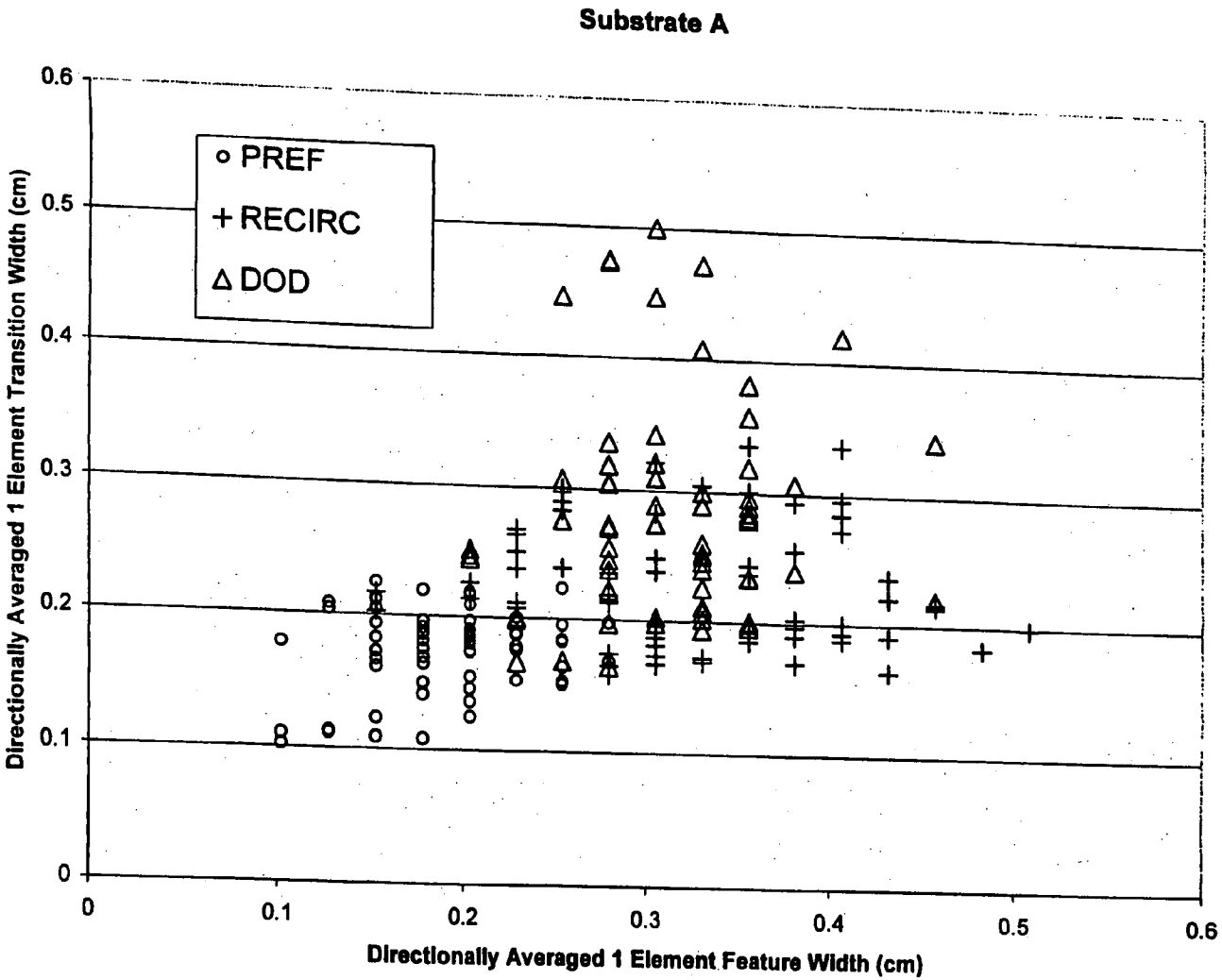
Figure 136:
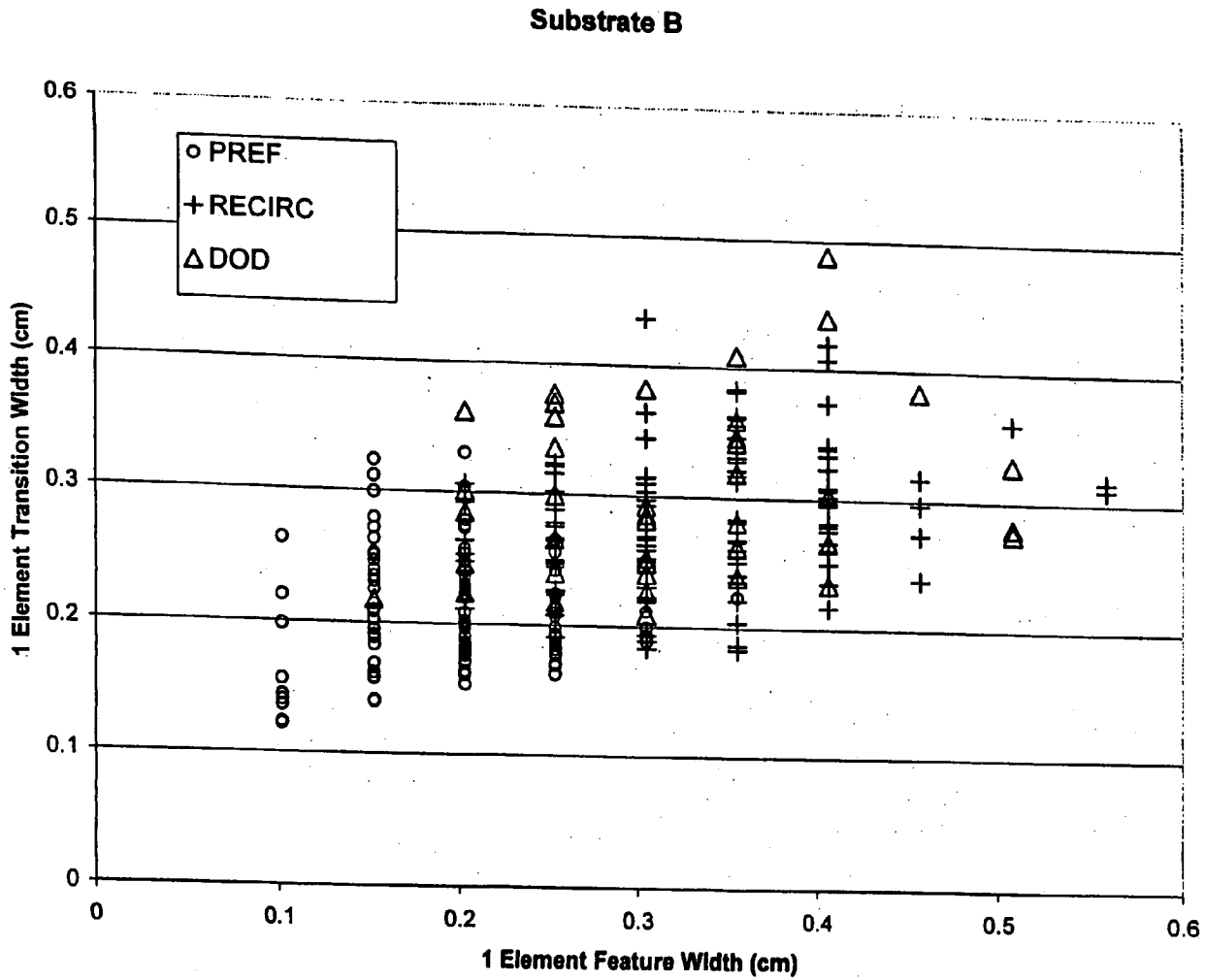
Figure 137:
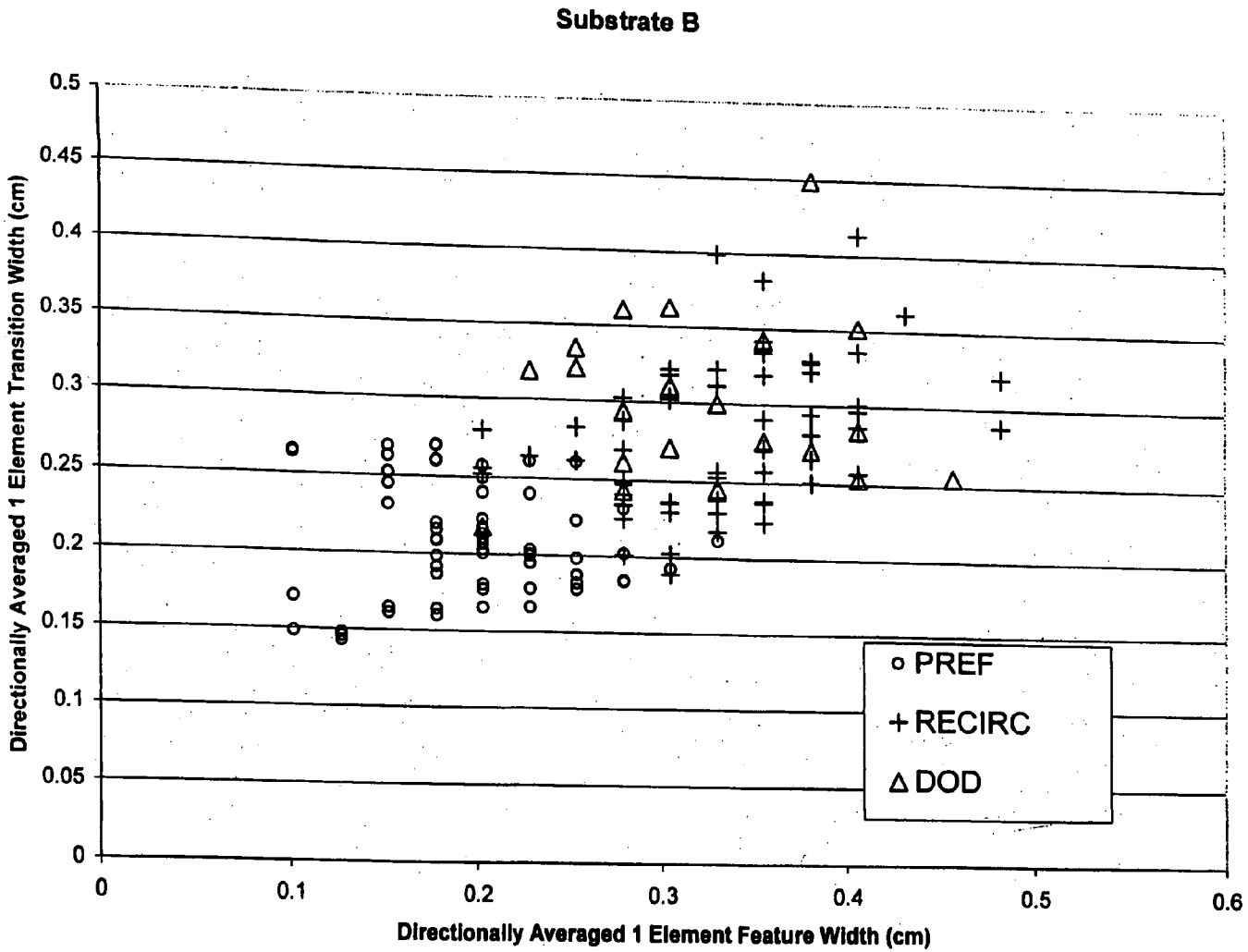
Figure 138:
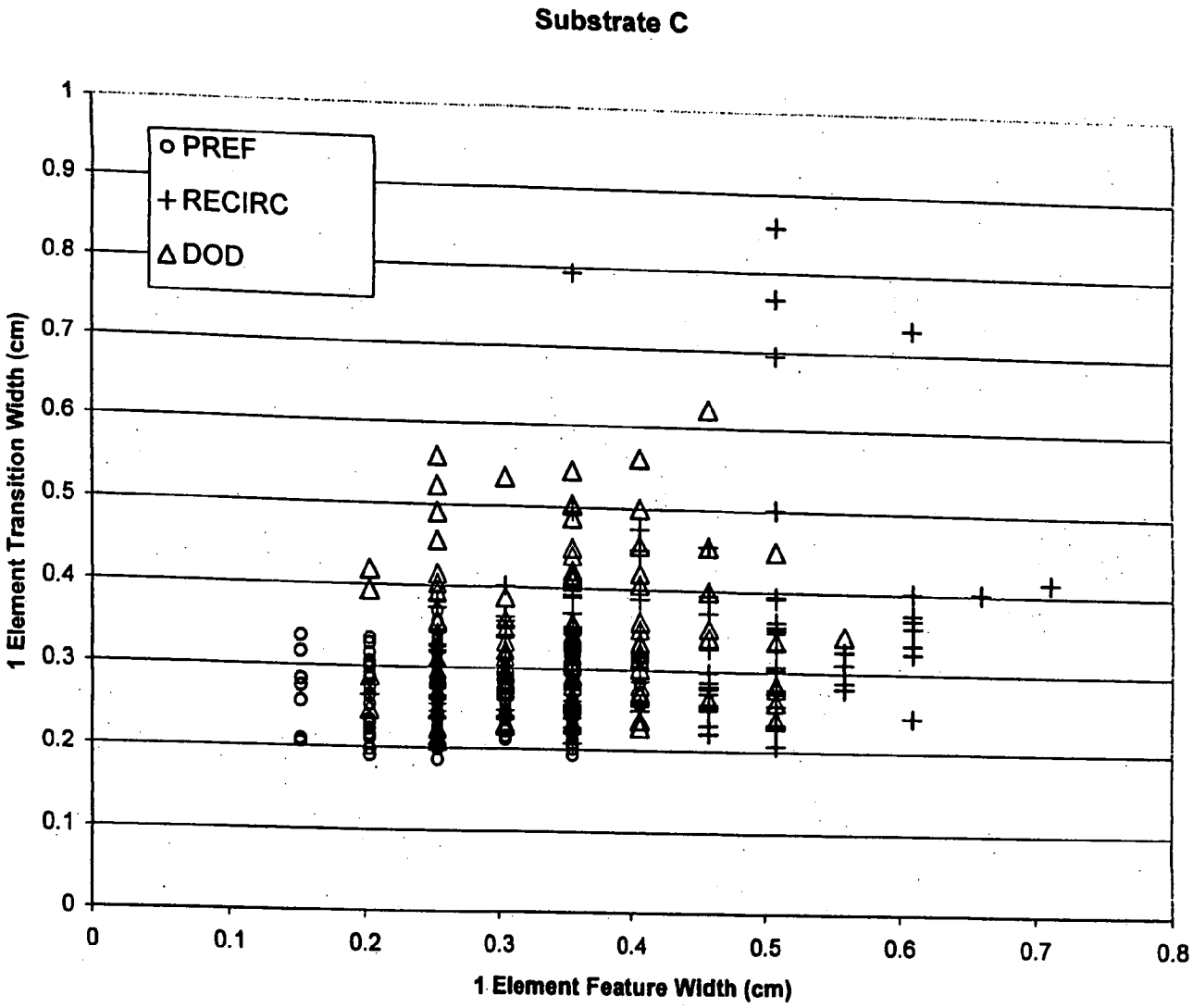
Figure 139:
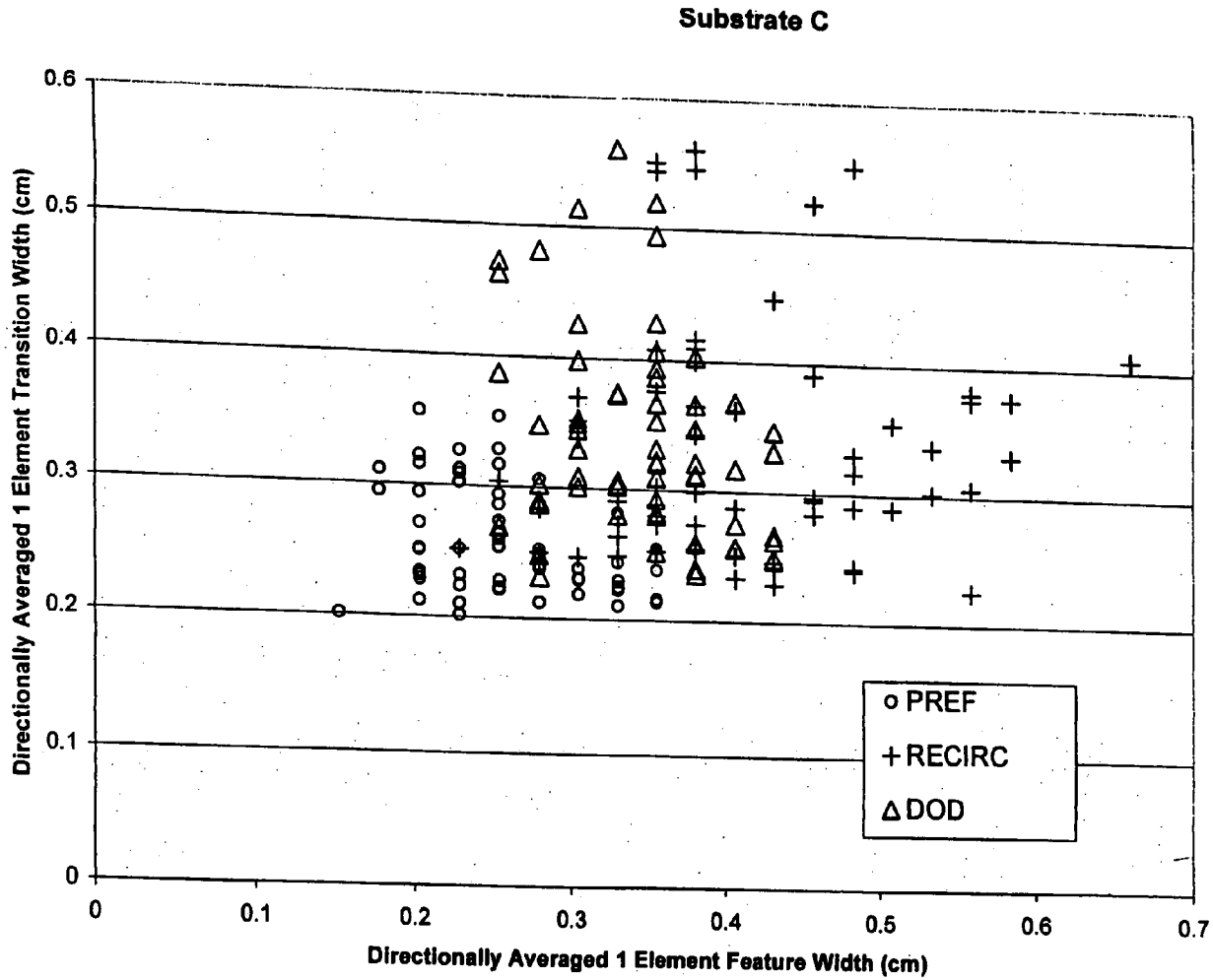
Figure 140:
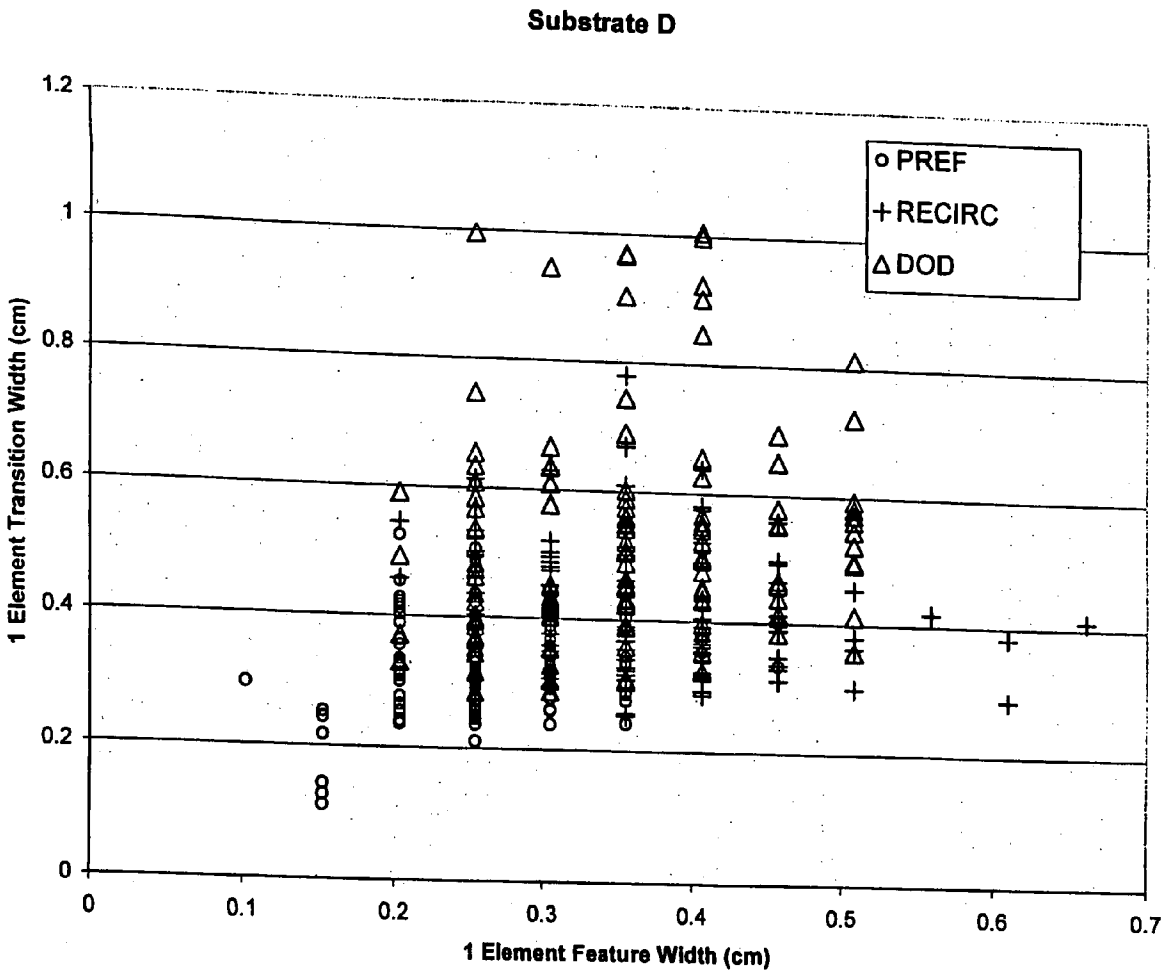
Figure 141:
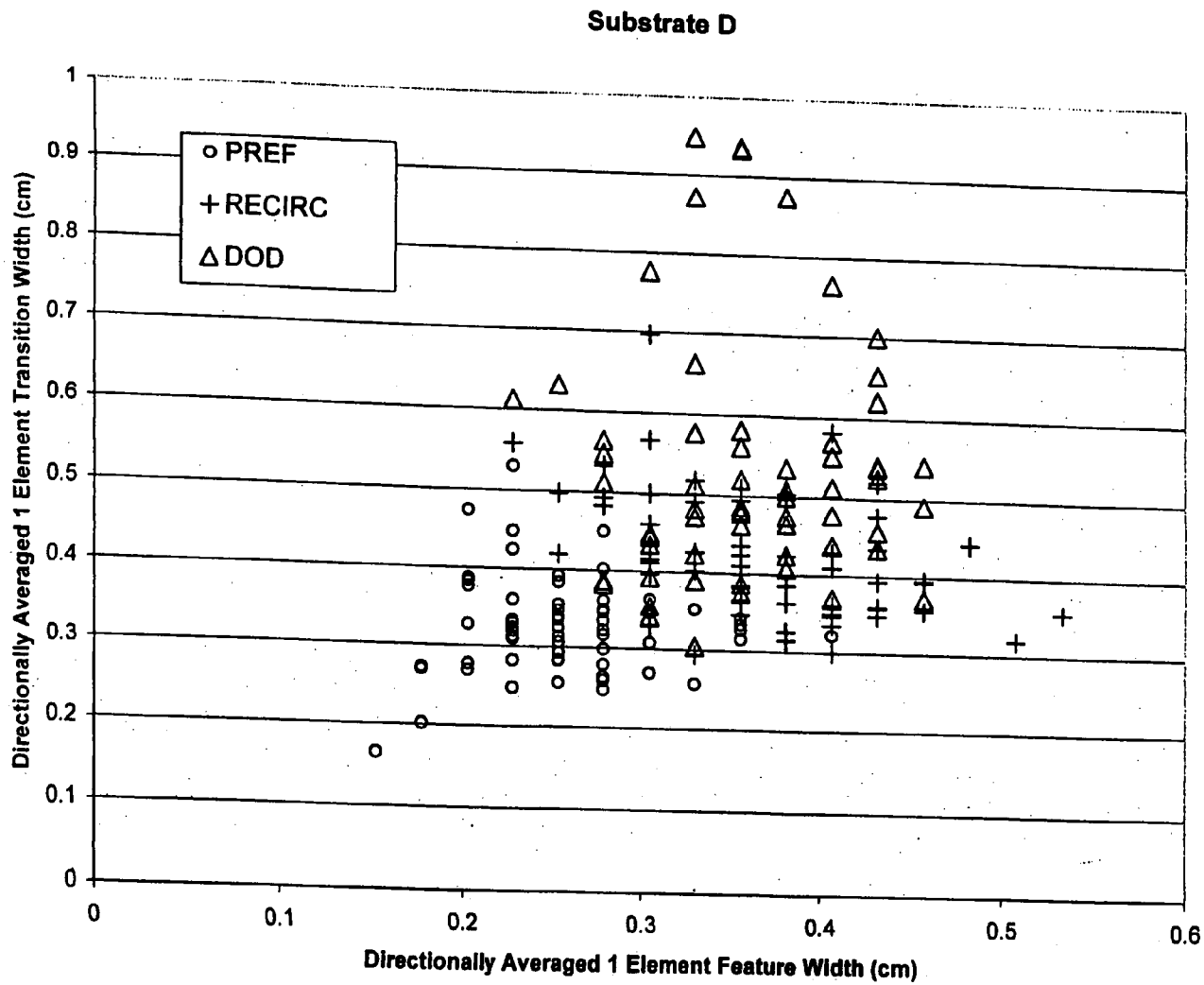
Figure 142:
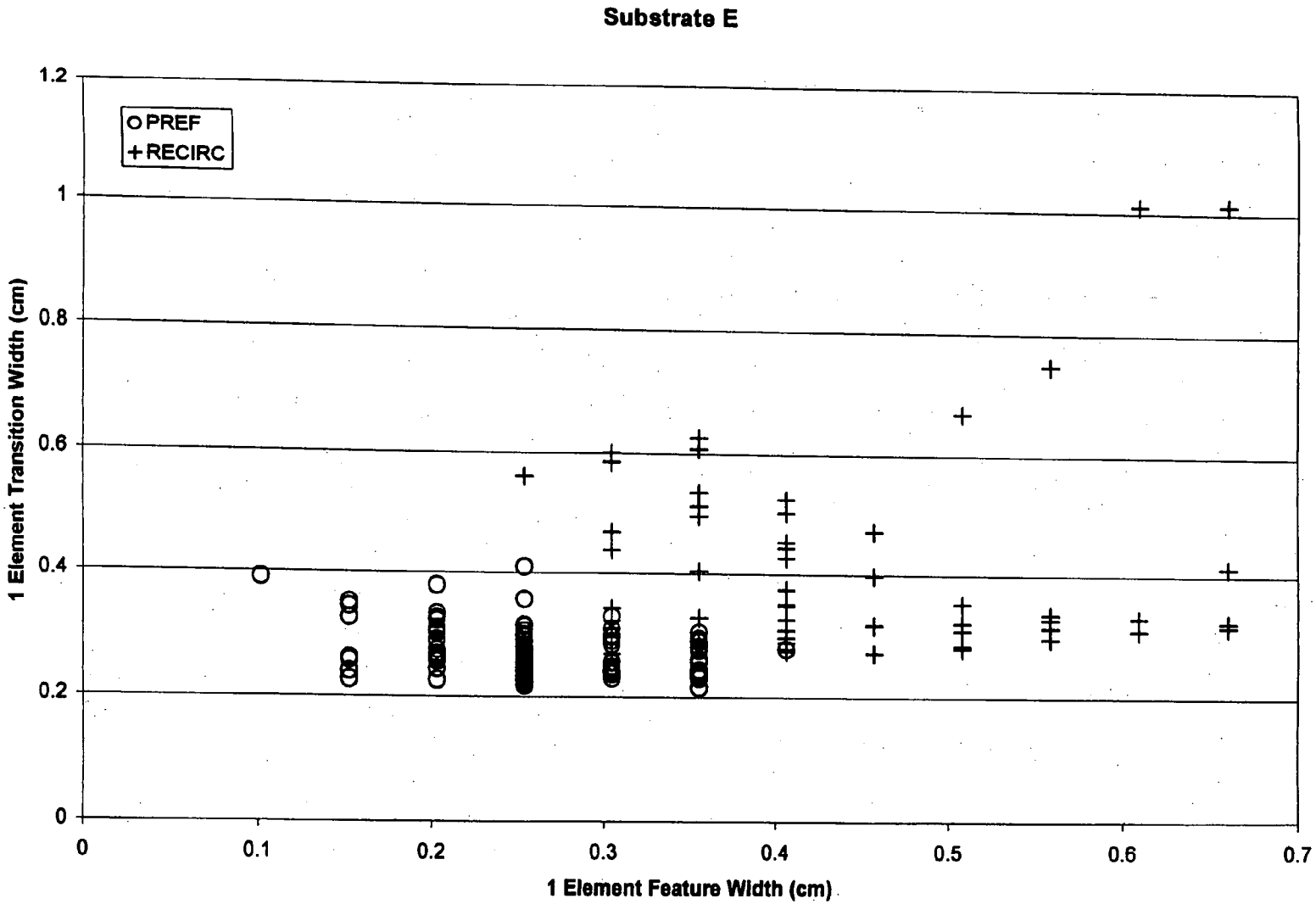
Figure 143:
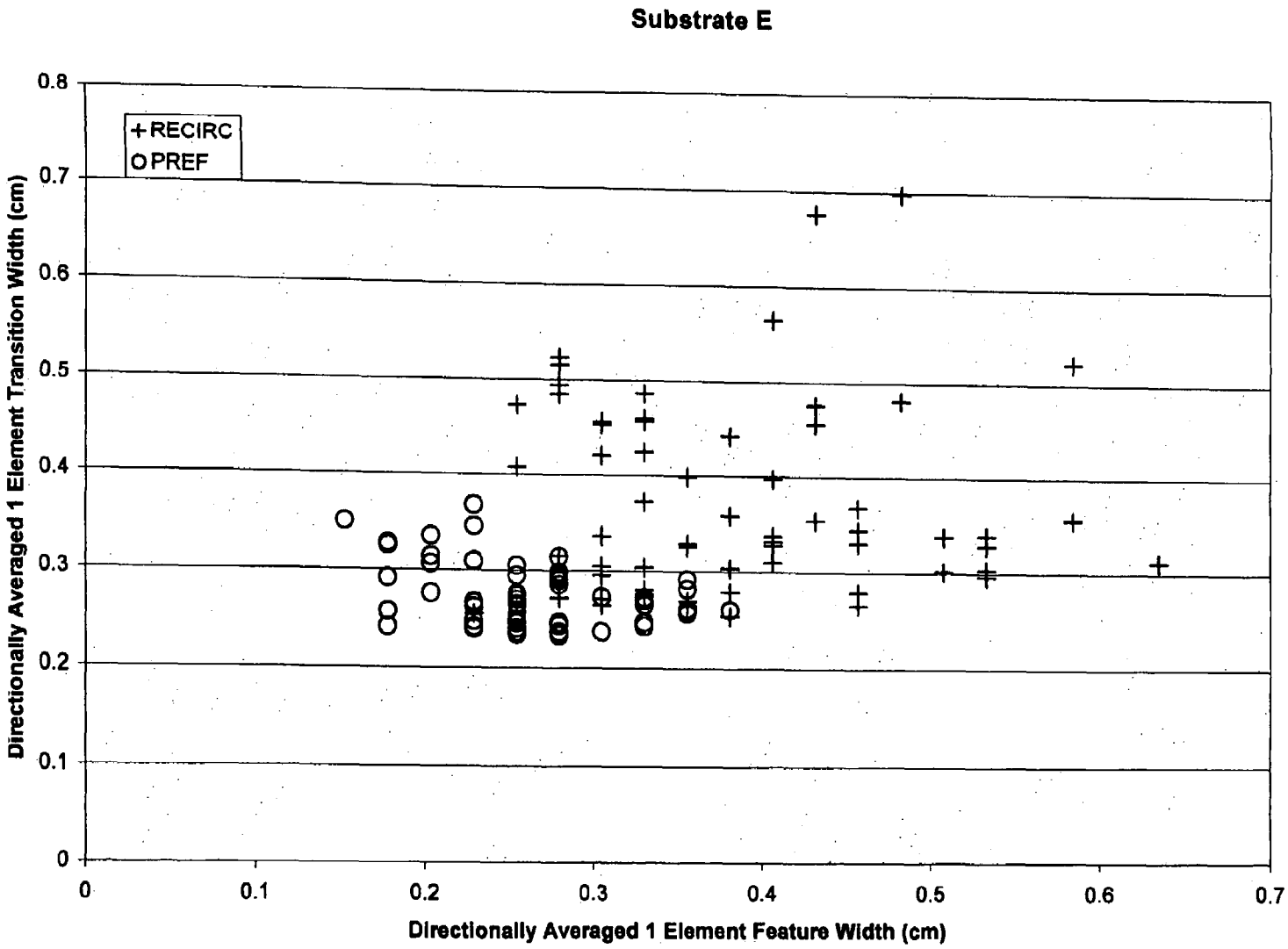
Figure 144:
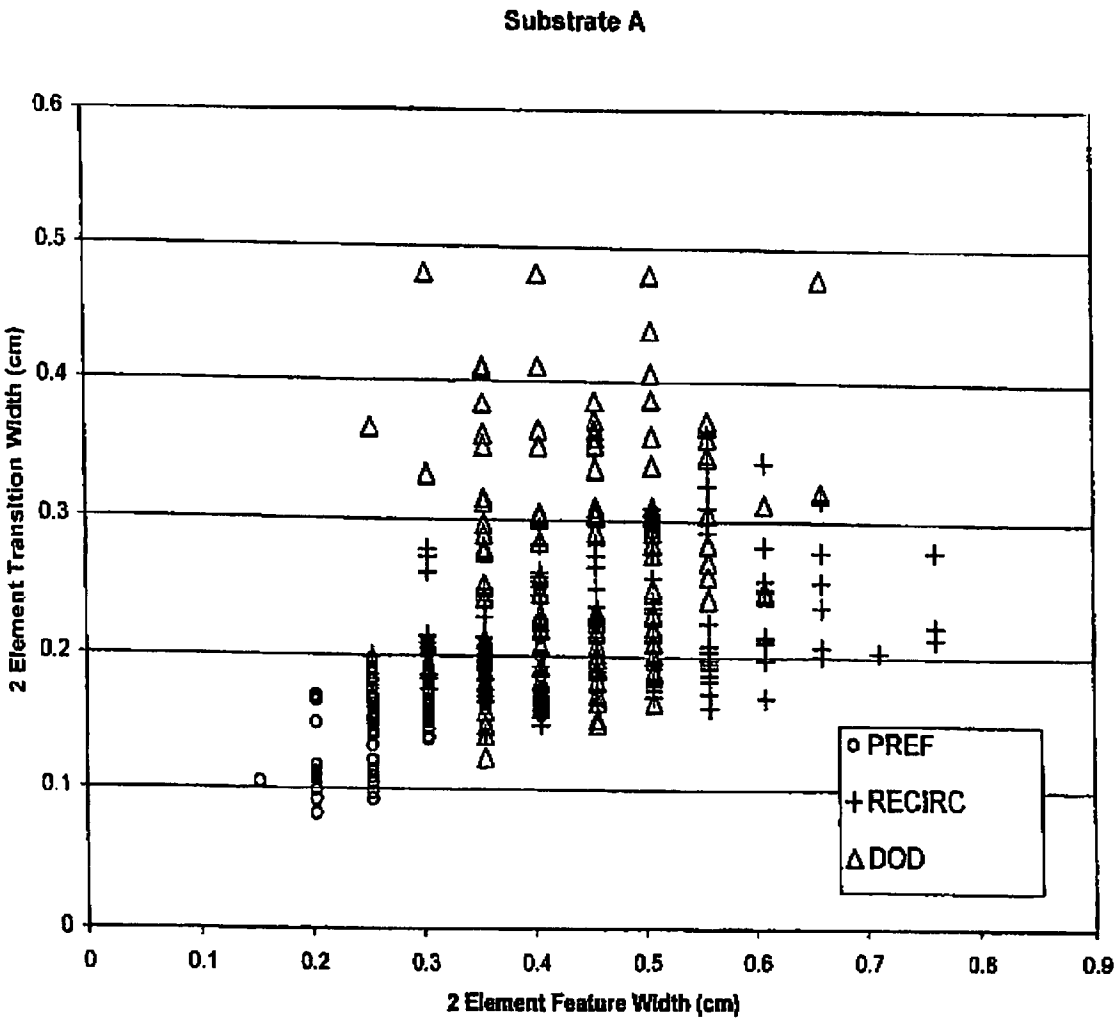
Figure 145:
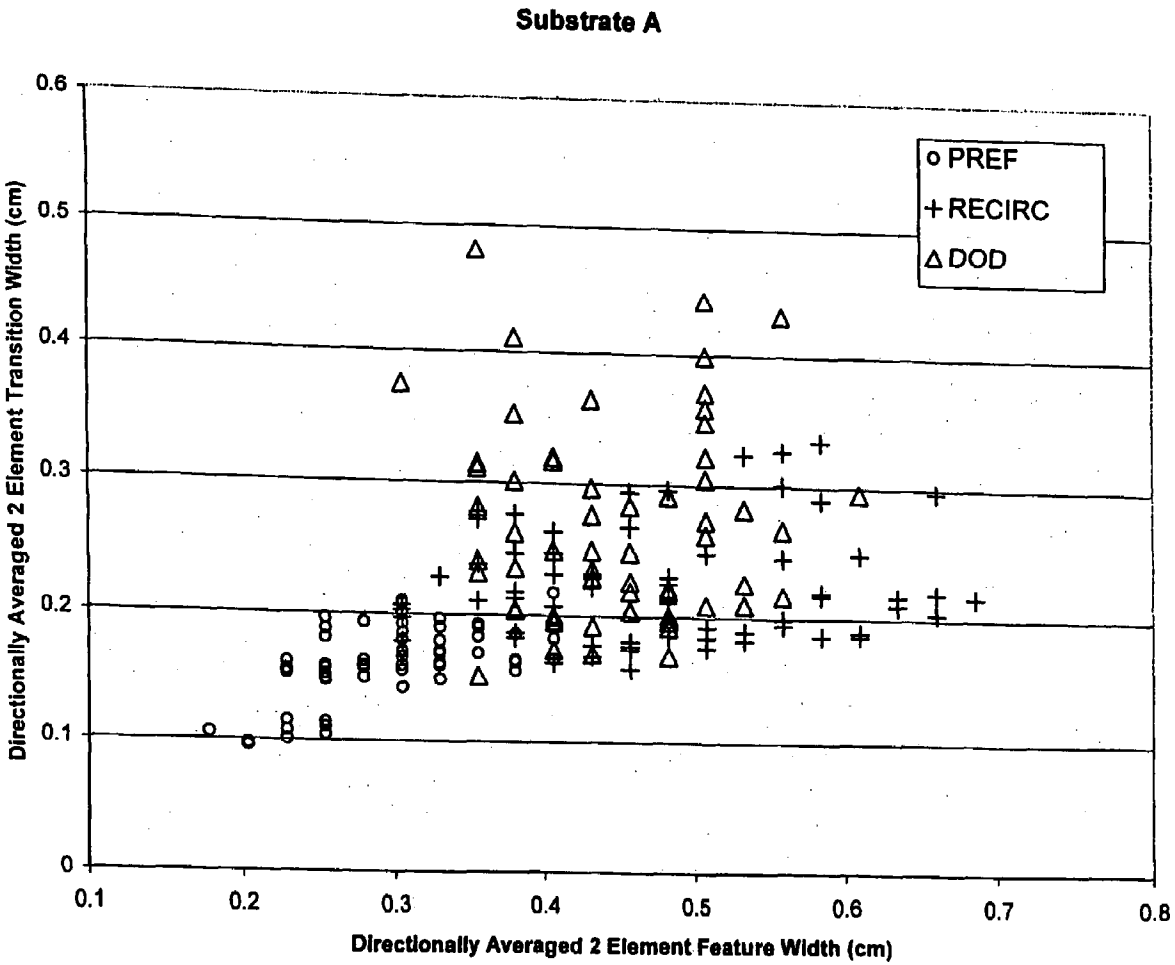
Figure 146:
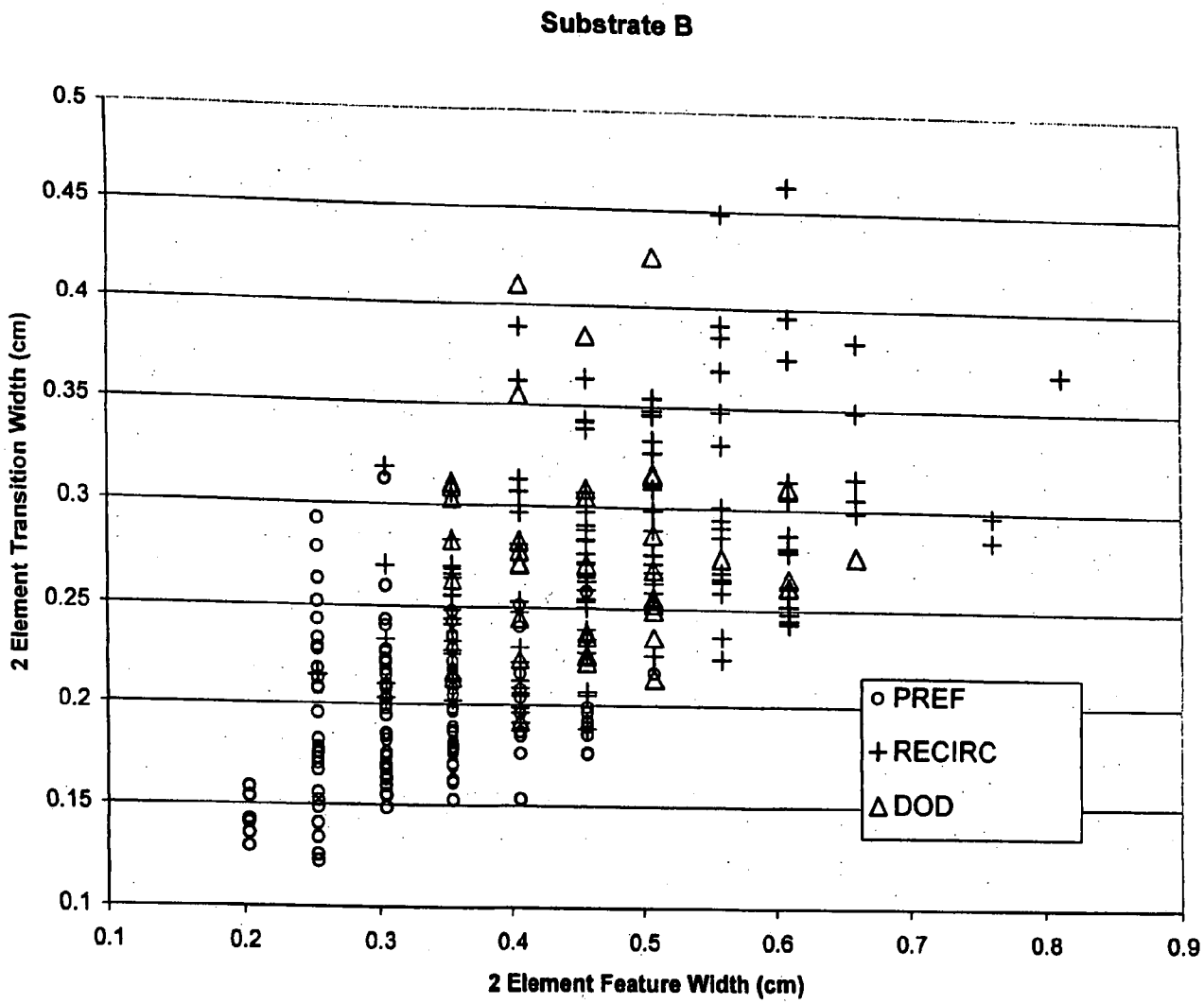
Figure 147:
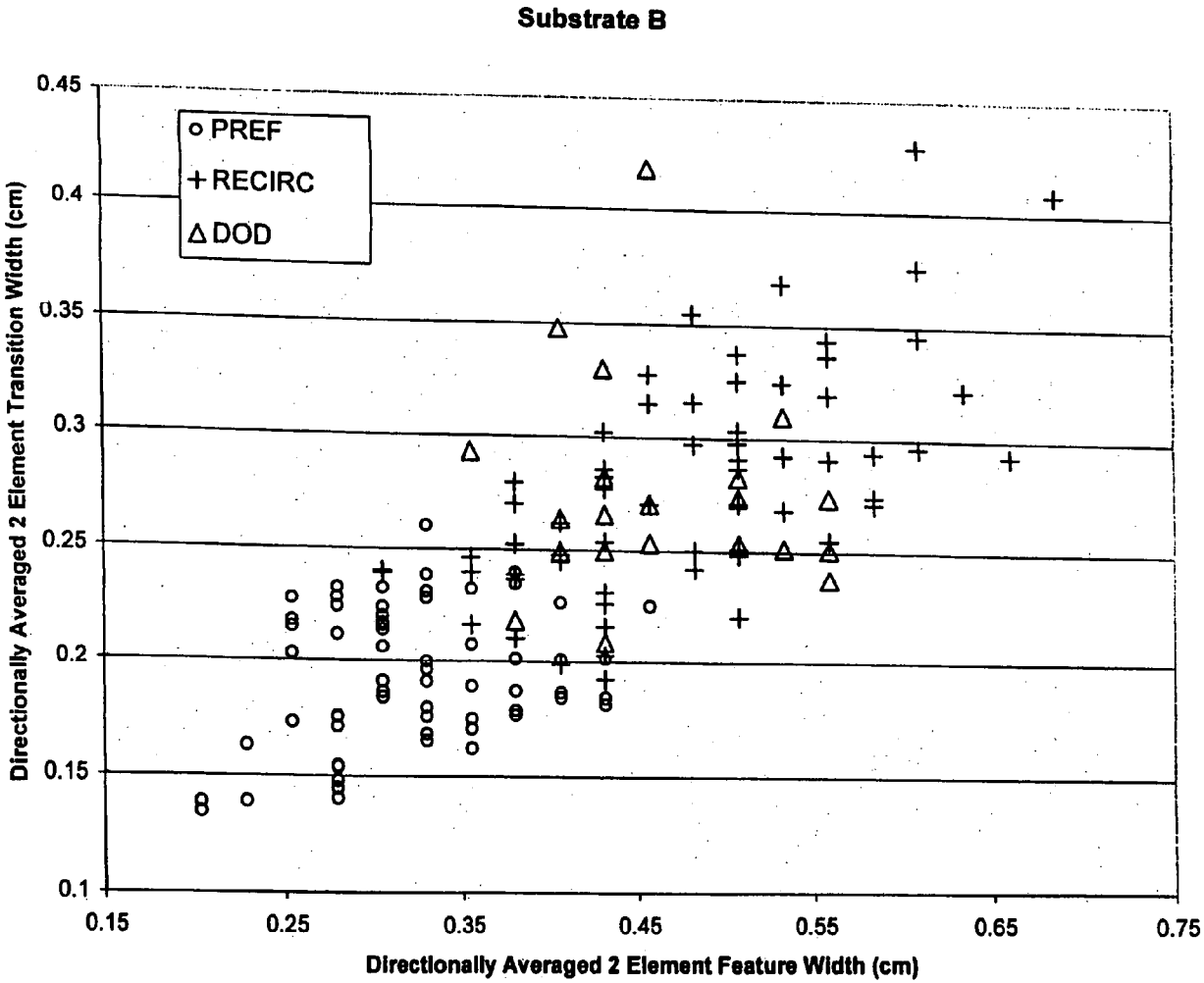
Figure 148:
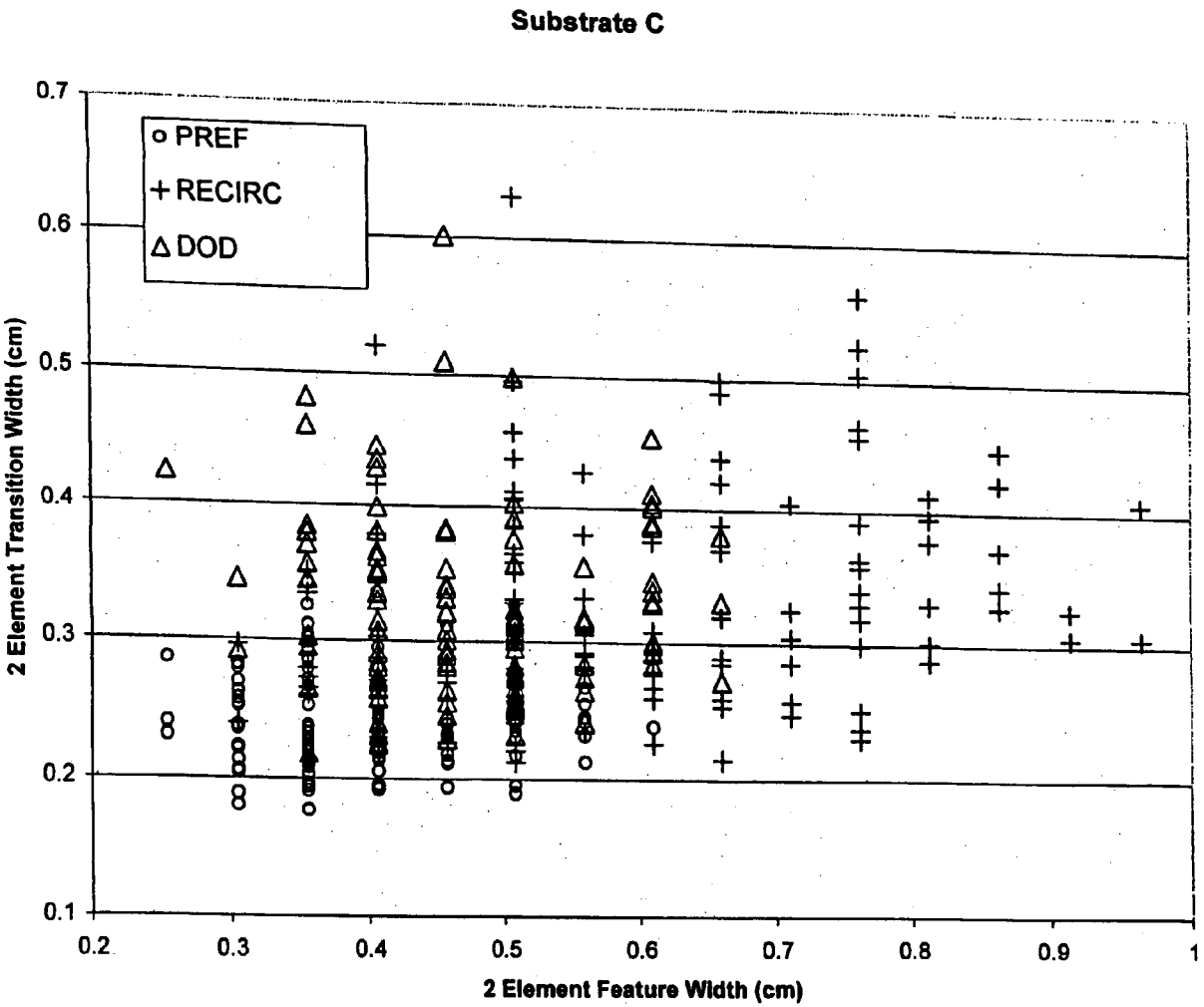
Figure 149:
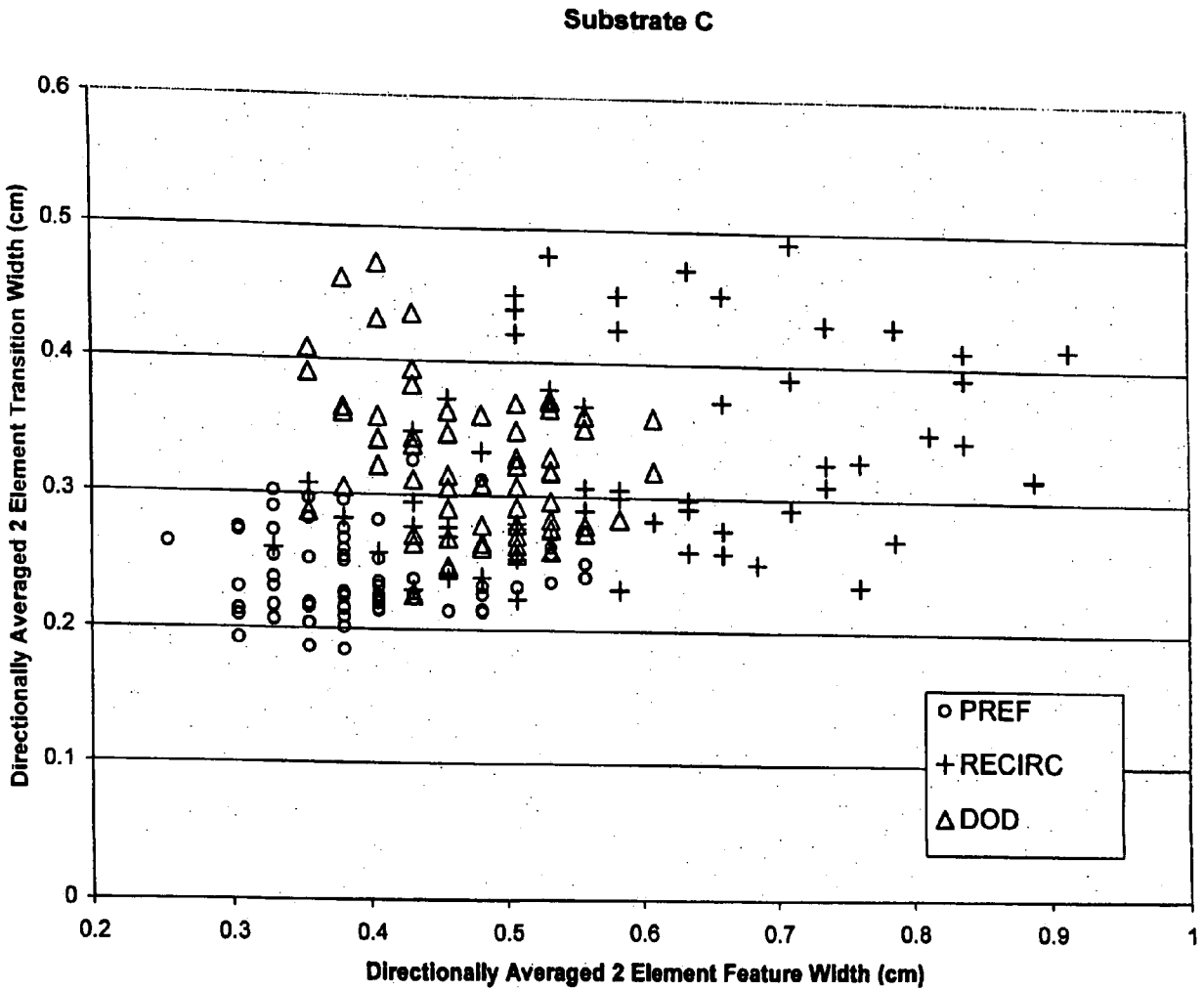
Figure 150:
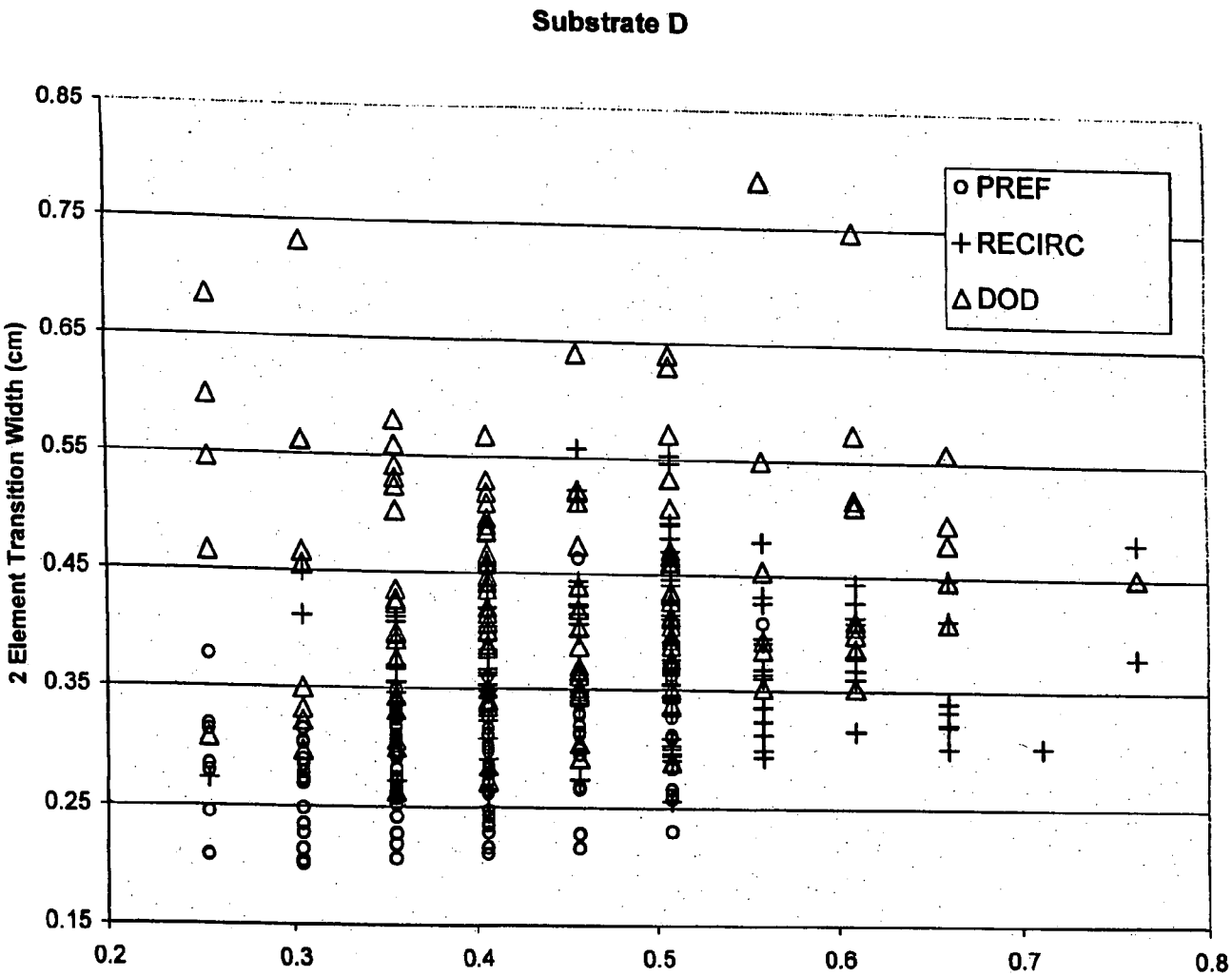
Figure 151:
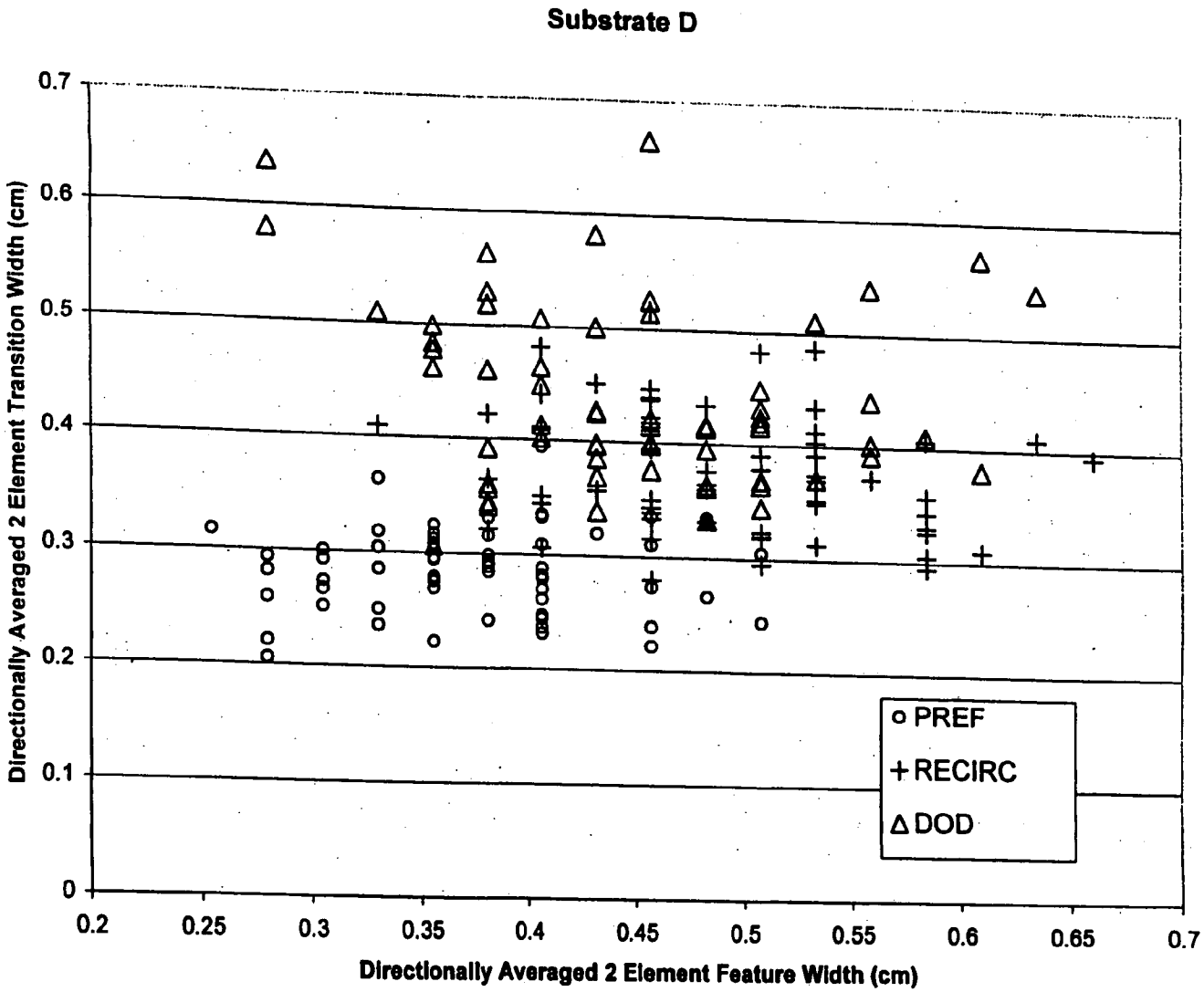
Figure 152:
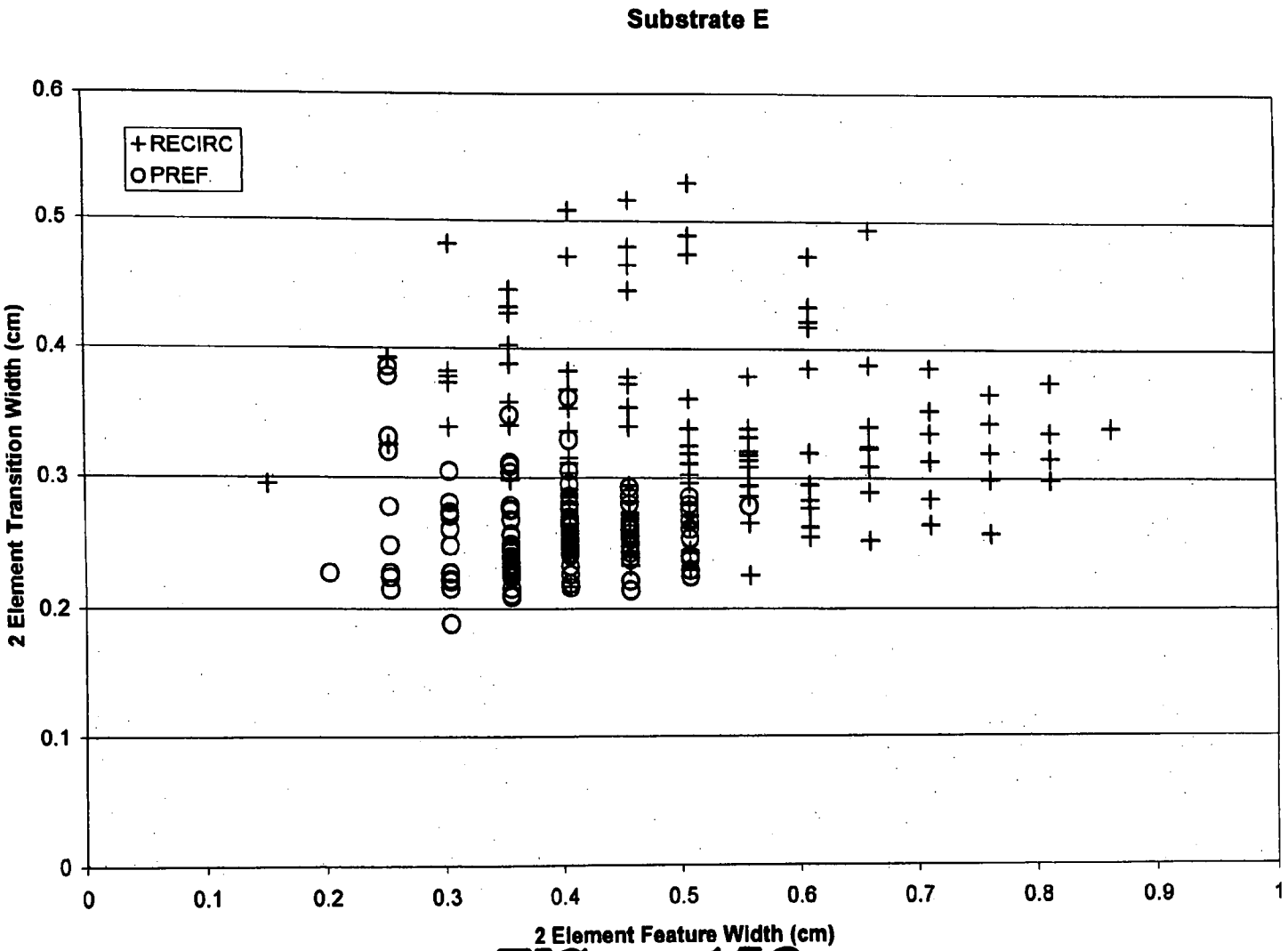
Figure 153:
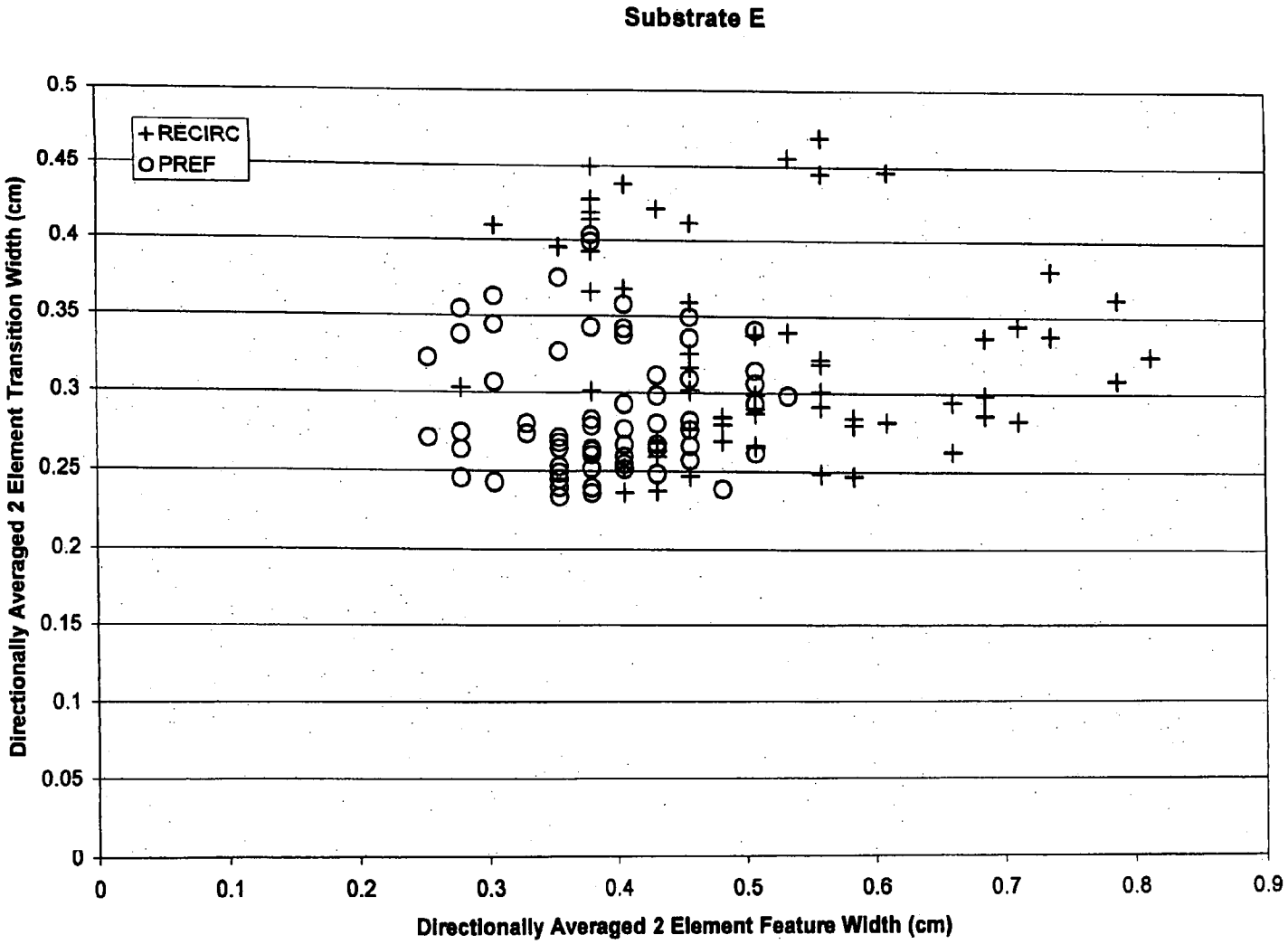
Figure 154:
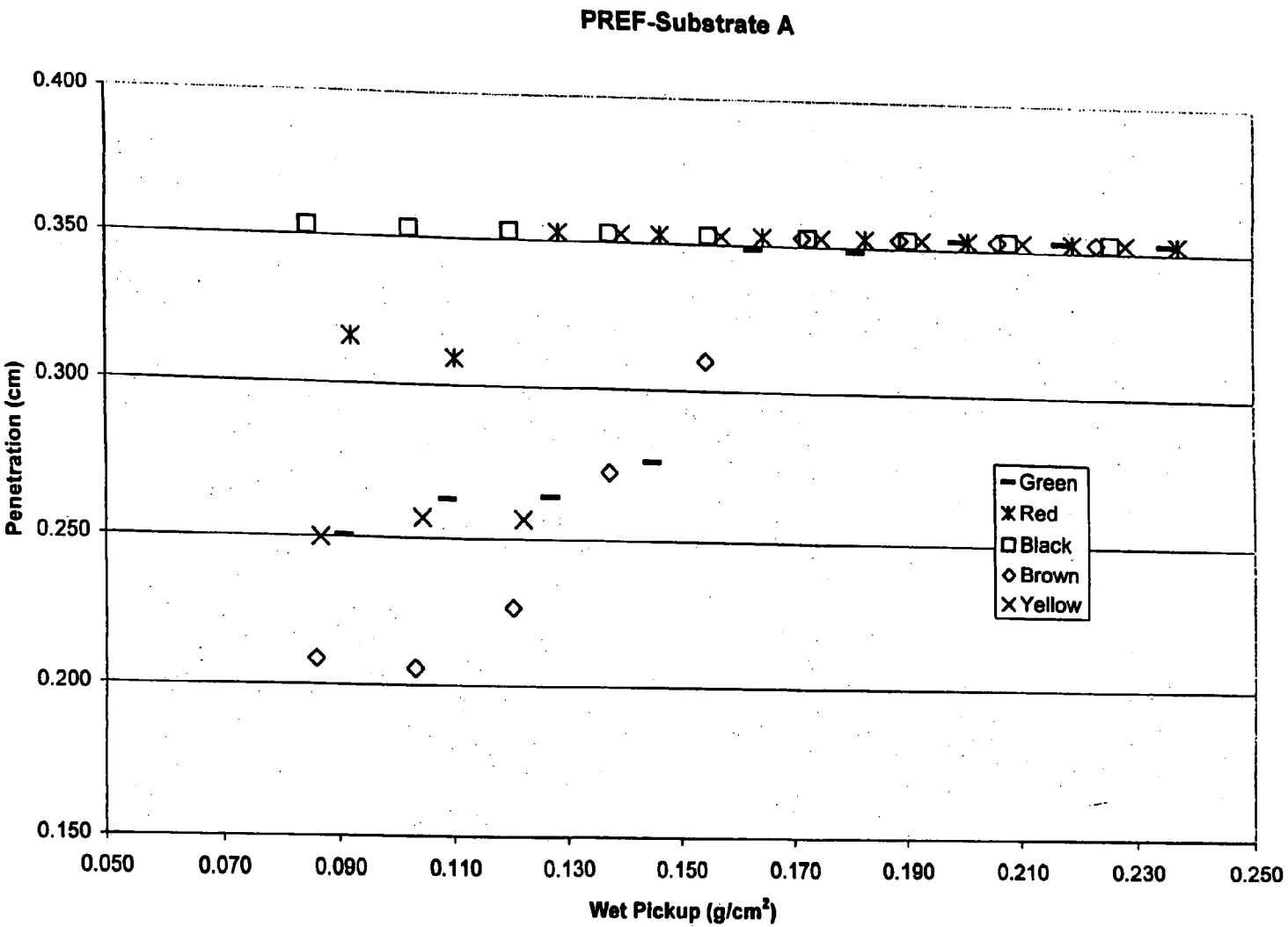
Figure 155:
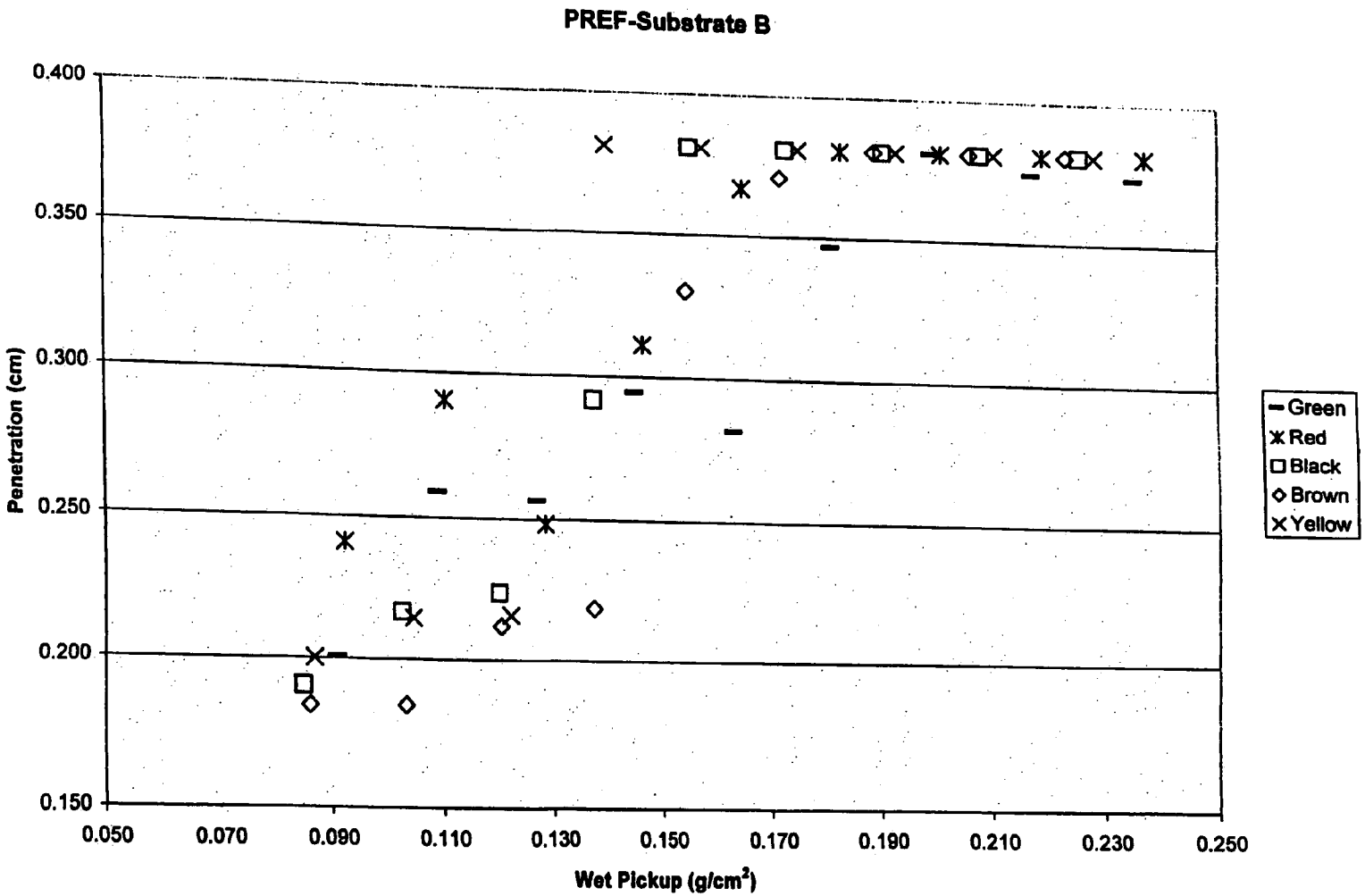
Figure 156:
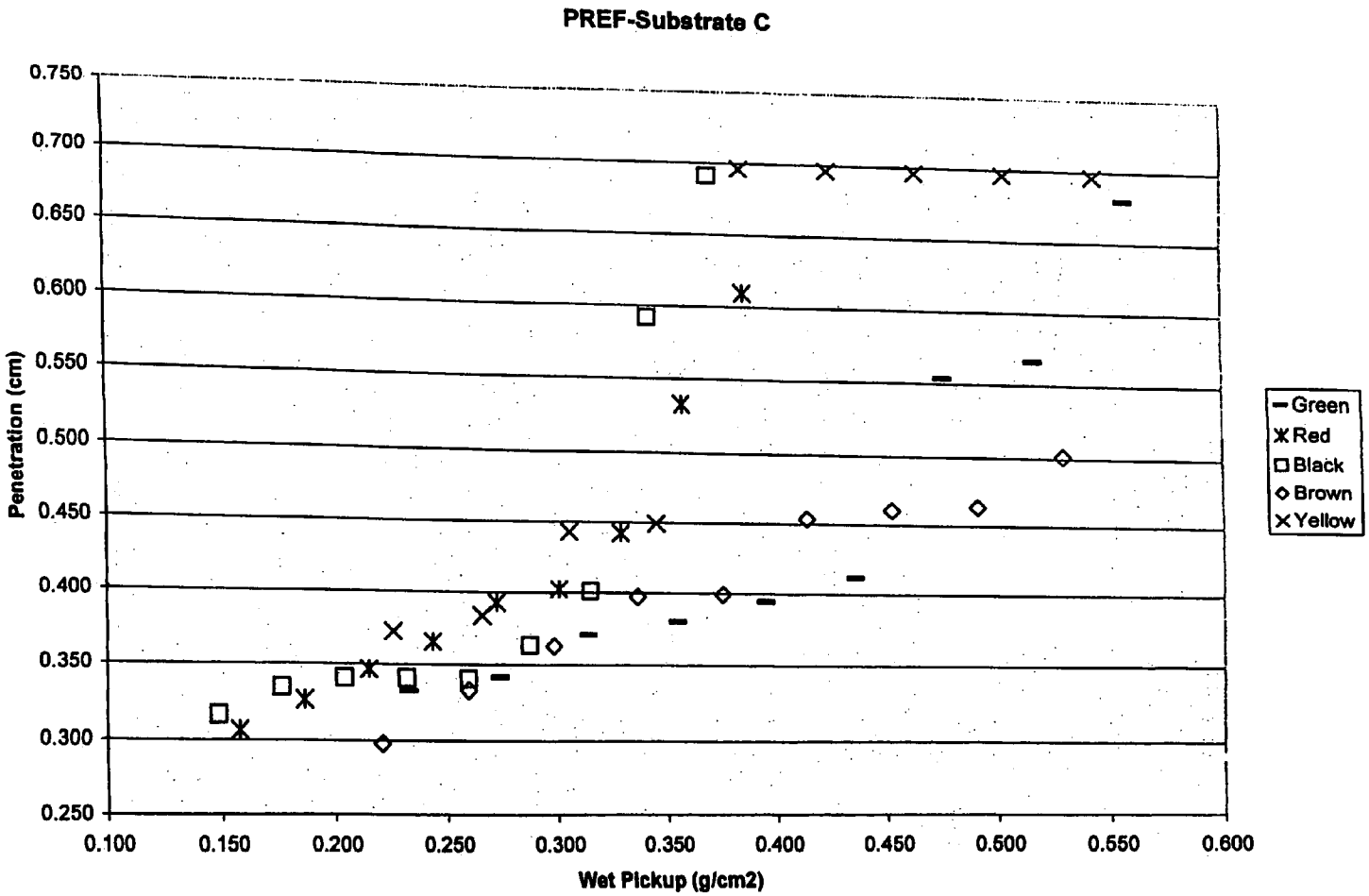
Figure 157:
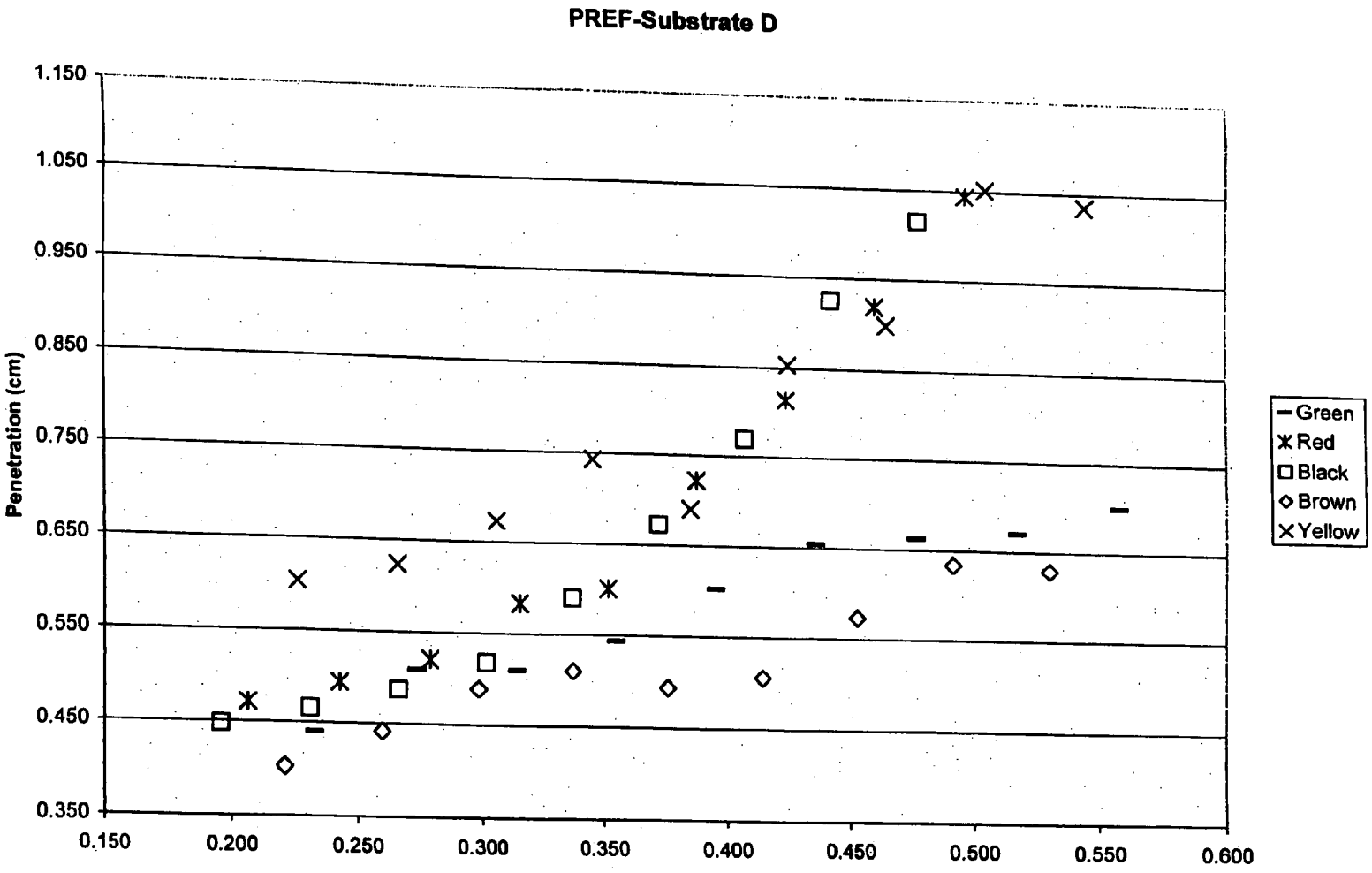
Figure 158:
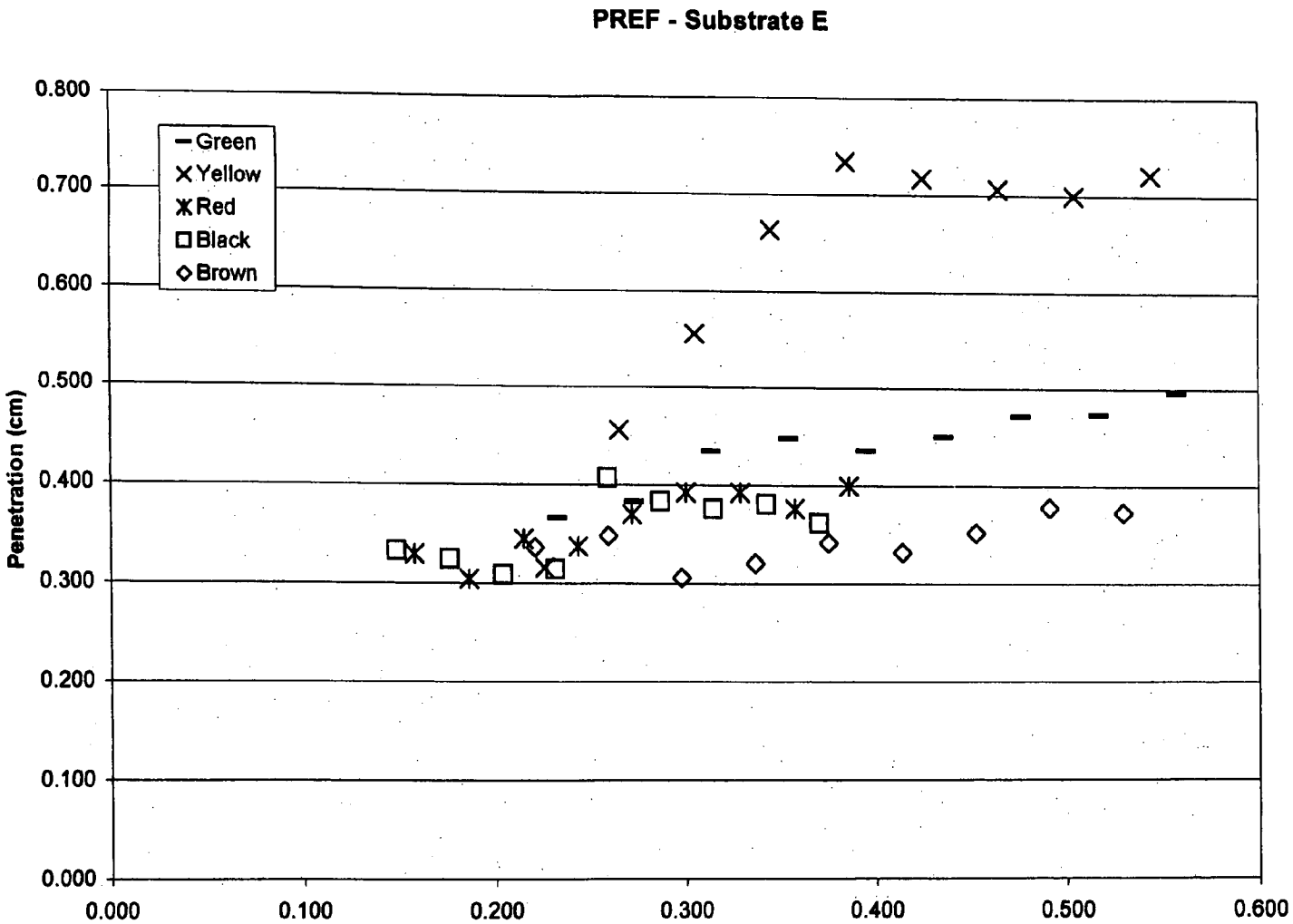
Figure 159:
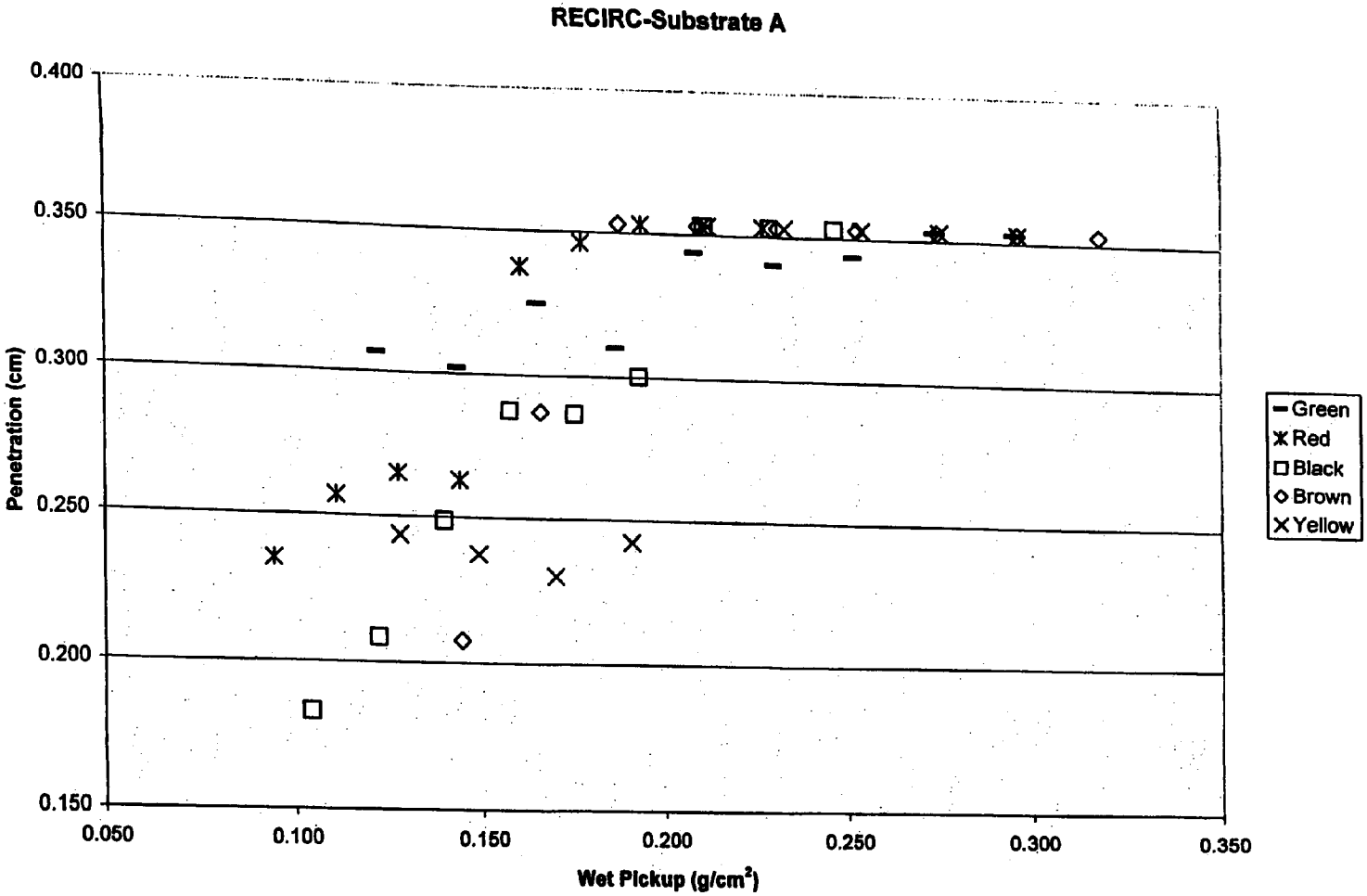
Figure 160:
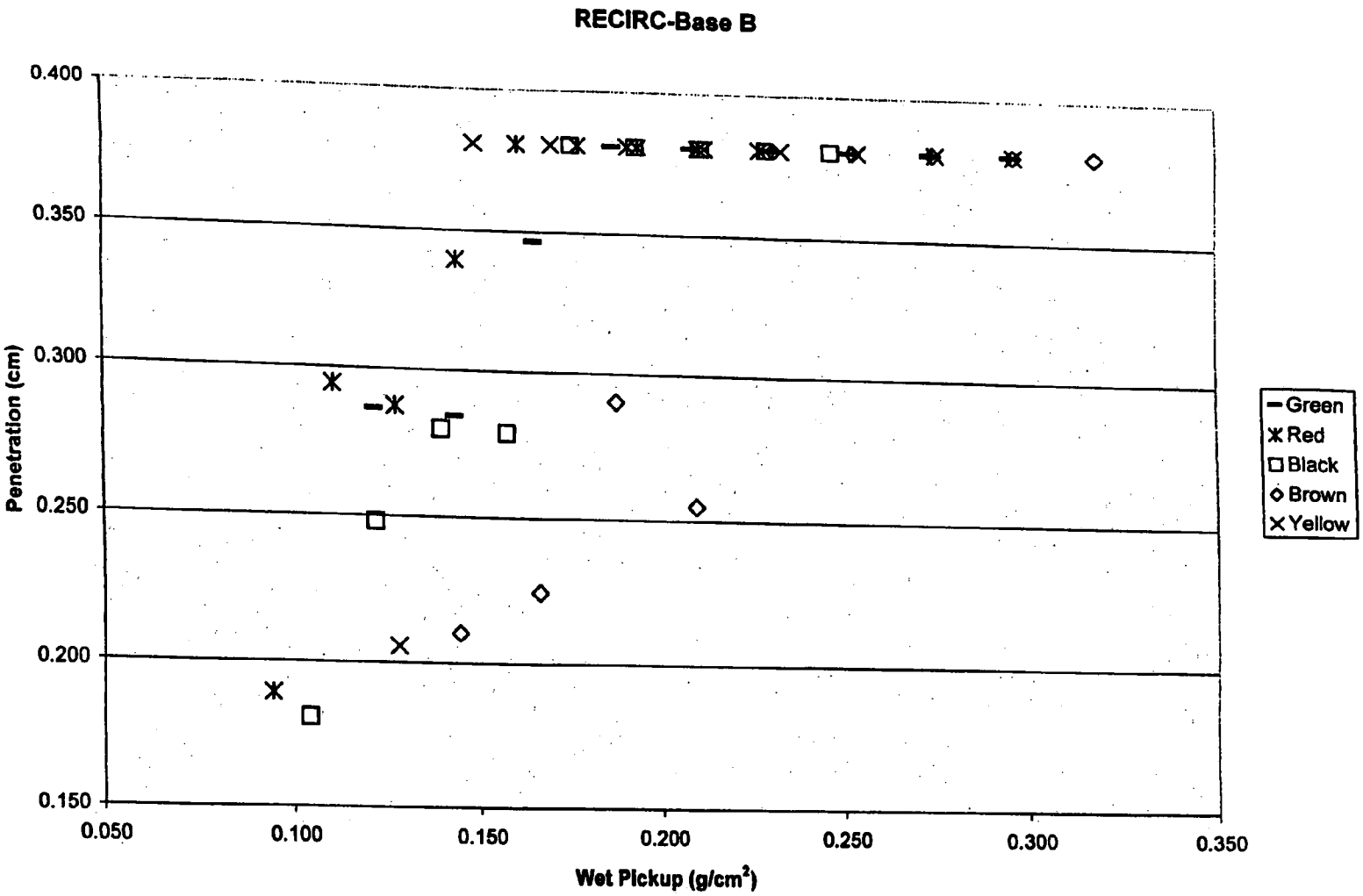
Figure 161:
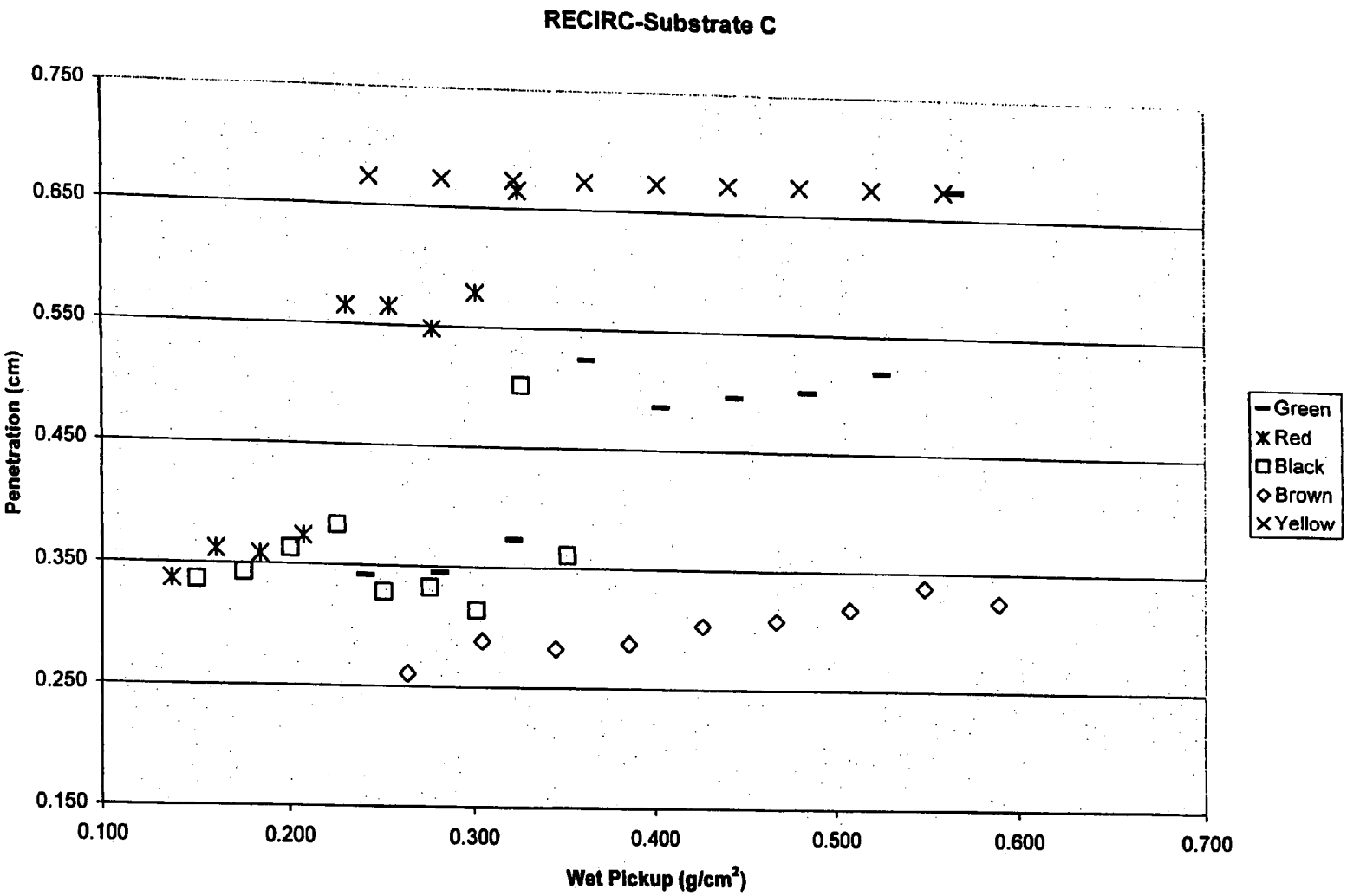
Figure 162:
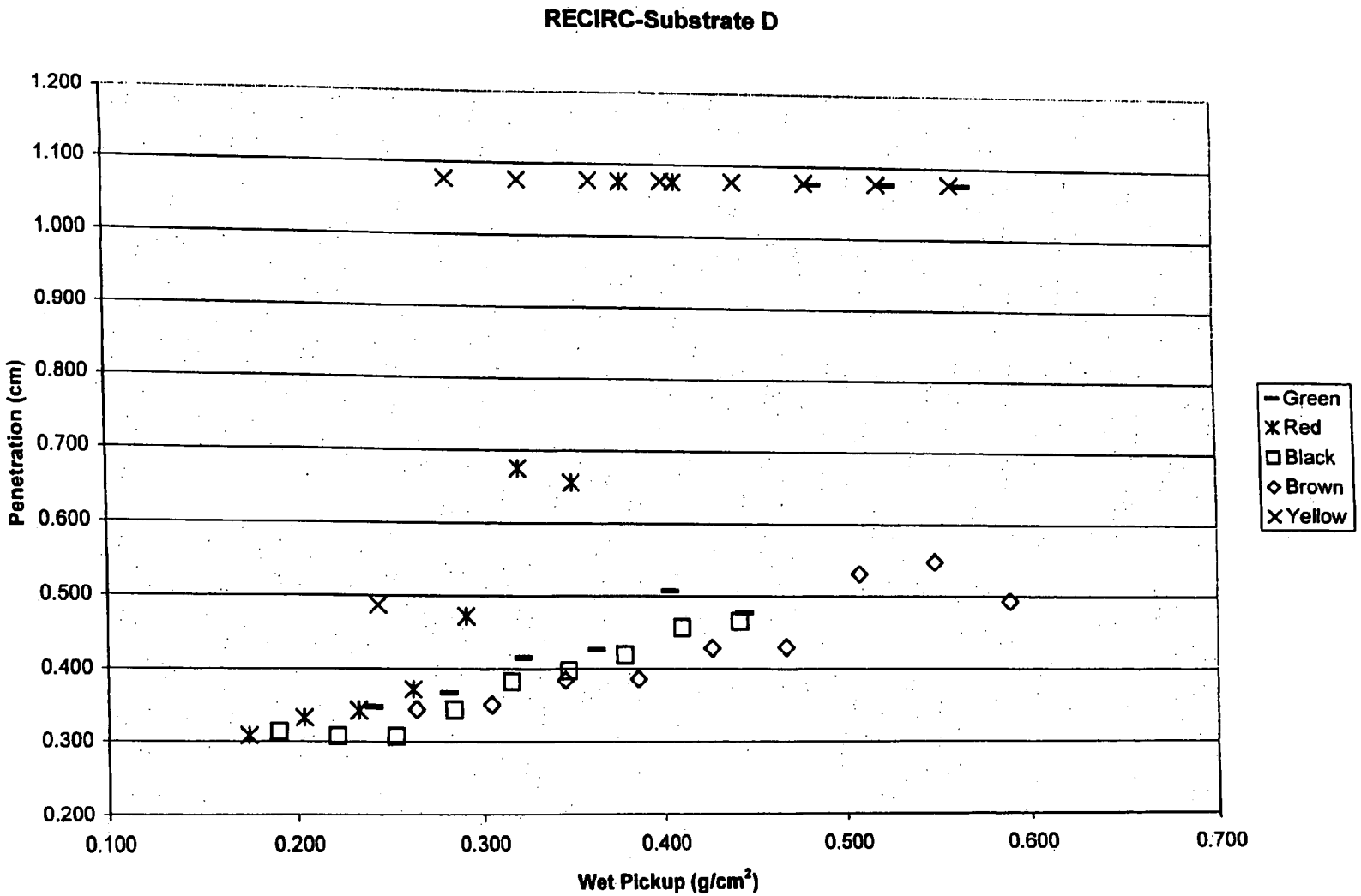
Figure 163:
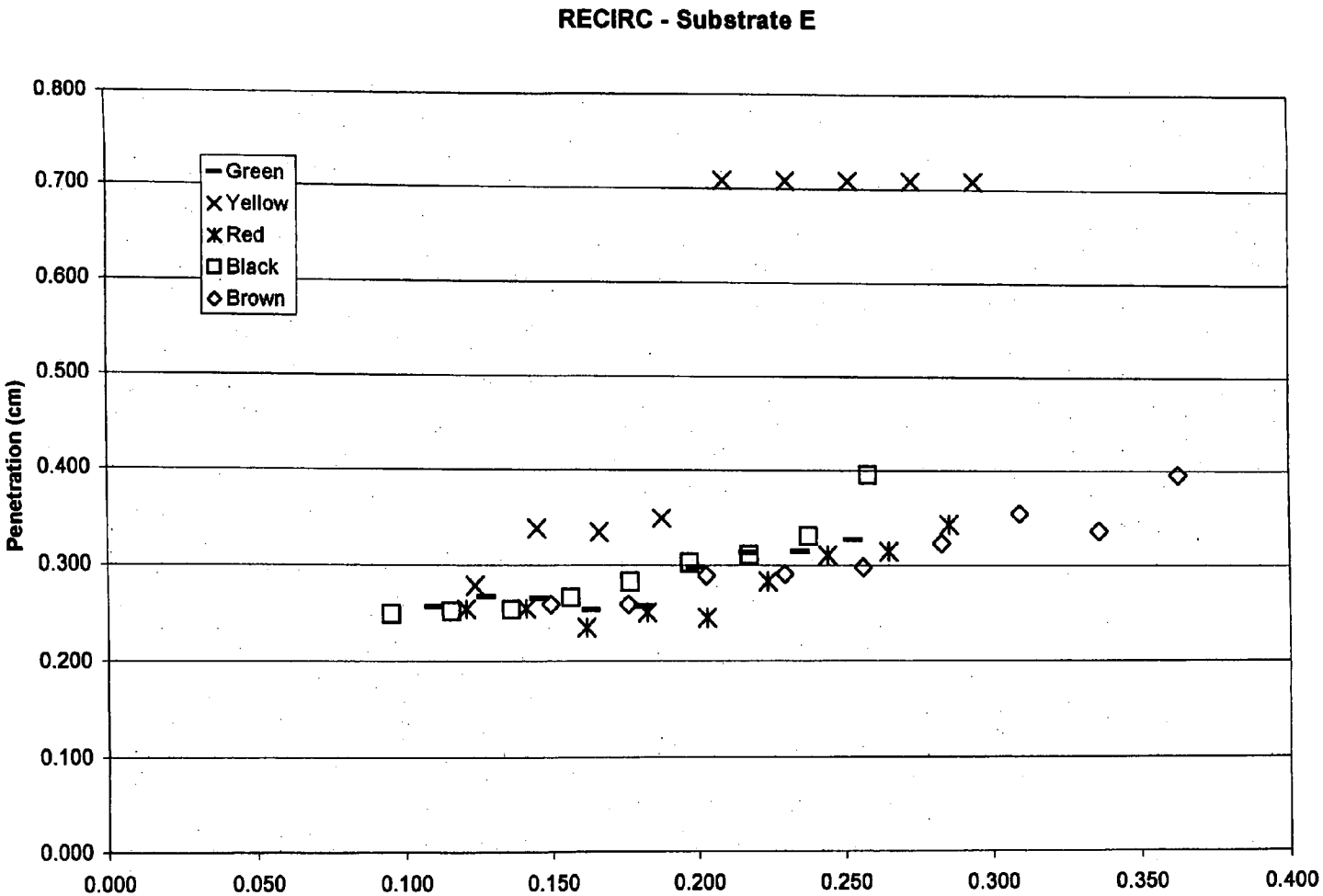
Figure 164:
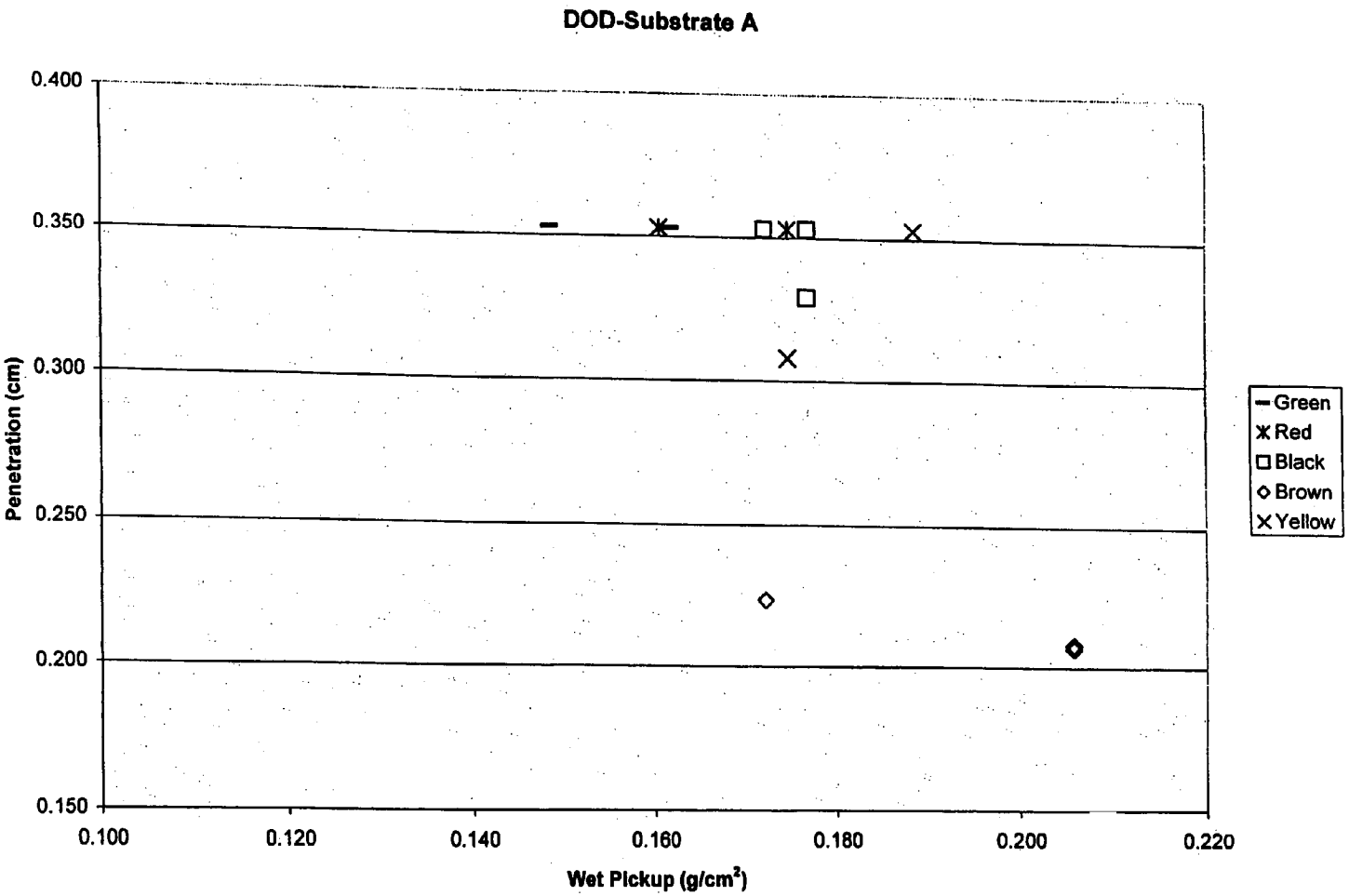
Figure 165:
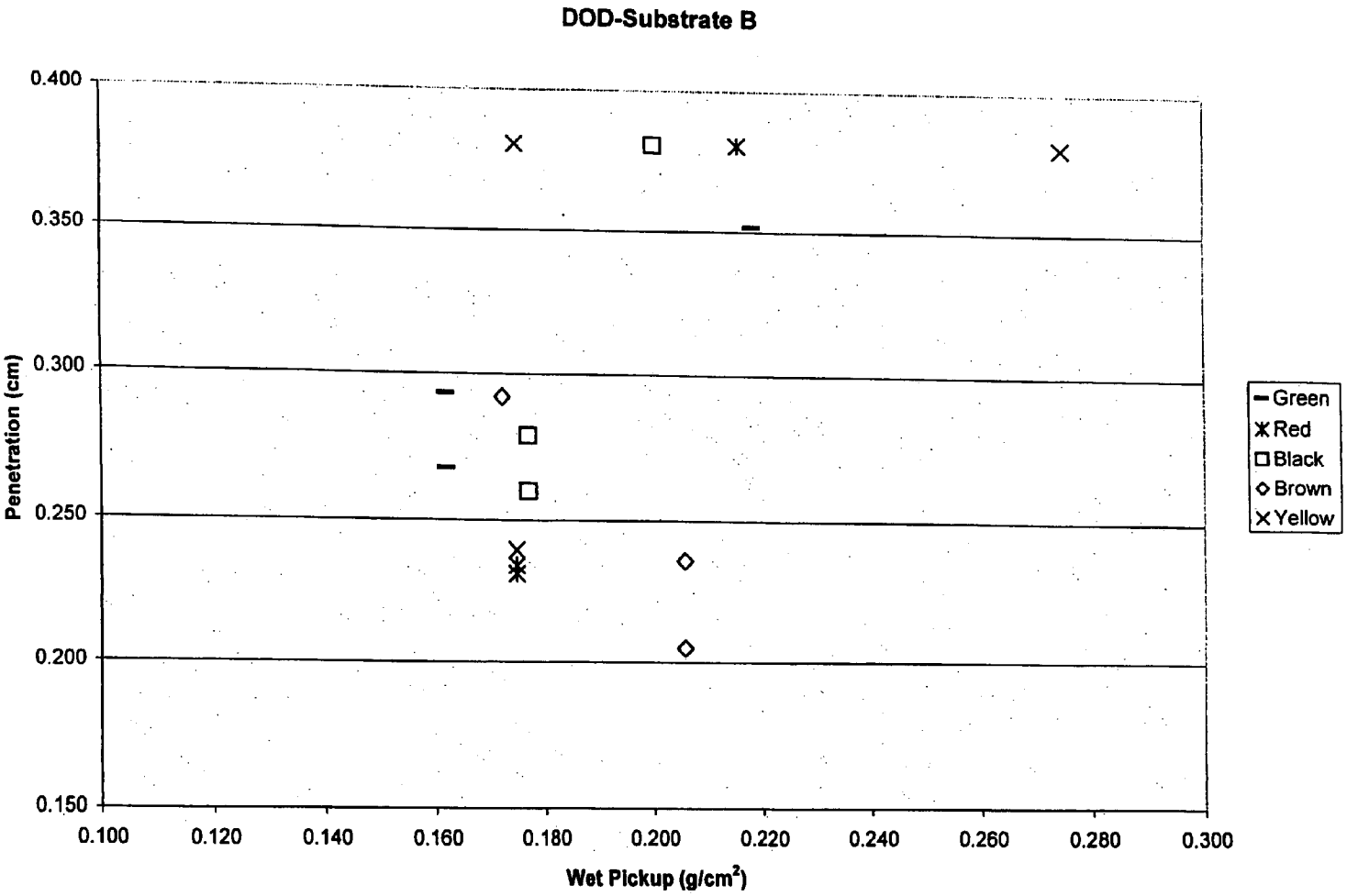
Figure 166:
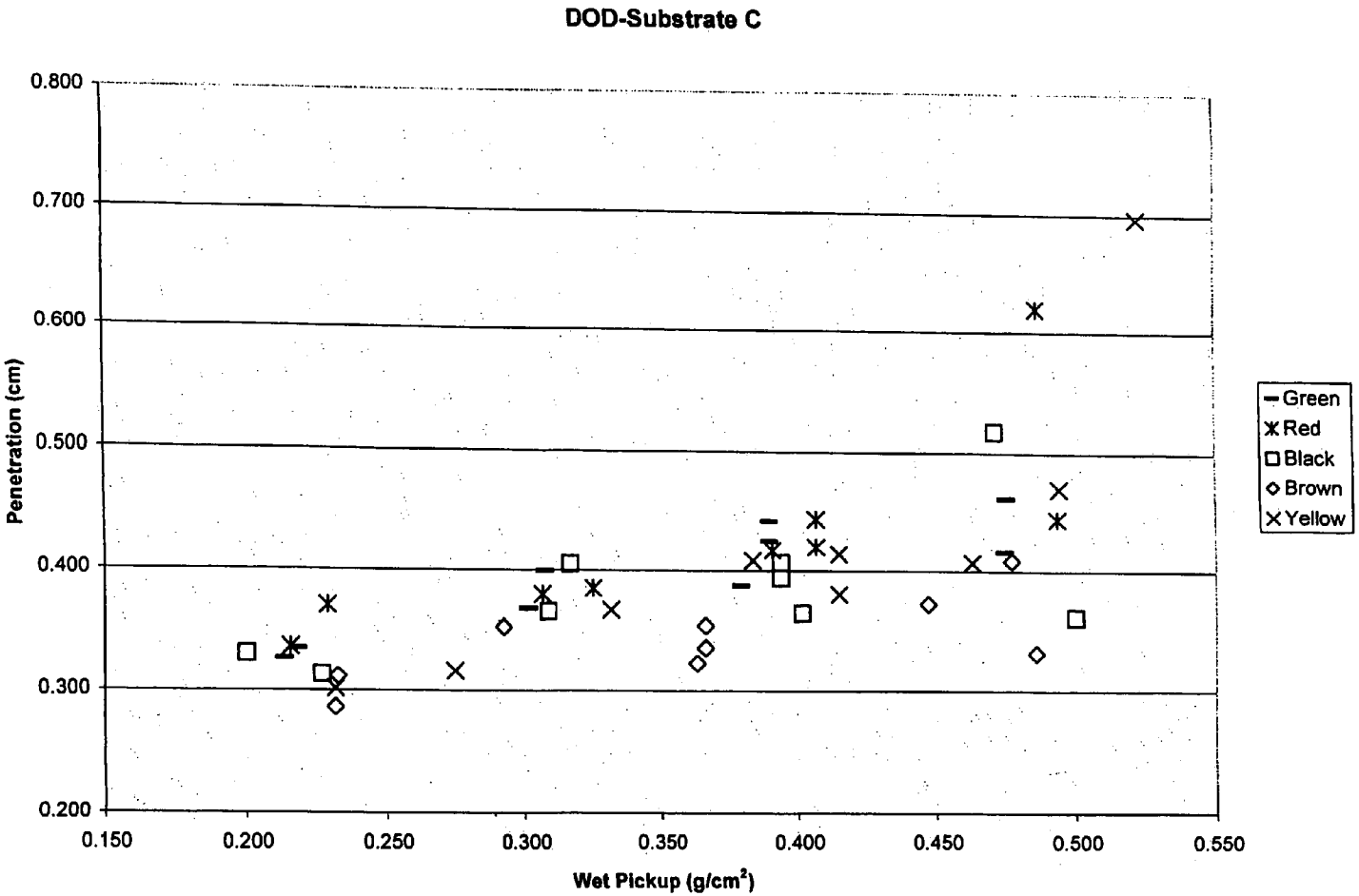
Figure 167:
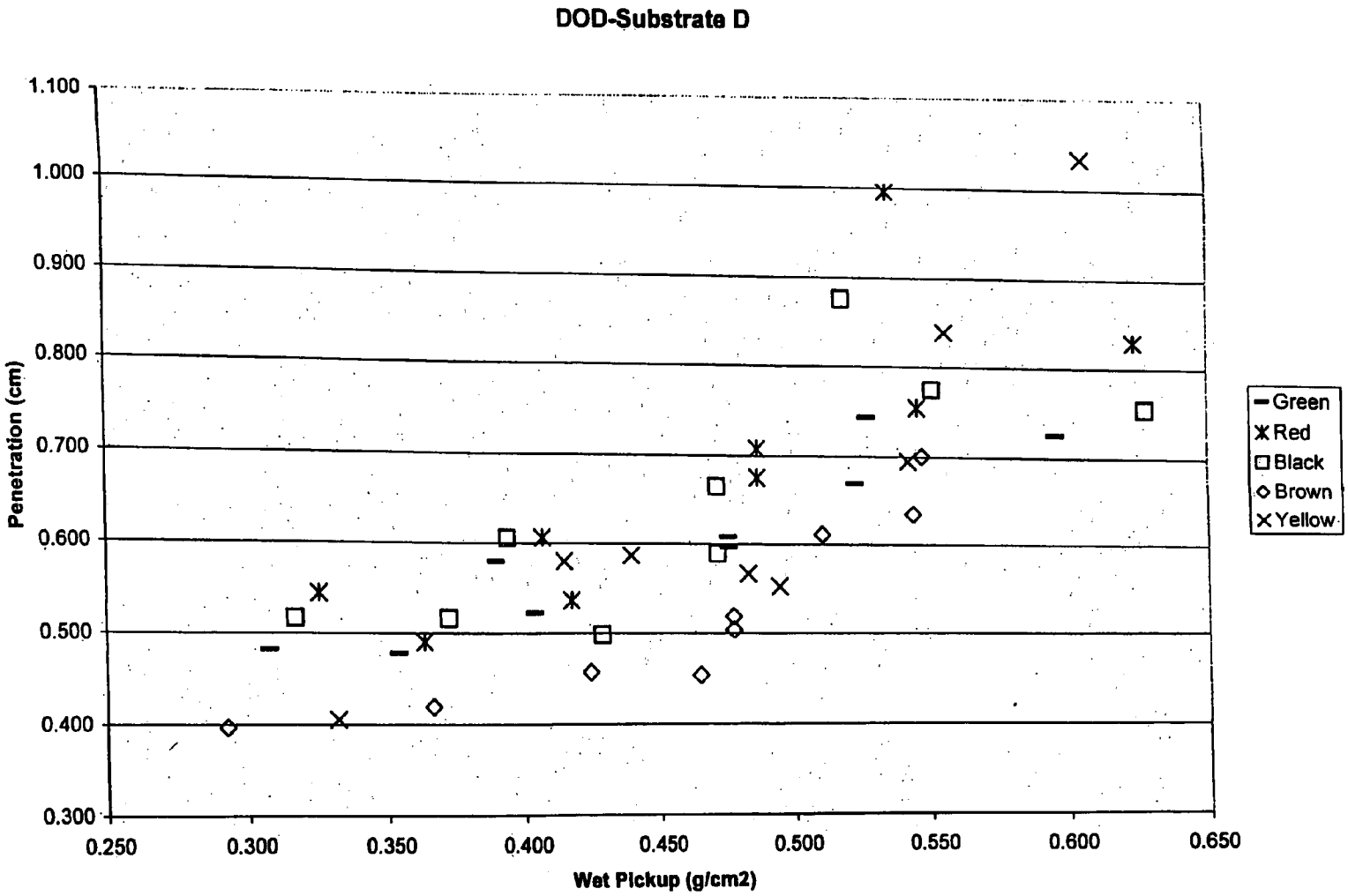

FIG. 130 shows Maximum Gauge as determined by calculating the reciprocal of the Directionally Averaged Minimum 1 Element Feature Width obtained from the previously discussed bar charts for each of the five substrates. As before, the spherical drop model provides a dividing line distinguishing the ability of the PREF patterning system from the RECIRC and DOD patterning systems in producing small 1 Element Feature Widths and thus relatively high effective print gauge. The single DOD data point that appears above the spherical drop prediction line is again due to a feature that has a relatively large Transition Width, and thus would not be considered a component of a high definition pattern. FIG. 131 shows the maximum wet pickup averaged print gauge for each substrate and patterning technology, calculated from the reciprocal of the minimum values of the Directionally and Wet Pickup Averaged 1 Element Feature Widths taken from the previously discussed bar charts. At the average wet pickup for the given bases, the PREF patterning system is clearly capable of producing a higher gauge (or smaller 1 Element Feature Widths) than either the DOD or RECIRC patterning systems. Thus, use of the spherical drop model here provides a clear dividing line between the ability of PREF to print small 1 Element Feature Widths and the ability of DOD and RECIRC patterning systems to print corresponding features. The bar charts clearly indicate that the PREF system is able to print smaller 1 Element Feature Widths for some dominant colors than is possible for either the DOD or the RECIRC patterning systems. To characterize this property, FIGS. 132-133 show, for any dominant color on a given substrate for each patterning system, the smallest value of the Minimum 1 Element Feature Width (in either direction or directionally averaged) that was measured, plotted against the Average Wet Pickup for that substrate. It is clear that the Directionally Averaged Minimum 1 Element Feature Widths obtained for the PREF patterning system are smaller than for either DOD or RECIRC systems. Looking at these plots generally, a line can be drawn that separates the smallest 1 Element Feature Widths that the DOD and RECIRC technologies can print from the corresponding 1 Element Feature Widths that the PREF printing system can generate. The equation for this separating line shown in FIG. 132 for the Minimum 1 Element Feature Width in any direction versus average substrate wet pickup is given below.

(nylon 6,6)

$$FW_{1\ element,\ min,\ any\ direction}(\text{cm})=0.16\cdot[\text{Average Substrate Wet Pickup}(\text{g/cm}^2)]+0.12$$

The corresponding line for the directionally averaged minimum 1 element Feature Width, FIG. 133, is given by (nylon 6,6)

$$FW_{1\ element,\ min,\ directionally\ averaged}(\text{cm})=0.081\cdot[\text{Average Substrate Wet Pickup}\ (\text{g/cm}^2)]+0.188$$

Looking at the data generated from Substrate E (i.e., the 80% wool/20% nylon 6,6 pile), the degree of dye penetration was typically less than the corresponding dye penetration observed in Substrates A through D (100% nylon 6,6 pile). As explained earlier, because of this resistance to penetration observed with pile comprised of wool, there is a tendency for the dye to remain at or near the surface of the pile, thereby enhancing the opportunity for the dye to migrate or bleed laterally and causing an increase in the Feature Width associated with that pattern feature, as compared with a similarly-constructed substrate with pile elements comprised primarily or exclusively of nylon 6,6 (see FIG. 132).

(wool)

$$FW_{1\ element,\ min,\ any\ direction}(\text{cm})=0.089\cdot[\text{Average Substrate Wet Pickup}(\text{g/cm}^2)]+0.12$$

The corresponding line for the directionally averaged minimum 1 element Feature Width, FIG. 133, is given by (wool)

$$FW_{1\ element,\ min,\ directionally\ averaged}(\text{cm})=0.045\cdot[\text{Average Substrate Wet Pickup}\ (\text{g/cm}^2)]+0.188$$

Up to this point in the data discussion, the patterning performance of the PREF patterning system has been compared with the DOD and RECIRC systems by using only a single parameter (i.e., Transition Width or Feature Width). However, the real advantage of the PREF patterning system is the ability to provide superior properties across multiple patterning parameters or figures of merit. Desirable attributes for a patterned textile substrate are not only the presence of sharp edges on large contiguous pattern areas (i.e., Transition Widths, described previously), but also the presence in the patterned area of fine details with substantial color contrast with their neighboring pattern areas (i.e., Minimum Feature Widths). To obtain fine printed details along with substantial contrast of the fine element with its neighboring pattern areas, both a small Feature Width and a small Transition Width are required. To the extent that some manufacturers may choose not to print 1 element features in their products (for example, to assure that the desired feature appears in the pattern, in spite of blocked dye jets, etc.), 2 element feature properties will be introduced in the following graphs and discussion. It will be demonstrated that the PREF patterning system is capable of providing the smallest Transition Widths and Feature Widths for both the 1 element and 2 element pattern features, when compared with the RECIRC and DOD systems. A person skilled in the art will recognize that a 1 element and 2 element detail can be generally distinguished from each other in that a 2 element detail will have a width generally larger than twice the nominal print gauge of the print machine.

The two-dimensional charts that compare Feature Width and Transition Width for each of the printing technologies on Substrates A through E are FIGS. 134-153. These charts include all wet pickup data—the data have not been culled to represent the typical wet pickup ranges that are printed for each substrate. Because it includes all wet pickup data, the charts will tend to represent the ability of each of the print technologies to get finer, sharper print details by lowering the wet pickup. The charts will show, for each of the selected substrates in sequence, first the 1 Element Transition Width plotted against the corresponding 1 Element Feature Width for all dominant colors features (raw data shown for both the horizontal and vertical print directions), and second the Directionally Averaged 1 Element Transition Width data plotted versus the Directionally Averaged 1 Element Feature Width data. Note that these data do NOT include wet pickup averaging or finding minimum values. It is the raw data and therefore tends to show how the majority of PREF, RECIRC and DOD data are clustered in this parameter space. The same order and sequence of charts will be shown for the 2 element feature data, below.

Inspection of FIGS. 134-153 shows a general trend. The PREF system 1 element and 2 element features tend to be clustered toward the low Transition Width and low Feature Width portion of the charts for both 1 element and 2 element features. The DOD and RECIRC system Feature Widths and Transition Width pairs tend to be more widely scattered, demonstrating the inherent difficulty of obtaining both good Feature Width and Transition Width for these print technologies. The clustering of the Feature Width and Transition Width data pairs for the PREF patterning system at low values for all dominant colors indicates that the PREF system is more capable of printing fine details with substantial contrast with neighboring pattern elements for a broad class of colors. Comparing the 1 Element and 2 Element Directionally Averaged Transition Width and corresponding Directionally Averaged Feature Width data demonstrates the clustering of the PREF system at small Transition Width and Feature Width values that the other print systems are not able to attain.

In most cases the data points that represent the smallest Transition Width and Feature Width are for the brown/beige pairing of colors. As mentioned previously, one skilled in the art recognizes that this color pair is a good surrogate for the majority of colors used to pattern print textile substrates. The directionally averaged data clearly demonstrates a positive difference between the PREF printing technology and the DOD and RECIRC systems because the PREF data are more directionally uniform, indicating high definition patterning performance in any direction. In contrast the DOD and RECIRC systems both have a good and a bad direction, so the directional averages fall in a different region of the Feature Width versus Transition Width chart, effectively distinguishing the PREF print system.

An additional and noteworthy feature of the PREF patterning system is that it is capable of generating sharply defined, high definition pattern details on a product while also providing for substantial penetration of the dyes into the substrate pile. As discussed above, achieving pattern features having high definition is generally easier where reduced quantities of dye are used (thereby minimizing lateral dye migration on the substrate surface). However, by so doing, dye penetration is usually adversely affected. For this reason, penetration measurements were carried out to determine the extent of penetration that can be obtained in 1 element and 2 element pattern details while maintaining small Feature Widths and Transition Widths. The penetration measurements were carried out with a very specific definition of penetration. The penetration was measured on the side profile of the substrate pile so that calipers could be used to specifically measure the distance from the top of the substrate pile surface down to the point where the dyed portion ceased to be uniform in any way. As an example, as the dye penetrates the pile, at some point the color may feather out due to the dye wicking uncontrollably into disparate capillaries, or the hue may change substantially. Accordingly, by measuring penetration in this way, the furthest extent of dye penetration may not be relevant; rather, the key measurement involves the point at which the dye has traveled along the yarn and dyed it in a visually uniform manner. A number of measurements were made to generate a suitable average value for the penetration of the dye of the feature in question, thereby accommodating inevitable variations due to substrate imperfections or irregularities.

In addition, measurements were made of the pile height for each substrate (i.e., length of exposed tuft or yarn forming the pile, as measured from the proximal end of the tuft). It should be noted that the manufacturing specifications associated with Substrates A through E in Table 1 gives the full length of the pile element, including that portion of the pile element that is encapsulated with adhesives, other chemicals, or out of view beneath the textile backing layers that support the carpet face—a much greater length for the pile height than was used to calculate fractional penetration (i.e., the ratio of the extent of uniform dye penetration to the full measured pile height or length extending above the backing).

FIGS. 154-167 show the penetration of each of the colors plotted versus wet pickup for each substrate and each patterning system. It is generally expected that the penetration will increase monotonically with wet pickup. Due to the complexity of how the dye wicks into the substrate and the definition used herein for determining penetration, a linear increase in penetration with increasing wet pickup was generally not found, though it was found to be generally monotonically increasing.

The samples patterned with the PREF system demonstrate the clearest trends. Generally, the colors with heavier concentrations of dyestuffs, such as black, red, and yellow, tend to have a high penetration from higher wet pickup, occasionally even with very low wet pickup. Colors that have lower dyestuff concentrations, such as brown and green, tend to have a reduced penetration at lower wet pickups. This result is not unexpected: as the dyes find sites at which to fix, dye molecules are removed from the downwardly wicking fluid so that, near the bottom of the pile tuft, there is insufficient dye to effectively dye the lowermost portions of the pile tuft. This trend is very clearly seen in the longer pile height substrates such as Substrates C through E. For those substrates, the differences between more and less highly concentrated dyes are enhanced due to the long pile. Similar results are seen for the penetration data for substrates patterned with the RECIRC and DOD patterning systems.

Figure 168:
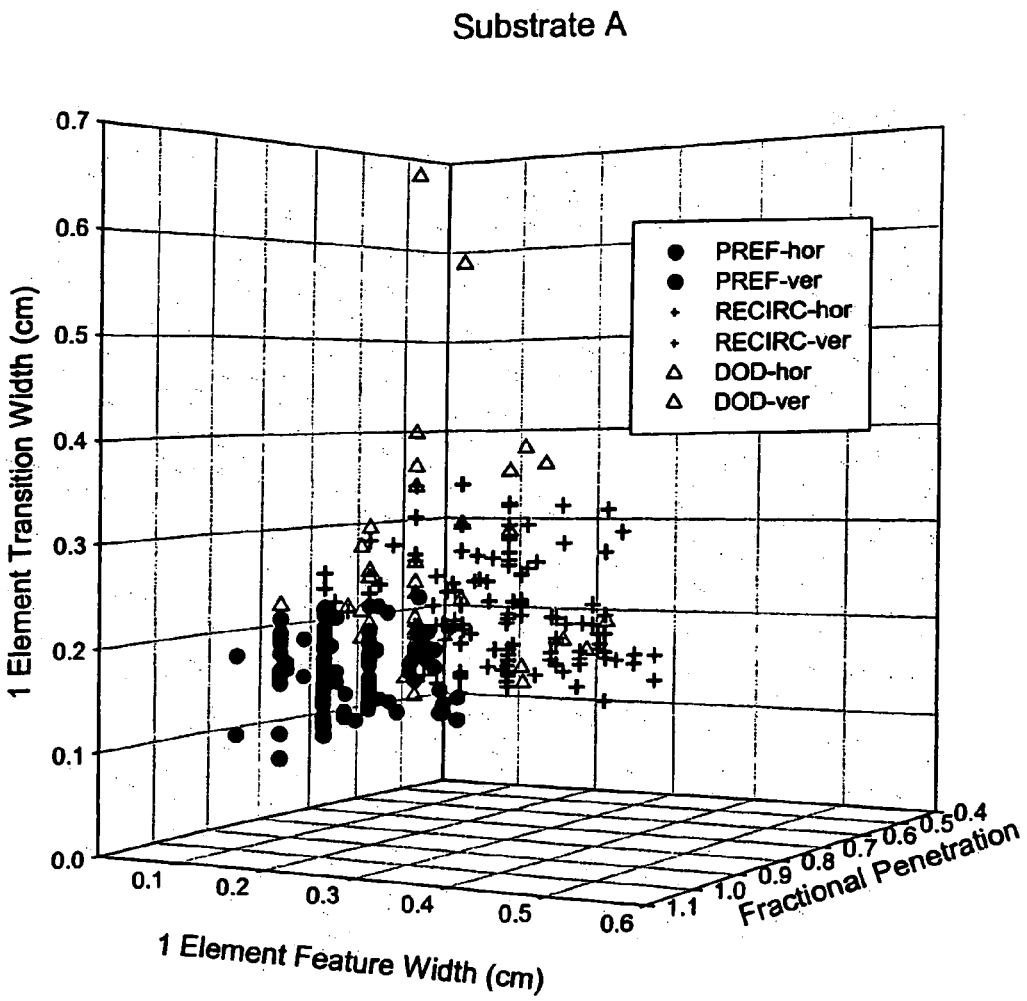

As has been discussed above, the PREF patterning system is capable of providing, simultaneously, small Feature Widths and small Transition Widths, as compared with competing patterning systems. The following discussion will look at how the PREF system compares with the RECIRC and DOD print systems when fractional penetration is also considered. As a part of this discussion, FIGS. 168-247 will be used, which are two-dimensional renditions of three-dimensional graphs. The figures show Feature Width data along with the corresponding Transition Width data and the corresponding penetration data (or alternatively wet pickup data). All of the wet pickups that were sampled for all dominant color features are included in these Figures—they are not limited to a pre-selected wet pickup range. These Figures are arranged in the following way: the first type of chart shows raw Transition Width and Feature Width data for both horizontal and vertical direction features along with fractional penetration (and alternatively wet pickup), first for 1 Element Dominant Color features, then for 2 Element Dominant Color features. The second type of chart shows Directionally Averaged Transition Width and Directionally Averaged Feature Width data for both horizontal and vertical direction features along with fractional penetration (and alternatively wet pickup), first for 1 Element Dominant Color features, then for 2 Element Dominant Color features. In connection with the instant discussions, the shorthand "average" shall be used to designate that the data have been averaged along two orthogonal directions for these charts. The third type of chart is a magnification of a corresponding three-dimensional graph, and serves to isolate a region of the graph corresponding to low Feature Width, low Transition Width, and high fractional penetration (or corresponding range of wet pickup values). These isolation graphs show that the PREF patterning system is capable of producing products with a combination of Transition Width, Feature Width, and fractional penetration for many colors that previously has been unobtainable in substrate-dyed products, and particularly unattainable through the use of a metered jet patterning system.

In general, the dominant color pattern elements printed by the PREF patterning system have Transition Widths and Feature Widths that are clustered at low values, along with those fractional penetration values that have been selected to define products that are considered of commercially acceptable quality (i.e., at least 0.5 for nylon 6,6 substrates and at least 0.4 for wool substrates). This is true for all substrates, to a greater or lesser extent, indicating that, on a broad variety of floor covering substrates, the PREF system can print finer, sharper details, while obtaining good fractional penetration, as compared with the DOD and RECIRC print systems. This statement is true for both the 1 element and 2 element features. This fact is made even clearer by the fact that the isolation charts show regions in the three-dimensional graph that represent desirable print features (e.g., fine details with sharp edges and good penetration) that only the PREF patterning system can attain.

As shown graphically in the isolation graphs discussed above, there are definite values for the Transition Width and Feature Width parameters (along with fractional penetration or wet pickup) that define a performance parameter space attainable only with the PREF patterning system. The boundaries of this space vary with the substrate and the nature of the pattern feature (i.e., whether the specific pattern feature is a 1 element or 2 element dominant color feature).

Figure 169:
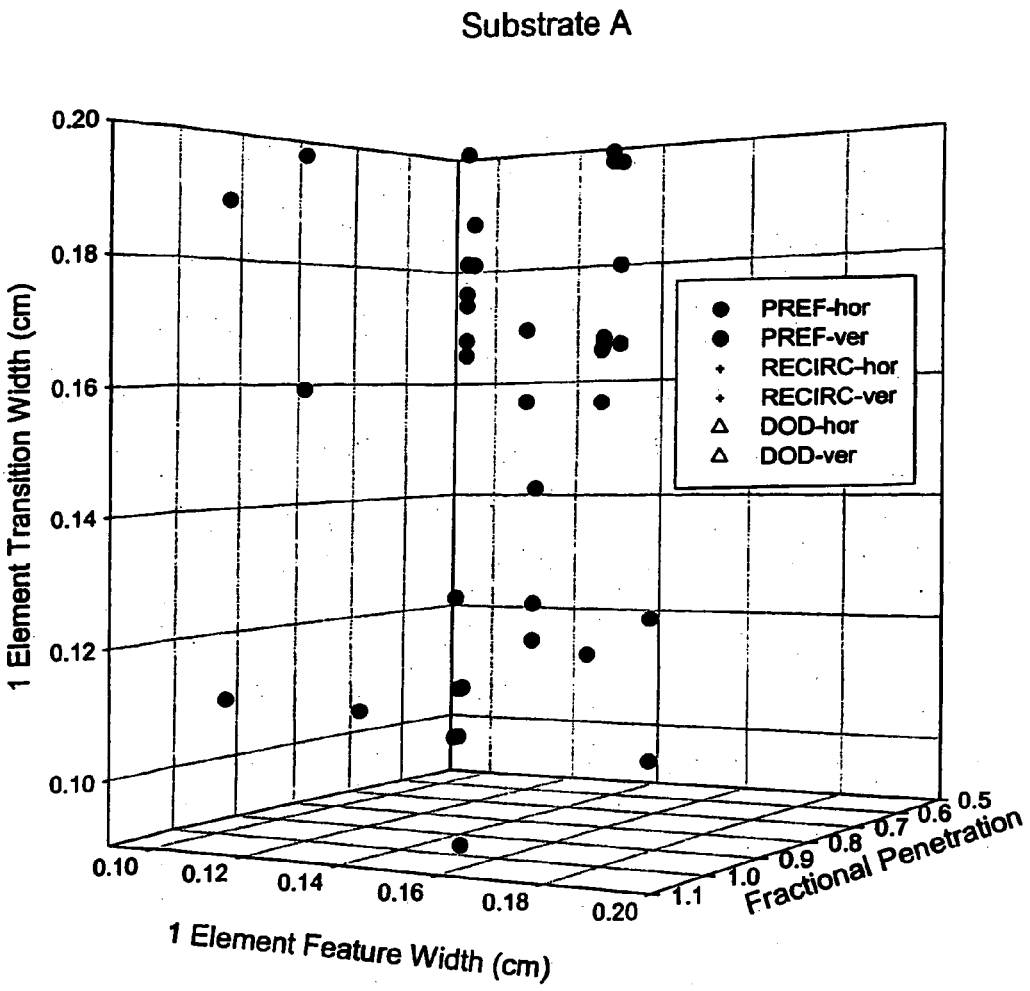
Figure 170:
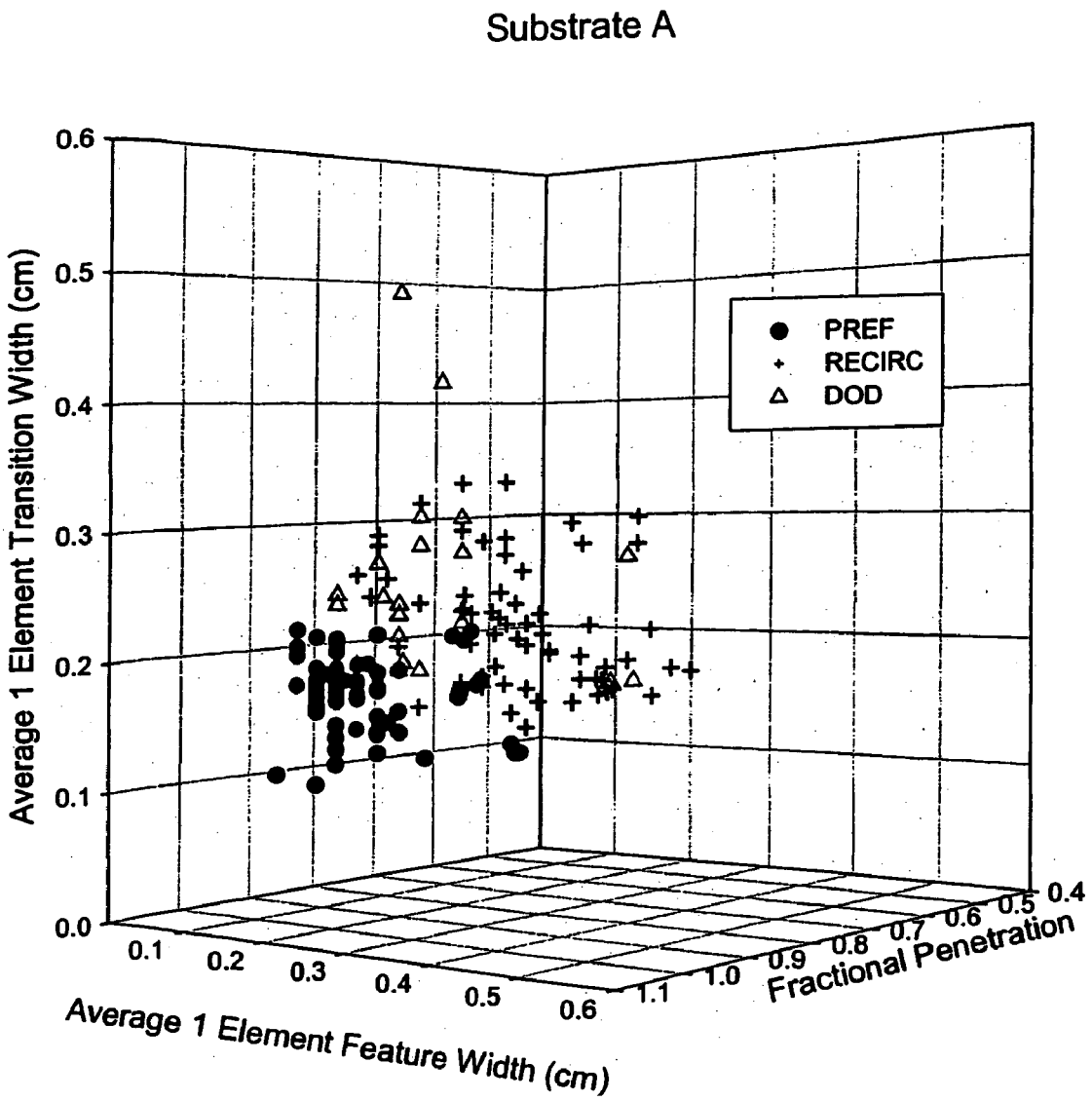

For Substrate A, direction-specific (two orthogonal directions) Feature Width, Transition Width and fractional penetration (and equivalent Wet Pickup range) values associated with a 1 element pattern area that are attainable only with the PREF patterning system (see FIG. 169) are:

(Substrate A)

$FW_{1element}$<0.2 cm, $TW_{1element}$<0.2 cm, Fractional Penetration≧0.5

Figure 173:
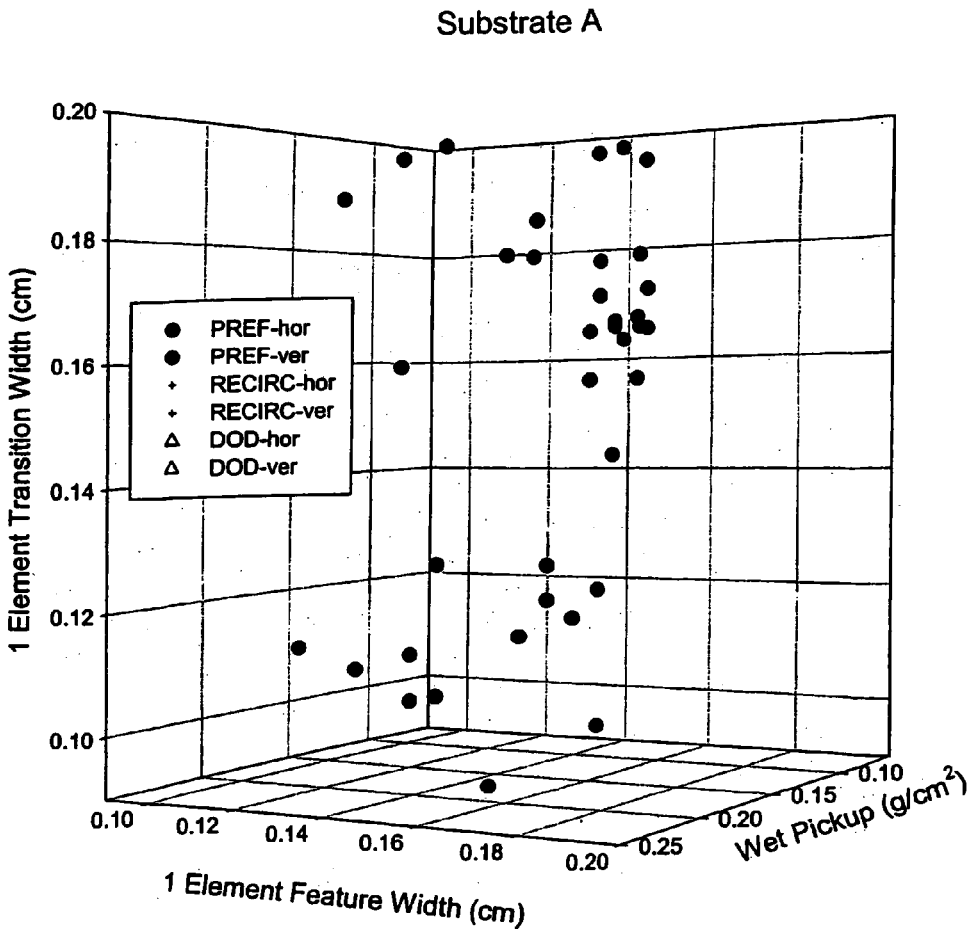
Figure 174:
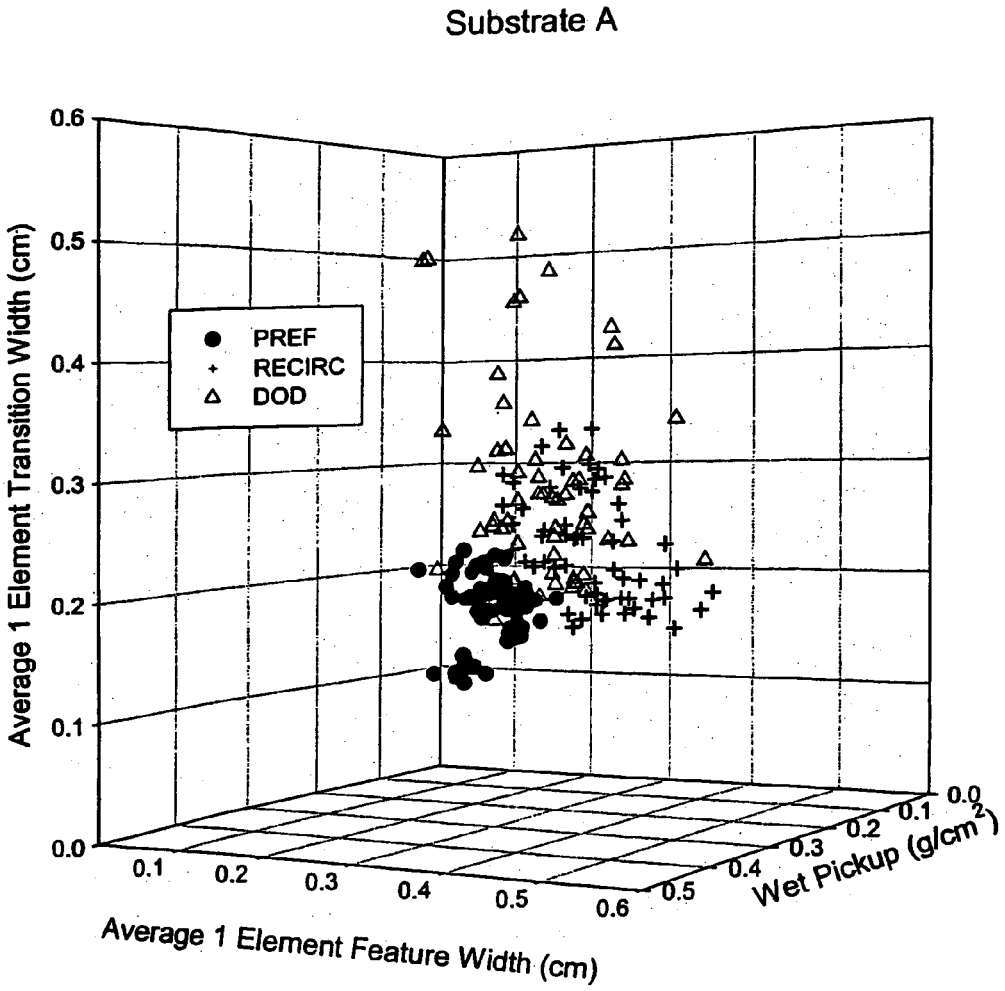

Or, equivalently, FIG. 173, (Substrate A)

$FW_{1element}$<0.2 cm, $TW_{1element}$<0.2 cm, Wet Pickup Range: 0.06-0.25 g/cm$^2$.

Figure 171:
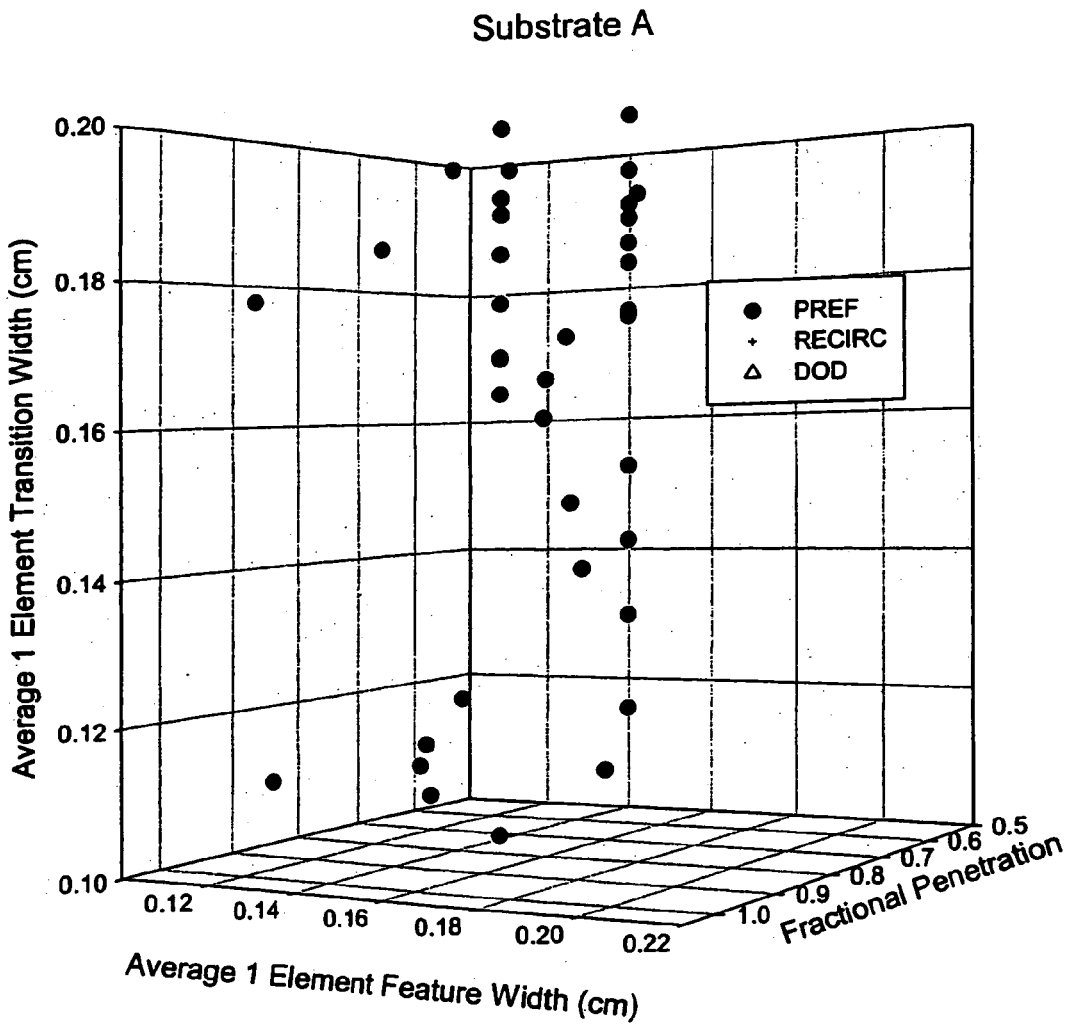
Figure 172:
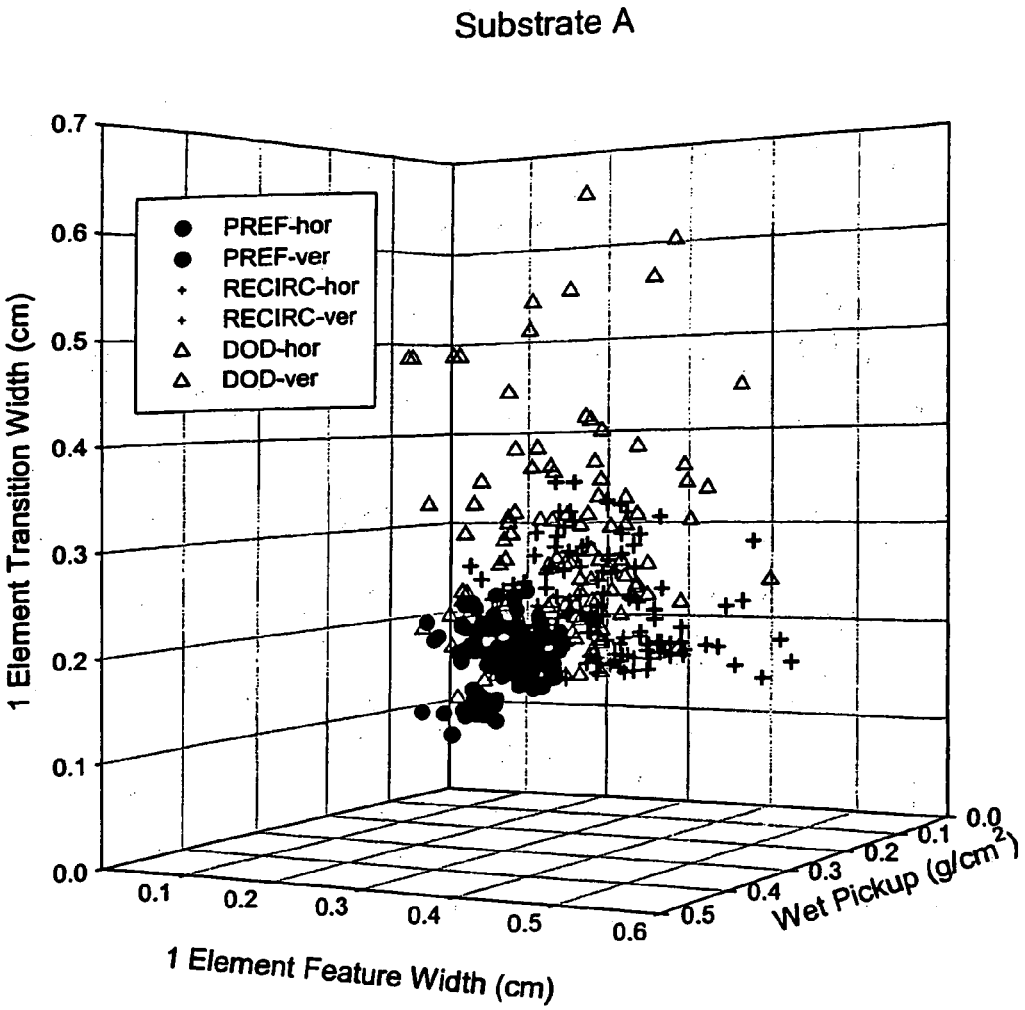

Directionally averaged values corresponding to the above boundaries for Substrate A (see FIG. 171) are:

(Substrate A)

$FW_{1element,\ directionally\ averaged}$<0.22 cm, $TW_{1element,\ directionally\ averaged}$<0.2 cm, Fractional Penetration≧0.5

Figure 175:
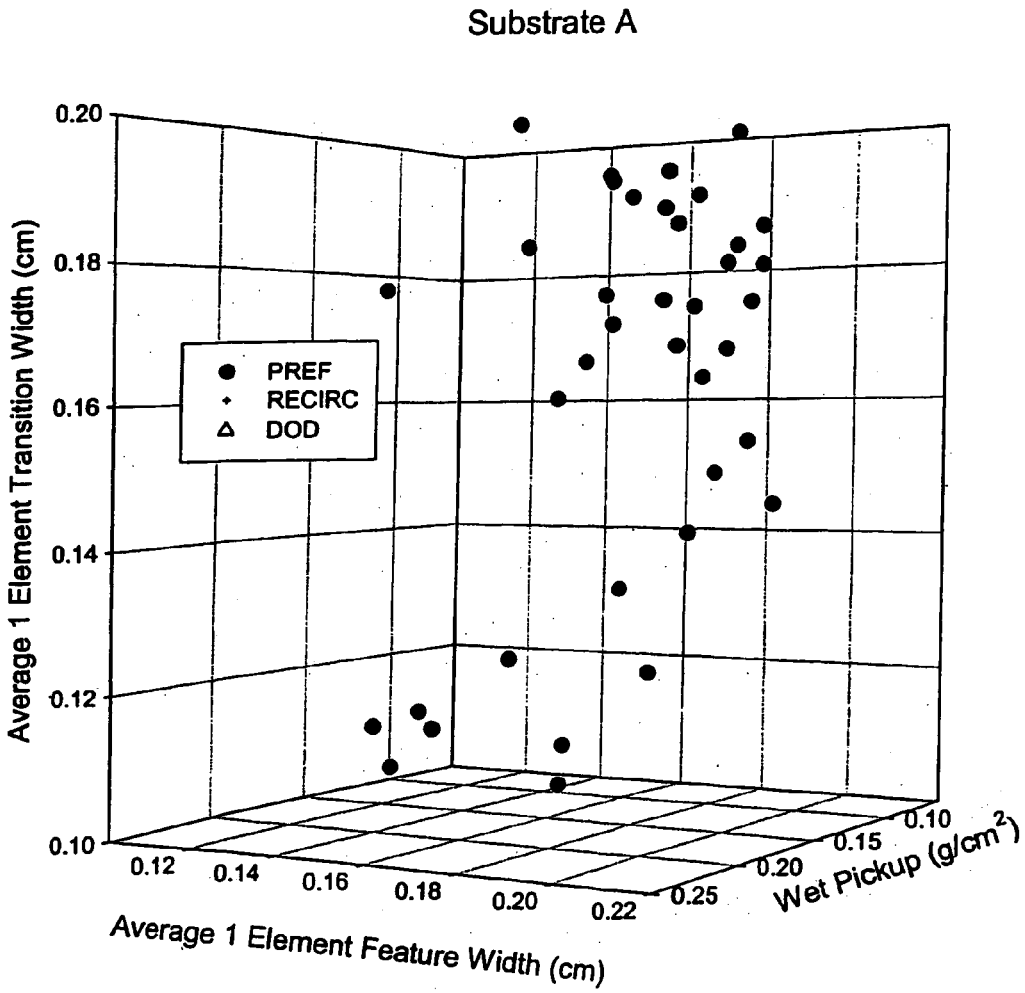
Figure 176:
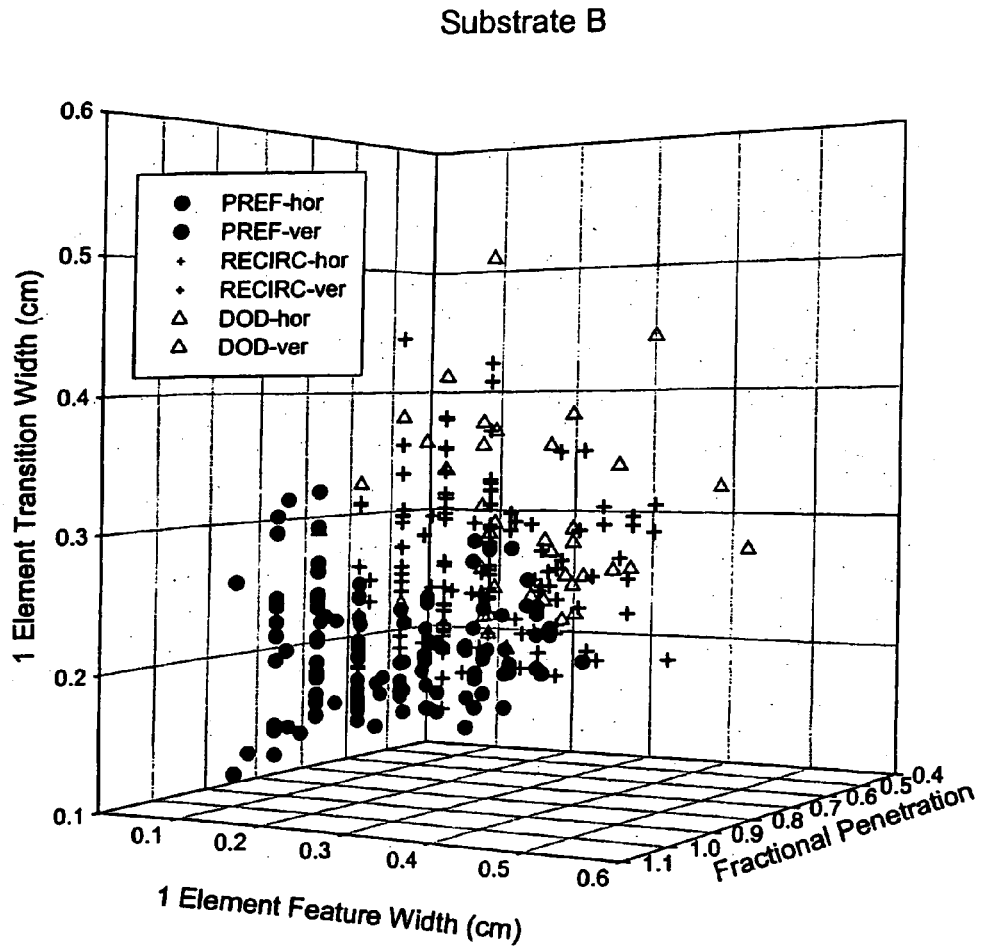

Or, equivalently, FIG. 175, (Substrate A)

$FW_{1element,\ directionally\ averaged}$<0.22 cm, $TW_{1element,\ directionally\ averaged}$<0.2 cm, Wet Pickup Range: 0.06-0.25 g/cm$^2$.

Figure 209:
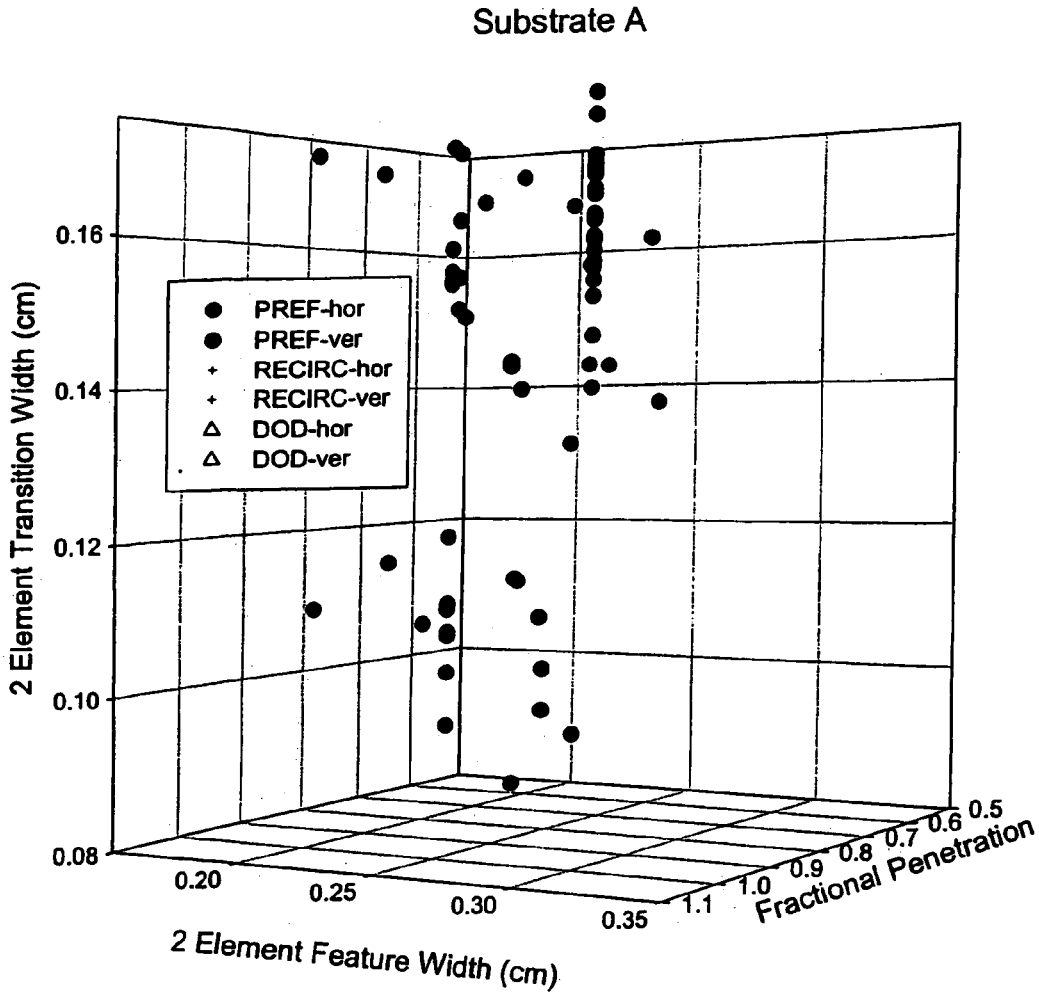
Figure 210:
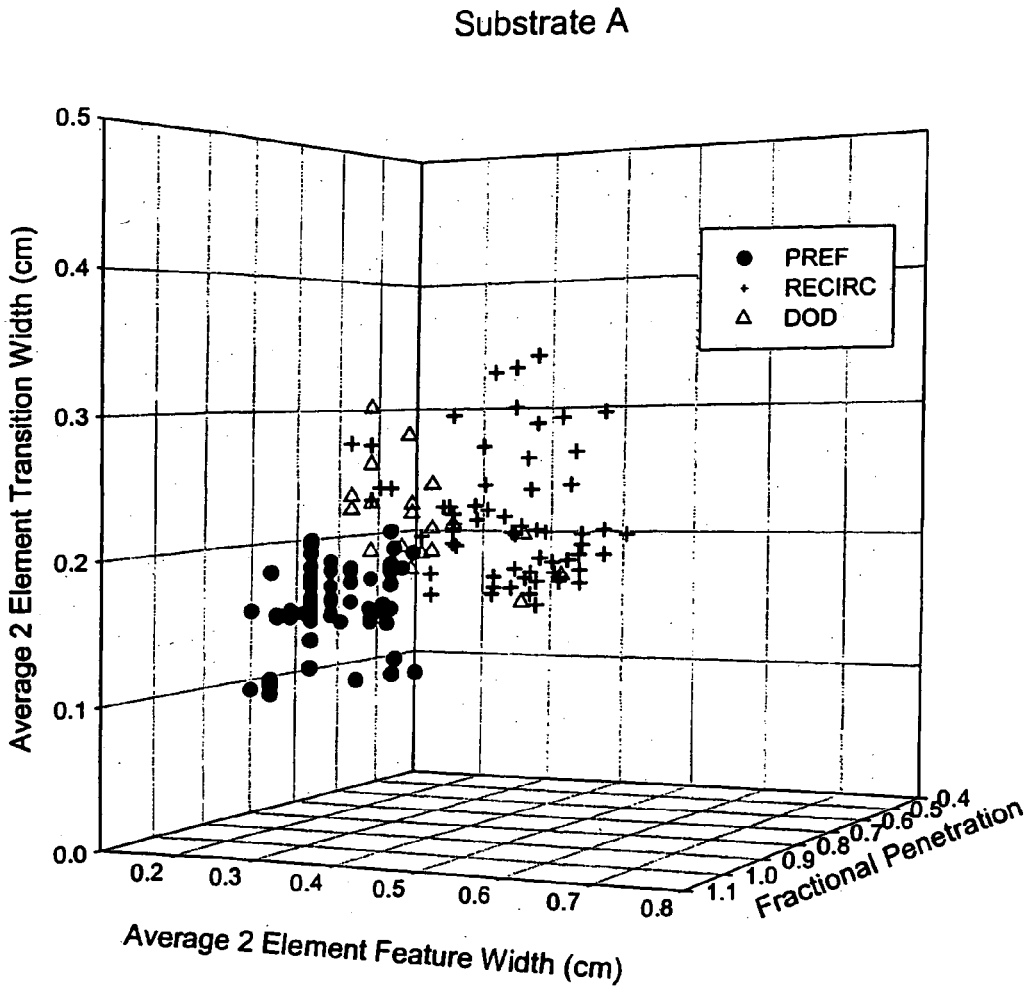

For Substrate A, direction-specific (two orthogonal directions) Feature Width, Transition Width and fractional penetration (and equivalent Wet Pickup range) values associated with a 2 element pattern area that are attainable only with the PREF patterning system (see FIG. 209) are:

(Substrate A)

$FW_{2element}$<0.34 cm, $TW_{2element}$<0.175 cm, Fractional Penetration≧0.5

Figure 213:
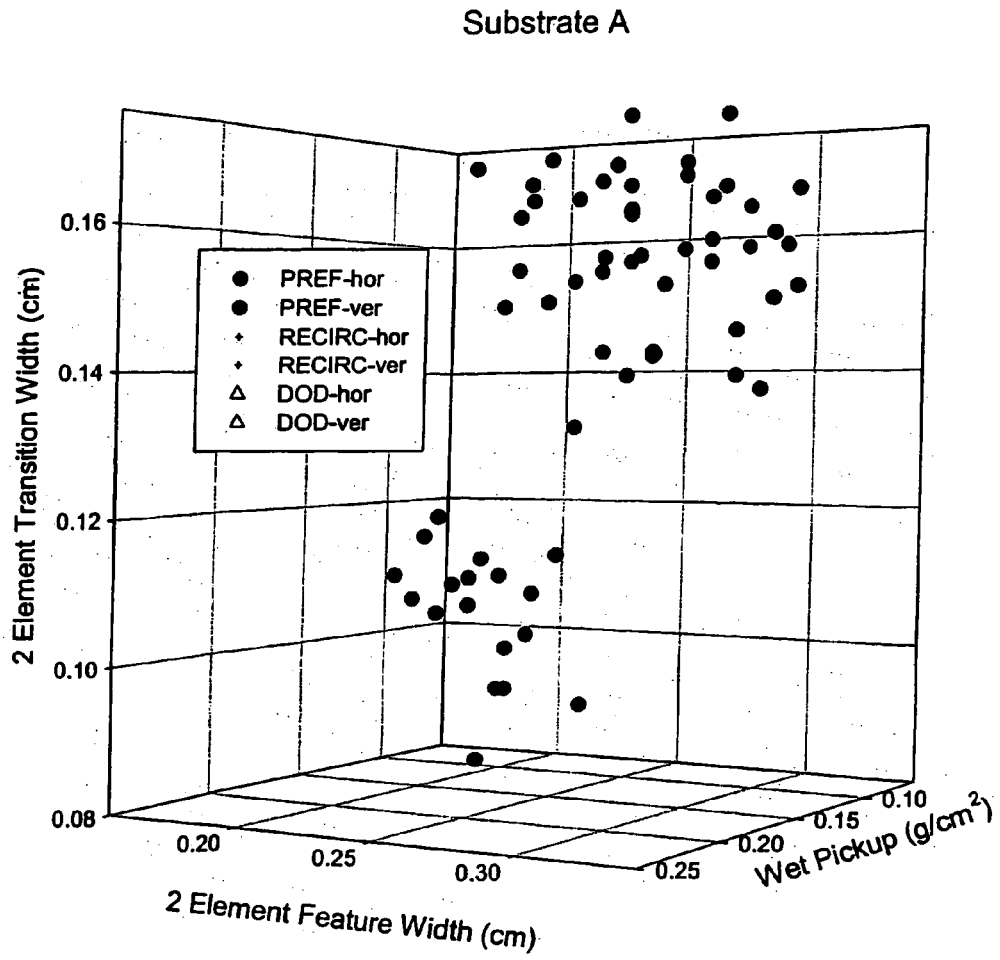
Figure 214:
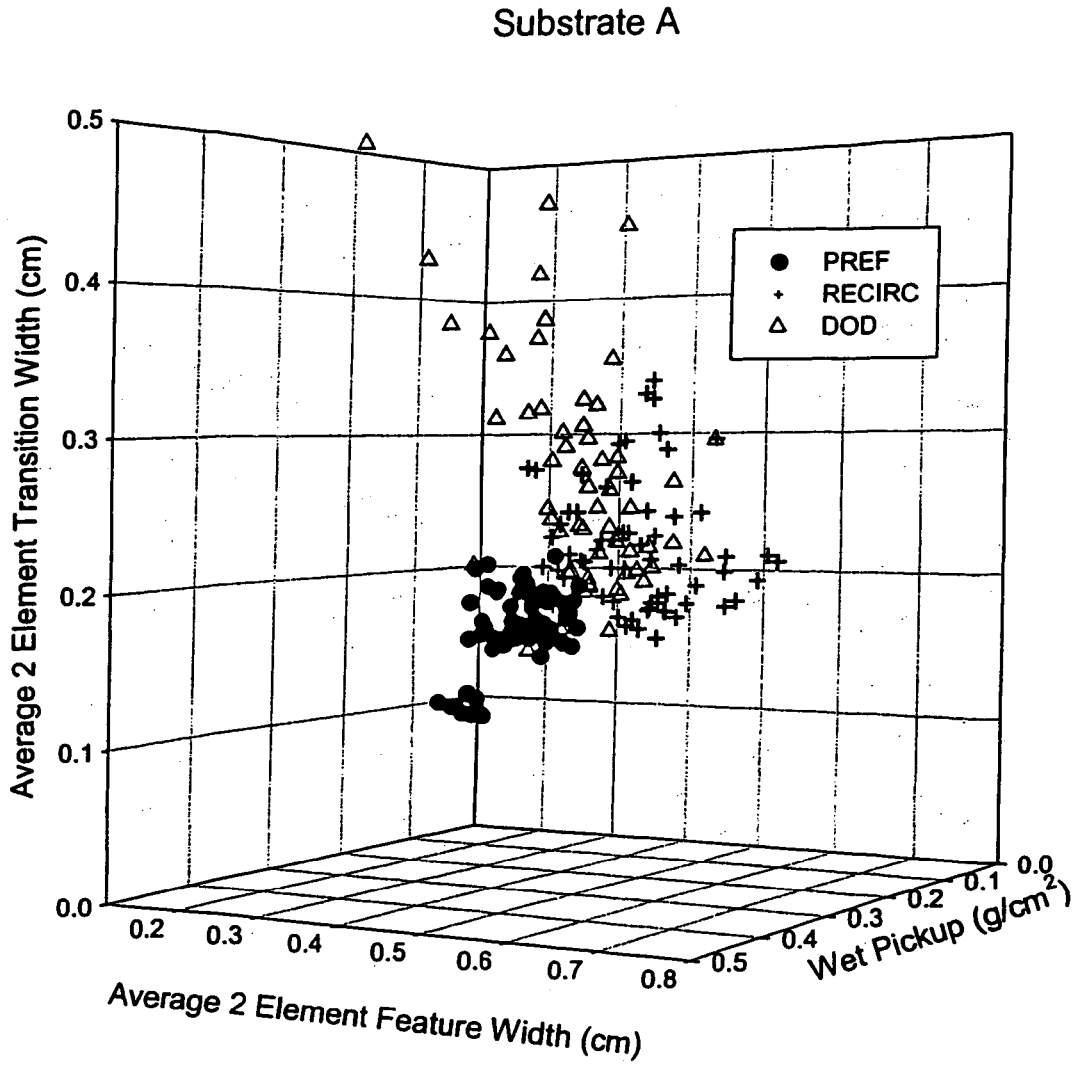

Or, equivalently, FIG. 213, (Substrate A)

$FW_{2\ element}$<0.34 cm, $TW_{2element}$<0.175 cm, Wet Pickup Range: 0.06-0.25 g/cm$^2$.

Figure 211:
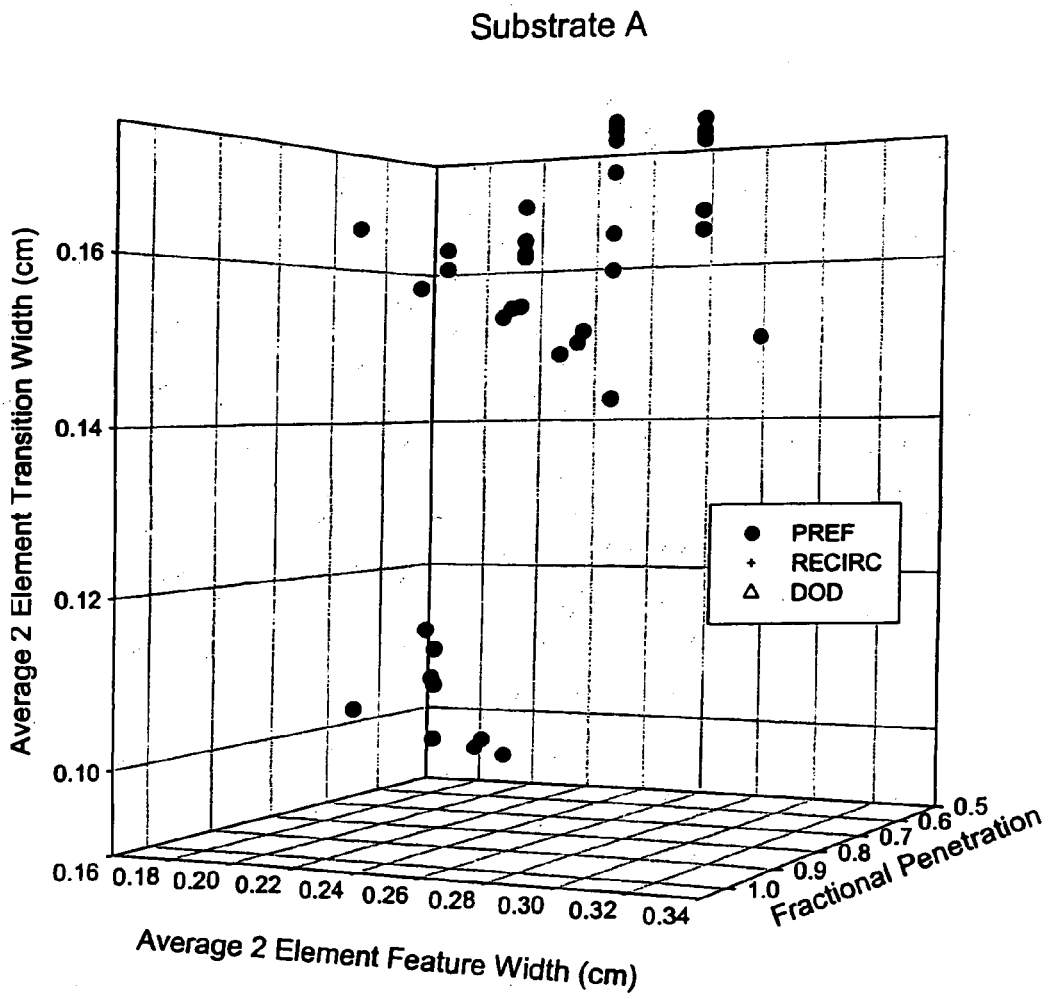
Figure 212:
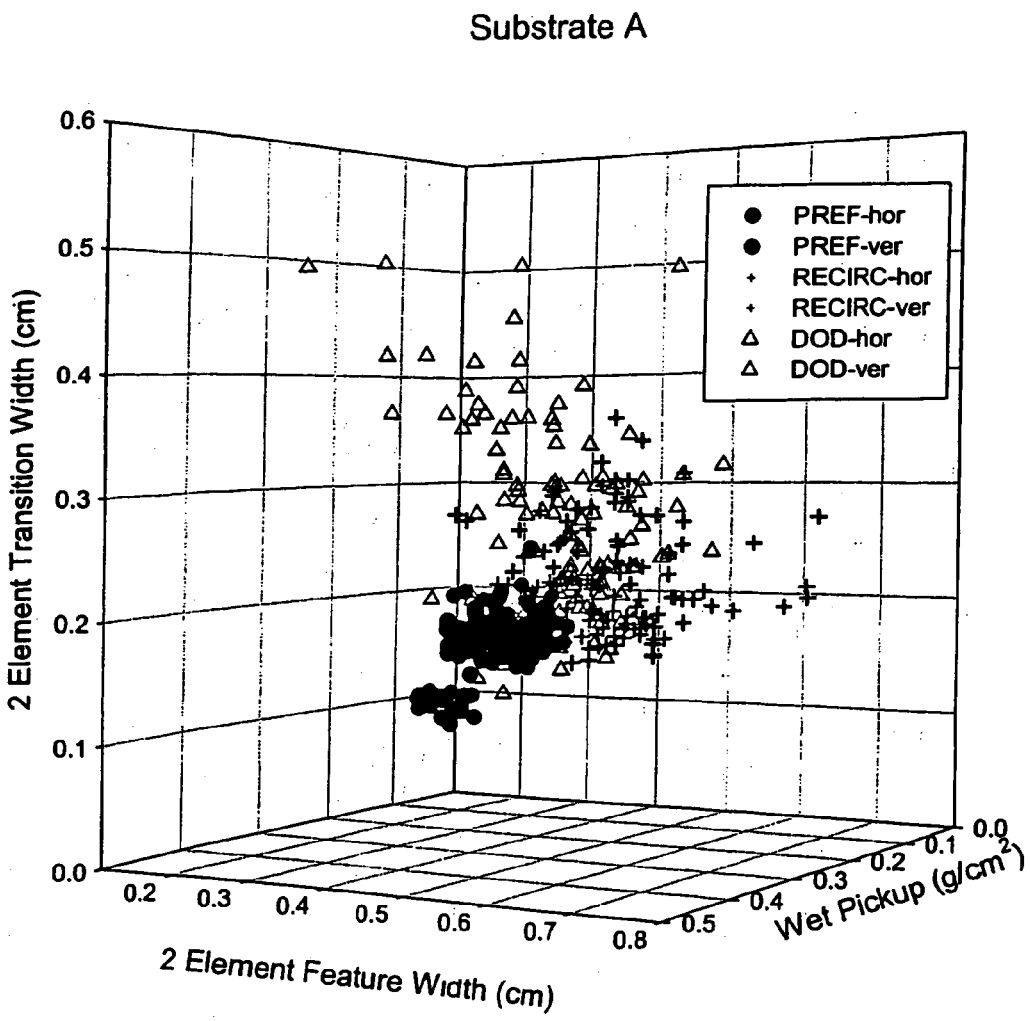

Directionally averaged values corresponding to the above boundaries for Substrate A (see FIG. 211) are:

(Substrate A)

$FW_{2\ element,\ directionally\ averaged}$<0.34, $TW_{2element,\ directionally\ averaged}$<0.18, Fractional Penetration≧0.5

Figure 215:
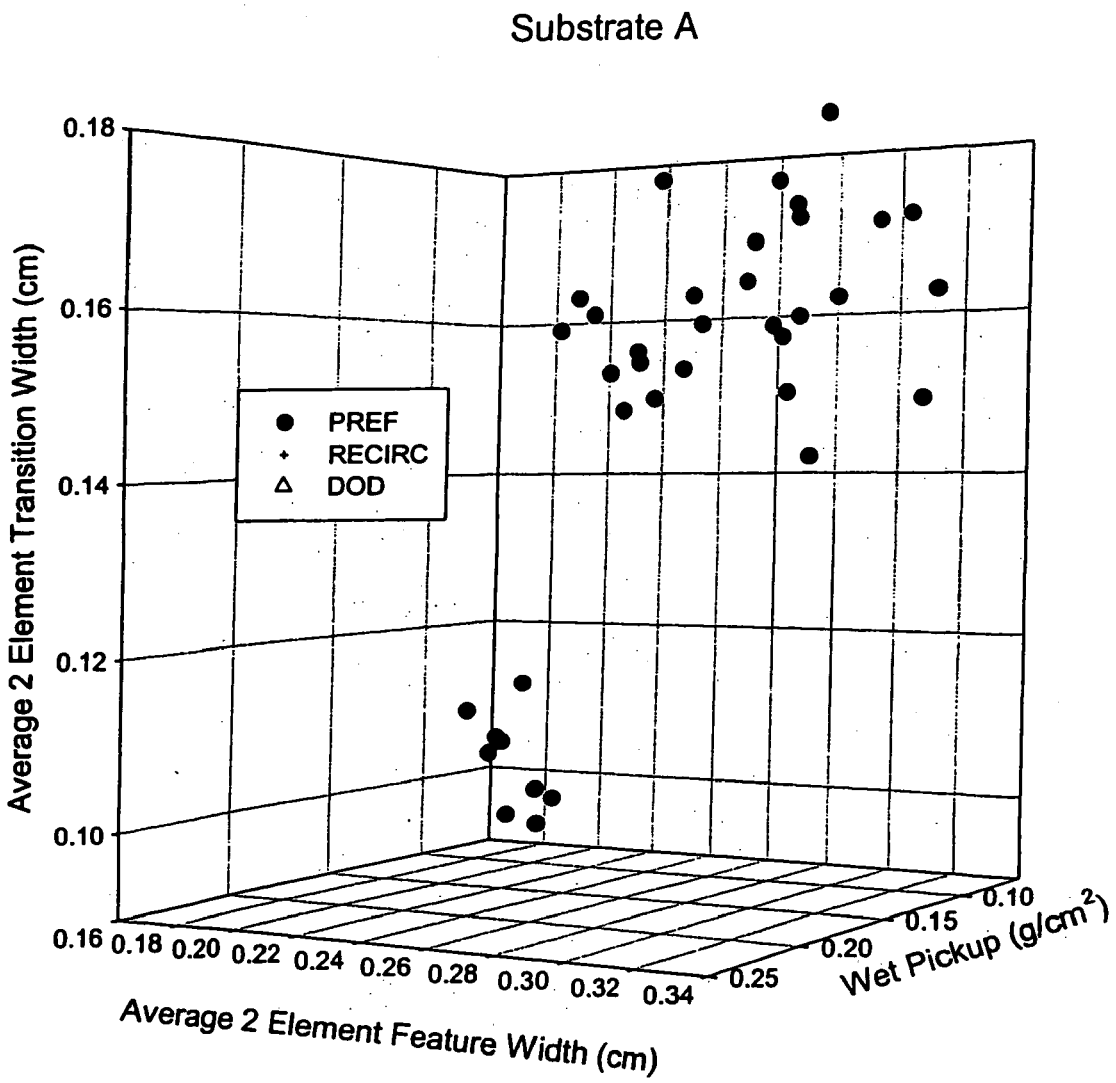
Figure 216:
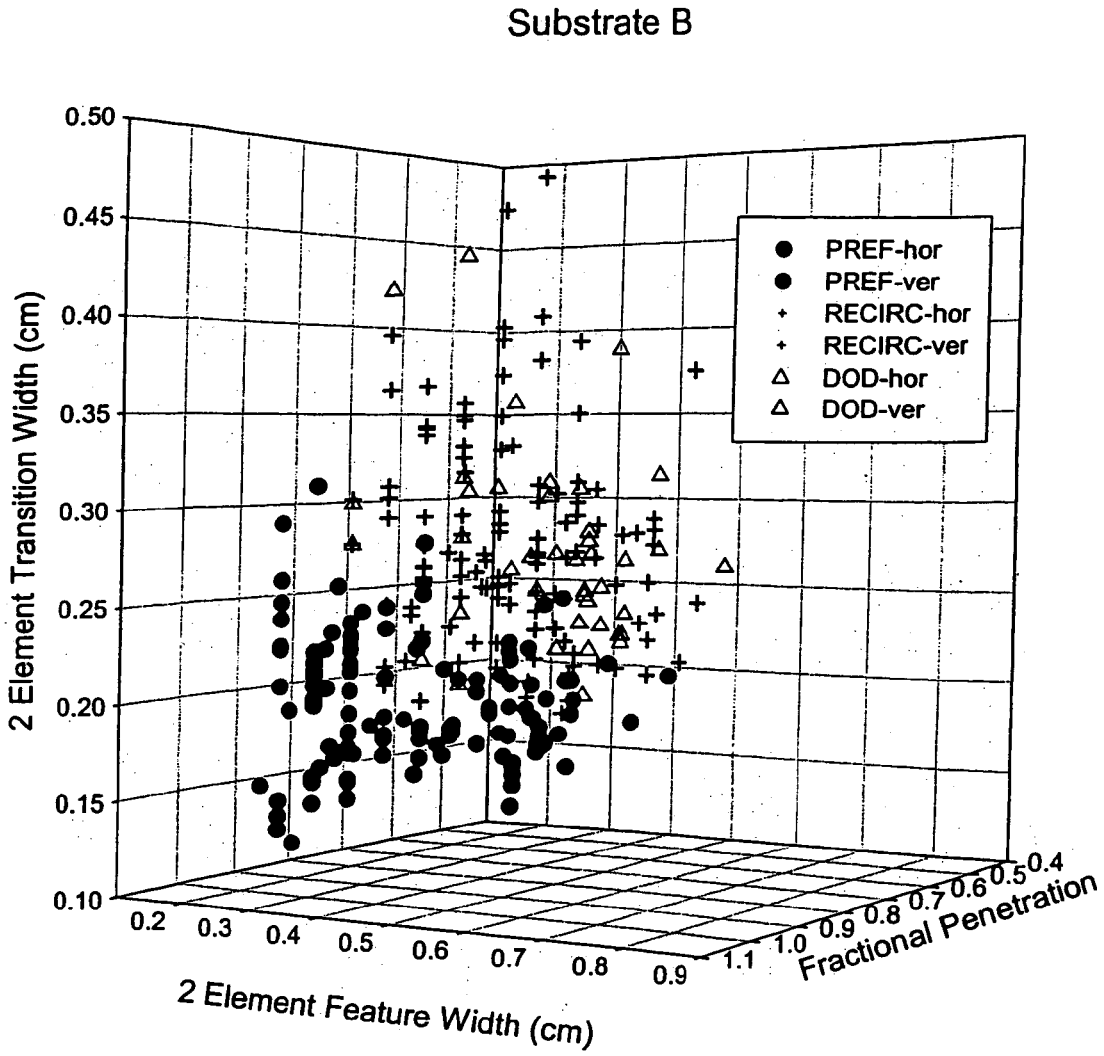

Or, equivalently, FIG. 215, (Substrate A)

$FW_{2\ element,\ directionally\ averaged}$<0.34, $TW_{2element,\ directionally\ averaged}$<0.18, Wet Pickup Range: 0.06-0.25 g/cm$^2$.

Figure 177:
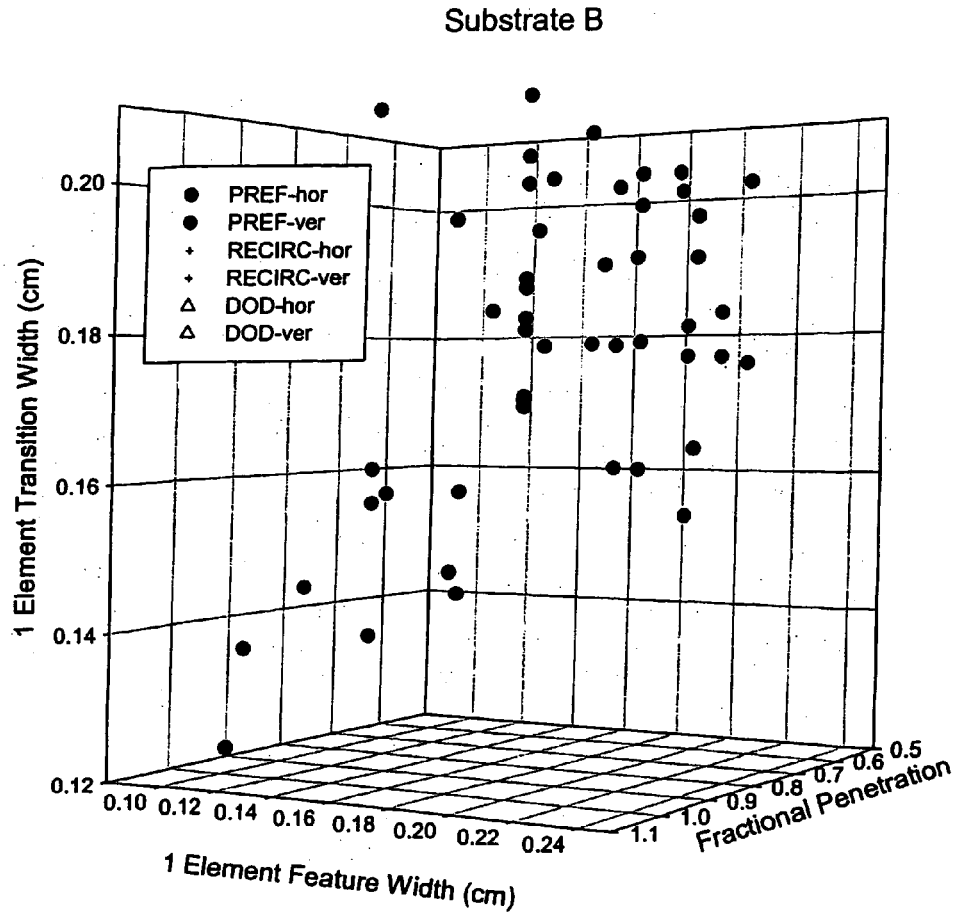
Figure 178:
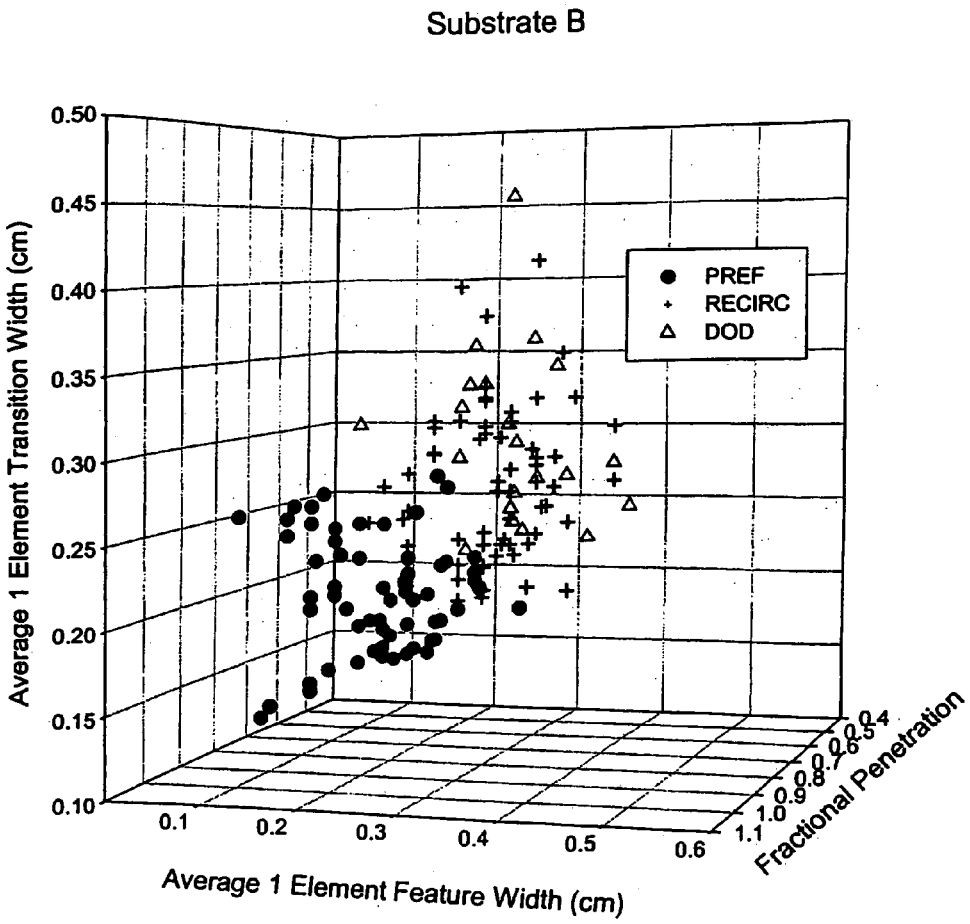

For Substrate B, direction-specific (two orthogonal directions) Feature Width, Transition Width and fractional penetration (and equivalent Wet Pickup range) values associated with a 1 element pattern area that are attainable only with the PREF patterning system (see FIG. 177) are:

(Substrate B)

$FW_{1element}$<0.25 cm, $TW_{1element}$<0.21 cm, Fractional Penetration≧0.5

Figure 181:
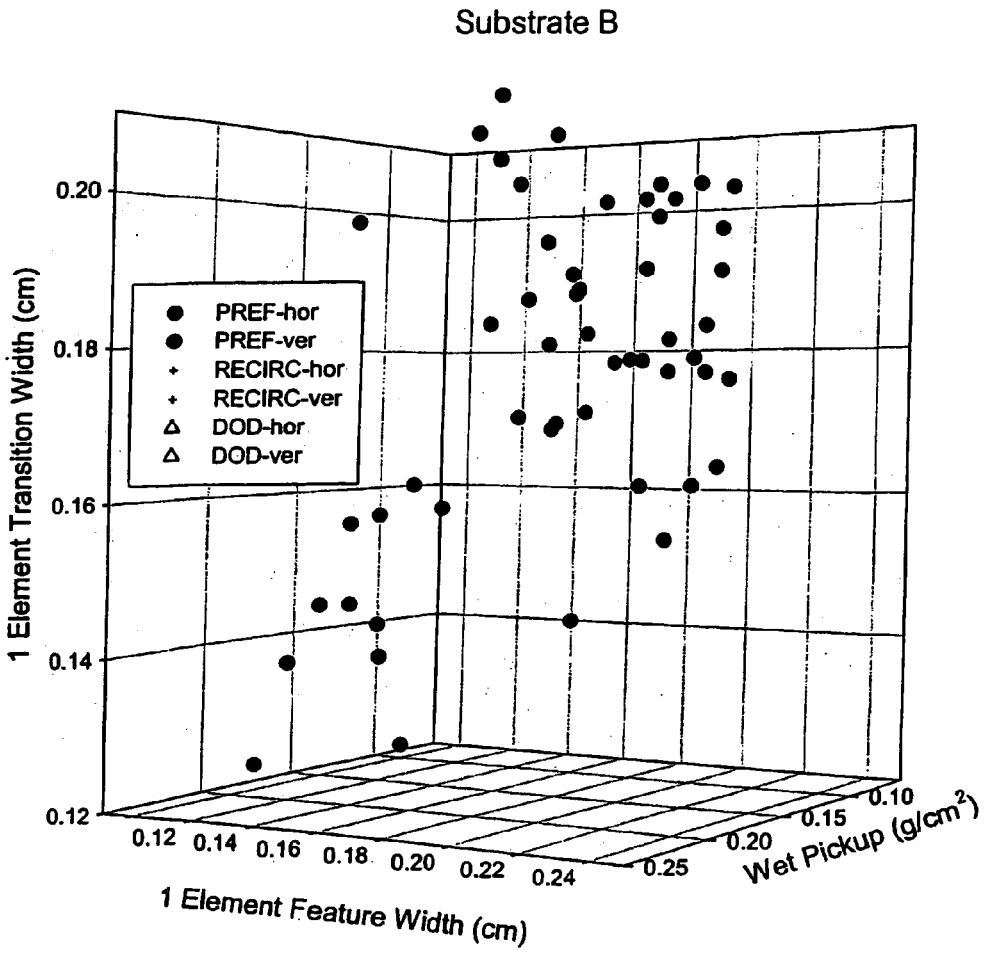
Figure 182:
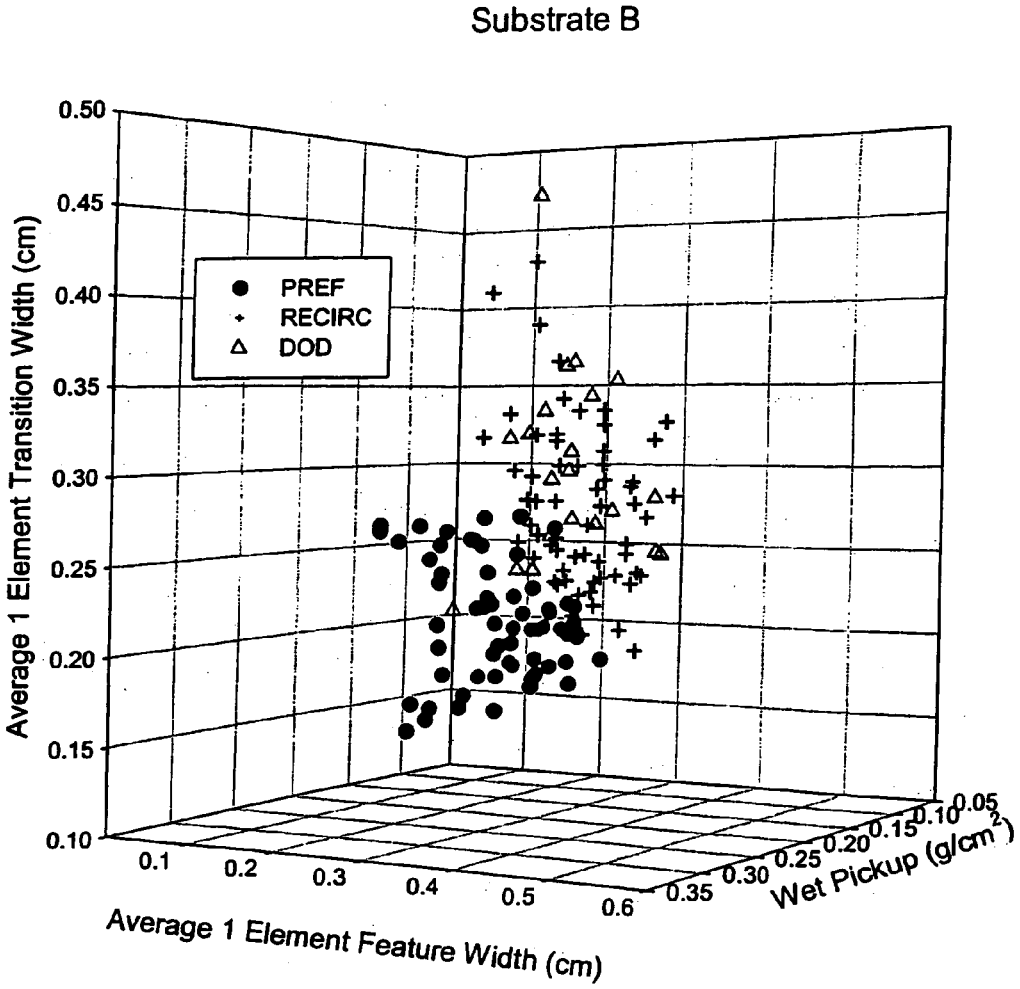

Or, equivalently, FIG. 181, (Substrate B)

$FW_{1element}$<0.25 cm, $TW_{1element}$<0.21 cm, Wet Pickup Range: 0.06-0.25 g/cm$^2$.

Figure 179:
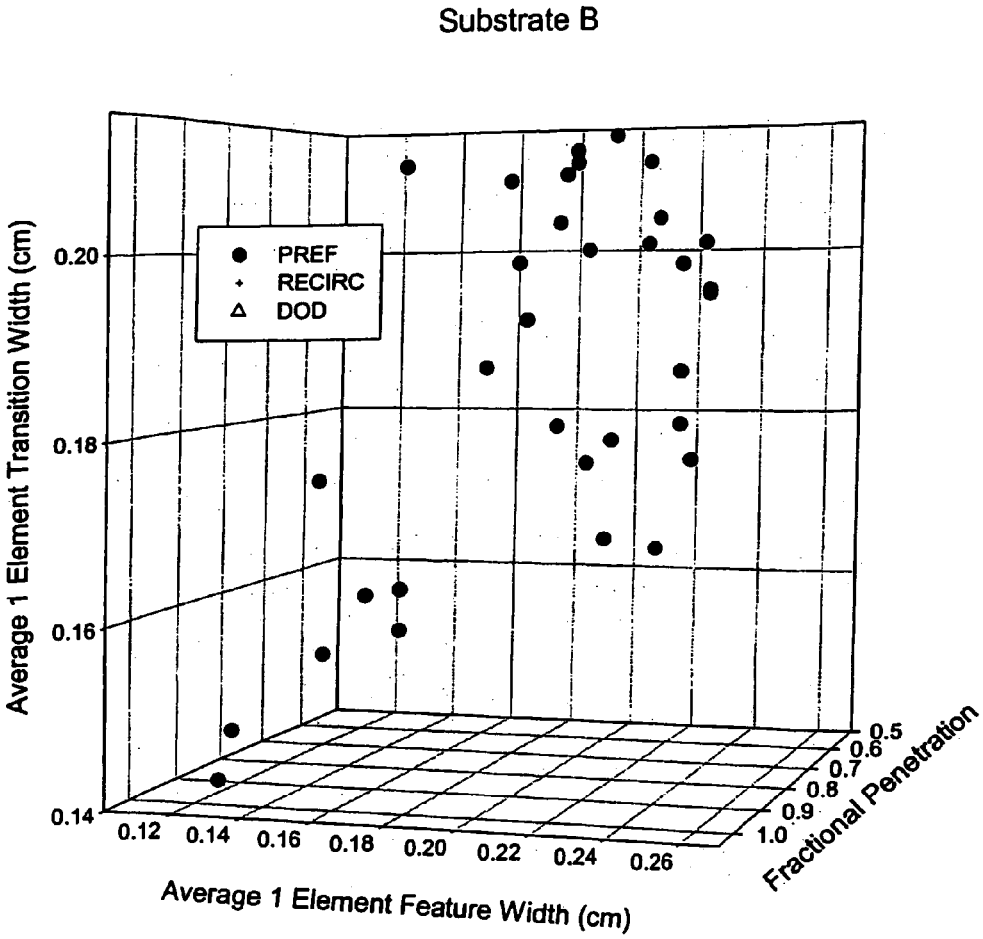
Figure 180:
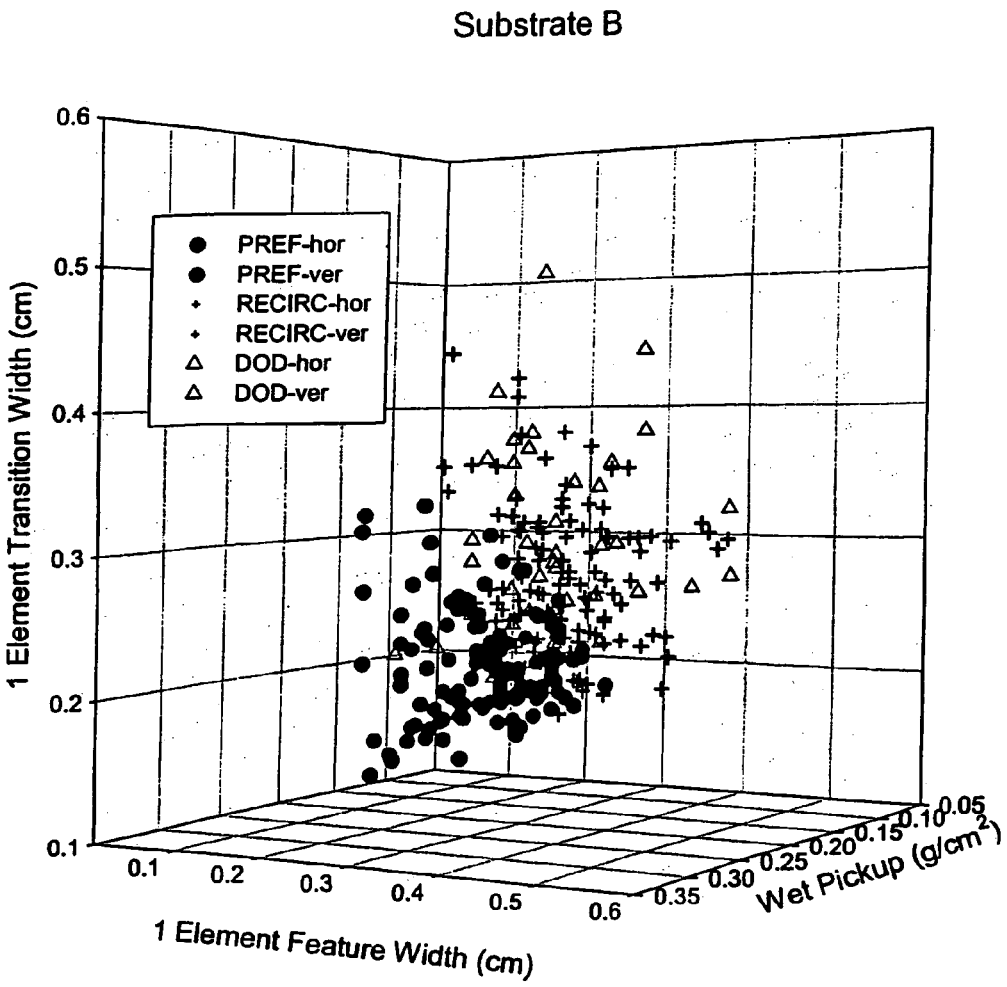

Directionally averaged values corresponding to the above boundaries for Substrate B (see FIG. 179) are:

(Substrate B)

$FW_{1element,\ directionally\ averaged}$<0.27 cm, $TW_{1element,\ directionally\ averaged}$<0.215 cm, Fractional Penetration≧0.5

Figure 183:
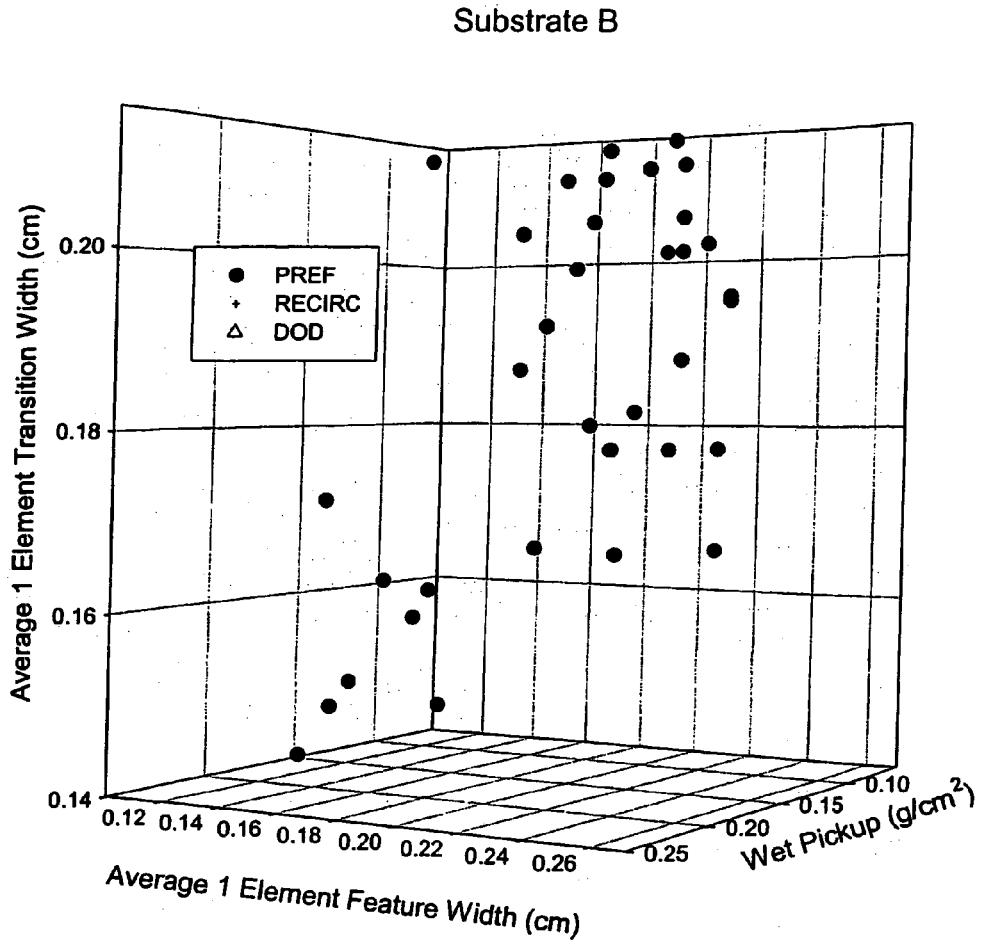
Figure 184:
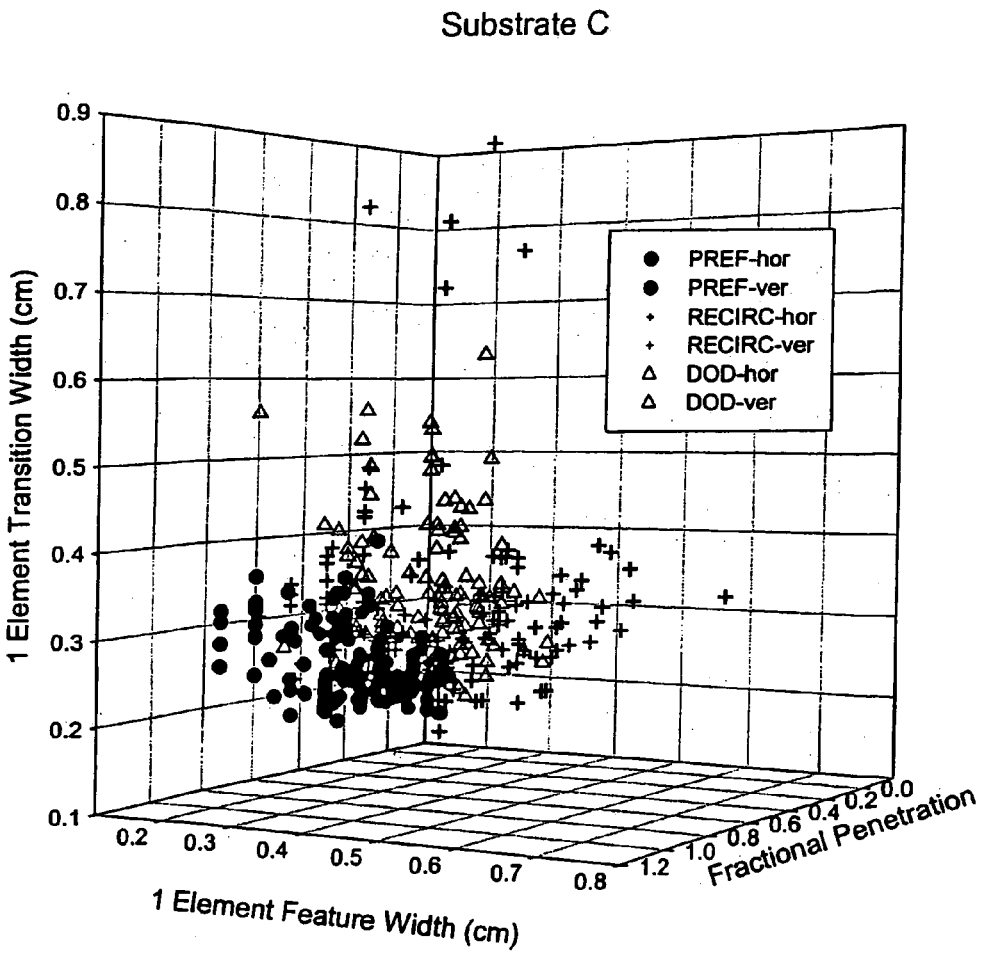

Or, equivalently, FIG. 183, (Substrate B)

$FW_{1element,\ directionally\ averaged}$<0.27 cm, $TW_{1element,\ directionally\ averaged}$<0.215 cm, Wet Pickup Range: 0.06-0.25 g/cm$^2$.

Figure 217:
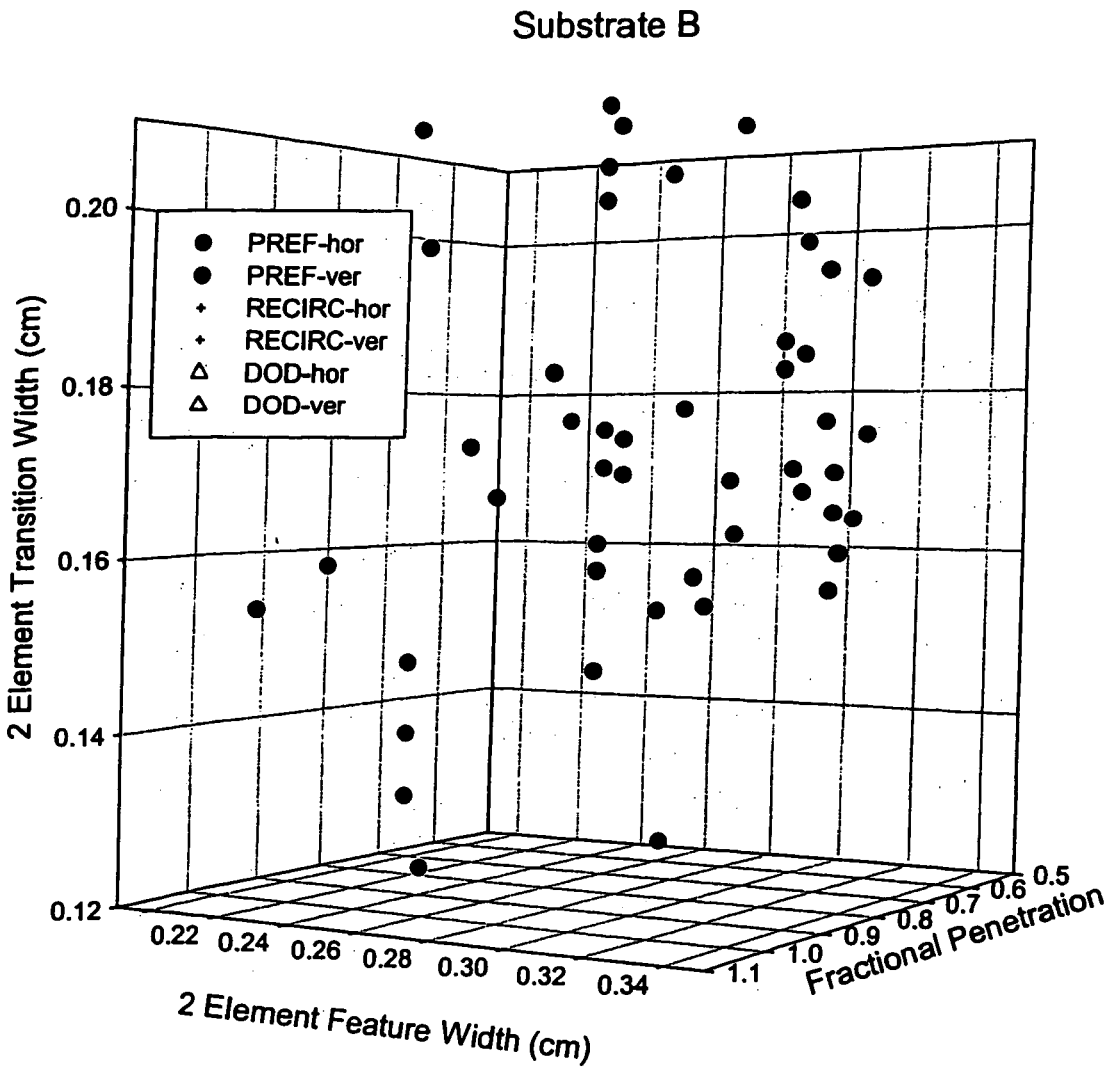
Figure 218:
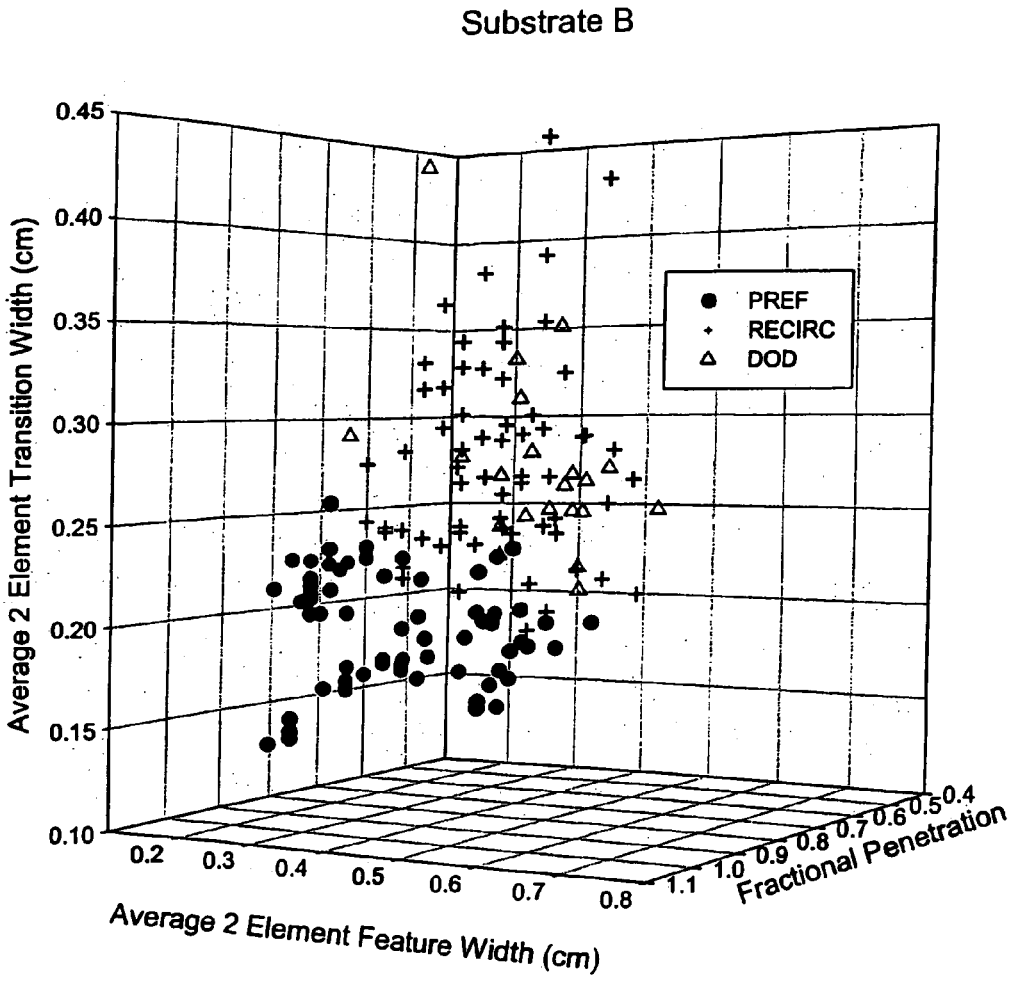

For Substrate B, direction-specific (two orthogonal directions) Feature Width, Transition Width and fractional penetration (and equivalent Wet Pickup range) values associated with a 2 element pattern area that are attainable only with the PREF patterning system (see FIG. 217) are:

(Substrate B)

$FW_{2element}$<0.35 cm, $TW_{2element}$<0.21 cm, Fractional Penetration≧0.5

Figure 221:
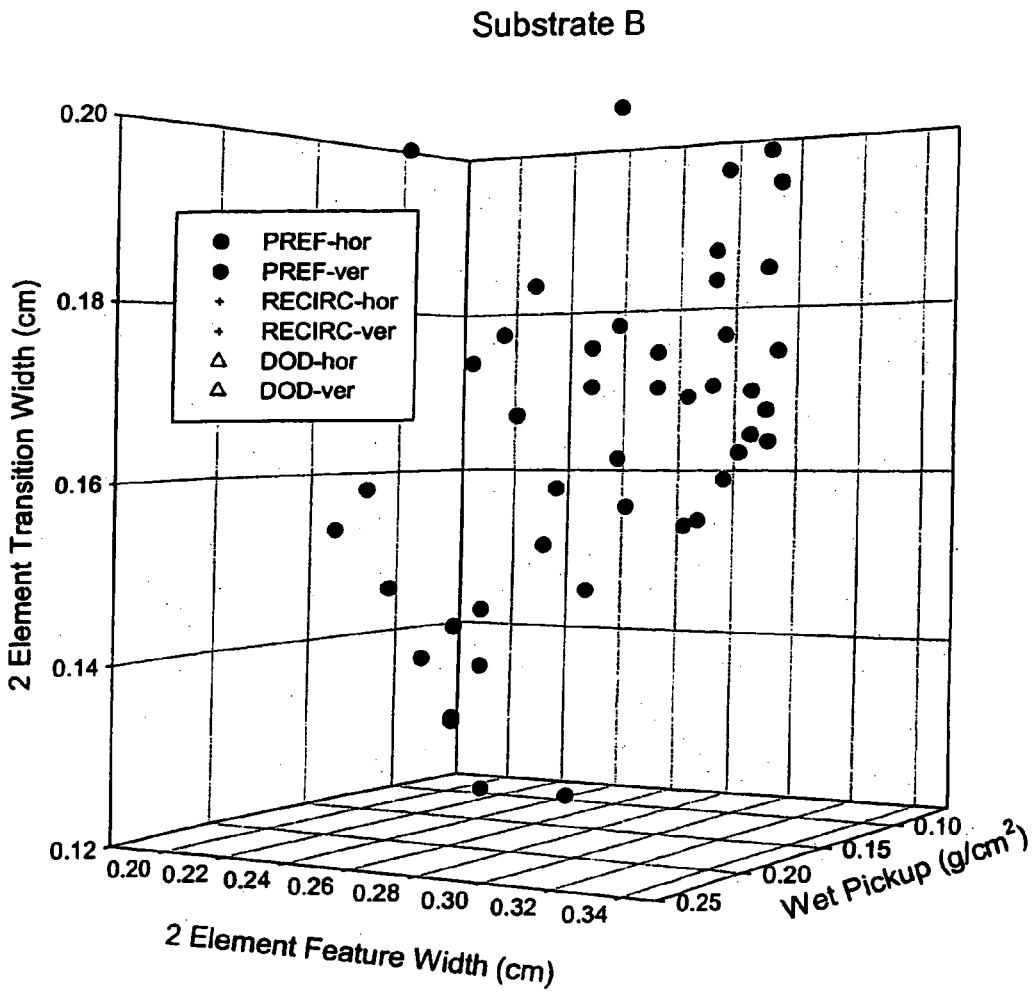
Figure 222:
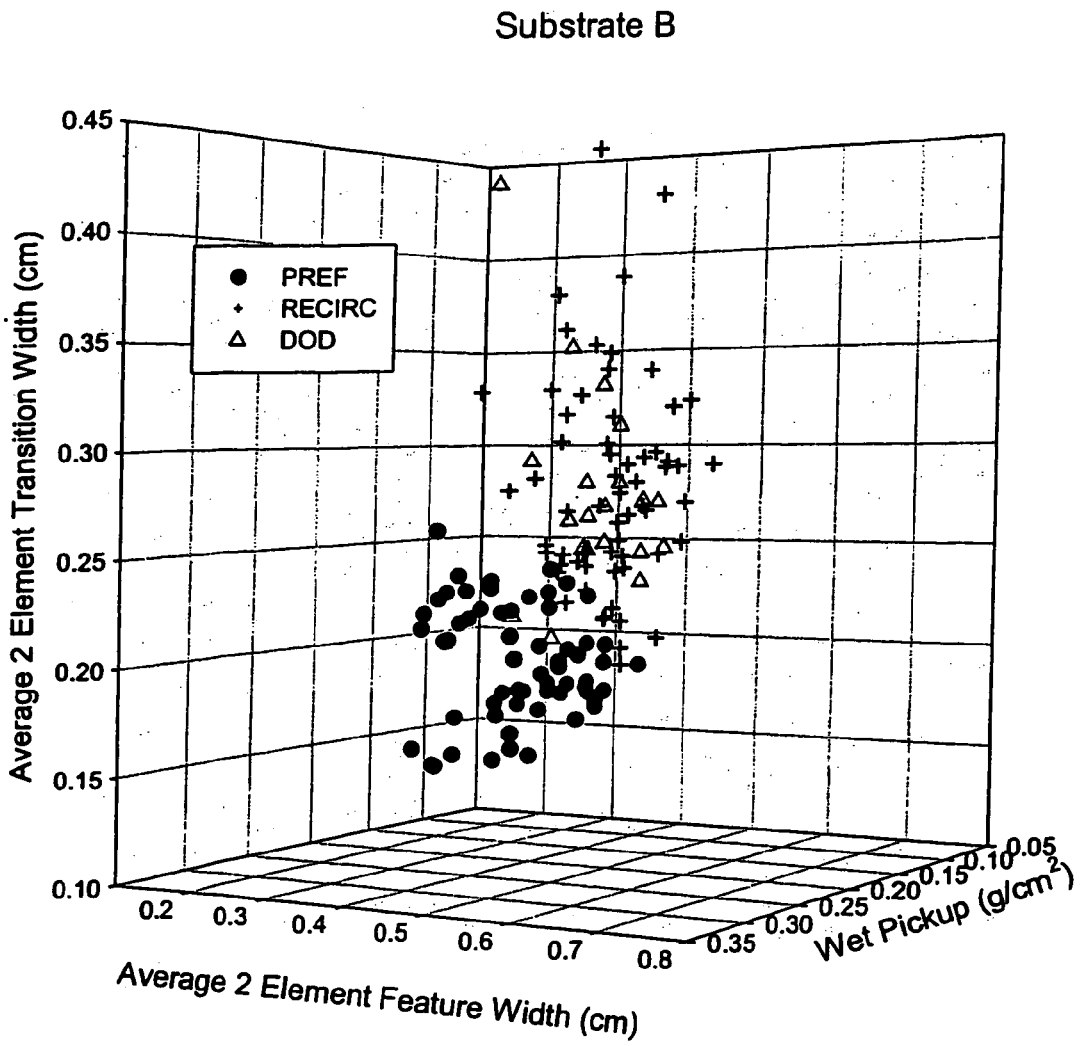

Or, equivalently, FIG. 221, (Substrate B)

$FW_{2element}$<0.35 cm, $TW_{2element}$<0.2 cm, Wet Pickup Range: 0.06-0.25 g/cm$^2$.

Directionally averaged values corresponding to the above boundaries for Substrate B (see FIG. 219) are:

(Substrate B)

$FW_{2element,\ directionally\ averaged}$<0.36, $TW_{2element,\ directionally\ averaged}$<0.24, Fractional Penetration≧0.5

Figure 223:
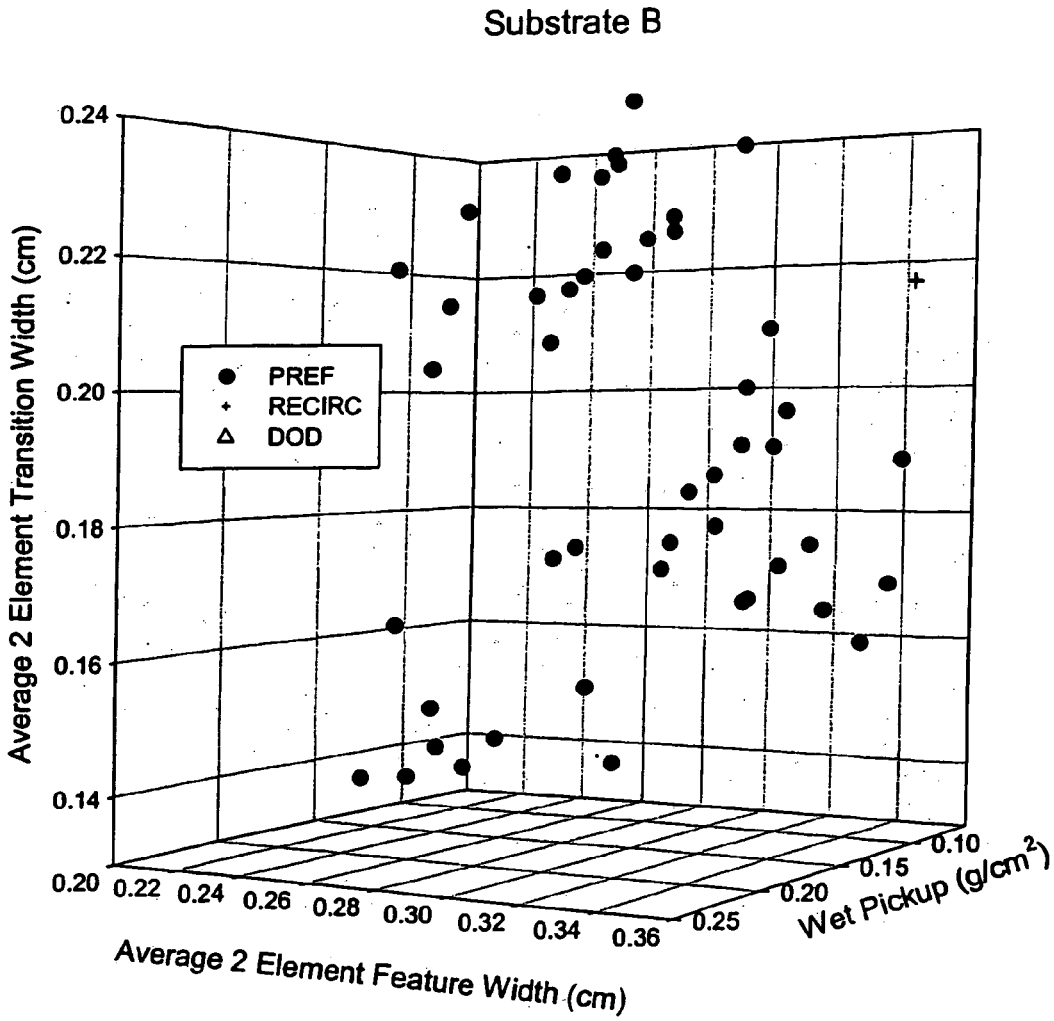
Figure 224:
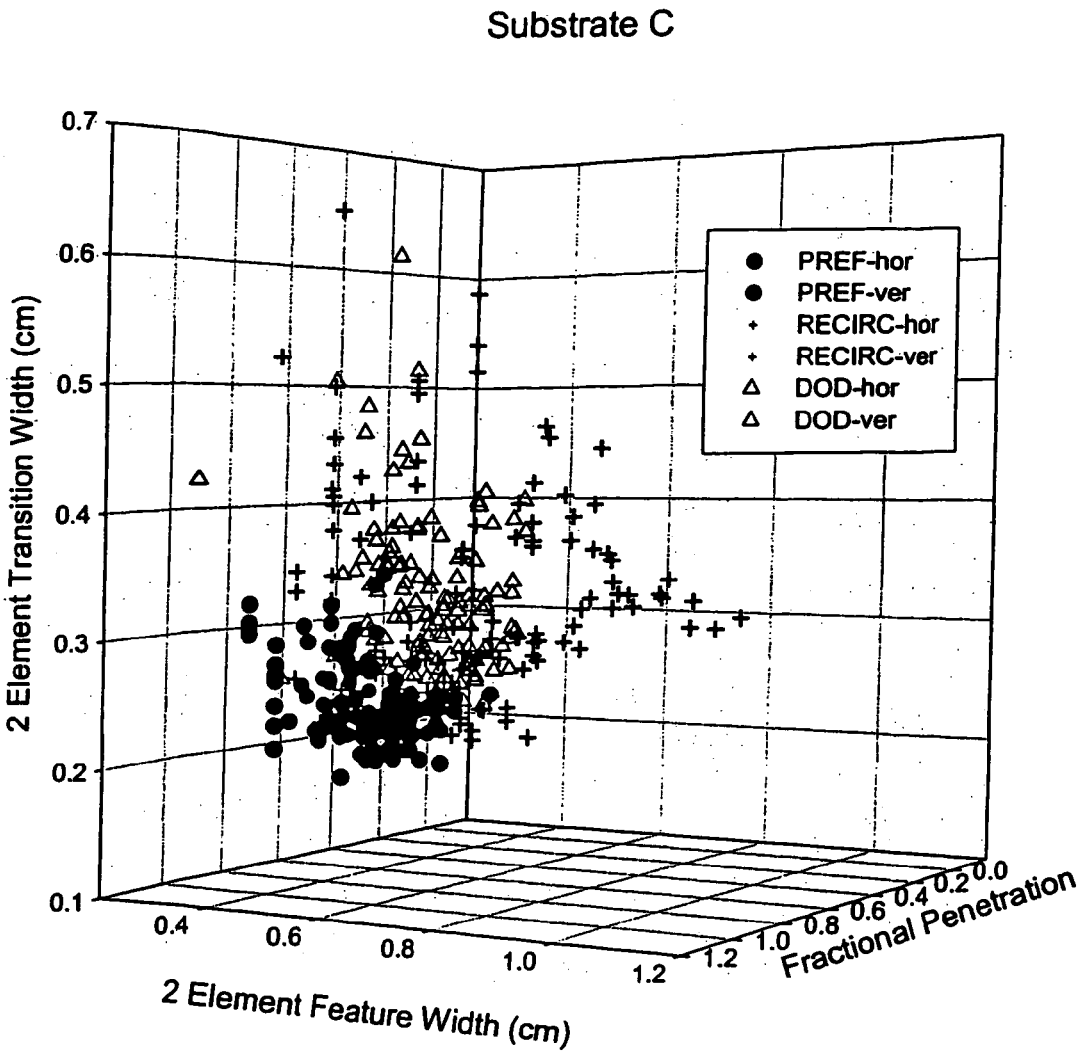

Or, equivalently, FIG. 223, (Substrate B)

$FW_{2element,\ directionally\ averaged}$<0.36, $TW_{2element,\ directionally\ averaged}$<0.24, Wet Pickup Range: 0.06-0.25 g/cm$^2$.

Figure 185:
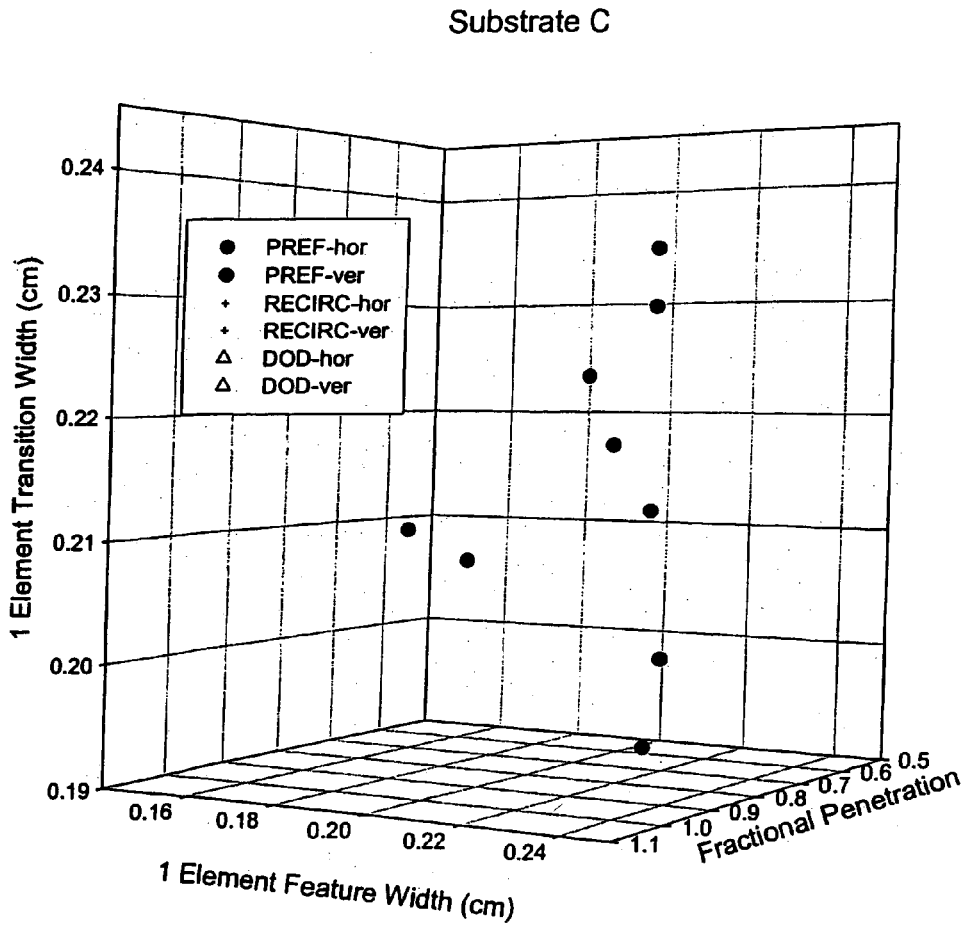
Figure 186:
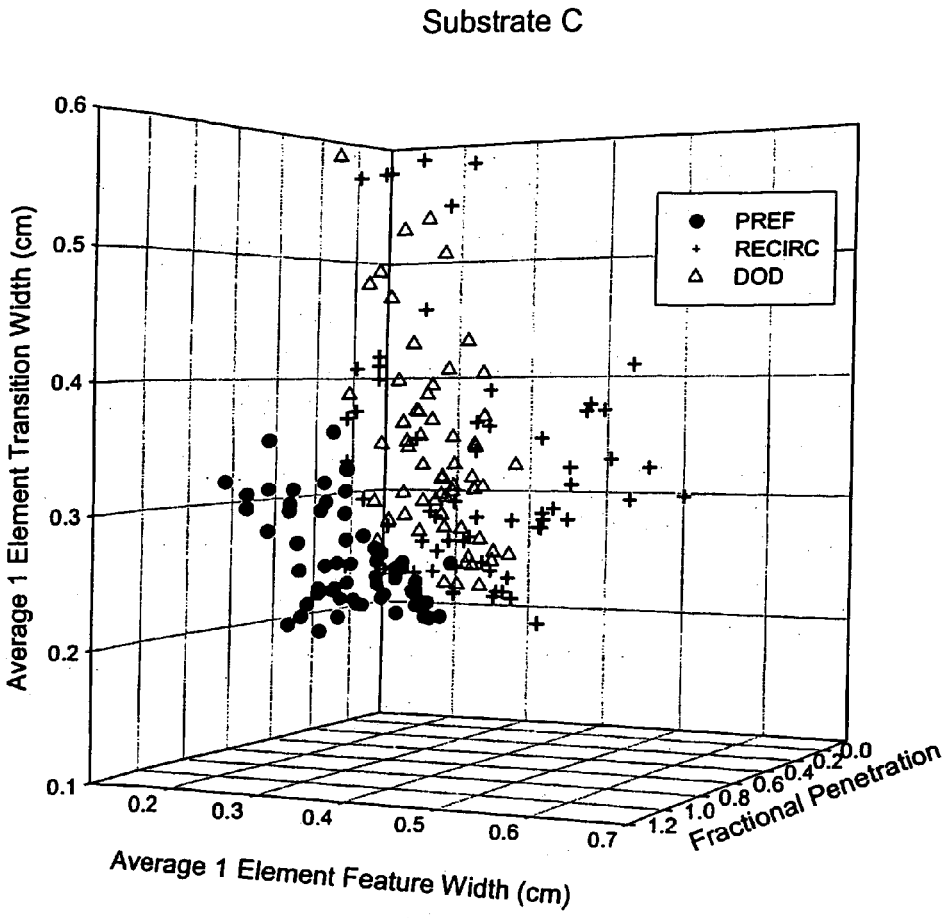

For Substrate C, direction-specific (two orthogonal directions) Feature Width, Transition Width and fractional penetration (and equivalent Wet Pickup range) values associated with a 1 element pattern area that are attainable only with the PREF patterning system (see FIG. 185) are:

(Substrate C)

$FW_{1element}$<0.25 cm, $TW_{1element}$<0.245 cm, Fractional Penetration≧0.5

Figure 189:
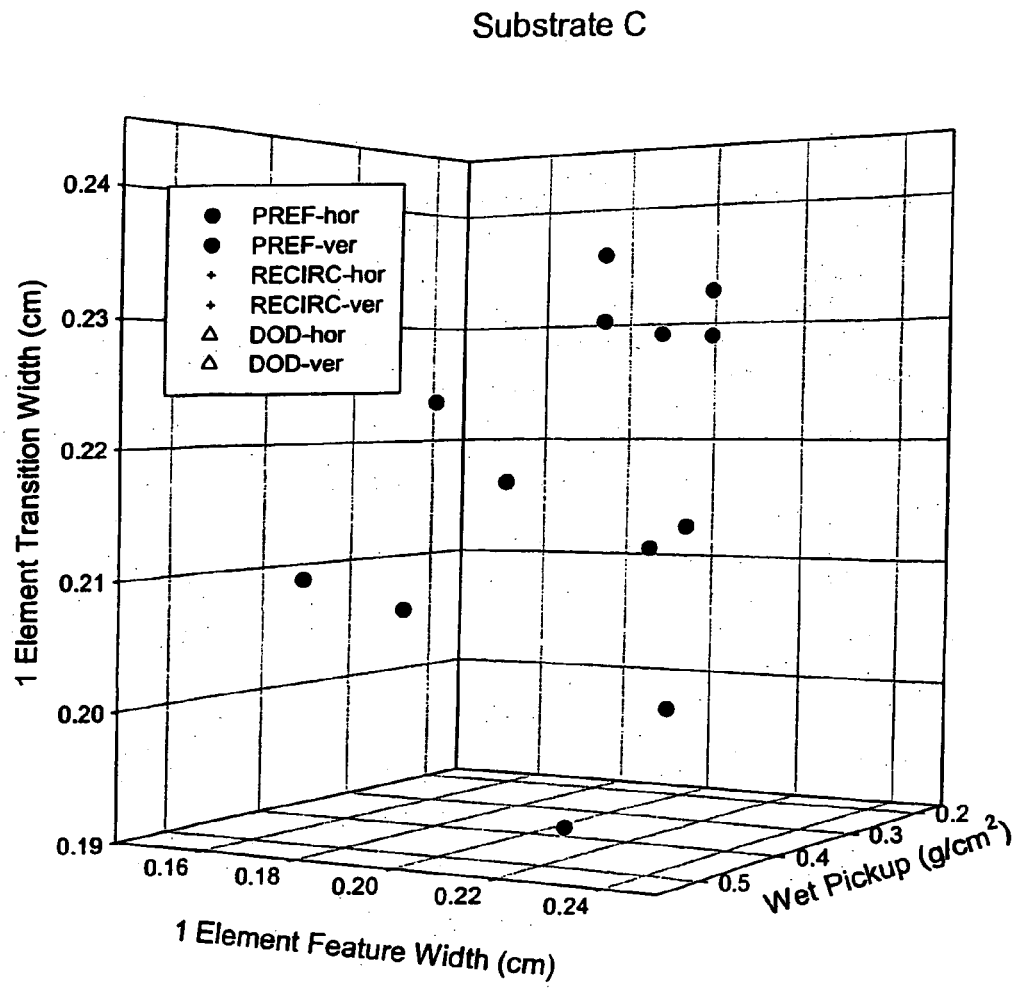
Figure 190:
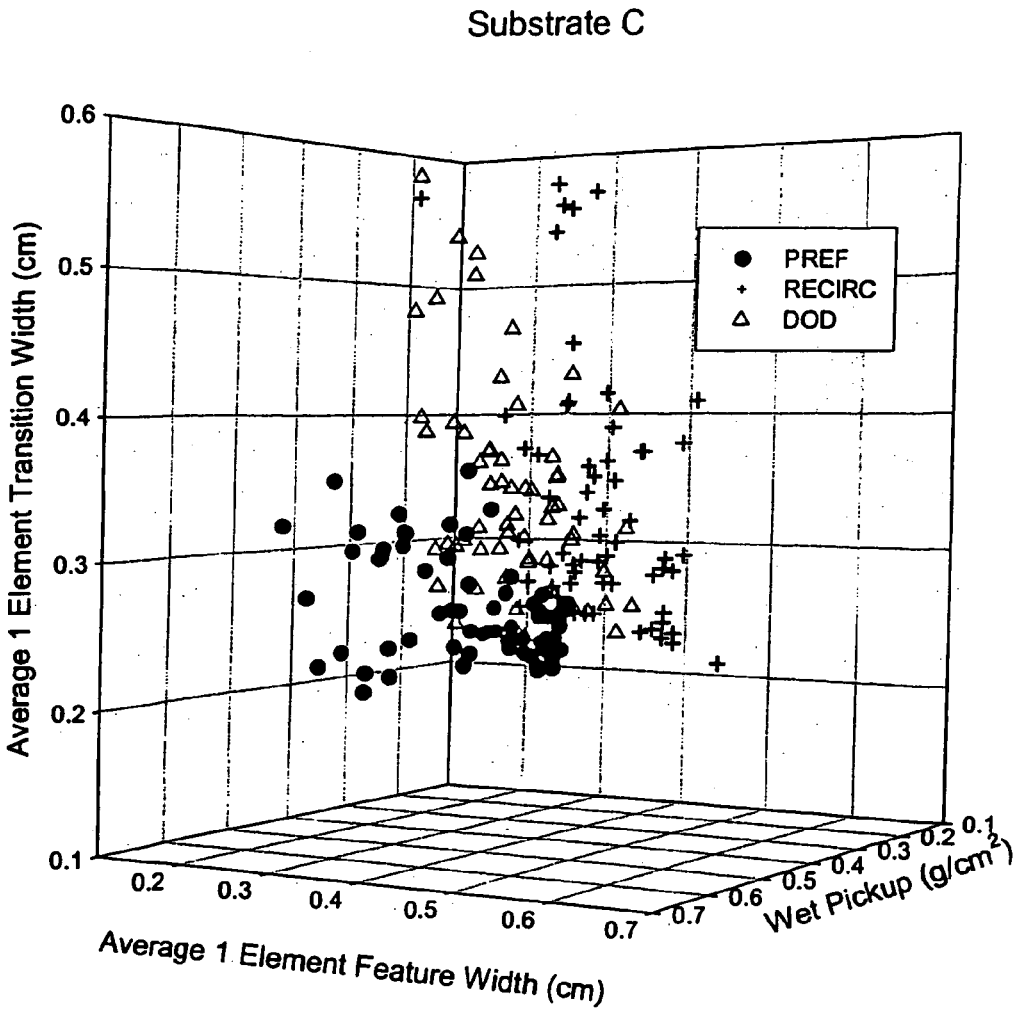

Or, equivalently, FIG. 189, (Substrate C)

$FW_{1element}$<0.25 cm, $TW_{1element}$<0.245 cm, Wet Pickup Range: 0.16-0.55 g/cm$^2$.

Figure 187:
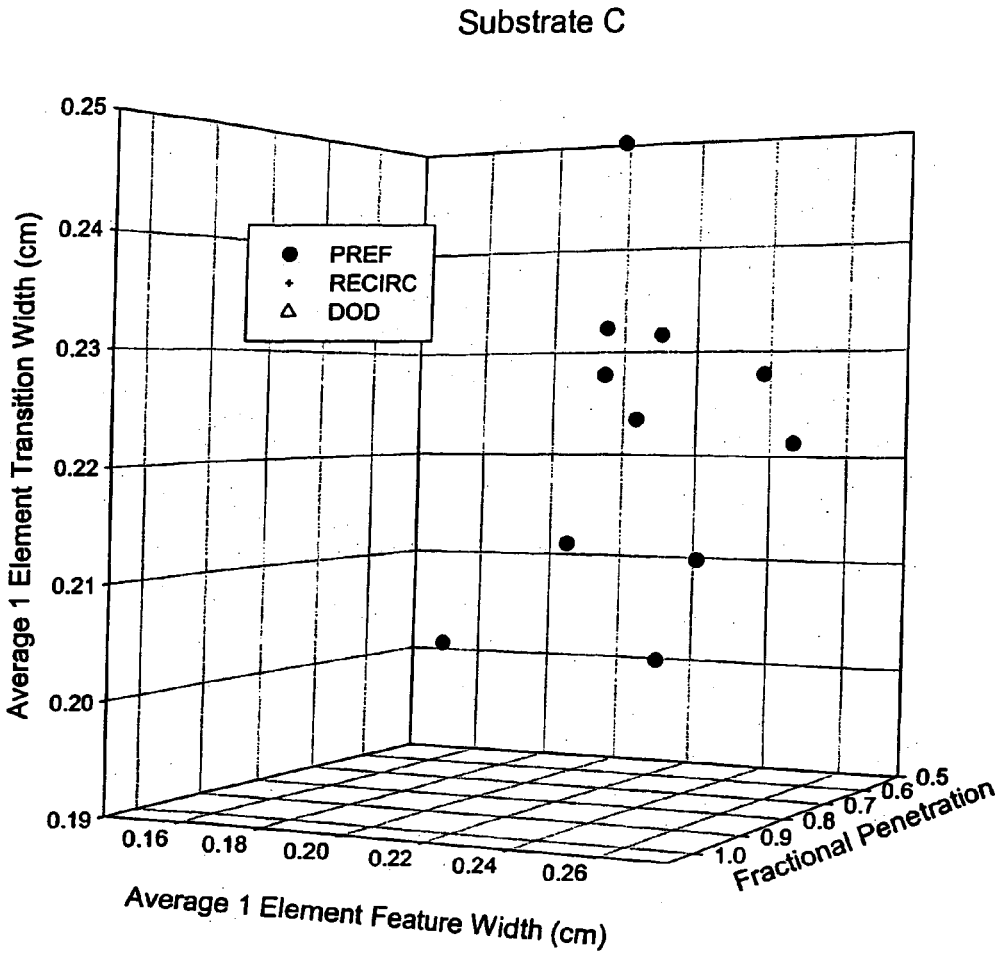
Figure 188:
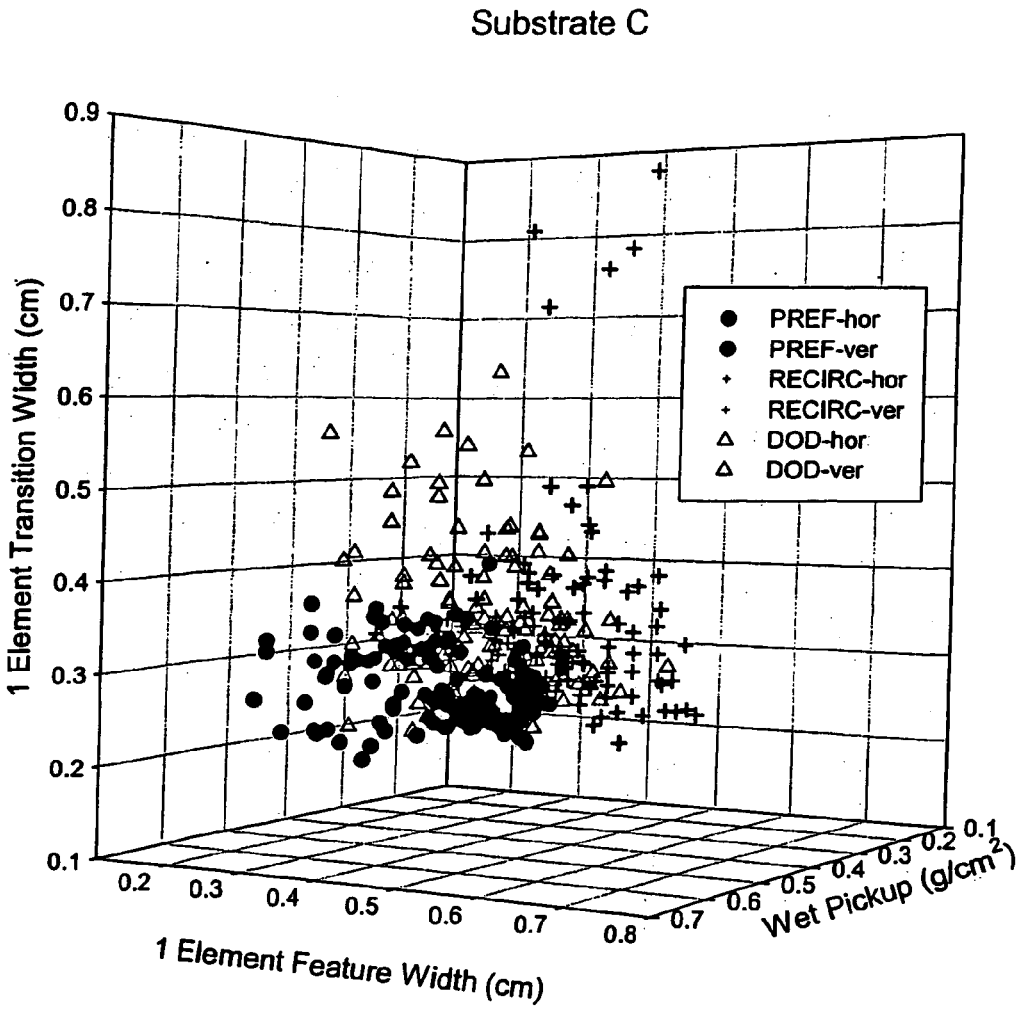

Directionally averaged values corresponding to the above boundaries for Substrate C (see FIG. 187) are:

(Substrate C)

$FW_{1element,\ directionally\ averaged}$<0.275 cm, $TW_{1element,\ directionally\ averaged}$<0.25 cm, Fractional Penetration>0.5

Figure 191:
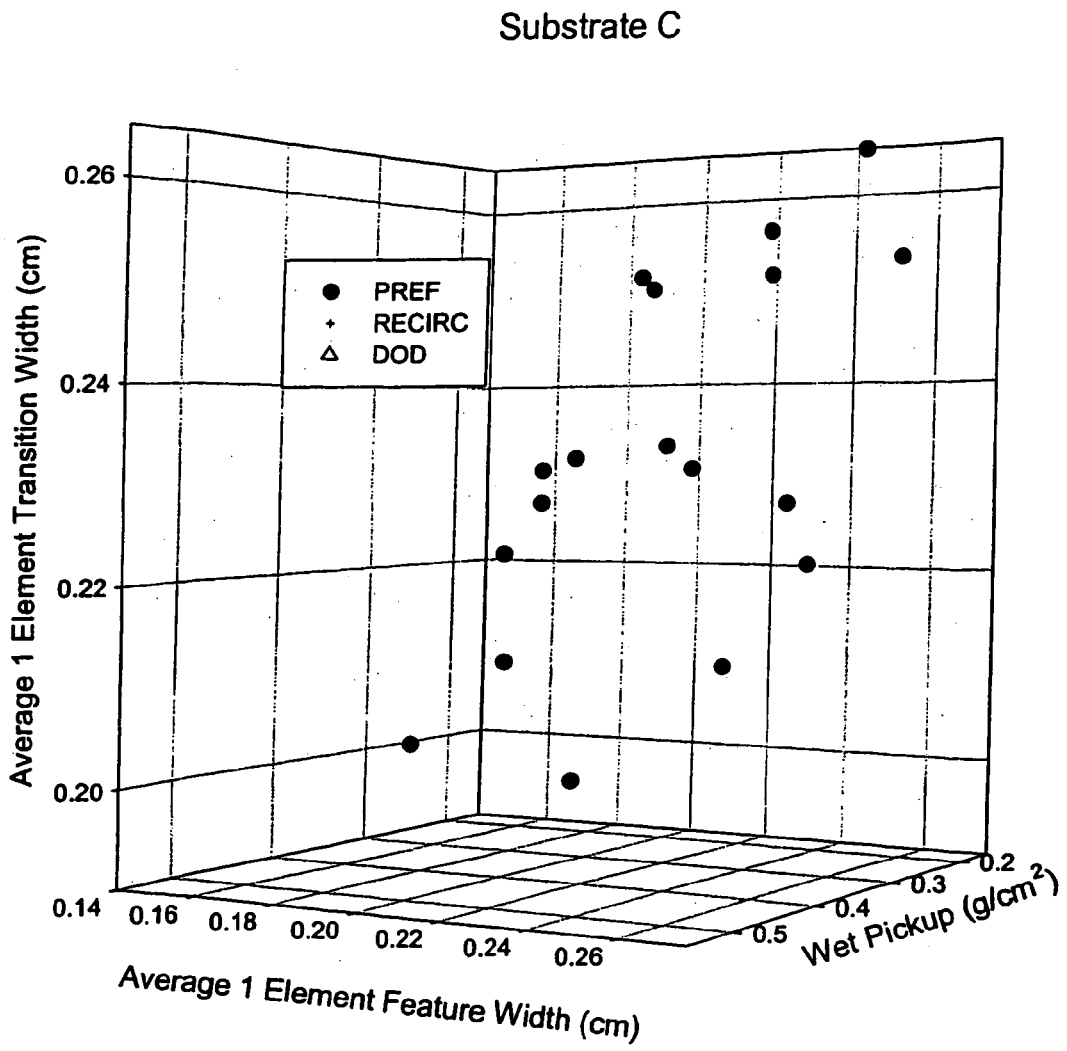
Figure 192:
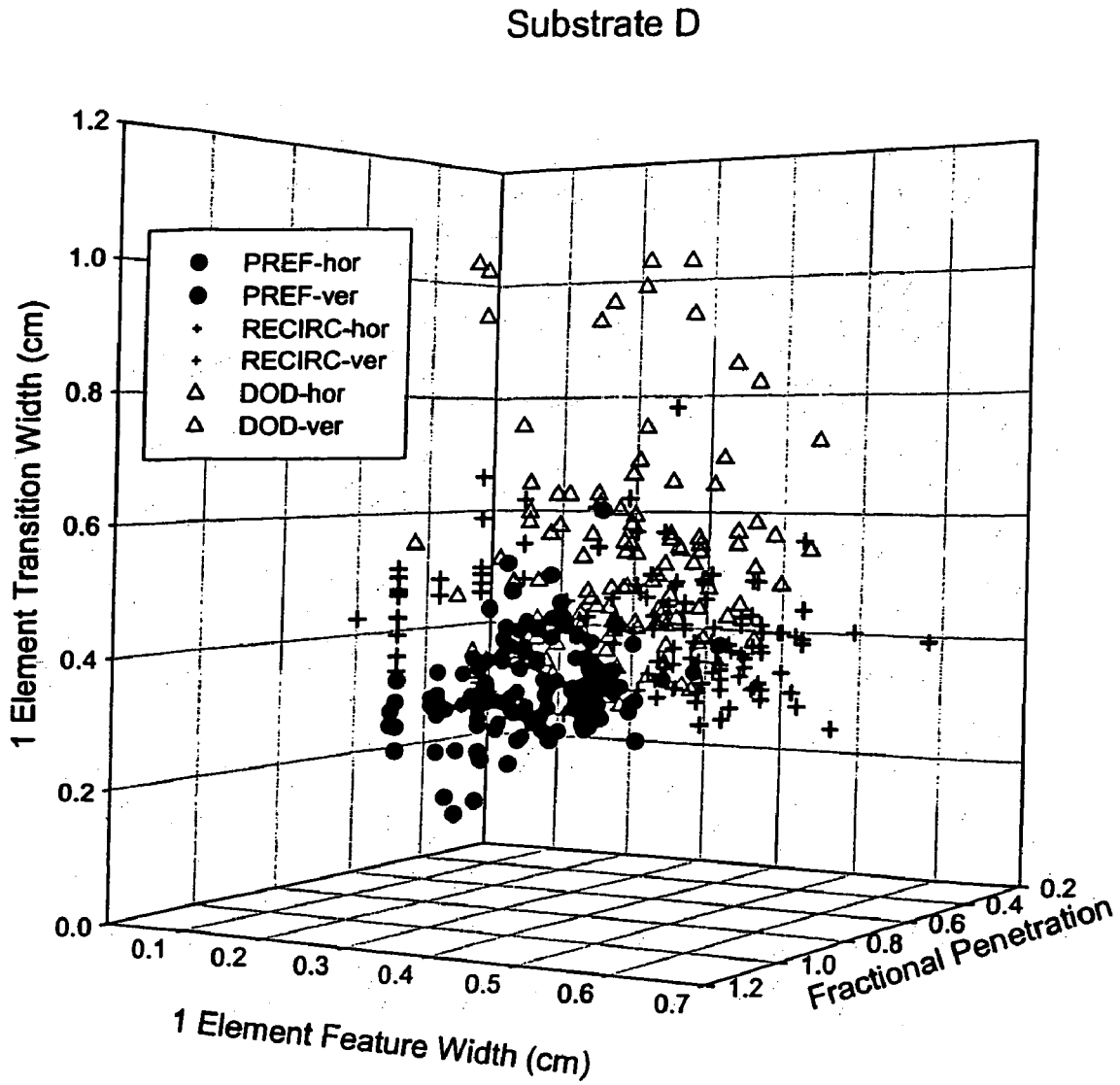

Or, equivalently, FIG. 191, (Substrate C)

$FW_{1element,\ directionally\ averaged}$<0.275 cm, $TW_{1elment,\ directionally\ averaged}$<0.265 cm, Wet Pickup Range: 0.16-0.55 g/cm$^2$.

Figure 225:
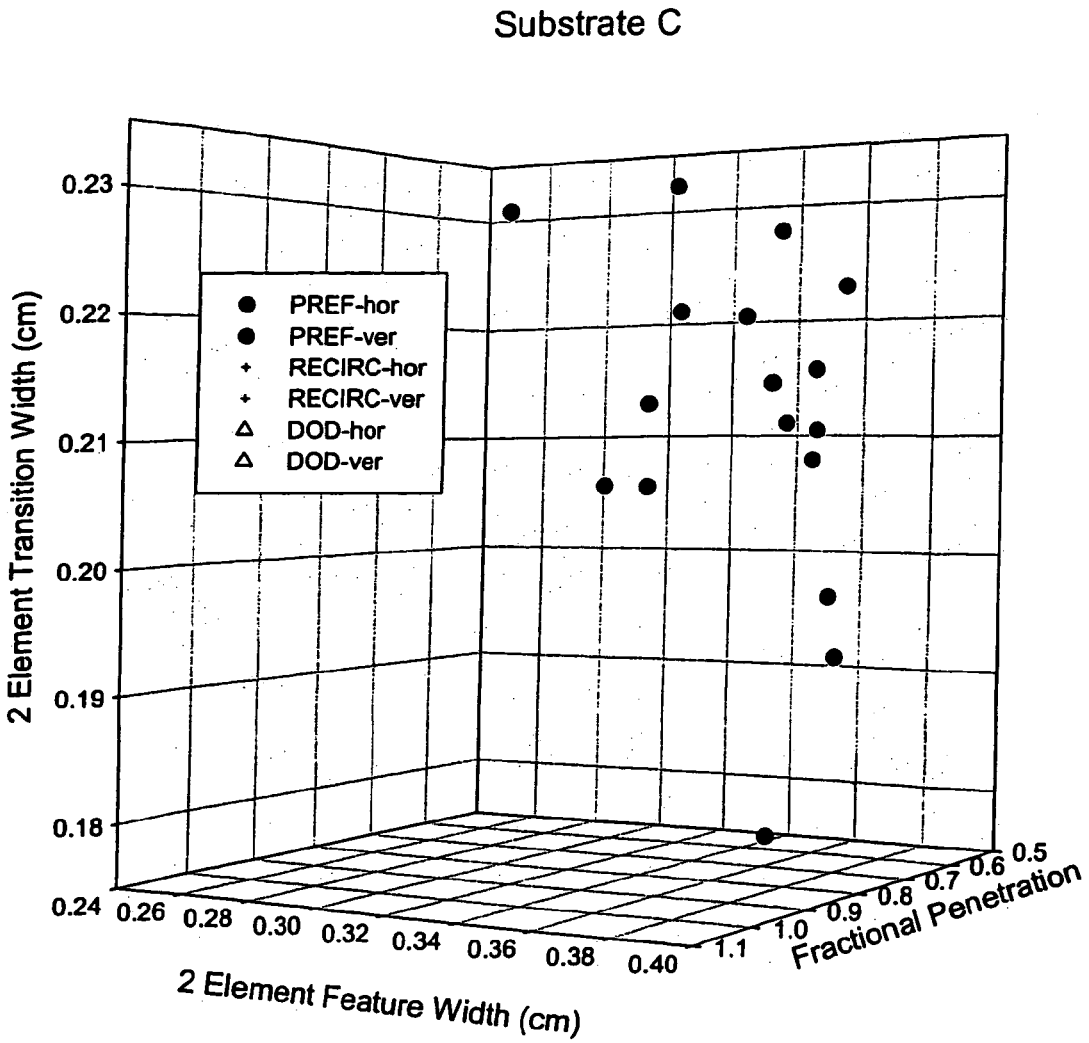
Figure 226:
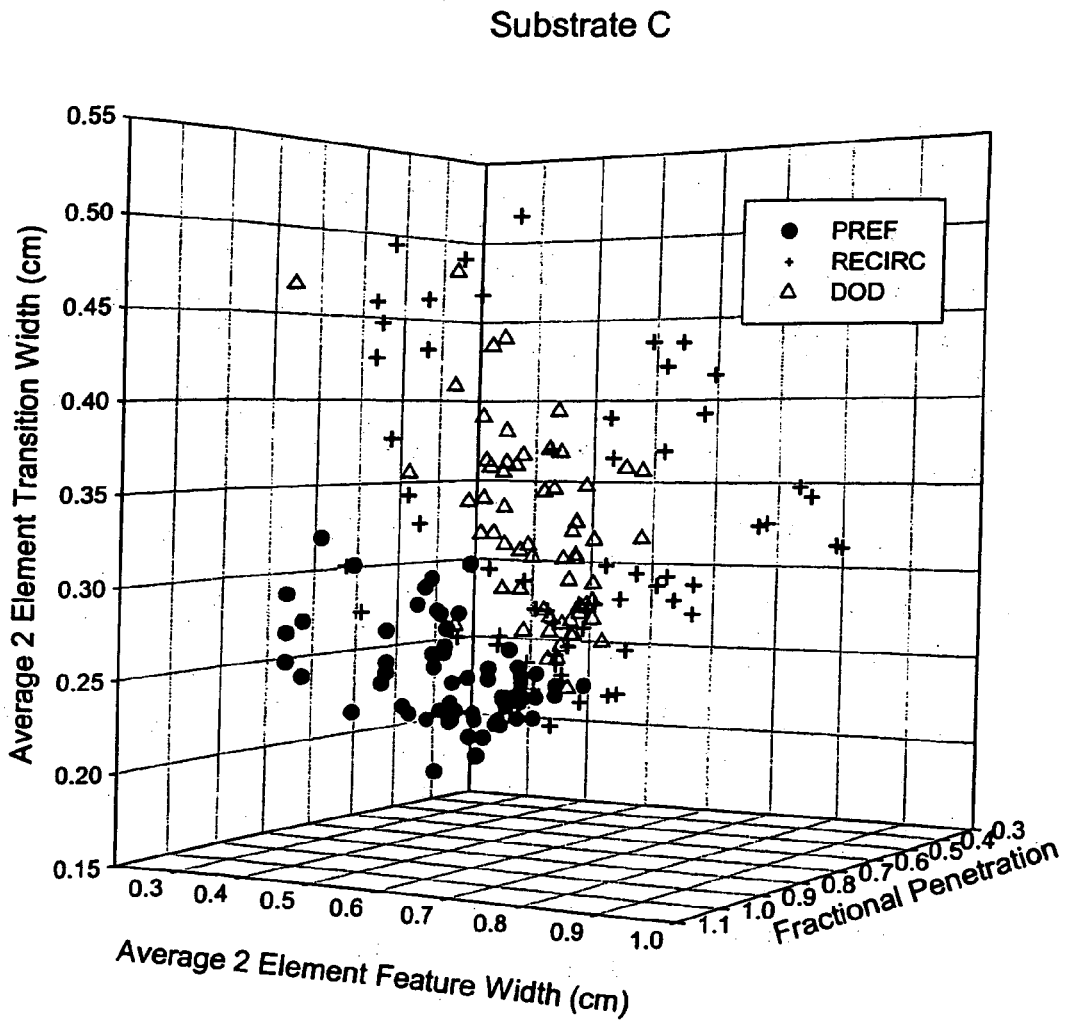

For Substrate C, direction-specific (two orthogonal directions) Feature Width, Transition Width and fractional penetration (and equivalent Wet Pickup range) values associated with a 2 element pattern area that are attainable only with the PREF patterning system (see FIG. 225) are:

(Substrate C)

$FW_{2element}$<0.4 cm, $TW_{2element}$<0.235 cm, Fractional Penetration≧0.5

Figure 229:
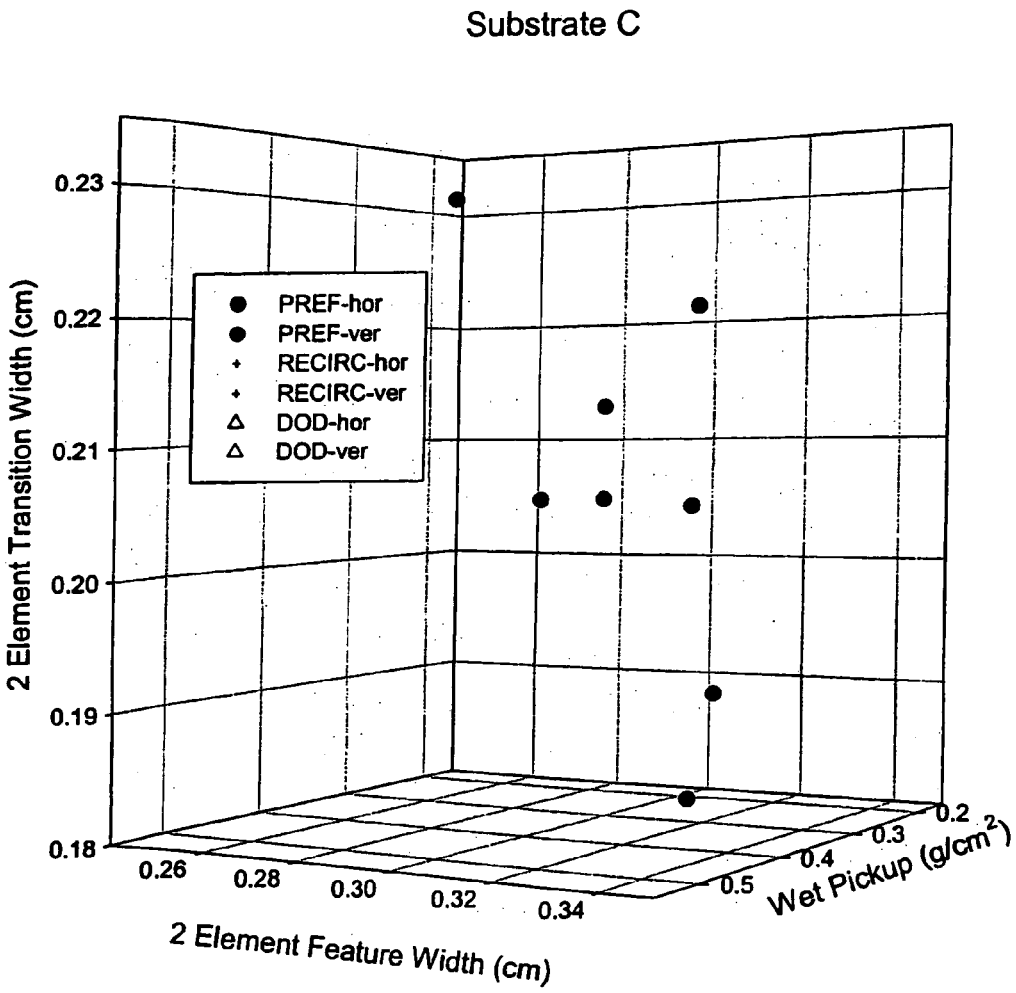
Figure 230:
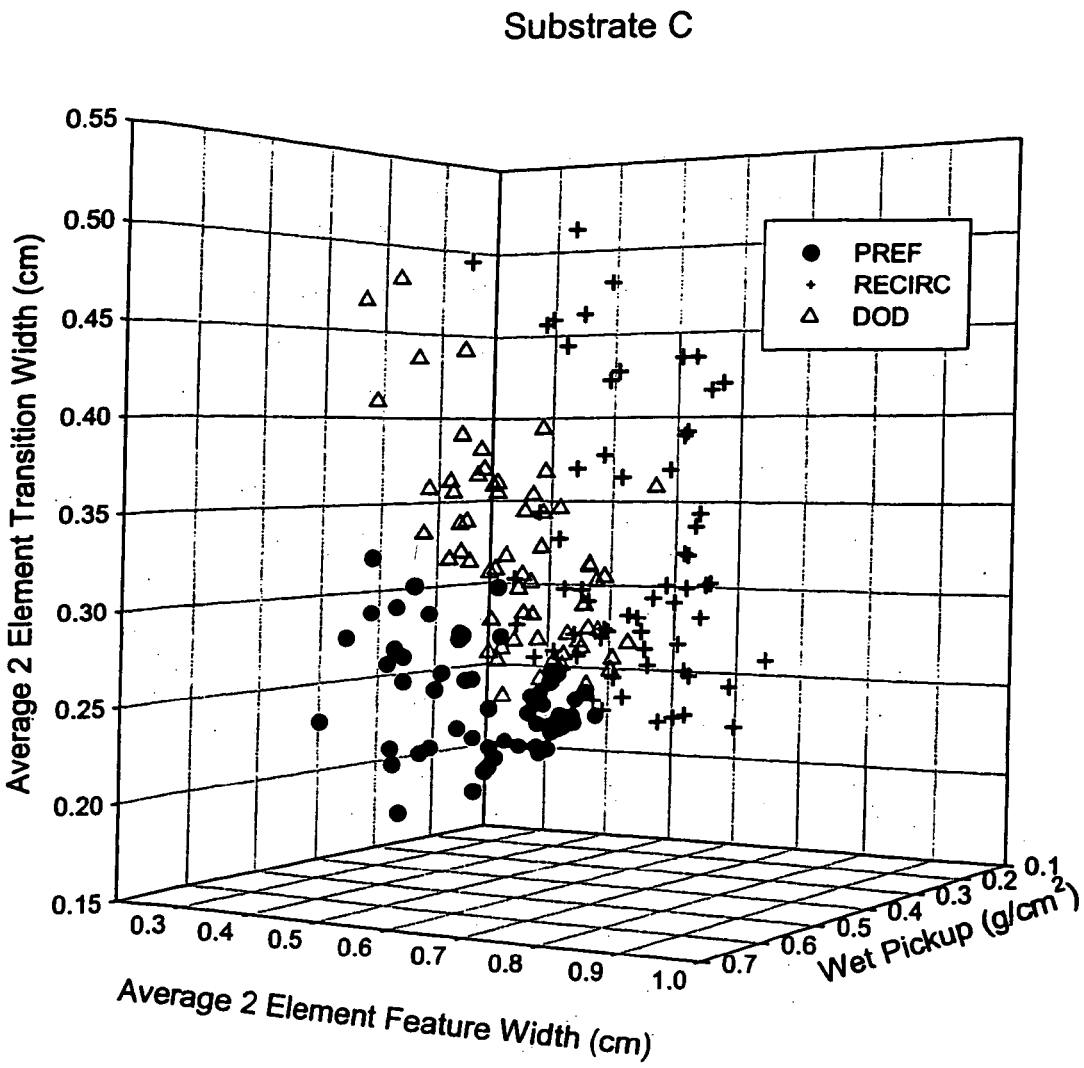

Or, equivalently, FIG. 229, (Substrate C)

$FW_{2element}$<0.35 cm, $TW_{2element}$<0.235 cm, Wet Pickup Range: 0.16-0.55 g/cm$^2$.

Figure 227:
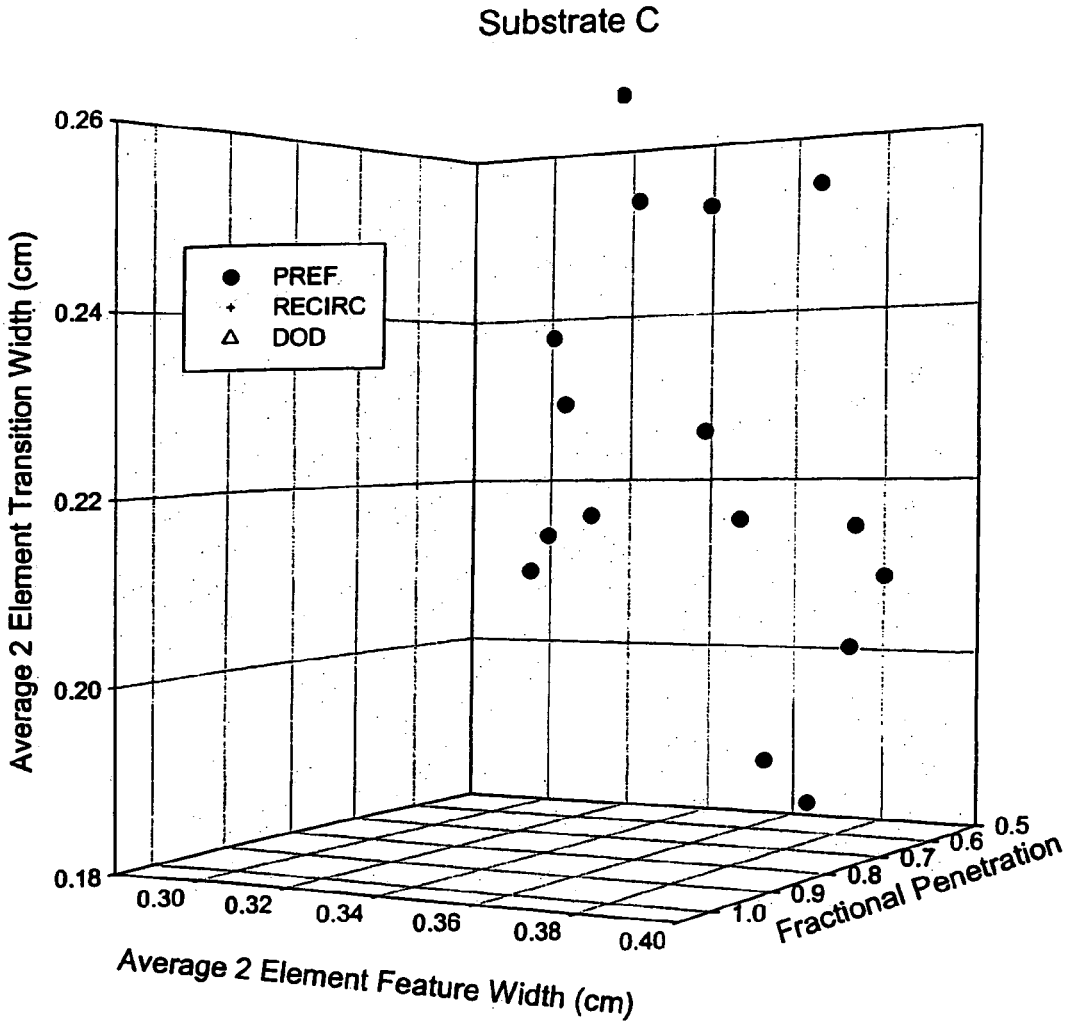
Figure 228:
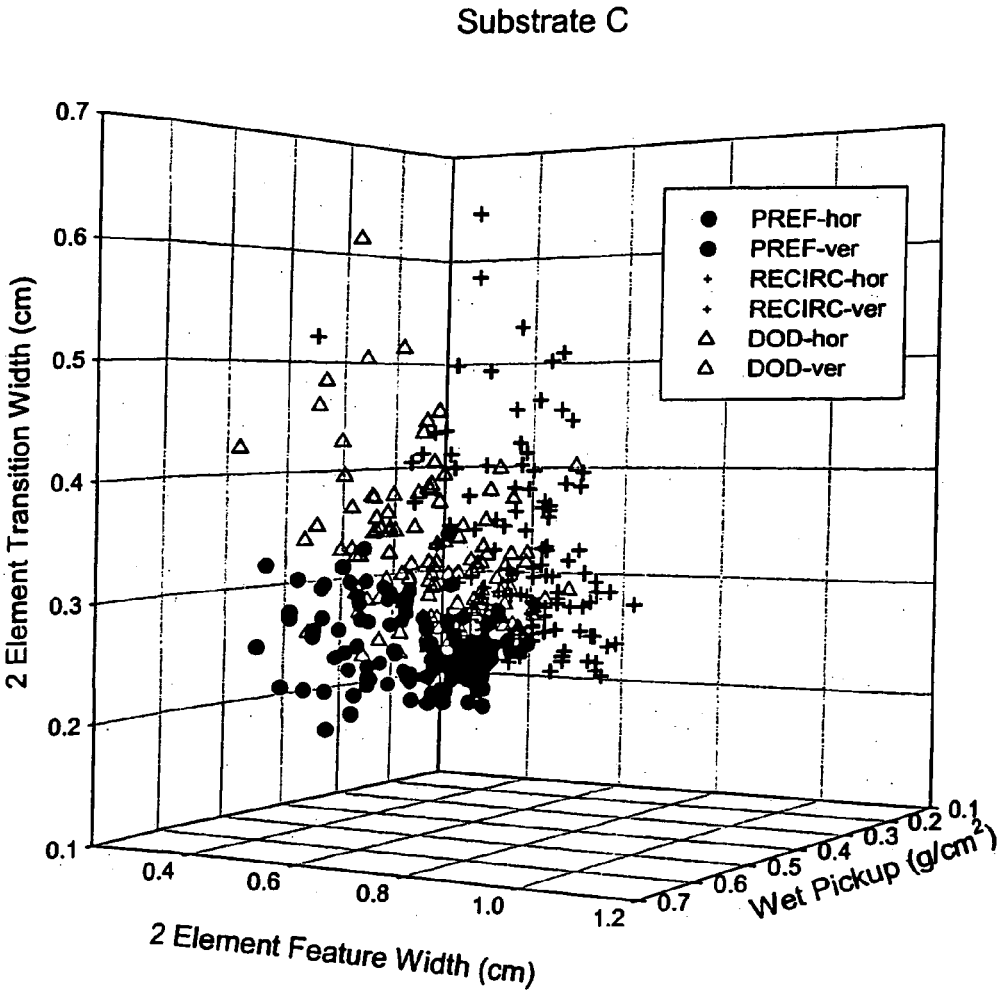

Directionally averaged values corresponding to the above boundaries for Substrate C (see FIG. 227) are:

(Substrate C)

$FW_{2element,\ directionally\ averaged}$<0.4, $TW_{2element,\ directionally\ averaged}$<0.26, Fractional Penetration≧0.5

Figure 231:
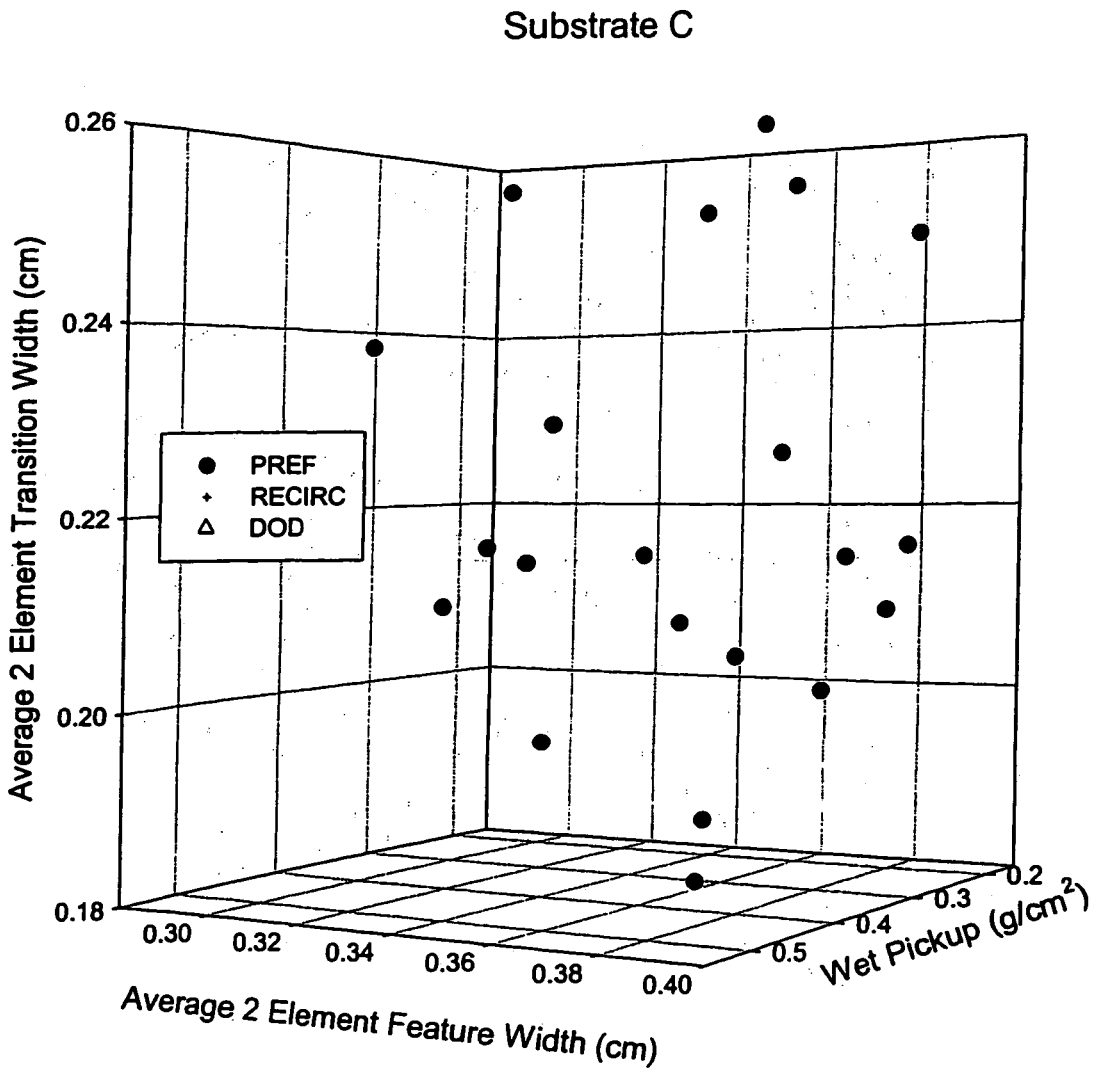
Figure 232:
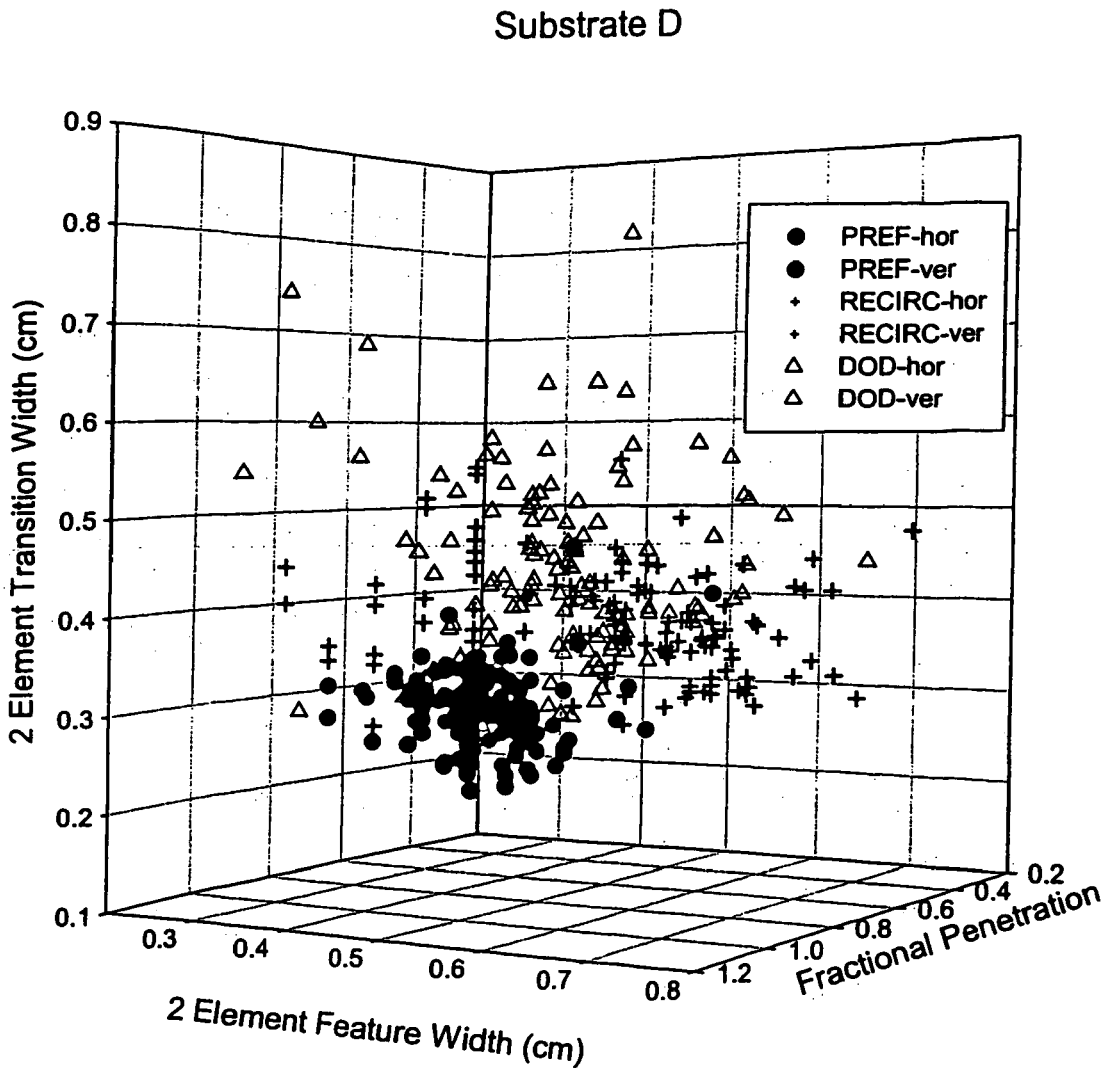

Or, equivalently, FIG. 231, (Substrate C)

$FW_{2element,\ directionally\ averaged}$<0.4, $TW_{2element,\ directionally\ averged}$<0.26, Wet Pickup Range: 0.16-0.55 g/cm$^2$.

Figure 193:
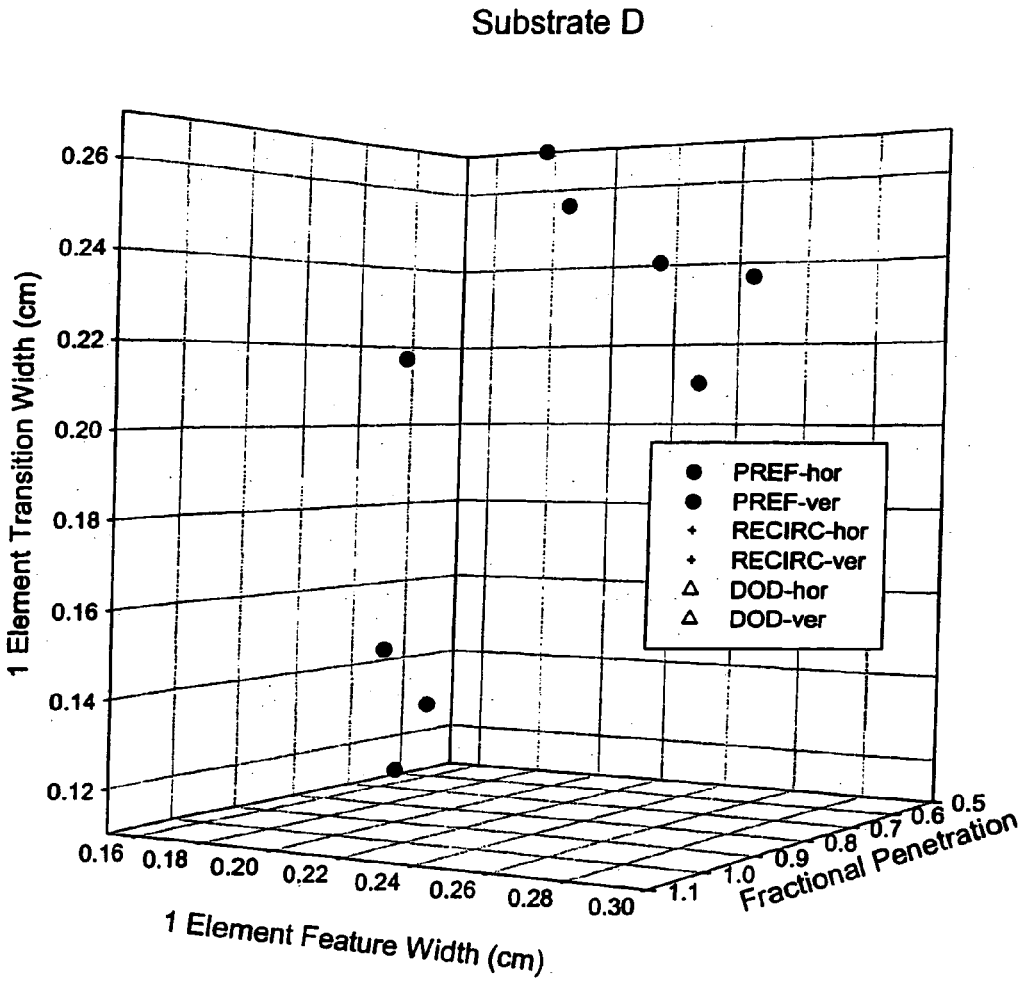
Figure 194:
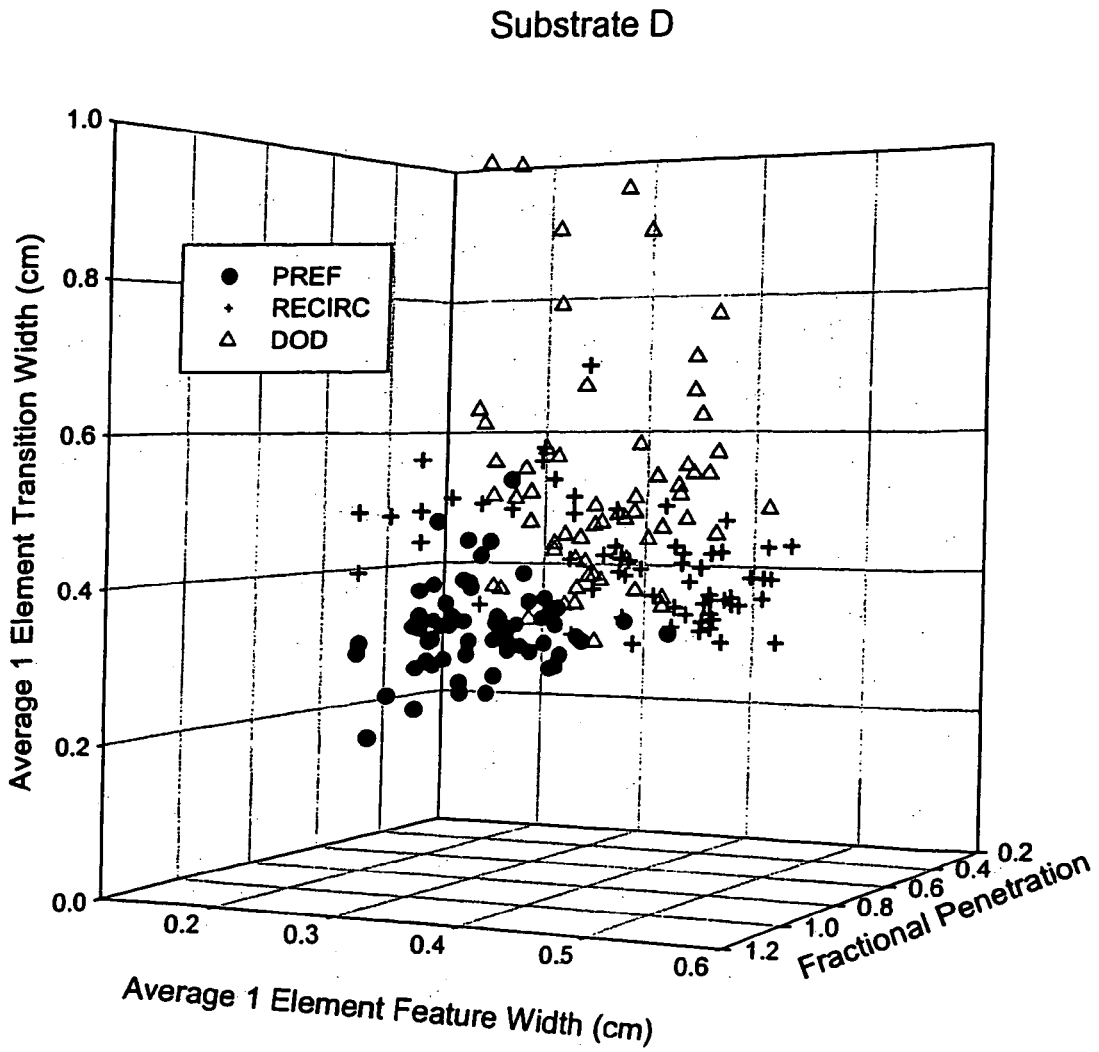

For Substrate D, direction-specific (two orthogonal directions) Feature Width, Transition Width and fractional penetration (and equivalent Wet Pickup range) values associated with a 1 element pattern area that are attainable only with the PREF patterning system (see FIG. 193) are:

(Substrate D)

$FW_{1element}$<0.3 cm, $TW_{1element}$<0.27 cm, Fractional Penetration≧0.5

Figure 197:
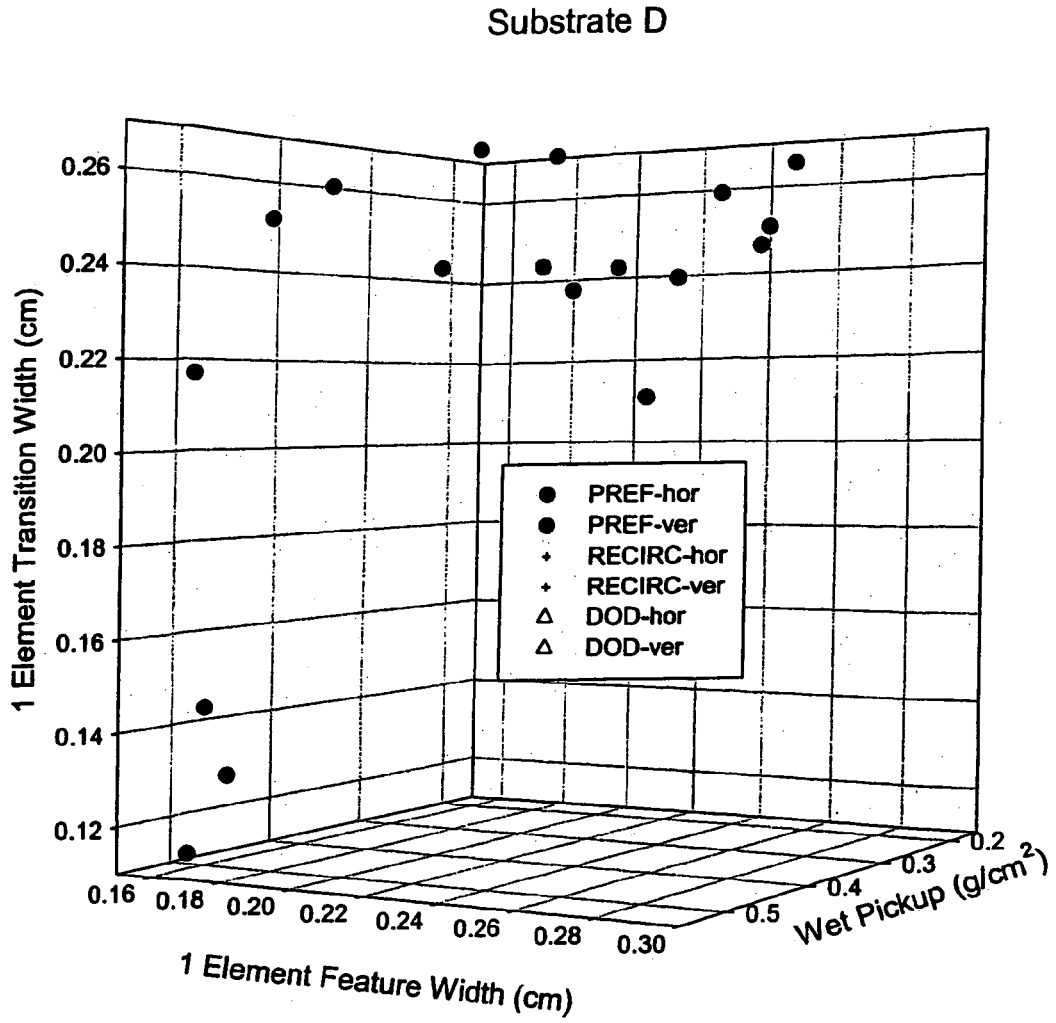
Figure 198:
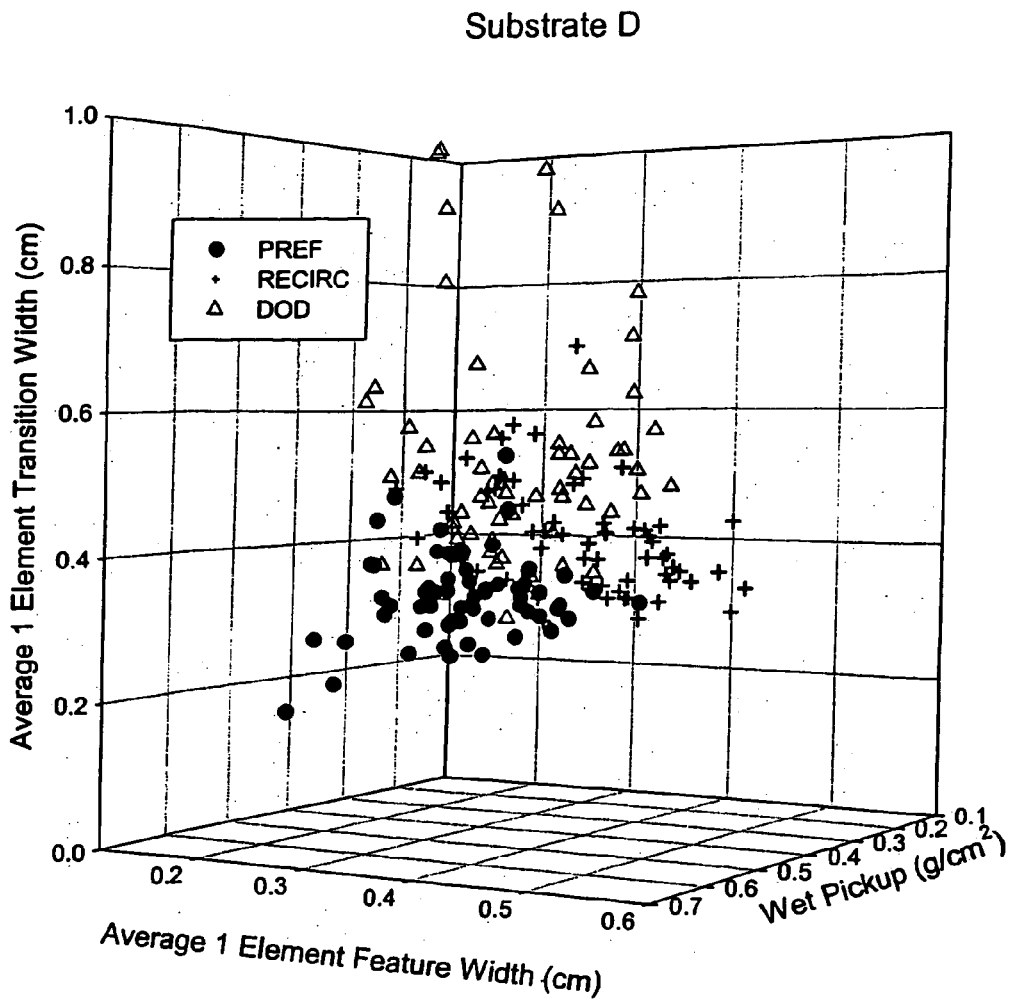

Or, equivalently, FIG. 197, (Substrate D)

$FW_{1element}$<0.3 cm, $TW_{1element}$<0.27 cm, Wet Pickup Range: 0.16-0.55 g/cm$^2$.

Figure 195:
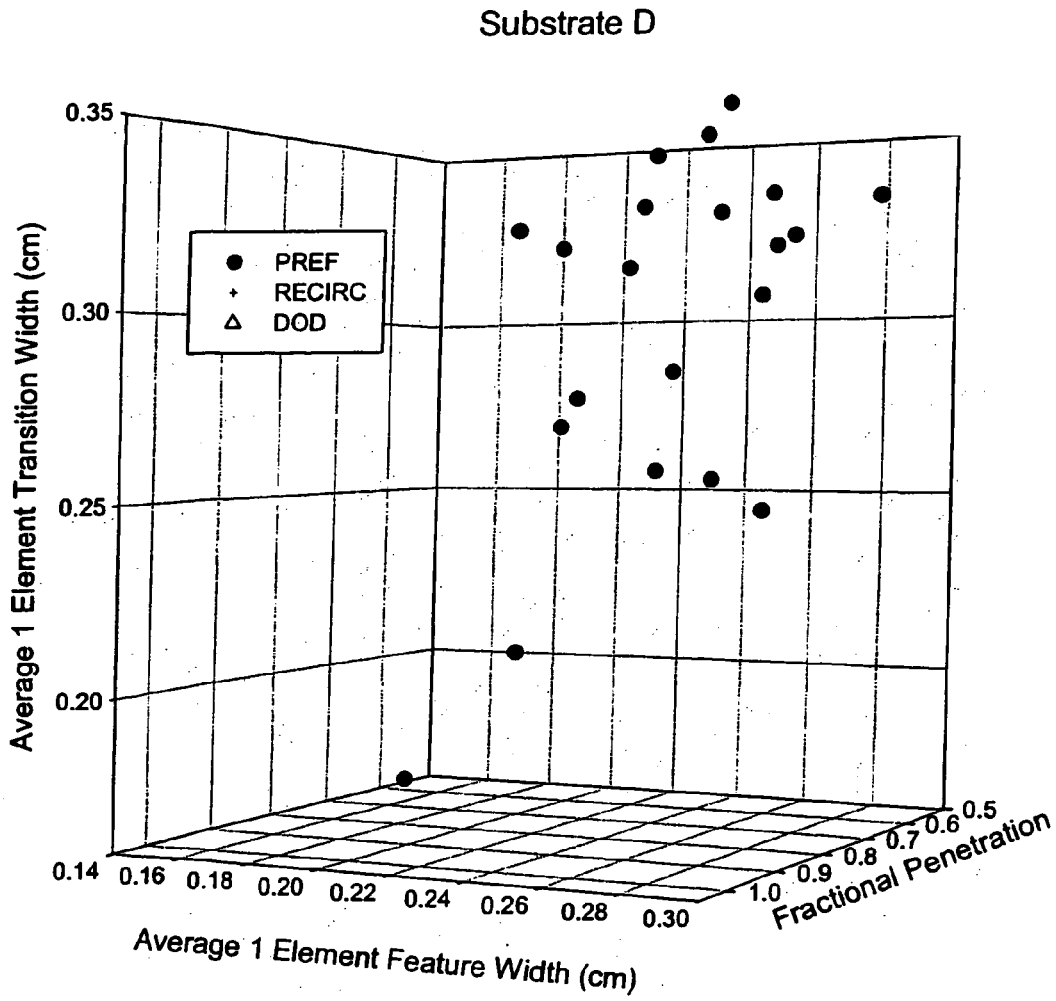
Figure 196:
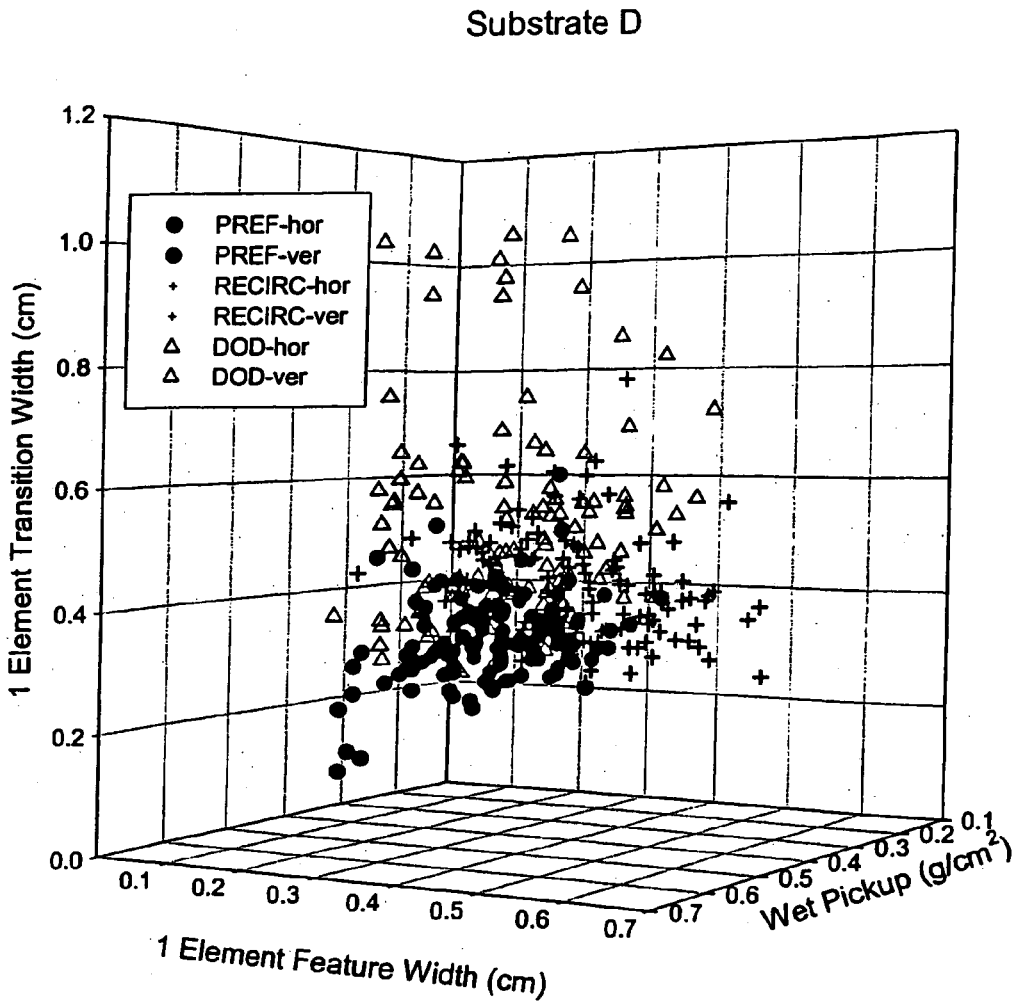

Directionally averaged values corresponding to the above boundaries for Substrate D (see FIG. 195) are:

(Substrate D)

$FW_{1element,\ directionally\ averaged}2$<0.3 cm, $TW_{1element,\ directionally\ averaged}$<0.35 cm, Fractional Penetration≧0.5

Figure 199:
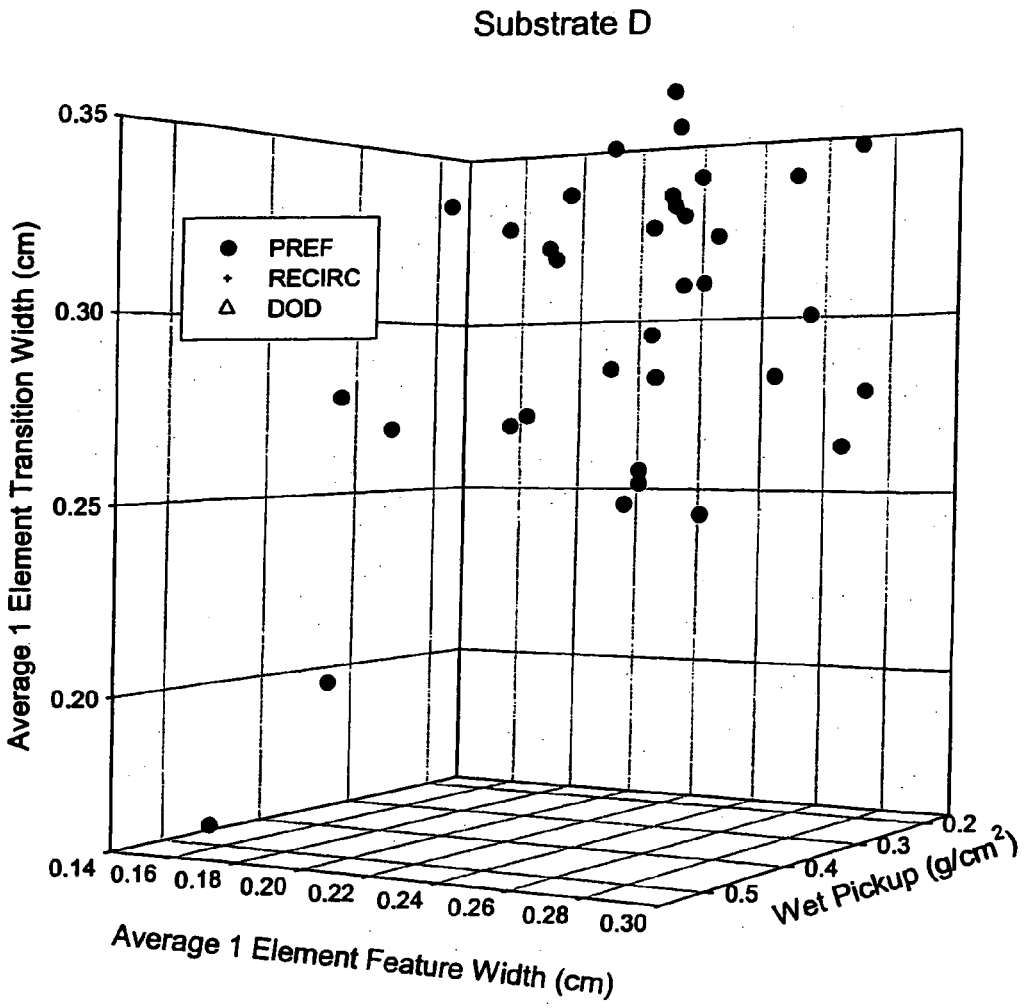
Figure 200:
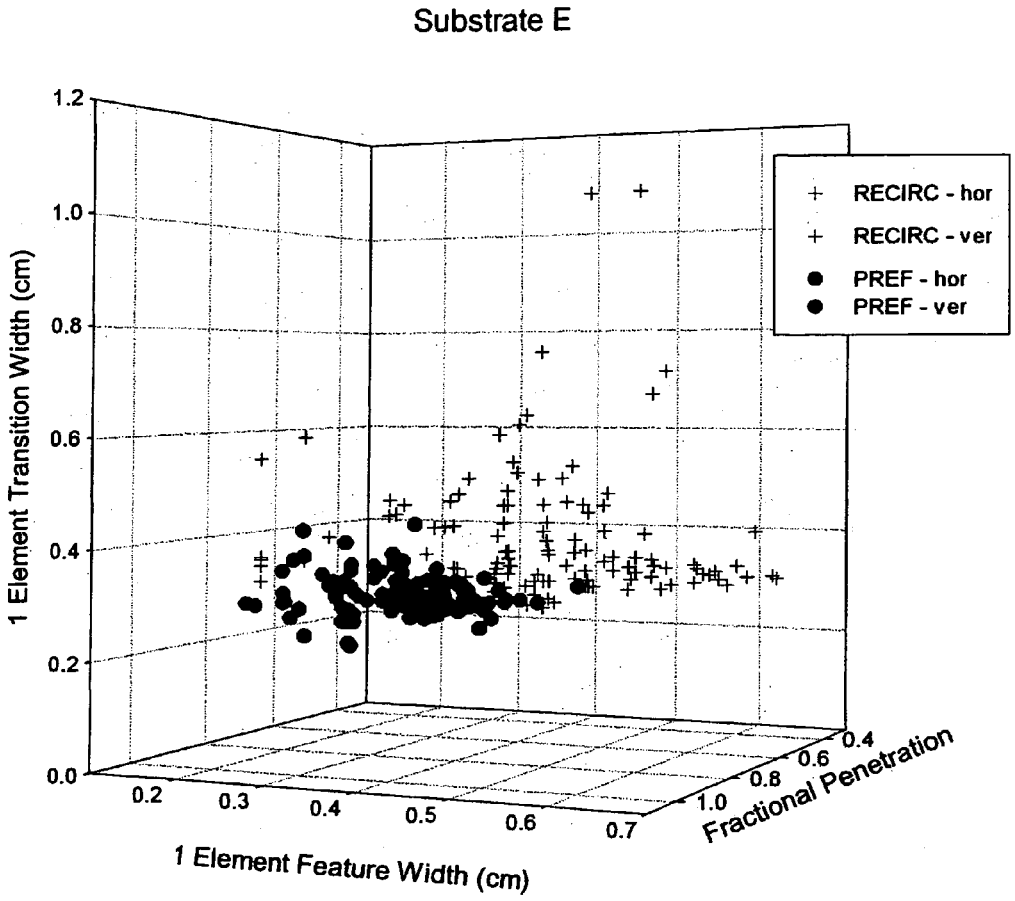

Or, equivalently, FIG. 199, (Substrate D)

$FW_{1element,\ directionally\ averaged}$<0.3 cm, $TW_{1element,\ directionally\ averaged}$<0.35 cm, Wet Pickup Range: 0.16-0.55 g/cm$^2$.

Figure 233:
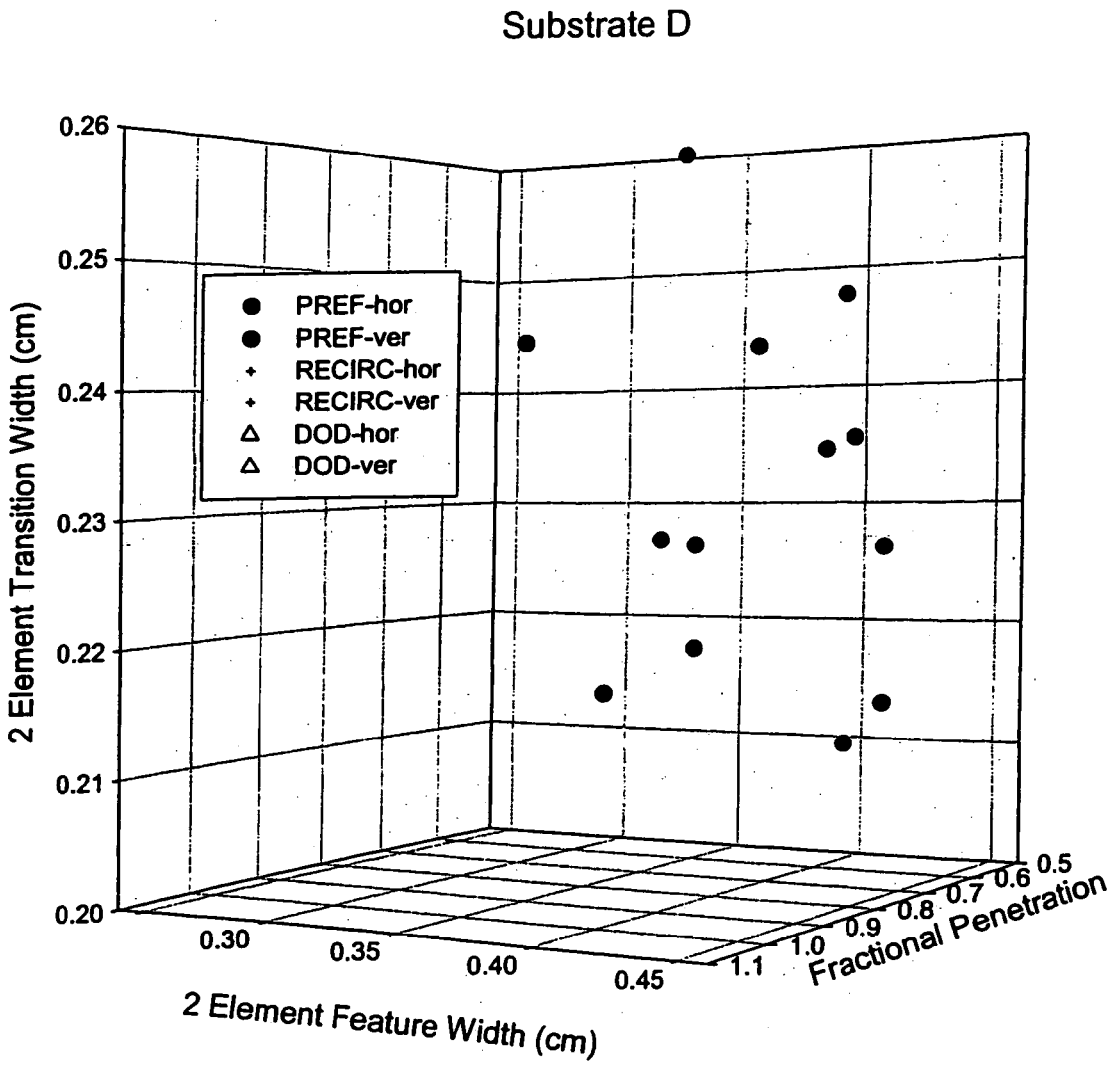
Figure 234:
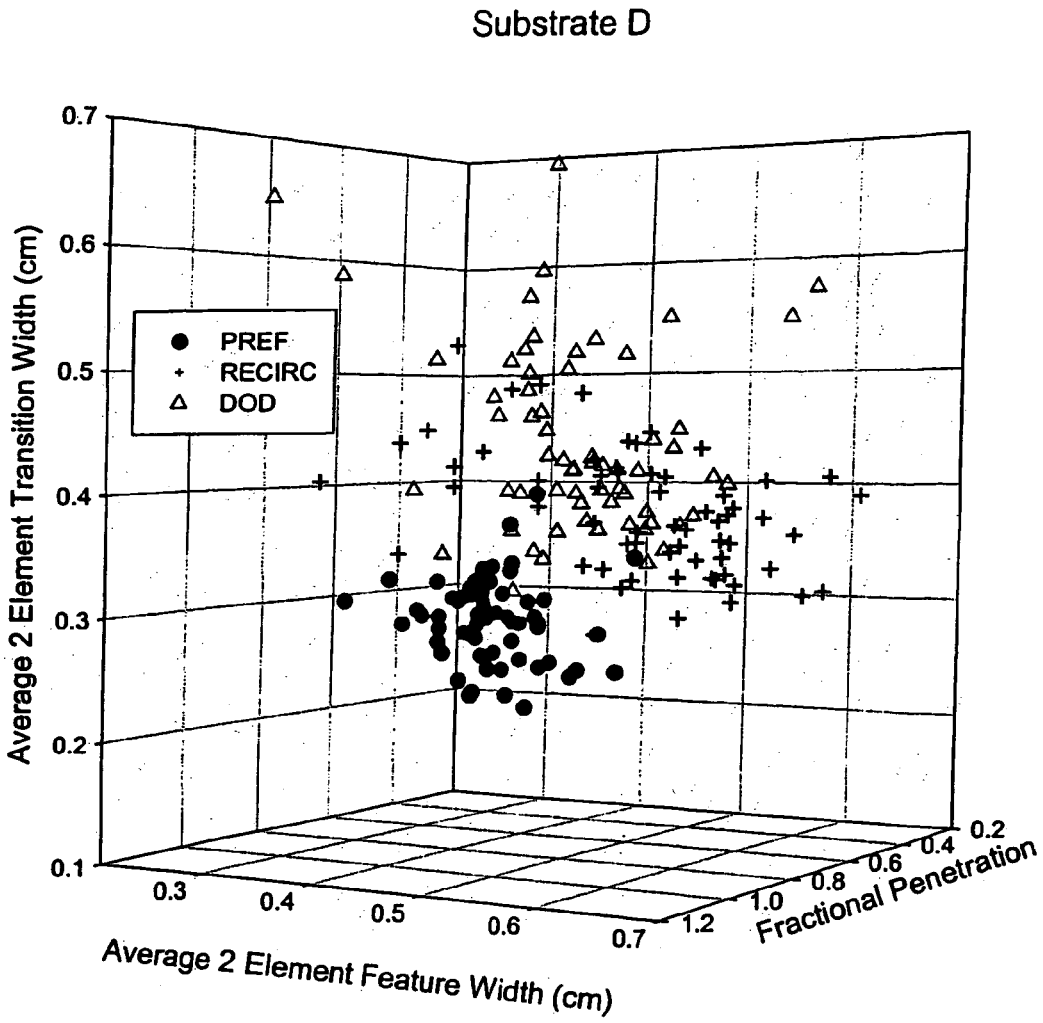

For Substrate D, direction-specific (two orthogonal directions) Feature Width, Transition Width and fractional penetration (and equivalent Wet Pickup range) values associated with a 1 element pattern area that are attainable only with the PREF patterning system (see FIG. 233) are:

(Substrate D)

$FW_{2element}$<0.46 cm, $TW_{2element}$<0.26 cm, Fractional Penetration≧0.5

Figure 237:
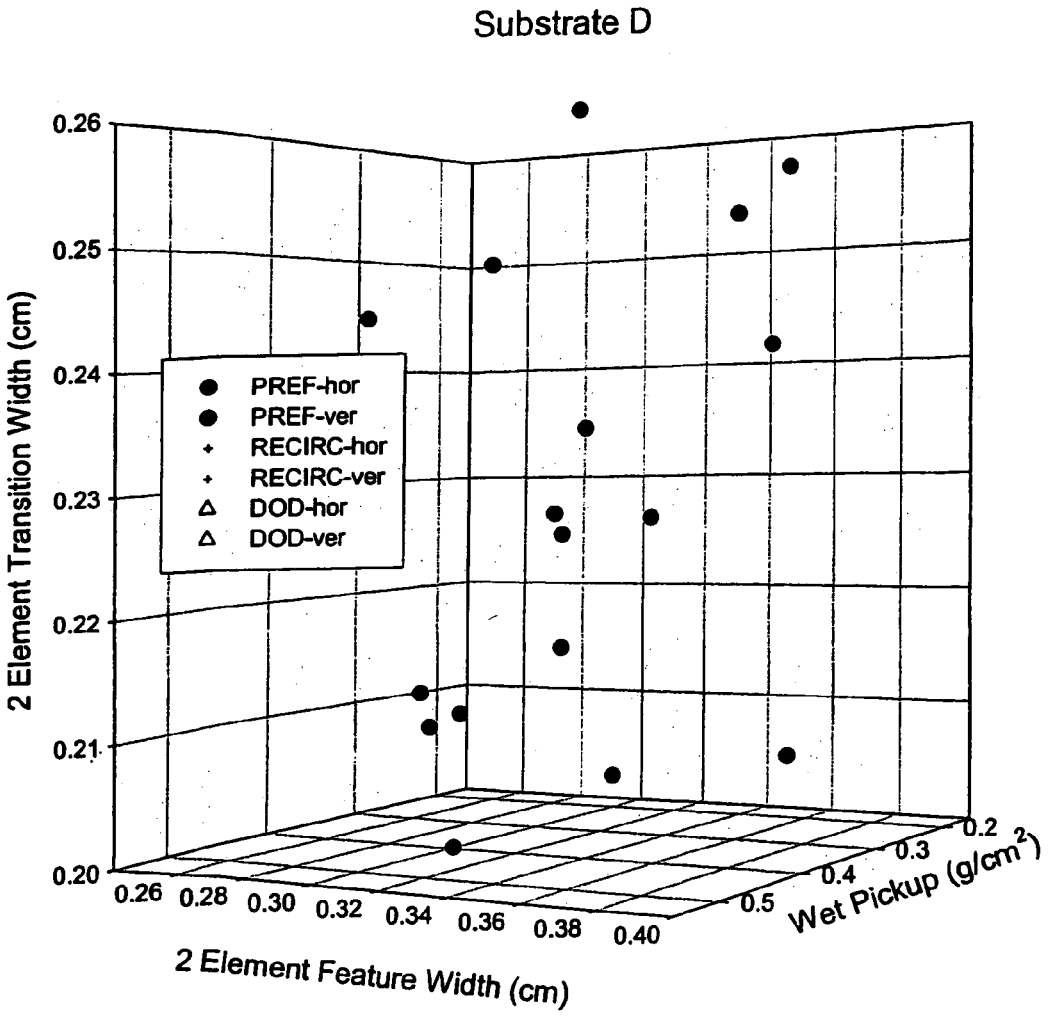
Figure 238:
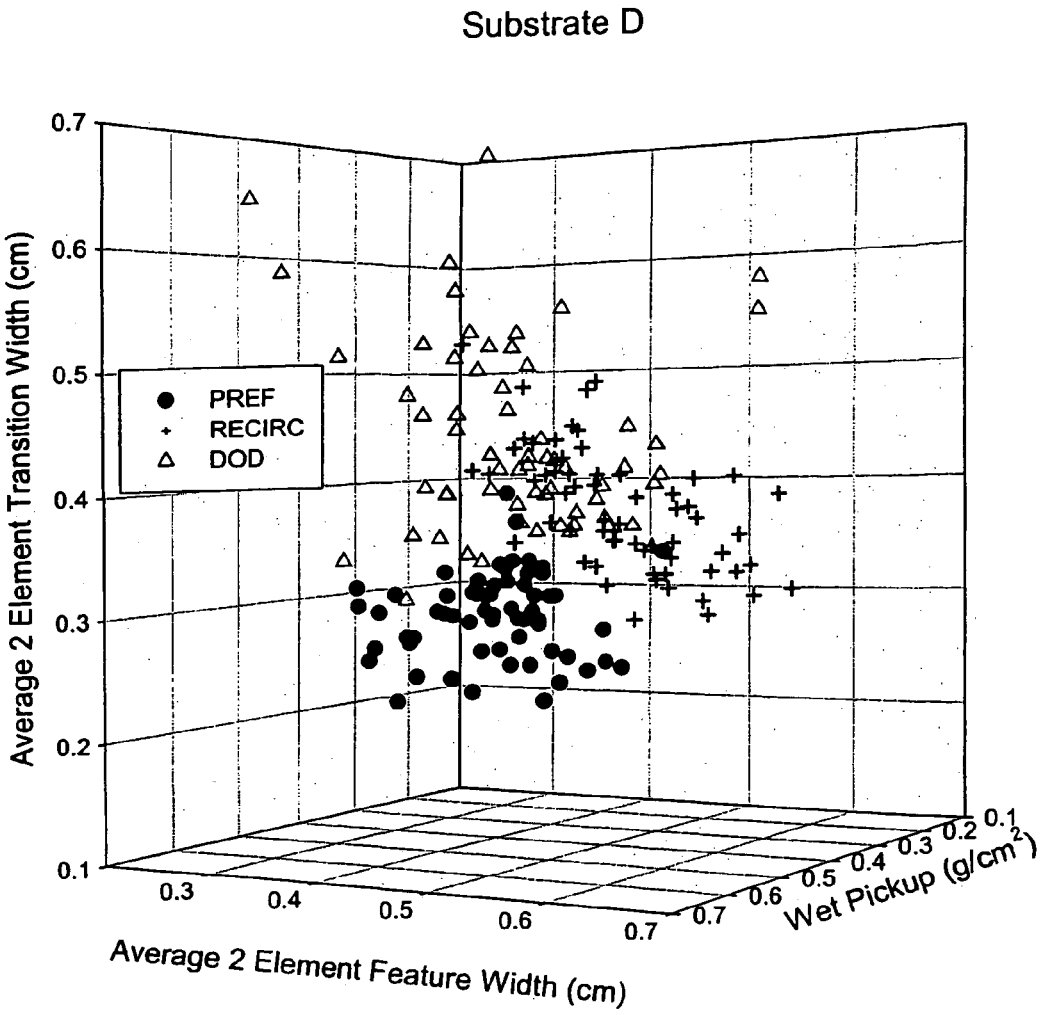

Or, equivalently, FIG. 237, (Substrate D)

$FW_{2element}$<0.4 cm, $TW_{2element}$<0.26 cm, Wet Pickup Range: 0.16-0.55 g/cm$^2$.

Figure 235:
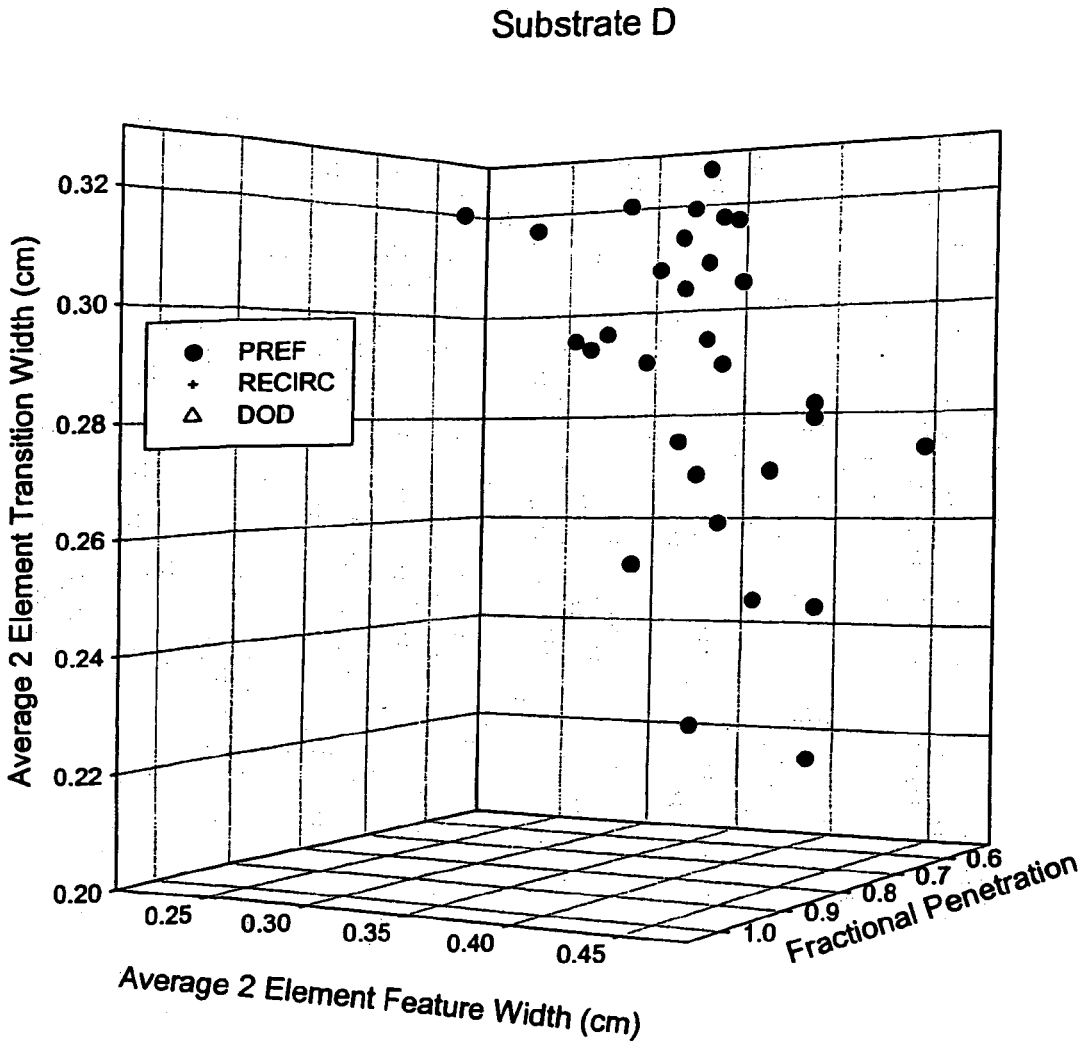
Figure 236:
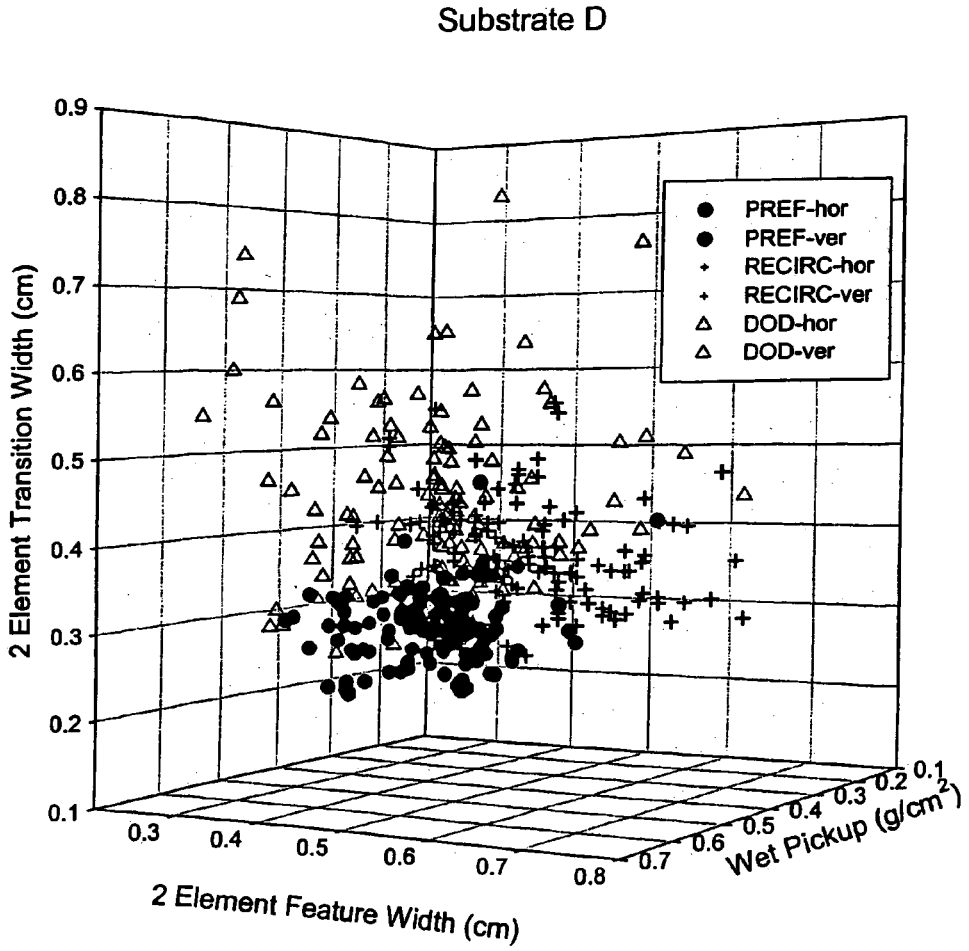

Directionally averaged values corresponding to the above boundaries for Substrate D (see FIG. 235) are:

(Substrate D)

$FW_{2element,\ directionally\ averaged}$<0.48, $TW_{2element,\ directionally\ averaged}$<0.33, Fractional Penetration≧0.5

Figure 239:
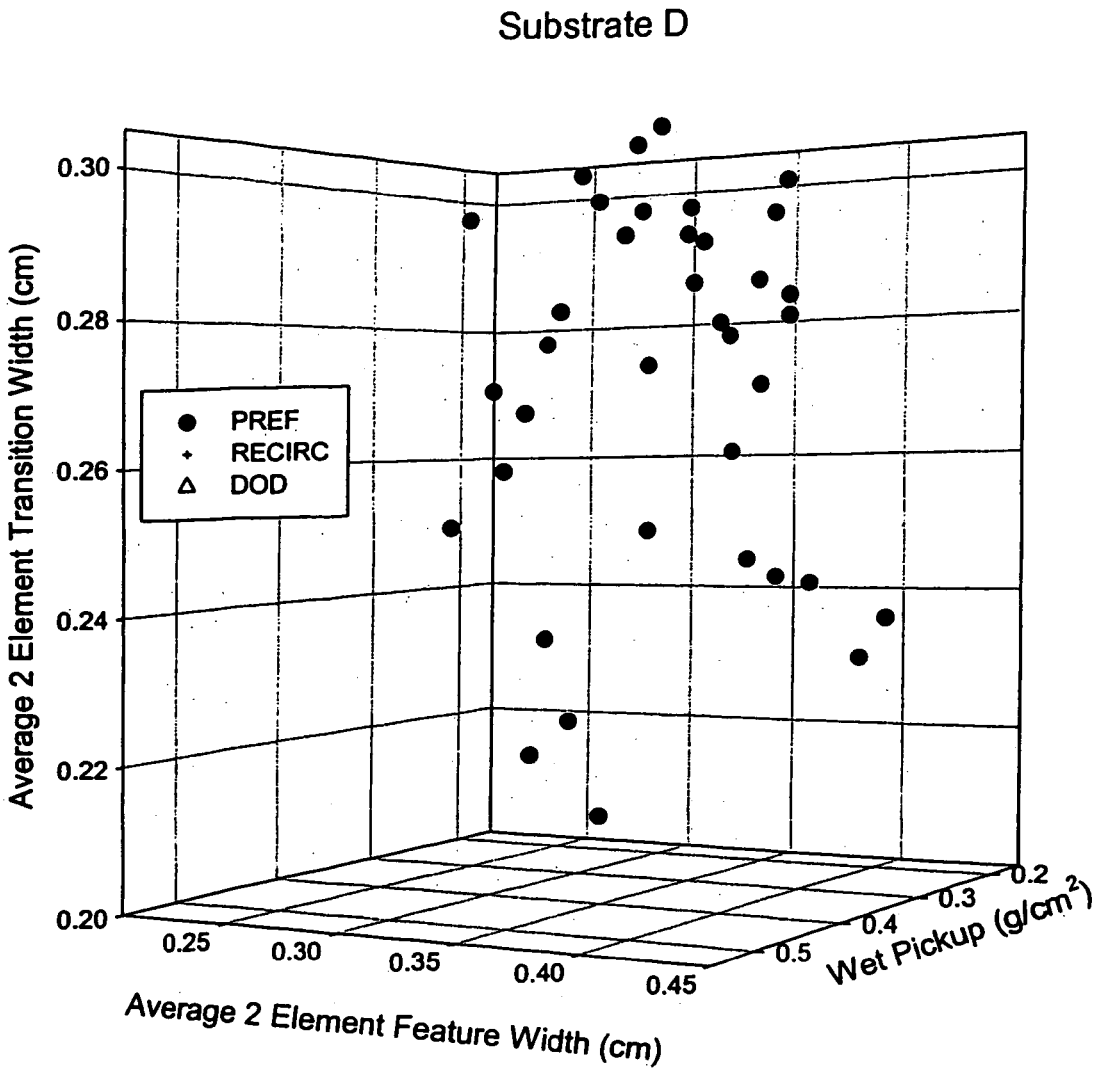
Figure 240:
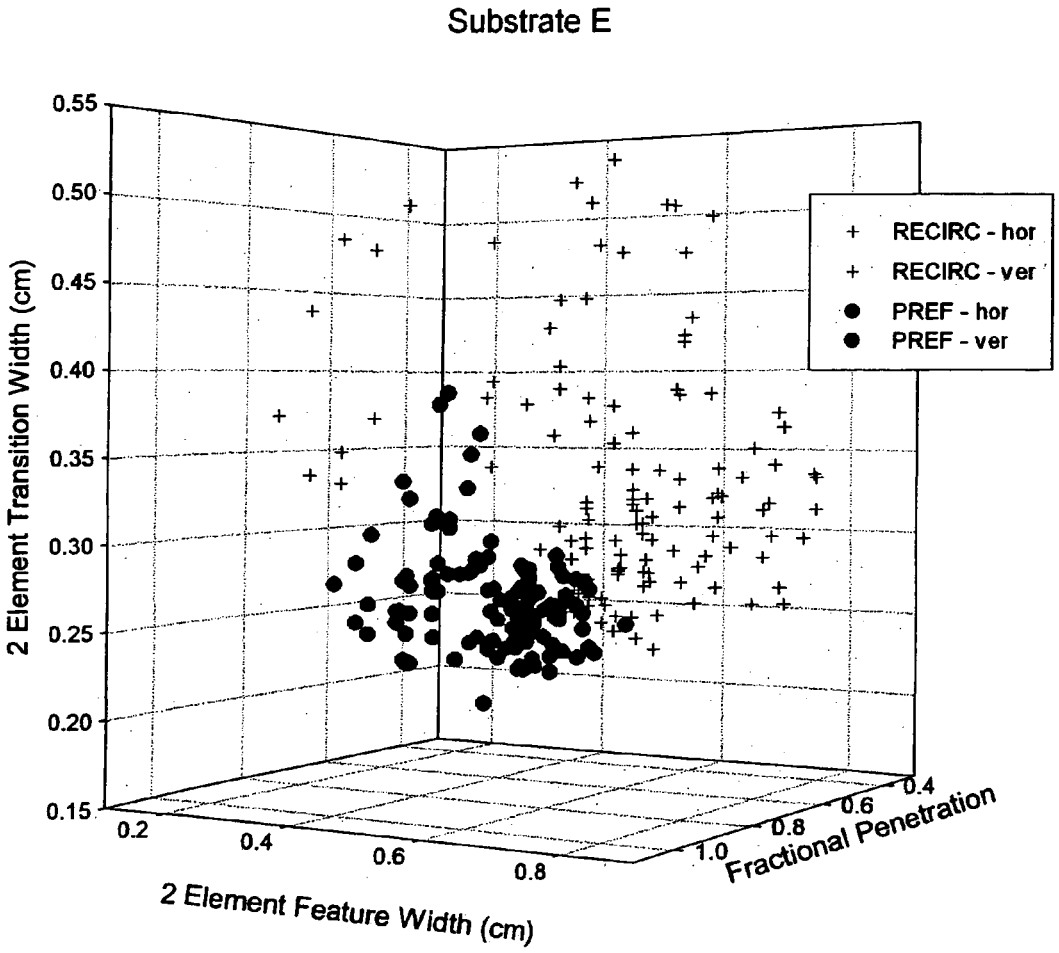

Or equivalently, FIG. 239, (Substrate D)

$FW_{2element,\ directionally\ averaged}$<0.45, $TW_{2element,\ directionally\ averaged}$<0.305, Wet Pickup Range: 0.16-0.55 g/cm$^2$.

Figure 201:
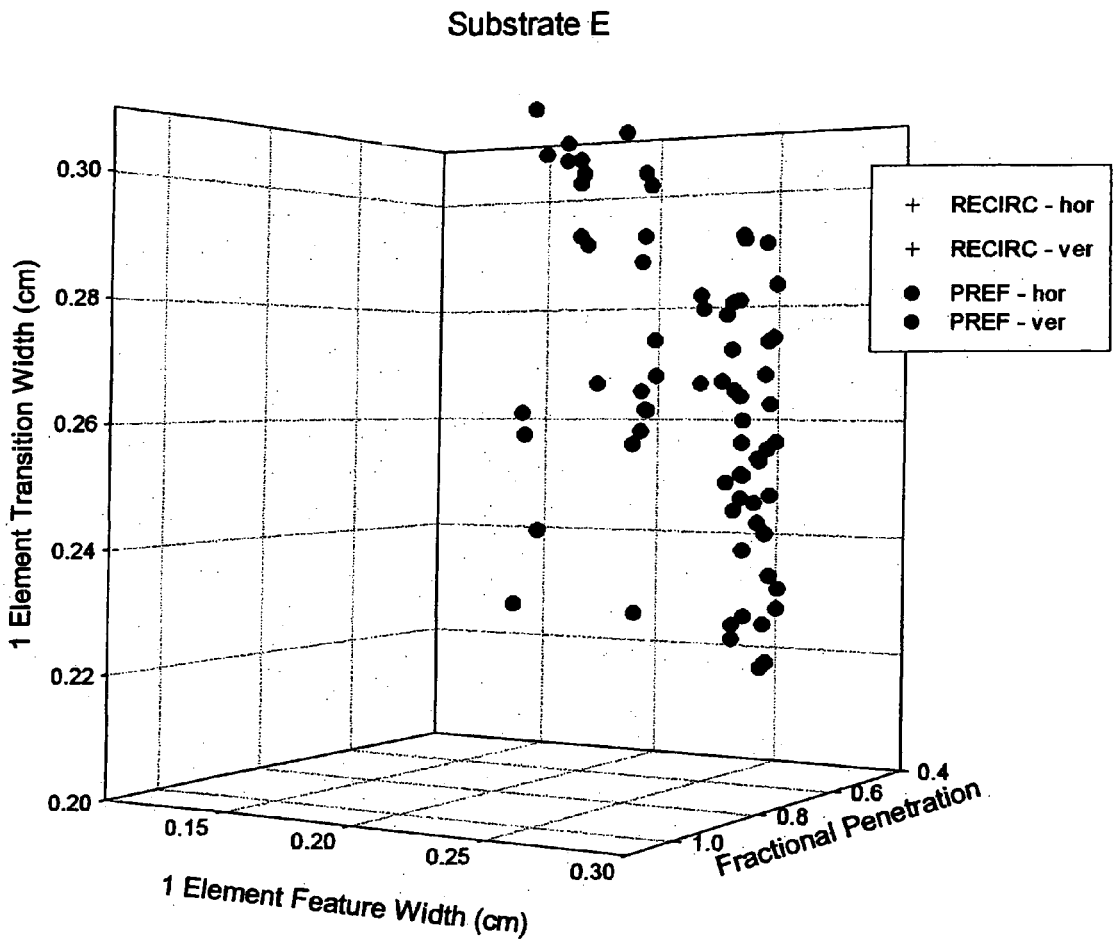
Figure 202:
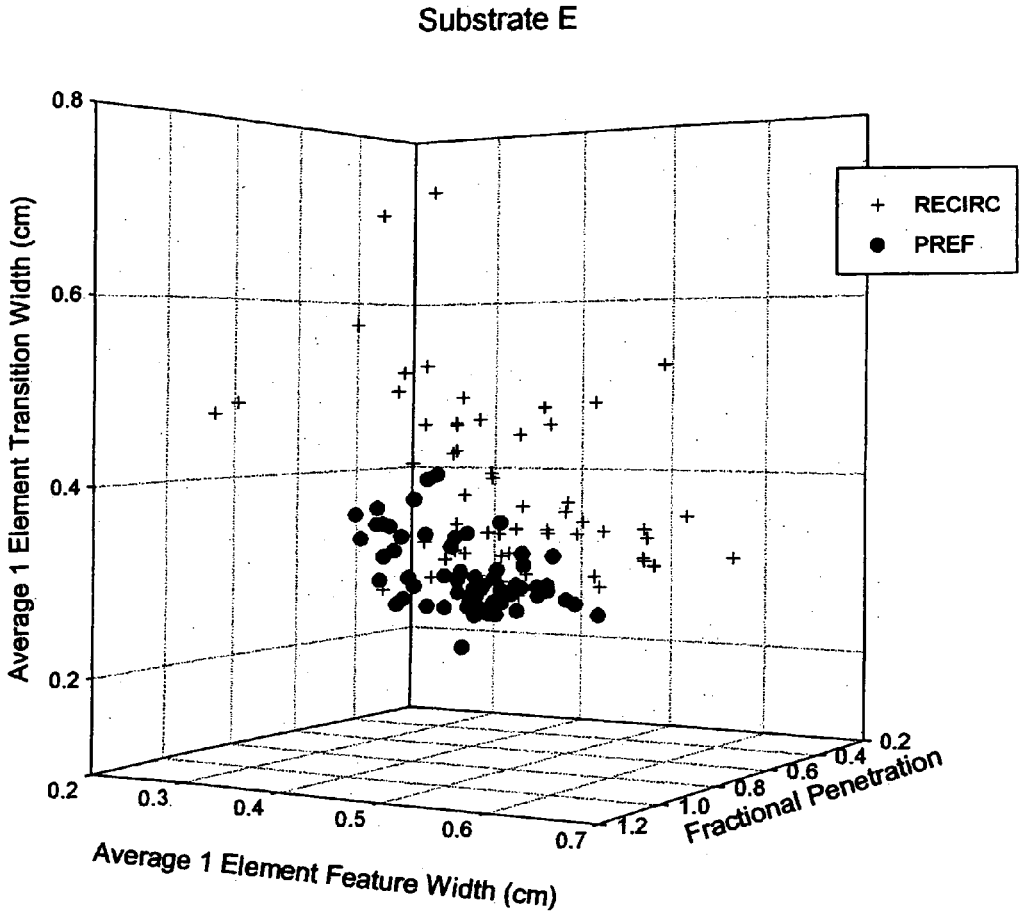

For Substrate E, direction-specific (two orthogonal directions) Feature Width, Transition Width and fractional penetration (and equivalent Wet Pickup range) values associated with a 1 element pattern area that are attainable only with the PREF patterning system (see FIG. 201) are:

(Substrate E)

$FW_{1\ element}$<0.3 cm, $TW_{1\ element}$<0.31 cm, Fractional Penetration≧0.4

Figure 205:
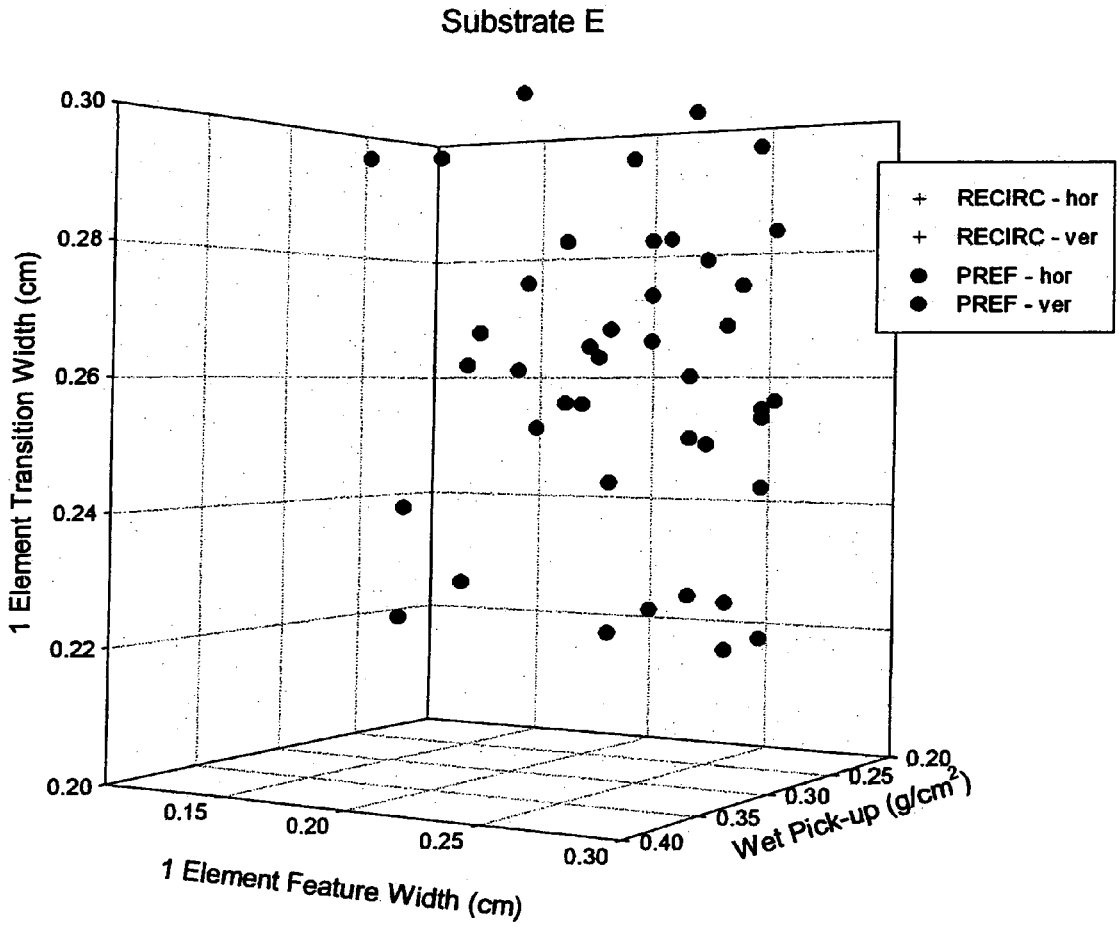
Figure 206:
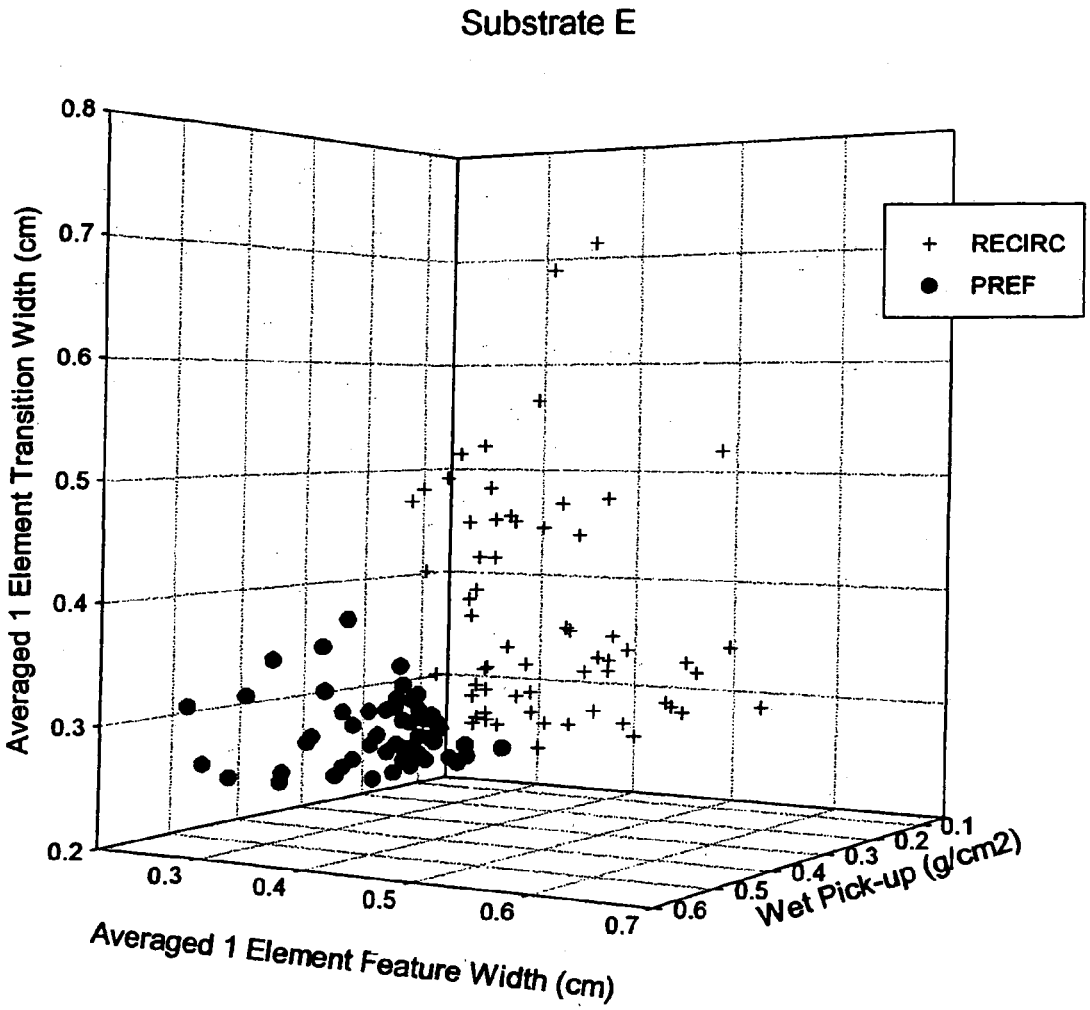

Or equivalently, as shown in FIG. 205, (Substrate E)

$FW_{1\ element}$<0.3 cm, $TW_{1\ element}$<0.31 cm, Wet Pickup Range: 0.2-0.4 g/cm$^2$.

Figure 203:
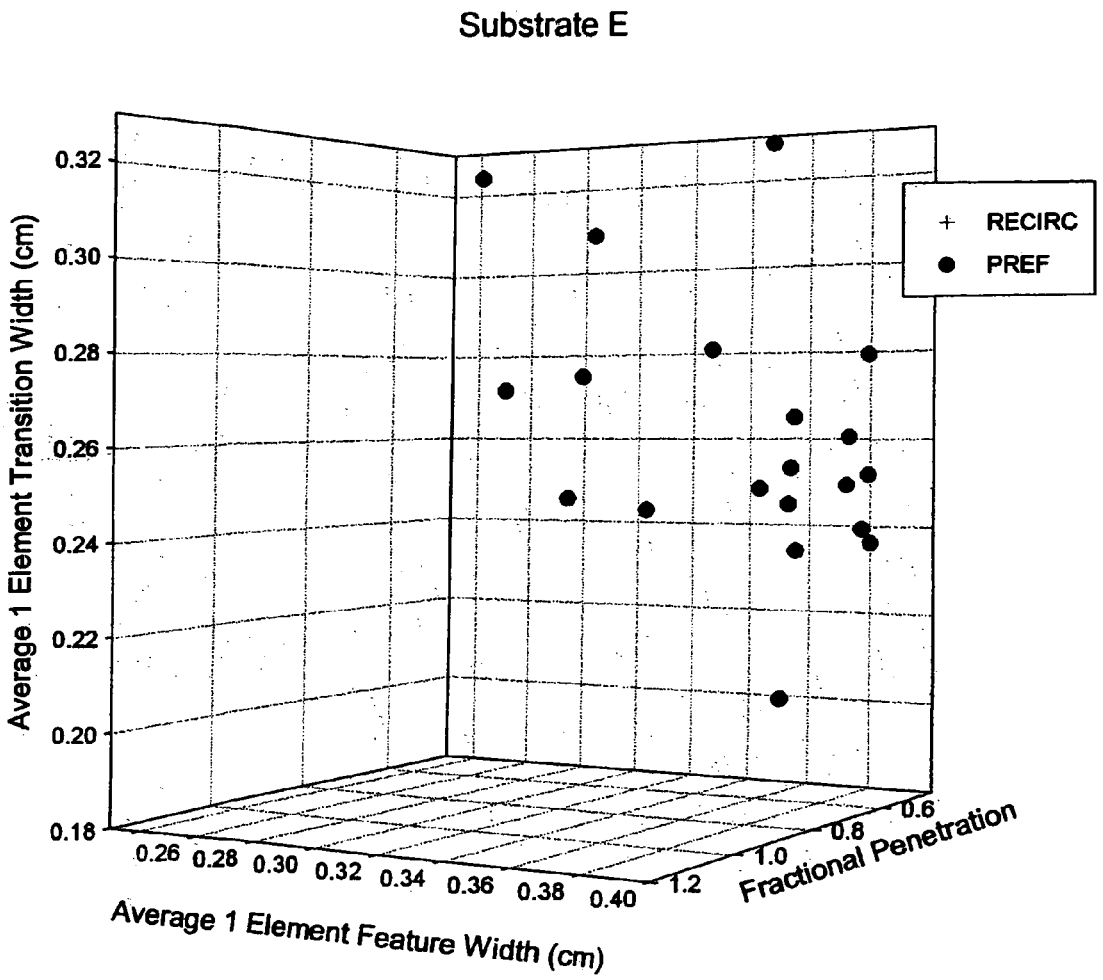
Figure 204:
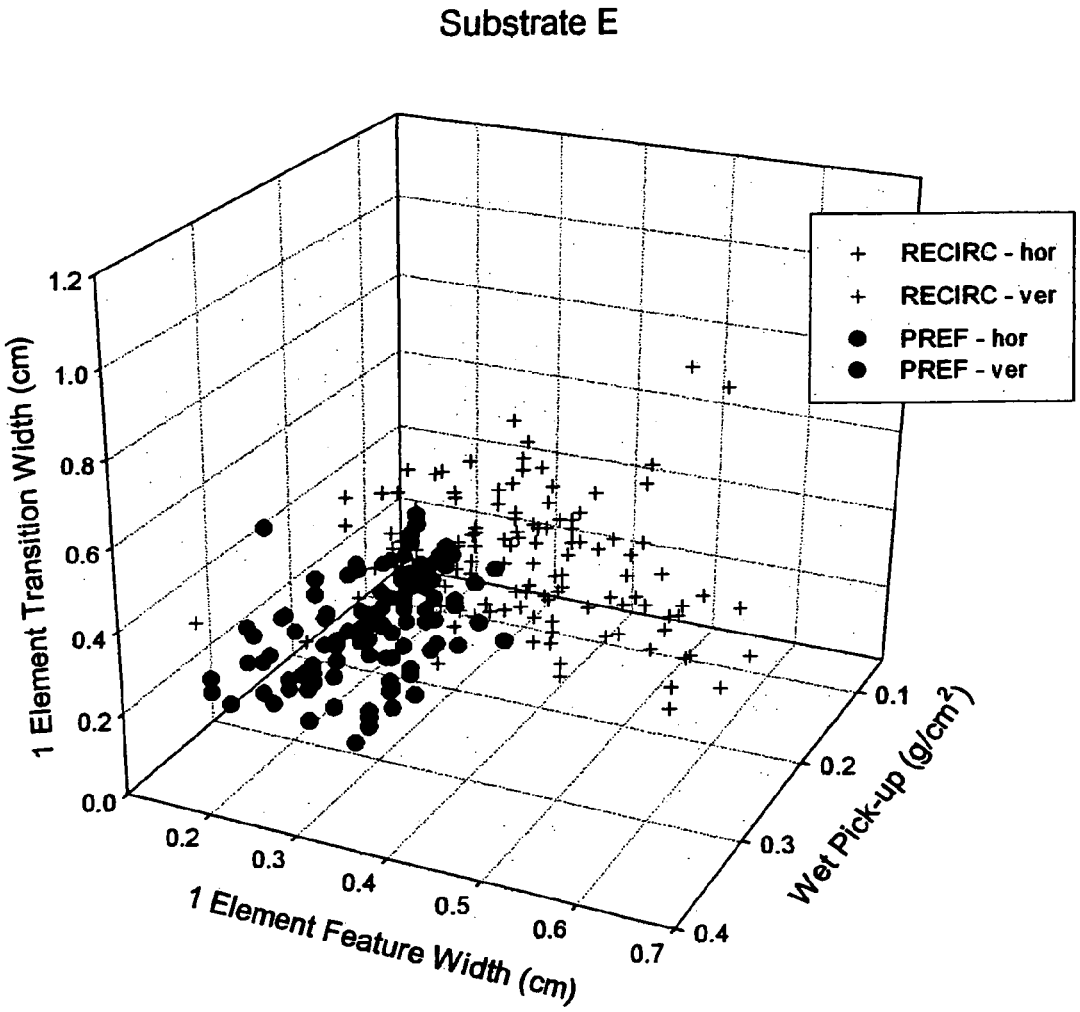

Directionally averaged values corresponding to the above boundaries for Substrate E (see FIG. 203) are:

(Substrate E)

$FW_{1\ element\ directionally\ averaged}$<0.4 cm, $TW_{1\ element,\ directionally\ averaged}$<0.33 cm, Fractional Penetration≧0.4

Figure 207:
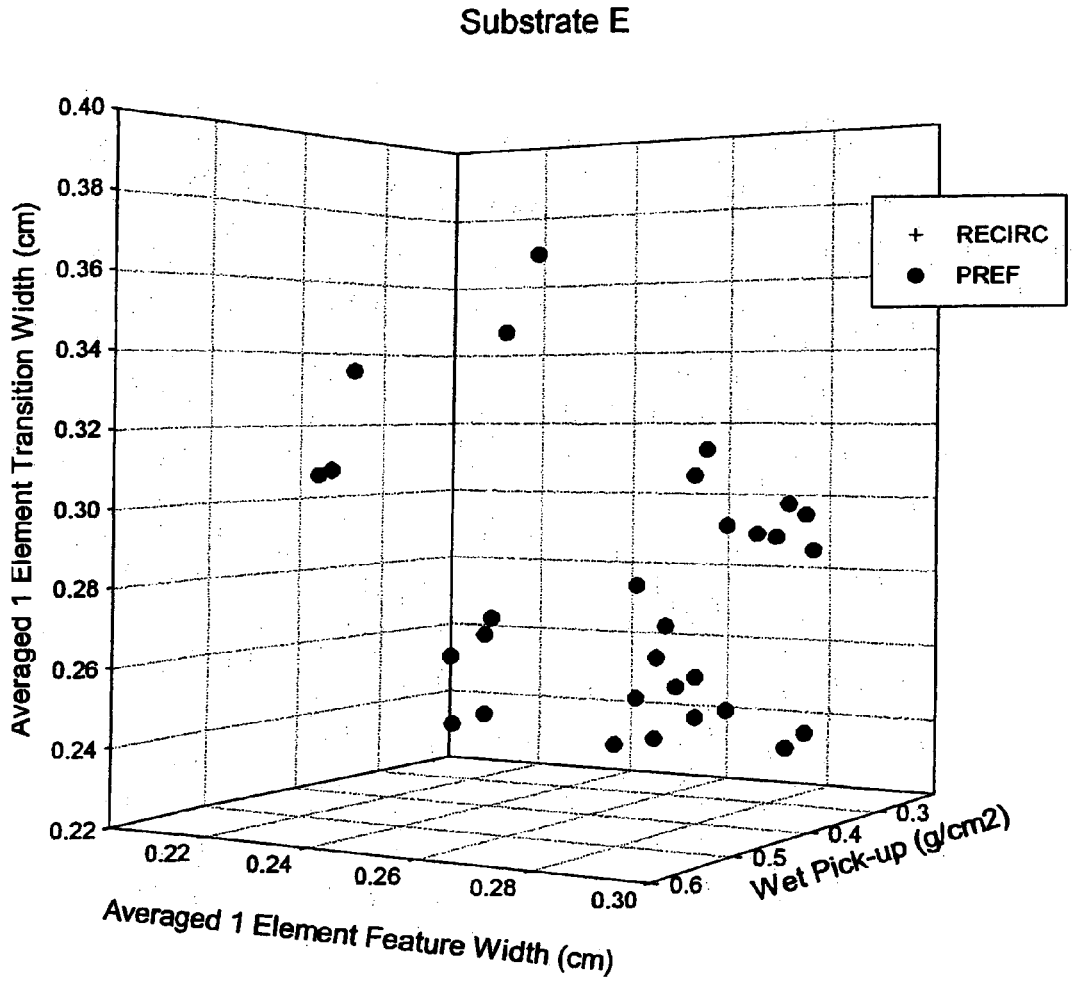
Figure 208:
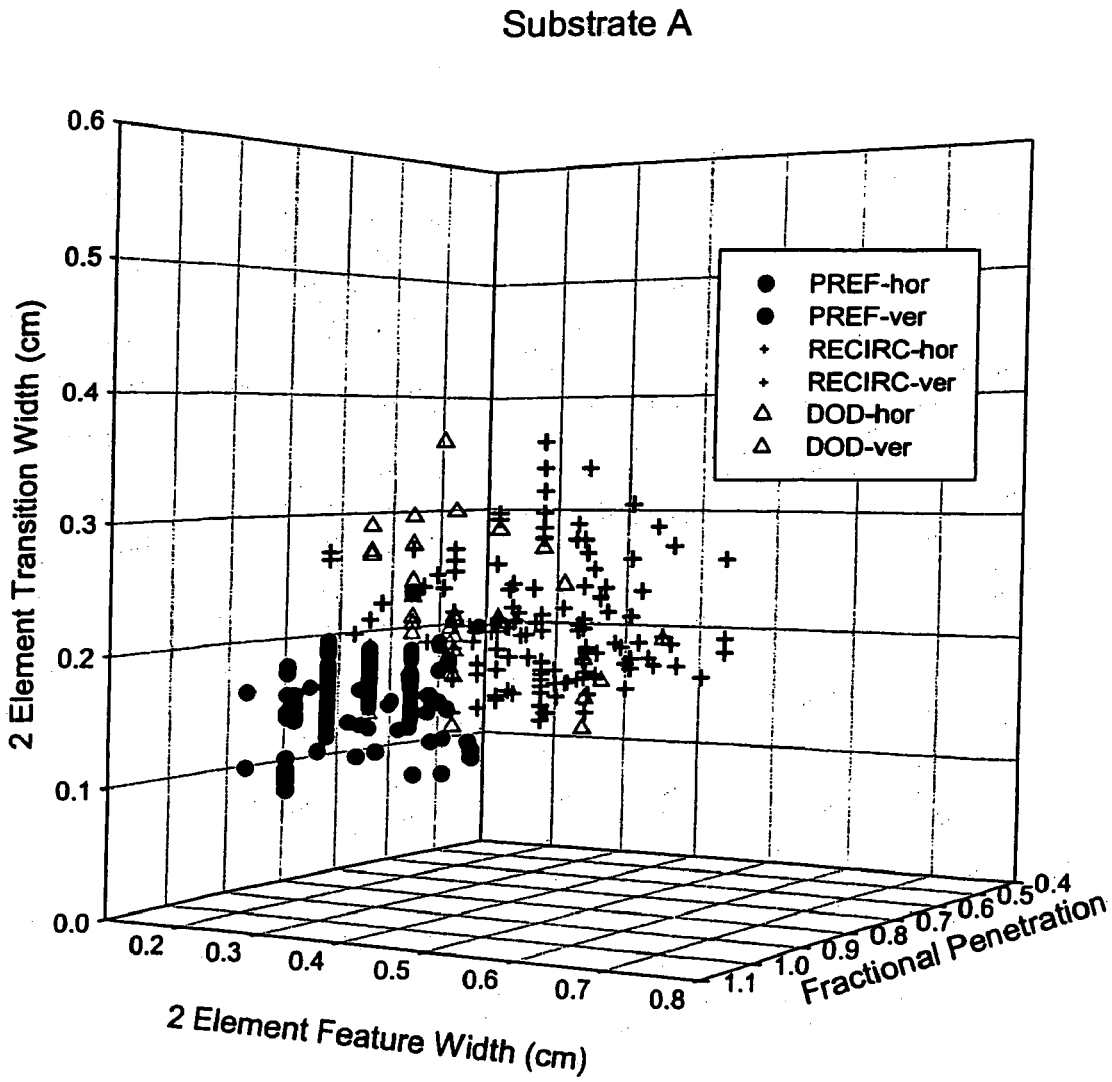

Or equivalently, as shown in FIG. 207, (Substrate E)

$FW_{1\ element,\ directionally\ averaged}$<0.3 cm, $TW_{1\ element,\ directionally\ averaged}$<0.4 cm, Wet Pickup Range: 0.2-0.6 g/cm$^2$.

Figure 241:
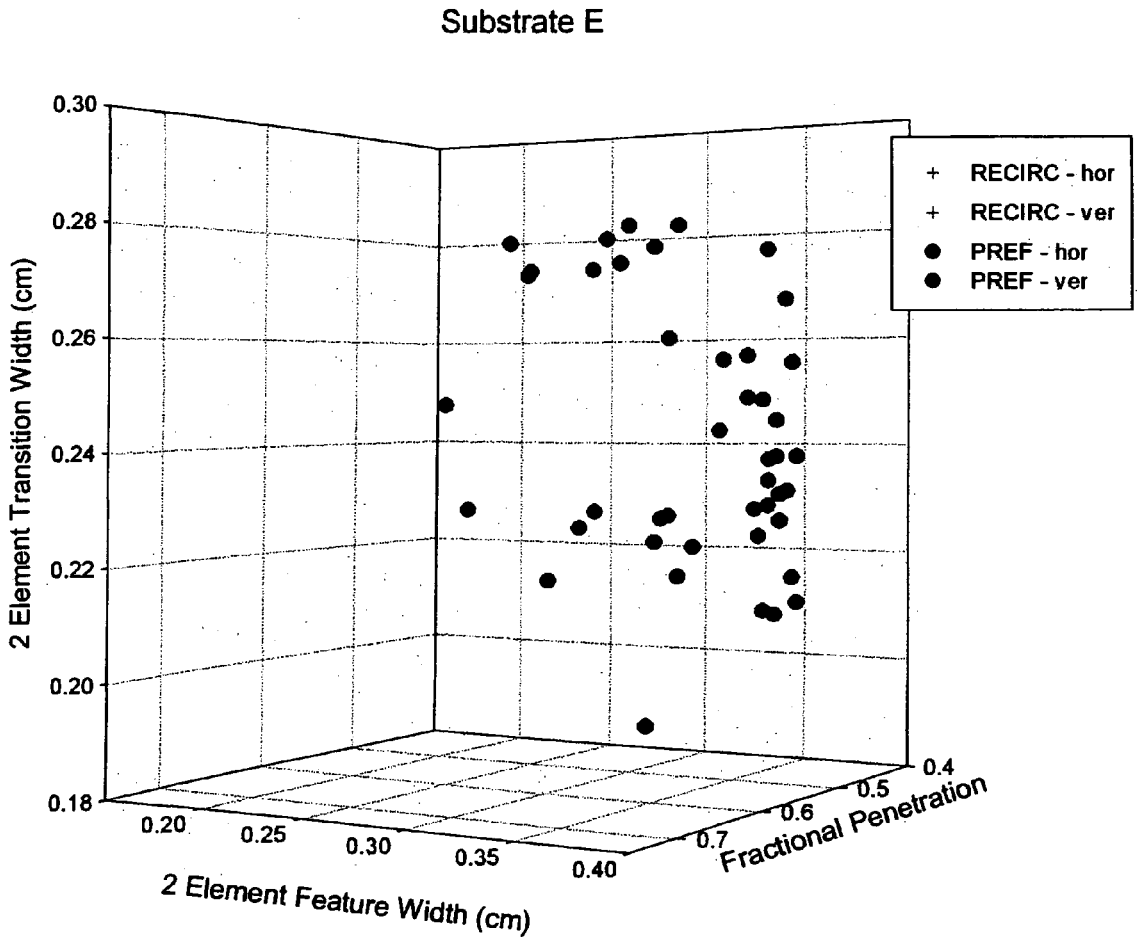
Figure 242:
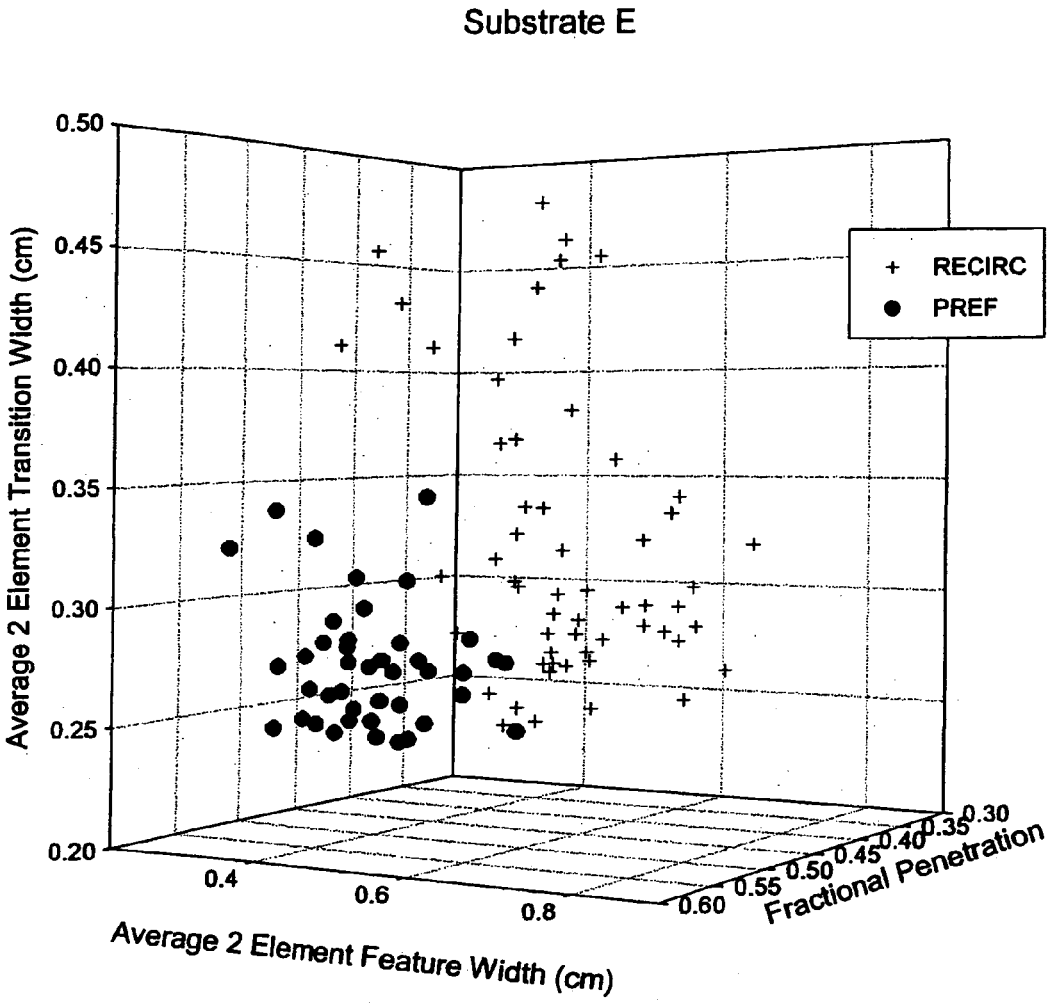

For Substrate E, direction-specific (two orthogonal directions) Feature Width, Transition Width and fractional penetration (and equivalent Wet Pickup range) values associated with a 2 element pattern area that are attainable only with the PREF patterning system (see FIG. 241) are:

(Substrate E)

$FW_{2\ element}$<0.4 cm, $TW_{2\ element}$<0.3 cm, Fractional Penetration≧0.4

Figure 245:
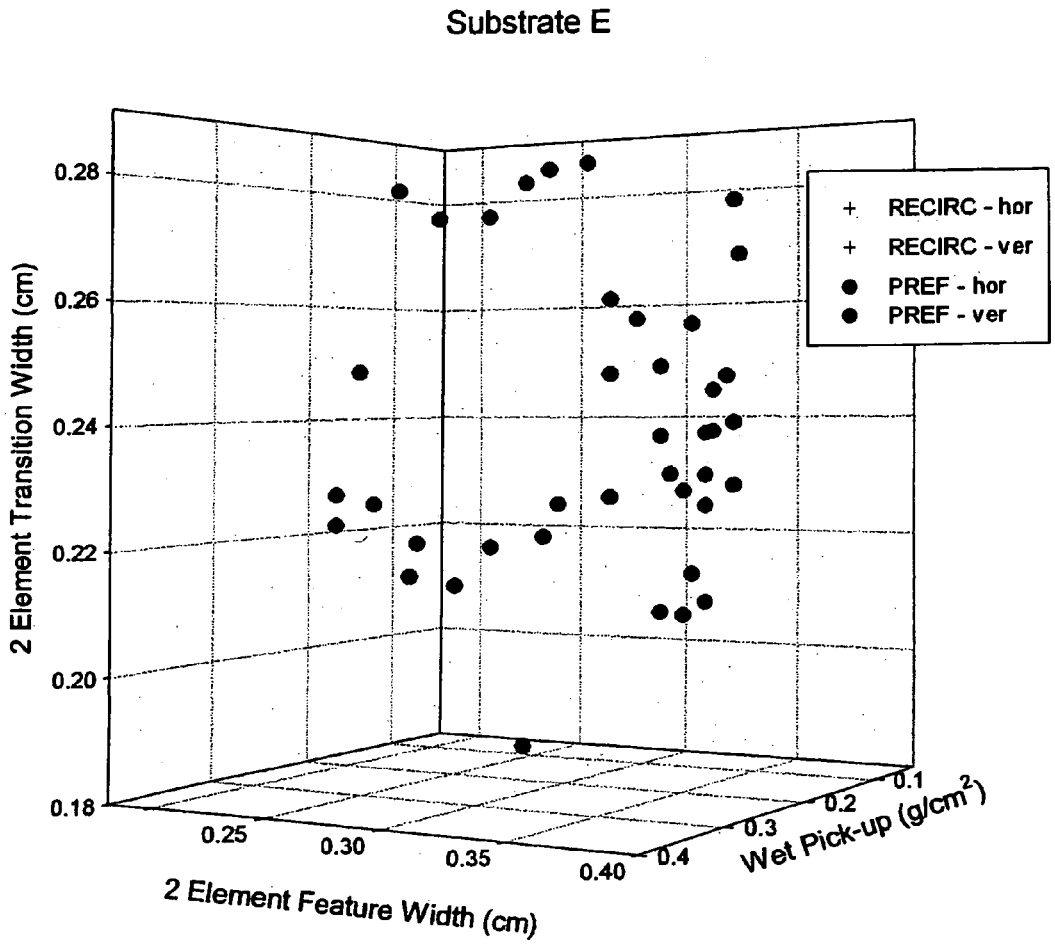
Figure 246:
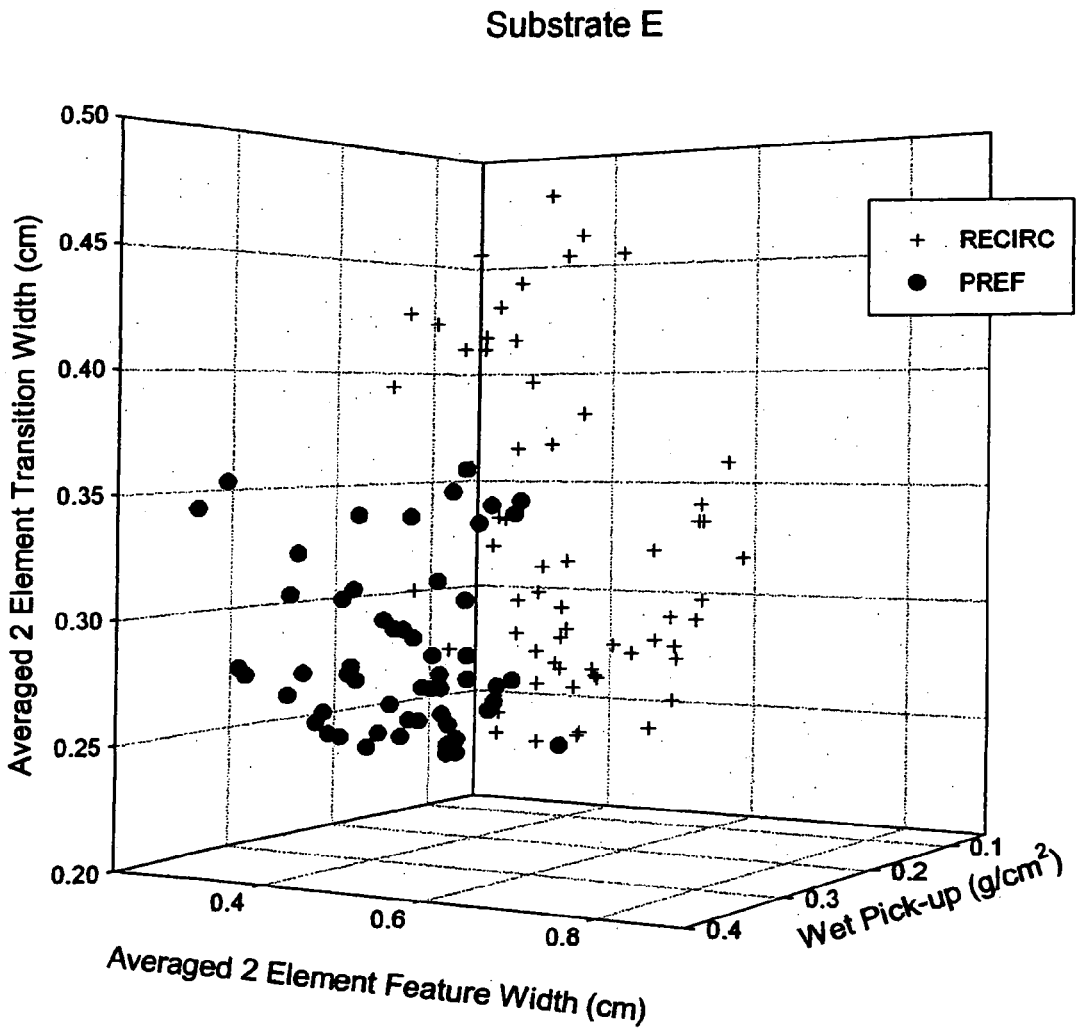

Or equivalently, as shown in FIG. 245, (Substrate E)

$FW_{2\ element}$<0.4 cm, $TW_{2\ element}$<0.3 cm, Wet Pickup Range: 0.04-0.4 g/cm$^2$.

Figure 243:
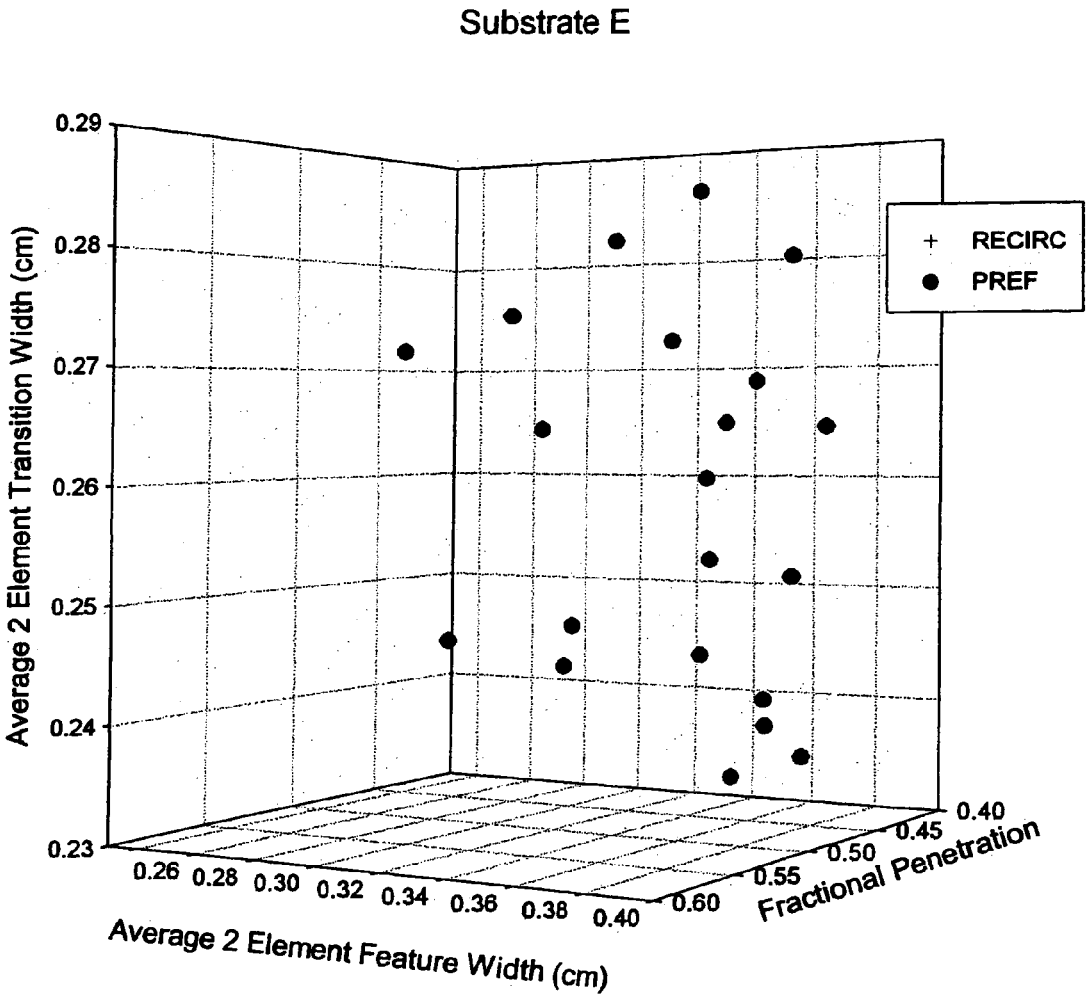
Figure 244:
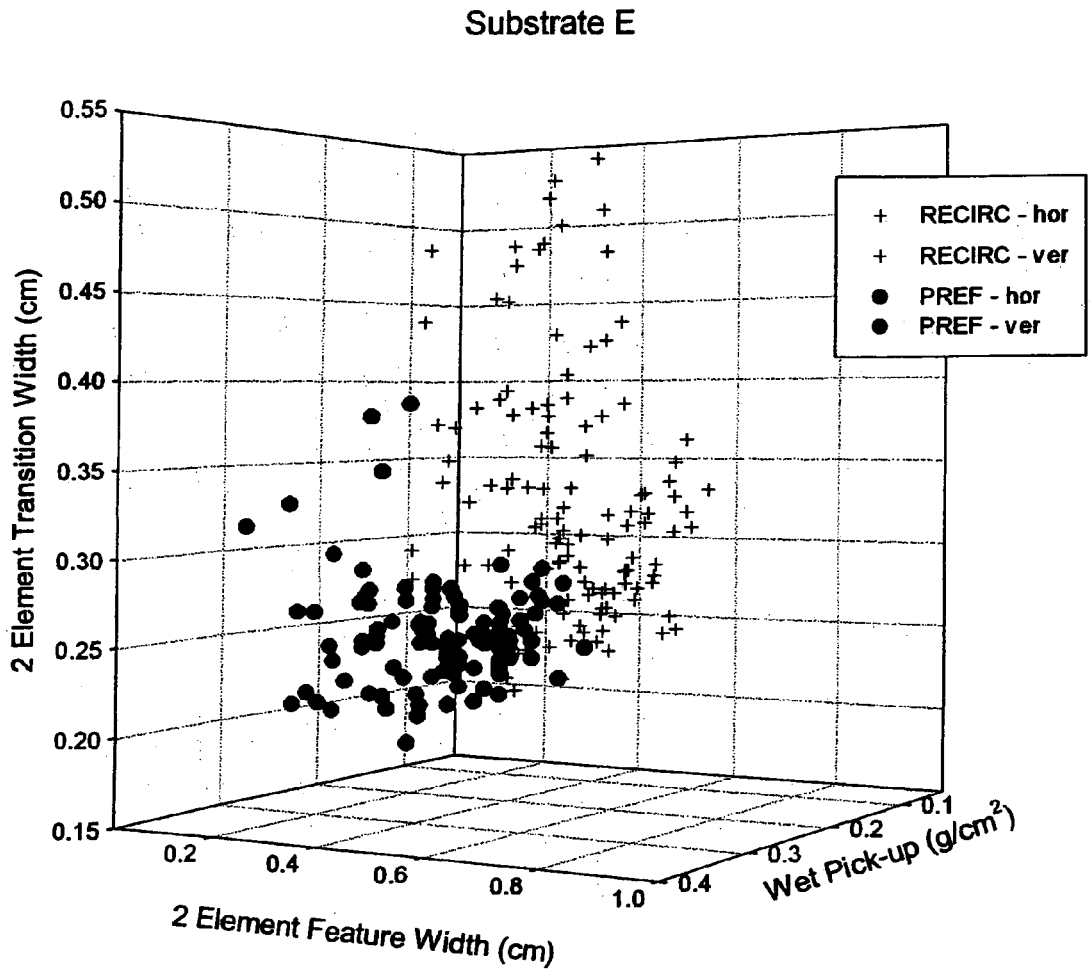

Directionally averaged values corresponding to the above boundaries for Substrate E (see FIG. 243) are:

(Substrate E)

$FW_{2\ element,\ directionally\ averaged}$<0.4, $TW_{2\ element,\ directionally\ averaged}$<0.29, Fractional Penetration≧0.4

Figure 247:
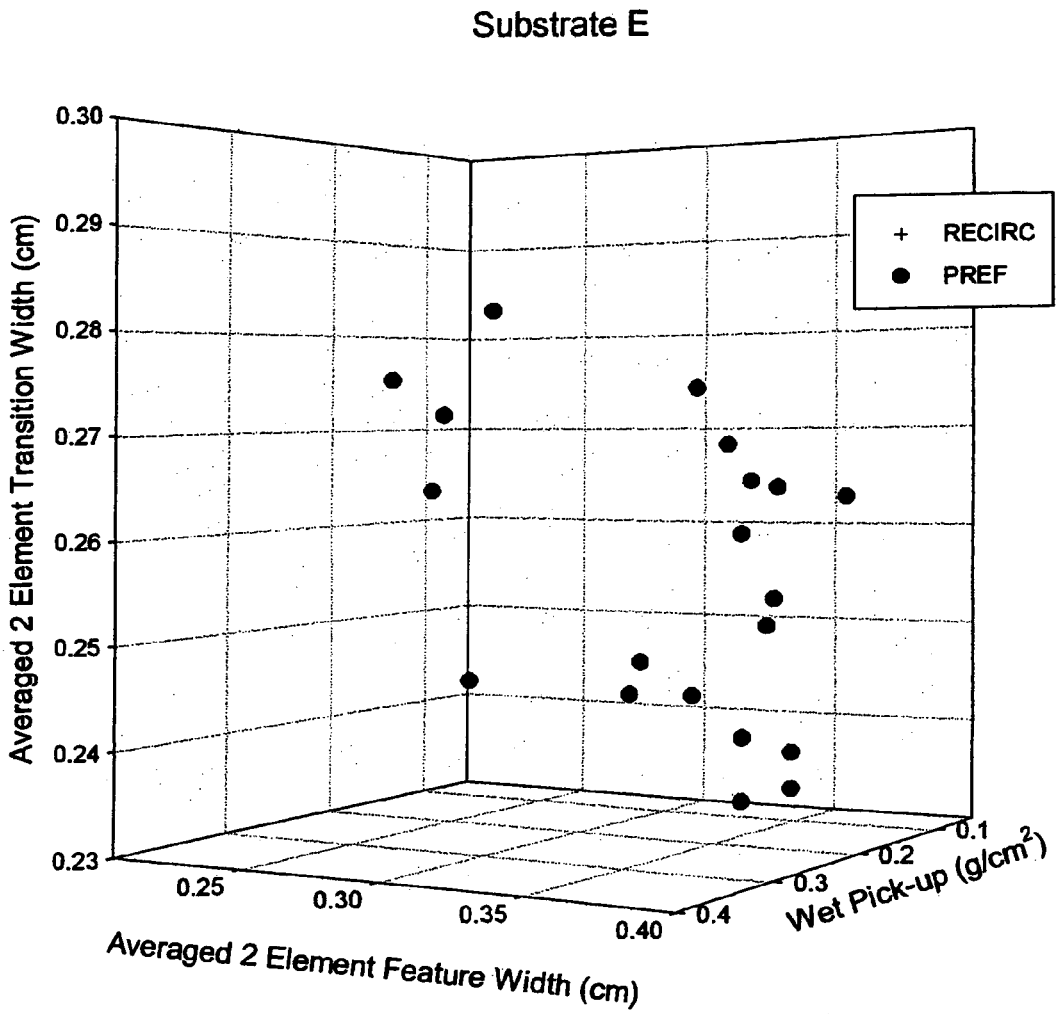

Or equivalently, as shown in FIG. 247, (Substrate E)

$FW_{2\ element,\ directionally\ averaged}$<0.4, $TW_{2\ element,\ directionally\ averaged}$<0.29, Wet Pickup Rang: 0.04-0.4 g/cm$^2$.

For each of the given substrates and pattern areas, a boundary value has been identified for both Transition Width and Feature Width in the corresponding isolation chart below which the print variables (Transition Width, Feature Width, and fractional penetration or wet pickup range) for the dominant color feature can only be attained by the PREF printing system. These boundaries therefore serve to distinguish PREF printed products from those printed by other systems in that previous products would not contain fine sharp dominant color pattern areas with the same 1 element or 2 element Transition Width and Feature Width parameters. To understand how the range of Transition Width and Feature Width values attained only by PREF varied with substrate, graphs plotting the boundary values for the PREF only cube (the isolation charts extreme boundaries) versus pile height were prepared. FIGS. 248-255 show the plots of these boundary values for the 1 and 2 element Transition Width and Feature Widths versus pile height both for the data regardless of direction and the directionally averaged data. It is apparent from the data that both the Transition Width and Feature Width increase monotonically with the pile height of the substrate.

In an effort to numerically quantify this relationship, a line that connected or fell below each point was applied to each data graph individually. They allow us to quantify for each case how the PREF cube boundaries varied with pile height. For the 1 element data for nylon 6,6 that was not directionally averaged, FIGS. 248-249, the results are $$FW_{boundary,\ 1\ element}(\text{cm})=0.14\cdot(\text{Pile Height (cm)})+0.15$$

$$TW_{boundary,\ 1\ element}(\text{cm})=0.11\cdot(\text{Pile Height (cm)})+0.16\ \text{Fractional Penetration}\geqq 0.5$$

The above equations serve, in combination, to define the upper boundaries of a three-dimensional space in which only the PREF patterning system can print pattern areas in any direction with a 1 Element Transition Width, a 1 Element Feature Width, and an attendant fractional penetration of greater than 0.5 (nylon 6,6 substrates). Stated a different way, for a dominant color 1 element pattern area printed (especially printed using metered jet patterning technology) in any direction on a predominantly nylon 6,6 substrate with a given pile height and a fractional penetration that is at least 0.5, the 1 element Feature Width and 1 Element Transition Width, measured in accordance with the teachings herein, will have values less than the values specified from the equations above only for such substrates printed with the PREF printing system.

The non-directionally averaged 2 element data (FIGS. 250-251) yields the following equations:

$$FW_{boundary,\ 2\ element}(\text{cm})=0.169\cdot(\text{Pile Height (cm)})+0.28$$

$$TW_{boundary,\ 2\ element}(\text{cm})=0.129\cdot(\text{Pile Height (cm)})+0.129\ \text{Fractional Penetration}\geqq 0.5$$

Figure 252:
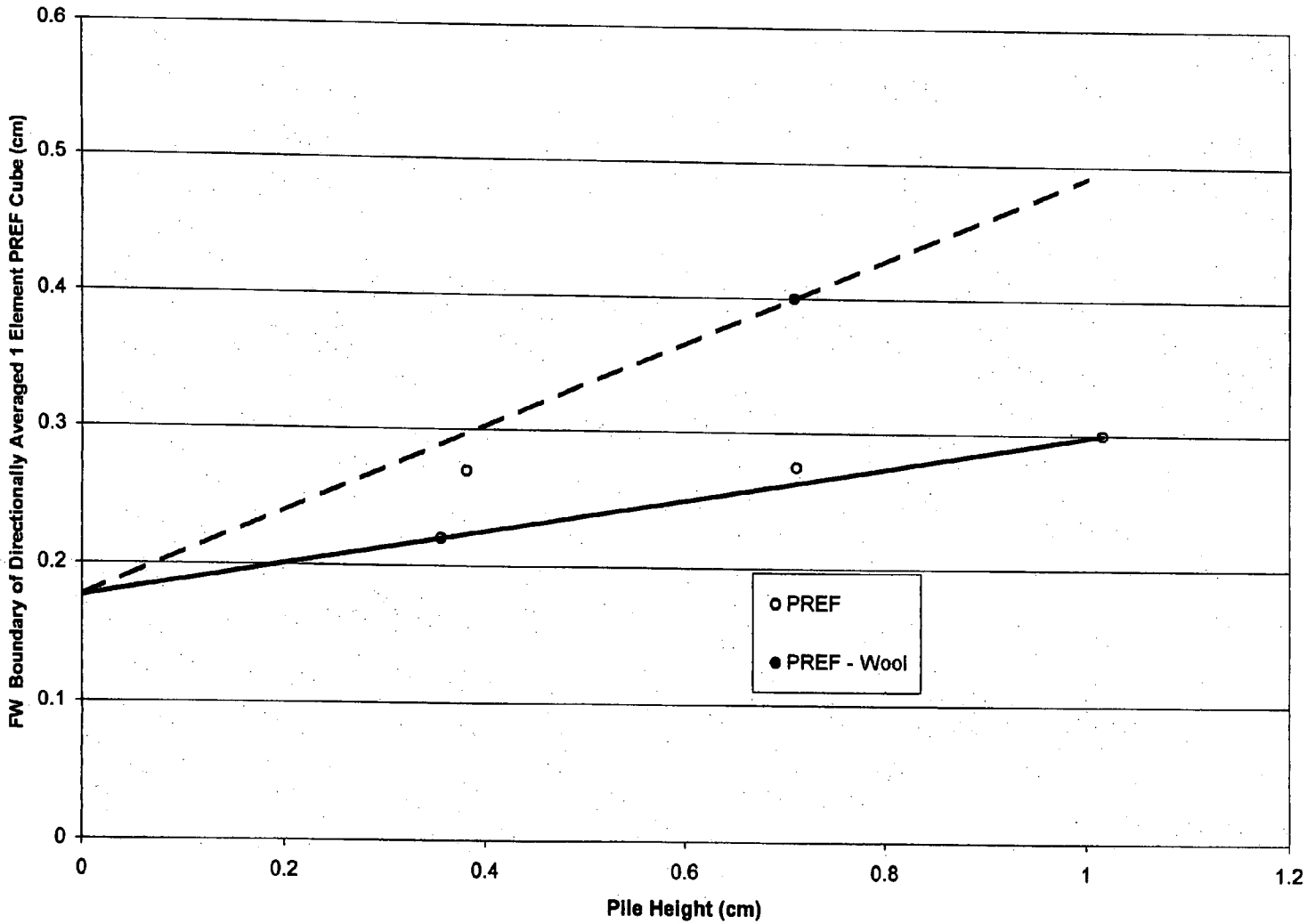
Figure 253:
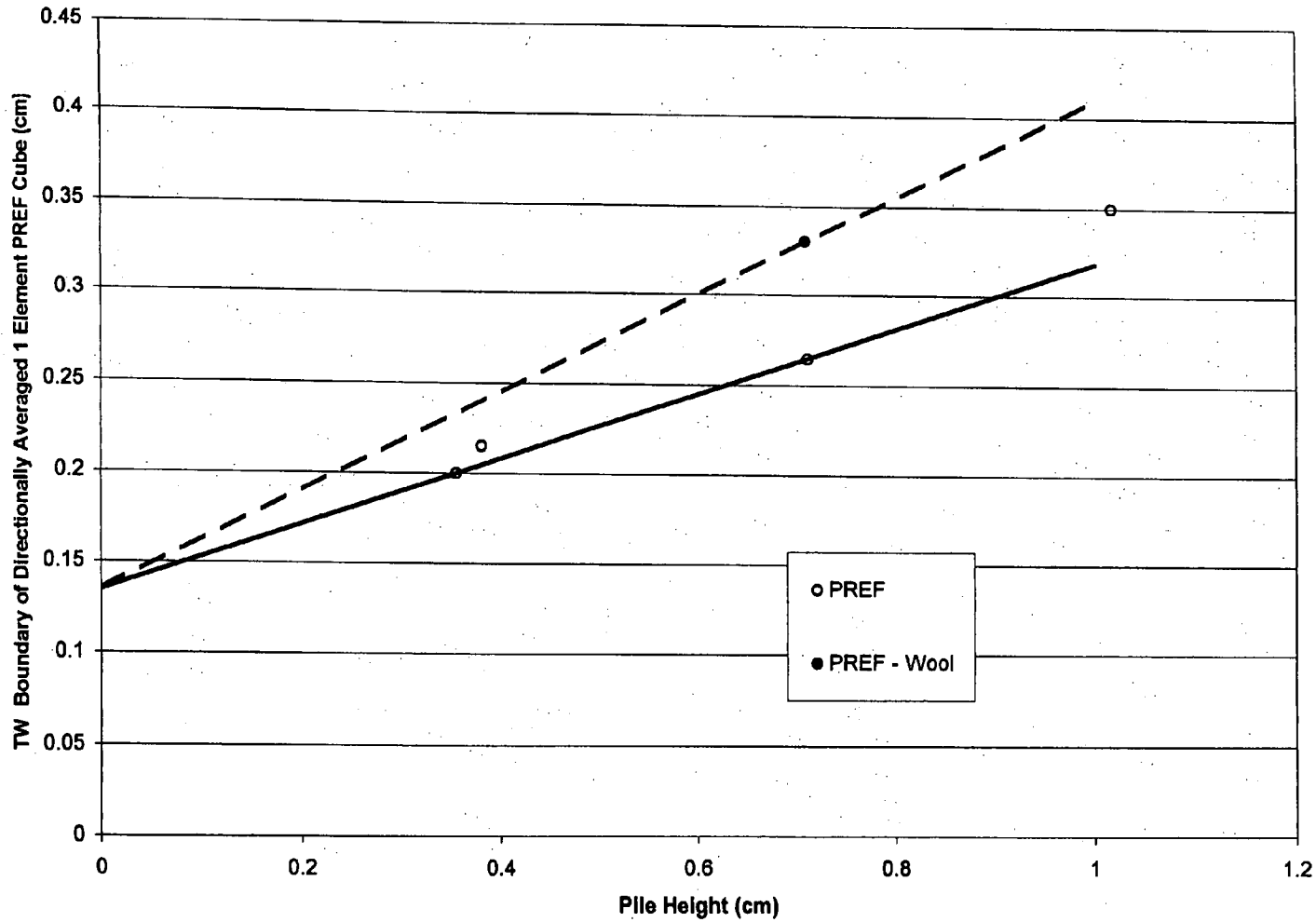

For the same 1 element data that was directionally averaged, FIGS. 252 and 253, the results are:

$$FW_{boundary,\ 1\ element,\ directionally\ averaged}(\text{cm})=0.121\cdot(\text{Pile Height (cm)})+0.177$$

$$TW_{boundary,\ 1\ element,\ directionally\ averaged}(\text{cm})=0.183\cdot(\text{Pile Height (cm)})+0.135\ \text{Fractional Penetration}\geqq 0.5$$

For a dominant color 2 element pattern area printed (especially printed using metered jet patterning technology) in any direction on a predominantly nylon 6,6 substrate with a given pile height and a fractional penetration that is at least 0.5, the 2 element Feature Width and 2 Element Transition Width, measured in accordance with the teachings herein, will have values less than the values specified from the equations above only for such substrates printed with the PREF printing system.

Again, for a specified dominant color, a 1 element pattern area can be identified that has been printed (in particular metered-jet printed) in any two orthogonal directions on a substrate with a given pile height, the measured said two orthogonal 1 element pattern area 1 element Feature Width and 1 element Transition Width, measured in accordance with the teachings herein and subsequently directionally averaged, will have values less than the values specified from the equations above, calculated at said pile height for the given substrate, in conjunction with a fractional penetration greater than 0.5 only for substrates printed with the PREF printing system.

Figure 254:
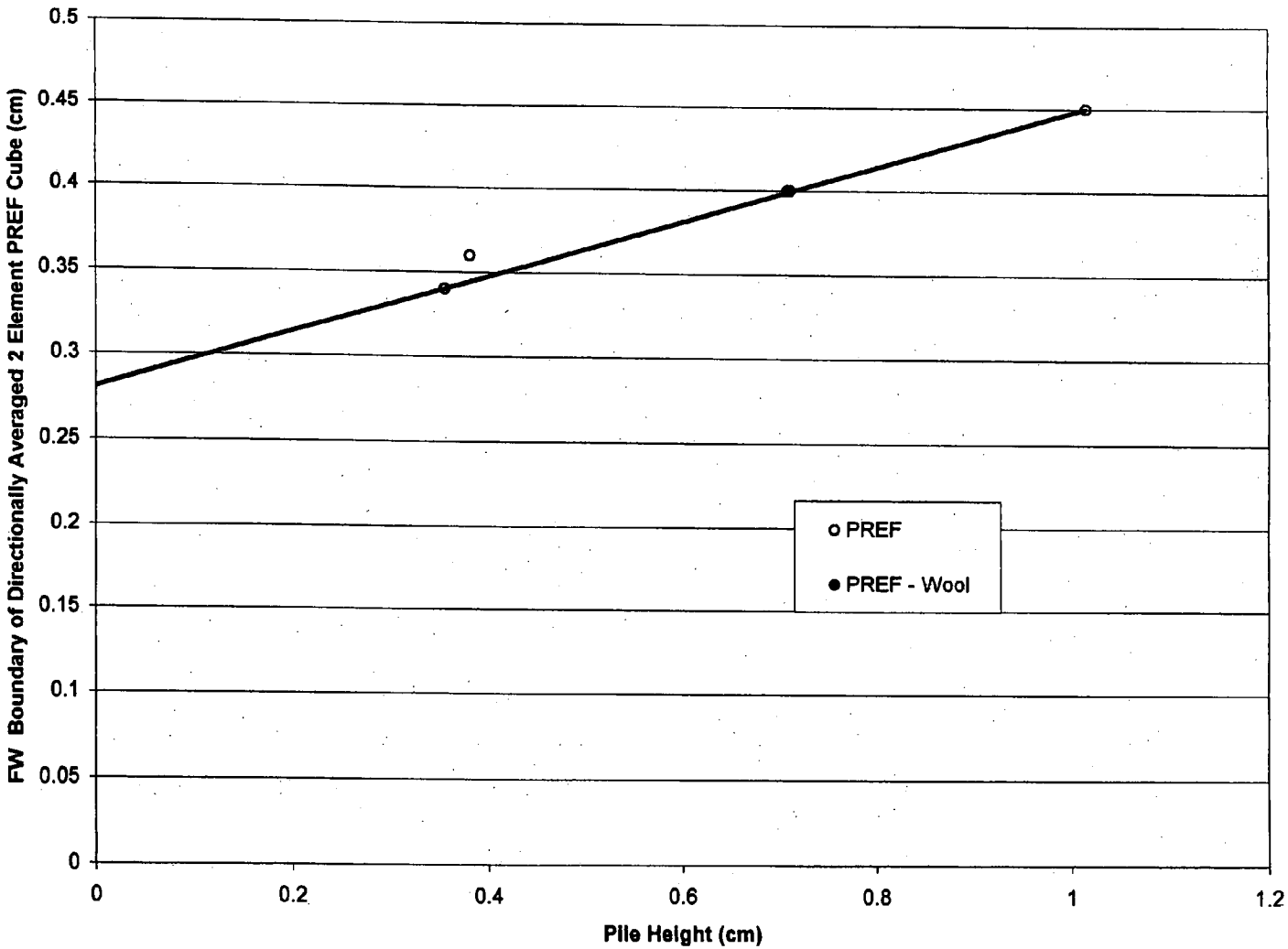

For the 2 element data that was directionally averaged, FIGS. 254-255, the results are $$FW_{boundary,\ 2\ element,\ directionally\ averaged}(\text{cm})=0.167\cdot(\text{Pile Height (cm)})+0.28$$

$$TW_{boundary,\ 2\ element,\ directionally\ averaged}(\text{cm})=0.189\cdot(\text{Pile Height (cm)})+0.113\ \text{Fractional Penetration}\geqq 0.5$$

Again, for a specified dominant color, a 2 element pattern area can be identified that has been printed (in particular metered-jet printed) in any two orthogonal directions on a nylon 6,6 substrate with a given pile height, the measured said two orthogonal 2 element pattern area 2 element Feature Width and 2 element Transition Width, measured in accordance with the teachings herein and subsequently directionally averaged, will have values less than the values specified from the equations above, calculated at said pile height for the given substrate, in conjunction with a fractional penetration greater than 0.5 only for substrates printed with the PREF printing system.

Turning to Substrate E (indicated by a dotted line in the Figures), comprised of predominantly wool pile yarns, it is possible to perform an analogous analysis resulting in the generation of an equation defining a line that effectively separates the PREF-patterned product from the RECIRC-patterned product for wool substrates as a function of pile height. For purposes of this analysis, it was assumed that, as pile height becomes smaller, the difference in patterning performance between wool pile yarns and nylon 6,6 pile yarns becomes less, until, at pile heights that approach insignificance, the values for Transition Width and Feature Width will essentially coincide.

Figure 248:
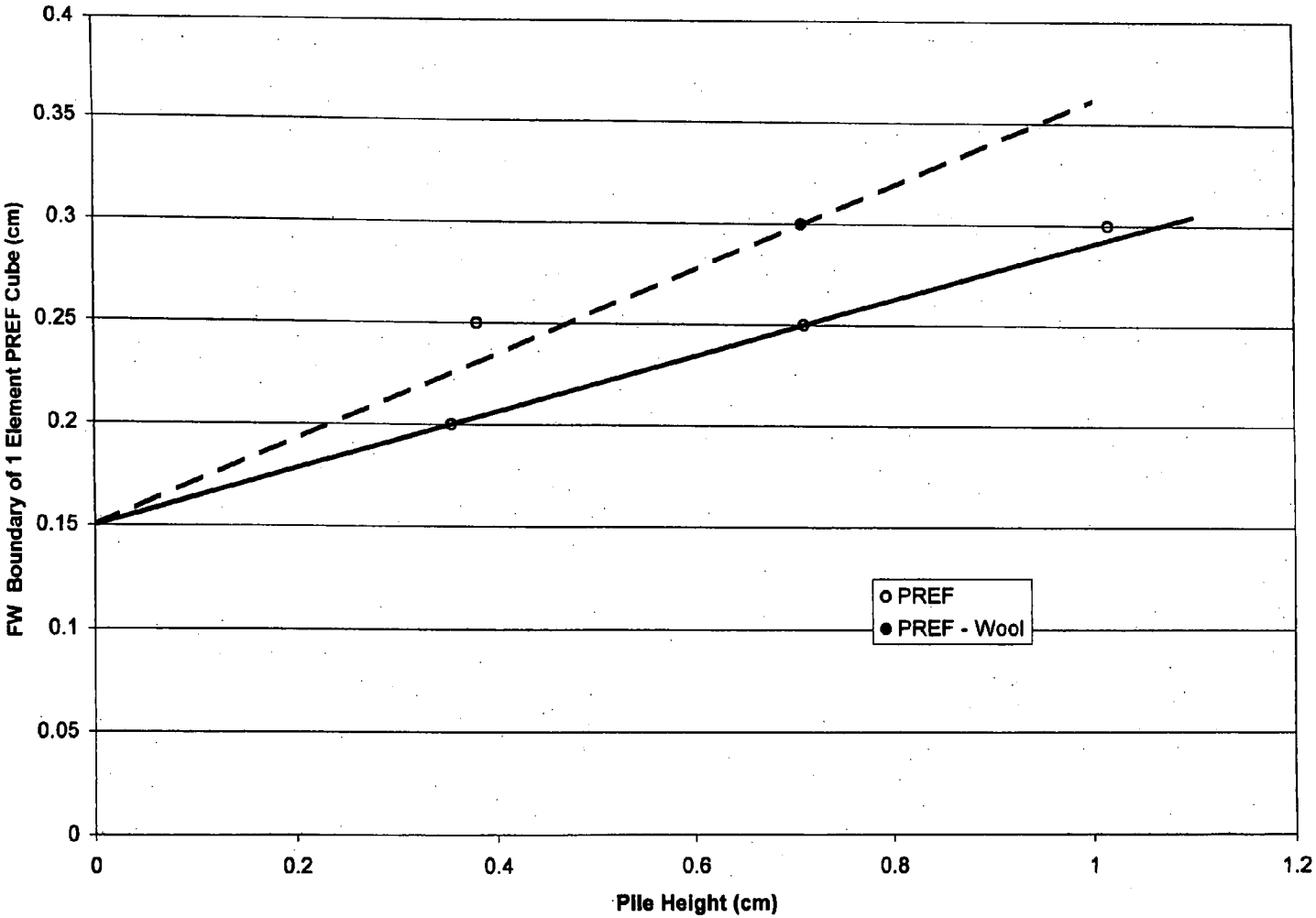
Figure 249:
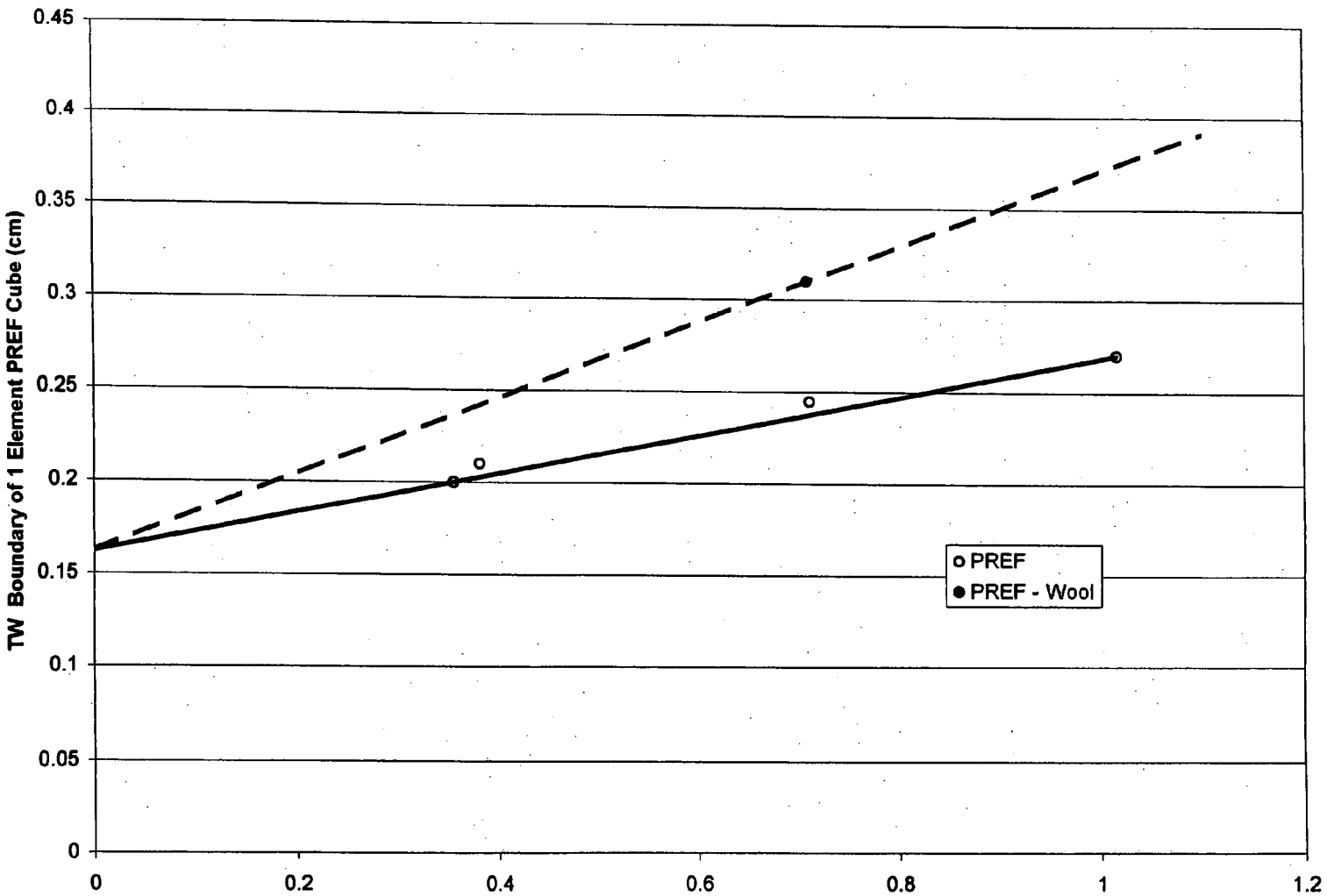

For 1 element data that was not directionally averaged, FIGS. 248-249, the results are $$FW_{boundary,\ 1\ element}(\text{cm})=0.21\cdot(\text{Pile Height (cm)})+0.15$$

$$TW_{boundary,\ 1\ element}(\text{cm})=0.21\cdot(\text{Pile Height (cm)})+0.16\ \text{Fractional Penetration}\geqq 0.4$$

The above equations serve, in combination, to define the upper boundaries of a three-dimensional space for which only the PREF patterning system can print pattern areas on a wool substrate in any direction with a 1 Element Transition Width, a 1 Element Feature Width, and an attendant fractional penetration of at least 0.4. Stated a different way, for a dominant color 1 element pattern area printed (in particular metered-jet printed) in any direction on a wool substrate with a given pile height, the measured said 1 element pattern area 1 Element Feature Width and 1 Element Transition Width, measured in accordance with the teachings herein, will have values less than the values specified from the equations above, calculated at said pile height for the given wool substrate, in conjunction with a fractional penetration of at least 0.5 only for substrates printed with the PREF printing system.

Figure 250:
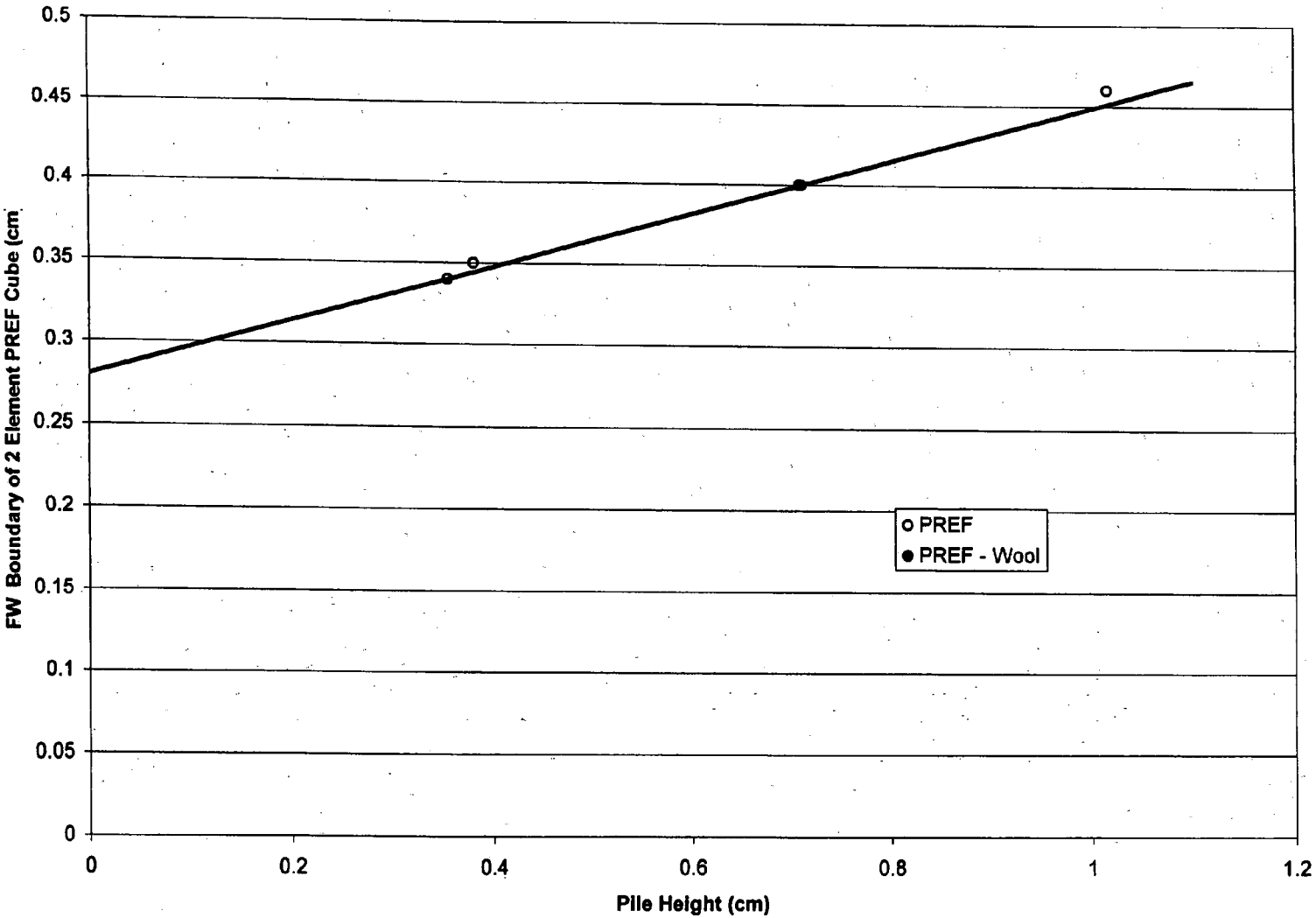
Figure 251:
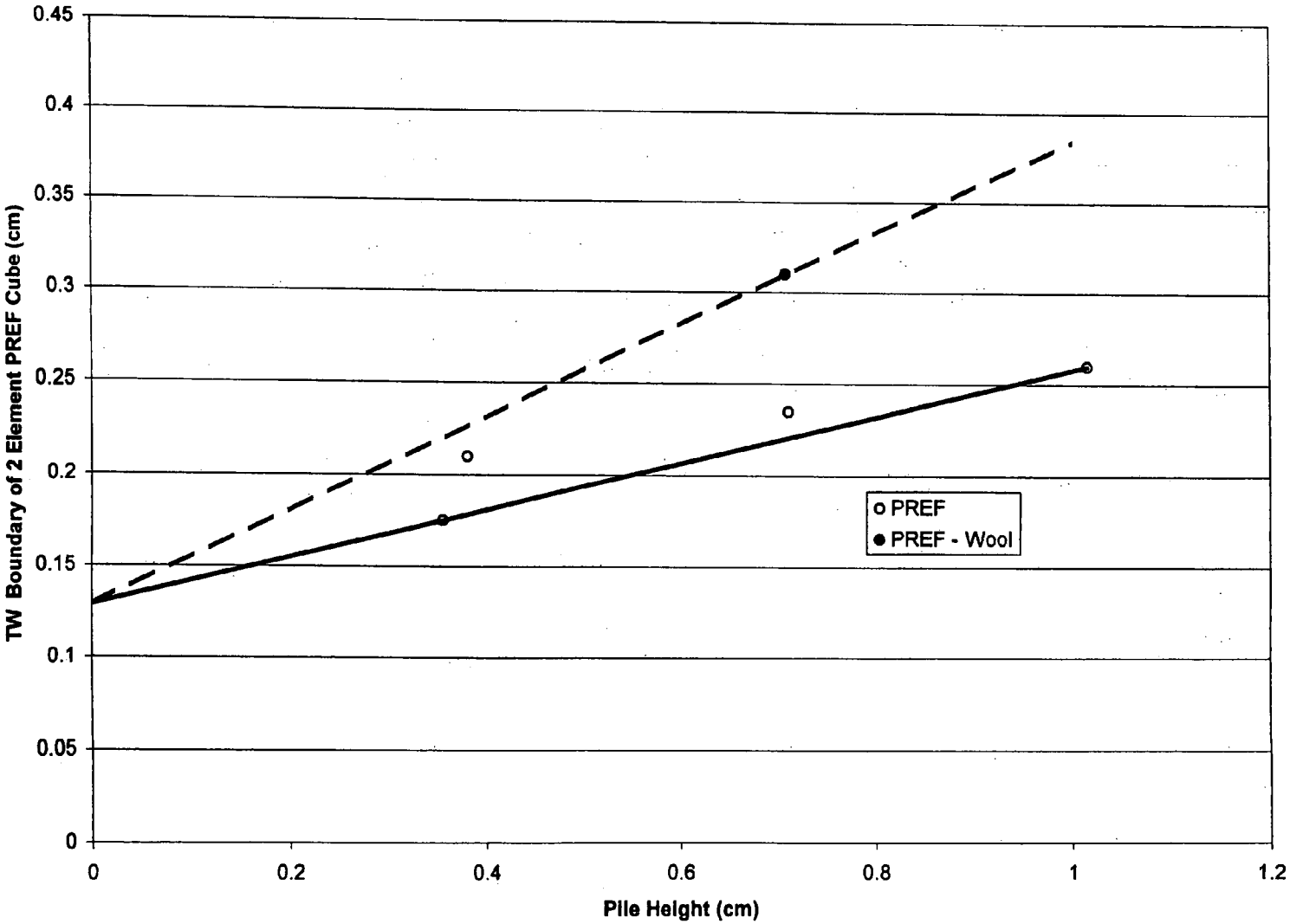

For the 2 element data that was not directionally averaged, FIGS. 250-251, the results are:

$$FW_{boundary,\ 2\ element}(\text{cm})=0.169\cdot(\text{Pile Height(cm)})+0.28$$

$$TW_{boundary,\ 2\ element}(\text{cm})=0.255\cdot(\text{Pile Height(cm)})+0.129\ \text{Fractional Penetration}\geqq 0.4$$

For a specified dominant color 2 element pattern area printed (in particular metered-jet printed) in any direction on a wool substrate with a given pile height, the measured said 2 element pattern area 2 element Feature Width and 2 element Transition Width, measured in accordance with the teachings herein, will have values less than the values specified by the equations above, calculated at said pile height for the given wool substrate, in conjunction with a fractional penetration of at least 0.4, only for substrates printed with the PREF printing system.

For the 1 element data that was directionally averaged, FIGS. 252 and 253, the results are:

$$FW_{boundary,\ 1\ element,\ directionally\ averaged}(\text{cm})=0.315\cdot(\text{Pile Height (cm)})+0.177$$

$$TW_{boundary,\ 1\ element,\ directionally\ averaged}(\text{cm})=0.275\cdot(\text{Pile Height (cm)})+0.135\ \text{Fractional Penetration}\geqq 0.4$$

For a specified dominant color, a 1 element pattern area can be identified that has been printed (in particular metered-jet printed) in any two orthogonal directions on a wool substrate with a given pile height, the measured said two orthogonal 1 element pattern area 1 element Feature Width and 1 element Transition Width, measured in accordance with the teachings herein and subsequently directionally averaged, will have values less than the values specified by the equations above, calculated at said pile height for the given wool substrate, in conjunction with a fractional penetration of at least 0.4 only for wool substrates printed with the PREF printing system.

For the 2 element data that was directionally averaged, FIG. 254-255, the results are $$FW_{boundary,\ 2\ element,\ directionally\ averaged}(\text{cm})=0.169\cdot(\text{Pile Height (cm)})+0.28$$

$$TW_{boundary,\ 2\ element,\ directionally\ averaged}(\text{cm})=0.25\cdot(\text{Pile Height (cm)})+0.113\ \text{Fractional Penetration}\geqq 0.4$$

For a specified dominant color, a 2 element pattern area can be identified that has been printed (in particular metered-jet printed) in any two orthogonal directions on a wool substrate with a given pile height, the measured said two orthogonal 2 element pattern area 2 element Feature Width and 2 element Transition Width, measured in accordance with the teachings herein and subsequently directionally averaged, will have values less than the values specified by the equations above, calculated at said pile height for the given substrate, in conjunction with a tractional penetration of at least 0.4 only for wool substrates printed with the PREF printing system.

In all of the above discussions of PREF-system capabilities, it should be understood that the numerical values selected from the data to characterize the PREF-produced products define a performance space within which these products have unique attributes. Numerical values falling within that performance space define products that are considered included in the scope of the invention herein disclosed. Accordingly, values of Transition Width or Feature Width (or their combination) that individually or collectively fall within 90%, 80%, 70%, or 60% of the values given above, while maintaining or increasing Fractional Penetration, shall also be considered within that performance space, as shown in the data. With respect to the individual values, and notwithstanding the foregoing, the data supports practical minimums for Transition Width of about 0.5 mm, and, separately, a minimum Feature Width. (for dominant color features) equal to the gauge of the patterning equipment used.

The invention claimed is:

1. A valve card for use in a substrate treatment apparatus adapted to controllably discharge a treatment fluid onto a substrate, the valve card comprising in combination:

a plurality of selectively operable valves operable between open and closed positions, wherein at least a portion of the valves are in fluid communication with corresponding dedicated fluid discharge jets, wherein said fluid discharge jets controllably discharge said treatment fluid onto said substrate when said valves are in the open position, said treatment fluid being selected from the group consisting of colorant compositions and chemical compositions;

a power input port adapted to receive a power cable for supply of electrical power to the valve card;

an instruction data input port adapted to receive a valve control cable for transmission of valve operating instructions from a control unit to the valve card; and an integral circuit board adapted to translate instruction data from the data input port into powered valve operating commands such that the valves may be selectively opened and closed, whereby said treatment fluids are discharged onto said substrate when said valves are open, and wherein the valve card is a modular unit which is suitable for independent operation within the substrate treatment apparatus and which is removable as a one piece structure from the substrate treatment apparatus.

2. The valve card of claim 1, wherein the valve card further comprises an identification board adapted to retain and transmit an electronic identification code.

3. The valve card of claim 2, wherein the identification board is adapted to transmit the identification code through the power input port.

4. A substrate treatment apparatus adapted to controllably discharge at least one of a colorant or chemical composition to a substrate, the substrate treatment apparatus comprising:

a plurality of independently operable modular valve cards adapted to discharge treatment fluids onto said substrate, said treatment fluids being selected from the group consisting of said colorant compositions and said chemical compositions, wherein at least a portion of said modular valve cards comprise:

a plurality of selectively operable valves operable between open and closed positions, wherein at least a portion of the valves are in fluid communication with corresponding dedicated fluid discharge jets, whereby said treatment fluids are controllably discharged onto said substrate when said valves are in the open position;

a power input port adapted to receive a power cable for supply of electrical power to the valve card;

an instruction data input port adapted to receive a valve control cable for transmission of valve operating instructions from a control unit to the valve card; and an integral circuit board adapted to translate instruction data from the data input port into powered valve operating commands such that the valves may be selectively opened and closed, whereby said treatment fluids are discharged onto said substrate when said valves are open, and wherein said at least a portion of said modular valve cards are suitable for independent operation within the substrate treatment apparatus and are independently removable as a unitary structures from the substrate treatment apparatus.

5. The substrate treatment apparatus of claim 4, wherein said at least a portion of said modular valve cards further comprise an identification board adapted to retain and transmit an electronic identification code.

6. The substrate treatment apparatus of claim 5, wherein the identification board is adapted to transmit the identification code through the power input port.

7. The substrate treatment apparatus of claim 4, wherein the substrate treatment apparatus further comprises an adjustment mechanism for adjusting the distance between the fluid discharge jets and the substrate.

8. A processing range for application of at least one of a colorant or chemical composition to a textile substrate, said processing range comprising:

a substrate treatment apparatus adapted to controllably discharge said at least one colorant or chemical composition onto the substrate;

a pretreatment station adapted to heat the substrate prior to entering the substrate treatment apparatus; and at least one treatment station disposed downstream of the pretreatment station, wherein the substrate treatment apparatus comprises:

a plurality of independently operable modular valve cards adapted to discharge treatment fluids onto said substrate, said treatment fluids being selected from the group consisting of said colorant compositions and said chemical compositions, wherein at least a portion of said modular valve cards comprise;

a plurality of selectively operable valves operable between open and closed positions, wherein at least a portion of the valves are in fluid communication with corresponding dedicated fluid discharge jets, whereby said treatment fluids are controllably discharged onto said substrate when said valves are in the open position;

a power input port adapted to receive a power cable for supply of electrical power to the valve card;

an instruction data input port adapted to receive a valve control cable for transmission of valve operating instructions from a control unit to the valve card; and an integral circuit board adapted to translate instruction data from the data input port into powered valve operating commands such that the valves may be selectively opened and closed, whereby said treatment fluids are discharged onto said substrate when said valves are open, and wherein said at least a portion of said modular valve cards are suitable for independent operation within the substrate treatment apparatus and are independently removable as unitary structures from the substrate treatment apparatus.

* * * * *